United States Patent [19]

Aoike et al.

[11] Patent Number: 4,981,766

[45] Date of Patent: Jan. 1, 1991

[54] LIGHT RECEIVING MEMBER HAVING A MULTILAYERED LIGHT RECEIVING LAYER COMPOSED OF A LOWER LAYER MADE OF ALUMINUM-CONTAINING INORGANIC MATERIAL AND AN UPPER LAYER MADE OF A NON-SINGLE-CRYSTAL SILICON MATERIAL

[75] Inventors: Tatsuyuki Aoike; Masafumi Sano; Takehito Yoshino; Toshimitsu Kariya; Hiroaki Niino, all of Nagahama, Japan

[73] Assignee: Canon Kabushiki Kaisha, Tokyo, Japan

[21] Appl. No.: 403,396

[22] Filed: Sep. 6, 1989

Related U.S. Application Data

[62] Division of Ser. No. 183,998, Apr. 20, 1988, Pat. No. 4,906,542.

[30] Foreign Application Priority Data

| | | | |
|---|---|---|---|
| Apr. 23, 1987 | [JP] | Japan | 62-101022 |
| Apr. 28, 1987 | [JP] | Japan | 62-107013 |
| May 6, 1987 | [JP] | Japan | 62-111623 |
| May 7, 1987 | [JP] | Japan | 62-112160 |
| Jun. 29, 1987 | [JP] | Japan | 62-161539 |
| Aug. 5, 1987 | [JP] | Japan | 62-196567 |
| Aug. 6, 1987 | [JP] | Japan | 62-197830 |
| Dec. 17, 1987 | [JP] | Japan | 62-317417 |

[51] Int. Cl.[5] ..... G03G 5/14

[52] U.S. Cl. ..... 430/58

[58] Field of Search ..... 430/58

[56] References Cited

U.S. PATENT DOCUMENTS

| | | | |
|---|---|---|---|
| 4,460,669 | 7/1984 | Ogawa et al. | 430/57 |
| 4,501,807 | 2/1985 | Shirai et al. | 430/57 |

FOREIGN PATENT DOCUMENTS

| | | |
|---|---|---|
| 59-28162 | 3/1984 | Japan . |
| 59-86056 | 5/1984 | Japan . |
| 61-48865 | 3/1986 | Japan . |

*Primary Examiner*—J. David Welsh

*Attorney, Agent, or Firm*—Fitzpatrick, Cella, Harper & Scinto

[57] ABSTRACT

A light receiving member for electrophotography made up of an aluminum support and a multilayered light receiving layer exhibiting photoconductivity formed on the aluminum support, wherein the multilayered light receiving layer consists of a lower layer in contact with the support and an upper layer, the lower layer being made of an inorganic material containing at least aluminum atom (Al), silicon atoms (Si) and hydrogen atoms (H), and having portion in which the aluminum atoms (Al), silicon atoms (Si), and hydrogen atoms (H) are unevenly distributed across the layer thickness, the upper layer being made of a non-single-crystal material composed of silicon atoms (Si) as the matrix and at least either of hydrogen atoms (H) or halogen atoms (X) and containing at least one of carbon atoms, nitrogen atoms (N) and oxygen atoms (O) in the layer region in adjacent with the lower layer. The light receiving member for electrophotography can overcome all of the foregoing problems and exhibits extremely excellent electrical property, optical property, photoconductivity, durability, image property and circumstantial property of use.

26 Claims, 16 Drawing Sheets

LIGHT RECEIVING MEMBER HAVING A MULTILAYERED LIGHT RECEIVING LAYER COMPOSED OF A LOWER LAYER MADE OF ALUMINUM-CONTAINING INORGANIC MATERIAL AND AN UPPER LAYER MADE OF A NON-SINGLE-CRYSTAL SILICON MATERIAL

This application is a division of application Ser. No. 183,998 filed Apr. 20, 1988, now U.S. Pat. No. 4,906,542.

FIELD OF THE INVENTION

This invention concerns a light receiving member sensitive to electromagnetic waves such as light (which herein means in a broader sense those lights such as ultraviolet rays, visible rays, infrared rays, X-rays, and γ-rays).

More particularly, it relates to an improved light receiving member having a multilayered light receiving layer composed of a lower layer made of an inorganic material containing at least aluminum atoms, silicon atoms, and hydrogen atoms, and an upper layer made of non-single-crystal silicon material, which is suitable particularly for use in the case where coherent lights such as laser beams are applied.

BACKGROUND OF THE INVENTION

The light receiving member used for image formation has a light receiving layer made of a photoconductive material. This material is required to have characteristic properties such as high sensitivity, high S/N ratio (ratio of light current (Ip) to dark current (Id)), absorption spectral characteristic matching the spectral characteristic of electromagnetic wave for irradiation, rapid optical response, appropriate dark resistance, and non-toxicity to the human body at the time of use. The non-toxicity at the time of use is an important requirement in the case of a light receiving member for electronic photography which is built into an electronic photographic apparatus used as an office machine.

A photoconductive material attracting attention at present from the standpoint mentioned above is amorphous silicon (A-Si for short hereinafter). The application of A-Si to the light receiving member for electrophotography is disclosed in, for example, German Patent Laid-open Nos. 746967 and 2855718.

FIG. 2 is a schematic sectional view showing the layer structure of the conventional light receiving member for electrophotography. There are shown an aluminum support 201 and a photosensitive layer of A-Si 202 This type of light receiving member for electrophotography is usually produced by forming the photosensitive layer 202. of A-Si on the aluminum support 201 heated to 50°-350° C., by deposition, hot CVD process, plasma CVD process, plasma CVD process or sputtering.

Unfortunately, this light receiving member for electrophotography has a disadvantage that the sensitive layer 202 of A-Si is liable to crack or peel off during cooling subsequent to the film forming step, because the coefficient of thermal expansion of aluminum is nearly ten times as high as that of A-Si. To solve this problem, there was proposed a photosensitive body for electrophotography which is composed of an aluminum support, an inter mediate layer containing at least aluminum and a sensitive layer of A-Si (Japanese Patent Laid-open No. 28162/1984). The intermediate layer containing at least aluminum relieves the stress arising from the difference in the coefficient of thermal expansion between the aluminum support and the A-Si sensitive layer, thereby reducing the cracking and peeling of the A-Si sensitive layer.

The conventional light receiving member for electrophotography which has the light receiving layer made of A-Si has been improved in electrical, optical, and photoconductive characteristics (such as dark resistance, photosensitivity, and light responsivity), adaptability of use environment, stability with time, and durability. Nevertheless, it still has room for further improvement in its overall performance.

For the improvement of image characteristics, several improvements has recently been made on the optical exposure unit, development unit, and transfer unit in the electrophotographic apparatus. This, in turn, has required the light receiving member for electrophotography to be improved further in image characteristics. With the improvement of images in resolving power, the users have begun to require further improvements such as the reduction of unevenness (so-called "coarse image") in the region where the image density delicately changes, and the reduction of image defects (so-called "dots") which appear in black or white spots, especially the reduction of very small "dots" which attracted no attention in the past.

Another disadvantage of the conventional light receiving member for electrophotography is its low mechanical strength. When it comes into contact with foreign matters which have entered the electrophotographic apparatus, or when it comes into contact with the main body or tools while the electrophotographic apparatus is being serviced for maintenance, image defects occur or the A-Si film peels off on account to of the mechanical shocks and pressure. These aggravate the durability of the light receiving member for electrophotography.

An additional disadvantage of the conventional light receiving member for electrophotography is that the A-Si film is susceptible to cracking and peeling on account of the stress which occurs because the A-Si film differs from the aluminum support in the coefficient of thermal expansion. This leads to lower yields in production.

Under the circumstances mentioned above, it is necessary to solve the above-mentioned problems and to improve the light receiving member for electrophotography from the standpoint of its structure as well as the characteristic properties of the A-Si material per se.

SUMMARY OF THE INVENTION

It is an object of the present invention to provide a light receiving member for electrophotography which meets the above-mentioned requirements and eliminates the above-mentioned disadvantages involved in the conventional light receiving member.

According to the present invention, the improved light receiving member for electrophotography is made up of an aluminum support and a multilayered light receiving layer exhibiting photoconductivity formed on the aluminum support, wherein the multilayered light receiving layer consists of a lower layer in contact with the support and an upper layer, the lower layer being made of an inorganic material containing at least aluminum atoms (Al), silicon atoms (Si), and hydrogen atoms (H) ("AlSiH" for short hereinafter), and having a portion in which the aluminum atoms (Al), silicon atoms (Si), and hydrogen atoms (H) are unevenly distributed across the layer thickness, the upper layer being made of a non-single-crystal material composed of silicon atoms (Si) as the matrix and at least either of hydrogen atoms (H) or halogen atoms (X) ("Non-Si (H,X): for short hereinafter), and containing at least one of carbon atoms (C), nitrogen atoms (N) and oxygen atoms (0) in the layer region in adjacent with the lower layer.

The light receiving member for electrophotography in the present invention has the multilayered structure as mentioned above. Therefore, it is free from the abovementioned disadvantages, and it exhibits outstanding electric characteristics, optical characteristics, photoconductive characteristics, durability, image characteristics, and adaptability to ambient environments.

As mentioned above, the lower layer is made such that the aluminum atoms and silicon atoms, and especially the hydrogen atoms, are unevenly distributed across the layer thickness. This structure improves the injection of electric charge (photocarrier) across the aluminum support and the upper layer. In addition, this structure joins the constituent elements of the aluminum support to the constituent elements of the upper layer gradually in terms of composition and constitution. This leads to the improvement of image characteristics relating to coarse image and dots. Therefore, the light receiving member permits the stable reproduction of images of high quality with a sharp half tone and a high resolving power.

The above-mentioned multilayered structure prevents the image defects and the peeling of the non-Si(H,X) film which occurs as the result of impactive mechanical pressure applied to the light receiving member for electrophotography. In addition, the multilayered structure relieves the stress arising from the difference between the aluminum support and the non-Si(H,X) film in the coefficient of thermal expansion and also prevents the occurrence of cracks and peeling in the non-Si(H,X) film. All this contributes to improved durability and increased yields in production.

Particularly, since at least one of carbon atoms, nitrogen atoms and oxygen atoms are incorporated into the layer region of the upper layer in adjacent with the lower layer in this invention, the quality of the upper layer is improved to enhance the durability to the high voltage and the close bondability between the upper layer and the lower layer can further be improved, and image defects or the peeling of the Non-Si(H,X) film can be prevented, thereby contributing to the improvement of the durability.

According to the present invention, the lower layer of the light receiving member may further contain atoms to control the image ("atoms (Mc)" for short hereinafter. The incorporation of atoms (Mc) to control the image quality improves the injection of electric charge (photocarrier) across the aluminum support and the upper layer and also improves the transferability of electric charge (photocarrier) in the lower layer. Thus the light receiving member permits the stable reproduction of images of high quality with a sharp half tone and a high resolving power.

According to the present invention, the lower layer of the light receiving member may further contain atoms to control the durability ("atoms (CNOc) for short hereinafter). The incorporation of atoms (CNOc) greatly improves the resistance to impactive mechanical pressure applied to the light receiving member for electrophotography. In addition, it prevents the image defects and the peeling of the non-Si(H,X) film, relieves the stress arising from the difference between the aluminum support and the non-Si(H,X) film in the coefficient of thermal expansion, and prevents the occurrence of cracks and peeling in the non-Si(H,X) film. All this contributes to improved durability and increased yields in production.

According to the present invention, the lower layer of the light receiving member may further contain halogen atom (X). The incorporation of halogen atom (X) compensates for the dangling bonds of silicon atom (Si) and aluminum atom (Al), thereby creating a stable state in terms of constitution and structure. This, coupled with the effect produced by the distribution of silicon atoms (Si), aluminum atoms (Al), and hydrogen atoms (H) mentioned above, greatly improves the image characteristics relating to coarse image and dots.

According to the present invention, the lower layer of the light receiving member may further contain at least either of germanium atoms (Ge) or tin atoms (Sn). The incorporation of at least either of germanium atoms (Ge) or tin atoms (Sn) improves the injection of electric charge (photocarrier) across the aluminum support and the upper layer, the adhesion of the lower layer to the aluminum support, and the transferability of electric charge (photocarrier) in the lower layer. This leads to a distinct improvement in image characteristics and durability.

According to the present invention, the lower layer of the light receiving member may further contain at least one kind of atoms selected from alkali metal atoms, alkaline earth metal atoms, and transition metal atoms, ("atoms (Me)" for short hereinafter). The incorporation of at least one kind of atoms selected from alkali metal atoms, alkaline earth metal atoms, and transition metal atoms permits more dispersion of the hydrogen atoms or halogen atoms contained in the lower layer (the reason for this is not yet fully elucidated) and also reduces the structure relaxation of the lower layer which occurs with lapse of time. This leads to reduced liability of cracking and peeling even after use for a long period of time. The incorporation of at least one kind of the above-mentioned metal atoms improves the injection of electric charge (photocarrier) across the aluminum support and the upper layer, the adhesion of the lower layer to the aluminum support, and the transferability of electric charge (photocarrier) in the lower layer. This leads to a distinct improvement in image characteristics and durability, which in turn leads to the stable production and quality.

In the meantime, the above-mentioned Japanese Patent Laid-open No. 28162/1984 mentions the layer containing aluminum atoms and silicon atoms unevenly across the layer thickness and also mentions the layer containing hydrogen atoms. However, it does not mention how the layer contains hydrogen atoms. Therefore, it is distinctly different from the present invention.

BRIEF DESCRIPTION OF THE INVENTION

FIGS. 3 to 8 are diagrams illustrating the distribution state of aluminum atoms (Al) contained in the lower layer, and also illustrating the distribution of atoms (Mc) to control image quality, and/or atoms (CNOc) to control durability, and/or halogen atoms (X), and/or germanium atoms (Ge), and/or tin atoms (Sn), and/or at least one kind of atoms selected from alkali metal atoms, alkaline earth metal atoms, and transition metal atoms, which are optionally contained in the lower layer.

FIGS. 9 to 16 are diagrams illustrating the distribution of silicon atoms (Si) and hydrogen atoms (H) contained in the lower layer, and also illustrating the distribution of atoms (Mc) to control image quality, and/or atoms (CNOc) to control durability, and/or halogen atoms (X), and/or germanium atoms (Ge), and/or tin atoms (Sn), and/or at least one kind of atoms selected from alkali metal atoms, alkaline earth metal atoms, and transition metal atoms, which are optionally contained in the lower layer.

FIGS. 17 to 36 are diagrams illustrating the distribution of atoms (M) to control conductivity, carbon atoms (C), and/or nitrogen atoms (N), and/or oxygen atoms (O), and/or germanium atoms (Ge), and/or tin atoms (Sn), and/or alkali metal atoms, and/or alkaline earth metal atoms, and/or transition metal atoms, which are contained in the upper layer.

Figure 37:
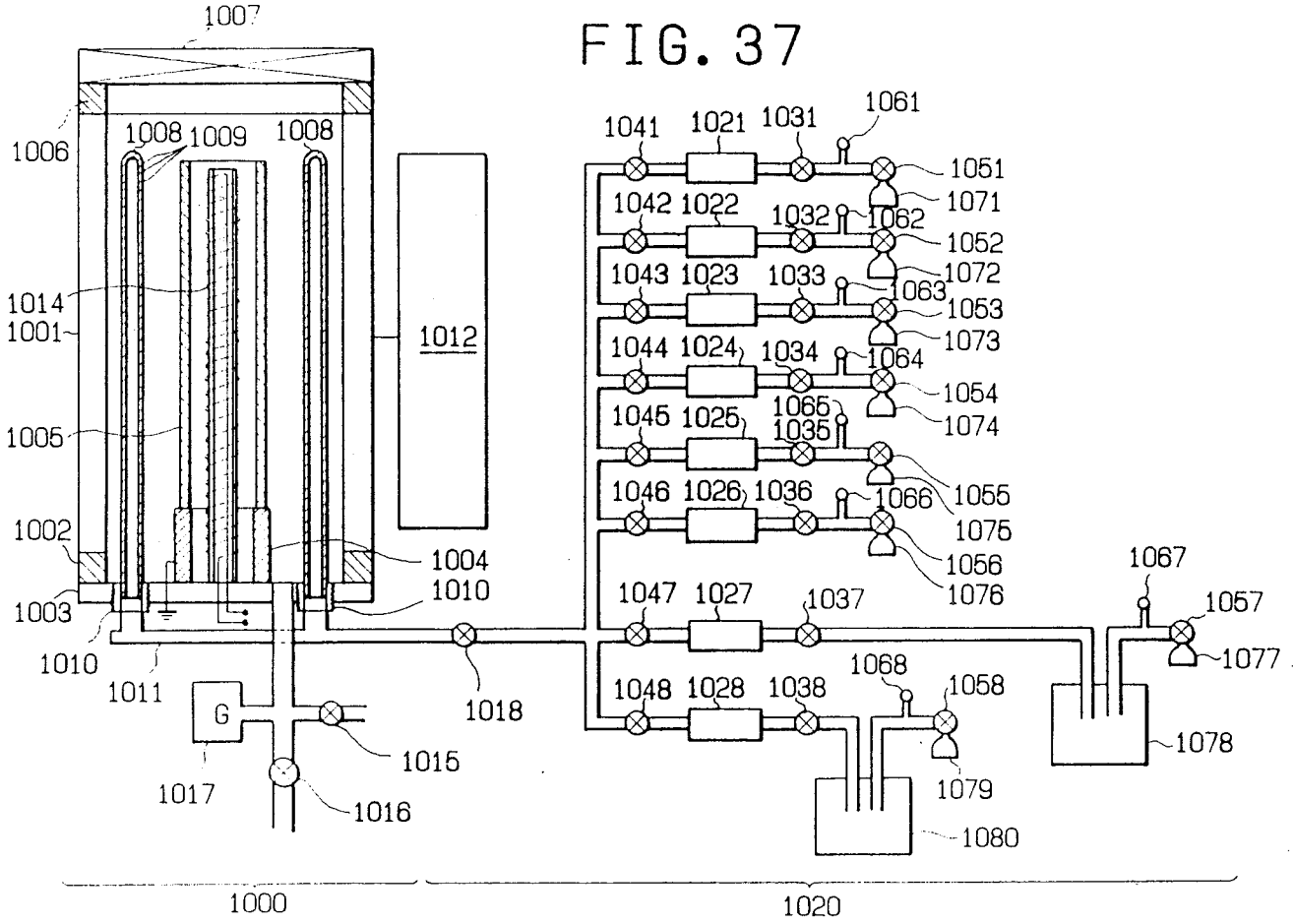

FIG. 37 is a schematic diagram illustrating an apparatus to form the light receiving layer of the light receiving member for electrophotography by RF glow discharge method according to the present invention.

Figure 38:
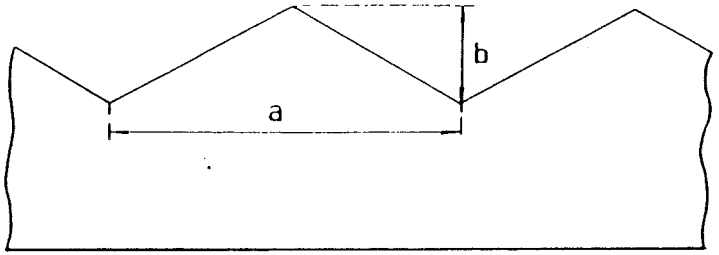

FIG. 38 is an enlarged sectional view of the aluminum support having a V-shape rugged surface which is used to form the light receiving member for electrophotography according to the present invention.

Figure 39:
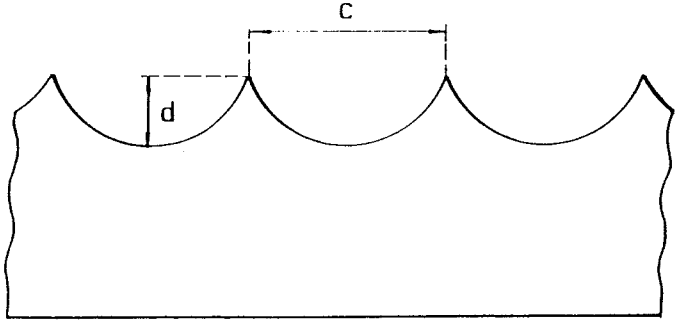

FIG. 39 is an enlarged sectional view of the aluminum support having a dimpled surface on which is used to form the light receiving member for electrophotography according to the present invention.

Figure 40:
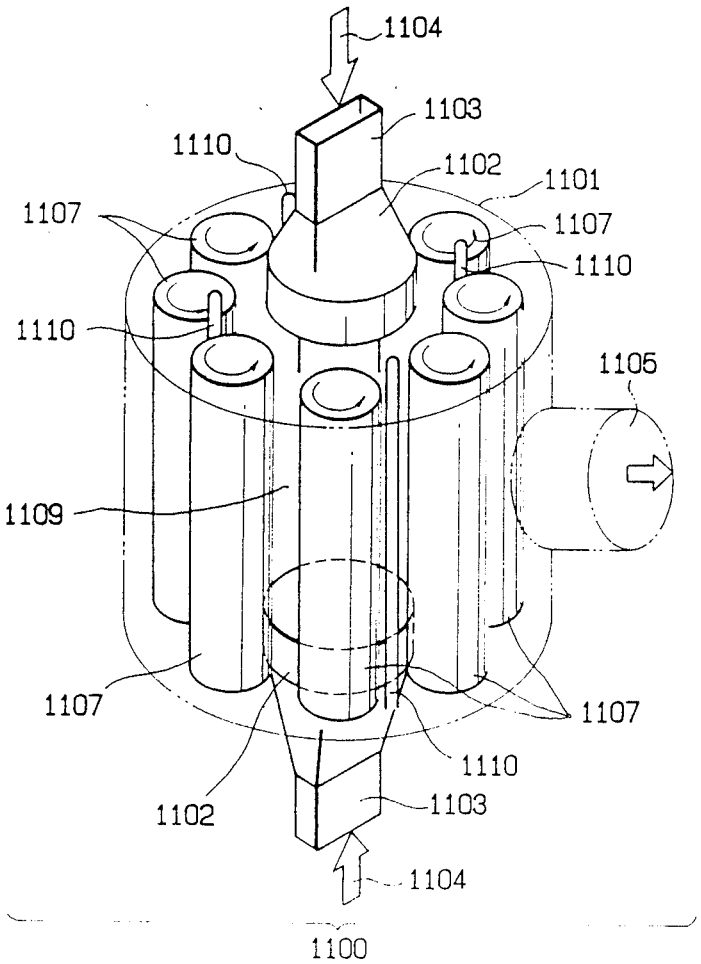

FIG. 40 is a schematic diagram of the depositing apparatus to form the light receiving layer of the light receiving member for electrophotography by microwave glow discharge method according to the present invention.

Figure 41:
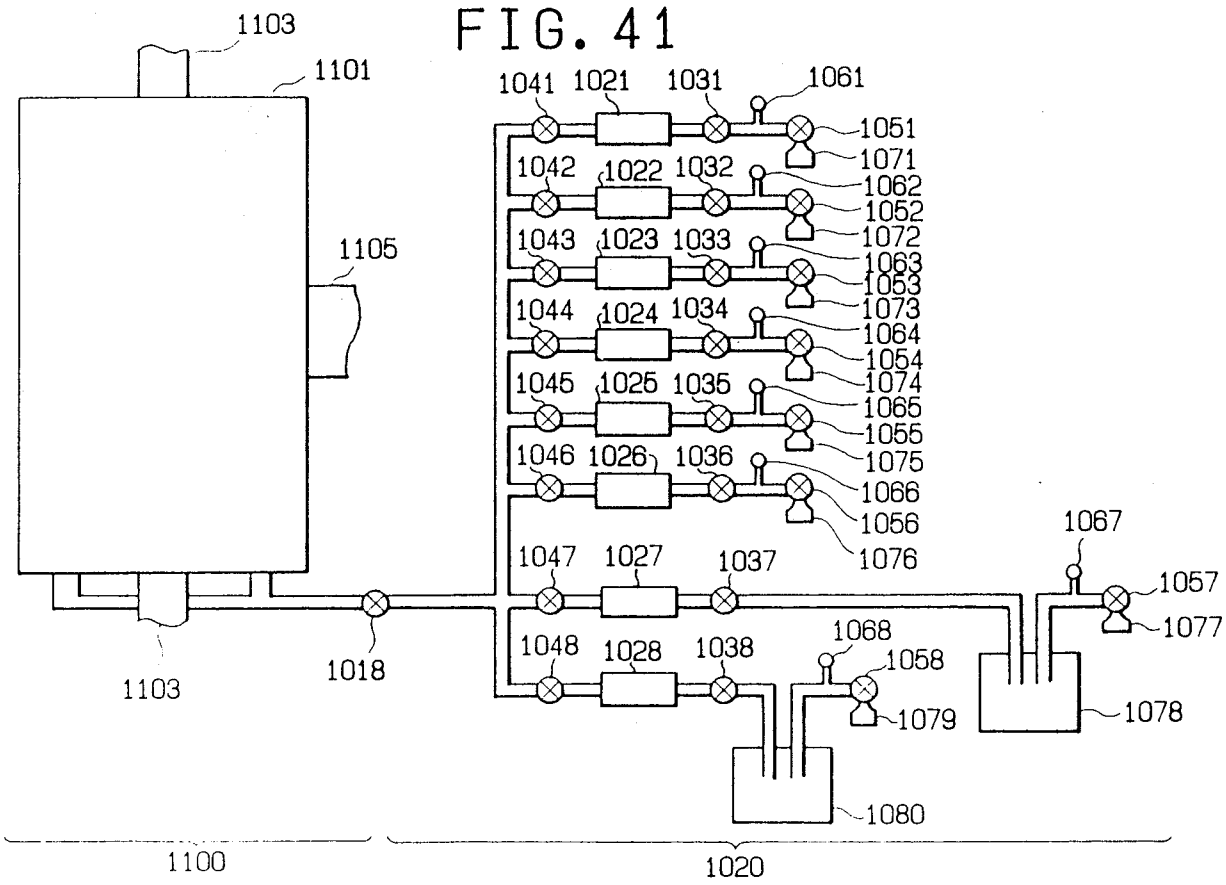

FIG. 41 is a schematic diagram of the apparatus to form the light receiving layer of the light receiving member for electrophotography by microwave glow discharge method according to the present invention.

Figure 42:
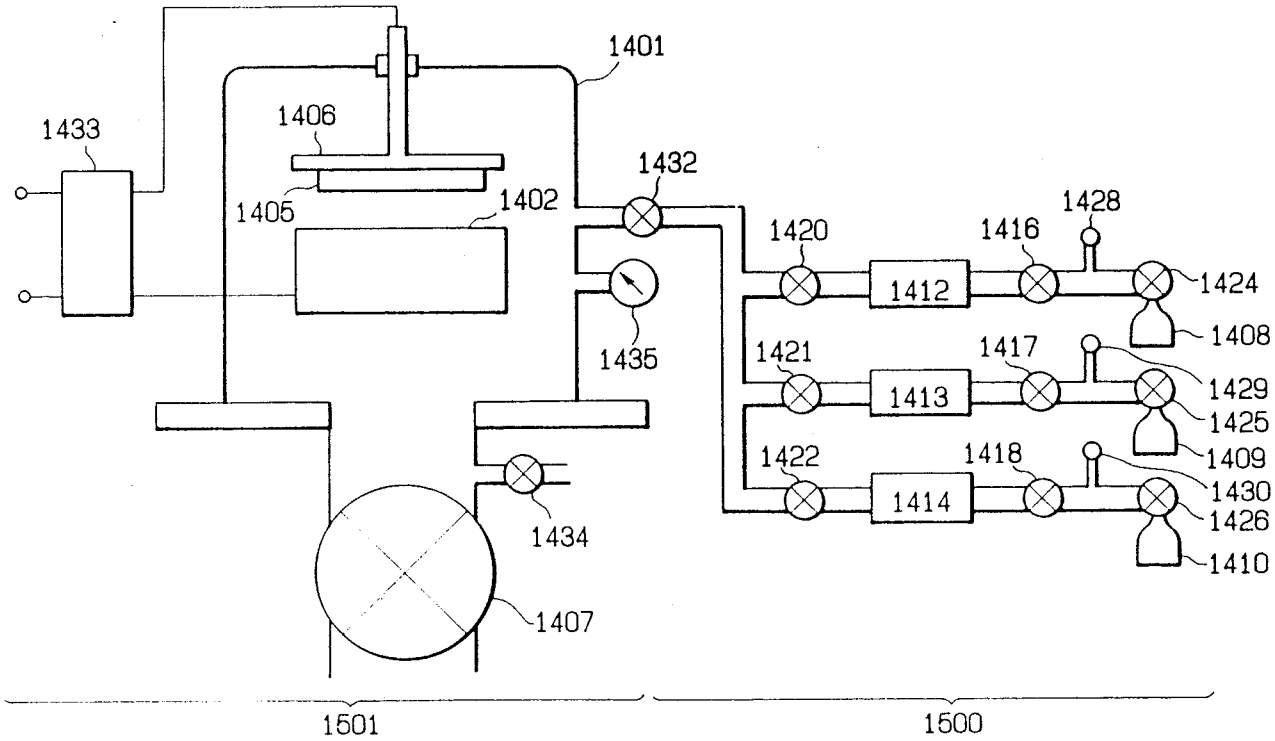
Figure 43A:
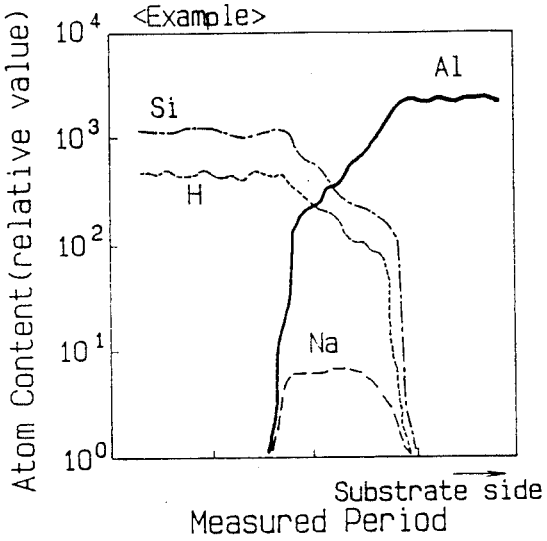
Figure 43B:
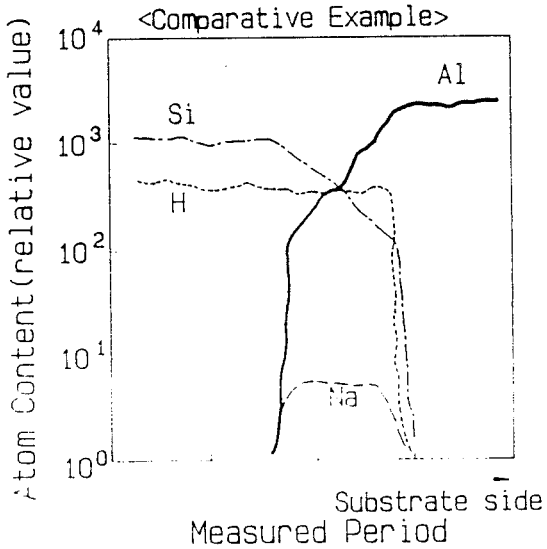
Figure 43C:
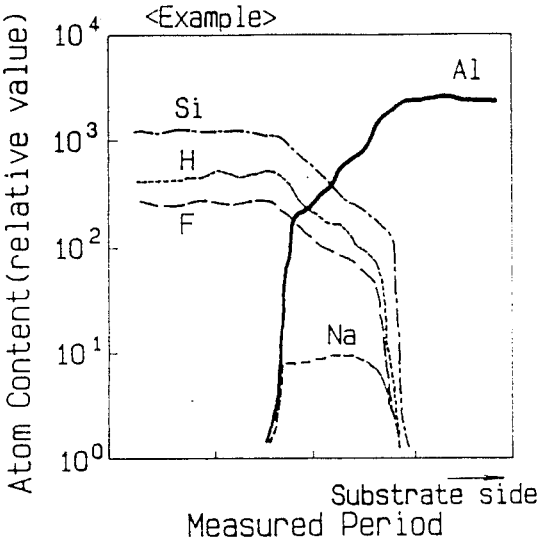
Figure 43D:
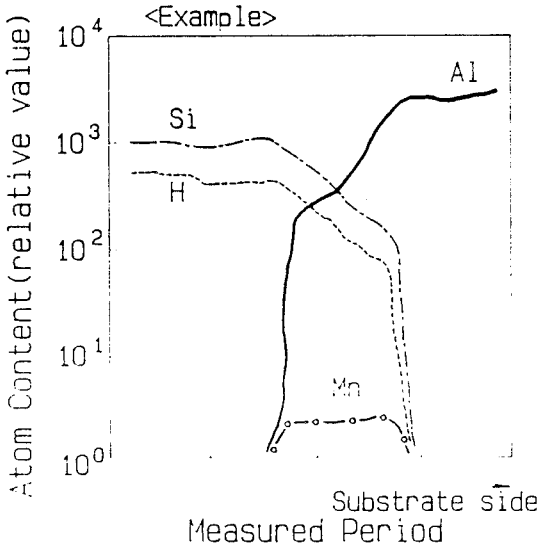

FIG. 42 is a schematic diagram of the apparatus to form the light receiving layer of the light receiving member for electrophotography by RF sputtering method according to the present invention.

FIGS. 43 (*a*) to 43(*d*) show the distribution of the content of the atoms across the layer thickness in Example 349, Comparative Example 8, Example 356, and Example 357, respectively, of the present invention.

DETAILED DESCRIPTION OF THE INVENTION

The light receiving member for electrophotography pertaining to the present invention will be described in more detail with reference to the drawings.

Figure 2:
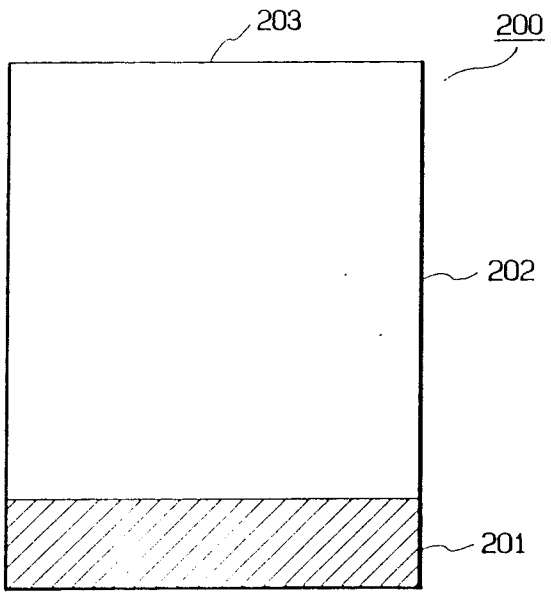
FIG. 2 is a schematic diagram illustrating the layer structure of the conventional light receiving member for electrophotography.
Figure 1:
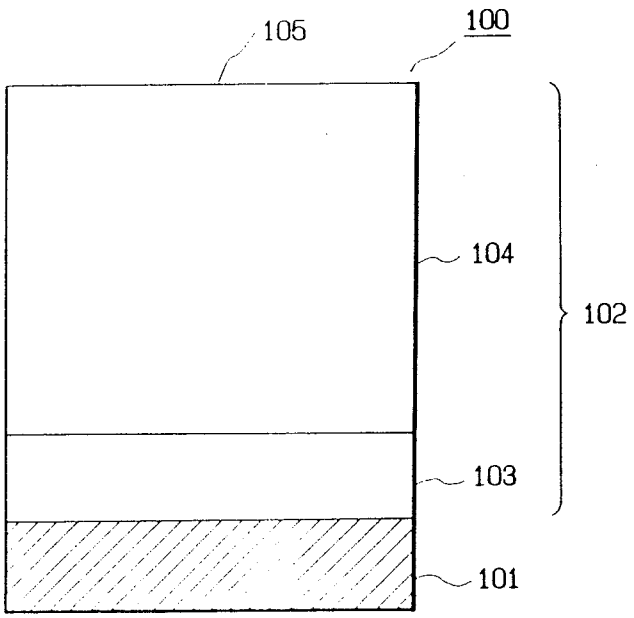
FIG. 1 is a schematic diagram illustrating the layer structure of the light receiving member for electrophotography.

FIG. 1 is a schematic diagram showing a typical example of the layer structure suitable for the light receiving member for electrophotography pertaining to the present invention.

The light receiving member 100 for electrophotography as shown in FIG. 1 comprises an aluminum support 101 for use in the light receiving member for electrophotography and, disposed thereon, a light receiving layer 102 having a layered structure comprising a lower layer 103 constituted with AlSiH and having a part in which the above-mentioned aluminum atoms and silicon atoms are unevenly distributed across the layer thickness and the upper layer 104 constituted with Non-Si(H,X) and containing at least one of carbon atoms, nitrogen atoms and oxygen atoms in the layer region in adjacent with the lower layer. The upper layer 104 has a free surface 105.

Support

The aluminum support 101 used in the present invention is made of an aluminum alloy. The aluminum alloy is no specifically limited in base aluminum and alloy components. The kind and composition of the components may be selected as desired. Therefore, the aluminum alloy used in the present invention may be selected from pure aluminum, Al-Cu alloy, Al-Mn alloy, Al-Mg alloy, Al-Mg-Si alloy, Al-Zn-Mg alloy, Al-Cu-Mg alloy (duralumin and super duralumin), Al-Cu-Si alloy (lautal), Al-Cu-Ni-Mg alloy (Y-alloy and RR alloy), and aluminum powder sintered body (SAP) which are standardized or registered as a malleable material, castable material, or die casting material in the Japanese Industrial Standards (JIS), AA Standards, BS Standards, DIN Standards, and International Alloy Registration.

The composition of the aluminum alloy used in the invention is exemplified in the following. The scope of the invention is not restricted to the examples.

Pure aluminum conforming to JIS-1100 which is composed of less than 1.0 wt % of Si and Fe, 0.05–0.20 wt % of Cu, less than 0.05 wt % of Mn, less than 0.10 wt % of Zn, and more than 99.00 wt % of Al.

Al-Cu-Mg alloy conforming to JIS-2017 which is composed of 0.05–0.20 wt % of Si, less than 0.7 wt % of Fe, 3.5–4.5 wt % of Cu, 0.40–1.0 wt % of Mn, 0.40–0.8 wt % of Mg, less than 0.25 wt % of Zn, and less than 0.10 wt % of Cr, with the remainder being Al.

Al-Mn alloy conforming to JIS-3003 which is composed of less than 0.6 wt % of Si, less than 0.7 wt % of Fe, 0.05–0.20 wt % of Cu, 1.0–1.5 wt % of Mn, and less than 0.10 wt % of Zn, with the remainder being Al.

Al-Si alloy conforming to JIS-4032 which is composed of 11.0–13.5 wt % of Si, less than 1.0 wt % of Fe, 0.50–1.3 wt % of Cu, 0.8–1.3 wt % of Mg, less than 0.25 wt % of Zn, less than 0.10 wt % of Cr, and 0.5–1.3 wt % of Ni, with the remainder being Al.

Al-Mg alloy conforming to JIS-5086 which is composed of less than 0.40 wt % of Si, less than 0.50 wt % of Fe, less than 0.10 wt % of Cu, 0.20–0.7 wt % of Mn, 3.5–4.5 wt % of Mg, less than 0.25 wt % of Zn, 0.05–0.25 wt % of Cr, and less than 0.15 wt % of Ti, with the remainder being Al.

An alloy composed of less than 0.50 wt % of Si, less than 0.25 wt % of Fe, 0.04–0.20 wt % of Cu, 0.01–1.0 wt % of Mn, 0.5–10 wt % of Mg, 0.03–0.25 wt % of Zn, 0.05–0.50 wt % of Cr, 0.05–0.20 wt % of Ti or Tr, and less than 1.0 cc of $H_2$ per 100 g of Al, with the remainder being Al.

Al alloy composed of less than 0.12 wt % of Si, less than 0.15% of Fe, less than 0.30 wt % of Mn, 0.5–5.5 wt % of Mg, 0.01–1.0 wt % of Zn, less than 0.20 wt % of Cr, and 0.01–0.25 wt % of Zr, with the remainder being Al.

Al-Mg-Si alloy conforming to JIS-6063 which is composed of 0.20–0.6 wt % of Si, less than 0.35 wt % of Fe, less than 0.10 wt % of Cu, less than 0.10 wt % of Mn, 0.45–0.9 wt % of MgO, less than 0.10 wt % of Zn, less than 0.10 wt % of Cr, and less than 0.10 wt % of Ti, with the remainder being Al.

Al-Zn-Mg alloy conforming to JIS-7N01 which is composed of less than 0.30 wt % of Si, less than 0.35 wt % of Fe, less than 0.20 wt % of Cu, 0.20–0.7 wt % of Mn, 1.0–2.0 wt % of Mg, 4.0–5.0 wt % of Zn, less than 0.30 wt % of Cr, less than 0.20 wt % of Ti, less than 0.25 wt % of Zr, and less than 0.10 wt % of V, with the remainder being Al.

In this invention, an aluminum alloy of proper composition should be selected in consideration of mechanical strength, corrosion resistance, workability, heat resistance, and dimensional accuracy which are required according to specific uses. For example, where precision working with mirror finish is required, an aluminum alloy containing magnesium and/or copper together is desirable because of its free-cutting performance.

According to the present invention, the aluminum support 101 can be in the form of cylinder or flat endless belt with a smooth or irregular surface. The thickness of the support should be properly determined so that the light receiving member for electrophotography can be formed as desired. In the case where the light receiving member for electrophotography is required to be flexible, it can be made as thin as possible within limits not harmful to the performance of the support. Usually the thickness should be greater than 10 um for the convenience of production and handling and for the reason of mechanical strength.

In the case where the image recording is accomplished by the aid of coherent light such as laser light, the aluminum support may be provided with an irregular surface to eliminate defective images caused by interference fringes.

The irregular surface on the support may be produced by any known method disclosed in Japanese Patent Laid-open Nos. 168156/1985, 178457/1985, and 225854/1985.

The support may also be provided with an irregular surface composed of a plurality of spherical dents in order to eliminate defective images caused by interference fringes which occur when coherent light such as laser light is used.

In this case, the surface of the support has irregularities smaller than the resolving power required for the light receiving member for electrophotography, and the irregularities are composed of a plurality of dents.

The irregularities composed of a plurality of spherical dents can be formed on the surface of the support according to the known method disclosed in Japanese Patent Laid-Open No. 231561/1986.

Lower layer

According to the present invention, the lower layer is made of an inorganic material which is composed of at least aluminum atoms (Al), silicon atoms (Si), and hydrogen atoms (H). It may further contain atoms (Mc) to control image quality, atoms (CNOc) to control durability, halogen atoms (X), germanium atoms (Ge), and/or tin atoms (Sn), and at least one kind of atoms (Me) selected from the group consisting of alkali metal atoms, and/or alkaline earth metal atoms, and transition metal atoms.

The lower layer contains aluminum atoms (Al), silicon atoms, (Si), and hydrogen atoms (H) which are distributed evenly throughout the layer; but it has a part in which their distribution is uneven across the layer thickness. Their distribution should be uniform in a plane parallel to the surface of the support so that uniform characteristics are ensured in the same plane.

According to a preferred embodiment, the lower layer contains aluminum atoms (Al), silicon atoms (Si), and hydrogen atoms (H) which are distributed evenly and continuously throughout the layer, with the aluminum atoms (Al) being distributed such that their concentration gradually decreases across the layer thickness toward the upper layer from the support, with the silicon atoms (Si) and hydrogen atoms (H) being distributed such that their concentration gradually increases across the layer thickness toward the upper layer from the support. This distribution of atoms makes the aluminum support and the lower layer compatible with each other and also makes the lower layer and the upper layer compatible with each other.

In the light receiving member for electrophotography according to the present invention, it is desirable that the lower layer contains aluminum atoms (Al), silicon atoms (Si), and hydrogen atoms (H) which are specifically distributed across the layer thickness as mentioned above but are evenly distributed in the plane parallel to the surface of the support.

The lower layer may further contain atoms (Mc) to control image quality, atoms (CNOc) to control durability, halogen atoms (X), germanium atoms (Ge), and/or tin atoms (Sn), and at least one kind of atoms (Me) selected from the group consisting of alkali metal atoms, alkaline earth metal atoms, and transition metal atoms, which are evenly distributed throughout the entire layer or unevenly distributed across the layer thickness in a specific part. In either case, their distribution should be uniform in a plane parallel to the surface of the support so that uniform characteristics are ensured in the same plane.

FIGS. 3 to 8 show the typical examples of the distribution of aluminum atoms (Al) and optionally added atoms in the lower layer of the light receiving member for electrophotography in the present invention. (The aluminum atoms (Al) and the optionally added atoms are collectively referred to as "atoms (AM)" hereinafter.)

In FIGS. 3 to 8, the abscissa represents the concentration (C) of atoms (AM) and the ordinate represents the thickness of the lower layer. (The aluminum atoms (Al) and the optionally added atoms may be the same or different in their distribution across the layer thickness.)

The ordinate represents the thickness of the lower layer, with $t_B$ representing the position of the end (adjacent to the support) of the lower layer, with $t_T$ representing the position of the end (adjacent to the upper layer) of the lower layer. In other words, the lower layer containing atoms (AM) is formed from the $t_B$ side toward the $t_T$ side.

Figure 3:
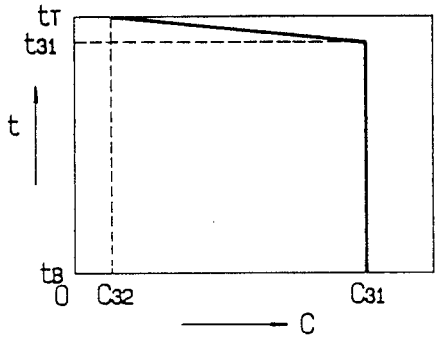

FIG. 3 shows a first typical example of the distribution of atoms (AM) across layer thickness in the lower layer. The distribution shown in FIG. 3 is such that the concentration (C) of atoms (AM) remains constant at $C_{31}$ between position $t_B$ and position $t_{31}$ and linearly decreases from $C_{31}$ to $C_{32}$ between position $t_{31}$ and position $t_T$.

Figure 4:
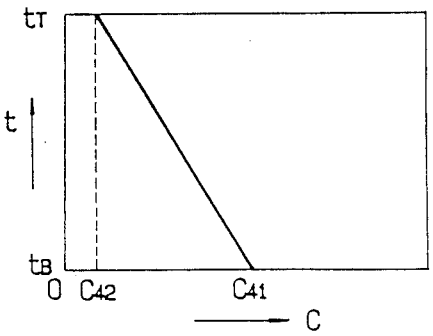

The distribution shown in FIG. 4 is such that the concentration (C) of atoms (AM) linearly decreases from $C_{41}$ to $C_{42}$ between position $t_B$ and position $t_T$.

Figure 5:
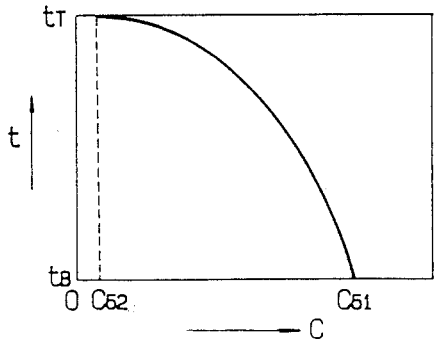

The distribution shown in FIG. 5 is such that the concentration (C) of atoms (AM) gradually and continuously decreases from $C_{51}$ to $C_{52}$ between position $t_B$ and position $t_T$.

Figure 6:
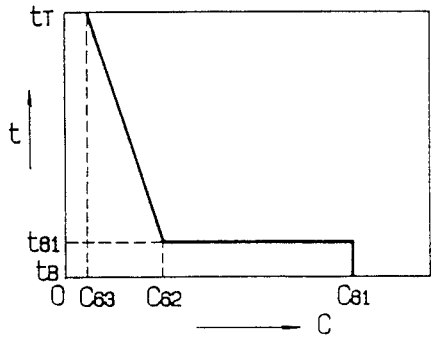
Figure 7:
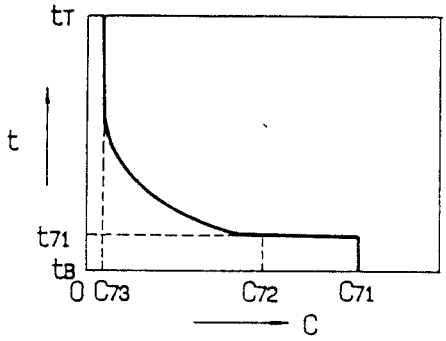

The distribution shown in FIG. 6 is such that the concentration (C) of atoms (AM) remains constant at $C_{61}$ between position $t_B$ and position $t_{61}$ and linearly decreases from $C_{62}$ to $C_{63}$ between $t_{61}$ and position $t_T$ The distribution shown in FIG. 7 is such that the concentration (C) of atoms (AM) remains constant at $C_{71}$ between position $t_B$ and position $t_{71}$ and decreases gradually and continuously from $C_{72}$ to $C_{73}$ between position $t_{71}$ and position $t_T$.

Figure 8:
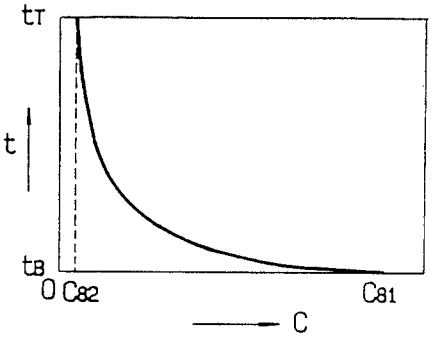

The distribution shown in FIG. 8 is such that the concentration (C) of atoms (AM) decreases gradually and continuously from $C_{81}$ to $C_{82}$ between position $t_B$ and position $t_T$.

The atoms (AM) in the lower layer are distributed across the layer thickness as shown in FIGS. 3 to 8 with reference to several typical examples. In a preferred embodiment, the lower layer contains silicon atoms (Si) and hydrogen atoms (H) and atoms (AM) in a high concentration of C in the part adjacent to the support, and also contains atoms (AM) in a much lower concentration at the interface $t_T$. In such a case, the distribution across the layer thickness should be made such that the maximum concentration Cmax of atoms (Al) is 10 atom % or above, preferably 30 atom % or above, and most desirably 50 atom % or above.

According to the present invention, the amount of atoms (Al) in the lower layer should be properly established so that the object of the invention is effectively achieved. It is 5–95 atom %, preferably 10–90 atom %, and most desirably 20–80 atom %.

FIGS. 9 to 16 shows the typical examples of the distribution of silicon atoms (Si), hydrogen atoms (H), and the above-mentioned optional atoms contained across the layer thickness in the lower layer of the light receiving member for electrophotography in the present invention.

In FIGS. 9 to 16, the abscissa represents the concentration (C) of silicon atoms (Si), hydrogen atoms (H), and optionally contained atoms and the ordinate represents the thickness of the lower layer will be collectively referred to as "atoms (SHM)" hereinafter.) The silicon atoms (Si), hydrogen atoms (H), and optionally contained atoms may be the same or different in their distribution across the layer thickness. $t_B$ on the ordinate represents the end of the lower layer adjacent to the support and $t_T$ on the ordinate represents the end of the lower layer adjacent to the upper layer. In other words, the lower layer containing atoms (SHM) is formed from the $t_B$ side toward the $t_T$ side.

Figure 9:
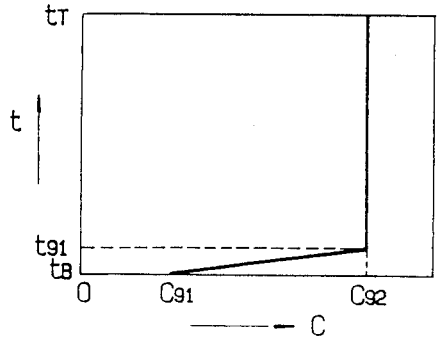

FIG. 9 shows a first typical example of the distribution of atoms (SHM) across the layer thickness in the lower layer. The distribution shown in FIG. 9 is such that the concentration (C) of atoms (SHM) linearly increases from $C_{91}$ to $C_{92}$ between position $t_B$ and position $t_{91}$ and remains constant at $C_{92}$ between position $t_{91}$ and position $t_T$.

Figure 10:
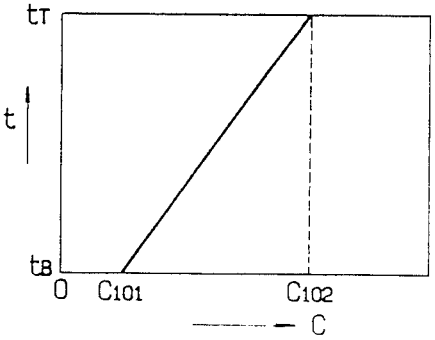

The distribution shown in FIG. 10 is such that the concentration (C) of atoms (SHM) linearly increases from $C_{101}$ to $C_{102}$ between position $t_B$ and position $t_T$.

Figure 11:
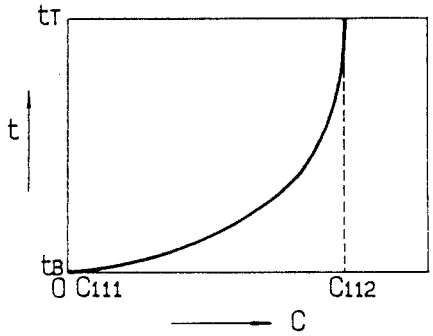

The distribution shown in FIG. 11 is such that the concentration (C) of atoms (SHM) gradually and continuously increase from $C_{111}$ to $C_{112}$ between position $t_B$ and position $t_T$.

Figure 12:
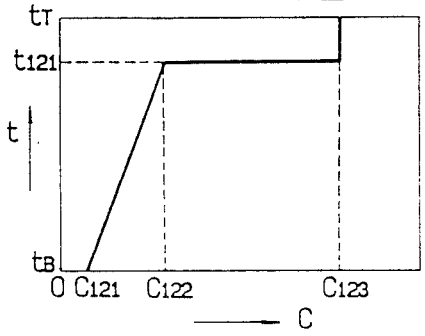

The distribution shown in FIG. 12 is such that the concentration (C) of atoms (SHM) linearly increases from $C_{121}$ to $C_{122}$ between position $t_B$ and position $t_{121}$ and remains constant at $C_{123}$ between position $t_{121}$ and position $t_T$.

Figure 13:
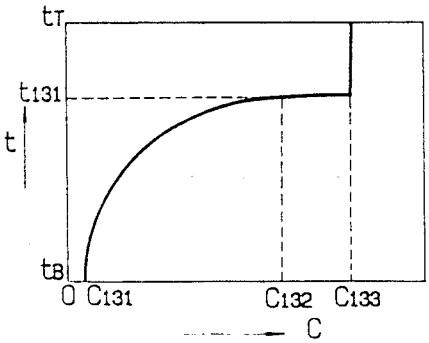

The distribution shown in FIG. 13 is such that the concentration (C) of atoms (SHM) gradually and continuously increases from $C_{131}$ to $C_{132}$ between position $t_B$ and position $t_{131}$ and remains constant at C between position $t_{131}$ and position $t_T$.

Figure 14:
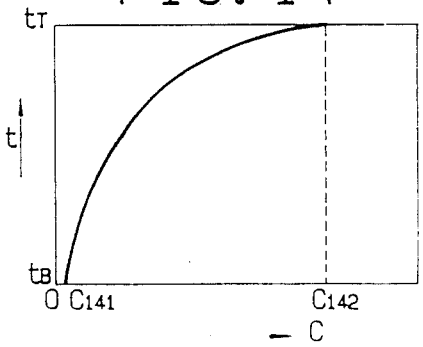

The distribution shown in FIG. 14 is such that the concentration (C) of atoms (SHM) gradually and continuously increases from $C_{141}$ to $C_{142}$ between position $t_B$ and position $t_T$.

Figure 15:
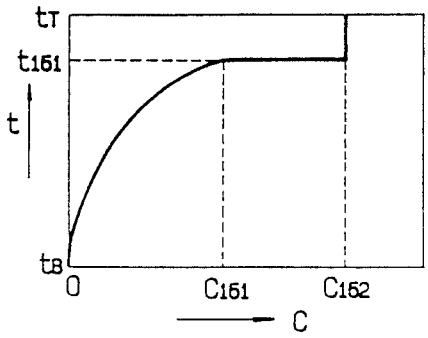

The distribution shown in FIG. 15 is such that the concentration (C) of atoms (SHM) gradually increases from substantially zero to $C_{151}$ position $t_B$ and position $t_{151}$ and remains constant at $C_{152}$ between position $t_{151}$ and position $t_T$. ("Substantially zero" means that the amount is lower than the detection limit. The same shall apply hereinafter.)

Figure 16:
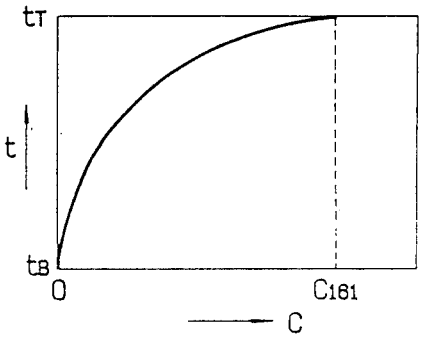

The distribution shown in FIG. 16 is such that the concentration (C) of atoms (SHM) gradually increases from substantially zero to $C_{161}$ between position $t_B$ and position $t_T$.

The silicon atoms (Si) and hydrogen atoms (H) in the lower layer are distributed across the layer thickness as shown in FIGS. 9 to 16 with reference to several typical examples. In a preferred embodiment, the lower layer contains aluminum atoms (Al) and silicon atoms (Si) and hydrogen atoms (H) in a low concentration of C in the part adjacent to the support, and also contains silicon atoms (Si) and hydrogen atoms (H) in a much higher concentration at the interface $t_T$. In such a case, the distribution across the layer thickness should be made such that the maximum concentration $C_{max}$ of the total of silicon atoms (Si) and hydrogen atoms (H) is 10 atom % or above, preferably 30 atom % or above, and most desirably 50 atom % or above.

According to the present invention, the amount of silicon atoms (Si) in the lower layer should be properly established so that the object of the invention is effectively achieved. It is 5–95 atom %, preferably 10–90 atom %, and most desirably 20–80 atom %.

According to the present invention, the amount of hydrogen atoms (H) in the lower layer should be properly established so that the object of the invention is effectively achieved. It is 0.01–70 atom %, preferably 0.1–50 atom %, and most desirably 1–40 atom %.

The above-mentioned atoms (Mc) optionally contained to control image quality are selected from atoms belonging to Group III of the periodic table, except for aluminum atoms (Al) ("Group III atoms" for short hereinafter), atoms belonging to Group V of the periodic table, except for nitrogen atoms (N) ("Group V atoms" for short hereinafter), and atoms belonging to Group VI of the periodic table, except for oxygen atoms (O) ("Group VI atoms" for short hereinafter).

Examples of Group III atoms include B (boron), Ga (gallium), In (indium), and Tl (thallium), with B, Al and Ga being preferable. Examples of Group V atoms include P (phosphorus), As (arsenic), Sb (antimony) and Bi (bismuth), with P and As being preferable. Examples of Group VI atoms include S (sulfur), Se (selenium), Te (tellurium), and Po (polonium), with S and Se being preferable.

According to the present invention, the lower layer may contain atoms (Mc) to control image quality, which are Group III atoms, Group V atoms, or Group VI atoms. The atoms (Mc) improve the injection of electric charge across the aluminum support and the upper layer and/or improve the transferability of electric charge in the lower layer. They also control conduction type and/or conductivity in the region of the lower layer which contains a less amount of aluminum atoms (Al).

In the lower layer, the content of atoms (Mc) to control image quality should be $1\times10^{-3}$–$5\times10^{4}$ atom-ppm, preferably $1\times10^{-1}$–$5\times10^{4}$ atom-ppm, and most desirably $1\times10^{-2}$–$5\times10^{3}$ atom-ppm The above-mentioned atoms (NCOc) optionally contained to control durability are selected from carbon atoms (C), nitrogen atoms (N), and oxygen atoms (O). When contained in the lower layer, carbon atoms (C), and/or nitrogen atoms (N), and/or oxygen atoms (O) as the atoms (CNOc) to control durability contributed to improve the injection of electric charge across the aluminum support and the upper layer and/or improve the transferability of electric charge in the lower layer and/or improve the adhesion of the lower layer to the aluminum support. They also contribute to control the width of the forbidden band in the region of the lower layer which contains a less amount of aluminum atoms (Al).

In the lower layer, the content of atoms (NCOc) to control durability should be $1\times10^{3}$–$5\times10^{5}$ atom-ppm, preferably $5\times10^{1}$–$4\times10^{5}$ atom-ppm, and most desirably $1\times10^{2}$–$3\times10^{3}$ atom-ppm The above-mentioned halogen atoms (X) optionally contained in the lower layer are selected from fluorine atoms (F), chlorine atoms (Cl), bromine atoms (Br), and iodine atoms (I). When contained in the lower layer, fluorine atoms (F), and/or chlorine atoms (Cl), and/or bromine atoms (Br), and/or iodine atoms (I) as the halogen atoms (V) compensate for the unbonded hands of silicon atoms (Si) and aluminum atoms (Al) contained mainly in the lower layer and make the lower layer stable in terms of composition and structure, thereby improving the quality of the layer.

The content of halogen atoms (X) in the lower layer should be properly established so that the object of the invention is effectively achieved. It is $1$–$4\times10^{5}$ atom-ppm, preferably $10$–$3\times10^{5}$ atom-ppm, and most desirably $1\times10^{2}$–$2\times10^{5}$ atom-ppm.

According to the present invention, the lower layer may optionally contain germanium atoms (Ge) and/or tin atoms (Sn). They improve the injection of electric charge across the aluminum support and the upper layer and/or improve the transferability of electric charge in the lower layer and/or improve the adhesion of the lower layer to the aluminum support. They also narrow the width of the forbidden band in the region of the lower layer which contains a less amount of aluminum atoms (Al). These effects suppress interference which occurs when a light of long wavelength such as semiconductor laser is used as the light source for image exposure in the electrophotographic apparatus.

The content of germanium atoms (Ge) and/or tin atoms (Sn) in the lower layer should be properly established so that the object of the invention is effectively achieved. It is $1$–$9\times10^{5}$ atom-ppm, preferably $1\times10^{2}$–$8\times10^{5}$ atom-ppm, and most desirably $5\times10^{2}$–$7\times10^{5}$ atom-ppm According to the present invention, the lower layer may optionally contain, as the alkali metal atoms and/or alkaline earth metal atoms and/or transition metal atoms, magnesium atoms (Mg) and/or copper atoms (Cu) and/or sodium atoms (Na) and/or yttrium atoms (Y) and/or manganese atoms (Mn) and/or zinc atoms (Zn). They disperse hydrogen atoms (H) and halogen atoms (X) uniformly in the lower layer and prevent the cohesion of hydrogen which is considered to cause cracking and peeling. They also improve the injection of electric charge across the aluminum support and the upper layer and/or improve the transferability of electric charge in the lower layer and/or improve the adhesion of the lower layer to the aluminum support.

The content of the above-mentioned metals in the lower layer should be properly established so that the object of the invention is effectively achieved. It is $1$–$2\times10^{5}$ atom-ppm, preferably $1\times10^{2}$–$1\times10^{5}$ atom-ppm, and most desirably $5\times10^{2}$–$5\times10^{4}$ atom-ppm.

According to the present invention, the lower layer composed of AlSiH is formed by the vacuum deposition film forming method, as in the upper layer which will be mentioned later, under proper conditions for the desired characteristic properties. The thin film is formed by one of the following various methods. Glow discharge method (including ac current discharge CVD, e.g., low-frequency CVD, high-frequency CVD, and microwave CVD, and dc current CVD), ECR-CVD method, sputtering method, vacuum metallizing method, ion plating method, light CVD method, "HRCVD" method (explained below), "FOCVD" method (explained below). (According to HRCVD method, an active substance (A) formed by the decomposition of a raw material gas and the other active substance (B) formed from a substance reactive to the first active substance are caused to react with each other in a space where the film formation is accomplished. According to FOCVD method, a raw material gas and a halogen-derived gas capable of oxidizing said raw material gas are caused to react in a space where the film formation is accomplished.) A proper method should be selected according to the manufacturing conditions, the capital available, the production scale, and the characteristic properties required for the light receiving member for electrophotography. Preferable among these methods are glow discharge method, sputtering method, ion plating method, HRCVD method, and FOCVD method on account of their ability to control the production conditions and to introduce aluminum atoms (Al), silicon atoms (Si), and hydrogen atoms (H) with ease. These methods may be used in combination with one another in the same apparatus.

The glow discharge method may be performed in the following manner to form the lower layer of AlSiH. The raw material gases are introduced into an evacuatable deposition chamber, and glow discharge is performed, with the gases being introduced at a desired pressure, so that a layer of AlSiH is formed as required on the surface of the support placed in the chamber. The raw material gases may contain a gas to supply aluminum atoms (Al), a gas to supply silicon atoms (Si), a gas to supply hydrogen atoms (H), an optional gas to supply atoms (Mc) to control image quality, an optional gas to supply atoms (CNOx) to control durability, an optional gas to supply halogen atoms (X), an optional gas to supply atoms (GSc), germanium atoms (Ge) and tin atoms (Sn), and an optional gas to supply atoms (Me) (at least one kind of alkali metal atoms, alkaline earth metal atoms, and transition metal atoms).

The HRCVD may be performed in the following manner to form the lower layer of AlSiH. The raw material gases are introduced all together or individually into an evacuatable deposition chamber, and glow discharge is performed or the gases are heated, with the gases being introduced at a desired pressure, during which a first active substance (A) is formed and a second active substance (B) is introduced into the deposition chamber, so that a layer of AlSiH is formed as required on the surface of the support placed in the chamber. The raw material gases may contain a gas to supply aluminum atoms, (Al), a gas to supply silicon atoms (Si), an optional gas to supply atoms (Mc) to control image quality, an optional gas to supply atoms (CNOc) to control durability, an optional gas to supply halogen atoms (X), an optional gas to supply atoms (GSc) (germanium atoms (Ge) and tin atoms (Sn)), and an optional gas to supply atoms (Me) (at least one kind of alkali metal atoms, alkaline earth metal atoms, and transition metal atoms). A second active substance (B) is formed by introducing a gas to supply hydrogen into the activation chamber. Said first active substance (A) and said second active substance are individually introduced into the deposition chamber.

The FOCVD method may be performed in the following manner to form the lower layer of AlSiH. The raw material gases are introduced into an evacuatable deposition chamber, and chemical reactions are performed, with the gases being introduced at a desired pressure, so that a layer of AlSiH is formed as required on the surface of the support placed in the chamber. The raw material gases may contain a gas to supply aluminum atoms (Al), a gas to supply silicon atoms (Si), a gas to supply hydrogen atoms (H), an optional gas to supply atoms (Mc) to control image quality, an optional gas to supply atoms (CNOc) to control durability, an optional gas to supply halogen atoms (X), an optional gas to supply atoms (GSc) (germanium atoms (Ge) and tin atoms (Sn)), and an optional gas to supply atoms (Me) (at least one kind of alkali metal atoms, alkaline earth metal atoms, and transition metal atoms). They may be introduced into the chamber altogether or individually, and a halogen (X) gas is introduced into the chamber separately from said raw materials gas, and these gases are subjected to chemical reaction in the deposition chamber.

The sputtering method may be performed in the following manner to form the lower layer of AlSiH. The raw material gases are introduced into a sputtering deposition chamber, and a desired gas plasma environment is formed using an aluminum target and an Si target in an inert gas of Ar or He or an Ar- or He-containing gas. The raw material gases may contain a gas to supply hydrogen atoms (H), an optional gas to supply atoms (Mc) to control image quality, an optional gas to supply atoms (CNOc) to control durability, an optional gas to supply halogen atoms (X), an optional gas to supply atoms (GSc) (Germanium atoms (Ge) and tin atoms (Sn)), and an optional gas to supply atoms (Me) (at least one kind of alkali metal atoms, alkaline earth metal atoms, and transition metal atoms). If necessary, a gas to supply aluminum atoms (Al) and/or to supply silicon atoms (Si) are introduced into the sputtering chamber.

The ion plating method may be performed in the same manner as the sputtering method, except that vapors of aluminum and silicon are passed through the gas plasma environment. The vapors of aluminum and silicon are produced from aluminum and silicon polycrystal or single crystal placed in a boat which is heated by resistance or electron beams (EB method).

According to the present invention, the lower layer contains aluminum atoms (Al), silicon atoms (Si), hydrogen atoms (H), optional atoms (Mc) to control image quality, optional atoms (CNOc) to control durability, optional halogen atoms (X), optional germanium atoms (Ge), optional tin atoms (Sn), optional alkali metal atoms, optional alkaline earth metal atoms, and optional transition metal atoms (collectively referred to as atoms (ASH) hereinafter), which are distributed in different concentrations across the layer thickness. The lower layer having such a depth profile can be formed by controlling the flow rate of the feed gas to supply atoms (ASH) according to the desired rate of change in concentration. The flow rate may be changed by operating the needle valve in the gas passage manually or by means of a motor, or it may be changed by any of customary means such as by properly adjusting the mass flow controller manually or by means of a programmable control apparatus.

In the case where the sputtering method is used, the lower layer having such a depth profile can be formed, as in the glow discharge method, it can be achieved by controlling the flow rate of the gaseous raw material to supply atoms (ASH) according to the desired rate of change in concentration and introducing the gas into the deposition chamber. Alternatively, it is possible to use a sputtering target comprising a Al-Si mixture in which the mixing ratio of Al and Si is properly changed in the direction of layer thickness of the target.

According to the present invention, the gas to supply Al includes, for example, $AlCl_3$, $AlBr_3$, $AlI_3$, $Al(CH_3)_2Cl$, $Al(CH_3)_3$, $Al(OCH_3)_3$, $Al(C_2H_5)_3$, $Al(OC_2H_5)_3$, $Al(i\text{-}C_4H_9)_3$, $Al(i\text{-}C_3H_7)_3$, $A(C_3H_7)_3$ and $(Al(OC_4H_9)_3$. These gases to supply Al may be diluted with an inert gas such as $H_2$, He, Ar and Ne, if necessary.

According to the present invention, the gas to supply Si includes, for example, gaseous or gasifiable silicohydrides (silanes) such as $Si_2$, $SiH_2H_6$, $Si_3H_8$ and $Si_4H_{10}$. $SiH_4$ and $Si_2H_6$ are preferable from the standpoint of each of handling and the efficient supply of Si. These gases to supply Si may be diluted with an inert gas such as $H_2$, He, Ar and Ne, if necessary.

According to the present invention, the gas to supply H includes, for example, silicohydrides (silanes) such as $SiH_4$, $Si_2H_6$, $Si_3H_8$ and $Si_4H_{10}$.

The amount of hydrogen atoms contained in the lower layer may be controlled by regulating the flow rate of the feed gas to supply hydrogen and/or regulating the temperature of the support and/or regulating the electric power for discharge.

The lower layer may contain atoms (Mc) to control image quality, such as Group III atoms, Group V atoms and Group VI atoms. This is accomplished by introducing into the deposition chamber the raw materials to form the lower layer together with a raw material to introduce Group III atoms, a raw material to introduce Group V atoms, or a raw material to introduce Group VI atoms. The raw material to introduce Group III atoms, the raw material to introduce Group V atoms, or the raw material to introduce Group VI atoms may desirably be gaseous at normal temperature and under normal pressure or gasifiable under the layer forming conditions. The raw material to introduce Group III atoms, especially boron atoms, include, for example, boron, hydrides such as $B_2H_6$, $B_5H_9$, $B_5H_{11}$, $B_6H_{10}$, $B_6H_{12}$ and $B_6H_{14}$, and boron halides such as $BF_3$, $BCl_3$ and $BBr_3$. Additional examples includes $GaCl_3$, $Ga(CH_3)_3$, $InCl_3$ and $TiCl_3$.

The raw material to introduce Group V atoms, especially phosphorus atoms, include, for example, phosphorus hydrides such as $PH_3$, $P_2H_4$ and phosphorus halides such as $PH_4I$, $PF_3$, $PF_3$, $PCl_3$, $PBr_3$, $PBr_5$ and $PI_3$. Other examples effective to introduce Group V atoms include $AsH_3$, $AsF_3$, $AsCl_3$, $AsBr_3$, $AsF_5$, $SbH_3$, $SbF_3$, $SbF_5$, $SbCl_3$, $SbCl_5$, $BiH_3$, $BiCl_3$ and $BiBr_3$.

The raw material to introduce Group VI atoms includes, for example, gaseous or gasifiable substances such as $H_2$, $SF_4$, $SF_6$, $SO_2$, $SO_2F_2$, COS, $CS_2$, $CH_3SH$, $C_2H_5SH$, $C_4H_4S$, $(CH_3)_2S$ and $S(C_2H_5)_2S$. Other examples include gaseous of gasifiable substances such as $SeH_2$, $SeF_6$, $(CH_3)_2)Se$, $(C_2H_5)_2Se$. $TeH_2$, $TeF_6$, $(CH_3)_2Te$ and $(C_2H_5)_2Te$.

These raw materials to introduce atoms (Mc) to control image quality may be diluted with an inert gas such as $H_2$, He, Ar and Ne.

According to the present invention, the lower layer may contain atoms (CNOc) to control durability, e.g., carbon atoms (C), nitrogen atom (N), and oxygen atoms (O). This is accomplished by introducing into the deposition chamber the raw materials to form the lower layer, together with a raw material to introduce carbon atoms (C), or a raw material to introduce nitrogen atoms (N), or a raw material to introduce oxygen atoms (O). Raw materials to introduce carbon atoms (C), nitrogen atoms (N), or oxygen atoms (O) may desirably be in the gaseous form at normal temperature and under normal pressure or may be readily gasifiable under the layer forming conditions.

A raw material gas to introduce carbon atoms (C) includes those composed of C and H atoms such as saturated hydrocarbons having 1 to 4 carbon atoms, ethylene, series hydrocarbons having 2 to 4 carbon atoms and acetylene series hydrocarbons having 2 to 3 carbon atoms.

Examples of the saturated hydrocarbons include specifically methane ($CH_4$), ethane ($C_2H_6$), propane ($C_3H_8$). n-butane (n-$C_4H_{10}$) and pentane ($C_5H_{12}$). Examples of the ethylene series hydrocarbons include ethylene ($C_2H_4$), propylene ), butene-1 ($C_4H_8$), butene-2 ($C_4H_8$), isobutylene ($C_4H_8$) and pentene ($C_5H_{10}$). Examples of acetylene series hydrocarbon include acetylene ), methylacetylene ($C_3H_4$) and butyne ($C_4H_6$).

The raw material gas composed of Si, C, and H includes alkyl silicides such as $Si(CH_3)_4$ and $Si(C_2H_5)_4$.

Additional examples include gases of halogenated hydrocarbons such as of $CF_4$, $CCl_4$ and $CH_3CF_3$, which introduce carbon atoms (C) as well as halogen atoms (X).

Examples of the raw material gas to introduce nitrogen atoms (N) include nitrogen and gaseous or gasifiable nitrogen compounds (e.g., nitrides and azides) which are composed of nitrogen and hydrogen, such as ammonia ($NH_3$), hydrazine ($H_2NNH_2$), hydrogen azide ($HN_3$), and ammonium azide ($NH_4N_3$).

Additional examples include halogenated nitrogen compounds such as nitrogen trifluoride ($F_3N$) and nitrogen tetrafluoride ($F_4N_2$), which can introduce nitrogen atoms as well as halogen atoms (X).

Examples of the raw material gas to introduce oxygen atoms (O) include oxygen ($O_2$), ozone ($O_3$), nitrogen monoxide (NO), nitrogen dioxide ($NO_2$), trinitrogen tetraoxide ($N_3O_4$), dinitrogen pentaoxide ($N_2O_5$) and nitrogen trioxide ($NO_3$), as well as lower siloxanes such as disiloxane ($H_3SiOSiH_3$) and trisiloxane ($H_3SiOSiH_2OSiH_3$) which are composed of silicon atoms (Si), oxygen atoms (O) and hydrogen atoms (H).

Examples of the gas to supply hydrogen atoms include halogen gases and gaseous or gasifiable halides, interhalogen compounds, and halogen-substituted silane derivatives. Additional examples include gaseous or gasifiable halogen-containing silicohydrides composed of silicon atoms and halogen atoms.

The halogen compounds that can be suitably used in the present invention include halogen gases such as fluorine, chlorine, bromine and iodine; and interhalogen compounds such as BrF, ClF, $ClF_3$, $BrF_5$, $BrF_3$, $IF_3$, $IF_7$, ICl and IBr.

Examples of the halogen-containing silicon compounds or halogen-substituted silane compounds, include specifically silane ($SiH_4$) and halogenated silicon such as $Si_2F$ $SiCl_4$ and $SiBr_4$.

In the case where the halogen-containing silicon compounds is used to form the light receiving member for electrophotography by the glow discharge method or HRCVD method, it is possible to form the lower layer composed of AlSiH containing halogen atoms on the support without using a silicohydride gas to supply silicon atoms.

In the case where the lower layer containing halogen atoms is formed by the glow discharge method of HRCVD method a silicon halide gas is used as the gas to supply silicon atoms. The silicon halide gas may be mixed with hydrogen or a hydrogen-containing silicon compound gas to facilitate the introduction of hydrogen atoms at a desired level.

The above-mentioned gases may be used individually or in combination with one another at a desired mixing ratio.

The raw materials to form the lower layer which are used in addition to the above-mentioned halogen compounds or halogen-containing silicon compounds include gaseous or gasifiable hydrogen halides such as HF, HCl, HBr and HI; and halogen-substituted silicohydrides such as $SiH_3F_2$, $SiH_2F_2$, $SiHF_3$, $SiH_2I_2$, $SiS_2Cl_2$, $SiHCl_3$, $SiH_2Br_2$ and $SiHBr_3$. Among these substances, the hydrogen-containing halides are a preferred halogen-supply gas because they supply the lower layer with halogen atoms as well as hydrogen atoms which are very effective for the control of electric or photoelectric characteristics.

The introduction of hydrogen atoms into the lower layer may also be accomplished in another method by inducing discharge in the deposition chamber containing a silicohydride such as $SiH_4$, $Si_2H_6$, $Si_3H_8$ and $Si_4H_{10}$ and a silicon compound to supply silicon atoms (Si).

The amount of hydrogen atoms (H) and/or halogen atoms (X) to be introduced into the lower layer may be controlled by regulating the temperature of the support, the electric power for discharge, and the amount of raw materials for hydrogen atoms and halogen atoms to be introduced into the deposition chamber.

The lower layer may contain germanium atoms (Ge) or tin atoms (Sn). This is accomplished by introducing into the deposition chamber the raw materials to form the lower layer together with a raw material to introduce germanium atoms (Ge) or tin atoms (Sn) in a gaseous form. The raw material to supply germanium atoms (Ge) or the raw material to supply tin atoms (Sn) may be gaseous at normal temperature and under normal pressure or gasifiable under the layer forming conditions.

The substance that can be used as a gas to supply germanium atoms (Ge) include gaseous or gasifiable germanium hydrides such as $GeH_4$, $Ge_2H_6$, $Ge_3H_8$ and $Ge_4H_{10}$ Among them, $GeH_4$, $Ge_2H_6$ and $Ge_3H_8$ are preferable from the standpoint of easy handling at the time of layer forming and the efficient supply of germanium atoms (Ge).

Other effective raw materials to form the lower layer include gaseous or gasifiable germanium hydride-halides such as $GeHF_3$, $GeH_2F_2$, $GeH_3F$, $GeHCl_3$, $GeH_2Cl_2$, $GeH_3Cl$, $GeHBr_3$, $GeH_2Br_2$. $GeH_3Br$, $GeHI_3$, $GeH_2I_2$ and $GeH_3I$ and germanium halides such as $GeF_4$, $GeCl_4$, $GeBr_4$, $GeI_4$, $GeF_2$, $GeCl_2$, $GeBr_2$ and $GeI_2$.

The substance that can be used as a gas to supply tin atoms (Sn) include gaseous or gasifiable tin hydrides such as $SnH_4$, $Sn_2H_6$, $Sn_3H_8$ and $Sn_4H_{10}$. Among them, $SnH_4$, $Sn_2H_6$ and $Sn_3H_8$ are preferable from the standpoint of easy handling at the time of layer forming and the efficient supply of tin atoms (Sn).

Other effective raw materials to form the lower layer include gaseous or gasifiable tin hydride-halides such as $SnHF_3$, $SnH_2F_2$, $SnH_3F$, $SnHCl_3$, $SnH_2Cl_2$, $SnH_3Cl$, $SnHBr_3$, $SnH_2Br_2$, $SnH_3Br$, $SnHI_3$, $SnH_2I_2$ and $SnH_3I$, and tin halides such as $SnF_4$, $SnCl_4$, $SnBr_4$, $SnI_4$, $SnF_2$, $SnCl_2$, $SnBr_2$ and $SnI_2$.

The gas to supply GSc may be diluted with an inert gas such as $H_2$, He, Ar and Ne, is necessary.

The lower layer may contain magnesium atoms (Mg). This is accomplished by introducing into the deposition chamber the raw materials to form the lower layer together with a raw material to introduce magnesium atoms (Mg) in a gaseous form. The raw material to supply magnesium atoms (Mg) may be gaseous at normal temperature and under normal pressure or gasifiable under the layer forming conditions.

The substance that can be used as a gas to supply magnesium atoms (Mg) include organometallic compounds containing magnesium atoms (Mg). Bis(cyclopentadienyl)magnesium (II) complex salt ($Mg(C_5H_5)_2$) is preferable from the standpoint of easy handling at the time of layer forming and the efficient supply of magnesium atoms (Mg).

The gas to supply magnesium atoms (Mg) may be diluted with an inert gas such as $H_2$, He, Ar and Ne, if necessary.

The lower layer may contain copper atoms (Cu). This is accomplished by introducing into the deposition chamber the raw materials to form the lower layer together with a raw material to introduce copper atoms (Cu) in a gaseous form. The raw material to supply copper atoms(Cu) may be gaseous at normal temperature and under normal pressure or gasifiable under the layer forming conditions.

The substance that can be used as a gas to supply copper atoms (Cu) include organometallic compounds containing copper atoms (Cu). Copper (II) bisdimethylglyoximate $Cu(C_4H_7N_2O_2)_2$ is preferable from the standpoint of easy handling at the time of layer forming and the efficient supply of Cu atoms.

The gas to supply copper atoms (Cu) may be diluted with an inert gas such as $H_2$, He, Ar and Ne, if necessary.

The lower layer may contain sodium atoms (Na) or yttrium atoms (Y) or manganese atoms (Mn), zinc atoms (Zn), etc. This is accomplished by introducing into the deposition chamber the raw materials to form the lower layer together with a raw material to introduce sodium atoms (Na) or yttrium (Y) or manganese atoms (Mn) or zinc atoms (Zn). The raw material to supply sodium atoms (Na) or yttrium atoms (Y) or mangnaese atoms (Mn) or zinc atoms (Zn) may be gaseous at normal temperature and under normal. pressure or gasifiable under the layer forming conditions.

The substance that can be used as a gas to supply sodium atoms (Na) includes sodium amine ($NaNH_2$) and organometallic compounds containing sodium atoms (Na). among them, sodium amine ($NaNH_2$) is preferable from the standpoint of easy handling at the time of layer forming and the efficient supply of sodium atoms (Na).

The substance that can be used as a gas to supply yttrium atoms (Y) includes organometallic compounds containing yttrium atoms (Y). Triisopropanol yttrium $Y(Oi\text{-}C_3H_7)_3$ is preferable from the standpoint of easy handling at the time of layer forming and the efficient supply of yttrium atoms (Y).

The substance that can be used as a gas to supply manganese atoms (Mn) includes organometallic compounds containing manganese atoms (Mn). Monomethylpentacarbonylmanganese $Mn(CH_3)(CO)_5$, is preferable from the standpoint of easy handling at the time of layer forming and the efficient supply of sodium atoms (Na).

The substance that can be used as a gas to supply zinc atoms (Zn) includes organometallic compounds containing zinc atoms (Zn). Diethyl zinc $Zn(C_2H_5)_2$ is preferable from the standpoint of easy handling at the time of layer forming and the efficient supply of zinc atoms (Zn).

The gas to supply sodium atoms (Na) or yttrium atoms (Y) or manganese atoms (Mn) or zinc atoms (Zn) may be diluted with an inert gas such as $H_2$, He, Ar and Ne, if necessary.

According to the present invention, the lower layer should have a thickness of 0.03–5 um, preferably, 0.01–1 um, and most desirable 0.05–0.5 um, from the standpoint of the desired electrophotographic characteristics and economic effects.

According to the present invention, the lower layer has an interface region which is in contact with the aluminum support and contains less than 95% of the aluminum atoms contained in the aluminum support. If the interface region contains more than 95% of the aluminum atoms contained in the aluminum support, it merely functions as the support. The lower layer also has an interface which is in contact with the upper layer and contains more than 5% of the aluminum atoms contained in the lower layer. If the interface region contains less than 5% of the aluminum atoms contained in the lower layer, if merely functions as the upper layer.

In order to form the lower layer of AlSiH which ha the characteristic properties to achieve the object of the present invention, it is necessary to properly establish the gas pressure in the deposition chamber nd the temperature of the support.

The gas pressure in the deposition chamber should be properly selected according to the desired layer. It is usually $1\times10^{-5}$–10 Torr, preferably $1\times10^{-4}$–3 Torr, and most desirably $1\times10^{-4}$–1 Torr.

The temperature (Ts) of the support should be properly selected according to the desired layer. It is usually 50°–600° C., and preferably 100°–400° C.

In order to form the lower layer of AlSiH by the glow discharge method according to the present invention, it is necessary to properly establish the discharge electric power to be supplied to the deposition chamber according to the desired layer. It is usually $5\times10^{-5}$–10 W/cm$^3$, preferably $5\times10^{-4}$–5 W/cm$^3$ and most desirably $1\times10^{-3}$–1 to $2\times10^{-3}$ W/cm$^3$.

The gas pressure of the deposition chamber, the temperature of the support, and the discharge electric power to be supplied to the deposition chamber mentioned above should be established interdependently to that the lower layer having the desired characteristic properties can be formed.

Upper layer

The upper layer in this invention is composed of a Non-Si (H, X) and has desired photoconductivity.

The upper layer of this invention contains, in at least the layer region adjacent with the lower layer, carbon atoms (C), and/or nitrogen atoms (N), and/or oxygen atoms (O), and optional atoms (M) to control conductivity but contains no substantial germanium atoms (Ge) and tin atoms (Sn). However, the upper layer may contain in other layer regions at least one of the atoms (M) to control the conductivity, carbon atoms (C), nitrogen atoms (N), oxygen atoms (O), germanium atoms (Ge) and tin atoms (Sn). Particularly, in the layer region of the upper layer near the free surface, at least one of carbon atoms (C), nitrogen atoms (N) and oxygen atoms (O) is preferably contained.

The upper layer may contain in the layer region of the upper layer at least adjacent with the lower layer carbon atoms (C), and/or nitrogen atoms (N), and/or oxygen atoms (O) and optional atoms (M) to control the conductivity, which are distributed evenly throughout the layer region or distributed evenly throughout the layer region but may be contained uneven distribution across the layer thickness in a part. However, in either of the cases, their distribution should be uniform in a plane parallel to the surface of the support so that uniform characteristics are ensured in the same plane.

In a case where the upper layer contains in other layer regions than the layer region at least in adjacent with the lower layer contains at least one of atoms (M) to control the conductivity, carbon atoms (C), nitrogen atoms (N), oxygen atoms (O), germanium atoms (Ge) and tin atoms (Sn), the atoms (M) to control the conductivity, carbon atoms (C), nitrogen atoms (N), oxygen atoms (O), germanium (Ge), tin atoms (Sn) may be distributed uniformly in the layer region, or they may be contained in a portion uniformly distributed in the layer region but not unevenly distributed across the layer thickness.

However, in either of the cases, their distribution should be uniform in a plane parallel to the surface of the support so that uniform characteristics are ensured in the same plane.

According to the present invention, the upper layer may contain at least one of alkali metals, alkaline earth metal and transition metals. The atoms are incorporated in the entire layer region or a partial layer region of the upper layer, and they may be uniformly distributed throughout the region, or distributed evenly through the layer region but may contained unevenly distributed across the layer thickness.

However, they should be incorporated uniformly in either of the cases in a plane parallel to the surface of the support so that uniform characteristics are ensured in the same plane.

A layer region (hereinafter simply referred to as "layer region (M)") containing atoms (M) to control the conductivity (hereinafter simply referred to as "atoms (M)") and a layer region of the upper layer at least in adjacent with the lower layer (hereinafter simply referred to as "layer region ($CNO_B$)") containing carbon atoms (C), and/or nitrogen atoms (N), and/or oxygen atoms (O) (hereinafter simply referred to as "atoms (CNO)") may be a substantially identical layer region or may have in common a portion at least on the side of the surface of the layer region ($CNO_B$), or may be contained within the layer region ($CNO_B$).

Further, the layer region (hereinafter simply referred to as "layer region (GS)") containing germanium atoms (Ge) and/or tin atoms (Sn) (hereinafter simply referred to as "atoms (GS)") may contain a portion on the surface of the layer region ($CNO_B$).

Further, the layer region containing atoms (CNO) other than the layer region ($CNO_B$) (hereinafter simply referred to as "layer region ($CNO_T$)" and the layer region ($CNO_B$) and the layer region ($CNO_T$) being collectively referred as "layer region (CNO)"), the layer region (M), the layer region (GS) and the layer region (NYMZ) containing at least one of alkali metals, alkaline earth metals and transition metals may be substantially an identical layer region, may have in common at least a portion for the respective layer regions, or may have in common substantially the respective layer regions.

FIGS. 17 to 36 show the typical examples of the profile of atoms (M) across the layer thickness in the layer region (M), a typical example of the profile of atoms (CNO) in the layer region (CNO) across the layer thickness, a typical example of the profile of the atoms (GS) contained the layer region (GS) across the layer thickness, and a typical example of the profile of alkali metal atoms, alkaline earth metal atoms or transition metal atoms contained in the layer region incorporating at least one of alkali metal atoms, alkaline earth metal atoms and transition metal atoms across the layer thickness in the upper layer of the light receiving member for use in electrophotography in this invention (hereinafter the layer regions are collectively referred to as "layer region (Y)" and these atoms are collectively referred to as "atoms (Y)").

Accordingly, FIGS. 17 to 36 show the typical examples of the profiles of the atoms (Y) contained in the layer region (Y) across the layer thickness, in which one layer region (Y) is contained in the upper layer in a case where the layer region (M), layer region (CNO), layer region (GS), a layer region containing at least one of alkali metal, alkaline earth metal and transition metal are substantially the identical layer region, or a plurality of the layer regions (Y) are contained in the upper layer if they are not substantially identical layer region.

In FIGS. 17 to 36, the abscissa represents the distribution concentration C of the atoms (Y) and ordinate represents the thickness of the layer region (Y), while $t_B$ represents the position of the end of the layer region (Y) on the side of the lower layer and $t_T$ represents the position of the end of the layer region (Y) on the side of the free surface. That is, the layer region (Y) containing the atoms (Y) is formed from the side $t_B$ to the side $t_T$.

Figure 17:
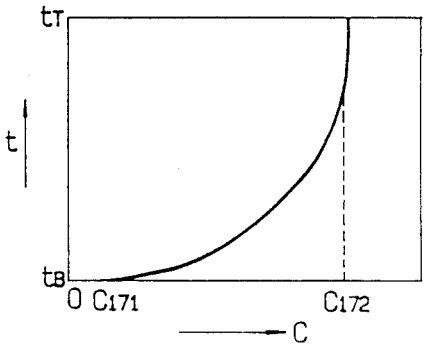

FIG. 17 shows a first typical example of the profile of atoms (Y) contained in the layer region (Y) across the layer thickness.

In the example shown in FIG. 17, the atoms (Y) contained is distributed such that the concentration increases gradually and continuously from $C_{171}$ to $C_{172}$ from the position $t_B$ to the position $t_T$.

Figure 18:
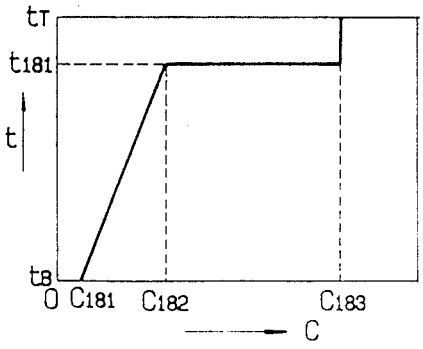

In the example shown in FIG. 18, the atoms (Y) contained is distributed such that the concentration C linearly increases from $C_{181}$ to $C_{182}$ from the position $t_B$ to the position $t_{181}$ and takes a constant value of $C_{183}$ from the position $t_{181}$ to the position $t_T$.

Figure 19:
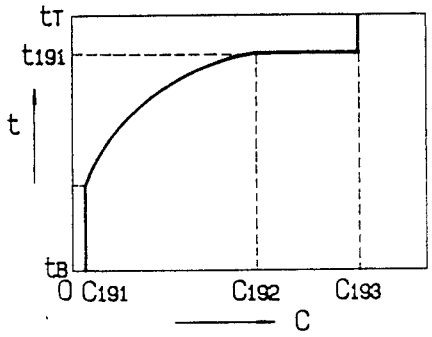

In the example shown in FIG. 19, the atoms (Y) contained is distributed such that the concentration C takes a constant value of $C_{191}$ from the position $t_B$ to the position $t_{191}$, gradually and continuously increases from $C_{191}$ to $C_{192}$ from the position $t_{191}$ to the position $t_{192}$ and then takes a constant value of concentration $t_{193}$ from the position $t_{192}$ to the position $t_T$.

Figure 20:
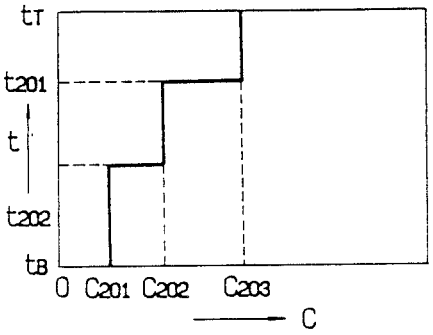

In the example shown in FIG. 20, the atoms (Y) contained is distributed such that the concentration C takes a constant value of $C_{201}$ from the position $t_B$ to the position $t_{201}$, takes a constant value $C_{202}$ from the position $t_{201}$ to the position $t_{202}$ and takes a constant value $C_{203}$ from the position $t_{202}$ to the position $t_T$.

Figure 21:
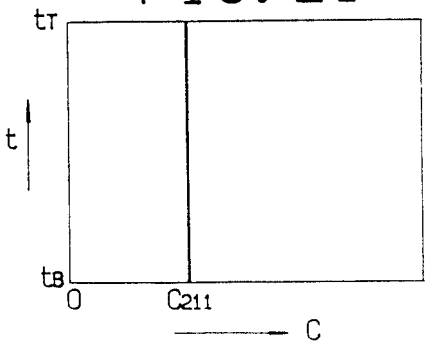

In the example shown in FIG. 21, the atoms (Y) contained is distributed such that the concentration C takes a constant value of the $C_{211}$ from the position $t_B$ to the position $t_T$.

Figure 22:
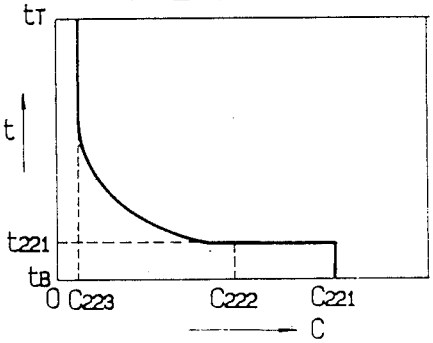

In the example shown in FIG. 22, the atoms (Y) contained is distributed such that the concentration C takes a constant value $C_{221}$ from the position $t_B$ to the position $t_{221}$, decreases gradually and continuously from $C_{222}$ to $C_{223}$ from the position $t_{221}$ to the position $t_T$.

Figure 23:
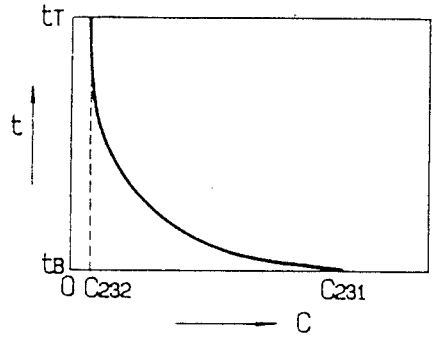

In the example shown in FIG. 23, the atoms (Y) contained is distributed such that the concentration C gradually and continuously decreases from $C_{231}$ to the $C_{232}$ from the position $t_B$ to the position $t_T$.

Figure 24:
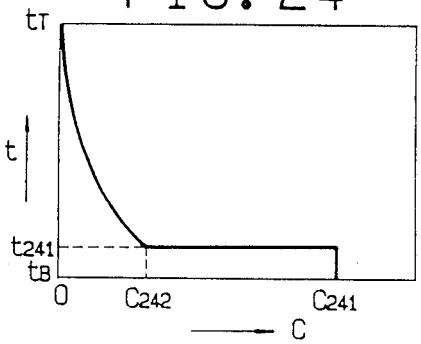

In the example shown in FIG. 24 the atoms (Y) contained is distributed such that the distribution C takes a constant value $C_{241}$ from the position $t_B$ to the position $t_{241}$, gradually and continuously decreases from the $C_{442}$ to the concentration substantialy equal to zero from the position $t_{241}$ to the position $t_T$ (substantially zero means here and hereinafter the concentration lower than the detectable limit).

Figure 25:
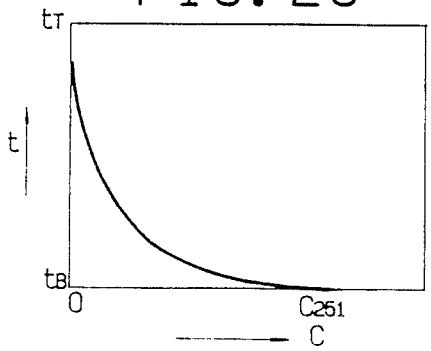

In the example shown in FIG. 25, the atoms (Y) contained is distributed such that the concentration C gradually and continuously decreases from $C_{251}$ to substantially equal to zero from the position $t_B$ to the position $t_T$.

Figure 26:
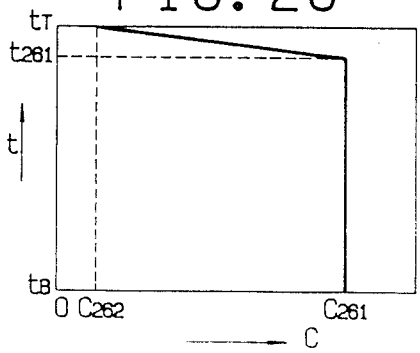

In the example shown in FIG. 26, the atoms (Y) contained is distributed such that the concentration C remains constant at $C_{261}$ from the position $t_B$ to the position $t_{262}$, lineary decreases to $C_{262}$ from the position $t_{261}$ to the position $t_T$ and remains at $C_{262}$ at the position $t_T$.

Figure 27:
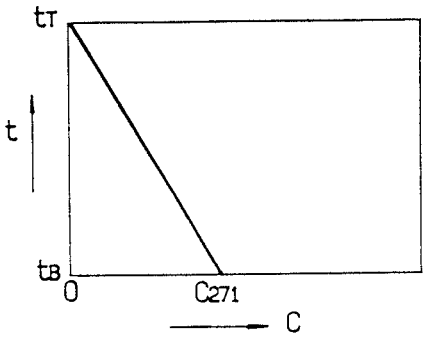

In the example shown in FIG. 27, the atoms (Y) contained is distributed such that the concentration C linearly decreases from $C_{271}$ to substantially equal to zero from the position $t_B$ to the position $t_T$.

Figure 28:
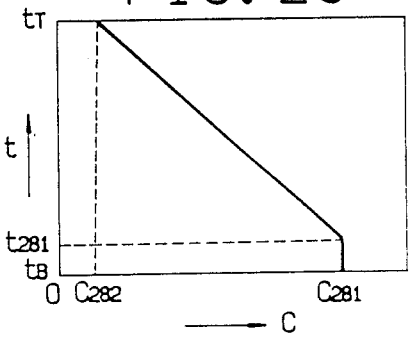

In the example shown in FIG. 28, the atoms (Y) contained is distributed such that the concentration C remaining constant at $C_{281}$ from the position $t_B$ to the position $t_{281}$ and linearly decreases from $C_{281}$ to $C_{282}$ from the position $t_{282}$ to the position $t_T$.

Figure 29:
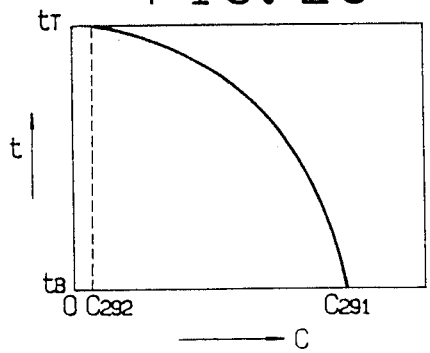

In the example shown in FIG. 29, the atoms (Y) contained is distributed such that the concentration C gradually and continuously decreases from $C_{291}$ to $C_{292}$ from the position $t_B$ to the position $t_T$.

Figure 30:
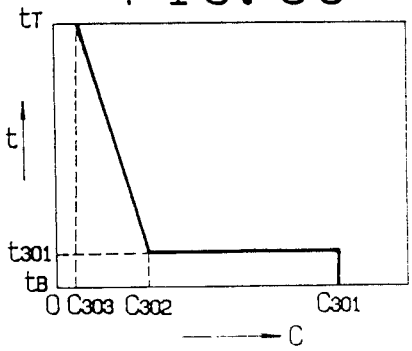

In the example shown in FIG. 30, the atoms (Y) contained is distributed such that the concentration C remains at a constant value $C_{301}$ from the position $t_B$ to the position $t_{301}$, linearly decreases from $C_{302}$ to $C_{303}$ from the position $t_{301}$ to the position $t_T$.

Figure 31:
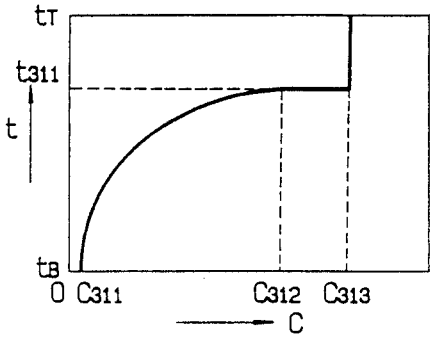

In the example shown in FIG. 31, the atoms (Y) contained is distributed such that the concentration C gradually and continuously increases from $C_{311}$ to $C_{312}$ from the position $_B$ to the position $t_{311}$ and remains at a constant value $C_{313}$ from the position $t_{311}$ to the position $t_T$.

Figure 32:
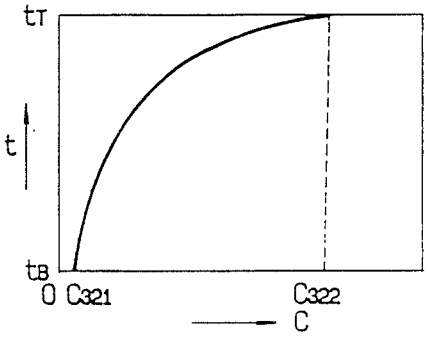

In the example shown in FIG. 32, the atoms (Y) contained is distributed such that the concentration C gradually and continuously increases from $C_{321}$ to $C_{322}$ from the position $t_B$ to the position $t_T$.

Figure 33:
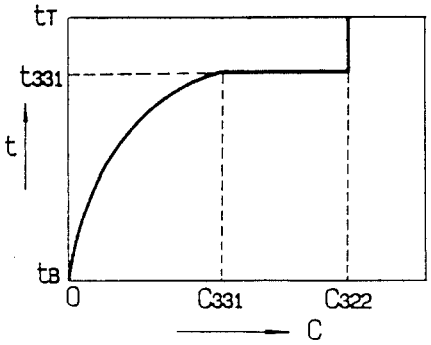

In the example shown in FIG. 33, the atoms (Y) contained is distributed such that the concentration C gradually and continuously increases from substantially zero to $C_{331}$ from the position $t_B$ to the position $t_{331}$ and remains constant at $C_{332}$ between position $t_{331}$ and position $t_T$.

Figure 34:
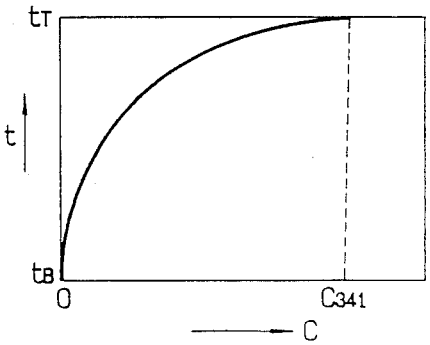

In the example shown in FIG. 34, the atoms (Y) contained is distributed such that the concentration C gradually and continuously increases from substantially zero to $C_{341}$ from the position $t_B$ to the position $t_T$.

Figure 35:
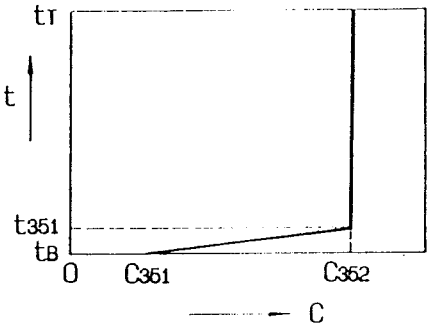

In the example shown in FIG. 35, the atoms (Y) contained is distributed such that the concentration C linearly increases from $C_{351}$ to $C_{352}$ from the position $t_B$ to the position $t_{351}$, and remains constant at $C_{352}$ from the position $t_{351}$ to the position $t_T$.

Figure 36:
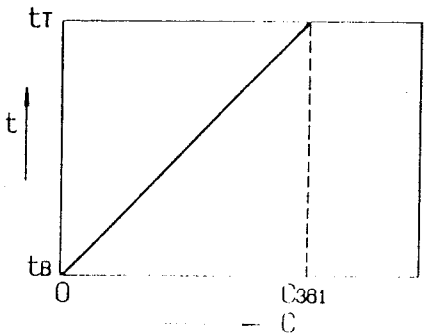

In the example shown in FIG. 36, the atoms (Y) contained is distributed such that the concentration C linearly increases from $C_{361}$ to $C_{362}$ from the position $t_B$ to the position $t_T$.

The atoms (M) to control the conductivity can include so-called impurities in the field of the semiconductor, and those used in this invention include atoms belonging to the group III of the periodical table giving p type conduction (hereinafter simply referred to as "group III atoms"), or atoms belonging to the group V of the periodical table except for nitrogen atoms (N) giving n-type conduction (hereinafter simply referred to as "group V atoms") and atoms belonging to the group VI of the periodical table except oxygen atoms (O) (hereinafter simply referred to as "group VI atoms").

Examples of the group III atoms can include B (boron), Al (aluminum), Ga (gallium), In (indium), Tl (thallium), etc., B, Al, Ga being particularly preferred. Examples of the group V atoms can include, specifically, P (phosphorus), As (arsenic), Sb (antimony), Bi (bismuth), P, As being particularly preferred. Examples of the group VI atoms can include, specifically, S (sulfur), Se (selenium), Te (tellurium) and Po (polonium), S and Se being particularly preferred. Incorporation of group III atoms, group V atoms or group VI atoms as the atoms (M) to control the conductivity into the layer region (M) in the present invention, can provide the effect, mainly, of controlling the conduction type and/or conductivity, and/or the effect of improving the charge injection between the layer region (M) and the layer region of the upper region other the layer region (M).

In the layer region (M), the content of atoms (M) to control the conductivity is preferably $1\times10^{-3}$–$5\times10^{4}$ atom-ppm, more preferably, $1\times10^{-2}$–$1\times10^{4}$ atom-ppm and, most preferably, $1\times10^{-1}$–$5\times10^{3}$ atom-ppm. Particularly, in a case where the layer region (M) contains carbon atoms (C), and/or nitrogen atoms (N), and/or oxygen atoms (O) described later by $1\times10^{3}$ atom-ppm, the layer region (M) contains atoms (M) to control the conductivity preferably from $1\times10^{-3}$–$1\times10^{3}$ atom-ppm and, in a case if the content of the carbon atoms (C) and/or nitrogen atom (N) and/or oxygen atom (O) is in excess of $1\times10^{3}$ atom-ppm, the content of the atoms (M) to control the conductivity is preferably $1\times10^{-1}$–$5\times10^{4}$ atom-ppm.

According to this invention, incorporation of the carbon atoms (C) and/or nitrogen atoms (N) and/or oxygen atoms (O) in the layer region (CNO) can mainly obtain an effect of increasing the dark resistance and/or hardness, and/or improving the control for the spectral sensitivity and/or enhancing the close bondability between the layer region (CNO) and the layer region of the upper layer other than the layer region (CNO). The content of carbon atoms (C), and/or nitrogen atoms (N) and/or oxygen atoms (O) in the layer region (CNO) is preferably $1-9\times10^5$ atom-ppm, preferably, $1\times10^1-5\times10^5$ atom-ppm and most more preferably, $1\times10^2-3\times10^5$ atom-ppm. In addition, if it is intended to increase the dark resistance and/or the hardness, the content is preferably $1\times10^3-9\times10^5$ atom-ppm and, preferably, it is $1\times10^2-5\times10^5$ atom-ppm in a case where the spectral sensitivity is intended to be controlled.

In this invention, the spectral sensitivity can be controlled mainly and, particularly, sensitivity to the light of longer wave length can be improved in the case of using light of longer wavelength such as of a semiconductor laser by incorporating germanium atoms (Ge) and/or tin atoms (Sn) to the layer region (GS). The content of germanium atoms (Ge) and/or tin atoms (Sn) contained in the layer region is preferably $1-9.5\times10^5$ atom-ppm, more preferably, $1\times10^2-8\times10^5$ atom-ppm and, most suitably, $5\times10^2-7\times10^5$ atom-ppm.

In addition, hydrogen atoms (H) and/or halogen atoms (X) contained in the upper layer in this invention can compensate the unbonded bands of silicon atoms (Si), thereby improving the quality of the layer. The content of hydrogen atoms (H) or the sum of the hydrogen atoms (H) and halogen atoms (X) in the upper layer is suitably $1\times10^3-7\times10^5$ atom-ppm, while the content of halogen atoms (X) is preferably $1-4\times10^5$ atom-ppm. Particularly, in a case where the content of the carbon atoms (C), and/or nitrogen atoms (N) and/or oxygen atoms (O) in the upper layer is less than $3\times10^5$ atom-ppm, the content of hydrogen atoms (H) or the sum of hydrogen atoms (H) and halogen atoms (X) is desirably $1\times10^3-4\times10^5$ atom-ppm. Furthermore, in a case where the upper layer is composed of poly-Si(H,X), the content of hydrogen atoms (H) or the sum of hydrogen atoms (H) and halogen atoms (X) in the upper layer is preferably $1\times10^3-2\times10^5$ atom-ppm and in a case where the upper layer is composed of A-Si(H,X), it is preferably $1\times10^4-7\times10^5$ atom-ppm.

In this invention, the content of at least one of alkali metal, alkaline earth metal and transition metal in the upper layer is preferably $1\times10^{-3}-1\times10^4$ atom-ppm, more preferably, $1\times10^{-2}-1\times10^3$ atom-ppm and most suitably $5\times10^{-2}-5\times10^2$ atom-ppm.

In this invention, the upper layer composed of Non-Si(H,X) can be prepared by the same vacuum deposition film formation as that for the lower layer described above, and glow discharge, sputtering, ion plating, HRCVD process, FOCVD process are particularly preferred. These methods may be used in combination in one identical device system.

For instance, the glow discharge method may be performed in the following manner to form the upper layer composed of Non-Si(H,X). The raw material gases are introduced into an evacuatable deposition chamber and glow discharge is performed with the gases being introduced at a desired pressure, so that a layer of Non-Si(H,X) is formed as required on the surface of the support situated at a predetermined position and previously formed with a predetermined lower layer. The raw material gases may contain a gas to supply silicon atoms (Si), a gas to supply hydrogen atoms (H), and/or a gas to supply halogen atoms (X), an optional gas to supply atoms (M) to control the conductivity, and/or a gas to supply carbon atoms (C), and/or a gas to supply nitrogen atoms (N), and/or a gas to supply oxygen atoms (O), and/or a gas to supply germanium atoms (Ge), and/or a gas to supply tin atoms (Sn) and/or a gas to supply at least one of alkali metal, alkaline earth metal and transition metal.

The HRCVD process may be performed in the following manner to form the upper layer composed of Non-Si(H,X). The raw material gases are introduced individually or altogether into an evacuatable deposition chamber, and glow discharge performed or the gases are heated with the gases being introduced at a desired pressure, during which active substance (A) is formed and another active substance (B) is introduced into the deposition chamber, so that a layer of Non-Si(H,X) is formed as required on the surface of the support situated at a predetermined position and formed with a predetermined lower layer thereon in the deposition chamber. The raw material gases may contain a gas to supply silicon atoms (Si), a gas to supply halogen atoms (X), an optional gas to control conductivity (M), and/or a gas to supply carbon atoms (C), and/or a gas to supply nitrogen atoms (N), and/or a gas to supply oxygen atoms (O), and/or a gas to supply germanium atoms (Ge), and/or a gas to supply tin atoms (Sn) and/or a gas to supply at least one of alkali metal, alkaline earth metal and transition metal. Another active substance (B) is formed by introducing a gas to supply hydrogen activation space. The active substance (A) and another active substance (B) may individually be introduced into the deposition chamber.

The FOCVD process may be performed in the following manner to form the upper layer of Non-Si(H,X). The raw material gases are introduced into an evacuatable deposition chamber individually or altogether as required under a desired gas pressure. The raw material gases may contain a gas to supply silicon atoms (Si), a gas to supply hydrogen atoms (H), an optional gas to supply atoms (M) to control conductivity, and/or a gas to supply carbon atoms (C), and/or a gas to supply nitrogen atoms (N), and/or a gas to supply oxygen atoms (O), and/or a gas to supply germanium atoms (Ge), and/or a gas to supply tin atoms (Sn) and/or a gas to supply at least one of alkali metal, alkaline earth metal and transition metals. They may be introduced into the deposition chamber individually or altogether as required. A halogen (X) gas is introduced into the deposition chamber separately from the raw material gases described above and these gases subjected to chemical reactions in the deposition chamber.

The sputtering method or the ion plating method may performed in the following manner to form the upper layer composed of the Non-Si(H,X), basically, by the known method as described for example, in Japanese Patent Laid-Open No. Sho 61-59342.

According to this invention, the upper layer is formed, while controlling the profile of the concentration C of atoms (M) to control the conductivity, carbon atoms (C), nitrogen atoms (N), oxygen atoms (O), germanium atoms (Ge), tin atoms (Sn) and at least one of alkali metal atoms, alkaline earth metal atoms and transition metal atoms (simply referred to collectively as "atoms (Z)") across the layer thickness to obtain a layer having a desired depth profile across the layer thickness. This can be achieved, in the case of glow discharge, HRCVD and FOCVD, by properly controlling the gas flow rate of a gas to supply atoms (Z) the concentration of which is to be varied in accordance with a desired rate of change in the concentration and then introducing the gas into the deposition chamber.

The flow rate may be changed by operating a needle valve disposed in the gas passage manually or by means of a customary means such as an external driving motor.

Alternatively, the flow rate setting to a mass flow controller for the control of the gas flow rate is properly changed by an adequate means manually or using a programmable control device.

The gas to supply Si atoms used in this invention can include gaseous or gasifiable silicon hydrides (silanes) such as $SiH_4$, $Si_2H_6$, $Si_3H_8$ and $Si_4H_{10}$. $SiH_4$ and $Si_2H_6$ are preferable from the standpoint of ease of handling and the. efficient supply of Si. These gases to supply Si may be diluted with an inert gas such as $H_2$, He, Ar and Ne if necessary.

According to the present invention, the gas to supply halogen includes various halogen compounds, for example, gaseous and gasifiable halogen compounds, for example, halogen gases, halides, interhalogen compounds and halogen-substituted silane derivatives.

Additional examples in this invention can include, gaseous or gasifiable halogen atom (X)-containing silicon hydride compounds composed of silicon atoms (Si) and halogen atoms (X).

Halogen compounds that can be suitably used in this invention can include halogen gases such as of fluorine, chlorine, bromine and iodine; and interhalogen compounds such as BrF, ClF, $ClF_3$, $BrF_5$, $BrF_3$, $IF_3$, $IF_7$ ICl and IBr.

Examples of the halogen atoms (X)-containing silicon compounds, or halogen atom (X)-substituted silane derivatives can include, specifically, silicon halides such as $SiF_4$, $Si_2F_6$, $SiCl_4$ and $SiBr_4$.

In the case where the halogen-containing silicon compound is used to form the light receiving member for use in electrophotography according to this invention by the glow discharge or HRCVD method, it is possible to form the upper layer composed of Non-Si(H,X) containing halogen atoms (X) on a desired lower layer without using a silico-hydride gas to supply Si atoms.

In the case where the upper layer containing halogen atoms (X) is formed according to the glow discharge or HRCVD method, a silicon halide gas is used as the gas to supply silicon atoms to form the upper layer on a desired support. The silicon halide gas may further be mixed with hydrogen gas or a hydrogen atom (H)-containing silicon compound gas to facilitate the introduction of hydrogen atoms (H) at a desired level.

The above-mentioned gases may be used individually or in combination with one another at a desired mixing ratio.

In this invention, the above-mentioned halogen compounds or halogen atom (X)-containing silicon compounds are used as effective material as the gas to supply halogen atoms, but gaseous or gasifiable hydrogen halides such as HF, HCl, HBr and HI; and halogen-substituted silicohydrides such as $SiH_3F$, $SiH_2F_2$, $SiHF_3$, $SiH_2I_1$, $SiH_2Cl_2$, $SiHCl_3$, $SiH_2Br_2$ and $SiBr_3$ can also be used. Among them, hydrogen atom (H)-containing halides can be used as preferably halogen supply gases in this invention upon forming the upper layer, because they supply the upper layer with halogen atoms (X), as well as hydrogen atoms (H) which are very effective for the control of electric or photoelectric characteristics.

The introduction of hydrogen atoms (H) into the upper layer may also be accomplished in another method by inducing discharge in the deposition chamber containing $H_2$ or silicoharide such as $SiH_4$, $Si_2H$ , $Si_3H_8$ and $Si_4H_{10}$ and a silicon compound to supply silicon atoms (Si).

The amount of hydrogen atoms (H) and/or halogen atoms (X) to be introduced into the upper layer may be controlled by regulating the temperature of the support, the amount of raw materials for hydrogen atoms and halogen atoms to be introduced into the deposition chamber and/or the electric power for discharge.

The upper layer may contain atoms (M) to control the conductivity, for example, group III atoms, group V atoms or group VI atoms. This is accomplished by introducing into the deposition chamber the raw materials to form the upper layer together with a raw materials to supply group III atoms, raw materials to supply group V atoms or raw material to supply group VI atoms. The raw material to supply group III atoms, the raw material to supply group V atoms, or the raw material to supply group VI atoms may be gaseous at normal temperature and under normal pressure or gasifiable under the layer forming conditions are desirably used. The raw material to supply the group III atoms can include specifically boron hydrides such as $B_2H_6$. $B_4H_{10}$, $B_4H_9$, $B_5H_{11}$, $B_6H_{10}$, $B_6H_{12}$ and $B_6H_{14}$ or boron harides such as $BF_3$, $BCl_3$ and $BBr_3$ for the material to supply boron atoms. Additional examples are $AlCl_3$, $GaCl_3$, $Ga(CH_3)_3$, $InCl_3$ and $TlCl_3$.

The raw material to supply group V atoms that can be used effectively in this present invention can include, phosphorus hydride such as $PH_3$, $P_2H_4$, etc. phosphorus halide such as $PH_4I$, $PF_3$, $PF_5$, $PCl_3$, $PCl_5$, $PBr_3$, $PBr_5$ and $PI_3$ as the material to supply phosphorus atoms.

Additional examples as effective raw materials to supply group V atoms can also include $AsH_3$, $AsF_3$, $AsCl_3AsBr_3$, $AsF_5$, $SbH_3$, $SbF_3$, $SbF_5$, $SbCl_3$, $SbCl_5$, $BiH_3$, $BiCl_3$, $BiBr_3$.

Raw materials to supply groups VI atoms can include those gaseous or gasifiable materials such as hydrogen sulfide ($H_2S$), $SF_4$, $SV_6$, $SO_2$, $SO_2F_2$, COS, $CS_2$, $CH_3SH$, $C_2H_5SH$, $C_4H_4S$, $(CH_3)_2S$, $C_2H_5)_2S$, etc. Additional example can include, those gaseous or gasifiable materials such as $SeH_2$, $SeF_6$, $(CH_3)_2Se$, $(C_2H_5)_2Se$, $TeH_2$, $TeF_6$, $(CH_3)_2Te$, $(C_2H_5)_2Te$.

The raw material for supplying atoms (M) to control the conductivity may be diluted with an inert gas such as $H_2$, He, Ar and Ne if necessary.

The upper layer may contain carbon atoms (C), nitrogen atoms (N) or oxygen atoms (O). This accomplished by introducing into the chamber the raw material to supply carbon atoms (C), the raw material to supply nitrogen atoms (N) or raw material to supply oxygen atoms (O) in a gaseous form together with other raw materials for forming the upper layer. The raw material to supply carbon atoms (C), the raw material to supply nitrogen atoms (N) or the raw material to supply oxygen atoms (O) are desirably gaseous at normal temperature and under normal pressure or gasifiable under the layer forming conditions.

A raw material that can effectively be used as the starting gas to supply carbon atoms (C) can include those hydrocarbons having C and H as constituent atoms, for example, saturated hydrocarbons having 1 to 4 carbon atoms, ethylene series hydrocarbons having 2 to 4 carbon atoms and acetylene series hydrocarbon atoms 2 to 3 carbon atoms.

Examples of the saturated hydrocarbons include methane ($CH_4$), ethane ($C_2H_5$), propane , n-butane (n-$C_4H_{10}$), pentane (Examples of ethylene series hydrocarbons include ethylene ($C_2H_4$), propylene butene-1), butene-2, isobutylene and pentene ($C_5H_{10}$). Examples of acetylene series hydrocarbon can include, acetylene ($C_2H_2$), methylacetylene ) and butine ($C_4H_6$).

Additional example can include halogenated hydrocarbon gases such as $CF_4$, $CCl_4$ and $CH_3CF_3$ with a view point that halogen atom (X) can be introduced in addition to hydrocarbons (C).

Examples of the raw materials gas to introduce nitrogen atoms (N) can include those having N as constituent atoms, or N and H as constituent atoms, for example, gaseous or gasifiable nitrogen, or nitrogen compounds such as nitrides and azides, for example, nitrogen ($N_2$), ammonia ($NH_3$), hydrazine ($H_2NNH_2$), hydrogen azide ($HN_3$) and ammonium azide ($NH_4N_3$). Additional examples can include halogenated nitrogen compounds such as nitrogen trifluoride ($F_3N$) and nitrogen tetrafluoride ($F_4N_2$), etc. which can introduce nitrogen atoms as well as halogen atoms (X).

Examples of the raw material gas to introduce oxygen atoms (O) can include oxygen ($O_2$), ozone ($O_3$), nitrogen monoxide (NO), nitrogen dioxide ($NO_2$), dinitrogen oxide ($N_2O$), dinitrogen trioxide ($N_2O_3$), trinitrogen tetraoxide ($N_3O_4$), dinitrogen pentaoxide ($N_2O_5$) and nitrogen trioxide ($NO_3$), as well as lower siloxanes having silicon atoms (Si), oxygen atoms (O) and hydrogen atoms (H) as constituent atoms, for example, disiloxane ($H_3SiOSiH_3$) and trisiloxane ($H_3SiOSiH_2OSiH_3$).

The upper layer may be introduced with germanium (Ge) or tin atoms (Sn). This is accomplished by introducing, into the deposition chamber, the raw material to supply germanium (Ge) or the raw material to supply tin atoms (Sn) into the deposition chamber together with other raw materials to form the upper layer in a gaseous form. The raw material to supply germanium (Ge) or the raw material to supply tin atoms (Sn) may desirably be gaseous at normal temperature and normal pressure or gasifiable under the layer forming conditions.

The material that can be used as a gas to supply germanium atoms (Ge) can include, gaseous or gasifiable germanium hydrides such as $GeH_4$, $Ge_2H_6$, $Ge_3H_8$ and $Ge_4H_{10}$. and $GeH_4$, $Ge_2H_6$ and $Ge_3H_8$ being preferable from the standpoint of easy handling at the time of layer forming and the efficient supply of germanium atoms (Ge).

Additional examples of the raw material for effectively forming the upper layer can include those gaseous or gasifiable materials such as germanium hydride-halides, for example, $GeHF_3$, $GeH_2F_2$, $GeH_3F$, $GeHCl_3$, $GeH_2Cl_2$, $GeH_3Cl$, $GeHBr_3$, $GeH_2Br_2$. $GeH_3Br$, $GeHI_3$, $GeH_2I_2$ and $GeH_3I$, as well as germanium halides such as $GeF_4$, $GeCl_4$, $GeBr_4$, $GeI_4$, $GeF_2$, $GeCl_2$, $GeBr_2$ and $GeI_2$.

The material that can be used as a gas to supply tin atoms (Sn) can include gaseous or gasifiable tin hydrides such as $SnH_4$, $Sn_2H_6$, $Sn_3H_8$ and $Sn_4H_{10}$ and $SnH_4$, $Sn_2H_6$ and $Sn_3H_8$ being preferred from the standpoint of easy handling at the time of layer forming and the efficient supply of tin atoms (Sn).

Additional examples of the starting material for effectively forming the upper layer can include gaseous or gasifiable tin halide-hydrides such as $SnHF_3$, $SnH_2F_2$, $SnH_3F$, $SnHCl_3$, $SnH_2Cl_2$, $SnH_3Cl$, $SnHBr_3$, $SnH_2Br_2$, $SnH_3Br$, $SnHI_3$, $SnH_2I_2$ and $SnH_3I$, as well as tin halides such as $SnF_4$, $SnCl_4$, $SnBr_4$, $SnI_4$, $SnF_2$, $SnCl_2$, $SnBr_2$ and $SnI_2$.

The lower layer may contain magnesium atoms (Mg). This accomplished by introducing, into the deposition chamber, the raw materials for supplying magnesium atoms (Mg) to form the upper layer together with other raw materials for forming the upper layer in a gaseous form. The raw material to supply magnesium atoms (Mg) may be gaseous at normal temperature and a normal pressure or gasifiable under the layer forming conditions.

The substance that can be used as a gas to supply magnesium atoms (Mg) can include organometallic compounds containing magnesium atoms (Mg). Bis(cyclopentadienyl)magnesium (II) complex salt ($Mg(C_{56})_2$) is preferable from the stand point of easy handling at the time of layer form an the effective supply of magnesium atoms (Mg).

The gas to supply magnesium atoms (Mg) may be diluted with an inert gas such as $H_2$, He, Ar and Ne if necessary.

The upper layer may contain copper atoms (Cu). This is accomplished by introducing, into the deposition chamber, the raw material to supply copper atoms (Cu) for forming the upper layer together with other raw materials for forming the upper layer in a gaseous form. The raw material to supply copper atoms (Cu) may be gaseous at normal temperature and normal pressure and gasifiable under the layer forming condition.

The material that can be used as a gas to supply copper atoms (Cu) can include organometallic compounds containing copper atoms (Cu). Copper (II)bisdimethylglyoximate $CU(C_4N_2O_2)_2$ is preferred from the stand point of easy handling at the time of layer forming and efficient supply of magnesium atoms (Mg).

The gas to supply copper atoms (Cu) may be diluted with an inert gas such as $H_2$. He, Ar and Ne, if necessary.

The upper layer may contain sodium atoms (Na), yttrium atoms (Y), manganese atoms (Mn) or zinc atoms (Zn). This is accomplished by introducing, into the deposition chamber, raw material to supply sodium atoms (Na), the raw material to supply yttrium atoms (Y), the raw material to supply manganese atoms (Mn) or the raw materials to supply zinc atoms (Zn) for forming the upper layer together with other raw materials for forming the upper layer in a gaseous form. The raw material to supply sodium atoms (Na), the raw material to supply yttrium atoms (Y), the raw material to supply manganese atoms (Mn) or the raw material to supply zinc atoms (Zn) may be gaseous at normal temperature and normal pressure or gasifiable at least under the layer forming conditions.

The material that can be effectively used as a gas to supply sodium atoms (Na) can include sodium amine ($NaNH_2$) and organometallic compounds containing sodium atoms (Na). Among them, sodium amine ($NaNH_2$) is preferred from the standpoint of easy handling at the time of layer forming and the efficient supply of sodium atoms (Na).

The material that can be effectively used as a gas to supply yttrium atoms (Y) can include organometallic compounds containing ytrrium atoms (Y). Triisopropanol yttrium $Y(Oi\text{-}C_3H_7)_3$ is preferred from the standpoint of easy handling at the time of layer forming and the effective supply of yttrium atoms (Y).

The material can be effectively used as a gas to supply manganese atoms (Mn) can include organometallic compounds containing manganese atoms (Mn). Monomethylpentacarbonyl manganese $Mn(CH_3)(CO)_5$ is preferred from the standpoint of easy handling at the time of layer forming and the efficient supply of manganese atoms (Mn).

The material that can be effectively used as a gas to supply zinc atoms (Zn) can include organometallic compounds containing Zinc atoms (Zn). Diethyl zinc $Zn(C_2H_5)_2$ is preferred from the standpoint of easy handling at the time of layer forming and the efficient supply of zinc atoms (Zn).

The gas to supply sodium atoms (Na), yttrium atoms (Y), manganese atoms (Mn) or zinc atoms (Zn) may be diluted with an inert gas such as $H_2$, He, Ar and Ne, if necessary.

In the present invention, the layer thickness of the upper layer is 1–130 um, preferably, 3–100 um and, most suitably, 5–60 um from the standpoint of the desired electrophotographic characteristics and economical effect.

In order to form the upper layer composed of Non-Si(H,X) which has the characteristics to achieve the object of this invention, it is necessary to properly establish the gas pressure in the deposition chamber and the temperature of the support.

The gas pressure in the deposition chamber should properly be selected according to the design of the layer. It is usually $1\times10^{-5}$–10 Torr, preferably, $1\times10^{-4}$–3 Torr and, most suitably, $1\times10^{-4}$–1 Torr. In the case of selecting A-Si(H, X) as the Non-Si(H,X) for the upper layer, the temperature (Ts) of the support should properly be selected according to the desired design for the layer and it is usually 50°–400° C., preferably, 100°–300° C. In a case where poly-Si(H,X) is selected as the Non-Si(H,X) for the upper layer, there are various methods for forming the layer including, for example, the following methods.

In one method, the temperature of the support is set to a high temperature, specifically, to 400°–600° C. and a film is deposited on the support by means of the plasma CVD process.

In another method, an amorphous layer is formed at first to the surface of the support. That is, a film is formed on a support heated to a temperature of about 250° C. by a plasma CVD process and the amorphous layer is annealed into a polycrystalline layer. The annealing is conducted by heating the support to 400°–600° C. about for 5–30 min, or applying laser beams for about 5–30 min.

Upon forming the upper layer composed of Non-Si(H,X) by the glow discharge method according to this invention, it is necessary to properly select the discharge electric power to be supplied to the deposition chamber according to the design of the layer. It is usually $5\times10^{-5}$–10 W/cm$^3$, preferably, $5\times10^{-5}$–5 W/cm$^3$ and, most suitably, $1\times10^{-3}$–$2\times10^{-1}$ W/cm$^3$.

The gas pressure of the deposition chamber, the temperature of the support and the discharge electric power to be supplied to the deposition chamber mentioned above should be set interdependently so that the upper layer having the desired characteristic properties can be formed.

EFFECT OF THE INVENTION

The light receiving member for use in electrophotography according to this invention, having the specific layer structure as described above, can overcome all of the problems in the conventional light receiving members for use in electrophotography constituted with A-Si and it can exhibit particularly excellent electrical properties, optical properties, photoconductive properties, image properties, durability and characteristics in the circumstance of use.

Particularly, since the lower layer contains aluminum atoms (Al), silicon atoms (Si) and, particularly, hydrogen atoms (H) across the layer thickness in an unevenly distributed state according to the present invention, injection of charges (photocarriers) across the aluminum support and the upper layer can be improved and, moreover, since the texture and continuity for the constituent elements between the aluminum support and the upper layer is improved, image properties such as coarse image or dots can be improved thereby enabling to stably reproduce high quality images with clear half-tone and high resolving power.

In addition, it is possible to prevent image defects or peeling of Non-Si(H,X) films due to impactive mechanical pressure applied for a relatively short period of time to the light receiving member for use in electrophotography, thereby improving the durability and, further, stresses resulted from the difference in the heat expansion coefficients between aluminum support and Non-Si(H,X) film to prevent cracking or peeling in the No-Si(H,X) film to thereby enhance the yield of the productivity.

Incorporation of at least one of carbon atoms, nitrogen atoms and oxygen atoms into the layer region of the upper layer in adjacent with the lower layer can further improve the close bondability between the upper layer and the lower layer, to prevent the occurrence of image defects and peeling of the Non-Si(H,X) films thereby improving the durability.

Further, since atoms (Mc) to control the image quality are contained in the lower layer in addition to aluminum atoms (Al), silicon atoms (Si) and hydrogen atoms (H), the injection of photocarriers across the aluminum support and the upper layer is further improved and the transferability of the photocarriers in the lower layer is improved. Accordingly, image characteristics such as coarse image can be improved to stably reproduce a high quality image with clear half-tone and high resolving power.

Further, since halogen atoms contained in the lower layer contribute to compensate the dangling bonds of silicon atoms, aluminum atoms, etc. to attain more stable state in view of the texture and structure according to the present invention, remarkable improvement is made in view of the image characteristics such as coarse image or dots coupled with the foregoing effect due to the distribution of the silicon atoms, aluminum atoms and hydrogen atoms.

At least one of germanium atoms (Ge) and tin atoms (Sn) contain in the lower layer according to this invention contributes to significantly improve the injection of the photocarriers across the aluminum support and the upper layer, close bondability and the transferability of the photocarriers in the lower layer. This in turn provides remarkable improvement in the characteristics and durability of a light receiving member.

Particularly, at least one of alkali metal atoms, alkaline earth metal atoms and transition metal atoms contained in the upper layer according to the present invention provides an outstanding feature that the hydrogen atoms and/or halogen atoms contained in the lower layer are dispersed more effectively to prevent layer peeling resulted from the cohesion of hydrogen atoms and/or halogen atoms during long time use.

This contributes to significantly improve the injection of photocarriers and the close bondability across the aluminum support and the upper layer, and the transferability of photocarriers in the lower layer as described above. This also makes significant improvement in the property and durability of an image as obtained. These factors result in stable production of the light receiving member having a stable quality.

PREFERRED EMBODIMENT OF THE INVENTION

This invention will be described more specifically referring to examples but the invention is no way limited only thereto.

EXAMPLE 1

A light receiving member for use in electrophotography according to this invention was formed by radio frequency (hereinafter simply referred to as "RF") glow discharge decomposition.

FIG. 37 shows an apparatus for producing the light receiving member for use in electrophotography by the RF glow discharge decomposition, comprising a raw material gas supply device 1020 and a deposition device 1000.

In the figure, raw material gases for forming the respective layers in this invention were tightly sealed in gas cylinders 1071, 1072, 1073, 1074, 1075, 1076 and 1077, and a tightly sealed vessel 1078, in which the cylinder 1071 was for $SiH_4$ gas (99.99% purity), the cylinder 1072 was for $H_2$ gas (99.9999%), the cylinder 1073 was for $CH_4$ gas (99.999% purity), cylinder 1074 was for $PH_3$ gas diluted with $H_2$ gas (99.999% purity, hereinafter simply referred to as "$PH_3/H_2$"), the cylinder 1075 was for $B_2H_6$ gas diluted with $H_2$ gas (99.999% purity, hereinafter simply referred to as "$B_2H_6/H_2$"), the cylinder 1076 was for NO gas (99.9% purity), the cylinder 1077 was for He gas (99.999% purity), and the vessel 1078 was tightly sealed charged with $AlCl_3$ (99.99% purity).

In the figure, a cylindrical aluminum support 1005 had an outer diameter of 108 mm and a mirror-finished surface.

After confirming that valves 1051–1057 for the gas cylinders 1071–1077, flow-in valves 1031–1037 and a leak valve 1015 for the deposition chamber 1001 were closed and flow-out valves 1041–1047 and an auxiliary valve 1018 were opened, a main valve 1016 was at first opened to evacuate the deposition chamber 1001 and gas pipeways by a vacuum pump not illustrated.

Then, when the indication of a vacuum meter 1017 showed about $1\times10^{-3}$ Torr, the auxiliary valve 1018, the flow-out valves 1041–1047 were closed.

Then, the valves 1051–1057 were opened to introduce $SiH_4$ from the gas cylinder 1071, $H_2$ gas from the gas cylinder 1072, $CH_4$ gas from the gas cylinder 1073, $PH_3/H_2$ gas from the gas cylinder 1074, $B_2H_6/H_2$ gas from the gas cylinder 1075, NO gas from the gas cylinder 1076 and He gas from the gas cylinder 1077, and the pressures for the respective gases were adjusted to 2 $kg/cm^2$ by pressure controllers 1061–1067.

Then, the flow-in valves 1031–1037 were gradually opened to introduce the respective gases in mass flow controllers 1021–1027. In this case, since the He gas from the gas cylinder 1077 was passed through the tightly sealed vessel 1078 charged with $AlCl_3$, the $AlCl_3$ gas diluted with the He gas (hereinafter simply referred to as "$AlCl_3$/He") was introduced to the mass flow controller 1027.

The temperature of the cylindrical aluminum support 1005 disposed in the deposition chamber 1001 was heated to 250° C. by a heater 1014.

After completing the preparation for the film formation as described above, each of the lower and upper layers was formed on the cylindrical aluminum support 1005.

The lower layer was formed by gradually opening the flow-out valves 1041, 1042 and 1047, and the auxiliary valve 1018 thereby introducing the $SiH_4$ gas, $H_2$ gas and $AlCl_3$/He gas through the gas discharge aperture 1009 of a gas introduction pipe 1018 to the inside of the deposition chamber 1001. In this case, the gas flow rates were controlled by the respective mass flow controllers 1021, 1022 and 1027 such that the gas flow rates were set to 50 SCCM for $SiH_4$, 10 SCCM for $H_2$ gas, and 120 SCCM for $AlCl_3$/He. The pressure in the deposition chamber was controlled to 0.4 Torr by adjusting the opening of the main valve 1016 while observing the vacuum meter 1017. Then, RF power was introduced to the inside of the deposition chamber 1001 by way of an RF matching box 1012 while setting the power of a RF power source (not illustrated) to 5 $mW/cm^3$, to cause RF glow discharge, thereby starting the formation of the lower layer on the aluminum support. The mass flow controllers 1021, 1022 and 1027 were adjusted during formation of the lower layer such that the $SiH_4$ gas flow remains at a constant rate of 50 SCCM, the $H_2$ gas flow rate is increased at a constant ratio from 10 SCCM to 200 SCCM and the $AlCl_3$/He gas flow rate is decreased at a constant ratio from 120 SCCM to 40 SCCM. Then, when the lower layer of 0.05 um thickness was formed, the RF glow discharge was stopped and the entrance of the gas to the inside of the deposition chamber 1001 is interrupted by closing the flow-out valves 1041, 1042 and 1047 and the auxiliary valve 1018, to complete the formation of the lower layer.

Then, for forming the first layer region of the upper layer, the flow-out valves 1041, 1042 and 1046, and the auxiliary valve 1018 were gradually opened to flow $SiH_4$ gas, $H_2$ gas and NO gas through the gas discharge aperture 1009 of the gas introduction pipe 1008 into the deposition chamber 1001. In this case, respective mass flow controllers 1021, 1022 and 1026 were adjusted so that the $SiH_4$ gas flow rate was 100 SCCM, $H_2$ gas flow rate was 100 SCCM and NO gas flow rate was 30 SCCM. The pressure in the deposition chamber 1001 was controlled to 0.35 Torr by adjusting the opening of the main valve 1016 while observing the vacuum meter 1017. Then, RF power was introduced into the deposition chamber 1001 through the radio frequency matching box 1012 while setting the power of a RF power source (not illustrated) to 10 $mW/cm^3$, to cause RF glow discharge and start the formation of the first layer region of the upper layer over the lower layer. Then, when the first layer region of the upper layer with 3 um thickness was formed, the RF glow discharge was stopped and the flow of the gas into the deposition chamber 1001 was interrupted by closing the flow-out valves 1041, 1042 and 1046, and the auxiliary valve 1018, thereby completing the formation of the first layer region of the upper layer.

Then, for forming the second layer region of the upper layer, the flow-out valves 1041 and 1042, and the auxiliary valve 1018 were gradually opened to flow $SiH_4$ gas and $H_2$ gas through the gas discharge aperture 1009 of the gas introduction pipe 1008 into the deposition chamber 1001. In this case, respective mass flow controllers 1021 and 1022 were adjusted so that the $SiH_4$ gas flow rate was 300 SCCM and $H_2$ flow rate was 300 SCCM. The pressure in the deposition chamber 1001 was controlled to 0.5 Torr by adjusting the opening of the main valve 1016 while the observing the vacuum meter 1017. Then, RF power was introduced into the deposition chamber 1001 through the radio frequency matching box 1012 while setting the power of the RF power source (not illustrated) to 15 $mW/cm^3$, to cause the RF glow discharge and start the formation of the second layer region on the first layer region of the upper layer. Then, when the second layer region of the upper layer with 20 um thickness was formed, the RF glow discharge was stopped and the flow of the gas into the deposition chamber 1001 was interrupted by closing the flow-out valves 1041 and 1042, and the auxiliary valve 1018, thereby completing the formation of the second layer region of the upper layer.

Then, for forming the third layer region of the upper layer, the flow-out valves 1041 and 1043, and the auxiliary valve 1018 were gradually opened to flow $SiH_4$ gas and $CH_4$ gas through the gas discharge aperture 1009 of the gas introduction pipe 1008 into the deposition chamber 1001. In this case, respective mass flow controllers 1021 and 1023 were adjusted so that the $SiH_4$ gas flow rate was 50 SCCM and $CH_4$ flow rate was 500 SCCM. The pressure in the deposition chamber 1001 was controlled to 0.4 Torr by adjusting the opening of the main valve 1016 while observing the vacuum meter 1017. Then, RF power was introduced into the deposition chamber 1001 through the radio frequency matching box 1012 while setting the power of the RF power source (not illustrated) to 10 $mW/cm^3$, to cause the RF glow discharge and start the formation of the third layer region on the second layer region of the upper layer. Then, when the third layer region of the upper layer with 0.5 um thickness was formed, the RF glow discharge was stopped and the flow of the gas into the deposition chamber 1001 was interrupted by closing the flow-out valves 1041 and 1043, and the auxiliary valve 1018, thereby completing the formation of the third layer region of the upper layer.

The conditions for preparing the light receiving member for use in electrophotography described above are shown in Table 1.

It will be apparent that all of the flow-out valves other than those required for forming the respective layers were completely closed and, for avoiding the respective gases from remaining in the deposition chamber 1001 and in the pipeways from the flow-out valves 1041–1047 to the deposition chamber 1001, the flow-out valves 1041–1047 were closed, the auxiliary valve 1018 was opened and, further, the main valve was fully opened thereby evacuating the inside of the system once to a high vacuum degree as required.

Further, for forming the layer uniformly during this layer formation, the cylindrical aluminum support 1005 was rotated at a desired speed by a driving device not illustrated.

COMPARATIVE EXAMPLE 1

A light receiving member for use in electrophotography was prepared under the same preparation conditions as those in Example 1 except for not using $H_2$ gas upon forming the lower layer. The conditions for preparing the light receiving member for use in electrophotography are shown in Table 2.

The light receiving members for use in electrophotography thus prepared in Example 1 and Comparative Example 1 were set respectively to an electrophotographic apparatus, i.e., a copying machine NP-7550 manufactured by Canon Inc. and modified for experimental use and, when several electrophotographic properties were checked under various conditions, it was found that both of them had outstanding characteristics with voltage withstanding property in that no image defects were formed even if a high voltage was applied to the light receiving member for use in electrophotography by highly intensive corona discharge or frictional discharge by means of a cleaning agent.

Then, when the number of dots as the image characteristics were compared, it was found that the number of dots, particularly, the number of dots with less than 0.1 mm diameter of the light receiving member for use in electrophotography of Example 1 was less than $\frac{3}{4}$ of that of the light receiving member for use in electrophotography in Comparative Example 1. In addition, for comparing the "coarse image", when the image density was measured for circular regions each of 0.05 mm diameter assumed as one unit at 100 points and the scattering in the image density was evaluated, it was found that the scattering in the light receiving member for use in electrophotography of Example 1 was less than $\frac{2}{3}$ for that of the light receiving member for use in electrophotography in Comparative Example 1, and the light receiving member for use in electrophotography of Example 1 was excellent over the light receiving member for use in Electrophotography of Comparative Example 1 in view of the visual observation.

In addition, for comparing the occurrence of image defects and the peeling of the light receiving layer due to impactive mechanical pressure applied for a relatively short period of time to the light receiving member for use in electrophotography, when stainless steel balls of 3.5 mm diameter were fallen freely from the vertical height of 30 cm above the surface of the light receiving member for use in electrophotography and abutted against the surface of the light receiving member for use in electrophotography, to thereby measure the frequency of occurrence for cracks in the light receiving layer, it was found that the rate of occurrence in the light receiving member for use in electrophotography of Example 1 was less than 3/5 for that in the light receiving member for use in electrophotography of Comparative Example 1.

As has been described above, the light receiving member for use in electrophotography of Example 1 was superior to the light receiving member for use in electrophotography of Comparative Example 1.

EXAMPLE 2

A light receiving member for use in electrophotography was prepared in the same manner as in Example 1 except for changing the way of varying the $AlCl_3$/He gas flow rate in the lower layer, under the preparation conditions shown in Table 3 and, when evaluated in the same manner, satisfactory improvement was obtained to the dots, coarse image and peeling in the same manner as in Example 1.

EXAMPLE 3

A light receiving member for use in electrophotography was prepared in the same manner as in Example 1 except for not using the $CH_4$ gas in the upper layer of Example 1, under the preparation conditions shown in Table 4 and, when evaluated in the same manner, satisfactory improvement was obtained to the dots, coarse image and peeling in the same manner as in Example 1.

EXAMPLE 4

A light receiving member for use in electrophotography was prepared in the same manner as in Example 1 except for replacing the $PH_3/H_2$ gas cylinder with a He gas (99.9999% purity) cylinder and, further, using $SiF_4$ gas and $N_2$ gas from cylinder not illustrated in Example 1, under the preparation conditions shown in Table 5 and, when evaluated in the same manner, satisfactory improvement was obtained to the dots, coarse image and peeling in the same manner as in Example 1.

EXAMPLE 5

A light receiving member for use in electrophotography was prepared in the same manner as in Example 1 except for replacing the $B_2H_6/H_2$ gas cylinder with an Ar gas (99.9999% purity) cylinder and, further replacing the NO gas cylinder with a $NH_3$ gas (99.999% purity) cylinder in Example 1, under the preparation conditions shown in Table 6 and, when evaluated in the same manner, satisfactory improvement was obtained to the dots, coarse image and peeling in the same manner as in Example 1.

EXAMPLE 6

A light receiving member for use in electrophotography was prepared in the same manner as in Example 1 by further using $PH_3/H_2$ gas and $C_2H_6$ gas in the upper layer, under the preparation conditions shown in Table 7 and, when evaluated in the same manner, satisfactory improvement was obtained to dots, coarse image and peeling in the same manner as in Example 1.

EXAMPLE 7

A light receiving member for use in electrophotography was prepared in the same manner as in Example 1 by further using $SiF_4$ gas from a not illustrated cylinder in the upper layer, under the preparation conditions shown in Table 8 and, when evaluated in the same manner, satisfactory improvement was obtained to dots, coarse image and. peeling in the same manner as in Example 1.

EXAMPLE 8

A light receiving member for use in electrophotography was prepared in the same manner as in Example 1 by further using $N_2$ gas from a not illustrated cylinder in the upper layer, under the preparation conditions shown in Table 9 and, when evaluated in the same manner, satisfactory improvement was obtained to dots, coarse image and peeling in the same manner as in Example 1.

EXAMPLE 9

A light receiving member for use in electrophotography was prepared in the same manner as in Example 1 except for replacing the $CH_4$ gas cylinder with a $C_2H_2$ gas (99.9999% purity) cylinder in Example 1, under the preparation conditions shown in Table 10 and, when evaluated in the same manner, satisfactory improvement was obtained to the dots, coarse image and peeling in the same manner as in Example 1.

EXAMPLE 10

A light receiving member for use in electrophotography was prepared in the same manner as in Example 1 by replacing the NO gas cylinder with a $N_2$ gas cylinder in Example 1, under the preparation conditions shown in Table 11 and, when evaluated in the same manner, satisfactory improvement was obtained to the dots, coarse image and peeling in the same manner as in Example 1.

EXAMPLE 11

A light receiving member for use in electrophotography was prepared in the same manner as in Example 1 by replacing the NO gas cylinder with a $NH_3$ gas (99.999% purity) cylinder in Example 1, under the preparation conditions shown in Table 12 and, when evaluated in the same manner, satisfactory improvement was obtained to the dots, coarse image and peeling in the same manner as in Example 1.

EXAMPLE 12

A light receiving member for use in electrophotography was prepared in the same manner as in Example 6 by further using $SiF_4$ gas from a not illustrated cylinder in the upper layer, under the preparation conditions shown in Table 13 and, when evaluated in the same manner, satisfactory improvement was obtained to dots, coarse image and peeling in the same manner as in Example 6.

EXAMPLE 13

A light receiving member for use in electrophotography was prepared in the same manner as in Example 9 by further using $B_2H_6/H_2$ gas in the upper layer, under the preparation conditions shown in Table 14 and, when evaluated in the same manner, satisfactory improvement was obtained to dots, coarse image and peeling in the same manner as in Example 9.

EXAMPLE 14

A light receiving member for use in electrophotography was prepared in the same manner as in Example 11 by further using $PH_3/H_2$ gas in the upper layer, under the preparation conditions shown in Table 15 and, when evaluated in the same manner, satisfactory improvement was obtained to dots, coarse image and peeling in the same manner as in Example 11.

EXAMPLE 15

A light receiving member for use in electrophotography was prepared in the same manner as in Example 1 by further using $GeH_4$ from a not illustrated cylinder in the upper layer, under the preparation conditions shown in Table 16 and, when evaluated in the same manner, satisfactory improvement was obtained to dots, coarse image and peeling in the same manner as in Example 1.

EXAMPLE 16

A light receiving member for use in electrophotography was prepared in the same manner as in Example 1 by changing the outer diameter of the cylindrical aluminum support to 80 mm in Example 1, under the preparation conditions shown in Table 17 and, when evaluated in the same manner as in Example 1, except for using an electrophotographic apparatus, i.e., a copying machine NP-9030 manufactured by Canon Inc. and modified for the experimental use, satisfactory improvement was obtained to the dots, coarse image and peeling in the same manner as in Example 1.

EXAMPLE 17

A light receiving member for use in electrophotography was prepared in the same manner as in Example 1 by changing the outer diameter of the cylindrical aluminum support to 60 mm in Example 1, under the preparation conditions shown in Table 18 and, when evaluated in the same manner as in Example 1, except for using an electrophotographic apparatus, i.e., a copying machine NP-150Z manufactured by Canon Inc. and modified for the experimental use, satisfactory improvement was obtained to the dots, coarse image and peeling in the same manner as in Example 1.

EXAMPLE 18

A light receiving member for use in electrophotography was prepared in the same manner as in Example 1 by changing the outer diameter of the cylindrical aluminum support to 30 mm in Example 1, under the preparation conditions shown in Table 19 and, when evaluated in the same manner as in Example 1, except for using an electrophotographic apparatus, i.e., a copying machine FC-5 manufactured by Canon Inc. and modified for the experimental use, satisfactory improvement was obtained to the dots, coarse image and peeling in the same manner as in Example 1.

EXAMPLE 19

A light receiving member for use in electrophotography was prepared in the same manner as in Example 1 by changing the outer diameter of the cylindrical aluminum support to 15 mm in Example 1, under the preparation conditions shown in Table 20, and evaluated in the same manner as in Example 1 except for using an electrophotographic apparatus, manufactured for experimental use, satisfactory improvement was obtained to the dots, coarse image and peeling in the same manner as in Example 1.

EXAMPLE 20

A light sensitive member for use in electrophotography was prepared, under the same preparation conditions as those in Example 16 by using a cylindrical aluminum support applied with mirror-finishing fabrication in Example 16 and further machined into a cross sectional shape of: a=25 um, b=0.8 um as shown in FIG. 38 by a diamond point tool and, when evaluated in the same manner as in Example 16, satisfactory improvement was obtained to, the dots, coarse image and peeling in the same manner as in Example 16.

EXAMPLE 21

A light receiving member for use in electrophotography was prepared, under the same preparation conditions as those in Example 16 using a cylindrical aluminum support applied with mirror-finish fabrication and subsequently applied with a so-called surface dimpling of causing a number of hit pits to the surface of the cylindrical aluminum support by the exposure to a plurality of dropping bearing balls to form into a cross sectional shape of: c=50 um and d=1 um as shown in FIG. 39 and, when evaluated in the same manner as in Example 16, satisfactory improvement was be obtained for the dots, coarse image and peeling in the same as in Example 16.

EXAMPLE 22

A light receiving member for use in electrophotography having an upper layer comprising poly-Si(H, X) was prepared in the same manner as in Example 9 by using a cylindrical aluminum support heated to a temperature of 500° C., under the preparation conditions as shown in Table 21 and, when evaluated in the same manner, satisfactory improvement was obtained to dots, coarse image and peeling in the same manner as in Example 9.

EXAMPLE 23

A light receiving member for use in electrophotography according to this invention was formed by microwave (hereinafter simply referred to as "uW") glow discharge decomposition.

A production apparatus for the light receiving member for use in photography by the uW glow discharge decomposition shown in FIG. 41 was used, in which a decomposition device 1100 for use in the uW glow discharge decomposition shown in FIG. 40 was used instead of the deposition device 1000 in the production apparatus of RF glow discharge decomposition shown in FIG. 37, and it was connected with a raw material gas supply device 1020.

In the figure, a cylindrical aluminum support 1107 had 108 mm of outer diameter and mirror-finished surface.

At first, in the same manner as in Example 1, the inside of the deposition chamber 1101 and the gas pipeways was evacuated such that the pressure in the deposition chamber 1101 was $5\times10^{-6}$ Torr.

Then, in the same manner as in Example 1, the respective gases were introduced in the mass flow controllers 1021–1027. In this case, however, a $SiF_4$ gas cylinder was used in place of the $N_2$ gas cylinder.

Further, the cylindrical aluminum support 1107 disposed in the deposition chamber 1101 was heated to a temperature of 250° C. by a heater not illustrated.

After the preparation for the film formation was thus completed, each of the lower and the upper layers was formed on the cylindrical aluminum support 1107. The lower layer was formed by gradually opening the flow-out valves 1041, 1042 and 1047 and the auxiliary valve 1018, thereby flowing the $SiH_4$ gas, $H_2$ gas and $AlCl_3$/He gas through the gas discharge aperture not illustrated of the gas introduction pipe 1110 into a plasma generation region 1109. In this case, the gas flow rate was controlled by each of the mass flow controllers 1021, 1022 and 1027 such that $SiH_4$ gas flow rate was 150 SCCM, $H_2$ gas flow rate was 20 SCCM and $AlCl_3$ gas flow rate was 400 SCCM. The pressure in the deposition chamber 1101 was set to 0.6 mTorr by adjusting the opening of the main valve not illustrated while observing the vacuum meter not illustrated. Then, uW power was introduced by way of a wave guide portion 1103 and a dielectric window 1102 into a plasma generation region 1109 by setting the power for a uW power source not illustrated to 0.5 W/cm$^3$, to cause uW glow discharge and start the formation of the lower layer on the cylindrical aluminum support 1107. The mass flow controllers 1021, 1022 and 1027 were controlled such that the $SiH_4$ gas flow rate remained at a constant rate of 150 SCCM, the $H_2$ gas flow rate was increased at a constant ratio from 20 SCCM to 500 SCCM, the $AlCl_3$/He gas flow rate was reduced at a constant ratio from 400 SCCM to 80 SCCM for the 0.01 um on the support side, while reduced at a constant ratio from 80 SCCM to 50 SCCM for 0.01 um on the side of the upper layer during formation of the lower layer. When the lower layer of 0.02 um thickness was formed, the uW glow discharge was stopped, the flow-out valves 1041, 1042, 1047 and the auxiliary valve 1018 were closed to interrupt the flow of the gas into the plasma generation region 1109 thereby completing the formation of the lower layer.

Then, for forming the first layer region of the upper layer, the flow-out valves 1041, 1042, 1044, 1045 and 1046, and the auxiliary valve 1018 were gradually opened to flow $SiH_4$ gas, $H_2$ gas and $SIF_4$ gas, $B_2H_6lH_2$ and NO gas through the gas discharge aperture not illustrated of the gas introduction pipe 1110 into the plasma generation space 1109. In this case, respective mass flow controllers 1021, 1022, 1024, 1025 and 1026 were adjusted so that the $SiH_4$ gas flow rate was 3500 SCCM, $H_2$ gas flow rate was 350 SCCM, $SiF_4$ gas flow rate was 20 SCCM, $B_2H_6H_2$ gas flow rate was 600 ppm to the $SiH_4$ gas flow rate and NO gas flow rate was 13 SCCM. The pressure in the deposition chamber 1101 was controlled to 0.5 mTorr. Then, RF power was introduced into the plasma generation chamber 1109 while setting the power of RF power source (not illustrated) to 0.5 mW/cm$^3$, to cause uW glow discharge and start the formation of the first layer region of the upper layer over the lower layer. Then, the first layer region of 3 um thickness of the upper layer was formed.

Then, for forming the second layer region of the upper layer, the flow-out valves 1041, 1042 and 1044, and the auxiliary valve 1018 were gradually opened to flow $SiH_4$ gas, $H_2$ gas and $SiF_4$ gas through the gas discharge aperture not illustrated of the gas introduction pipe 1110 into the plasma generation space 1109. In this case, respective mass flow controllers 1021, 1022 and 1024 were adjusted so that the $SiH_4$ gas flow rate was 700 SCCM, $H_2$ gas flow rate was 500 SCCM and $SiF_4$ gas flow rate was 30 SCCM. The pressure in the deposition chamber 1101 was controlled to 0.5 mTorr. Then, the power of a uW power source (not illustrated) was set to 0.5 mW/cm$^3$, to cause uW glow discharge in the plasma generation region 1109 and form the second layer region with 20 um thickness of the upper layer on the first layer region of the upper layer.

Then, for forming the third layer region of the upper layer, the flow-out valves 1041 and 1043 and the auxiliary valve 1018 were gradually opened to flow $SiH_4$ gas and $CH_4$ gas through the gas discharge aperture not illustrated of the gas introduction pipe 1110 into the plasma generation space 1109. In this case, respective mass flow controllers 1021 and 1023 were adjusted so that the $SiH_4$ gas flow rate was 150 SCCM and $CH_4$ gas flow rate was 500 SCCM. The pressure in the deposition chamber 1101 was controlled to 0.3 mTorr. Then, the power of a uW power source (not illustrated) was set to 0.5 mW/cm$^3$, to cause uW glow discharge in the plasma generation region 1109 and the third layer region with 0.5 um thickness of the upper layer was formed on the second layer region of the upper layer.

The conditions for preparing the light receiving member for use in electrophotography described above are shown in Table 22.

When the light receiving member for use in electrophotography was evaluated in the same manner in Example 1, improvement was obtained to the dots, coarse image and peeling in the same manner as in Example 1.

EXAMPLE 24

A light receiving member for use in electrophotography was prepared in the same manner as in Example 1 by replacing the $CH_4$ gas cylinder with a $C_2H_2$ gas (99.9999% purity) cylinder in Example 1, under the preparation conditions shown in Table 23 and, when evaluated in the same manner, satisfactory improvement was obtained to the dots, coarse image and peeling in the same manner as in Example 1.

EXAMPLE 25

A light receiving member for use in electrophotography was prepared in the same manner as in Example 1 by replacing the No gas cylinder with a $N_2$ gas cylinder in Example 1, under the preparation conditions shown in Table 24 and, when evaluated in the same manner, satisfactory improvement was obtained to the dots, coarse image and peeling in the same manner as in Example 1.

EXAMPLE 26

A light receiving member for use in electrophotography was prepared in the same manner as in Example 1 by replacing the NO gas cylinder with a $NH_3$ gas (99.999% purity) cylinder in Example 1, under the preparation conditions shown in Table 25 and, when evaluated in the same manner, satisfactory improvement was obtained to the dots, coarse . image and peeling in the same manner as in Example 1.

EXAMPLE 27

A light receiving member for use in electrophotography was prepared in the same manner as in Example 6 by further using $SiF_4$ from a not illustrated cylinder in the upper layer, under the preparation conditions shown in Table 26 and, when evaluated in the same manner, satisfactory improvement was obtained to the dots, coarse image and peeling in the same manner as in Example 6.

EXAMPLE 28

A light receiving member for use in electrophotography was prepared in the same manner as in Example 9 by further using $B_2H_6lH_2$ gas in the upper layer, under the preparation conditions shown in Table 27 and, when evaluated in the same manner, satisfactory improvement was obtained to the dots, coarse image and peeling in the same manner as in Example 9.

EXAMPLE 29

A light receiving member for use in electrophotography was prepared in the same manner as in Example 11 by further using $PH_3/H_2$ gas in the upper layer, under the preparation conditions shown in Table 28 and, when evaluated in the same manner, satisfactory improvement was obtained to the dots, coarse image and peeling in the same manner as in Example 11.

EXAMPLE 30

A light receiving member for use in electrophotography was prepared in the same manner as in Example 1 by replacing the $PH_3/H_2$ gas cylinder with a He gas (99.999% purity) cylinder and further using $N_2$ gas from not illustrated cylinder in the Example 1, under the preparation conditions shown in Table 29 and, when evaluated in the same manner, satisfactory improvement was obtained to the dots, coarse image and peeling in the same manner as in Example 1.

EXAMPLE 31

A light receiving member for use in electrophotography was prepared in the same manner as in Example 1 by further using $PH_3/H_2$ gas, $C_2H_2$ gas and $SiF_4$ gas in the upper layer, under the preparation conditions shown in Table 30 and, when evaluated in the same manner, satisfactory improvement was obtained to the dots, coarse image and peeling in the same manner as in Example 1.

EXAMPLE 32

A light receiving member for use in electrophotography was prepared in the same manner as in Example 6 by further using $SiF_4$ gas from a not illustrated cylinder in the upper layer, under the preparation conditions shown in Table 31 and, when evaluated in the same manner, satisfactory improvement was obtained to the dots, coarse image and peeling in the same manner as in Example 6.

EXAMPLE 33

A light receiving member for use in electrophotography was prepared in the same manner as in Example 1 by further using $B_2H_6lH_2$ and $C_2H_2$ gas in the upper layer, under the preparation conditions shown in Table 32 and, when evaluated in the same manner, satisfactory improvement was obtained to the dots, coarse image and peeling in the same manner as in Example 1.

EXAMPLE 34

A light receiving member for use in electrophotography was prepared in the same manner as in Example 1 by further using $PH_3/H_2$ gas and $C_2H_2$ gas in the upper layer, under the preparation conditions shown in Table 33 and, when evaluated in the same manner, satisfactory improvement was obtained to the dots, coarse image and peeling in the same manner as in Example 1.

EXAMPLE 35

A light receiving member for use in electrophotography was prepared in the same manner as in Example 1 by further using $PH_3/H_2$ and $C_2H_2$ gas, $SiF_4$ gas and $H_2$ S gas in the upper layer, under the preparation conditions shown in Table 34 and, when evaluated in the same manner, satisfactory improvement was obtained to the dots, coarse image and peeling in the same manner as in Example 1.

EXAMPLE 36

A light receiving member for use in electrophotography was prepared in the same manner as in Example 1 by further using $B_2H_6$ gas upon forming the lower layer in Example 1, under the preparation conditions as shown in Table 35.

COMPARATIVE EXAMPLE 2

A light receiving member for use in electrophotography was prepared under the same preparation conditions as those in Example 36 except for not using gas and $H_2$ gas upon forming the lower layer. The conditions for preparing the light receiving member for use in electrophotography are shown in Table 36.

The light receiving members for use in electrophotography thus prepared in Example 36 and Comparative Example 2 were set respectively to an electrophotographic apparatus, i.e., a copying machine NP-7550 manufactured by Canon Inc. and modified for experimental use and, when several electrophotographic properties were checked under various conditions, it was found that both of them had outstanding characteristics with voltage withstanding property in that no image defects were formed even if a high voltage was applied to the light receiving member for use in electrophotography by highly intensive corona discharge or frictional discharge by means of a cleaning agent.

Then, when the number of dots as the image characteristics were compared, it was found that the number of dots, particularly, the number of dots with less than 0.1 mm diameter of the light receiving member for use in electrophotography of Example 24 was less than $\frac{3}{4}$ of that of the light receiving member for use in electrophotography in Comparative Example 2. In addition, for comparing the "coarse image", when the image density was measured for circular regions each of 0.05 mm diameter assumed as one unit at 100 points and the scattering in the image density was evaluated, it was found that the scattering in the light receiving member for use in electrophotography of Example 36 was less than $\frac{1}{2}$ for that of the light receiving member for use in electrophotography in Comparative Example 2, and the light receiving member for use in electrophotography of Example 1 was excellent over the light receiving member for use in Electrophotography of Comparative Example in view of the visual observation.

EXAMPLE 37

A light receiving member for use in electrophotography was prepared in the same manner as in Example 36 except for changing the way of varying the $AlCl_3$/He gas flow rate in the lower layer, under the preparation conditions shown in Table 37 and, when evaluated in the same manner, satisfactory improvement was obtained to the dots, coarse image and peeling in the same manner as in Example 36.

EXAMPLE 38

A light receiving member for use in electrophotography was prepared in the same manner as in Example 36 except for not using the $CH_4$ gas in the upper layer of Example 36, under the preparation conditions shown in Table 38 and, when evaluated in the same manner, satisfactory improvement was obtained to the dots, coarse image and peeling in the same manner as in Example 36.

EXAMPLE 39

A light receiving member for use in electrophotography was prepared in the same manner as in Example 36 except for replacing the $PH_3/H_2$ gas cylinder with a He gas (99.9999% purity) cylinder and, further, using $SiF_4$ gas and $N_2$ gas from cylinder not illustrated, under the preparation conditions shown in Table 39 and, when evaluated in the same manner, satisfactory improvement was obtained to the dots, coarse image and peeling in the same manner as in Example 36.

EXAMPLE 40

A light receiving member for use in electrophotography was prepared in the same manner as in Example 36 except for replacing the $B_2H_61H_2$ gas cylinder with an Ar gas (99.9999% purity) cylinder and, further replacing the NO gas cylinder with a $NH_3$ gas (99.999% purity) cylinder, under the preparation conditions shown in Table 40 and, when evaluated in the same manner, satisfactory improvement was obtained to the dots, coarse image and peeling in the same manner as in Example 36.

EXAMPLE 41

A light receiving member for use in electrophotography was prepared in the same manner as in Example 36 by further using $PH_3/H_2$ gas and $C_2H_2$ gas in the upper layer, under the preparation conditions shown in Table 41 and, when evaluated in the same manner, satisfactory improvement was obtained to dots, coarse image and peeling in the same manner as in Example 36.

EXAMPLE 42

A light receiving member for use in electrophotography was prepared in the same manner as in Example 36 by further using $SiF_4$ gas from a not illustrated cylinder in the upper layer under the preparation conditions shown in Table 42, and, when evaluated in the same manner, satisfactory improvement was obtained to dots, coarse image and peeling in the same manner as in Example 36.

EXAMPLE 43

A light receiving member for use in electrophotography was prepared in the same manner as in Example 36 by further using $N_2$ gas from a not illustrated cylinder in the upper layer, under the preparation conditions shown in Table 43 and, when evaluated in the same manner, satisfactory improvement was obtained to dots, coarse image and peeling in the same manner as in Example 36.

EXAMPLE 44

A light receiving member for use in electrophotography was prepared in the same manner as in Example 36 except for replacing the $CH_4$ gas cylinder with a $C_2H_2$ gas (99.9999% purity) cylinder in Example 36, under the preparation conditions shown in Table 44 and, when evaluated in the same manner, satisfactory improvement was obtained to the dots, coarse image and peeling in the same manner as in Example 36.

EXAMPLE 45

A light receiving member for use in electrophotography was prepared in the same manner as in Example 36 by replacing the NO gas cylinder with a $N_2$ gas cylinder in Example 36, under the preparation conditions shown in Table 45 and, when evaluated in the same manner, satisfactory improvement was obtained to the dots, coarse image and peeling in the same manner as in Example 36.

EXAMPLE 46

A light receiving member for use in electrophotography prepared in the same manner as in Example 36 by replacing the NO gas cylinder with a $NH_3$ gas (99.999% purity) cylinder in Example 36, under the preparation conditions shown in Table 46 and, when evaluated in the same manner, satisfactory improvement was obtained to the dots, coarse image and peeling in the same manner as in Example 36.

EXAMPLE 47

A light receiving member for use in electrophotography was prepared in the same manner as in Example 41 by further using $SiF_4$ gas from a not illustrated cylinder in the upper layer, under the preparation conditions shown in Table 47 and, when evaluated in the same manner, satisfactory improvement was obtained to dots, coarse image and peeling in the same manner as in Example 41.

EXAMPLE 48

A light receiving member for use in electrophotography was prepared in the same manner as in Example 44 by further using Bphd $2H_6/H_2$ gas in the upper layer, under the preparation conditions shown in Table 48 and, when evaluated in the same manner, satisfactory improvement was obtained to dots, coarse image and peeling in the same manner as in Example 44.

EXAMPLE 49

A light receiving member for use in electrophotography was prepared in the same manner as in Example 46 by further using $PH_3/H_2$ gas in the upper layer, under the preparation conditions shown in Table 49 and, when evaluated in the same manner, satisfactory improvement was obtained to dots, coarse image and peeling in the same manner as in Example 46.

EXAMPLE 50

A light receiving member for use in electrophotography was prepared in the same manner as in Example 36 by further using $GeH_4$ from a not illustrated cylinder in the upper layer, under the preparation conditions shown in Table 50 and, when evaluated in the same manner, satisfactory improvement was obtained to dots, coarse image and peeling in the same manner as in Example 36.

EXAMPLE 51

A light receiving member for use in electrophotography was prepared in the same manner as in Example 1 by changing the outer diameter of the cylindrical aluminum support to 80 mm in Example 36, under the preparation conditions shown in Table 51 and, when evaluated in the same manner as in Example 36, except for using an electrophotographic apparatus, i.e., a copying machine NP-9030 manufactured by Canon Inc. and modified for the experimental use, satisfactory improvement was obtained to the dots, coarse image and peeling in the same manner as in Example 36.

EXAMPLE 52

A light receiving member for use in electrophotography was prepared in the same manner as in Example 36 by changing the outer diameter of the cylindrical aluminum support to 60 mm in Example 36, under the preparation conditions shown in Table 52 and, when evaluated in the same manner as in Example 36, except for using an electrophotographic apparatus, i.e., a copying machine NP-150Z manufactured by Canon Inc. and modified for the experimental use, satisfactory improvement was obtained to the dots, coarse image and peeling in the same manner as in Example 36.

EXAMPLE 53

A light receiving member for use in electrophotography was prepared in the same manner as in Example 36 by changing the outer diameter of the cylindrical aluminum support to 30 mm in Example 36, under the preparation conditions shown in Table 53 and, when evaluated in the same manner as in Example 36, except for using an electrophotographic apparatus, i.e , a copying machine FC-5 manufactured by Canon Inc. and modified for the experimental use, satisfactory improvement was obtained to the dots, coarse image and peeling in the same manner as in Example 36.

EXAMPLE 54

A light receiving member for use in electrophotography was prepared in the same manner as in Example 36 by changing the outer diameter of the cylindrical aluminum support to 15 mm in Example 36, under the preparation conditions shown in Table 54, and evaluated in the same manner as in Example 36, except for using an electrophotographic apparatus, manufactured for experimental use, satisfactory improvement was obtained to the dots, coarse image and peeling in the same manner as in Example 36.

EXAMPLE 55

A light sensitive member for use in electrophotography was prepared, under the same preparation conditions as those in Example 51 by using a cylindrical aluminum support applied with mirror-finishing fabrication in Example 51 and further machined into a cross sectional shape of : a =25 um, b =0.8 um as shown in FIG. 38 by a diamond point tool and, when evaluated in the same manner as in Example 51, satisfactory improvement was obtained to, the dots, coarse image and peeling in the same manner as in Example 51.

EXAMPLES 56, 57

A light receiving member for use in electrophotography was prepared, under the same preparation conditions as those in Example 51 using a cylindrical aluminum support applied with mirror-finish fabrication and subsequently applied with a so-called surface dimpling of causing a number of hit pits to the surface of the cylindrical aluminum support by the exposure to a plurality of dropping bearing balls to form into a cross sectional shape of : c =50 um and d =1 um as shown in FIG. 39 and, when evaluated in the same manner as in Example 56, satisfactory improvement was be obtained for the dots, coarse image and peeling in the same as in Example 51.

EXAMPLE 58

A light receiving member for use in electrophotography was prepared by microwave glow discharge decomposition in the same manner as in Example 23 by further using $B_2H_6$ gas upon forming the lower layer in Example 23, under the preparation conditions shown in Table 56.

When the light receiving member for use in electrophotography was evaluated in the same manner as in Example 36, satisfactory improvement was obtained to the dots, coarse image and peeling in the same manner as in Example 36.

EXAMPLE 59

A light receiving member for use in electrophotography was prepared in the same manner as in Example 36 by replacing the $CH_4$ gas cylinder with a $C_2H_2$ gas (99.9999% purity) cylinder in Example 36, under the preparation conditions shown in Table 57 and, when evaluated in the same manner, satisfactory improvement was obtained to the dots, coarse image and peeling in the same manner as in Example 36.

EXAMPLE 60

A light receiving member for use in electrophotography was prepared in the same manner as in Example 36 by replacing the No gas cylinder with a $N_2$ gas cylinder in Example 36, under the preparation conditions shown in Table 58 and, when evaluated in the same manner, satisfactory improvement was obtained to the dots, coarse image and peeling in the same manner as in Example 36.

EXAMPLE 61

A light receiving member for use in electrophotography was prepared in the same manner as in Example 36 by replacing the NO gas cylinder with a $NH_3$ gas (99.999% purity) cylinder in Example 36, under the preparation conditions shown in Table 59 and, when evaluated in the same manner, satisfactory improvement was obtained to the dots, coarse image and peeling in the same manner as in Example 36.

EXAMPLE 62

A light receiving member for use in electrophotography was prepared in the same manner as in Example 41 by further using $SiF_4$ gas from a not illustrated cylinder in the upper layer, under the preparation conditions shown in Table 60 and, when evaluated in the same manner, satisfactory improvement was obtained to the dots, coarse image and peeling in the same manner as in Example 41.

EXAMPLE 63

A light receiving member for use in electrophotography was prepared in the same manner as in Example 44 by further using $B_2H_61H_2$ gas in the upper layer, under the preparation conditions shown in Table 61 and, when evaluated in the same manner, satisfactory improvement was obtained to the dots, coarse image and peeling in the same manner as in Example 44.

EXAMPLE 64

A light receiving member for use in electrophotography was prepared in the same manner as in Example 46 by further using $PH_3/H_2$ gas in the upper layer, under the preparation conditions shown in Table 62 and, when evaluated in the same manner, satisfactory improvement was obtained to the dots, coarse image and peeling in the same manner as in Example 46.

EXAMPLE 65

A light receiving member for use in electrophotography was prepared in the same manner as in Example 36 by replacing the $PH_3/H_2$ gas cylinder with a He gas (99.999% purity) cylinder and further using $N_2$ gas from a not illustrated cylinder in the Example 36, under the preparation conditions shown in Table 63 and, when evaluated in the same manner, satisfactory improvement was obtained to the dots, coarse image and peeling in the same manner as in Example 36.

EXAMPLE 66

A light receiving member for use in electrophotography was prepared in the same manner as in Example 36 by further using $PH_3/H_2$ gas, $C_2H_2$ gas and $SiF_4$ gas in the upper layer, under the preparation conditions shown in Table 64 and, when evaluated in the same manner, satisfactory improvement was obtained to the dots, coarse image and peeling in the same manner as in Example 36.

EXAMPLE 67

A light receiving member for use in electrophotography was prepared in the same manner as in Example 41 by further using $SiF_4$ gas from a not illustrated cylinder in the upper layer, under the preparation conditions shown in Table 65 and, when evaluated in the same manner, satisfactory improvement was obtained to the dots, coarse image and peeling in the same manner as in Example 41.

EXAMPLE 68

A light receiving member for use in electrophotography was prepared in the same manner as in Example 36 by further using $B_2H_6/H_2$ and $C_2H_2$ gas in the upper layer, under the preparation conditions shown in Table 66 and, when evaluated in the same manner, satisfactory improvement was obtained to the dots, coarse image and peeling in the same manner as in Example 36.

EXAMPLE 69

A light receiving member for use in electrophotography was prepared in the same manner as in Example 36 by further using $PH_3/H_2$ gas and $C_2H_2$ gas in the upper layer, under the preparation conditions shown in Table 67 and, when evaluated in the same manner, satisfactory improvement was obtained to the dots, coarse image and peeling in the same manner as in Example 36.

EXAMPLE 70

A light receiving member for use in electrophotography was prepared in the same manner as in Example 36 by further using $PH_3/H_2$ and $C_2H_2$ gas, $SiF_4$ gas and $H_2S$ gas in the upper layer, under the preparation conditions shown in Table 68 and, when evaluated in the same manner, satisfactory improvement was obtained to the dots, coarse image and peeling in the same manner as in Example 36.

EXAMPLE 71

A light receiving member for use in electrophotography was prepared in the same manner as in Example 1 by further using NO gas upon forming the lower layer in Example 1, under the preparation conditions as shown in Table 69.

COMPARATIVE EXAMPLE 3

A light receiving member for use in electrophotography was prepared under the same preparation conditions as those in Example 71 except for not using $H_2$ gas and NO gas upon forming the lower layer. The conditions for preparing the light receiving member for use in electrophotography are shown in Table 70.

The light receiving members for use in electrophotography thus prepared in Example 36 and Comparative Example 2 were set respectively to an electrophotographic apparatus, i.e., a copying machine NP-7550 manufactured by Canon Inc. and modified for experimental use and, when several electrophotographic properties were checked under various conditions, it was found that both of them had outstanding characteristics with voltage withstanding property in that no image defects were formed even if a high voltage was applied to the light receiving member for use in electrophotography by highly intensive corona discharge or frictional discharge by means of a cleaning agent.

Then, when the number of dots as the image characteristics were compared, it was found that the number of dots, particularly, the number of dots with less than 0.1 mm diameter of the light receiving member for use in electrophotography of Example 71 was less than ¾ of that of the light receiving member for use in electrophotography in Comparative Example 3. In addition, for comparing the "coarse image", when the image density was measured for circular regions each of 0.05 mm diameter assumed as one unit at 100 points and the scattering in the image density was evaluated, it was found that the scattering in the light receiving member for use in electrophotography of Example 71 was less than ½ for that of the light receiving member for use in electrophotography in Comparative Example 3, and the light receiving member for use in electrophotography of Example 71 was excellent over the light receiving member for use in Electrophotography of Comparative Example 3 in view of the visual observation.

In addition, for comparing the occurrence of image defects and the peeling of the light receiving layer due to impactive mechanical pressure applied for a relatively short period of time to the light receiving member for use in electrophotography, when stainless steel balls of 3.5 mm diameter were fallen freely from the vertical height of 30 cm above the surface of the light receiving member for use in electrophotography and abutted against the surface of the light receiving member for use in electrophotography, to thereby measure the frequency of occurrence for cracks in to the light receiving layer, it was found that the rate of occurrence in the light receiving member for use in electrophotography of Example 71 was less than 2/5 for that in the light receiving member for use in electrophotography of Comparative Example 3.

As has been described above, the light receiving member for use in electrophotography of Example 71 was superior to the light receiving member for use in electrophotography of Comparative Example 3.

EXAMPLE 72

A light receiving member for use in electrophotography was prepared in the same manner as in Example 71 except for changing the way of varying the $AlCl_3$/He gas flow rate in the lower layer and using $B_2H_6$ gas in the upper layer, under the preparation conditions shown in Table 71 and, when evaluated in the same manner, satisfactory improvement was obtained to the dots, coarse image and peeling in the same manner as in Example 71.

EXAMPLE 73

A light receiving member for use in electrophotography was prepared in the same manner as in Example 71 except for not using the $CH_4$ gas in the upper layer of Example 71, under the preparation conditions shown in Table 72 and, when evaluated in the same manner, satisfactory improvement was obtained to the dots, coarse image and peeling in the same manner as in Example 71.

EXAMPLE 74

A light receiving member for use in electrophotography was prepared in the same manner as in Example 71 by replacing the $PH_3/H_2$ gas cylinder with the He gas (99.9999% purity) cylinder and, further, using $SiF_4$ gas and $N_2$ gas from cylinders not illustrated in Example 71, under the preparation conditions shown in Table 73 and, when evaluated in the same manner, satisfactory improvement was obtained to the dots, coarse image and peeling in the same manner as in Example 71.

EXAMPLE 75

A light receiving member for use in electrophotography was prepared in the same manner as in Example 71 by replacing the $B_2H_6/H_2$ gas cylinder with an Ar gas (99.9999% purity) cylinder and replacing the NO gas cylinder with a $NH_3$ gas (99.999% purity) cylinder in Example 71, under the preparation conditions shown in Table 74 and, when evaluated in the same manner, satisfactory improvement was obtained to the dots, coarse image and peeling in the same manner as in Example 71.

EXAMPLE 76

A light receiving member for use in electrophotography was prepared in the same manner as in Example 71 by further using $pH_3/H_2$ and $C_2H_6$ gas in the upper layer, under the preparation conditions shown in Table 75 and, when evaluated in the same manner, satisfactory improvement was obtained to dots, coarse image and peeling in the same manner as in Example 71.

EXAMPLE 77

A light receiving member for use in electrophotography was prepared in the same manner as in Example 71 by further using $SiF_4$ gas from a not illustrated cylinder in the upper layer, under the preparation conditions shown in Table 76 and, when evaluated in the same manner, satisfactory improvement was obtained to dots, coarse image and peeling in the same manner as in Example 71.

EXAMPLE 78

A light receiving member for use in electrophotography was prepared in the same manner as in Example 71 by further using $N_2$ gas and $H_2S$ gas from a not illustrated cylinder in the Example 71, under the preparation conditions shown in Table 77, and, when evaluated in the same manner, satisfactory improvement was obtained to dots, coarse image and peeling in the same manner as in Example 1.

EXAMPLE 79

A light receiving member for use in electrophotography was prepared in the same manner as in Example 71 by replacing the $CH_4$ gas cylinder with a $C_2H_2$ gas (99.9999% purity) cylinder in Example 71, under the preparation conditions shown in Table 78 and, when evaluated in the same manner, satisfactory improvement was obtained to the dots, coarse image and peeling in the same manner as in Example 71.

EXAMPLE 80

A light receiving member for use in electrophotography was prepared in the same manner as in Example 71 by replacing the NO gas cylinder with a $N_2$ gas cylinder and, further using the $H_2S$ gas from cylinder not illustrated in Example 71, under the preparation conditions shown in Table 79 and, when evaluated in the same manner, satisfactory improvement was obtained to the dots, coarse image and peeling in the same manner as in Example 71.

EXAMPLE 81

A light receiving member for use in electrophotography was prepared in the same manner as in Example 71 by replacing the NO gas cylinder with a $NH_3$ gas (99.999% purity) cylinder in Example 71, under the preparation conditions shown in Table 80 and, when evaluated in the same manner, satisfactory improvement was obtained to the dots, coarse image and peeling in the same manner as in Example 71.

EXAMPLE 82

A light receiving member for use in electrophotography was prepared in the same manner as in Example 76 by further using $SiF_4$ gas from a not illustrated cylinder and replacing $C_2H_2$ gas cylinder with $CH_4$ gas cylinder in the upper layer, under the preparation conditions shown in Table 82 and, when evaluated in the same manner, satisfactory improvement was obtained to dots, coarse image and peeling in the same manner as in Example 79.

EXAMPLE 83

A light receiving member for use in electrophotography was prepared in the same manner as in Example 79 by using $Si_2F_4$ gas from a not illustrated cylinder and further using $B_2H_6/H_2$ gas in the upper layer, under the preparation conditions shown in Table 82 and, when evaluated in the same manner, satisfactory improvement was obtained to dots, coarse image and peeling in the same manner as in Example 79.

EXAMPLE 84

A light receiving member for use in electrophotography was prepared in the same manner as in Example 81 by further using $PH_3/H_2$ gas in the upper layer, under the preparation conditions shown in Table 83 and, when evaluated in the same manner, satisfactory improvement was obtained to dots, coarse image and peeling in the same manner as in Example 81.

EXAMPLE 85

A light receiving member for use in electrophotography was prepared in the same manner as in Example 71 by further using $GeH_4$ from a not illustrated cylinder in the upper layer, under the preparation conditions shown in Table 84 and, when evaluated in the same manner, satisfactory improvement was obtained to dots, coarse image and peeling in the same manner as in Example 71.

EXAMPLE 86

A light receiving member for use in electrophotography was prepared in the same manner as in Example 71 by changing the outer diameter of the cylindrical aluminum support to 80 mm in Example 71, under the preparation conditions shown in Table 85 and, when evaluated in the same manner as in Example 71, except for using an electrophotographic apparatus, i.e., a copying machine NP-9030 manufactured by Canon Inc. and modified for the experimental use, satisfactory improvement was obtained to the dots, coarse image and peeling in the same manner as in Example 71.

EXAMPLE 87

A light receiving member for use in electrophotography was prepared in the same manner as in Example 71 by changing the outer diameter of the cylindrical aluminum support to 60 mm in Example 71, under the preparation conditions shown in Table 86 and, when evaluated in the same manner as in Example 71, except for using an electrophotographic apparatus, i.e., a copying machine NP-150Z manufactured by Canon Inc. and modified for the experimental use, satisfactory improvement was obtained to the dots, coarse image and peeling in the same manner as in Example 71.

EXAMPLE 88

A light receiving member for use in electrophotography was prepared in the same manner as in Example 71 by changing the outer diameter of the cylindrical aluminum support to 30 mm in Example 71, under preparation conditions shown in Table 87 and, when evaluated in the same manner as in Example 71, except for using an electrophotographic apparatus, i.e., a copying machine FC-5 manufactured by Canon Inc. and modified for the experimental use, satisfactory improvement was obtained to the dots, coarse image and peeling in the same manner as in Example 71.

EXAMPLE 89

A light receiving member for use in electrophotography was prepared in the same manner as in Example 71 by changing the outer diameter of the cylindrical aluminum support to 15 mm in Example 71, under the preparation conditions shown in Table 88, and evaluated in the same manner as in Example 71, except for using an electrophotographic apparatus, manufactured for experimental use, satisfactory improve was obtained to the dots, coarse image and peeling in the same manner as in Example 71.

EXAMPLE 90

A light sensitive member for use in electrophotography was prepared, under the same preparation conditions as those in Example 86 by using a cylindrical aluminum support applied with mirror-finishing fabrication in Example 86 and further machined into a cross sectional shape of:a =25 um, b=0.8 um as shown in FIG. 38 by a diamond point tool and, when evaluated in the same manner as in Example 86, satisfactory improvement was obtained to, the dots, coarse image and peeling in the same manner as in Example 86.

EXAMPLE 91

A light receiving member for use in electrophotography was prepared, under the same preparation conditions as those in Example 86 using a cylindrical aluminum support applied with mirror-finish fabrication and subsequently applied with a so-called surface dimpling of causing a number of hit pits to the surface of the cylindrical aluminum support by the exposure to a plurality of dropping bearing balls to form into a cross sectional shape of c=50 um and d=1 um as shown in FIG. 39 and, when evaluated in the same manner as in Example 86, satisfactory improvement was be obtained for the dots, coarse image and peeling in the same as in Example 86.

EXAMPLE 92

A light receiving member for use in electrophotography having an upper layer comprising poly-Si(H, X) was prepared in the same manner as in Example 79 by using a cylindrical aluminum support heated to a temperature of 500° C., the preparation conditions as shown in Table 89 and, when evaluated in the same manner, satisfactory improvement was obtained to dots, coarse image and peeling in the same manner as in Example 79.

EXAMPLE 93

A light receiving member for use in electrophotography was prepared by microwave glow discharge decomposition in the same manner as in Example 23 by further using NO gas and B gas upon forming the lower layer in Example 23, under the preparation conditions shown in Table 90.

When the light receiving member for use in electrophotography was evaluated in the same manner as in Example 71, satisfactory improvement was obtained to the dots, coarse image and peeling in the same manner as in Example 71.

EXAMPLE 94

A light receiving member for use in electrophotography was prepared in the same manner as in Example 71 by replacing the $CH_4$ gas cylinder with a $C_2H_2$ gas (99.9999% purity) cylinder in Example 71, under the preparation conditions shown in Table 91 and, when evaluated in the same manner, satisfactory improvement was obtained to the dots, coarse image and peeling in the same manner as in Example 71.

EXAMPLE 95

A light receiving member for use in electrophotography was prepared in the same manner as in Example 71 by replacing the No gas cylinder with a $N_2$ gas cylinder in Example 71, under the preparation conditions shown in Table 92 and, when evaluated in the same manner, satisfactory improvement was obtained to the dots, coarse image and peeling in the same manner as in Example 71.

EXAMPLE 96

A light receiving member for use in electrophotography was prepared in the same manner as in Example 71 by replacing the NO gas cylinder with a $NH_3$ gas (99.999% purity) cylinder in Example 71, under the preparation conditions shown in Table 93 and, when evaluated in the same manner, satisfactory improvement was obtained to the dots, coarse image and peeling in the same manner as in Example 71.

EXAMPLE 97

A light receiving member for use in electrophotography was prepared in the same manner as in Example 76 by further using $SiF_4$ from a not illustrated cylinder in the upper layer, under the preparation conditions shown in Table 94 and, when evaluated in the same manner, satisfactory improvement was obtained to the dots, coarse image and peeling in the same manner as in Example 76.

EXAMPLE 98

A light receiving member for use in electrophotography was prepared in the same manner as in Example 79 by replacing $SiH_4$ gas cylinder with $Si_2H_6$ gas cylinder and further using gas in the upper layer, under the preparation conditions shown in Table 95 and, when evaluated in the same manner, satisfactory improvement was obtained to the dots, coarse image and peeling in the same manner as in Example 79.

EXAMPLE 99

A light receiving member for use in electrophotography was prepared in the same manner as in Example 81 by further using $PH_3/H_2$ gas in the upper layer, under the preparation conditions shown in Table 96 and, when evaluated in the same manner, satisfactory improvement was obtained to the dots, coarse image and peeling in the same manner as in Example 81.

EXAMPLE 100

A light receiving member for use in electrophotography was prepared in the same manner as in Example 71 by replacing the $PH_3/H_2$ gas cylinder with a He gas (99.999% purity) cylinder and further using $N_2$ gas from a not illustrated cylinder in the Example 71, under the preparation conditions shown in Table 97 and, when evaluated in the same manner, satisfactory improvement was obtained to the dots, coarse image and peeling in the same manner as in Example 71.

EXAMPLE 101

A light receiving member for use in electrophotography was prepared in the same manner as in Example 71 by further using C gas and $SiF_4$ gas from a not illustrated cylinder in the upper layer, under the preparation conditions shown in Table 98 and, when evaluated in the same manner, satisfactory improvement was obtained to the dots, coarse image and peeling in the same manner as in Example 11.

EXAMPLE 102

A light receiving member for use in electrophotography was prepared in the same manner as in Example 101 by further using $SiF_4$ gas from a not illustrated cylinder in the upper layer, under the preparation conditions shown in Table 99 and, when evaluated in the same manner, satisfactory improvement was obtained to the dots, coarse image and peeling in the same manner as in Example 101.

EXAMPLE 103

A light receiving member for us in electrophotography was prepared in the same manner as in Example 106 by using $B_2/H_6/H_2$ and further using $C_2H_2$ gas from a not illustrated cylinder, under the preparation conditions shown in Table 100 and, when evaluated in the same manner, satisfactory improvement was obtained to the dots, coarse image and peeling in the same manner as in Example 106.

EXAMPLE 104

A light receiving member for use in electrophotography was prepared in the same manner as in Example 71 by using $PH_3/H_2$ and further using $C_2H_2$ gas from a not illustrated cylinder, under the preparation conditions shown in Table 101 and, when evaluated in the same manner, satisfactory improvement was obtained to the dots, coarse image and peeling in the same manner as in Example 71.

EXAMPLE 105

A light receiving member for use in electrophotography was prepared in the same manner as in Example 71 by using $C_2H_2$ gas, $SiF_4$ gas and $H_2S$ gas from a not illustrated cylinder, under the preparation conditions shown in Table 102 and, when evaluated in the same manner, satisfactory improvement was obtained to the dots, coarse image and peeling in the same manner as in Example 71.

EXAMPLE 106

A light receiving member for use in electrophotography was prepared in the same manner as in Example 79 by using $C_2H_2$ gas and $SiF_4$ gas from a not illustrated cylinder, under the preparation conditions shown in Table 103 and, when evaluated in the same manner, satisfactory improvement was obtained to the dots, coarse image and peeling in the same manner as in Example 79.

EXAMPLE 107

A light receiving member for use in electrophotography was prepared in the same manner as in Example 106, under the preparation conditions shown in Table 104, and, when evaluated in the same manner, satisfactory improvement was obtained to the dots, coarse image and peeling in the same manner as in Example 106.

EXAMPLE 108

A light receiving member for use in electrophotography was prepared in the same manner as in Example 106, under the preparation conditions shown in Table 105 and, when evaluated in the same manner, satisfactory improvement was obtained to the dots, coarse image and peeling in the same manner as in Example 106.

EXAMPLE 109

A light receiving member for use in electrophotography was prepared in the same manner as in Example 106, under the preparation conditions shown in Table 106 and, when evaluated in the same manner, satisfactory improvement was obtained to the dots, coarse image and peeling in the same manner as in Example 106.

EXAMPLE 110

A light receiving member for use in electrophotography was prepared in the same manner as in Example 106, under the preparation conditions shown in Table 107 and, when evaluated in the same manner, satisfactory improvement was obtained to the dots, coarse image and peeling in the same manner as in Example 106.

EXAMPLE 111

A light receiving member for use in electrophotography was prepared in the same manner as in Example 106, under the preparation conditions shown in Table 108 and, when evaluated in the same manner, satisfactory improvement was . obtained to the dots, coarse image and peeling in the same manner as in Example 106.

EXAMPLE 112

A light receiving member for use in electrophotography was prepared in the same manner as in Example 106, under the preparation conditions shown in Table 109 and, when evaluated in the same manner, satisfactory improvement was obtained to the dots, coarse image and peeling in the same manner as in Example 106.

EXAMPLE 113

A light receiving member for use in electrophotography was prepared in the same manner as in Example 106, under the preparation conditions shown in Table 110 and, when evaluated in the same manner, satisfactory improvement was obtained to the dots, coarse image and peeling in the same manner as in Example 106.

EXAMPLE 114

A light receiving member for use in electrophotography was prepared in the same manner as in Example 106, under the preparation conditions shown in Table 111 and, when evaluated in the same manner, satisfactory improvement was obtained to the dots, coarse image and peeling in the same manner as in Example 106.

EXAMPLE 115

A light receiving member for use in electrophotography was prepared in the same manner as in Example 106 by further using $PH_3$ gas from a not illustrated cylinder, under the preparation conditions shown in Table 112 and, when evaluated in the same manner, satisfactory improvement was obtained to the dots, coarse image and peeling in the same manner as in Example 106.

EXAMPLE 116

A light receiving member for use in electrophotography was prepared in the same manner as in Example 115, under the preparation conditions shown in Table 113 and, when evaluated in the same manner, satisfactory improvement was obtained to the dots, coarse image and peeling in the same manner as in Example 115.

EXAMPLE 117

A light receiving member for use in electrophotography was prepared in the same manner as in Example 106 by further using $H_2S$ gas from a not illustrated cylinder, under the preparation conditions shown in Table 114 and, when evaluated in the same manner, satisfactory improvement was obtained to the dots, coarse image and peeling in the same manner as in Example 106.

EXAMPLE 118

A light receiving member for use in electrophotography was prepared in the same manner as in Example 106, under the preparation conditions shown in Table 114 and, when evaluated in the same manner, satisfactory improvement was obtained to the dots, coarse image and peeling in the same manner as in Example 106.

EXAMPLE 119

A light receiving member for use in electrophotography was prepared in the same manner as in Example 106, under the preparation conditions shown in Table 116 and, when evaluated in the same manner, satisfactory improvement was obtained to the dots, coarse image and peeling in the same manner as in Example 106.

EXAMPLE 120

A light receiving member for use in electrophotography was prepared in the same manner as in Example 106 by further using $NH_3$ gas from a not illustrated cylinder, under the preparation conditions shown in Table 117 and, when evaluated in the same manner, satisfactory improvement was obtained to the dots, coarse image and peeling in the same manner as in Example 106.

EXAMPLE 121

A light receiving member for use in electrophotography was prepared in the same manner as in Example 106 by further using $N_2$ gas from a not illustrated cylinder, under the preparation conditions shown in Table 118 and, when evaluated in the same manner, satisfactory improvement was obtained to the dots, coarse image and peeling in the same manner as in Example 106.

EXAMPLE 122

A light receiving member for use in electrophotography was prepared in the same manner as in Example 106, under the preparation conditions shown in Table 119 and, when evaluated in the same manner, satisfactory improvement was obtained to the dots, coarse image and peeling in the same manner as in Example 106.

EXAMPLE 123

A light receiving member for use in electrophotography was prepared in the same manner as in Example 106, under the preparation conditions shown in Table 120 and, when evaluated in the same manner, satisfactory improvement was obtained to the dots, coarse image and peeling in the same manner as in Example 106.

EXAMPLE 124

A light receiving member for use in electrophotography was prepared in the same manner as in Example 115, under the preparation conditions shown in Table 121 and, when evaluated in the same manner, satisfactory improvement was obtained to the dots, coarse image and peeling in the same manner as in Example 115.

EXAMPLE 125

A light receiving member for use in electrophotography was prepared in the same manner as in Example 106, under the preparation conditions shown in Table 122 and, when evaluated in the same manner, satisfactory improvement was obtained to the dots, coarse image and peeling in the same manner as in Example 106.

EXAMPLE 126

A light receiving member for use in electrophotography was prepared in the same manner as in Example 1 by further using $SiF_4$ gas and NO gas upon forming the lower layer in Example 1, under the preparation conditions shown in Table 123.

COMPARATIVE EXAMPLE 4

A light receiving member for use in electrophotography was prepared under the same preparation conditions as those in Example 126 except for not using $SiF_4$ gas, NO gas and $H_2$ gas upon forming the lower layer. The conditions for preparing the light receiving member for use in electro photography are shown in Table 124.

The light receiving members for use in electrophotography thus prepared in Example 126 and Comparative Example 4 were set respectively to an electrophotographic apparatus, i.e., a copying machine NP-7550 manufactured by Canon Inc. and modified for experimental use and, when several electrophotographic properties were checked under various conditions, it was found that both of them had outstanding characteristics with voltage withstanding property in that no image defects were formed even if a high voltage was applied to the light receiving member for use in electrophotography by highly intensive corona discharge or frictional discharge by means of a cleaning agent.

Then, when the number of dots as the image characteristics were compared, it was found that the number of dots, particularly, the number of dots with less than 0.1 mm diameter of the light receiving member for use in electrophotography of Example 71 was less than half of that of the light receiving member for use in electrophotography in Comparative Example 3. In addition, for comparing the "coarse image", when the image density was measured for circular regions each of 0.05 mm diameter assumed as one unit at 100 points and the scattering in the image density was evaluated, it was found that the scattering in the light receiving member for use in electrophotography of Example 126 was less than ½ for that of the light receiving member for use in electrophotography in Comparative Example 4, and the light receiving member for use in electrophotography of Example 126 was excellent over the light receiving member for use in Electrophotography of Comparative Example 4 in view of the visual observation.

In addition, for comparing the occurrence of image defects and the peeling of the light receiving layer due to impactive mechanical pressure applied for a relatively short period of time to the light receiving member for use in electrophotography, when stainless steel balls of 3.5 mm diameter were fallen freely from the vertical height of 30 cm above the surface of the light receiving member for use in electrophotography and abutted against the surface of the light receiving member for use in electrophotography, to thereby measure the frequency of occurrence for cracks in the light receiving layer, it was found that the rate of occurrence in the light receiving member for use in electrophotography of Example 126 was less than 2/5 for that in the light receiving member for use in electrophotography of Comparative Example 4.

As has been described above, the light receiving member for use in electrophotography of Example 126 was superior to the light receiving member for use in electrophotography of Comparative Example 4.

EXAMPLE 127

A light receiving member for use in electrophotography was prepared in the same manner as in Example 126 by not using the NO gas and changing the way of varying the $AlCl_3$/He gas flow rate in the lower layer of Example 126, under the preparation conditions shown in Table 125 and, when evaluated in the same manner, satisfactory improvement was obtained to the dots, coarse image and peeling in the same manner as in Example 126.

EXAMPLE 128

A light receiving member for use in electrophotography was prepared in the same manner as in Example 126 by not using the $CH_4$ gas in Example 126, under the preparation conditions shown in Table 126 and, when evaluated in the same manner, satisfactory improvement was obtained to the dots, coarse image and peeling in the same manner as in Example 71.

EXAMPLE 129

A light receiving member for use in electrophotography was prepared in the same manner as in Example 126 by further using He gas (99.9999% purity) from a not illustrated cylinder in Example 126, under the preparation conditions shown in Table 127 and when evaluated in the same manner, satisfactory improvement was obtained to the dots, coarse image and peeling in the same manner as in Example 71.

EXAMPLE 130

A light receiving member for use in electrophotography was prepared in the same manner as in Example 126 by replacing the $B_2H_6/H_2$ gas with diluted $H_2$ gas (99.999% purity, hereinafter simply referred to as $PH_3/H_2$) cylinder, replacing the NO gas cylinder with $NH_3$ gas (99.999% purity) cylinder in Example 126, under the preparation conditions shown in Table 128 and, when evaluated in the same manner, satisfactory improvement was obtained to the dots, coarse image and peeling in the same manner as in Example 126.

EXAMPLE 131

A light receiving member for use in electrophotography was prepared in the same manner as in Example 126 by further using $C_2H_2$ gas from a not illustrated cylinder in the upper layer, under the preparation conditions shown in Table 129 and, when evaluated in the same manner, satisfactory improvement was obtained to dots, coarse image and peeling in the same manner as in Example 126.

EXAMPLE 132

A light receiving member for use in electrophotography was prepared in the same manner as in Example 126 by further using $PH_3/H_2$ gas from a not illustrated cylinder, under the preparation conditions shown in Table 130 and, when evaluated in the same manner, satisfactory improvement was obtained to dots, coarse image and peeling in the same manner as in Example 126.

EXAMPLE 133

A light receiving member for use in electrophotography was prepared in the same manner as in Example 126 by further using $N_2$ gas, $H_2S$ and $PH_3/H_2$ gas from a not illustrated cylinder in the Example 126, under the preparation conditions shown in Table 131 and, when evaluated in the same manner, satisfactory improvement was obtained to dots, coarse image and peeling in the same manner as in Example 126.

EXAMPLE 134

A light receiving member for use in electrophotography was prepared in the same manner as in Example 126 by replacing the $CH_4$ gas cylinder with a $C_2H_2$ gas (99.9999% purity) cylinder in Example 126, under the preparation conditions shown in Table 132 and, when evaluated in the same manner, satisfactory improvement was obtained to the dots, coarse image and peeling in the same manner as in Example 126.

EXAMPLE 135

A light receiving member for use in electrophotography was prepared in the same manner as in Example 126 by replacing the $B_2H_6/H_2$ gas cylinder with $H_2$-diluted $BF_3$ gas (99.999% purity, hereinafter simply referred to as $PH_3/H_2$) cylinder, replacing the NO gas cylinder with a $N_2$ gas (99.999% purity) cylinder and using $H_2S$ gas from a not illustrated cylinder in Example 126, under the preparation conditions shown in Table 133 and, when evaluated in the same manner, satisfactory improvement was obtained to the dots, coarse image and peeling in the same manner as in Example 126.

EXAMPLE 136

A light receiving member for use in electrophotography was prepared in the same manner as in Example 126 by replacing the NO gas cylinder with a $NH_3$ gas (99.999% purity) cylinder in Example 126, under the preparation conditions shown in Table 134, and, when evaluated in the same manner, satisfactory improvement was obtained to the dots, coarse image and peeling in the same manner as in Example 71.

EXAMPLE 137

A light receiving member for use in electrophotography was prepared in the same manner as in Example 131 by further using the hydrogen gas-diluted $PF_5$ gas (99.999% purity, hereinafter simply referred to as $PF_3/H_2$) from a not illustrated cylinder and $PH_3/H_2$ gas, replating the $G_2H_2$ gas cylinder with $CH_4$ gas cylinder, under the preparation conditions shown in Table 135 and, when evaluated in the same manner, satisfactory improvement was obtained to the dots, coarse image and peeling in the same manner as in Example 131.

EXAMPLE 138

A light receiving member for use in electrophotography was prepared in the same manner as in Example 136 by using a not illustrated $Si_2F_6$ gas cylinder, under the preparation conditions shown in Table 136 and, when evaluated in the same manner, satisfactory improvement was obtained to the dots, coarse image and peeling in the same manner as in Example 134.

EXAMPLE 139

A light receiving member for use in electrophotography was prepared in the same manner as in Example 136 by further using $PH_3/H_2$ gas and $Si_2F_4$ gas, under the preparation conditions shown in Table 137 and, when evaluated in the same manner, satisfactory improvement was obtained to dots, coarse image and peeling in the same manner as in Example 136.

EXAMPLE 140

A light receiving member for use in electrophotography was prepared in the same manner as in Example 126 by further using $GeH_4$ from a not illustrated cylinder in the upper layer, under the preparation conditions shown in Table 138 and, when evaluated in the same manner, satisfactory improvement was obtained to dots, coarse image and peeling in the same manner as in Example 126.

EXAMPLE 141

A light receiving member for use in electrophotography was prepared in the same manner as in Example 126 by changing the outer diameter of the cylindrical aluminum support to 80 mm in Example 126, under the preparation conditions shown in Table 139 and, when evaluated in the same manner as in Example 126, except for using an electrophotographic apparatus, i.e., a copying machine NP-9030 manufactured by Canon Inc. and modified for the experimental use, satisfactory improvement was obtained to the dots, coarse image and peeling in the same manner as in Example 71.

EXAMPLE 142

A light receiving member for use in electrophotography was prepared in the same manner as in Example 126 by changing the outer diameter of the cylindrical aluminum support to 60 mm in Example 126, under the preparation conditions shown in Table 140 and, when evaluated in the same manner as in Example 126, except for using an electrophotographic apparatus, i.e., a copying machine NP-150Z manufactured by Canon Inc. and modified for the experimental use, satisfactory improvement was obtained to the dots, coarse image and peeling in the same manner as in Example 126.

EXAMPLE 143

A light receiving member for use in electrophotography was prepared in the same manner as in Example 126 by changing the outer diameter of the cylindrical aluminum support to 30 mm in Example 126, under the preparation conditions shown in Table 141 and, when evaluated in the same manner as in Example 126, except for using an electrophotographic apparatus, i.e., a copying machine FC-5 manufactured by Canon Inc. and modified for the experimental use, satisfactory improvement was obtained to the dots, coarse image and peeling in the same manner as in Example 126.

EXAMPLE 144

A light receiving member for use in electrophotography was prepared in the same manner as in Example 126 by changing the outer diameter of the cylindrical aluminum support to 15 mm in Example 126, under the preparation conditions shown in Table 142, and evaluated in the same manner as in Example 126, except for using an electrophotographic apparatus, manufactured for experimental use, satisfactory improvement was obtained to the dots, coarse image and peeling in the same manner as in Example 126.

EXAMPLE 145

A light sensitive member for use in electrophotography was prepared, under the same preparation conditions as those in Example 141 by using a cylindrical aluminum support applied with mirror-finishing fabrication in Example 141 and further machined into a cross sectional shape of : a=25 um, b=0.8 um as shown in FIG. 38 by a diamond point tool and, when evaluated in the same manner as in Example 141, satisfactory improvement was obtained to, the dots, coarse image and peeling in the same manner as in Example 141.

EXAMPLE 146

A light receiving member for use in electrophotography was prepared, under the same preparation conditions as those in Example 141 using a cylindrical aluminum support applied with mirror-finish fabrication and subsequently applied with a so-called surface dimpling of causing a number of hit pits to the surface of the cylindrical aluminum support by the exposure to a plurality of dropping bearing balls to form into a cross sectional shape of : c=50 um and d=1 um as shown in FIG. 39 and, when evaluated in the same manner as in Example 141, satisfactory improvement was be obtained for the dots, coarse image and peeling in the same as in Example 141.

EXAMPLE 147

A light receiving member for use in electrophotography having an upper layer comprising poly-Si(H, X) was prepared in the same manner as in Example 134 by using a cylindrical aluminum support heated to a temperature of 500° C., under the preparation conditions as shown in Table 143 and, when evaluated in the same manner, satisfactory improvement was obtained to dots, coarse image and peeling in the same manner as in Example 134.

EXAMPLE 148

A light receiving member for use in electrophotography was prepared by microwave glow discharge decomposition in the same manner as in Example 23 by further using $SiF_4$ gas, No gas and $B_2H_6$ gas in Example 23, under the same preparation conditions as shown in Table 144.

When the light receiving member for use in electrophotography was evaluated in the same manner as in Example 126. satisfactory improvement was obtained to the dots, coarse image and peeling in the same manner as in Example 126.

EXAMPLE 149

A light receiving member for use in electrophotography was prepared in the same manner as in Example 126 by replacing the $CH_4$ gas cylinder with a $C_2H_2$ gas (99.9999% purity) cylinder in Example 126, under the preparation conditions shown in Table 145 and, when evaluated in the same manner, satisfactory improvement was obtained to the dots, coarse image and peeling in the same manner as in Example 126.

EXAMPLE 150

A light receiving member for use in electrophotography was prepared in the same manner as in Example 126 by replacing the NO gas cylinder with a $N_2$ gas cylinder in Example 126, under the preparation conditions shown in Table 146 and, when evaluated in the same manner, satisfactory improvement was obtained to the dots, coarse image and peeling in the same manner as in Example 126.

EXAMPLE 151

A light receiving member for use in electrophotography was prepared in the same manner as in Example 126 by using $PF_5$ gas and $Si_2F_6$ gas from a not illustrated cylinder and replacing NO gas cylinder with a $NH_3$ gas cylinder in Example 126, under the preparation conditions shown in Table 147 and, when evaluated in the same manner, satisfactory improvement was obtained to the dots, coarse image and peeling in the same manner as in Example 126.

EXAMPLE 152

A light receiving member for use in electrophotography was prepared in the same manner as in Example 131 by further using $PF_5/H_2$ gas from a not illustrated cylinder, under the preparation conditions shown in Table 148 and, when evaluated in the same manner, satisfactory improvement was obtained to the dots, coarse image and peeling in the same manner as in Example 131.

EXAMPLE 153

A light receiving member for use in electrophotography was prepared in the same manner as in Example 134, under the preparation conditions shown in Table 149 and, when evaluated in the same manner, satisfactory improvement was obtained to the dots, coarse image and peeling in the same manner as in Example 134.

EXAMPLE 154

A light receiving member for use in electrophotography was prepared in the same manner as in Example 136 by further using $PH_3/H_2$ gas, under the preparation conditions shown in Table 150 and, when evaluated in the same manner, satisfactory improvement was obtained to the dots, coarse image and peeling in the same manner as in Example 136.

EXAMPLE 155

A light receiving member for use in electrophotography was prepared in the same manner as in Example 126 by further using the He gas (99.999% purity) from a not illustrated cylinder in the Example 126, under the preparation conditions shown in Table 151 and, when evaluated in the same manner, satisfactory improvement was obtained to the dots, coarse image and peeling in the same manner as in Example 126.

EXAMPLE 156

A light receiving member for use in electrophotography was prepared in the same manner as in Example 126 by further using $C_2H_2$ gas and $PH_3/H_2$ gas from a not illustrated cylinder, under the preparation conditions shown in Table 151 and, when evaluated in the same manner, satisfactory improvement was obtained to the dots, coarse image and peeling in the same manner as in Example 126.

EXAMPLE 157

A light receiving member for use in electrophotography was prepared in the same manner as in Example 131 by further using $PH_3/H_2$ gas from a not illustrated cylinder, under the preparation conditions shown in Table 153 and, when evaluated in the same manner, satisfactory improvement was obtained to the dots, coarse image and peeling in the same manner as in Example 131.

EXAMPLE 158

A light receiving member for use in electrophotography was prepared in the same manner as in Example 126 by further using $C_2H_2$ gas from a not illustrated cylinder, under the preparation conditions shown in Table 154 and, when evaluated in the same manner, satisfactory improvement was obtained to the dots, coarse image and peeling in the same manner as in Example 126.

EXAMPLE 159

A light receiving member for use in electrophotography was prepared in the same manner as in Example 158 by further using $C_2H_2$ gas and $PH_3/H_2$ from a not illustrated cylinder, under the preparation conditions shown in Table 155 and, when evaluated in the same manner, satisfactory improvement was obtained to the dots, coarse image and peeling in the same manner as in Example 158.

EXAMPLE 160

A light receiving member for use in electrophotography was prepared in the same manner as in Example 126 by further using $C_2H_2$ gas, $PF_3/H_2$ gas and $H_2S$ gas from a not was prepared in the same manner as in Example 126 by further using $C_2H_2$ gas, $PF_3/H_2$ gas and $H_2S$ gas from a not illustrated cylinder, under the preparation conditions shown in Table 156 and, when evaluated in the same manner, satisfactory improvement was obtained to the dots, coarse image and peeling in the same manner as in Example 126.

EXAMPLE 161

A light receiving member for use in electrophotography was prepared in the same manner as in Example 134 by further using $C_2H_2$ gas from a not illustrated cylinder, under the preparation conditions shown in Table 134 and, when evaluated in the same manner, satisfactory improvement was obtained to the dots, coarse image and peeling in the same manner as in Example 134.

EXAMPLE 162

A light receiving member for use in electrophotography was prepared in the same manner as in Example 161, under the preparation conditions shown in Table 158, and, when evaluated in the same manner, satisfactory improvement was obtained to the dots, coarse image and peeling in the same manner as in Example 161.

EXAMPLE 163

A light receiving member for use in electrophotography was prepared in the same manner as in Example 161, under the preparation conditions shown in Table 159, and, when evaluated in the same manner, satisfactory improvement was obtained to the dots, coarse image and peeling in the same manner as in Example 161.

EXAMPLE 164

A light receiving member for use in electrophotography was prepared in the same manner as in Example 161 by using $BF_3$ gas from a not illustrated cylinder, under the preparation conditions shown in Table 160, and, when evaluated in the same manner, satisfactory improvement was obtained to the dots, coarse image and peeling in the same manner as in Example 161.

EXAMPLE 165

A light receiving member for use in electrophotography was prepared in the same manner as in Example 161, under the preparation conditions shown in Table 161 and, when evaluated in the same manner, satisfactory improvement was obtained to the dots, coarse image and peeling in the same manner as in Example 161.

EXAMPLE 166

A light receiving member for use in electrophotography was prepared in the same manner as in Example 161, under the preparation conditions shown in Table 162 and, when evaluated in the same manner, satisfactory improvement was obtained to the dots, coarse image and peeling in the same manner as in Example 161.

EXAMPLE 167

A light receiving member for use in electrophotography was prepared in the same manner as in Example 161, under the preparation conditions shown in Table 163 and, when evaluated in the same manner, satisfactory improvement was obtained to the dots, coarse image and peeling in the same manner as in Example 161.

EXAMPLE 168

A light receiving member for use in electrophotography was prepared in the same manner as in Example 161, under the preparation conditions shown in Table 164 and, when evaluated in the same manner, satisfactory improvement was obtained to the dots, coarse image and peeling in the same manner as in Example 161.

EXAMPLE 169

A light receiving member for use in electrophotography was prepared in the same manner as in Example 161, under the preparation conditions shown in Table 165 and, when evaluated in the same manner, satisfactory improvement was obtained to the dots, coarse image and peeling in the same manner as in Example 161.

EXAMPLE 170

A light receiving member for use in electrophotography was prepared in the same manner as in Example 161 by further using $PH_3$ gas and $Si_2F_6$ gas from a not illustrated cylinder, under the preparation conditions shown in Table 166 and, when evaluated in the same manner, satisfactory improvement was obtained to the dots, coarse image and peeling in the same manner as in Example 161.

EXAMPLE 171

A light receiving member for use in electrophotography was prepared in the same manner as in Example 170, under the preparation conditions shown in Table 167 and, when evaluated in the same manner, satisfactory improvement was obtained to the dots, coarse image and peeling in the same manner as in Example 170.

EXAMPLE 172

A light receiving member for use in electrophotography was prepared in the same manner as in Example 161 by further using $H_2S$ gas from a not illustrated cylinder, under the preparation conditions shown in Table 168 and, when evaluated in the same manner, satisfactory improvement was obtained to the dots, coarse image and peeling in the same manner as in Example 161.

EXAMPLE 173

A light receiving member for use in electrophotography was prepared in the same manner as in Example 161, under the preparation conditions shown in Table 169 and, when evaluated in the same manner, satisfactory improvement was obtained to the dots, coarse image and peeling in the same manner as in Example 161.

EXAMPLE 174

A light receiving member for use in electrophotography was prepared in the same manner as in Example 161, under the preparation conditions shown in Table 170 and, when evaluated in the same manner, satisfactory improvement was obtained to the dots, coarse image and peeling in the same manner as in Example 161.

EXAMPLE 175

A light receiving member for use in electrophotography was prepared in the same manner as in Example 161 by further using $NH_3$ gas from a not illustrated cylinder, under the preparation conditions shown in Table 171 and, when evaluated in the same manner, satisfactory improvement was obtained to the dots, coarse image and peeling in the same manner as in Example 161.

EXAMPLE 176

A light receiving member for use in electrophotography was prepared in the same manner as in Example 161 by further using $N_2$ gas from a not illustrated cylinder, under the preparation conditions shown in Table 172 and, when evaluated in the same manner, satisfactory improvement was obtained to the dots, coarse image and peeling in the same manner as in Example 161.

EXAMPLE 177

A light receiving member for use in electrophotography was prepared in the same manner as in Example 161, under the preparation conditions shown in Table 173 and, when evaluated in the same manner, satisfactory improvement was obtained to the dots, coarse image and peeling in the same manner as in Example 161.

EXAMPLE 178

A light receiving member for use in electrophotography was prepared in the same manner as in Example 161, under the preparation conditions shown in Table 174 and, when evaluated in the same manner, satisfactory improvement was obtained to the dots, coarse image and peeling in the same manner as in Example 161.

EXAMPLE 179

A light receiving member for use in electrophotography was prepared in the same manner as in Example 170, under the preparation conditions shown in Table 175 and, when evaluated in the same manner, satisfactory improvement was obtained to the dots, coarse image and peeling in the same manner as in Example 170.

EXAMPLE 180

A light receiving member for use in electrophotography was prepared in the same manner as in Example 161, under the preparation conditions shown in Table 176 and, when evaluated in the same manner, satisfactory improvement was obtained to the dots, coarse image and peeling in the same manner as in Example 161.

EXAMPLE 181

A light receiving member for use in electrophotography was prepared in the same manner as in Example 1 by further using $GeH_4$ gas upon forming the lower layer in Example 1, under the same preparation conditions as shown in Table 177. Comparative Example 5

A light receiving member for use in electrophotography was prepared under the same preparation conditions as those in Example 181 except for not using $GeH_4$ gas and $H_2$ gas upon forming the lower layer. The conditions for preparing the light receiving member for use in electro photography are shown in Table 178.

The light receiving members for use in electrophotography thus prepared in Example 181 and Comparative Example 5 were set respectively to an electrophotographic apparatus, i.e., a copying machine NP-7550 manufactured by Canon Inc. and modified for experimental use and, when several electrophotographic properties were checked under various conditions, it was found that both of them had outstanding characteristics with voltage withstanding property in that no image defects were formed even if a high voltage was applied to the light receiving member for use in electrophotography by highly intensive corona discharge or frictional discharge by means of a cleaning agent.

Then, when the number of dots as the image characteristics were compared, it was found that the number of dots, particularly, the number of dots with less than 0.1 mm diameter of the light receiving member for use in electrophotography of Example 181 was less than 2/5 of that of the light receiving member for use in electrophotography in Comparative Example 5. In addition, for comparing the "coarse image", when the image density was measured for circular regions each of 0.05 mm diameter assumed as one unit at 100 points and the scattering in the image density was evaluated, it was found that the scattering in the light receiving member for use in electrophotography of Example 181 was less than $\frac{1}{3}$ for that of the light receiving member for use in electrophotography in Comparative Example 5, and the light receiving member for use in electrophotography of Example 181 was excellent over the light receiving member for use in Electrophotography of Comparative Example 5 in view of the visual observation.

In addition, for comparing the occurrence of image defects and the peeling of the light receiving layer due to impactive mechanical pressure applied for a relatively short period of time to the light receiving member for use in electrophotography, when stainless steel balls of 3.5 mm diameter were fallen freely from the vertical height of 30 cm above the surface of the light receiving member for use in electrophotography and abutted against the surface of the light receiving member for use in electrophotography, to thereby measure the frequency that cracks occurred to the light receiving layer, it was found that the rate of occurrence in the light receiving member for use in electrophotography of Example 181 was less than $\frac{1}{3}$ for that in the light receiving member for use in electrophotography of Comparative Example 5.

When the lower layer of the light receiving member for use in electrophotography of Example 181 was analyzed by using SIMS, it was found that the content of silicon atoms, hydrogen atoms and aluminum atoms in the direction of the film thickness was varied as desired.

As has been described above, the light receiving member for use in electrophotography of Example 181 was superior to the light receiving member for use in electrophotography of Comparative Example 5.

EXAMPLE 182

A light receiving member for use in electrophotography was prepared in the same manner as in Example 181 by changing the way of varying the $AlCl_3$/He gas flow rate in the lower layer, under the preparation conditions shown in Table 179, and when evaluated in the same manner, satisfactory improvement was obtained to the dots, coarse image and peeling in the same manner as in Example 181.

EXAMPLE 183

A light receiving member for use in electrophotography was prepared in the same manner as in Example 181 not using the $CH_4$ gas in the upper layer of Example 181, under the preparation conditions shown in Table 180, and when evaluated in the same manner, satisfactory improvement was obtained to the dots, coarse image and peeling in the same manner as in Example 181.

EXAMPLE 184

A light receiving member for use in electrophotography was prepared in the same manner as in Example 181 by further using He gas (99.9999% purity) and $N_2$ gas from a not illustrated cylinder in Example 181, under the preparation conditions shown in Table 181, and when evaluated in the same manner, satisfactory improvement was obtained to the dots, coarse image and peeling in the same manner as in Example 71.

EXAMPLE 185

A light receiving member for use in electrophotography was prepared in the same manner as in Example 181 by replacing the $B_2H_6/H_2$ gas cylinder with hydrogen-diluted $PH_3$ gas (99.999% purity, hereinafter simply referred to as $PH_3/H_2$) cylinder, replacing the NO gas cylinder with $NH_3$ gas (99.999% purity) cylinder in Example 181, under the preparation conditions shown in Table 182, and when evaluated in the same manner, satisfactory improvement was obtained to the dots, coarse image and peeling in the same manner as in Example 181.

EXAMPLE 186

A light receiving member for use in electrophotography was prepared in the same manner as in Example 181 by further using $C_2H_2$ gas from a not illustrated cylinder in Example 181, under the preparation conditions shown in Table 183 and, when evaluated in the same manner, satisfactory improvement was obtained to dots, coarse image and peeling in the same manner as in Example 181.

EXAMPLE 187

A light receiving member for use in electrophotography was prepared in the same manner as in Example 181 by further using $PH_3/H_2$ gas from a not illustrated cylinder, under the preparation conditions shown in Table 184 and, when evaluated in the same manner, satisfactory improvement was obtained to dots, coarse image and peeling in the same manner as in Example 181.

EXAMPLE 188

A light receiving member for use in electrophotography was prepared in the same manner as in Example 181 by further using $N_2$ gas, $H_2S$ (99.9% purity) and $PH_3/H_2$ gas from a not illustrated cylinder in Example 181, under the preparation conditions shown in Table 185, and, when evaluated in the same manner, satisfactory improvement was obtained to dots, coarse image and peeling in the same manner as in Example 181.

EXAMPLE 189

A light receiving member for use in electrophotography was prepared in the same manner as in Example 181 by replacing the $GeH_4$ gas cylinder with $GeF_4$ gas (99.999% purity), and replacing the $CH_4$ gas cylinder with a $C_2H_2$ gas (99.9999% purity) cylinder in Example 181, under the preparation conditions shown in Table 186 and, when evaluated in the same manner, satisfactory improvement was obtained to the dots, coarse image and peeling in the same manner as in Example 181.

EXAMPLE 190

A light receiving member for use in electrophotography was prepared in the same manner as in Example 181 by replacing the $B_2H_6/H_2$ gas cylinder with $H_2$-diluted $BF_3$ gas (99.999% purity, hereinafter simply referred to as $BF_3/H_2$) cylinder and replacing the NO gas cylinder with $N_2$ gas and also using $H_2S$ gas from a not illustrated cylinder in Example 181, under the preparation conditions shown in Table 187, and when evaluated in the same manner, satisfactory improvement was obtained to the dots, coarse image and peeling in the same manner as in Example 181.

EXAMPLE 191

A light receiving member for use in electrophotography was prepared in the same manner as in Example 181 by replacing cylinder in Example 181, under the preparation conditions shown in Table 188, and, when evaluated in the same manner, satisfactory improvement was obtained to the dots, coarse image and peeling in the same manner as in Example 71.

EXAMPLE 192

A light receiving member for use in electrophotography was prepared in the same manner as in Example 186 by replacing the $PF_5$ gas diluted with hydrogen (99.999% purity, hereinafter simply referred to as $PH_3/H_2$) from a not illustrated cylinder and further using $B_2H_6/H_2$ gas, under the preparation conditions shown in Table 189, and when evaluated in the same manner, satisfactory improvement was obtained to the dots, coarse image and peeling in the same manner as in Example 186.

EXAMPLE 193

A light receiving member for use in electrophotography was prepared in the same manner as in Example 189 by using $Si_2H_6$ (99.99% purity), $Si_2F_6$ (99199% purity) gas, under the preparation conditions shown in Table 190, and, when evaluated in the same manner, satisfactory improvement was obtained to the dots, coarse image and peeling in the same manner as in Example 189.

EXAMPLE 194

A light receiving member for use in electrophotography was prepared in the same manner as in Example 191 by further using $PF_5/H_2$ gas and $Si_2F_6$ gas, under the preparation conditions shown in Table 191 and, when evaluated in the same manner, satisfactory improvement was obtained to dots, coarse image and peeling in the same manner as in Example 191.

EXAMPLE 195

A light receiving member for use in electrophotography was prepared in the same manner as in Example 181 by further using $GeH_4$ gas in the upper layer, under the preparation conditions shown in Table 192 and, when evaluated in the same manner, satisfactory improvement was obtained to dots, coarse image and peeling in the same manner as in Example 181.

EXAMPLE 196

A light receiving member for use in electrophotography was in same manner as prepared the in Example 181 by changing the outer diameter of the cylindrical aluminum support to 80 mm in Example 181, under the preparation conditions shown in Table 193 and, when evaluated in the same manner as in Example 181, except for using an electrophotographic apparatus, i.e., a copying machine NP-9030 manufactured by Canon Inc. and modified for experimental use, satisfactory improvement was obtained to the dots, coarse image and peeling in the same manner as in Example 181.

EXAMPLE 197

A light receiving member for use in electrophotography was prepared in the same manner as in Example 181 by changing the outer diameter of the cylindrical aluminum support to 60 mm in Example 181, under the preparation conditions shown in Table 194 and, when evaluated in the same manner as in Example 181, except for using an electrophotographic apparatus, i.e., a copying machine NP-150Z manufactured by Canon Inc. and modified for the experimental use, satisfactory improvement was obtained to the dots, coarse image and peeling in the same manner as in Example 181.

EXAMPLE 198

A light receiving member for use in electrophotography was prepared in the same manner as in Example 181 by changing the outer diameter of the cylindrical aluminum support to 30 mm in Example 181, under the preparation conditions shown in Table 195 and, when evaluated in the same manner as in Example 181, except for using an electrophotographic apparatus, i.e., a copying machine FC-5 manufactured by Canon Inc. and modified for the experimental use, satisfactory improvement was obtained to the dots, coarse image and peeling in the same manner as in Example 181.

EXAMPLE 199

A light receiving member for use in electrophotography was prepared in the same manner as in Example 181 by changing the outer diameter of the cylindrical aluminum support to 15 mm in Example 181, under the preparation conditions shown in Table 196, and evaluated in the same manner as in Example 181, except for using an electrophotographic apparatus, manufactured for experimental use and, when evaluated in the same manner, satisfactory improvement was obtained to the dots coarse image and peeling in the same manner as in Example 181.

EXAMPLE 200

A light sensitive member for use in electrophotography was prepared, under the same preparation conditions as those in Example 196 by using a cylindrical aluminum support applied with mirror-finishing fabrication in Example 196 and further machined into a cross sectional shape of a=25 um, b=0.8 um as shown in FIG. 38 by a diamond point tool and, when evaluated in the same manner as in Example 196, satisfactory improvement was obtained to, the dots, coarse image and peeling in the same manner as in Example 196.

EXAMPLE 201

A light receiving member for use in electrophotography was prepared, under the same preparation conditions as those in Example 196 using a cylindrical aluminum support applied with mirror-finish fabrication and subsequently applied with a so-called surface dimpling of causing a number of hit pits to the surface of the cylindrical aluminum support by the exposure to a plurality of dropping bearing balls to form into a cross sectional shape of: c=50 um and d=1 um as shown in FIG. 39 and, when evaluated in the same manner as in Example 196, satisfactory improvement was be obtained for the dots, coarse image and peeling in the same as in Example 196.

EXAMPLE 202

A light receiving member for use in electrophotography in the same manner as in Example 189 having an upper layer comprising poly-Si(H, X) was prepared by using a cylindrical aluminum support heated to a temperature of 500° C., under the preparation conditions as shown in Table 197 and, when evaluated in the same manner, satisfactory improvement was obtained to dots, coarse image and peeling in the same manner as in Example 189.

EXAMPLE 203

A light receiving member for use in electrophotography was prepared by microwave glow discharge decomposition in the same manner as in Example 23 by further using $GeH_4$ gas, $B_2H_6$ gas and NO gas upon forming the lower layer in Example 23, under the same preparation conditions as shown in Table 198.

When the light receiving member for use in electrophotography was evaluated in the same manner as in Example 181, satisfactory improvement was obtained to the dots, coarse image and peeling in the same manner as in Example 181.

EXAMPLE 204

A light receiving member for use in electrophotography was prepared in the same manner as in Example 181 by replacing the $CH_4$ gas cylinder with a $C_2H_2$ gas (99.9999% purity) cylinder, and replacing $GeH_4$ gas cylinder with a $GeF_4$ gas cylinder and further using $Si_2F_6$ gas in Example 181, under the preparation conditions shown in Table 199 and, when evaluated in the same manner, satisfactory improvement was obtained to the dots, coarse image and peeling in the same manner as in Example 181.

EXAMPLE 205

A light receiving member for use in electrophotography was prepared in the same manner as in Example 181, under the preparation conditions shown in Table 200 and, when evaluated in the same manner, satisfactory improvement was obtained to the dots, coarse image and peeling in the same manner as in Example 181.

EXAMPLE 206

A light receiving member for use in electrophotography was prepared in the same manner as in Example 181 by using $SnH_4$ gas (99.99% purity), $PF_5$ gas and $Si_2F_6$ gas from a not illustrated cylinder and replacing NO gas cylinder with a $NH_3$ gas cylinder in Example 181, under the preparation conditions shown in Table 201 and, when evaluated in the same manner, satisfactory improvement was obtained to the dots, coarse image and peeling in the same manner as in Example 181.

EXAMPLE 207

A light receiving member for use in electrophotography was prepared in the same manner as in Example 186 by further using $PF_5/H_2$ gas and $SiF_4$ gas from a not illustrated cylinder, under the preparation conditions shown in Table 202 and, when evaluated in the same manner, satisfactory improvement was obtained to the dots, coarse image and peeling in the same manner as in Example 186.

EXAMPLE 208

A light receiving member for use in electrophotography was prepared in the same manner as in Example 189, under the preparation conditions shown in Table 203 and, when evaluated in the same manner, satisfactory improvement was obtained to the dots, coarse image and peeling in the same manner as in Example 189.

EXAMPLE 209

A light receiving member for use in electrophotography was prepared in the same manner as in Example 181 by further using $PH_3/H_2$ gas, under the preparation conditions shown in Table 204 and, when evaluated in the same manner, satisfactory improvement was obtained to the dots, coarse image and peeling in the same manner as in Example 181.

EXAMPLE 210

A light receiving member for use in electrophotography was prepared in the same manner as in Example 181 by further using He gas and $N_2$ gas from a not illustrated cylinder, under the preparation conditions shown in Table 205 and, when evaluated in the same manner, satisfactory improvement was obtained to the dots, coarse image and peeling in the same manner as in Example 181.

EXAMPLE 211

A light receiving member for use in electrophotography was prepared in the same manner as in Example 181 by further using $C_2H_2$ gas, $SiF_4$ gas and $PH_3/H_2$ gas from a not illustrated cylinder, under the preparation conditions shown in Table 206 and when evaluated in the same manner, satisfactory improvement was obtained to the dots, coarse image and peeling in the same manner as in Example 181.

EXAMPLE 212

A light receiving member for use in electrophotography was prepared in the same manner as in Example 211 by further using $PH_3/H_2$ gas and $SiF_4$ gas from a not illustrated cylinder, under the preparation conditions shown in Table 207 and, when evaluated in the same manner, satisfactory improvement was obtained to the dots, coarse image and peeling in the same manner as in Example 211.

EXAMPLE 213

A light receiving member for use in electrophotography was prepared in the same manner as in Example 181 by further using $C_2H_2$ gas from a not illustrated cylinder, under the preparation conditions shown in Table 208 and, when evaluated in the same manner, satisfactory improvement was obtained to the dots, coarse image and peeling in the same manner as in Example 181.

EXAMPLE 214

A light receiving member for use in electrophotography was prepared in the same manner as in Example 213 by further using $C_2H_2$ and $SnH_4$ gas from a not illustrated cylinder, under the preparation conditions shown in Table 209 and, when evaluated in the same manner, satisfactory improvement was obtained to the dots, coarse image and peeling in the same manner as in Example 213.

EXAMPLE 215

A light receiving member for use in electrophotography was prepared in the same manner as in Example 181 by further using $C_2H_2$ gas, $PF_3/H_2$ gas, $H_2S$ gas and $SiF_4$ gas from a not illustrated cylinder, under the preparation conditions shown in Table 210 and, when evaluated in the same manner, satisfactory improvement was obtained to the dots, coarse image and peeling in the same manner as in Example 181.

EXAMPLE 216

A light receiving member for use in electrophotography was prepared in the same manner as in Example 189 by further using $C_2H_2$ gas and $SiF_4$ gas from a not illustrated cylinder, under the preparation conditions shown in Table 211 and, when evaluated in the same manner, satisfactory improvement was obtained to the dots, coarse image and peeling in the same manner as in Example 189.

EXAMPLE 217

A light receiving member for use in electrophotography was prepared in the same manner as in Example 216 by using $SnH_4$ gas from a not illustrated cylinder, under the preparation conditions shown in Table 212, and, when evaluated in the same manner, satisfactory improvement was obtained to the dots, coarse image and peeling in the same manner as in Example 216.

EXAMPLE 218

A light receiving member for use in electrophotography was prepared in the same manner as in Example 216, under the preparation conditions shown in Table 213 and, when evaluated in the same manner, satisfactory improvement was obtained to the dots, coarse image and peeling in the same manner as in Example 216.

EXAMPLE 219

A light receiving member for use in electrophotography was prepared in the same manner as in Example 216 by using $BF_3$ gas from a not illustrated cylinder, under the preparation conditions shown in Table 214, and, when evaluated in the same manner, satisfactory improvement was obtained to the dots, coarse image and peeling in the same manner as in Example 216.

EXAMPLE 220

A light receiving member for use in electrophotography was prepared in the same manner as in Example 216, under the preparation conditions shown in Table 215 and, when evaluated in the same manner, satisfactory improvement was obtained to the dots, coarse image and peeling in the same manner as in Example 216.

EXAMPLE 221

A light receiving member for use in electrophotography was prepared in the same manner as in Example 216, under the preparation conditions shown in Table 216 and, when evaluated in the same manner, satisfactory improvement was obtained to the dots, coarse image and peeling in the same manner as in Example 216.

EXAMPLE 222

A light receiving member for use in electrophotography was prepared in the same manner as in Example 216, under the preparation conditions shown in Table 217 and, when evaluated in the same manner, satisfactory improvement was obtained to the dots, coarse image and peeling in the same manner as in Example 216.

EXAMPLE 223

A light receiving member for use in electrophotography was prepared in the same manner as in Example 216, under the preparation conditions shown in Table 218 and, when evaluated in the same manner, satisfactory improvement was obtained to the dots, coarse image and peeling in the same manner as in Example 216.

EXAMPLE 224

A light receiving member for use in electrophotography was prepared in the same manner as in Example 216, under the preparation conditions shown in Table 219 and, when evaluated in the same manner, satisfactory improvement was obtained to the dots, coarse image and peeling in the same manner as in Example 216.

EXAMPLE 225

A light receiving member for use in electrophotography was prepared in the same manner as in Example 216 by further using $PH_3$ gas and $Si_2F_6$ gas from a not illustrated cylinder, under the preparation conditions shown in Table 220 and, when evaluated in the same manner, satisfactory improvement was obtained to the dots, coarse image and peeling in the same manner as in Example 216.

EXAMPLE 226

A light receiving member for use in electrophotography was prepared in the same manner as in Example 225, under the preparation conditions shown in Table 221 and, when evaluated in the same manner, satisfactory improvement was obtained to the dots, coarse image and peeling in the same manner as in Example 225.

EXAMPLE 227

A light receiving member for use in electrophotography was prepared in the same manner as in Example 216 by further using $H_2S$ gas from a not illustrated cylinder, under the preparation conditions shown in Table 222 and, when evaluated in the same manner, satisfactory improvement was obtained to the dots, coarse image and peeling in the same manner as in Example 216.

EXAMPLE 228

A light receiving member for use in electrophotography was prepared in the same manner as in Example 216, under the preparation conditions shown in Table 223 and, when evaluated in the same manner, satisfactory improvement was obtained to the dots, coarse image and peeling in the same manner as in Example 216.

EXAMPLE 229

A light receiving member for use in electrophotography was prepared in the same manner as in Example 216, under the preparation conditions shown in Table 224 and, when evaluated in the same manner, satisfactory improvement was obtained to the dots, coarse image and peeling in the same manner as in Example 216.

EXAMPLE 230

A light receiving member for use in electrophotography was prepared in the same manner as in Example 216 by further using $NH_3$ gas from a not illustrated cylinder, under the preparation conditions shown in Table 225 and, when evaluated in the same manner, satisfactory improvement was obtained to the dots, coarse image and peeling in the same manner as in Example 216.

EXAMPLE 231

A light receiving member for use in electrophotography was prepared in the same manner as in Example 216 by further using $N_2$ gas from a not illustrated cylinder, under the preparation conditions shown in Table 226 and, when evaluated in the same manner, satisfactory improvement was obtained to the dots, coarse image and peeling in the same manner as in Example 216.

EXAMPLE 232

A light receiving member for use in electrophotography was prepared in the same manner as in Example 216, under the preparation conditions shown in Table 227 and, when evaluated in the same manner, satisfactory improvement was obtained to the dots, coarse image and peeling in the same manner as in Example 216.

EXAMPLE 233

A light receiving member for use in electrophotography was prepared in the same manner as in Example 216, under the preparation conditions shown in Table 228 and, when evaluated in the same manner, satisfactory improvement was obtained to the dots, coarse image and peeling in the same manner as in Example 216.

EXAMPLE 234

A light receiving member for use in electrophotography was prepared in the same manner as in Example 225, under the preparation conditions shown in Table 229 and, when evaluated in the same manner, satisfactory improvement was obtained to the dots, coarse image and peeling in the same manner as in Example 225.

EXAMPLE 235

A light receiving member for use in electrophotography was prepared in the same manner as in Example 216, under the preparation conditions shown in Table 230 and, when evaluated in the same manner, satisfactory improvement was obtained to the dots, coarse image and peeling in the same manner as in Example 216.

EXAMPLE 236

The light receiving member for use in electrophotography according to this invention was formed by radio frequency (hereinafter simply referred to as "RF") glow discharge decomposition.

FIG. 37 shows an apparatus for producing the light receiving member for use in electrophotography by the RF glow discharge decomposition, comprising a raw material gas supply device 1020 and a deposition device 1000.

In the figure, raw material gases for forming the respective layers in this invention were tightly sealed in gas cylinders 1071, 1072, 1073, 1074, 1075, 1076, 1077 and 1079, and tightly sealed vessels 1078 and 1080 in which the cylinder 1071 was for $SiH_4$ gas (99.99% purity), the cylinder 1072 was for $H_2$ gas (99.9999%), the cylinder 1073 was for $CH_4$ gas (99.999% purity), the cylinder 1074 was for $GeH_4$ gas (99.999%), the cylinder 1075 was for $PH_3$ gas diluted with $H_2$ gas (99.999% purity, hereinafter simply referred to as "$PH_3/H_2$"), the cylinder 1076 was for NO gas (99.9% purity), the cylinders 1077 and 1079 were for He gas (99.999% purity), the tightly sealed vessel 178 was charged with $AlCl_3$ (99.999% purity) and the tightly sealed vessel 178 was charged with $Mg(C_5H_5)_3$ (99.999% purity).

In the figure, a cylindrical aluminum support 1005 had an outer diameter of 108 mm and a mirror-finished surface.

After confirming that valves 1051–1058 for the gas cylinders 1071–1077 and 1079, flow-in valves 1031–1038 and a leak valve 1015 for the deposition chamber 1001 were closed and flow-out valves 1041–1048 and an auxiliary valve 1018 were opened, a main valve 1016 was at first opened to evacuate the deposition chamber 1001 and gas pipeways by a vacuum pump not illustrated.

Then, when the indication of a vacuum meter 1017 showed about $1\times10^{-3}$ Torr, the auxiliary valve 1018, the flow-out valves 1041–1048 were closed.

Then, the valves 1051–1058 were opened to introduce $SiH_4$ from the gas cylinder 1071, $H_2$ gas from the gas cylinder 1072, $CH_4$ gas from the gas cylinder 1073, $GeH_4$ gas from the gas cylinder 1074, $B_2H_5/H_2$ gas from the gas cylinder 1075, NO gas from the gas cylinder 1076 and He gas from the gas cylinders 1077 and 1079, and the pressures for the respective gases were adjusted to 2 kg/cm$^2$ by pressure controllers 1061–1068.

Then, the flow-in valves 1031–1038 were gradually opened to introduce the respective gases in mass flow controllers 1021–1028. In this case, since the He gas from the gas cylinder 1077 was passed through the tightly sealed vessel 1078 charged with $AlCl_3$, the $AlCl_3$ gas diluted with the He gas (hereinafter simply referred to as "$AlCl_3$/He") was introduced to the mass flow controller 1027 and since the He gas from the gas cylinder 1079 was passed through the tightly sealed vessel 1080 charged with $Mg(C_5H_5)_2$, the $Mg(C_5H_5)_3$ gas diluted with the He gas (hereinafter simply referred to as "$Mg(C_2H_5)_2$/He") was introduced to the mass flow controller 1028.

The temperature of the cylindrical aluminum support 1005 disposed in the deposition chamber 1001 was heated to 250° C. by a heater 1014.

After completing the preparation for the film formation as described above, each of the lower and upper layers was formed on the cylindrical aluminum support 1005.

The lower layer was formed by gradually opening the flow-out valves 1041, 1042, 1047 and 1048, and the auxiliary valve 1018 thereby introducing the $SiH_4$ gas, $H_2$ gas, $AlCl_3$/He gas and $Mg(C_5H_5)$ gas through the gas discharge aperture 1009 of a gas introduction pipe 1008 to the inside of the deposition chamber 1001. In this case, the gas flow rates were controlled by the respective mass flow controllers 1021, 1022, 1027 and 1028 such that the gas flow rates were set to 50 SCCM for $SiH_4$, 10 SCCM for $H_2$ gas, 120 SCCM for $AlCl_3$/He and 10 SCCM for $Mg(C_5H_5)_2$. The pressure in the deposition chamber 1101 was controlled to 0.4 Torr by adjusting the opening of the main valve 1016 while observing the vacuum meter 1017. Then, RF power was introduced to the inside of the deposition chamber 1001 by way of an RF matching box 1012 while setting the power of RF power source (not illustrated) to 5 mW/cm$^3$, to cause RF glow discharge, thereby starting the formation of the lower layer on the aluminum support. The mass flow controllers 1021, 1022, 1027 and 1028 were adjusted during formation of the lower layer such that the $SiH_4$ gas flow remains at a constant rate of 50 SCCM the $H_2$ gas flow rate was increased at a constant ratio from 10 SCCM to 200 SCCM, the $AlCl_3$/He gas flow rate was decreased at a constant ratio from 120 SCCM to 40 SCCM and $Mg(C_5H_5)_2$/He gas flow remains at a constant rate of 10 SCCM. Then, when the lower layer of 0.05 um thickness was formed, the RF glow discharge was stopped and the entrance of the gas to the inside of the deposition chamber 1001 is interrupted by closing the flow-out valves 1041, 1042, 1047 and 1048, and the auxiliary valve 1018, to complete the formation of the lower layer.

Then, for forming the first layer region of the upper layer, the flow-out valves 1041, 1042 and 1046, and the auxiliary valve 1018 were gradually opened to flow $SiH_4$ gas, $H_2$ gas and NO gas through the gas discharge aperture 1009 of the gas introduction pipe 1008 into the deposition chamber 1001. In this case, respective mass flow controllers 1021, 1022 and 1026 were adjusted so that the $SiH_4$ gas flow rate was 100 SCCM, $H_2$ gas flow rate was 100 SCCM and NO gas flow rate was 30 SCCM. The pressure in the deposition chamber 1001 was controlled to 0.35 Torr by adjusting the opening of the main valve 1016 while observing the vacuum meter 1017. Then, RF power was introduced into the deposition chamber 1001 through a radio frequency matching box 1012 while setting the power of RF power source (not illustrated) to 10 mW/cm$^3$, to cause RF glow discharge and start the formation of the first layer region of the upper layer over the lower layer. Then, when the first layer region of the upper layer with 3 um thickness was formed, the RF glow discharge was stopped and the flow of the gas into the deposition chamber 1001 was interrupted by closing the flow-out valves 1041, 1042 and 1046, and the auxiliary valve 1018, thereby completing the formation of the first layer region of the upper layer.

Then, for forming the second layer region of the upper layer, the flow-out valves 1041 and 1042, and the auxiliary valve 1018 were gradually opened to flow $SiH_4$ gas and $H_2$ gas through the gas discharge aperture 1009 of the gas introduction pipe 1008 into the deposition chamber 1001. In this case, respective mass flow controllers 1021 and 1022 were adjusted so that the $SiH_4$ gas flow rate was 300 SCCM and $H_2$ flow rate was 300 SCCM. The pressure in the deposition chamber 1001 was controlled to 0.5 Torr by adjusting the opening of the main valve 1016 while observing the vacuum meter 1017. Then, RF power was introduced into the deposition chamber 1001 through the radio frequency matching box 1012 while setting the power of the RF power source (not illustrated) to 15 $mW/cm^3$, to cause the RF glow discharge and start the formation of the second layer region on the first layer region of the upper layer. Then, when the second layer region of the upper layer with 20 um thickness was formed, the RF glow discharge was stopped and the flow of the gas into the deposition chamber 1001 was interrupted by closing the flowout valves 1041 and 1042, and the auxiliary valve 1018, thereby completing the formation of the second layer region of the upper layer.

Then, for forming the third layer region of the upper layer, the flow-out valves 1041 and 1043, and the auxiliary valve 1018 were gradually opened to flow $SiH_4$ gas and $CH_4$ gas through the gas discharge aperture 1009 of the gas introduction pipe 1008 into the deposition chamber 1001. In this case, respective mass flow controllers 1021 and 1023 were adjusted so that the $SiH_4$ gas flow rate was 50 SCCM and $CH_4$ flow rate was 500 SCCM. The pressure in the deposition chamber 1001 was controlled to 0.4 Torr by adjusting the opening of the main valve 1016 while observing the vacuum meter 1017. Then, RF power was introduced into the deposition chamber 1001 through the radio frequency matching box 1012 while setting the power of RF power source (not illustrated) to 10 $mW/cm^3$, to cause the RF glow discharge and start the formation of the third layer region on the second layer region of the upper layer. Then, when the third layer region of the upper layer with 0.5 um thickness was formed, the RF glow discharge was stopped and the flow of the gas into the deposition chamber 1001 was interrupted by closing the flow-out valves 1041 and 1043, and the auxiliary valve 1018, thereby completing the formation of the third layer region of the upper layer.

The conditions for preparing the light receiving member for use in electrophotography described above are shown in Table 231.

It will be apparent that all of the flow-out valves other than those required for forming respective layers were completely closed and, for avoiding the respective gases from remaining in the deposition chamber 1001 and in the pipeways from the flow-out valves 1041–1048 to the deposition chamber 1001, the flow-out valves 1041–1048 were closed, the auxiliary valve 1018 was opened and, further, the main valve was fully opened thereby evacuating the inside of the system once to a high vacuum degree as required.

Further, for forming the layer uniformly during this layer formation, the cylindrical aluminum support 1005 was rotated at a desired speed by a driving device not illustrated.

COMPARATIVE EXAMPLE 6

A light receiving member for use in electrophotography was prepared under the same preparation conditions as those in Example 236 except for not using $H_2$ gas and $Mg(C_5H_5)_2/H_2$ gas upon forming the lower layer. The conditions for preparing the light receiving member for use in electrophotography are shown in Table 232.

The light receiving members for use in electrophotography thus prepared in Example 236 and Comparative Example 6 were set respectively to an electrophotographic apparatus, i.e., a copying machine NP-7550 manufactured by Canon Inc. and modified for experimental use and, when several electrophotographic properties were checked under various conditions, it was found that both of them had outstanding characteristics with voltage withstanding property in that no image defects were formed even if a high voltage wa applied to the light receiving member for use in electrophotography by highly intensive corona discharge or frictional discharge by means of a cleaning agent.

Then, when the number of dots as the image characteristics were compared, it was found that the number of dots, particularly, the number of dots with less than 0.1 mm diameter of the light receiving member for use in electrophotography of Example 236 was less than ⅓ of that of the light receiving member for use in electrophotography in Comparative Example 6. In addition, for comparing the "coarse image", when the image density was measured for circular regions each of 0.05 mm diameter assumed as one unit at 100 points and the scattering in the image density was evaluated, it was found that the scattering in the light receiving member for use in electrophotography of Example 236 was less than ¼ for that of the light receiving member for use in electrophotography in Comparative Example 6 and the light receiving member for use in electrophotography of Example 236 was excellent over the light receiving member for use in Electrophotography of Comparative Example 6 in view of the visual observation.

In addition, for comparing the occurrerce of image defects and the peeling of the light receiving layer due to impactive mechanical pressure applied for a relatively short period of time to the light receiving member for use in electrophotography, when stainless steel balls of 3.5 mm diameter were fallen freely from the vertical height of 30 cm above the surface of the light receiving member for use in electrophotography and abutted against the surface of the light receiving member for use in electrophotography, to thereby measure the frequency that cracks occurred to the light receiving layer, it was found that the rate of occurrence in the light receiving member for use in electrophotography of Example 236 was less than ¼ for that in the light receiving member for use in electrophotography of Comparative Example 6.

When the lower layer of the light receiving member for use in electrophotography of Example 236 was analyzed by using SIMS, it was found that the content of silicon atoms, hydrogen atoms and aluminum atoms in the direction of the film thickness was varied as desired.

As has been described above, the light receiving member for use in electrophotography of Example 236 was superior to the light receiving member for use in electrophotography of Comparative Example 6.

EXAMPLE 237

A light receiving member for use in electrophotography was prepared in the same manner as in Example 236 by changing the way of varying the $AlCl_3$/He gas flow rate in the lower layer, under the preparation conditions shown in Table 233 and, when evaluated in the same manner, satisfactory improvement was obtained to the dots, coarse image and peeling in the same manner as in Example 236.

EXAMPLE 238

A light receiving member for use in electrophotography was prepared in the same manner as in Example 236 by not using the $CH_4$ gas in the upper layer of Example 236, under the preparation conditions shown in Table 234 and, when evaluated in the same manner, satisfactory improvement was obtained to the dots, coarse image and peeling in the same manner as in Example 181.

EXAMPLE 239

A light receiving member for use in electrophotography was prepared in the same manner as in Example 181 by further using not illustrated $SiF_4$ gas (99.9999% purity), not illustrated He gas (99.999% purity) and not illustrated $N_2$ gas in Example 236, under the preparation conditions shown in Table 235 and, when evaluated in the same manner, satisfactory improvement was obtained to the dots, coarse image and peeling in the same manner as in Example 236.

EXAMPLE 240

A light receiving member for use in electrophotography was prepared in the same manner as in Example 236 by replacing $GeH_4$ gas cylinder with Ar gas (99.9999% purity) cylinder, replacing NO gas cylinder with $NH_3$ gas (99.999% purity) cylinder, replacing $B_2H_6/H_2$ gas cylinder with $H_2$-diluted $PH_3$ gas (99.999% purity, hereinafter simply referred to as "$PH_3/H_2$ gas") purity, hereinafter simply referred to as $PH_3/H_2$) cylinder, replacing the NO gas cylinder with $NH_3$ gas (99.999% purity) cylinder in Example 236, under the preparation conditions shown in Table 236 and, when evaluated in the same manner, satisfactory improvement was obtained to the dots, coarse image and peeling in the same manner as in Example 236.

EXAMPLE 241

A light receiving member for use in electrophotography was prepared in the same manner as in Example 236 by further using $B_2H_6/H_2$ gas, not illustrated $PH_3/H_2$ gas, not illustrated $C_2H_2$ gas and not illustrated $SiF_4$ gas, under the preparation conditions shown in Table 237 and, when evaluated in the same manner, satisfactory improvement was obtained to dots, coarse image and peeling in the same manner as in Example 236.

EXAMPLE 242

A light receiving member for use in electrophotography was prepared in the same manner as in Example 236 by replacing $GeH_4$ gas cylinder with $SiF_4$ gas (99.999% purity) cylinder, and further using NO gas, not illustrated $PH_3/H_2$ gas, $B_2H_6/H_2$ gas and Si/$F_4$ gas, under the preparation conditions shown in Table 238 and, when evaluated in the same manner, satisfactory improvement was obtained to dots, coarse image and peeling in the same manner as in Example 236.

EXAMPLE 243

A light receiving member for use in electrophotography was prepared in the same manner as in Example 236 by further using $B_2H_6/H_2$ gas, not illustrated $H_2S$ (99.9% purity), not illustrated $PH_3/H_2$ gas and not illustrated $N_2$ gas, under the preparation conditions shown in Table 239, and, when evaluated in the same manner, satisfactory improvement was obtained to dots, coarse image and peeling in the same manner as in Example 181.

EXAMPLE 244

A light receiving member for use in electrophotography was prepared in the same manner as in Example 236 replacing the $CH_4$ gas cylinder with $C_2H_2$ gas (99.999% purity) cylinder in Example 236, under the preparation conditions shown in Table 240 and, when evaluated in the same manner, satisfactory improvement was obtained to the dots, coarse image and peeling in the same manner as in Example 236.

EXAMPLE 245

A light receiving member for use in electrophotography was prepared in the same manner as in Example 236 by replacing the $B_2H_6/H_2$ gas cylinder with $BF_3$ gas diluted $H_2$ (99.999% purity, hereinafter simply referred to as $BF_3/H_2$) cylinder, and replacing the NO gas cylinder with $N_2$ gas and using $H_2S$ gas from a not illustrated cylinder in Example 236, under the preparation conditions shown in Table 241, and when evaluated in the same manner, satisfactory improvement was obtained to the dots, coarse image and peeling in the same manner as in Example 181.

EXAMPLE 246

A light receiving member for use in electrophotography was prepared in the same manner as in Example 236 by replacing the NO gas cylinder with a $NH_3$ gas (99.999% purity) cylinder, replacing $B_2H_6/H_2$ gas cylinder with $PH_3/H_2$ gas cylinder in Example 236, under the preparation conditions shown in Table 242, and, when evaluated in the same manner, satisfactory improvement was obtained to the dots, coarse image and peeling in the same manner as in Example 236.

EXAMPLE 247

A light receiving member for use in electrophotography was prepared in the same manner as in Example 241 by further using $H_2$-diluted $PF_5$ gas from a not illustrated cylinder (99.999% purity, hereinafter simply referred to as "$PF_3/H_2$ gas"), $SiF_4$ gas and $B_2H_6/H_2$ gas, under the preparation conditions shown in Table 243, and when evaluated in the same manner, satisfactory improvement was obtained to the dots, coarse image and peeling in the same manner as in Example 241.

EXAMPLE 248

A light receiving member for use in electrophotography was prepared in the same manner as in Example 244 by further using $Si_2H_6$ (99.99% purity), $Si_2F_6$ (99199% purity) gas and $PH_3/H_3$ gas, under the preparation conditions shown in Table 244, and, when evaluated in the same manner, satisfactory improvement was obtained to the dots, coarse image and peeling in the same manner as in Example 244.

EXAMPLE 249

A light receiving member for use in electrophotography was prepared in the same manner as in Example 246 by further using $B_2H_6/H_2$ gas from a not illustrated cylinder, $PH_5/H_5$ gas and $Si_2F_6$ gas, under the preparation conditions shown in Table 245 and, when evaluated in the same manner, satisfactory improvement was obtained to dots, coarse image and peeling in the same manner as in Example 246.

EXAMPLE 250

A light receiving member for use in electrophotography was prepared in the same manner as in Example 236 by further using $B_2H_6/H_2$ gas and $GeH_4$ gas in the upper layer, under the preparation conditions shown in Table 246 and, when evaluated in the same manner, satisfactory improvement was obtained to dots, coarse image and peeling in the same manner as in Example 236.

EXAMPLE 251

A light receiving member for use in electrophotography was prepared in the same manner as in Example 236 by changing the outer diameter of the cylindrical aluminum support to 80 mm in Example 247, under the preparation conditions shown in Table 193 and, when evaluated in the same manner as in Example 236, except for using an electrophotographic apparatus, i.e., a copying machine NP-9030 manufactured by Canon Inc. and modified for the experimental use, satisfactory improvement was obtained to the dots, coarse image and peeling in the same manner as in Example 236.

EXAMPLE 252

A light receiving member for use in electrophotography was prepared in the same manner as in Example 236 by changing the outer diameter of the cylindrical aluminum support to 60 mm in Example 236, under the preparation conditions shown in Table 248 and, when evaluated in the same manner as in Example 236 except for using an electrophotographic apparatus, i.e., a copying machine NP-150Z manufactured by Canon Inc. and modified for the experimental use, satisfactory improvement was obtained to the dots, coarse image and peeling in the same manner as in Example 236.

EXAMPLE 253

A light receiving member for use in electrophotography was prepared in the same manner as in Example 236 by changing the outer diameter of the cylindrical aluminum support to 30 mm in Example 236 under the preparation conditions shown in Table 249 and, when evaluated in the same manner as in Example 236, except for using an electrophotographic apparatus, i.e., a copying machine FC-5 manufactured by Canon Inc. and modified for the experimental use, satisfactory improvement was obtained to the dots, coarse image and peeling in the same manner as in Example 236.

EXAMPLE 254

A light receiving member for use in electrophotography was prepared in the same manner as in Example 236 by changing the outer diameter of the cylindrical aluminum support to 15 mm in Example 236, under the preparation conditions shown in Table 250, and evaluated in the same manner as in Example 236, except for using an electrophotographic apparatus, manufactured for experimental use and, when evaluated in the same manner, satisfactory improvement was obtained to the dots, coarse image and peeling in the same manner as in Example 236.

EXAMPLE 255

A light sensitive member for use in electrophotography was prepared, under the same preparation conditions as those in Example 251 by using a cylindrical aluminum support applied with mirror-finishing fabrication in Example 251 and further machined into a cross sectional shape of: a=25 um, b=0.8 um as shown in FIG. 38 by a diamond point tool and, when evaluated in the same manner as in Example 251, satisfactory improvement was obtained to, the dots, coarse image and peeling in the same manner as in Example 251.

EXAMPLE 256

A light receiving member for use in electrophotography was prepared, under the same preparation conditions as those in Example 251 using a cylindrical aluminum support applied with mirror-finish fabrication and subsequently applied with a so-called surface dimpling of causing a number of hit pits to the surface of the cylindrical aluminum support by the exposure to a plurality of dropping bearing balls to form into a cross sectional shape of: c=50 um and d=1 um as shown in FIG. 39 and, when evaluated in the same manner as in Example 251, satisfactory improvement was be obtained for the dots, coarse image and peeling in the same as in Example 251.

EXAMPLE 257

A light receiving member for use in electrophotography having an upper layer comprising poly-Si(H, X) was prepared in the same manner as in Example 244 by using a cylindrical aluminum support heated to a temperature of 500° C., under the preparation conditions as shown in Table 251 and, when evaluated in the same manner, satisfactory improvement was obtained to dots, coarse image and peeling in the same manner as in Example 244.

EXAMPLE 258

A light receiving member for use in electrophotography was prepared by microwave glow discharge decomposition in the same manner as in Example 23 by further using $SiF_4$ gas, NO gas, $Mg(C_5H_5)_2$/He gas and $B_2H_6/H_2$ gas upon forming the lower layer in Example 23, under the same preparation conditions as shown in Table 252.

When the light receiving member for use in electrophotography was evaluated in the same manner as in Example 236. satisfactory improvement was obtained to the dots, coarse image and peeling in the same manner as in Example 236.

When the lower layer of the light receiving member for use in electrophotography of Example 258 was analyzed by using SIMS, it was found that the content of silicon atoms, hydrogen atoms and aluminum atoms in the direction of the film thickness was varied as desired.

EXAMPLE 259

A light receiving member for use in electrophotography was prepared in the same manner as in Example 236 by replacing the $CH_4$ gas cylinder with a $C_2H_2$ gas (99.9999% purity) cylinder, and further using $B_2H_6/H_2$ gas $Si_2F_6$ gas in Example 236, under the preparation conditions shown in Table 253 and, when evaluated in the same manner, satisfactory improvement was obtained to the dots, coarse image and peeling in the same manner as in Example 236.

EXAMPLE 260

A light receiving member for use in electrophotography was prepared in the same manner as in Example 236 by further using $B_2H_6/H_2$ gas, $N_2$ gas, under the preparation conditions shown in Table 254 and, when evaluated in the same manner, satisfactory improvement was obtained to the dots, coarse image and peeling in the same manner as in Example 236.

EXAMPLE 261

A light receiving member for use in electrophotography was prepared in the same manner as in Example 236 by using $SnH_4$ gas (99.99% purity) from a not illustrated cylinder, $PF_3/H_2$ gas, $Si_2/F_6$ gas and replacing NO gas cylinder with $NH_3$ gas (99.999%, purity) cylinder in Example 236, under the preparation conditions shown in Table 255 and, when evaluated in the same manner, satisfactory improvement was obtained to the dots, coarse image and peeling in the same manner as in Example 236.

EXAMPLE 262

A light receiving member for use in electrophotography was prepared in the same manner as in Example 241 by replacing $N_2$ gas cylinder with $SiF_4$ gas and further using $PF_5H_2$ gas from a not illustrated cylinder, $SiF_4$ gas in Example 236, under the preparation conditions shown in Table 256 and, when evaluated in the same manner, satisfactory improvement was obtained to the dots, coarse image and peeling in the same manner as in Example 241.

EXAMPLE 263

A light receiving member for use in electrophotography was prepared in the same manner as in Example 244 by further using $Si_2H_6/H_2$ gas in the upper layer, under the preparation conditions shown in Table 257 and, when evaluated in the same manner, satisfactory improvement was obtained to the dots, coarse image and peeling in the same manner as in Example 244.

EXAMPLE 264

A light receiving member for use in electrophotography was prepared in the same manner as in Example 246 by further using $B_2H_6/H_2$ gas in the upper layer, under the preparation conditions shown in Table 258 and, when evaluated in the same manner, satisfactory improvement was obtained to the dots, coarse image and peeling in the same manner as in Example 246.

EXAMPLE 265

A light receiving member for use in electrophotography was prepared in the same manner as in Example 236 by further using $B_2H_6/H_2$ gas and He gas from a not illustrated cylinder, under the preparation conditions shown in Table 259 and, when evaluated in the same manner, satisfactory improvement was obtained to the dots, coarse image and peeling in the same manner as in Example 236.

EXAMPLE 266

A light receiving member for use in electrophotography was prepared in the same manner as in Example 236 by further using $B_2H_6/H_2$ gas, $SiF_4$ gas from a not illustrated cylinder, $C_2H_2$ gas and $PH_3/H_2$, under the preparation conditions shown in Table 266 and, when evaluated in the same manner, satisfactory improvement was obtained to the dots, coarse image and peeling in the same manner as in Example 236.

EXAMPLE 267

A light receiving member for use in electrophotography was prepared in the same manner as in Example 241, under the preparation conditions shown in Table 261 and, when evaluated in the same manner, satisfactory improvement was obtained to the dots, coarse image and peeling in the same manner as in Example 241.

EXAMPLE 268

A light receiving member for use in electrophotography was prepared in the same manner as in Example 236 by further using $B_2H_6/H_2$ gas, $C_2H_2$ gas from a not illustrated cylinder, under the preparation conditions shown in Table 262 and, when evaluated in the same manner, satisfactory improvement was obtained to the dots, coarse image and peeling in the same manner as in Example 236.

EXAMPLE 269

A light receiving member for use in electrophotography was prepared in the same manner as in Example 236 by further using $C_2H_2$ gas from a not illustrated cylinder, $PH_3/H_2$ gas, under the preparation conditions shown in Table 262 and, when evaluated in the same manner, satisfactory improvement was obtained to the dots, coarse image and peeling in the same manner as in Example 236.

EXAMPLE 270

A light receiving member for use in electrophotography was prepared in the same manner as in Example 236 by further using $GeH_4$ gas, $H_2S$ gas from a not illustrated cylinder, $PH_3/H_2$ gas, $C_2H_2$ gas and $SiF_4$, under the preparation conditions shown in Table 264 and, when evaluated in the same manner, satisfactory improvement was obtained to the dots, coarse image and peeling in the same manner as in Example 236.

EXAMPLE 271

A light receiving member for use in electrophotography was prepared in the same manner as in Example 244 by further using $SiH_4$ gas from a not illustrated cylinder, under the preparation conditions shown in Table 265 and, when evaluated in the same manner, satisfactory improvement was obtained to the dots, coarse image and peeling in the same manner as in Example 244.

EXAMPLE 272

A light receiving member for use in electrophotography was prepared in the same manner as in Example 271, under the preparation conditions shown in Table 266 and, when evaluated in the same manner, satisfactory improvement was obtained to the dots, coarse image and peeling in the same manner as in Example 271.

EXAMPLE 273

A light receiving member for use in electrophotography was prepared in the same manner as in Example 271, under the preparation conditions shown in Table 267 and, when evaluated in the same manner, satisfactory improvement was obtained to the dots, coarse image and peeling in the same manner as in Example 271.

EXAMPLE 274

A light receiving member for use in electrophotography was prepared in the same manner as in Example 271 by further using $BF_3$ gas from a not illustrated cylinder, under the preparation conditions shown in Table 268 and, when evaluated in the same manner, satisfactory improvement was obtained to the dots, coarse image and peeling in the same manner as in Example 271.

EXAMPLE 275

A light receiving member for use in electrophotography was prepared in the same manner as in Example 271, under the preparation conditions shown in Table 269 and, when evaluated in the same manner, satisfactory improvement was obtained to the dots, coarse image and peeling in the same manner as in Example 271.

EXAMPLE 276

A light receiving member for use in electrophotography was prepared in the same manner as in Example 271, under the preparation conditions shown in Table 270 and, when evaluated in the same manner, satisfactory improvement was obtained to the dots, coarse image and peeling in the same manner as in Example 271.

EXAMPLE 277

A light receiving member for use in electrophotography was prepared in the same manner as in Example 271, under the preparation conditions shown in Table 271 and, when evaluated in the same manner, satisfactory improvement was obtained to the dots, coarse image and peeling in the same manner as in Example 271.

EXAMPLE 278

A light receiving member for use in electrophotography was prepared in the same manner as in Example 271, under the preparation conditions shown in Table 272 and, when evaluated in the same manner, satisfactory improvement was obtained to the dots, coarse image and peeling in the same manner as in Example 271.

EXAMPLE 279

A light receiving member for use in electrophotography was prepared in the same manner as in Example 271, under the preparation conditions shown in Table 273 and, when evaluated in the same manner, satisfactory improvement was obtained to the dots, coarse image and peeling in the same manner as in Example 271.

EXAMPLE 280

A light receiving member for use in electrophotography was prepared in the same manner as in Example 271 by further using $PH_3$ gas from a not illustrated cylinder and $Si_2F_6$ gas, under preparation conditions shown in Table 274 and, when evaluated in the same manner, satisfactory improvement was obtained to the dots, coarse image and peeling in the same manner as in Example 271.

EXAMPLE 281

A light receiving member for use in electrophotography was prepared in the same manner as in Example 280, under the preparation conditions shown in Table 275 and, when evaluated in the same manner, satisfactory improvement was obtained to the dots, coarse image and peeling in the same manner as in Example 280.

EXAMPLE 282

A light receiving member for use in electrophotography was prepared in the same manner as in Example 271 by using $H_2S$ gas from a not illustrated cylinder, under the preparation conditions shown in Table 276 and, when evaluated in the same manner, satisfactory improvement was obtained to the dots, coarse image and peeling in the same manner as in Example 271.

EXAMPLE 283

A light receiving member for use in electrophotography was prepared in the same manner as in Example 271, under the preparation conditions shown in Table 277 and, when evaluated in the same manner, satisfactory improvement was obtained to the dots, coarse image and peeling in the same manner as in Example 271.

EXAMPLE 284

A light receiving member for use in electrophotography was prepared in the same manner as in Example 271, under the preparation conditions shown in Table 278 and, when evaluated in the same manner, satisfactory improvement was obtained to the dots, coarse image and peeling in the same manner as in Example 271.

EXAMPLE 285

A light receiving member for use in electrophotography was prepared in the same manner as in Example 271 by using $NH_3$ gas from a not illustrated cylinder, under the preparation conditions shown in Table 279 and, when evaluated in the same manner, satisfactory improvement was obtained to the dots, coarse image and peeling in the same manner as in Example 271.

EXAMPLE 286

A light receiving member for use in electrophotography was prepared in the same manner as in Example 271 by using $N_2$ gas from a not illustrated cylinder, under the preparation conditions shown in Table 280 and, when evaluated in the same manner, satisfactory improvement was obtained to the dots, coarse image and peeling in the same manner as in Example 271.

EXAMPLE 287

A light receiving member for use in electrophotography was prepared in the same manner as in Example 271, under the preparation conditions shown in Table 281 and, when evaluated in the same manner, satisfactory improvement was obtained to the dots, coarse image and peeling in the same manner as in Example 271.

EXAMPLE 288

A light receiving member for use in electrophotography was prepared in the same manner as in Example 271, under the preparation conditions shown in Table 282 and, when evaluated in the same manner, satisfactory improvement was obtained to the dots, coarse image and peeling in the same manner as in Example 271.

EXAMPLE 289

A light receiving member for use in electrophotography was prepared in the same manner as in Example 280, under the preparation conditions shown in Table 283 and, when evaluated in the same manner, satisfactory improvement was obtained to the dots, coarse image and peeling in the same manner as in Example 280.

EXAMPLE 290

A light receiving member for use in electrophotography was prepared in the same manner as in Example 271, under the preparation conditions shown in Table 284 and, when evaluated in the same manner, satisfactory improvement was obtained to the dots, coarse image and peeling in the same manner as in Example 71.

EXAMPLE 291

A lower layer of a light receiving member for use in electrophotography according to this invention was formed by RF sputtering method and the upper layer thereof was formed RF glow discharge decomposition.

FIG. 42 shows an apparatus for producing the light receiving member for use in electrophotography by the RF sputtering, comprising a raw material gas supply device 1500 and a deposition device 1501.

In the figure, a target 1045 is composed of Si, Al and Mg as the raw material for forming the lower layer, in which the mixing ratio for the atoms is varied such that a desired profile is obtained across the thickness for each of the atoms.

In the figure, raw material gases for forming the lower layer in this invention were tightly sealed in gas cylinders 1408, 1409 and 1410, in which the cylinder 1408 was for $SiH_4$ gas (99.99% purity), the cylinder 1409 was for $H_2$ gas (99.9999%) and the cylinder 1076 was for Ar gas (99.9999% purity).

In the figure, a cylindrical aluminum support 1402 has an outer diameter of 108 mm and a mirror-finished surface.

At first, in the same manner as in Example 1, the inside of the deposition chamber 1401 and gas pipeways was evacuated till the pressure of the deposition chamber 1401 was reduced to $1\times10^{-6}$ Torr.

Then, in the same manner as in Example 1, the respective gases were introduced into the mass flow controllers 1412–1414.

The temperature of the cylindrical aluminum support 1402 disposed in the deposition chamber 1401 was heated to 250° C. by a heater not illustrated.

After completing the preparation for the film formation as described above, the lower layer was formed on the cylindrical aluminum support 1402.

The lower layer was formed by gradually opening the flow-out valves 1420, 1421 and 1422, and the auxiliary valve 1432 thereby introducing the $SiH_4$ gas, $H_2$ gas and Ar gas to the inside of the deposition chamber 1401. In this case, the gas flow rates were controlled by the respective mass flow controllers 1412, 1413 and 1414 such that the gas flow rates were set to 50 SCCM for $SiH_4$, 10 SCCM for $H_2$ gas, and 200 SCCM for Ar gas. The pressure in the deposition chamber 1401 was controlled to 0.01 Torr by adjusting the opening of the main valve 1407 while observing the vacuum meter 1435. Then, RF power was introduced between the target 1405 and the aluminum support 1402 by way of an RF matching box 1433 while setting the power of an RF power source (not illustrated) to 1 $mW/cm^3$, thereby starting the formation of the lower layer on the cylindrical aluminum support. The mass flow controllers 1412, 1413 and 1414 were adjusted during formation of the lower layer such that the $SiH_4$ gas flow remained at a constant rate of 50 SCCM, the $H_2$ gas flow rate was increased at a constant ratio from 5 SCCM to 100 SCCM and the Ar gas flow rate remained at a constant ratio of 204 SCCM. Then, when the lower layer of 0.05 um thickness was formed, the RF glow discharge was stopped and the entrance of the gas to the inside of the deposition chamber 1401 was interrupted by closing the flow-out valves 1420, 1421 and 1423 and the auxiliary valve 1432, to complete the formation of the lower layer.

The cylindrical aluminum support 1402 was rotated at a desired speed by a driving device not illustrated during formation of the lower layer for making the layer formation uniform.

Then, a light receiving member for use in electrophotography was prepared in the same manner as in Example 265 under the preparation conditions shown in Table 285 by using the device illustrated in FIG. 37 upon forming the upper layer. When the same evaluation was applied, satisfactory improvement was obtained to dots, coarse image and layer peeling in the same manner as in Example 265.

When the lower layer of the light receiving member for use in electrophotography of Example 291 was analyzed by using SIMS, it was found that the content of silicon atoms, hydrogen atoms and aluminum atoms in the direction of the film thickness was varied as desired.

EXAMPLE 292

A light receiving member for use in electrophotography was prepared in the same manner as in Example 1 under the preparation conditions shown in Table 286 by further using $Cu(C_4H_7N_2O_2)_2$/He gas upon forming the lower layer in Example 1.

COMPARATIVE EXAMPLE 7

A light receiving member for use in electrophotography was prepared under the same preparation conditions as those in Example 292 except for not using $H_2$ gas and $Cu(C_4H_7N_2O_2)_2$/He gas upon forming the lower layer. The conditions for preparing the light receiving member for use in electrophotography are shown in Table 287.

The light receiving members for use in electrophotography thus prepared in Example 292 and Comparative Example 7 were set respectively to an electrophotographic apparatus, i.e., a copying machine NP-7550 manufactured by Canon Inc. and modified for experimental use and, when several electrophotographic properties were checked under various conditions, it was found that both of them had outstanding characteristic with voltage withstanding property in that no image defects were formed even if a high voltage was applied to the light receiving member for use in electrophotography by highly intensive corona discharge or frictional discharge by means of a cleaning agent.

Then, when the number of dots as the image characteristics were compared, it was found that the number of dots, particularly, the number of dots with less than 0.1 mm diameter of the light receiving member for use in electrophotography of Example 292 was less than ¼ of that of the light receiving member for use in electrophotography in Comparative Example 7. In addition, for comparing the "coarse image", when the image density was measured for circular regions each of 0.05 mm diameter assumed as one unit at 100 points and the scattering in the image density, was evaluated, it was found that the scattering in the light receiving member for use in electrophotography of Example 292 was less than 1/5 for that of the light receiving member for use in electrophotography in Comparative Example 7 and the light receiving member for use in electrophotography of Example 292 was excellent over the light receiving member for use in Electrophotography of Comparative Example 7 in view of the visual observation.

In addition, for comparing the occurrence of image defects and the peeling of the light receiving layer due to impactive mechanical pressure applied for a relatively short period of time to the light receiving member for use in electrophotography, when stainless steel balls of 3.5 mm diameter were fallen freely from the vertical height of 30 cm above the surface of the light receiving member for use in electrophotography and abutted against the surface of the light receiving member for use in electrophotography, to thereby measure the frequency that cracks occurred to the light receiving layer, it was found that the rate of occurrence in the light receiving member for use in electrophotography of Example 292 was less than 1/5 for that in the light receiving member for use in electrophotography of Comparative Example 7.

When the lower layer of the light receiving member for use in electrophotography of Example 292 was analyzed by using SIMS, it was found that the content of silicon atoms, hydrogen atoms and aluminum atoms in the direction of the film thickness was varied as desired.

As has been described above, the light receiving member for use in electrophotography of Example 292 was superior to the light receiving member for use in electrophotography of Comparative Example 6.

EXAMPLE 293

A light receiving member for use in electrophotography was prepared in the same manner as in Example 292 by using $B_2H_6/H_2$ gas and NO gas and changing the way of varying the $AlCl_3$/He gas flow rate in the lower layer, under the preparation conditions shown in Table 288, and when evaluated in the same manner, satisfactory improvement was obtained to the dots, coarse image and peeling in the same manner as in Example 292.

EXAMPLE 294

A light receiving member for use in electrophotography was prepared in the same manner as in Example 292 by using $Mg(C_5H_5)$ gas diluted with He gas (hereinafter simply referred to as "$Mg(C_5H_5)_2$/He") from a not illustrated sealed vessel and $GeH_4$ gas in the lower layer, and He gas from a not illustrated cylinder in the upper layer, under the preparation conditions shown in Table 289 and, when evaluated in the same manner, satisfactory improvement was obtained to the dots, coarse image and peeling in the same manner as in Example 292.

EXAMPLE 295

A light receiving member for use in electrophotography was prepared in the same manner as in Example 292 by further using $Mg(C_5H_5)_2$/He gas from a not illustrated sealed vessel, $CH_4$ gas, $B_2H_6/H_2$ gas, NO gas, $SiF_4$ gas (99.999% purity) from a not illustrated cylinder, $N_2$ gas from a not illustrated cylinder and He gas, under the preparation conditions shown in Table 290 and, when evaluated in the same manner, satisfactory improvement was obtained to the dots, coarse image and peeling in the same manner as in Example 236.

EXAMPLE 296

A light receiving member for use in electrophotography was prepared in the same manner as in Example 291 by replacing $H_2$ gas cylinder with Ar gas cylinder (99.9999% purity), $CH_4$ gas cylinder with $NH_3$ gas cylinder (99.999% purity), and further using $SiV_4$ gas in the upper layer, under the preparation conditions shown in Table 291 and, when evaluated in the same manner, satisfactory improvement, was obtained to the dots, coarse image and peeling in the same manner as in Example 236.

EXAMPLE 297

A light receiving member for use in electrophotography was prepared in the same manner as in Example 292 by using $CH_4$ gas and $B_2H_6/H_2$ gas in the lower layer, and $PH_3/H_2$ gas (99.999% purity) from a not illustrated cylinder in the upper layer, under the preparation conditions shown in Table 292, and when evaluated in the same manner, satisfactory improvement was obtained to the dots, coarse image and peeling in the same manner as in Example 292.

EXAMPLE 298

A light receiving member for use in electrophotography was prepared in the same manner as in Example 292 by replacing NO gas cylinder with $SiF_4$ gas cylinder in the lower layer, and further using $PH_3/H_2$ from a not illustrated cylinder in the upper layer in Example 292, under the preparation conditions shown in Table 298 and, when evaluated in the same manner, satisfactory improvement was obtained to dots, coarse image and peeling in the same manner as in Example 292.

EXAMPLE 299

A light receiving member for use in electrophotography was prepared in the same manner as in Example 292 by using $Mg(C_5H_5)_2$/He gas from a not illustrated sealed vessel in the lower layer, and $PH_3/H_2$ gas from a not illustrated cylinder and $N_2$ gas in the upper layer, under the preparation conditions shown in Table 294 and, when evaluated in the same manner, satisfactory improvement was obtained to dots, coarse image and peeling in the same manner as in Example 292.

EXAMPLE 300

A light receiving member for use in electrophotography was prepared in the same manner as in Example 292 by further using $CH_4$ gas and $B_2H_6/H_2$ gas in the lower layer, and replacing $CH_4$ gas cylinder with $C_2H_2$ gas (99.9999% purity) cylinder in the upper layer, under the preparation conditions shown in Table 295 and, when evaluated in the same manner, satisfactory improvement was obtained to dots, coarse image and peeling in the same manner as in Example 292.

EXAMPLE 301

A light receiving member for use in electrophotography was prepared in the same manner as in Example 292 by using $Mg(C_5H_5)_2/He$ gas from a not illustrated sealed vessel, replacing $B_2H_6$ gas cylinder with $PH_3/H_2$ gas cylinder and further using $SiF_4$ gas from a not illustrated cylinder, under the preparation conditions shown in Table 296 and, when evaluated in the same manner, satisfactory improvement was obtained to dots, coarse image and peeling in the same manner as in Example 292.

EXAMPLE 302

A light receiving member for use in electrophotography was prepared in the same manner as in Example 292 by replacing $CH_4$ gas cylinder with $NH_3$ gas (99.999% purity) cylinder in Example 292, and using $NH_3$ gas in the upper layer, under the preparation conditions shown in Table 297, and, when evaluated in the same manner, satisfactory improvement was obtained to dots, coarse image and peeling in the same manner as in Example 292.

EXAMPLE 303

A light receiving member for use in electrophotography was prepared in the same manner as in Example 297 by using $CH_4$ gas in the lower layer, and further using $SiF_4$ gas in the upper layer, under the preparation conditions shown in Table 298 and, when evaluated in the same manner, satisfactory improvement was obtained to the dots, coarse image and peeling in the same manner as in Example 297.

EXAMPLE 304

A light receiving member for use in electrophotography was prepared in the same manner as in Example 300 by replacing $CH_4$ gas with $C_2H_2$ gas, using $PH_3/H_2$ gas from a not illustrated cylinder in the lower layer, and further using $Si_2F_6$ gas (99.99% purity) cylinder from a not illustrated cylinder and $Si_2F_6$ gas (99.99 a% purity) in the upper layer, under the preparation conditions shown in Table 299 and, when evaluated in the same manner, satisfactory improvement was obtained to the dots, coarse image and peeling in the same manner as in Example 300.

EXAMPLE 305

A light receiving member for use in electrophotography was prepared in the same manner as in Example 292 by using $Si_2F_6$ gas, $PH_3$ gas and $NH_3$ gas from a not illustrated cylinder, under the preparation conditions shown in Table 300, and, when evaluated in the same manner, satisfactory improvement was obtained to the dots, coarse image and peeling in the same manner as in Example 292.

EXAMPLE 306

A light receiving member for use in electrophotography was prepared in the same manner as in Example 292, under the preparation conditions shown in Table 301 and, when evaluated in the same manner, satisfactory improvement was, obtained to the dots, coarse image and peeling in the same manner as in Example 292.

EXAMPLE 307

A light receiving member for use in electrophotography was prepared in the same manner as in Example 292 by changing the outer diameter of the cylindrical aluminum support to 80 mm in Example 292, under the preparation conditions shown in Table 302 and, when evaluated in the same manner as in Example 292, except for using an electrophotographic apparatus, i.e., a copying machine NP-9030 manufactured by Canon Inc, and modified for the experimental use, satisfactory improvement was obtained to the dots, coarse image and peeling in the same manner as in Example 292.

EXAMPLE 308

A light receiving member for use in electrophotography was prepared in the same manner as in Example 292 by changing the outer diameter of the cylindrical aluminum support to 60 mm in Example 292, under the preparation conditions shown in Table 303 and, when evaluated in the same manner as in Example 292, except for using an electrophotographic apparatus, i.e., a copying machine NP-150Z manufactured by Canon Inc. and modified for the experimental use, satisfactory improvement was obtained to the dots, coarse image and peeling in the same manner as in Example 292.

EXAMPLE 309

A light receiving member for use in electrophotography was prepared in the same manner as in Example 292 by changing the outer diameter of the cylindrical aluminum support to 30 mm in Example 294, under the preparation conditions shown in Table 304 and, when evaluated in the same manner as in Example 236, except for using an electrophotographic apparatus, i.e., a copying machine FC-5 manufactured by Canon Inc. and modified for the experimental use, satisfactory improvement was obtained to the dots, coarse image and peeling in the same manner as in Example 292.

EXAMPLE 310

A light receiving member for use in electrophotography was prepared in the same manner as in Example 292 by changing the outer diameter of the cylindrical aluminum support to 15 mm in Example 292, under the preparation conditions shown in Table 305, and evaluated in the same manner as in Example 292, except for using an electrophotographic apparatus, manufactured for experimental use and, when evaluated in the same manner, satisfactory improvement was obtained to the dots, coarse image and peeling in the same manner as in Example 292.

EXAMPLE 311

A light sensitive member for use in electrophotography was prepared, under the same preparation conditions as those in Example 307 by using a cylindrical aluminum support applied with mirror-finishing fabrication in Example 307 and further machined into a cross sectional shape of: $a=25\ \mu m$, $b=0.8\ \mu m$ as shown in FIG. 38 by a diamond point tool and, when evaluated in the same manner as in Example 207, satisfactory improvement was obtained to, the dots, coarse image and peeling in the same manner as in Example 307.

EXAMPLE 312

A light receiving member for use in electrophotography was prepared, under the same preparation conditions as those in Example 307 using a cylindrical aluminum support applied with mirror-finish fabrication and subsequently applied with a so-called surface dimpling of causing a number of hit pits to the surface of the cylindrical aluminum support by the exposure to a plurality of dropping bearing balls to form into a cross sectional shape of: c=50 μm and d=1 μm as shown in FIG. 39 and, when evaluated in the same manner as in Example 307, satisfactory improvement was be obtained for the dots, coarse image and peeling in the same as in Example 307.

EXAMPLE 313

A light receiving member for use in electrophotography having an upper layer comprising poly-Si(H, X) was prepared in the same manner as in Example 300 by replacing $CH_4$ gas with $C_2h_2$ gas and using a cylindrical aluminum support heated to a temperature of 500° C., under the preparation conditions as shown in Table 306 and, when evaluated in the same manner, satisfactory improvement was obtained to dots, coarse image and peeling in the same manner as in Example 300.

EXAMPLE 314

A light receiving member for use in electrophotography was prepared by microwave glow discharge decomposition in the same manner as in Example 23 by further using $Cu(C_4H_7N_2O_2)He$ gas, $SiF_4$ gas, NO gas and $B_2H_6$ gas upon forming the lower layer in Example 23, under the same preparation conditions as shown in Table 307.

When the light receiving member for use in electrophotography was evaluated in the same manner as in Example 292, satisfactory improvement was obtained to the dots, coarse image and peeling in the same manner as in Example 292.

When the lower layer of the light receiving member for use in electrophotography of Example 314 was analyzed by using SIMS, it was found that the content of silicon atoms, hydrogen atoms and aluminum atoms in the direction of the film thickness was varied as desired.

EXAMPLE 315

A light receiving member for use in electrophotography was prepared in the same manner as in Example 292 by replacing the $CH_4$ gas cylinder with a $C_2H_2$ gas cylinder in Example 292, under the preparation conditions shown in Table 308 and, when evaluated in the same manner, satisfactory improvement was obtained to the dots, coarse image and peeling in the same manner as in Example 236.

EXAMPLE 316

A light receiving member for use in electrophotography was prepared in the same manner as in Example 292 by replacing $B_2H_6/H_2$ gas cylinder with $PF_3/H_2$ gas cylinder in Example 292, using $CH_4$ gas in lower layer, and using $SiF_4$ gas in the entire layer, under the preparation condition shown in Table 309 and, when evaluated in the same manner, satisfactory improvement was obtained to the dots, coarse image and peeling in the same manner as in Example 292.

EXAMPLE 317

A light receiving member for use in electrophotography was prepared in the same manner as in Example 292 by replacing $CH_4$ gas cylinder with $NH_3$ gas cylinder, using $SnH_4$ from a not illustrated cylinder, $Mg(C_5H_5)_2/He$ gas from a not illustrated sealed vessel in Example 292, under the preparation conditions shown in Table 310 and, when evaluated in the same manner, satisfactory improvement was obtained to the dots, coarse image and peeling in the same manner as in Example 292.

EXAMPLE 318

A light receiving member for use in electrophotography was prepared in the same manner as in Example 297 by replacing $N_2$ gas cylinder with $PF_3/H_2$ gas cylinder, and using $SiF_4$ gas, under the preparation conditions shown in Table 311 and, when evaluated in the same manner, satisfactory improvement was obtained to the dots, coarse image and peeling in the same manner as in Example 241.

EXAMPLE 319

A light receiving member for use in electrophotography was prepared in the same manner as in Example 292 by replacing $CH_4$ gas cylinder with $C_2H_2$ gas cylinder, and further using $Si_2H_6$ gas in the upper layer, under the preparation conditions shown in Table 312 and, when evaluated in the same manner, satisfactory improvement was obtained to the dots, coarse image and peeling in the same manner as in Example 292.

EXAMPLE 320

A light receiving member for use in electrophotography was prepared in the same manner as in Example 292 by replacing $CH_4$ gas cylinder with $C_2H_2$ gas cylinder in Example 292, and further using $PH_3/H_2$ gas from a nor illustrated gas cylinder in the upper layer, under the preparation conditions shown in Table 313 and, when evaluated in the same manner, satisfactory improvement was obtained to the dots, coarse image and peeling in the same manner as in Example 292.

EXAMPLE 321

A light receiving member for use in electrophotography was prepared in the same manner as in Example 292 by further using NO gas, $B_2H_6/H_2$ gas, $Mg(C_5H_5)_2/He$ gas in the lower layer, and replacing $H_2$ gas with not illustrated He gas in the upper layer in Example 292, under the preparation conditions shown in Table 314 and, when evaluated in the same manner, satisfactory improvement was obtained to the dots, coarse image and peeling in the same manner as in Example 292.

EXAMPLE 322

A light receiving member for use in electrophotography was prepared in the same manner as in Example 292 by using $SiF_4$ gas, $CH_4$ gas, $B_2H_6/H_2$ gas, NO gas, $AlCl_3/He$ gas, $Cu(C_4H_7N_2O_2)_2/He$ gas in the entire layer, and using $PH_3/H_2$ gas in the upper layer, under the preparation conditions shown in Table 315 and, when evaluated in the same manner, satisfactory improvement was obtained to the dots, coarse image and peeling in the same manner as in Example 292.

EXAMPLE 323

A light receiving member for use in electrophotography was prepared in the same manner as in Example 322, under the preparation conditions shown in Table 316 and, when evaluated in the same manner, satisfactory improvement was obtained to the dots, coarse image and peeling in the same manner as in Example 322.

EXAMPLE 324

A light receiving member for use in electrophotography was prepared in the same manner as in Example 292 by further using $C_2H_2$ gas, under the preparation conditions shown in Table 317 and, when evaluated in the same manner, satisfactory improvement was obtained to the dots, coarse image and peeling in the same manner as in Example 292.

EXAMPLE 325

A light receiving member for use in electrophotography was prepared in the same manner as in Example 292 by replacing $C_4$ gas cylinder with $C_2H_2$ 2 gas cylinder, $B_2H_6/H_2$ gas cylinder with $PH_3/H_2$ gas cylinder in Example 292, under the preparation conditions shown in Table 318 and, when evaluated in the same manner, satisfactory improvement was obtained to the dots, coarse image and peeling in the same manner as in Example 292.

EXAMPLE 326

A light receiving member for use in electrophotography was prepared in the same manner as in Example 292 by further using $H_2$ S gas (99.999% purity) from a not illustrated cylinder, under the preparation conditions shown in Table 319 and, when evaluated in the same manner, satisfactory improvement was obtained to the dots, coarse image and peeling in the same manner as in Example 292.

EXAMPLE 327

A light receiving member for use in electrophotography was prepared in the same manner as in Example 322 by further using $C_2H_2$ gas from a not illustrated cylinder, under the preparation conditions shown in Table 320 and, when evaluated in the same manner, satisfactory improvement was obtained to the dots, coarse image and peeling in the same manner as in Example 322.

EXAMPLE 328

A light receiving member for use in electrophotography was prepared in the same manner as in Example 327, under the preparation conditions shown in Table 321 and, when evaluated in the same manner, satisfactory improvement was obtained to the dots, coarse image and peeling in the same manner as in Example 327.

EXAMPLE 329

A light receiving member for use in electrophotography was prepared in the same manner as in Example 322 by further using $Mg(C_5H_5)_2/He$ gas from a not illustrated sealed vessel, under the preparation conditions shown in Table 322 and, when evaluated in the same manner, satisfactory improvement was obtained to the dots, coarse image and peeling in the same manner as in Example 322.

EXAMPLE 330

A light receiving member for use in electrophotography was prepared in the same manner as in Example 327, under the preparation conditions shown in Table 324 and, when evaluated in the same manner, satisfactory improvement was obtained to the dots, coarse image and peeling in the same manner as in Example 327

EXAMPLE 331

A light receiving member for use in electrophotography was prepared in the same manner as in Example 329, under the preparation conditions shown in Table 324 and, when evaluated in the same manner, satisfactory improvement was obtained to the dots, coarse image and peeling in the same manner as in Example 329.

EXAMPLE 332

A light receiving member for use in electrophotography was prepared in the same manner as in Example 327, under the preparation conditions shown in Table 325 and, when evaluated in the same manner, satisfactory improvement was obtained to the dots, coarse image and peeling in the same manner as in Example 327.

EXAMPLE 333

A light receiving member for use in electrophotography was prepared in the same manner as in Example 327, under the preparation conditions shown in Table 326 and, when evaluated in the same manner, satisfactory improvement was obtained to the dots, coarse image and peeling in the same manner as in Example 327.

EXAMPLE 334

A light receiving member for use in electrophotography was prepared in the same manner as in Example 327, under the preparation conditions shown in Table 327 and, when evaluated in the same manner, satisfactory improvement was obtained to the dots, coarse image and peeling in the same manner as in Example 327.

EXAMPLE 335

A light receiving member for use in electrophotography was prepared in the same manner as in Example 327, under the preparation conditions shown in Table 328 and, when evaluated in the same manner, satisfactory improvement was obtained to the dots, coarse image and peeling in the same manner as in Example 327.

EXAMPLE 336

A light receiving member for use in electrophotography was prepared in the same manner as in Example 327 by further using $H_2S$ gas from a not illustrated cylinder, under the preparation conditions shown in Table 329 and, when evaluated in the same manner, satisfactory improvement was obtained to the dots, coarse image and peeling in the same manner as in Example 236.

EXAMPLE 337

A light receiving member for use in electrophotography was prepared in the same manner as in Example 327, under the preparation conditions shown in Table 330 and, when evaluated in the same manner, satisfactory improvement was obtained to the dots, coarse image and peeling in the same manner as in Example 327.

EXAMPLE 338

A light receiving member for use in electrophotography was prepared in the same manner as in Example 327 by further using $H_2S$ gas from a not illustrated cylinder, under the preparation conditions shown in Table 327 and, when evaluated in the same manner, satisfactory improvement was obtained to the dots, coarse image and peeling in the same manner as in Example 327.

EXAMPLE 339

A light receiving member for use in electrophotography was prepared in the same manner as in Example 327, under the preparation conditions shown in Table 332 and, when evaluated in the same manner, satisfactory improvement was obtained to the dots, coarse image and peeling in the same manner as in Example 327.

EXAMPLE 340

A light receiving member for use in electrophotography was prepared in the same manner as in Example 329, under the preparation conditions shown in Table 333 and, when evaluated in the same manner, satisfactory improvement was obtained to the dots, coarse image and peeling in the same manner as in Example 329.

EXAMPLE 341

A light receiving member for use in electrophotography was prepared in the same manner as in Example 327 by further using $NH_3$ tas and $H_2S$ gas from a not illustrated cylinder, under the preparation conditions shown in Table 327 and, when evaluated in the same manner, satisfactory improvement was obtained to the dots, coarse image and peeling in the same manner as in Example 327.

EXAMPLE 342

A light receiving member for use in electrophotography was prepared in the same manner as in Example 327, under the preparation conditions shown in Table 335 and, when evaluated in the same manner, satisfactory improvement was obtained to the dots, coarse image and peeling in the same manner as in Example 327.

EXAMPLE 343

A light receiving member for use in electrophotography was prepared in the same manner as in Example 327, under the preparation conditions shown in Table 336 and, when evaluated in the same manner, satisfactory improvement was obtained to the dots, coarse image and peeling in the same manner as in Example 327.

EXAMPLE 344

A light receiving member for use in electrophotography was prepared in the same manner as in Example 329, under the preparation conditions shown in Table 337 and, when evaluated in the same manner, satisfactory improvement was obtained to the dots, coarse image and peeling in the same manner as in Example 329.

EXAMPLE 345

A light receiving member for use in electrophotography was prepared in the same manner as in Example 329 by further using $Mg(C_5H_5)_2$/He gas, under the preparation conditions shown in Table 338 and, when evaluated in the same manner, satisfactory improvement was obtained to the dots, coarse image and peeling in the same manner as in Example 329.

EXAMPLE 346

A light receiving member for use in electrophotography was prepared in the same manner as in Example 327, under the preparation conditions shown in Table 339 and, when evaluated in the same manner, satisfactory improvement was obtained to the dots, coarse image and peeling in the same manner as in Example 327.

EXAMPLE 347

A light receiving member for use in electrophotography was prepared in the same manner as in Example 292, under the preparation conditions shown in Table 340 and, when evaluated in the same manner, satisfactory improvement was obtained to the dots, coarse image and peeling in the same manner as in Example 292.

EXAMPLE 348

The lower layer was formed under the preparation conditions shown in Table 341 in the same manner as in Example 292 except for using a target composed of Si, Al, Cu instead of Si, Al, Mg upon forming the lower layer in Example 291.

Then, a light receiving member for use in electrophotography was prepared in the same manner as in Example 292 under the preparing conditions shown in a Table 341 by using the device shown in FIG. 37 for forming the upper layer. When the evaluation was conducted in the same manner, satisfactory improvement to dots end layer peeling was obtained in the same manner as in Example 292.

When the lower layer of the light receiving member for use in electrophotography of Example 348 was analyzed by using SIMS, it was found that the content of silicon atoms, hydrogen atoms and aluminum atoms in the direction of the film thickness was varied as desired.

EXAMPLE 349

A light receiving member for use in electrophotography was prepared in the same manner as in Example 1 under the preparation conditions shown in Table 225 by further using $NaNH_2$/He gas upon forming the lower layer in Example 1.

COMPARATIVE EXAMPLE 8

A light receiving member for use in electrophotography was prepared under the same conditions in Example 349 except for not using $H_2$ gas upon forming the lower layer.

The orifice for the content of atoms across the layer thickness near the lower layer of the light receiving member for use in electrophotography in Example 349 and Comparative Example 8 thus prepared was analyzed by using SIMS (secondary ion mass analyzing device, manufactured by Kameka: IMS-3F). The results are shown in FIG. 43(*a*), (*b*). In FIG. 43, the abscissa represents the measured time corresponding to the position across the layer thickness, and the ordinate represents the content for each of the atoms by relative values.

FIG. 4(*a*) shows the profile for the content of atoms across the layer thickness in Example 349 in which aluminum atoms were distributed more on the side of the support, while silicon atoms, hydrogen atoms are distributed more on the side of the upper layer.

FIG. 4(*b*) shows the profile for the content of atoms across the layer thickness in Comparative Example 8 in which aluminum atoms are distributed more on the side of the support, silicon atoms were distributed more on the side of the upper layer and hydrogen atoms were distributed uniformly.

Then, the light receiving members for use photography thus prepared in Example 349 and Comparative Example 8 were set respectively to electrophotographic apparatus, that is, a copying machine NP-7550 manufactured by Cannon Inc. and modified for experimental use and several electrophotographic properties were checked under various conditions.

The light receiving member for use in electrophotography was rotated for 1000 turns while using a magnet roller as a cleaning roller, coating positive toners on the magnet roller while keeping all of the charging devices not operated. Then, a black original was prepared by an ordinary electrophotographic process and as a result of measuring the number of dots generated, it was found that the light receiving member for use in electrophotography of Example 349 showed the number of dots less than $\frac{1}{3}$ for that of the light receiving member for use in electrophotography in Comparative Example 8.

In addition, the light receiving member for use in electrophotography was rotated by 20 turns in a state where coagulated paper dusts were placed on the grits of a separation charger to cause abnormal discharge. Then, after removing the paper dusts, images were prepared by using a black original and, as a result of measuring the number of dots, it was found that the number of dots in the light receiving member for use in electrophotography of Example 349 was less than $\frac{2}{3}$ for that of the light receiving member for use in electrophotography in Comparative Example 8.

Further, a roll made of high density polyethylene having about 32 mmϕ diameter and 5 mm thickness was urged to the light receiving member for use in electrophotography under the pressure of 2 kg and then the light receiving member for use in electrophotography was rotated for 500,000 turns. Then, as a result of comparing the number of peeling visually in the light receiving layer, it was found that the number of peeling for the light receiving member for use in Example 349 was less than $\frac{1}{2}$ for that of the light receiving member for use in electrophotography in Comparative Example 8.

As has been described above, the light receiving member for use in electrophotography in Example 349 was superior from overall point of view to the light receiving member for use in electrophotography in Comparative Example 8.

EXAMPLE 350

A light receiving member for use in electrophotography was prepared in the same manner as in Example 349 under the preparing conditions shown in Table 342 except for changing the gas flow rate of $Al(CH_3)_3$/He to the value shown in Table 343.

COMPARATIVE EXAMPLE 9

A light receiving member for use in electrophotography was prepared in the same manner as in Example 349 under the preparing conditions shown in Table 342 except for changing the gas flow rate of $Al(CH_3)_3$/He to the value shown in Table 343.

A roll made of high density polyethylene was urged to the light receiving members for use in electrophotography thus prepared in Example 350 and Comparative Example 9 in the same manner as in Example 349 and the number of layer peeling was compared. The result is shown in Table 343 assuming the number of layer peeling to 1 in the layer of the light receiving member for use in electrophotography of Example 349. Further, the content of aluminum atoms near the upper portion of the lower layer was analyzed by using SIMS. The result is shown in Table 343.

As shown by the result in Table 343, the number of layer peeling was low and satisfactory result was obtained in the region where the content of the aluminum atoms near the upper portion of the lower layer is greater than 20 atom %.

EXAMPLE 351

A light receiving member for use in electrophotography was prepared in the same manner as in Example 349 under the preparing conditions shown in Table 342 except for changing the temperature for the support at a constant rate from 350° C. to 250° C. and using $Y(Oi\text{—}C_3H_7)_3$ instead of $NaNH_2$ during formation of the lower layer. When the evaluation was conducted in the same manner, satisfactory improvement to dots and layer peeling was obtained in the same manner as in Example 349.

EXAMPLE 352

A light receiving member for use in electrophotography was prepared in the same manner as in Example 349 under the preparing conditions shown in Table 342 except for changing RF power at a constant rate from 50 mW/cm$^3$ to 5 mW/cm$^3$ and using $Mn(CH_3)(CO)_5$ instead of $NaNH_2$ during formation of the lower layer. When the evaluation was conducted in the same manner, satisfactory improvement to dots and layer peeling was obtained in the same manner as in Example 349.

EXAMPLE 353

A light receiving member for use in electrophotography was prepared in the same manner as in Example 349 under the preparing conditions shown in Table 344 except for using $Zn(C_2H_5)_2$ instead of $NaNH_2$ and, further, adding the raw material gas shown in Table 342. When the evaluation was conducted in the same manner, satisfactory improvement to dots and layer peeling was obtained in the same manner as in Example 349.

EXAMPLE 354

A light receiving member for use in electrophotography was prepared in the same manner as in Example 349 under the preparing conditions shown in Table 342 except for changing the outer diameter of the cylindrical aluminum support to 30 mm and changing the gas flow rate and RF power shown in Table 342 to $\frac{1}{3}$ respectively. When the evaluation was conducted in the same manner, satisfactory improvement to dots and layer peeling was obtained in the same manner as in Example 349.

EXAMPLE 355

A light receiving member for use in electrophotography was prepared in the same manner as in Example 349 under the preparing conditions shown in Table 345. When the evaluation was conducted in the same manner, satisfactory improvement to dots and layer peeling was obtained in the same manner as in Example 349.

EXAMPLE 356

A light receiving member for use in electrophotography was prepared by the microwave glow discharge decomposition in the same manner as in Example 23 under the preparing conditions shown in Table 346 by further using $SiF_4$ gas and $NaNH_2$/He gas upon forming the lower layer in Example 23.

When the same evaluation as in Example 349 was conducted for the light receiving member for use in electrophotography, satisfactory improvement was obtained to dots and layer peeling in the same manner as in Example 349.

The profile for the content of atoms across the layer thickness near the lower layer wa analyzed by using SIMS in the same manner as in Example 349 and the result is shown in FIG. 43(*c*).

It was found that aluminum atoms, silicon atoms and hydrogen atoms are distributed in the same manner as in Example 349.

EXAMPLE 357

The lower layer was formed under the preparing conditions shown in Table 347 in the same manner as in Example 291 except for using a target composed of Si, Al, Mn instead of a target composed of Si, Al, Mg upon forming the lower layer in Example 291.

Then, a light receiving member for use in electrophotography was prepared in the same manner as in Example 349 under the preparing conditions shown in 342 by using the device shown in FIG. 37 for forming the upper layer. When the evaluation was conducted in the same manner, satisfactory improvement to dots and layer peeling was obtained in the same manner as in Example 349.

The profile for the content of atoms across the layer thickness near the lower layer was analyzed by using SIMS in the manner as in Example 349 and the results is shown in FIG. 43(*d*).

It was found that aluminum atoms, silicon atoms and hydrogen atoms were distributed in the same manner as in Example 349.

In the following Tables 1 to 346, the mark "*" means increase of a flow rate at constant proportion;
the mark "**" means decrease of a flow rate at constant proportion;
the term "S-side" means substrate side;
the term "UL-side" means upper layer side;
the term "LL-side" means lower layer side;
the term "U.1st LR-side" means 1st layer region side of the upper layer;
the term "U.2nd LR-side" means 2nd layer region side of the upper layer;
the term "U.3rd LR-side" means 3rd layer region side of the upper layer;
the term "U.4th LR-side" means 4th layer region side of the upper layer; and
the term "FS-side" means free surface side of the upper layer.

TABLE 1

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 50 | 250 | 5 | 0.4 | 0.05 |
| | | $H_2$ | 10→200* | | | | |
| | | $AlCl_3$/He | 120→40** | | | | |
| Upper layer | 1st layer region | $SiH_4$ | 100 | 250 | 10 | 0.35 | 3 |
| | | $H_2$ | 100 | | | | |
| | | NO | 30 | | | | |
| | 2nd layer region | $SiH_4$ | 300 | 250 | 15 | 0.5 | 20 |
| | | $H_2$ | 300 | | | | |
| | 3rd layer region | $SiH_4$ | 50 | 250 | 10 | 0.4 | 0.5 |
| | | $CH_4$ | 500 | | | | |

TABLE 2

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 50 | 250 | 5 | 0.4 | 0.05 |
| | | $AlCl_3$/He | 120→40** | | | | |
| Upper layer | 1st layer region | $SiH_4$ | 100 | 250 | 10 | 0.35 | 3 |
| | | $H_2$ | 100 | | | | |
| | | NO | 30 | | | | |
| | 2nd layer region | $SiH_4$ | 300 | 250 | 15 | 0.5 | 20 |
| | | $H_2$ | 300 | | | | |
| | 3rd layer region | $SiH_4$ | 50 | 250 | 10 | 0.4 | 0.5 |
| | | $CH_4$ | 500 | | | | |

TABLE 3

| Order of lamination (layer name) | | Gases and their flow rates (SCCM) | | Substrate temperature (°C.) | RF discharging power (mW/cm$^3$) | Inner pressure (Torr) | Layer thickness (μm) |
|---|---|---|---|---|---|---|---|
| Lower layer | | $SiH_4$ | 50 | 250 | 5 | 0.4 | 0.03 |
| | | $H_2$ | 10→200* | | | | |
| | | $AlCl_3$/He | | | | | |
| | | (S-side: 0.01 μm) | 100→10** | | | | |
| | | (UL-side: 0.01 μm) | 10 | | | | |
| Upper layer | 1st layer region | $SiH_4$ | 100 | 250 | 10 | 0.35 | 3 |
| | | $H_2$ | 100 | | | | |
| | | $B_2H_6$ (against $SiH_4$) | 800 ppm | | | | |
| | | NO | 10 | | | | |
| | 2nd layer region | $SiH_4$ | 300 | 250 | 15 | 0.5 | 20 |
| | | $H_2$ | 300 | | | | |
| | 3rd layer region | $SiH_4$ | 50 | 250 | 10 | 0.4 | 0.5 |
| | | $CH_4$ | 500 | | | | |

TABLE 4

| Order of lamination (layer name) | | Gases and their flow rates (SCCM) | | Substrate temperature (°C.) | RF discharging power (mW/cm$^3$) | Inner pressure (Torr) | Layer thickness (μm) |
|---|---|---|---|---|---|---|---|
| Lower layer | | $SiH_4$ | 50 | 150 | 0.5 | 0.3 | 0.02 |
| | | $H_2$ | 5→200* | ↓ | ↓ | | |
| | | $AlCl_3$/He | | 300 | 1.5 | | |
| | | (S-side: 0.01 μm) | 200→30** | | | | |
| | | (UL-side: 0.01 μm) | 30→10** | | | | |
| Upper layer | 1st layer region | $SiH_4$ | 100 | 270 | 10 | 0.35 | 3 |
| | | $H_2$ | 100 | | | | |
| | | $B_2H_6$ (against $SiH_4$) | 800 ppm | | | | |
| | | NO | 10 | | | | |
| | 2nd layer region | $SiH_4$ | 300 | 250 | 20 | 0.5 | 20 |
| | | $H_2$ | 500 | | | | |

TABLE 5

| Order of lamination (layer name) | | Gases and their flow rates (SCCM) | | Substrate temperature (°C.) | RF discharging power (mW/cm$^3$) | Inner pressure (Torr) | Layer thickness (μm) |
|---|---|---|---|---|---|---|---|
| Lower layer | | $SiH_4$ | 50 | 250 | 1 | 0.3 | 0.02 |
| | | $H_2$ | 5→200* | | | | |
| | | $AlCl_3$/He | | | | | |
| | | (S-side: 0.01 μm) | 200→30** | | | | |
| | | (UL-side: 0.01 μm) | 30→10** | | | | |
| Upper layer | 1st layer region | $SiH_4$ | 100 | 250 | 10 | 0.35 | 3 |
| | | He | 100 | | | | |
| | | $B_2H_6$ (against $SiH_4$) | 800 ppm | | | | |
| | | NO | | | | | |
| | | (LL-side: 2 μm) | 10 | | | | |
| | | (U · 2nd LR-side: 1 μm) | 10→0** | | | | |
| | | $AlCl_3$/He | 0.1 | | | | |
| | | $SiF_4$ | 0.5 | | | | |
| | | $CH_4$ | 1 | | | | |
| | 2nd layer region | $SiH_4$ | 300 | 250 | 25 | 0.6 | 25 |
| | | He | 600 | | | | |
| | | $B_2H_6$ | 0.3 ppm | | | | |
| | | $AlCl_3$/He | 0.1 | | | | |
| | | $SiF_4$ | 0.5 | | | | |
| | | $CH_4$ | 1 | | | | |
| | | NO | 0.1 | | | | |
| | 3rd layer region | $SiH_4$ | 50 | 250 | 10 | 0.4 | 1 |
| | | $CH_4$ | 500 | | | | |
| | | NO | 0.1 | | | | |
| | | $N_2$ | 1 | | | | |
| | | $B_2H_6$ | 0.3 ppm | | | | |
| | | $Al_2Cl_3$/He | 0.5 | | | | |
| | | $SiF_4$ | 0.5 | | | | |

TABLE 6

| Order of lamination (layer name) | | Gases and their flow rates (SCCM) | | Substrate temperature (°C.) | RF discharging power (mW/cm$^3$) | Inner pressure (Torr) | Layer thickness (μm) |
|---|---|---|---|---|---|---|---|
| Lower layer | | $SiH_4$ | 10→100* | 250 | 10 | 0.4 | 0.2 |
| | | $H_2$ | 5→200* | | | | |
| | | $AlCl_3$/He | | | | | |
| | | (S-side: 0.05 μm) | 200→40** | | | | |
| | | (UL-side: 0.15 μm) | 40→10** | | | | |
| Upper layer | 1st layer region | $SiH_4$ | 100 | 250 | 10 | 0.35 | 3 |
| | | $H_2$ | 100 | | | | |
| | | $PH_3$ (against $SiH_4$) | 800 ppm | | | | |
| | | $NH_3$ | 4 | | | | |
| | 2nd layer region | $SiH_4$ | 400 | 250 | 10 | 0.5 | 15 |
| | | Ar | 200 | | | | |
| | 3rd layer region | $SiH_4$ | 100 | 250 | 5 | 0.4 | 0.3 |
| | | $NH_3$ | 30 | | | | |

TABLE 7

| Order of lamination (layer name) | | Gases and their flow rates (SCCM) | | Substrate temperature (°C.) | RF discharging power (mW/cm$^3$) | Inner pressure (Torr) | Layer thickness (μm) |
|---|---|---|---|---|---|---|---|
| Lower layer | | $SiH_4$ | 10→100* | 300 | 10 | 0.4 | 0.2 |
| | | $H_2$ | 5→200* | | | | |
| | | $AlCl_3$/He | | | | | |
| | | (S-side: 0.05 μm) | 200→40** | | | | |
| | | (UL-side: 0.15 μm) | 40→10** | | | | |
| Upper layer | 1st layer region | $SiH_4$ | 100 | 300 | 10 | 0.35 | 3 |
| | | $H_2$ | 100 | | | | |
| | | $B_2H_6$ | 1000 ppm | | | | |
| | | $C_2H_2$ | 5 | | | | |
| | 2nd layer region | $SiH_4$ | 300 | 300 | 20 | 0.5 | 20 |
| | | $H_2$ | 500 | | | | |
| | 3rd layer region | $SiH_4$ | 100 | 300 | 15 | 0.4 | 7 |
| | | $CH_4$ | 600 | | | | |
| | | $PH_3$ (against $SiH_4$) | 3000 ppm | | | | |
| | 4th layer region | $SiH_4$ | 40 | 300 | 10 | 0.4 | 0.1 |
| | | $CH_4$ | 600 | | | | |

TABLE 8

| Order of lamination (layer name) | | Gases and their flow rates (SCCM) | | Substrate temperature (°C.) | RF discharging power (mW/cm$^3$) | Inner pressure (Torr) | Layer thickness (μm) |
|---|---|---|---|---|---|---|---|
| Lower layer | | $SiH_4$ | 50 | 330 | 5 | 0.4 | 0.05 |
| | | $H_2$ | 5→200* | | | | |
| | | $AlCl_3$/He | 200→20** | | | | |
| Upper layer | 1st layer region | $SiH_4$ | 100 | 330 | 10 | 0.35 | 3 |
| | | $H_2$ | 100 | | | | |
| | | $PH_3$ (against $SiH_4$) | 800 ppm | | | | |
| | | NO | 10 | | | | |
| | 2nd layer region | $SiH_4$ | 400 | 330 | 25 | 0.5 | 25 |
| | | $SiF_4$ | 10 | | | | |
| | | $H_2$ | 800 | | | | |
| | 3rd layer region | $SiH_4$ | 100 | 350 | 15 | 0.4 | 5 |
| | | $CH_4$ | 400 | | | | |
| | | $B_2H_6$ (against $SiH_4$) | 5000 ppm | | | | |
| | 4th layer region | $SiH_4$ | 20 | 350 | 10 | 0.4 | 1 |
| | | $CH_4$ | 400 | | | | |
| | | $B_2H_6$ (against $SiH_4$) | 8000 ppm | | | | |

TABLE 9

| Order of lamination (layer name) | | Gases and their flow rates (SCCM) | | Substrate temperature (°C.) | RF discharging power (mW/cm$^3$) | Inner pressure (Torr) | Layer thickness (μm) |
|---|---|---|---|---|---|---|---|
| Lower layer | | $SiH_4$ | 50 | 300 | 1 | 0.3 | 0.02 |
| | | $H_2$ | 5→200* | | | | |
| | | $AlCl_3$/He | | | | | |
| | | (S-side: 0.01 μm) | 200→30** | | | | |
| | | (UL-side: 0.01 μm) | 30→10** | | | | |
| Upper layer | 1st layer | $SiH_4$ | 100 | 300 | 10 | 0.35 | 3 |
| | | $H_2$ | 150 | | | | |

TABLE 9-continued

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| | region | $B_2H_6$ (against $SiH_4$) | 900→600 ppm** | | | | |
| | | $N_2$ | 150 | | | | |
| | 2nd layer region | $SiH_4$ | 300 | 300 | 20 | 0.5 | 20 |
| | | $H_2$ | 200 | | | | |
| | 3rd layer region | $SiH_4$ | 50 | 300 | 20 | 0.4 | 5 |
| | | $N_2$ | 500 | | | | |
| | | $PH_3$ (against $SiH_4$) | 3000 ppm | | | | |
| | 4th layer region | $SiH_4$ | 40 | 300 | 10 | 0.4 | 0.3 |
| | | $CH_4$ | 600 | | | | |

TABLE 10

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 50 | 250 | 5 | 0.4 | 0.05 |
| | | $H_2$ | 5→200* | | | | |
| | | $AlCl_3$/He | 200→20** | | | | |
| Upper layer | 1st layer region | $SiH_4$ | 100 | 250 | 10 | 0.35 | 3 |
| | | $H_2$ | 100 | | | | |
| | | $B_2H_6$ (against $SiH_4$) | 1000 ppm | | | | |
| | | $C_2H_2$ | 5 | | | | |
| | 2nd layer region | $SiH_4$ | 300 | 250 | 15 | 0.5 | 10 |
| | | $H_2$ | 300 | | | | |
| | 3rd layer region | $SiH_4$ | 200 | 250 | 15 | 0.4 | 20 |
| | | $C_2H_2$ | 10→20* | | | | |
| | | NO | 1 | | | | |

TABLE 11

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 50 | 250 | 1 | 0.4 | 0.02 |
| | | $H_2$ | 5→200* | | | | |
| | | $AlCl_3$/He | | | | | |
| | | (S-side: 0.01 μm) | 200→30** | | | | |
| | | (UL-side: 0.01 μm) | 30→10** | | | | |
| Upper layer | 1st layer region | $SiH_4$ | 100 | 300 | 10 | 0.35 | 3 |
| | | $H_2$ | 150 | | | | |
| | | $B_2H_6$ (against $SiH_4$) | 900→600 ppm** | | | | |
| | | $N_2$ | 150 | | | | |
| | 2nd layer region | $SiH_4$ | 300 | 300 | 20 | 0.5 | 5 |
| | | $H_2$ | 300 | | | | |
| | 3rd layer region | $SiH_4$ | 100 | 300 | 15 | 0.4 | 20 |
| | | $CH_4$ | 100 | | | | |
| | 4th layer region | $SiH_4$ | 50 | 300 | 10 | 0.4 | 0.5 |
| | | $CH_4$ | 600 | | | | |

TABLE 12

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 10→100* | 300 | 5 | 0.4 | 0.2 |
| | | $H_2$ | 5→200* | | | | |
| | | $AlCl_3$/He | | | | | |
| | | (S-side: 0.05 μm) | 200→40** | | | | |
| | | (UL-side: 0.15 μm) | 40→10** | | | | |
| Upper layer | 1st layer region | $SiH_4$ | 100 | 300 | 10 | 0.35 | 3 |
| | | $H_2$ | 100 | | | | |
| | | $PH_3$ (against $SiH_4$) | 800 ppm | | | | |
| | | $NH_3$ | 5 | | | | |
| | 2nd layer region | $SiH_4$ | 100 | 300 | 5 | 0.2 | 8 |
| | | $H_2$ | 300 | | | | |
| | 3rd layer | $SiH_4$ | 300 | 300 | 15 | 0.4 | 25 |
| | | $NH_3$ | 50 | | | | |

TABLE 12-continued

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| | region | | | | | | |
| | 4th layer region | $SiH_4$ | 100 | 300 | 10 | 0.4 | 0.3 |
| | | $NH_3$ | 50 | | | | |

TABLE 13

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 10→100* | 250 | 5 | 0.4 | 0.2 |
| | | $H_2$ | 5→200* | | | | |
| | | $AlCl_3$/He | | | | | |
| | | (S-side: 0.05 μm) | 200→40** | | | | |
| | | (UL-side: 0.15 μm) | 40→10** | | | | |
| Upper layer | 1st layer region | $SiH_4$ | 100 | 280 | 10 | 0,35 | 3 |
| | | $H_2$ | 100 | | | | |
| | | $PH_3$ (against $SiH_4$) | 800 ppm | | | | |
| | | NO | 10 | | | | |
| | 2nd layer region | $SiH_4$ | 100 | 300 | 3 | 0.5 | 3 |
| | | $SiF_4$ | 5 | | | | |
| | | $H_2$ | 200 | | | | |
| | 3rd layer region | $SiH_4$ | 100 | 300 | 15 | 0.4 | 30 |
| | | $CH_4$ | 100 | | | | |
| | | $PH_3$ (against $SiH_4$) | 50 ppm | | | | |
| | 4th layer region | $SiH_4$ | 50 | 300 | 10 | 0.4 | 0.5 |
| | | $CH_4$ | 600 | | | | |

TABLE 14

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 50 | 250 | 5 | 0.4 | 0.05 |
| | | $H_2$ | 5→200* | | | | |
| | | $AlCl_3$/He | 200→20** | | | | |
| Upper layer | 1st layer region | $SiH_4$ | 100 | 300 | 10 | 0.35 | 3 |
| | | $H_2$ | 100 | | | | |
| | | $B_2H_6$ (against $SiH_4$) | 800 ppm | | | | |
| | | NO | | | | | |
| | | (LL-side: 2 μm) | 10 | | | | |
| | | (U · 2nd LR-side: 1 μm) | 10→0** | | | | |
| | 2nd layer region | $Si_2H_6$ | 200 | 300 | 10 | 0.5 | 10 |
| | | $H_2$ | 200 | | | | |
| | 3rd layer region | $SiH_4$ | 300 | 330 | 20 | 0.4 | 30 |
| | | $C_2H_2$ | 50 | | | | |
| | | $B_2H_6$ (against $SiH_4$) | 100 ppm | | | | |
| | 4th layer region | $SiH_4$ | 200 | 330 | 10 | 0.4 | 1 |
| | | $C_2H_2$ | 200 | | | | |

TABLE 15

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 10→100* | 250 | 5 | 0.4 | 0.2 |
| | | $H_2$ | 5→200* | | | | |
| | | $AlCl_3$/He | | | | | |
| | | (S-side: 0.05 μm) | 200→40** | | | | |
| | | (UL-side: 0.15 μm) | 40→10** | | | | |
| Upper layer | 1st layer region | $SiH_4$ | 100 | 270 | 10 | 0.35 | 3 |
| | | $H_2$ | 100 | | | | |
| | | $B_2H_6$ (against $SiH_4$) | 800 ppm | | | | |
| | | $NH_3$ | 5 | | | | |
| | 2nd layer region | $SiH_4$ | 100 | 300 | 5 | 0.2 | 8 |
| | | $H_2$ | 300 | | | | |
| | 3rd layer region | $SiH_4$ | 300 | 300 | 15 | 0.4 | 25 |
| | | $NH_3$ | 30→50* | | | | |
| | | $PH_3$ (against $SiH_4$) | 50 ppm | | | | |
| | 4th | $SiH_4$ | 100 | 300 | 5 | 0.4 | 0.7 |

TABLE 15-continued

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| | layer region | $NH_3$ | 80→100* | | | | |
| | | $PH_3$ (against $SiH_4$) | 500 ppm | | | | |

TABLE 16

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 50 | 250 | 1 | 0.4 | 0.02 |
| | | $H_2$ | 5→200* | | | | |
| | | $AlCl_3$/He | | | | | |
| | | (S-side: 0.01 μm) | 200→30** | | | | |
| | | (UL-side: 0.01 μm) | 30→10** | | | | |
| Upper layer | 1st layer region | $SiH_4$ | 100 | 250 | 10 | 0.35 | 3 |
| | | $H_2$ | 100 | | | | |
| | | $B_2H_6$ (against $SiH_4$) | 800 ppm | | | | |
| | | NO | | | | | |
| | | (LL-side: 2 μm) | 10 | | | | |
| | | (U · 2nd LR-side: 1 μm) | 10→0** | | | | |
| | 2nd layer region | $SiH_4$ | 300 | 300 | 20 | 0.5 | 20 |
| | | $H_2$ | 500 | | | | |
| | 3rd layer region | $SiH_4$ | 100 | 300 | 5 | 0.4 | 1 |
| | | $GeH_4$ | 10→50* | | | | |
| | | $H_2$ | 300 | | | | |
| | 4th layer region | $SiH_4$ | 100→40** | 300 | 10 | 0.4 | 1 |
| | | $CH_4$ | 100→600* | | | | |

TABLE 17

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 50 | 300 | 1 | 0.3 | 0.02 |
| | | $H_2$ | 5→200* | | | | |
| | | $AlCl_3$/He | | | | | |
| | | (S-side: 0.01 μm) | 200→30** | | | | |
| | | (UL-side: 0.01 μm) | 30→10** | | | | |
| Upper layer | 1st layer region | $SiH_4$ | 85 | 300 | 9 | 0.35 | 3 |
| | | $H_2$ | 90 | | | | |
| | | $B_2H_6$ (against $SiH_4$) | 800 ppm | | | | |
| | | NO | 9 | | | | |
| | 2nd layer region | $SiH_4$ | 300 | 300 | 15 | 0.5 | 20 |
| | | $H_2$ | 400 | | | | |
| | 3rd layer region | $SiH_4$ | 50 | 300 | 10 | 0.4 | 0.5 |
| | | $CH_4$ | 500 | | | | |

TABLE 18

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 50 | 300 | 0.7 | 0.3 | 0.02 |
| | | $H_2$ | 5→200* | | | | |
| | | $AlCl_3$/He | | | | | |
| | | (S-side: 0.01 μm) | 200→30** | | | | |
| | | (UL-side: 0.01 μm) | 30→10** | | | | |
| Upper layer | 1st layer region | $SiH_4$ | 70 | 300 | 8 | 0.35 | 3 |
| | | $H_2$ | 80 | | | | |
| | | $B_2H_6$ (against $SiH_4$) | 800 ppm | | | | |
| | | NO | 8 | | | | |
| | 2nd layer region | $SiH_4$ | 200 | 300 | 12 | 0.4 | 20 |
| | | $H_2$ | 400 | | | | |
| | 3rd layer region | $SiH_4$ | 40 | 300 | 7 | 0.3 | 0.5 |
| | | $CH_4$ | 400 | | | | |

TABLE 19

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 25 | 300 | 0.5 | 0.2 | 0.02 |
| | | $H_2$ | 5→100* | | | | |
| | | $AlCl_3$/He | | | | | |
| | | (S-side: 0.01 μm) | 100→15** | | | | |
| | | (UL-side: 0.01 μm) | 15→5** | | | | |
| Upper layer | 1st layer region | $SiH_4$ | 55 | 300 | 7 | 0.35 | 3 |
| | | $H_2$ | 70 | | | | |
| | | $B_2H_6$ (against $SiH_4$) | 800 ppm | | | | |
| | | NO | 7 | | | | |
| | 2nd layer region | $SiH_4$ | 150 | 300 | 10 | 0.4 | 20 |
| | | $H_2$ | 300 | | | | |
| | 3rd layer region | $SiH_4$ | 30 | 300 | 5 | 0.3 | 0.5 |
| | | $CH_4$ | 300 | | | | |

TABLE 20

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 20 | 300 | 0.3 | 0.2 | 0.02 |
| | | $H_2$ | 5→100* | | | | |
| | | $AlCl_3$/He | | | | | |
| | | (S-side: 0.01 μm) | 80→15** | | | | |
| | | (UL-side: 0.01 μm) | 15→5** | | | | |
| Upper layer | 1st layer region | $SiH_4$ | 45 | 300 | 6 | 0.35 | 3 |
| | | $H_2$ | 60 | | | | |
| | | $B_2H_6$ (against $SiH_4$) | 800 ppm | | | | |
| | | NO | 5 | | | | |
| | 2nd layer region | $SiH_4$ | 100 | 300 | 6 | 0.3 | 20 |
| | | $H_2$ | 300 | | | | |
| | 3rd layer region | $SiH_4$ | 20 | 300 | 3 | 0.2 | 0.5 |
| | | $CH_4$ | 200 | | | | |

TABLE 21

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 50 | 500 | 5 | 0.4 | 0.05 |
| | | $H_2$ | 5→200* | | | | |
| | | $AlCl_3$/He | 200→20** | | | | |
| Upper layer | 1st layer region | $SiH_4$ | 180 | 500 | 22 | 0.4 | 4 |
| | | $H_2$ | 1200 | | | | |
| | | $B_2H_6$ (against $SiH_4$) | 700 ppm | | | | |
| | | $C_2H_2$ | 8 | | | | |
| | 2nd layer region | $SiH_4$ | 300 | 500 | 30 | 0.5 | 10 |
| | | $H_2$ | 1500 | | | | |
| | 3rd layer region | $SiH_4$ | 200 | 500 | 30 | 0.4 | 20 |
| | | $C_2H_2$ | 10→20* | | | | |
| | | NO | 1 | | | | |

TABLE 22

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 150 | 250 | 0.5 | 0.6 | 0.02 |
| | | $H_2$ | 20→500* | | | | |
| | | $AlCl_3$/He | | | | | |
| | | (S-side: 0.01 μm) | 400→80** | | | | |
| | | (UL-side: 0.01 μm) | 80→50** | | | | |
| Upper layer | 1st layer region | $SiH_4$ | 350 | 250 | 0.5 | 0.5 | 3 |
| | | $H_2$ | 350 | | | | |
| | | $B_2H_6$ (against $SiH_4$) | 600 ppm | | | | |
| | | NO | 13 | | | | |
| | | $SiF_4$ | 20 | | | | |
| | 2nd layer region | $SiH_4$ | 700 | 250 | 0.5 | 0.5 | 20 |
| | | $SiF_4$ | 30 | | | | |
| | | $H_2$ | 500 | | | | |

TABLE 22-continued

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| | 3rd layer region | $SiH_4$ | 150 | 250 | 0.5 | 0.3 | 1 |
| | | $CH_4$ | 500 | | | | |

TABLE 23

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 50 | 250 | 5 | 0.4 | 0.05 |
| | | $H_2$ | 5→200* | | | | |
| | | $AlCl_3$/He | 200→20** | | | | |
| Upper layer | 1st layer region | $SiH_4$ | 100 | 250 | 10 | 0.35 | 3 |
| | | $H_2$ | 100 | | | | |
| | | $B_2H_6$ (against $SiH_4$) | 1000 ppm | | | | |
| | | $C_2H_2$ | 5 | | | | |
| | 2nd layer region | $SiH_4$ | 200 | 250 | 15 | 0.4 | 20 |
| | | $C_2H_2$ | 10→20* | | | | |
| | | NO | 1 | | | | |
| | 3rd layer region | $SiH_4$ | 300 | 250 | 15 | 0.5 | 10 |
| | | $H_2$ | 300 | | | | |

TABLE 24

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 50 | 250 | 1 | 0.4 | 0.02 |
| | | $H_2$ | 10→200* | | | | |
| | | $AlCl_3$/He | | | | | |
| | | (S-side: 0.01 μm) | 200→30** | | | | |
| | | (UL-side: 0.01 μm) | 30→10** | | | | |
| Upper layer | 1st layer region | $SiH_4$ | 100 | 300 | 10 | 0.35 | 3 |
| | | $H_2$ | 150 | | | | |
| | | $B_2H_6$ (against $SiH_4$) | 900→600 ppm** | | | | |
| | | $N_2$ | 150 | | | | |
| | 2nd layer region | $SiH_4$ | 100 | 300 | 15 | 0.4 | 20 |
| | | $CH_4$ | 100 | | | | |
| | 3rd layer region | $SiH_4$ | 300 | 300 | 20 | 0.5 | 5 |
| | | $H_2$ | 300 | | | | |
| | 4th layer region | $SiH_4$ | 50 | 300 | 10 | 0.4 | 0.5 |
| | | $CH_4$ | 600 | | | | |

TABLE 25

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 10→100* | 300 | 5 | 0.4 | 0.2 |
| | | $H_2$ | 5→200* | | | | |
| | | $AlCl_3$/He | | | | | |
| | | (S-side: 0.05 μm) | 200→40** | | | | |
| | | (UL-side: 0.15 μm) | 40→10** | | | | |
| Upper layer | 1st layer region | $SiH_4$ | 100 | 300 | 10 | 0.35 | 3 |
| | | $H_2$ | 100 | | | | |
| | | $PH_3$ (against $SiH_4$) | 800 ppm | | | | |
| | | $NH_3$ | 5 | | | | |
| | 2nd layer region | $SiH_4$ | 300 | 300 | 15 | 0.4 | 25 |
| | | $NH_3$ | 50 | | | | |
| | 3rd layer region | $SiH_4$ | 100 | 300 | 5 | 0.2 | 8 |
| | | $H_2$ | 300 | | | | |
| | 4th layer region | $SiH_4$ | 100 | 300 | 10 | 0.4 | 0.3 |
| | | $NH_3$ | 50 | | | | |

TABLE 26

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 10→100* | 250 | 5 | 0.4 | 0.2 |
| | | $H_2$ | 5→200* | | | | |
| | | $AlCl_3$/He | | | | | |
| | | (S-side: 0.05 μm) | 200→40** | | | | |
| | | (UL-side: 0.15 μm) | 40→10** | | | | |
| Upper layer | 1st layer region | $SiH_4$ | 100 | 250 | 10 | 0.35 | 3 |
| | | $H_2$ | 100 | | | | |
| | | $PH_3$ (against $SiH_4$) | 800 ppm | | | | |
| | | NO | 10 | | | | |
| | 2nd layer region | $SiH_4$ | 100 | 300 | 15 | 0.4 | 30 |
| | | $CH_4$ | 100 | | | | |
| | | $PH_3$ (against $SiH_4$) | 50 ppm | | | | |
| | 3rd layer region | $SiH_4$ | 100 | 300 | 3 | 0.5 | 3 |
| | | $SiF_4$ | 5 | | | | |
| | | $H_2$ | 200 | | | | |
| | 4th layer region | $SiH_4$ | 50 | 300 | 10 | 0.4 | 0.5 |
| | | $CH_4$ | 600 | | | | |

TABLE 27

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 50 | 250 | 5 | 0.4 | 0.05 |
| | | $H_2$ | 5→200* | | | | |
| | | $AlCl_3$/He | 200→20** | | | | |
| Upper layer | 1st layer region | $SiH_4$ | 100 | 300 | 10 | 0.35 | 3 |
| | | $H_2$ | 100 | | | | |
| | | $B_2H_6$ (against $SiH_4$) | 800 ppm | | | | |
| | | NO | | | | | |
| | | (LL-side: 2 μm) | 10 | | | | |
| | | (U · 2nd LR-side: 1 μm) | 10→0** | | | | |
| | 2nd layer region | $SiH_4$ | 300 | 330 | 20 | 0.4 | 30 |
| | | $C_2H_2$ | 50 | | | | |
| | | $B_2H_6$ (against $SiH_4$) | 100 ppm | | | | |
| | 3rd layer region | $Si_2H_6$ | 200 | 300 | 10 | 0.5 | 10 |
| | | $H_2$ | 200 | | | | |
| | 4th layer region | $SiH_4$ | 200 | 330 | 10 | 0.4 | 1 |
| | | $C_2H_2$ | 200 | | | | |

TABLE 28

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 10→100* | 250 | 5 | 0.4 | 0.2 |
| | | $H_2$ | 5→200* | | | | |
| | | $AlCl_3$/He | | | | | |
| | | (S-side: 0.05 μm) | 200→40** | | | | |
| | | (UL-side: 0.15 μm) | 40→10** | | | | |
| Upper layer | 1st layer region | $SiH_4$ | 100 | 300 | 10 | 0.35 | 3 |
| | | $H_2$ | 100 | | | | |
| | | $B_2H_6$ (against $SiH_4$) | 800 ppm | | | | |
| | | $NH_3$ | 5 | | | | |
| | 2nd layer region | $SiH_4$ | 300 | 300 | 15 | 0.4 | 25 |
| | | $NH_3$ | 30→50* | | | | |
| | | $PH_3$ (against $SiH_4$) | 50 ppm | | | | |
| | 3rd layer region | $SiH_4$ | 100 | 300 | 5 | 0.2 | 8 |
| | | $H_2$ | 300 | | | | |
| | 4th layer region | $SiH_4$ | 100 | 300 | 5 | 0.4 | 0.7 |
| | | $NH_3$ | 80→100* | | | | |
| | | $PH_3$ (against $SiH_4$) | 500 ppm | | | | |

TABLE 29

| Order of lamination (layer name) | Gases and their flow rates (SCCM) | | Substrate temperature (°C.) | RF discharging power (mW/cm³) | Inner pressure (Torr) | Layer thickness (μm) |
|---|---|---|---|---|---|---|
| Lower layer | $SiH_4$ | 50 | 250 | 1 | 0.3 | 0.02 |
| | $H_2$ | 5→200* | | | | |

TABLE 29-continued

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| | | $AlCl_3$/He | | | | | |
| | | (S-side: 0.01 μm) | 200→30** | | | | |
| | | (UL-side: 0.01 μm) | 30→10** | | | | |
| Upper layer | 1st layer region | $SiH_4$ | 100 | 250 | 10 | 0.35 | 3 |
| | | $H_2$ | 100 | | | | |
| | | $B_2H_6$ (against $SiH_4$) | 800 ppm | | | | |
| | | NO | | | | | |
| | | (LL-side: 2 μm) | 10 | | | | |
| | | (U · 2nd LR-side: 1 μm) | 10→0** | | | | |
| | 2nd layer region | $SiH_4$ | 300 | 250 | 25 | 0.6 | 25 |
| | | He | 600 | | | | |
| | 3rd layer region | $SiH_4$ | 50 | 250 | 10 | 0.4 | 1 |
| | | $CH_4$ | 500 | | | | |
| | | NO | 0.1 | | | | |
| | | $N_2$ | 1 | | | | |

TABLE 30

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 10→100* | 300 | 10 | 0.4 | 0.2 |
| | | $H_2$ | 5→200* | | | | |
| | | $AlCl_3$/He | | | | | |
| | | (S-side: 0.05 μm) | 200→40** | | | | |
| | | (UL-side: 0.15 μm) | 40→10** | | | | |
| Upper layer | 1st layer region | $SiH_4$ | 100 | 300 | 10 | 0.35 | 3 |
| | | $H_2$ | 100 | | | | |
| | | $B_2H_6$ (against $SiH_4$) | 1000 ppm | | | | |
| | | $C_2H_2$ | 5 | | | | |
| | | $AlCl_3$/He | 0.1 | | | | |
| | | NO | 0.1 | | | | |
| | | $SiF_4$ | 0.5 | | | | |
| | 2nd layer region | $SiH_4$ | 300 | 300 | 20 | 0.5 | 20 |
| | | $H_2$ | 500 | | | | |
| | | $C_2H_2$ | 0.1 | | | | |
| | | $AlCl_3$/He | 0.1 | | | | |
| | | NO | 0.1 | | | | |
| | | $SiF_4$ | 0.5 | | | | |
| | | $B_2H_6$ | 0.3 ppm | | | | |
| | 3rd layer region | $SiH_4$ | 100 | 300 | 15 | 0.4 | 7 |
| | | $CH_4$ | 600 | | | | |
| | | $PH_3$ (against $SiH_4$) | 3000 ppm | | | | |
| | | $AlCl_3$/He | 0.1 | | | | |
| | | NO | 0.1 | | | | |
| | | $SiF_4$ | 0.5 | | | | |
| | | $B_2H_6$ | 0.3 ppm | | | | |
| | 4th layer region | $SiH_4$ | 40 | 300 | 10 | 0.4 | 0.1 |
| | | $CH_4$ | 600 | | | | |
| | | $AlCl_3$/He | 0.1 | | | | |
| | | NO | 0.1 | | | | |
| | | $SiF_4$ | 0.5 | | | | |
| | | $B_2H_6$ | 0.3 ppm | | | | |
| | | $PH_3$ | 0.3 ppm | | | | |

TABLE 31

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 10→100* | 250 | 5 | 0.4 | 0.2 |
| | | $H_2$ | 5→200* | | | | |
| | | $AlCl_3$/He | | | | | |
| | | (S-side: 0.05 μm) | 200→40** | | | | |
| | | (UL-side: 0.15 μm) | 40→10** | | | | |
| Upper layer | 1st layer region | $SiH_4$ | 100 | 280 | 10 | 0.35 | 3 |
| | | $H_2$ | 100 | | | | |
| | | $PH_3$ (against $SiH_4$) | 800 ppm | | | | |
| | | NO | 10 | | | | |
| | | $AlCl_3$/He | 0.1 | | | | |
| | | $SiF_4$ | 0.5 | | | | |
| | | $CH_4$ | 1 | | | | |
| | 2nd layer | $SiH_4$ | 100 | 300 | 3 | 0.5 | 3 |
| | | $SiF_4$ | 5 | | | | |

TABLE 31-continued

| Order of lamination (layer name) | Gases and their flow rates (SCCM) | | Substrate temperature (°C.) | RF discharging power (mW/cm$^3$) | Inner pressure (Torr) | Layer thickness (μm) |
|---|---|---|---|---|---|---|
| region | $H_2$ | 200 | | | | |
| | $PH_3$ | 0.3 ppm | | | | |
| | NO | 0.1 | | | | |
| | $CH_4$ | 1 | | | | |
| | $AlCl_3$/He | 0.1 | | | | |
| 3rd | $SiH_4$ | 100 | 300 | 15 | 0.4 | 30 |
| layer | $CH_4$ | 100 | | | | |
| region | $PH_3$ (against $SiH_4$) | 50 ppm | | | | |
| | $AlCl_3$/He | 0.1 | | | | |
| | NO | 0.1 | | | | |
| | $SiF_4$ | 0.5 | | | | |
| 4th | $SiH_4$ | 50 | 300 | 10 | 0.4 | 0.5 |
| layer | $CH_4$ | 600 | | | | |
| region | $AlCl_3$/He | 0.1 | | | | |
| | $SiF_4$ | 0.5 | | | | |
| | NO | 0.1 | | | | |
| | $PH_3$ | 0.3 ppm | | | | |

TABLE 32

| Order of lamination (layer name) | | Gases and their flow rates (SCCM) | | Substrate temperature (°C.) | RF discharging power (mW/cm$^3$) | Inner pressure (Torr) | Layer thickness (μm) |
|---|---|---|---|---|---|---|---|
| Lower layer | | $SiH_4$ | 50 | 250 | 5 | 0.4 | 0.03 |
| | | $H_2$ | 10→200* | | | | |
| | | $AlCl_3$/He | | | | | |
| | | (S-side: 0.01 μm) | 100→10** | | | | |
| | | (UL-side: 0.01 μm) | 10 | | | | |
| Upper layer | 1st layer region | $SiH_4$ | 100 | 250 | 10 | 0.5 | 2 |
| | | $B_2H_6$ (against $SiH_4$) | 1500 ppm | | | | |
| | | $C_2H_2$ | 13 | | | | |
| | | $H_2$ | 300 | | | | |
| | | NO | 1 | | | | |
| | 2nd layer region | $SiH_4$ | 100 | 250 | 25 | 0.5 | 22 |
| | | $B_2H_6$ (against $SiH_4$) | 40 ppm | | | | |
| | | $C_2H_2$ | 15 | | | | |
| | | $H_2$ | 300 | | | | |
| | 3rd layer region | $SiH_4$ | 100 | 250 | 20 | 0.5 | 5 |
| | | $C_2H_2$ | 10 | | | | |
| | | $H_2$ | 150 | | | | |
| | 4th layer region | $SiH_4$ | 60 | 250 | 10 | 0.4 | 0.5 |
| | | $C_2H_2$ | 60 | | | | |
| | | $H_2$ | 50 | | | | |

TABLE 33

| Order of lamination (layer name) | | Gases and their flow rates (SCCM) | | Substrate temperature (°C.) | RF discharging power (mW/cm$^3$) | Inner pressure (Torr) | Layer thickness (μm) |
|---|---|---|---|---|---|---|---|
| Lower layer | | $SiH_4$ | 50 | 250 | 5 | 0.4 | 0.03 |
| | | $H_2$ | 10→200* | | | | |
| | | $AlCl_3$/He | | | | | |
| | | (S-side: 0.01 μm) | 100→10** | | | | |
| | | (UL-side: 0.01 μm) | 10 | | | | |
| Upper layer | 1st layer region | $SiH_4$ | 100 | 250 | 10 | 0.5 | 2 |
| | | $PH_3$ (against $SiH_4$) | 1500 ppm | | | | |
| | | $C_2H_2$ | 13 | | | | |
| | | $H_2$ | 300 | | | | |
| | | NO | 1 | | | | |
| | 2nd layer region | $SiH_4$ | 100 | 250 | 25 | 0.5 | 22 |
| | | $C_2H_2$ | 15 | | | | |
| | | $H_2$ | 300 | | | | |
| | 3rd layer region | $SiH_4$ | 100 | 250 | 20 | 0.5 | 5 |
| | | $C_2H_2$ | 10 | | | | |
| | | $H_2$ | 150 | | | | |
| | 4th layer region | $SiH_4$ | 60 | 250 | 10 | 0.4 | 0.5 |
| | | $C_2H_2$ | 60 | | | | |
| | | $H_2$ | 50 | | | | |

TABLE 34

| Order of lamination (layer name) | | Gases and their flow rates (SCCM) | | Substrate temperature (°C.) | RF discharging power (mW/cm$^3$) | Inner pressure (Torr) | Layer thickness (μm) |
|---|---|---|---|---|---|---|---|
| Lower layer | | $SiH_4$ | 10→100* | 250 | 5 | 0.4 | 0.2 |
| | | $H_2$ | 5→200* | | | | |
| | | $AlCl_3$/He | | | | | |
| | | (S-side: 0.05 μm) | 200→40** | | | | |
| | | (UL-side: 0.15 μm) | 40→10** | | | | |
| Upper layer | 1st layer region | $SiH_4$ | 100 | 300 | 10 | 0.4 | 3 |
| | | $H_2$ | 100 | | | | |
| | | $B_2H_6$ (against $SiH_4$) | 1000 ppm | | | | |
| | | $C_2H_2$ | 5 | | | | |
| | | $SiF_4$ | 0.5 | | | | |
| | | NO | 0.3 | | | | |
| | | $H_2S$ (against $SiH_4$) | 1 ppm | | | | |
| | | $AlCl_3$/He | 0.5 | | | | |
| | 2nd layer region | $SiH_4$ | 100 | 300 | 15 | 0.5 | 3 |
| | | $H_2$ | 500 | | | | |
| | | $B_2H_6$ (against $SiH_4$) | 0.5 ppm | | | | |
| | | $C_2H_2$ | 0.1 | | | | |
| | | $SiF_4$ | 0.2 | | | | |
| | | NO | 0.1 | | | | |
| | | $H_2S$ (against $SiH_4$) | 0.4 ppm | | | | |
| | | $AlCl_3$/He | 0.2 | | | | |
| | 3rd layer region | $SiH_4$ | 100 | 300 | 25 | 0.6 | 30 |
| | | $CH_4$ | 600 | | | | |
| | | $H_2$ | 300 | | | | |
| | | $PH_3$ (against $SiH_4$) | 3000 ppm | | | | |
| | | $B_2H_6$ (against $SiH_4$) | 0.5 ppm | | | | |
| | | $SiF_4$ | 0.2 | | | | |
| | | NO | 0.2 | | | | |
| | | $H_2S$ (against $SiH_4$) | 0.8 ppm | | | | |
| | | $AlCl_3$/He | 0.1 | | | | |
| | 4th layer region | $SiH_4$ | 30 | 300 | 10 | 0.4 | 0.5 |
| | | $CH_4$ | 600 | | | | |
| | | $PH_3$ (against $SiH_4$) | 1 ppm | | | | |
| | | $B_2H_6$ (against $SiH_4$) | 0.5 ppm | | | | |
| | | $H_2S$ (against $SiH_4$) | 0.8 ppm | | | | |
| | | $SiF_4$ | 0.5 | | | | |
| | | NO | 0.6 | | | | |
| | | $AlCl_3$/He | 0.5 | | | | |

TABLE 35

| Order of lamination (layer name) | | Gases and their flow rates (SCCM) | | Substrate temperature (°C.) | RF discharging power (mW/cm$^3$) | Inner pressure (Torr) | Layer thickness (μm) |
|---|---|---|---|---|---|---|---|
| Lower layer | | $SiH_4$ | 50 | 250 | 5 | 0.4 | 0.05 |
| | | $B_2H_6$ (against $SiH_4$) | 100 ppm | | | | |
| | | $H_2$ | 10→200* | | | | |
| | | $AlCl_3$/He | 120→40** | | | | |
| Upper layer | 1st layer region | $SiH_4$ | 100 | 250 | 10 | 0.35 | 3 |
| | | $H_2$ | 100 | | | | |
| | | NO | 30 | | | | |
| | 2nd layer region | $SiH_4$ | 300 | 250 | 15 | 0.5 | 20 |
| | | $H_2$ | 300 | | | | |
| | 3rd layer region | $SiH_4$ | 50 | 250 | 10 | 0.4 | 0.5 |
| | | $CH_4$ | 500 | | | | |

TABLE 36

| Order of lamination (layer name) | | Gases and their flow rates (SCCM) | | Substrate temperature (°C.) | RF discharging power (mW/cm$^3$) | Inner pressure (Torr) | Layer thickness (μm) |
|---|---|---|---|---|---|---|---|
| Lower layer | | $SiH_4$ | 50 | 250 | 5 | 0.4 | 0.05 |
| | | $AlCl_3$/He | 120→40** | | | | |
| Upper layer | 1st layer region | $SiH_4$ | 100 | 250 | 10 | 0.35 | 3 |
| | | $H_2$ | 100 | | | | |
| | | NO | 30 | | | | |
| | 2nd layer region | $SiH_4$ | 300 | 250 | 15 | 0.5 | 20 |
| | | $H_2$ | 300 | | | | |
| | 3rd layer region | $SiH_4$ | 50 | 250 | 10 | 0.4 | 0.5 |
| | | $CH_4$ | 500 | | | | |

TABLE 37

| Order of lamination (layer name) | | Gases and their flow rates (SCCM) | | Substrate temperature (°C.) | RF discharging power (mW/cm$^3$) | Inner pressure (Torr) | Layer thickness (μm) |
|---|---|---|---|---|---|---|---|
| Lower layer | | $SiH_4$ | 50 | 250 | 5 | 0.4 | 0.03 |
| | | $B_2H_6$ (against $SiH_4$) | 100 ppm | | | | |
| | | $H_2$ | 10→200* | | | | |
| | | $AlCl_3$/He | | | | | |
| | | (S-side: 0.01 μm) | 100→10** | | | | |
| | | (UL-side: 0.02 μm) | 10 | | | | |
| Upper layer | 1st layer region | $SiH_4$ | 100 | 250 | 10 | 0.35 | 3 |
| | | $H_2$ | 100 | | | | |
| | | $B_2H_6$ (against $SiH_4$) | 800 ppm | | | | |
| | | NO | 10 | | | | |
| | 2nd layer region | $SiH_4$ | 300 | 250 | 15 | 0.5 | 20 |
| | | $H_2$ | 300 | | | | |
| | 3rd layer region | $SiH_4$ | 50 | 250 | 10 | 0.4 | 0.5 |
| | | $CH_4$ | 500 | | | | |

TABLE 38

| Order of lamination (layer name) | | Gases and their flow rates (SCCM) | | Substrate temperature (°C.) | RF discharging power (mW/cm$^3$) | Inner pressure (Torr) | Layer thickness (μm) |
|---|---|---|---|---|---|---|---|
| Lower layer | | $SiH_4$ | 50 | 150 | 0.5 | 0.3 | 0.02 |
| | | $H_2$ | 5→200* | ↓ | ↓ | | |
| | | $AlCl_3$/He | | 300 | 1.5 | | |
| | | (S-side: 0.01 μm) | 200→30** | | | | |
| | | (UL-side: 0.01 μm) | 30→10** | | | | |
| | | $B_2H_6$ (against $SiH_4$) | 100 ppm | | | | |
| Upper layer | 1st layer region | $SiH_4$ | 100 | 270 | 10 | 0.35 | 3 |
| | | $H_2$ | 100 | | | | |
| | | $B_2H_6$ (against $SiH_4$) | 800 ppm | | | | |
| | | NO | 10 | | | | |
| | 2nd layer region | $SiH_4$ | 300 | 250 | 20 | 0.5 | 20 |
| | | $H_2$ | 500 | | | | |

TABLE 39

| Order of lamination (layer name) | | Gases and their flow rates (SCCM) | | Substrate temperature (°C.) | RF discharging power (mW/cm$^3$) | Inner pressure (Torr) | Layer thickness (μm) |
|---|---|---|---|---|---|---|---|
| Lower layer | | $SiH_4$ | 50 | 250 | 1 | 0.3 | 0.02 |
| | | $H_2$ | 5→200* | | | | |
| | | $AlCl_3$/He | | | | | |
| | | (S-side: 0.01 μm) | 200→30** | | | | |
| | | (UL-side: 0.01 μm) | 30→10** | | | | |
| | | $B_2H_6$ (against $SiH_4$) | 100 ppm | | | | |
| Upper layer | 1st layer region | $SiH_4$ | 100 | 250 | 10 | 0.35 | 3 |
| | | He | 100 | | | | |
| | | $B_2H_6$ (against $SiH_4$) | 800 ppm | | | | |
| | | NO | | | | | |
| | | (LL-side: 2 μm) | 10 | | | | |
| | | (U · 2nd LR-side: 1 μm) | 10→0** | | | | |
| | | $AlCl_3$/He | 0.1 | | | | |
| | | $SiF_4$ | 0.5 | | | | |
| | | $CH_4$ | 1 | | | | |
| | 2nd layer region | $SiH_4$ | 300 | 250 | 25 | 0.6 | 25 |
| | | He | 600 | | | | |
| | | $B_2H_6$ | 0.3 ppm | | | | |
| | | $AlCl_3$/He | 0.1 | | | | |
| | | $SiF_4$ | 0.5 | | | | |
| | | $CH_4$ | 1 | | | | |
| | | NO | 0.1 | | | | |
| | 3rd layer region | $SiH_4$ | 50 | 250 | 10 | 0.4 | 1 |
| | | $CH_4$ | 500 | | | | |
| | | NO | 0.1 | | | | |
| | | $N_2$ | 1 | | | | |
| | | $B_2H_6$ | 0.3 ppm | | | | |
| | | $AlCl_3$/He | 0.5 | | | | |
| | | $SiF_4$ | 0.5 | | | | |

TABLE 40

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 10→100* | 250 | 10 | 0.4 | 0.2 |
| | | $H_2$ | 5→200* | | | | |
| | | $AlCl_3$/He | | | | | |
| | | (S-side: 0.05 μm) | 200→40** | | | | |
| | | (UL-side: 0.15 μm) | 40→10** | | | | |
| | | $PH_3$ (against $SiH_4$) | 100 ppm | | | | |
| Upper layer | 1st layer region | $SiH_4$ | 100 | 250 | 10 | 0.35 | 3 |
| | | $H_2$ | 100 | | | | |
| | | $PH_3$ (against $SiH_4$) | 800 ppm | | | | |
| | | $NH_3$ | 4 | | | | |
| | 2nd layer region | $SiH_4$ | 400 | 250 | 10 | 0.5 | 15 |
| | | Ar | 200 | | | | |
| | 3rd layer region | $SiH_4$ | 100 | 250 | 5 | 0.4 | 0.3 |
| | | $NH_3$ | 30 | | | | |

TABLE 41

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 10→100* | 300 | 10 | 0.4 | 0.2 |
| | | $H_2$ | 5→200* | | | | |
| | | $AlCl_3$/He | | | | | |
| | | (S-side: 0.05 μm) | 200→40** | | | | |
| | | (UL-side: 0.15 μm) | 40→10** | | | | |
| | | $B_2H_6$ (against $SiH_4$) | 80 ppm | | | | |
| Upper layer | 1st layer region | $SiH_4$ | 100 | 300 | 10 | 0.35 | 3 |
| | | $H_2$ | 100 | | | | |
| | | $B_2H_6$ (against $SiH_4$) | 1000 ppm | | | | |
| | | $C_2H_2$ | 5 | | | | |
| | 2nd layer region | $SiH_4$ | 300 | 300 | 20 | 0.5 | 20 |
| | | $H_2$ | 500 | | | | |
| | 3rd layer region | $SiH_4$ | 100 | 300 | 15 | 0.4 | 7 |
| | | $CH_4$ | 600 | | | | |
| | | $PH_3$ (against $SiH_4$) | 3000 ppm | | | | |
| | 4th layer region | $SiH_4$ | 40 | 300 | 10 | 0.4 | 0.1 |
| | | $CH_4$ | 600 | | | | |

TABLE 42

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 50 | 330 | 5 | 0.4 | 0.05 |
| | | $H_2$ | 5→200* | | | | |
| | | $AlCl_3$/He | 200→20** | | | | |
| | | $PH_3$ (against $SiH_4$) | 60 ppm | | | | |
| Upper layer | 1st layer region | $SiH_4$ | 100 | 330 | 10 | 0.35 | 3 |
| | | $H_2$ | 100 | | | | |
| | | $PH_3$ (against $SiH_4$) | 800 ppm | | | | |
| | | NO | 10 | | | | |
| | 2nd layer region | $SiH_4$ | 400 | 330 | 25 | 0.5 | 25 |
| | | $SiF_4$ | 10 | | | | |
| | | $H_2$ | 800 | | | | |
| | 3rd layer region | $SiH_4$ | 100 | 350 | 15 | 0.4 | 5 |
| | | $CH_4$ | 400 | | | | |
| | | $B_2H_6$ (against $SiH_4$) | 5000 ppm | | | | |
| | 4th layer region | $SiH_4$ | 20 | 350 | 10 | 0.4 | 1 |
| | | $CH_4$ | 400 | | | | |
| | | $B_2H_6$ (against $SiH_4$) | 8000 ppm | | | | |

TABLE 43

| Order of lamination (layer name) | Gases and their flow rates (SCCM) | | Substrate temperature (°C.) | RF discharging power (mW/cm³) | Inner pressure (Torr) | Layer thickness (μm) |
|---|---|---|---|---|---|---|
| Lower layer | $SiH_4$ | 50 | 300 | 1 | 0.3 | 0.02 |
| | $H_2$ | 5→200* | | | | |
| | $AlCl_3$/He | | | | | |
| | (S-side: 0.01 μm) | 200→30** | | | | |

TABLE 43-continued

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| | | (UL-side: 0.01 μm) | 30→10** | | | | |
| | | $B_2H_6$ (against $SiH_4$) | 60→100* | | | | |
| Upper layer | 1st layer region | $SiH_4$ | 100 | 300 | 10 | 0.35 | 3 |
| | | $H_2$ | 150 | | | | |
| | | $B_2H_6$ (against $SiH_4$) | 900→600 ppm** | | | | |
| | | $N_2$ | 150 | | | | |
| | 2nd layer region | $SiH_4$ | 300 | 300 | 20 | 0.5 | 20 |
| | | $H_2$ | 200 | | | | |
| | 3rd layer region | $SiH_4$ | 50 | 300 | 20 | 0.4 | 5 |
| | | $N_2$ | 500 | | | | |
| | | $PH_3$ (against $SiH_4$) | 3000 ppm | | | | |
| | 4th layer region | $SiH_4$ | 40 | 300 | 10 | 0.4 | 0.3 |
| | | $CH_4$ | 600 | | | | |

TABLE 44

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 50 | 250 | 5 | 0.4 | 0.05 |
| | | $H_2$ | 5→200* | | | | |
| | | $AlCl_3$/He | 200→20** | | | | |
| | | $B_2H_6$ (against $SiH_4$) | 10 ppm | | | | |
| Upper layer | 1st layer region | $SiH_4$ | 100 | 250 | 10 | 0.35 | 3 |
| | | $H_2$ | 100 | | | | |
| | | $B_2H_6$ (against $SiH_4$) | 1000 ppm | | | | |
| | | $C_2H_2$ | 5 | | | | |
| | 2nd layer region | $SiH_4$ | 300 | 250 | 15 | 0.5 | 10 |
| | | $H_2$ | 300 | | | | |
| | 3rd layer region | $SiH_4$ | 200 | 250 | 15 | 0.4 | 20 |
| | | $C_2H_2$ | 10→20* | | | | |
| | | NO | 1 | | | | |

TABLE 45

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 50 | 250 | 1 | 0.4 | 0.02 |
| | | $H_2$ | 5→200* | | | | |
| | | $AlCl_3$/He | | | | | |
| | | (S-side: 0.01 μm) | 200→30** | | | | |
| | | (UL-side: 0.01 μm) | 30→10** | | | | |
| | | $B_2H_6$ (against $SiH_4$) | 10→150 ppm* | | | | |
| Upper layer | 1st layer region | $SiH_4$ | 100 | 300 | 10 | 0.35 | 3 |
| | | $H_2$ | 150 | | | | |
| | | $B_2H_6$ (against $SiH_4$) | 900→600 ppm* | | | | |
| | | $N_2$ | 150 | | | | |
| | 2nd layer region | $SiH_4$ | 300 | 300 | 20 | 0.5 | 5 |
| | | $H_2$ | 300 | | | | |
| | 3rd layer region | $SiH_4$ | 100 | 300 | 15 | 0.4 | 20 |
| | | $CH_4$ | 100 | | | | |
| | 4th layer region | $SiH_4$ | 50 | 300 | 10 | 0.4 | 0.5 |
| | | $CH_4$ | 600 | | | | |

TABLE 46

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 10→100* | 300 | 5 | 0.4 | 0.2 |
| | | $H_2$ | 5→200* | | | | |
| | | $AlCl_3$/He | | | | | |
| | | (S-side: 0.05 μm) | 200→40** | | | | |
| | | (UL-side: 0.15 μm) | 40→10** | | | | |
| | | $PH_3$ (against $SiH_4$) | 5→200 ppm* | | | | |
| Upper layer | 1st layer | $SiH_4$ | 100 | 300 | 10 | 0.35 | 3 |
| | | $H_2$ | 100 | | | | |

TABLE 46-continued

| Order of lamination (layer name) | Gases and their flow rates (SCCM) | | Substrate temperature (°C.) | RF discharging power (mW/cm³) | Inner pressure (Torr) | Layer thickness (μm) |
|---|---|---|---|---|---|---|
| region | $PH_3$ (against $SiH_4$) | 800 ppm | | | | |
| | $NH_3$ | 5 | | | | |
| 2nd layer region | $SiH_4$ | 100 | 300 | 5 | 0.2 | 8 |
| | $H_2$ | 300 | | | | |
| 3rd layer region | $SiH_4$ | 300 | 300 | 15 | 0.4 | 25 |
| | $NH_3$ | 50 | | | | |
| 4th layer region | $SiH_4$ | 100 | 300 | 10 | 0.4 | 0.3 |
| | $NH_3$ | 50 | | | | |

TABLE 47

| Order of lamination (layer name) | Gases and their flow rates (SCCM) | | Substrate temperature (°C.) | RF discharging power (mW/cm³) | Inner pressure (Torr) | Layer thickness (μm) |
|---|---|---|---|---|---|---|
| Lower layer | $SiH_4$ | 10→100* | 250 | 5 | 0.4 | 0.2 |
| | $H_2$ | 5→200* | | | | |
| | $AlCl_3$/He | | | | | |
| | (S-side: 0.05 μm) | 200→40** | | | | |
| | (UL-side: 0.15 μm) | 40→10** | | | | |
| | $PH_3$ (against $SiH_4$) | 100 ppm | | | | |
| Upper layer 1st layer region | $SiH_4$ | 100 | 280 | 10 | 0.35 | 3 |
| | $H_2$ | 100 | | | | |
| | $PH_3$ (against $SiH_4$) | 800 ppm | | | | |
| | NO | 10 | | | | |
| 2nd layer region | $SiH_4$ | 100 | 300 | 3 | 0.5 | 3 |
| | $SiF_4$ | 5 | | | | |
| | $H_2$ | 200 | | | | |
| 3rd layer region | $SiH_4$ | 100 | 300 | 15 | 0.4 | 30 |
| | $CH_4$ | 100 | | | | |
| | $PH_3$ (against $SiH_4$) | 50 ppm | | | | |
| 4th layer region | $SiH_4$ | 50 | 300 | 10 | 0.4 | 0.5 |
| | $CH_4$ | 600 | | | | |

TABLE 48

| Order of lamination (layer name) | Gases and their flow rates (SCCM) | | Substrate temperature (°C.) | RF discharging power (mW/cm³) | Inner pressure (Torr) | Layer thickness (μm) |
|---|---|---|---|---|---|---|
| Lower layer | $SiH_4$ | 50 | 250 | 5 | 0.4 | 0.05 |
| | $H_2$ | 5→200* | | | | |
| | $AlCl_3$/He | 200→20** | | | | |
| | $B_2H_6$ (against $SiH_4$) | 30 ppm | | | | |
| Upper layer 1st layer region | $SiH_4$ | 100 | 300 | 10 | 0.35 | 3 |
| | $H_2$ | 100 | | | | |
| | $B_2H_6$ (against $SiH_4$) | 800 ppm | | | | |
| | NO | | | | | |
| | (LL-side: 2 μm) | 10 | | | | |
| | (U · 2nd LR-side: 1 μm) | 10→0** | | | | |
| 2nd layer region | $SiH_4$ | 200 | 300 | 10 | 0.5 | 10 |
| | $H_2$ | 200 | | | | |
| 3rd layer region | $SiH_4$ | 300 | 330 | 20 | 0.4 | 30 |
| | $C_2H_2$ | 50 | | | | |
| | $B_2H_6$ (against $SiH_4$) | 100 ppm | | | | |
| 4th layer region | $SiH_4$ | 200 | 330 | 10 | 0.4 | 1 |
| | $C_2H_2$ | 200 | | | | |

TABLE 49

| Order of lamination (layer name) | Gases and their flow rates (SCCM) | | Substrate temperature (°C.) | RF discharging power (mW/cm³) | Inner pressure (Torr) | Layer thickness (μm) |
|---|---|---|---|---|---|---|
| Lower layer | $SiH_4$ | 10→100* | 250 | 5 | 0.4 | 0.2 |
| | $H_2$ | 5→200* | | | | |
| | $AlCl_3$/He | | | | | |
| | (S-side: 0.05 μm) | 200→40** | | | | |
| | (UL-side: 0.15 μm) | 40→10** | | | | |
| | $B_2H_6$ (against $SiH_4$) | 50 ppm | | | | |
| Upper 1st | $SiH_4$ | 100 | 270 | 10 | 0.35 | 3 |

TABLE 49-continued

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| layer | layer region | $H_2$ | 100 | | | | |
| | | $B_2H_6$ (against $SiH_4$) | 800 ppm | | | | |
| | | $NH_3$ | 5 | | | | |
| | 2nd layer region | $SiH_4$ | 100 | 300 | 5 | 0.2 | 8 |
| | | $H_2$ | 300 | | | | |
| | 3rd layer region | $SiH_4$ | 300 | 300 | 15 | 0.4 | 25 |
| | | $NH_3$ | 30→50* | | | | |
| | | $PH_3$ (against $SiH_4$) | 50 ppm | | | | |
| | 4th layer region | $SiH_4$ | 100 | 300 | 5 | 0.4 | 0.7 |
| | | $NH_3$ | 80→100* | | | | |
| | | $PH_3$ (against $SiH_4$) | 500 ppm | | | | |

TABLE 50

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 50 | 250 | 1 | 0.4 | 0.02 |
| | | $H_2$ | 5→200* | | | | |
| | | $AlCl_3$/He | | | | | |
| | | (S-side: 0.01 μm) | 200→30** | | | | |
| | | (UL-side: 0.01 μm) | 30→10** | | | | |
| | | $B_2H_6$ (against $SiH_4$) | 80→150 ppm | | | | |
| Upper layer | 1st layer region | $SiH_4$ | 100 | 250 | 10 | 0.35 | 3 |
| | | $H_2$ | 100 | | | | |
| | | $B_2H_6$ (against $SiH_4$) | 800 ppm | | | | |
| | | NO | | | | | |
| | | (LL-side: 2 μm) | 10 | | | | |
| | | (U · 2nd LR-side: 1 μm) | 10→0** | | | | |
| | 2nd layer region | $SiH_4$ | 300 | 300 | 20 | 0.5 | 20 |
| | | $H_2$ | 500 | | | | |
| | 3rd layer region | $SiH_4$ | 100 | 300 | 5 | 0.4 | 1 |
| | | $GeH_4$ | 10→50* | | | | |
| | | $H_2$ | 300 | | | | |
| | 4th layer region | $SiH_4$ | 100→40** | 300 | 10 | 0.4 | 1 |
| | | $CH_4$ | 100→600* | | | | |

TABLE 51

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 50 | 300 | 1 | 0.3 | 0.02 |
| | | $H_2$ | 5→200* | | | | |
| | | $AlCl_3$/He | | | | | |
| | | (S-side: 0.01 μm) | 200→30** | | | | |
| | | (UL-side: 0.01 μm) | 30→10** | | | | |
| | | $B_2H_6$ (against $SiH_4$) | 70 ppm | | | | |
| Upper layer | 1st layer region | $SiH_4$ | 85 | 300 | 9 | 0.35 | 3 |
| | | $H_2$ | 90 | | | | |
| | | $B_2H_6$ (against $SiH_4$) | 800 ppm | | | | |
| | | NO | 9 | | | | |
| | 2nd layer region | $SiH_4$ | 300 | 300 | 15 | 0.5 | 20 |
| | | $H_2$ | 400 | | | | |
| | 3rd layer region | $SiH_4$ | 50 | 300 | 10 | 0.4 | 0.5 |
| | | $CH_4$ | 500 | | | | |

TABLE 52

| Order of lamination (layer name) | Gases and their flow rates (SCCM) | | Substrate temperature (°C.) | RF discharging power (mW/cm³) | Inner pressure (Torr) | Layer thickness (μm) |
|---|---|---|---|---|---|---|
| Lower layer | $SiH_4$ | 50 | 300 | 0.7 | 0.3 | 0.02 |
| | $H_2$ | 5→200* | | | | |
| | $AlCl_3$/He | | | | | |
| | (S-side: 0.01 μm) | 200→30** | | | | |
| | (UL-side: 0.01 μm) | 30→10** | | | | |
| | $B_2H_6$ (against $SiH_4$) | 70 ppm | | | | |

TABLE 52-continued

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Upper layer | 1st layer region | $SiH_4$ | 70 | 300 | 8 | 0.35 | 3 |
| | | $H_2$ | 80 | | | | |
| | | $B_2H_6$ (against $SiH_4$) | 800 ppm | | | | |
| | | NO | 8 | | | | |
| | 2nd layer region | $SiH_4$ | 200 | 300 | 12 | 0.4 | 20 |
| | | $H_2$ | 400 | | | | |
| | 3rd layer region | $SiH_4$ | 40 | 300 | 7 | 0.3 | 0.5 |
| | | $CH_4$ | 400 | | | | |

TABLE 53

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 25 | 300 | 0.5 | 0.2 | 0.02 |
| | | $H_2$ | 5→100* | | | | |
| | | $AlCl_3$/He | | | | | |
| | | (S-side: 0.01 μm) | 100→15** | | | | |
| | | (UL-side: 0.01 μm) | 15→5** | | | | |
| | | $B_2H_6$ (against $SiH_4$) | 70 ppm | | | | |
| Upper layer | 1st layer region | $SiH_4$ | 55 | 300 | 7 | 0.35 | 3 |
| | | $H_2$ | 70 | | | | |
| | | $B_2H_6$ (against $SiH_4$) | 800 ppm | | | | |
| | | NO | 7 | | | | |
| | 2nd layer region | $SiH_4$ | 150 | 300 | 10 | 0.4 | 20 |
| | | $H_2$ | 300 | | | | |
| | 3rd layer region | $SiH_4$ | 30 | 300 | 5 | 0.3 | 0.5 |
| | | $CH_4$ | 300 | | | | |

TABLE 54

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 20 | 300 | 0.3 | 0.2 | 0.02 |
| | | $H_2$ | 5→100* | | | | |
| | | $AlCl_3$/He | | | | | |
| | | (S-side: 0.01 μm) | 80→15** | | | | |
| | | (UL-side: 0.01 μm) | 15→5** | | | | |
| | | $B_2H_6$ (against $SiH_4$) | 70 ppm | | | | |
| Upper layer | 1st layer region | $SiH_4$ | 45 | 300 | 6 | 0.35 | 3 |
| | | $H_2$ | 60 | | | | |
| | | $B_2H_6$ (against $SiH_4$) | 800 ppm | | | | |
| | | NO | 5 | | | | |
| | 2nd layer region | $SiH_4$ | 100 | 300 | 6 | 0.3 | 20 |
| | | $H_2$ | 300 | | | | |
| | 3rd layer region | $SiH_4$ | 20 | 300 | 3 | 0.2 | 0.5 |
| | | $CH_4$ | 200 | | | | |

TABLE 55

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 50 | 500 | 5 | 0.4 | 0.05 |
| | | $H_2$ | 5→200* | | | | |
| | | $AlCl_3$/He | 200→20** | | | | |
| | | $B_2H_6$ (against $SiH_4$) | 10→30 ppm | | | | |
| Upper layer | 1st layer region | $SiH_4$ | 180 | 500 | 22 | 0.4 | 4 |
| | | $H_2$ | 1200 | | | | |
| | | $B_2H_6$ (against $SiH_4$) | 700 ppm | | | | |
| | | $C_2H_2$ | 8 | | | | |
| | 2nd layer region | $SiH_4$ | 300 | 500 | 30 | 0.5 | 10 |
| | | $H_2$ | 1500 | | | | |
| | 3rd layer | $SiH_4$ | 200 | 500 | 30 | 0.4 | 20 |
| | | $C_2H_2$ | 10→20* | | | | |

TABLE 55-continued

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| | region | NO | 1 | | | | |

TABLE 56

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 150 | 250 | 0.5 | 0.6 | 0.02 |
| | | $H_2$ | 20→500* | | | | |
| | | $AlCl_3$/He | | | | | |
| | | (S-side: 0.01 μm) | 400→80** | | | | |
| | | (UL-side: 0.01 μm) | 80→50** | | | | |
| | | $B_2H_6$ (against $SiH_4$) | 30 ppm | | | | |
| Upper layer | 1st layer region | $SiH_4$ | 350 | 250 | 0.5 | 0.5 | 3 |
| | | $H_2$ | 350 | | | | |
| | | $B_2H_6$ (against $SiH_4$) | 600 ppm | | | | |
| | | NO | 13 | | | | |
| | | $SiF_4$ | 20 | | | | |
| | 2nd layer region | $SiH_4$ | 700 | 250 | 0.5 | 0.5 | 20 |
| | | $SiF_4$ | 30 | | | | |
| | | $H_2$ | 500 | | | | |
| | 3rd layer region | $SiH_4$ | 150 | 250 | 0.5 | 0.3 | 1 |
| | | $CH_4$ | 500 | | | | |

TABLE 57

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 50 | 250 | 5 | 0.4 | 0.05 |
| | | $H_2$ | 5→200* | | | | |
| | | $AlCl_3$/He | 200→20** | | | | |
| | | $B_2H_6$ (against $SiH_4$) | 10 ppm | | | | |
| Upper layer | 1st layer region | $SiH_4$ | 100 | 250 | 10 | 0.35 | 3 |
| | | $H_2$ | 100 | | | | |
| | | $B_2H_6$ (against $SiH_4$) | 1000 ppm | | | | |
| | | $C_2H_2$ | 5 | | | | |
| | 2nd layer region | $SiH_4$ | 200 | 250 | 15 | 0.4 | 20 |
| | | $C_2H_2$ | 10→20* | | | | |
| | | NO | 1 | | | | |
| | 3rd layer region | $SiH_4$ | 300 | 250 | 15 | 0.5 | 10 |
| | | $H_2$ | 300 | | | | |

TABLE 58

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 50 | 250 | 1 | 0.4 | 0.02 |
| | | $H_2$ | 5→200* | | | | |
| | | $AlCl_3$/He | | | | | |
| | | (S-side: 0.01 μm) | 200→30** | | | | |
| | | (UL-side: 0.01 μm) | 30→10** | | | | |
| | | $B_2H_6$ (against $SiH_4$) | 10→150 ppm* | | | | |
| Upper layer | 1st layer region | $SiH_4$ | 350 | 300 | 10 | 0.35 | 3 |
| | | $H_2$ | 150 | | | | |
| | | $B_2H_6$ (against $SiH_4$) | 900→600 ppm** | | | | |
| | | $N_2$ | 150 | | | | |
| | 2nd layer region | $SiH_4$ | 100 | 300 | 15 | 0.4 | 20 |
| | | $CH_2$ | 100 | | | | |
| | 3rd layer region | $SiH_4$ | 300 | 300 | 20 | 0.5 | 5 |
| | | $H_2$ | 300 | | | | |
| | 4th layer region | $SiH_4$ | 50 | 300 | 10 | 0.4 | 0.5 |
| | | $CH_4$ | 600 | | | | |

TABLE 59

| Order of lamination (layer name) | | Gases and their flow rate (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 10→100* | 300 | 0.5 | 0.4 | 0.02 |
| | | $H_2$ | 5→200* | | | | |
| | | $AlCl_3$/He | | | | | |
| | | (S-side: 0.05 μm) | 200→40** | | | | |
| | | (UL-side: 0.15 μm) | 40→10** | | | | |
| | | $PH_3$ (against $SiH_4$) | 5→200 ppm* | | | | |
| Upper layer | 1st layer region | $SiH_4$ | 100 | 300 | 10 | 0.35 | 3 |
| | | $H_2$ | 100 | | | | |
| | | $PH_3$ (against $SiH_4$) | 800 ppm | | | | |
| | | $NH_3$ | 5 | | | | |
| | 2nd layer region | $SiH_4$ | 300 | 300 | 15 | 0.4 | 25 |
| | | $NH_3$ | 50 | | | | |
| | 3rd layer region | $SiH_4$ | 100 | 300 | 5 | 0.2 | 8 |
| | | $H_2$ | 300 | | | | |
| | 4th layer region | $SiH_4$ | 100 | 300 | 10 | 0.4 | 0.3 |
| | | $NH_3$ | 50 | | | | |

TABLE 60

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 10→100* | 250 | 5 | 0.4 | 0.2 |
| | | $H_2$ | 5→200* | | | | |
| | | $AlCl_3$/He | | | | | |
| | | (S-side: 0.05 μm) | 200→40** | | | | |
| | | (UL-side: 0.15 μm) | 40→10** | | | | |
| | | $PH_3$ (against $SiH_4$) | 100 ppm | | | | |
| Upper layer | 1st layer region | $SiH_4$ | 100 | 250 | 10 | 0.35 | 3 |
| | | $H_2$ | 100 | | | | |
| | | $PH_3$ (against $SiH_4$) | 800 ppm | | | | |
| | | NO | 10 | | | | |
| | 2nd layer region | $SiH_4$ | 100 | 300 | 15 | 0.4 | 30 |
| | | $CH_4$ | 100 | | | | |
| | | $PH_3$ (against $SiH_4$) | 50 ppm | | | | |
| | 3rd layer region | $SiH_4$ | 100 | 300 | 3 | 0.5 | 3 |
| | | $SiF_4$ | 5 | | | | |
| | | $H_2$ | 200 | | | | |
| | 4th layer region | $SiH_4$ | 50 | 300 | 10 | 0.4 | 0.5 |
| | | $CH_4$ | 600 | | | | |

TABLE 61

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 50 | 250 | 5 | 0.4 | 0.05 |
| | | $H_2$ | 5→200* | | | | |
| | | $AlCl_3$/He | 200→20** | | | | |
| | | $B_2H_6$ (against $SiH_4$) | 30 ppm | | | | |
| Upper layer | 1st layer region | $SiH_4$ | 100 | 300 | 10 | 0.35 | 3 |
| | | $H_2$ | 100 | | | | |
| | | $B_2H_6$ (against $SiH_4$) | 800 ppm | | | | |
| | | NO | | | | | |
| | | (LL-side: 2 μm) | 10 | | | | |
| | | (U · 2nd LR-side: 1 μm) | 10→0** | | | | |
| | 2nd layer region | $SiH_4$ | 300 | 330 | 20 | 0.4 | 30 |
| | | $C_2H_2$ | 50 | | | | |
| | | $B_2H_6$ (against $SiH_4$) | 100 ppm | | | | |
| | 3rd layer region | $Si_2H_4$ | 200 | 300 | 10 | 0.5 | 10 |
| | | $H_2$ | 200 | | | | |
| | 4th layer region | $SiH_4$ | 200 | 330 | 10 | 0.4 | 1 |
| | | $C_2H_2$ | 200 | | | | |

TABLE 62

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 10→100* | 250 | 5 | 0.4 | 0.2 |
| | | $H_2$ | 5→200* | | | | |
| | | $AlCl_3$/He | | | | | |
| | | (S-side: 0.05 μm) | 200→40** | | | | |
| | | (UL-side: 0.15 μm) | 40→10** | | | | |
| | | $B_2H_6$ (against $SiH_4$) | 50 ppm | | | | |
| Upper layer | 1st layer region | $SiH_4$ | 100 | 300 | 10 | 0.35 | 3 |
| | | $H_2$ | 100 | | | | |
| | | $B_2H_6$ (against $SiH_4$) | 800 ppm | | | | |
| | | $NH_3$ | 5 | | | | |
| | 2nd layer region | $SiH_4$ | 300 | 300 | 15 | 0.4 | 25 |
| | | $NH_3$ | 30→5** | | | | |
| | | $PH_3$ (against $SiH_4$) | 50 ppm | | | | |
| | 3rd layer region | $SiH_4$ | 100 | 300 | 5 | 0.2 | 8 |
| | | $H_2$ | 300 | | | | |
| | 4th layer region | $SiH_4$ | 100 | 300 | 5 | 0.4 | 0.7 |
| | | $NH_3$ | 80→100* | | | | |
| | | $PH_3$ (against $SiH_4$) | 500 ppm | | | | |

TABLE 63

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 50 | 250 | 1 | 0.3 | 0.02 |
| | | $H_2$ | 5→200* | | | | |
| | | $AlCl_3$/He | | | | | |
| | | (S-side: 0.01 μm) | 200→30** | | | | |
| | | (UL-side: 0.01 μm) | 30→10** | | | | |
| | | $B_2H_6$ (against $SiH_4$) | 100 ppm | | | | |
| Upper layer | 1st layer region | $SiH_4$ | 100 | 250 | 25 | 0.35 | 3 |
| | | $H_2$ | 100 | | | | |
| | | $B_2H_6$ (against $SiH_4$) | 800 ppm | | | | |
| | | NO | | | | | |
| | | (LL-side: 2 μm) | 10 | | | | |
| | | (U · 2nd LR-side: 1 μm) | 10→0** | | | | |
| | 2nd layer region | $SiH_4$ | 300 | 250 | 25 | 0.6 | 25 |
| | | He | 600 | | | | |
| | 3rd layer region | $SiH_4$ | 50 | 250 | 10 | 0.4 | 1 |
| | | $CH_4$ | 500 | | | | |
| | | NO | 0.1 | | | | |
| | | $N_2$ | 1 | | | | |

TABLE 64

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 10→100* | 300 | 10 | 0.4 | 0.2 |
| | | $H_2$ | 5→200* | | | | |
| | | $AlCl_3$/He | | | | | |
| | | (S-side: 0.05 μm) | 200→40** | | | | |
| | | (UL-side: 0.15 μm) | 40→10** | | | | |
| | | $B_2H_6$ (against $SiH_4$) | 80 ppm | | | | |
| Upper layer | 1st layer region | $SiH_4$ | 100 | 300 | 10 | 0.35 | 3 |
| | | $H_2$ | 100 | | | | |
| | | $B_2H_6$ (against $SiH_4$) | 1000 ppm | | | | |
| | | $C_2H_2$ | 5 | | | | |
| | | $AlCl_3$/He | 0.1 | | | | |
| | | NO | 0.1 | | | | |
| | | $SiF_4$ | 0.5 | | | | |
| | 2nd layer region | $SiH_4$ | 300 | 300 | 20 | 0.5 | 20 |
| | | $H_2$ | 500 | | | | |
| | | $C_2H_2$ | 0.1 | | | | |
| | | $AlCl_3$/He | 0.1 | | | | |
| | | NO | 0.1 | | | | |
| | | $SiF_4$ | 0.5 | | | | |
| | | $B_2H_6$ | 0.3 ppm | | | | |
| | 3rd layer region | $SiH_4$ | 100 | 300 | 15 | 0.4 | 7 |
| | | $CH_4$ | 600 | | | | |
| | | $PH_3$ (against $SiH_4$) | 3000 ppm | | | | |
| | | $AlCl_3$/He | 0.1 | | | | |
| | | NO | 0.1 | | | | |

TABLE 64-continued

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| | | $SiF_4$ | 0.5 | | | | |
| | | $B_2H_6$ | 0.3 ppm | | | | |
| | | $C_2H_2$ | 0.1 | | | | |
| | 4th layer region | $SiH_4$ | 40 | 300 | 10 | 0.4 | 0.1 |
| | | $CH_4$ | 600 | | | | |
| | | $AlCl_3$/He | 0.1 | | | | |
| | | NO | 0.1 | | | | |
| | | $SiF_4$ | 0.5 | | | | |
| | | $B_2H_6$ | 0.3 ppm | | | | |
| | | $C_2H_2$ | 0.1 | | | | |
| | | $PH_3$ | 0.3 ppm | | | | |

TABLE 65

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 10→100* | 250 | 5 | 0.4 | 0.2 |
| | | $H_2$ | 5→200* | | | | |
| | | $AlCl_3$/He | | | | | |
| | | (S-side: 0.05 μm) | 200→40** | | | | |
| | | (UL-side: 0.15 μm) | 40→10** | | | | |
| | | $PH_3$ (against $SiH_4$) | | | | | |
| Upper layer | 1st layer region | $SiH_4$ | 100 | 280 | 10 | 0.35 | 3 |
| | | $H_2$ | 100 | | | | |
| | | $PH_3$ (against $SiH_4$) | 800 ppm | | | | |
| | | NO | 10 | | | | |
| | | $AlCl_3$ | 0.1 | | | | |
| | | $SiF_4$ | 0.5 | | | | |
| | | $CH_4$ | 1 | | | | |
| | 2nd layer region | $SiH_4$ | 100 | 300 | 3 | 0.5 | 3 |
| | | $SiF_4$ | 5 | | | | |
| | | $H_2$ | 200 | | | | |
| | | $PH_3$ (against $SiH_4$) | 0.3 ppm | | | | |
| | | NO | 10 | | | | |
| | | $CH_4$ | 1 | | | | |
| | | $AlCl_3$ | 0.1 | | | | |
| | 3rd layer region | $SiH_4$ | 100 | 300 | 15 | 0.4 | 30 |
| | | $CH_4$ | 100 | | | | |
| | | $PH_3$ (against $SiH_4$) | 50 ppm | | | | |
| | | $AlCl_3$/He | 0.1 | | | | |
| | | NO | 0.1 | | | | |
| | | $SiF_4$ | 0.5 | | | | |
| | 4th layer region | $SiH_4$ | 50 | 300 | 10 | 0.4 | 0.5 |
| | | $CH_4$ | 600 | | | | |
| | | $AlCl_3$/He | 0.1 | | | | |
| | | $SiF_4$ | 0.5 | | | | |
| | | NO | 0.1 | | | | |
| | | $PH_3$ (against $SiH_4$) | 0.3 ppm | | | | |

TABLE 66

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 50 | 250 | 5 | 0.4 | 0.03 |
| | | $H_2$ | 10→200* | | | | |
| | | $AlCl_3$/He | | | | | |
| | | (S-side: 0.01 μm) | 100→10** | | | | |
| | | (UL-side: 0.02 μm) | 10 | | | | |
| | | $B_2H_6$ (against $SiH_4$) | 150→200 ppm* | | | | |
| Upper layer | 1st layer region | $SiH_4$ | 100 | 250 | 25 | 0.5 | 2 |
| | | $B_2H_6$ (against $SiH_4$) | 1500 ppm | | | | |
| | | $C_2H_2$ | 13 | | | | |
| | | $H_2$ | 300 | | | | |
| | | NO | 1 | | | | |
| | 2nd layer region | $SiH_4$ | 100 | 250 | 25 | 0.5 | 22 |
| | | $B_2H_6$ (against $SiH_4$) | 40 ppm | | | | |
| | | $C_2H_2$ | 15 | | | | |
| | | $H_2$ | 300 | | | | |
| | 3rd layer region | $SiH_4$ | 100 | 250 | 20 | 0.5 | 5 |
| | | $C_2H_2$ | 10 | | | | |
| | | $H_2$ | 150 | | | | |
| | 4th layer | $SiH_4$ | 60 | 250 | 10 | 0.4 | 0.5 |
| | | $C_2H_2$ | 60 | | | | |

TABLE 66-continued

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| | region | $H_2$ | 50 | | | | |

TABLE 67

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 50 | 250 | 5 | 0.4 | 0.03 |
| | | $H_2$ | 10→200* | | | | |
| | | $AlCl_3$/He | | | | | |
| | | (S-side: 0.01 μm) | 100→10** | | | | |
| | | (UL-side: 0.02 μm) | 10 | | | | |
| | | $PH_3$ (against $SiH_4$) | 120→180 ppm* | | | | |
| Upper layer | 1st layer region | $SiH_4$ | 100 | 250 | 10 | 0.5 | 2 |
| | | $PH_3$ (against $SiH_4$) | 1500 ppm | | | | |
| | | $C_2H_2$ | 13 | | | | |
| | | $H_2$ | 300 | | | | |
| | | NO | 1 | | | | |
| | 2nd layer region | $SiH_4$ | 100 | 250 | 25 | 0.5 | 22 |
| | | $C_2H_2$ | 15 | | | | |
| | | $H_2$ | 300 | | | | |
| | 3rd layer region | $SiH_4$ | 100 | 250 | 20 | 0.5 | 5 |
| | | $C_2H_2$ | 10 | | | | |
| | | $H_2$ | 150 | | | | |
| | 4th layer region | $SiH_4$ | 60 | 250 | 10 | 0.4 | 0.5 |
| | | $C_2H_2$ | 60 | | | | |
| | | $H_2$ | 50 | | | | |

TABLE 68

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 10→100* | 250 | 5 | 0.4 | 0.2 |
| | | $H_2$ | 5→200* | | | | |
| | | $AlCl_3$/He | | | | | |
| | | (S-side: 0.05 μm) | 200→40** | | | | |
| | | (UL-side: 0.15 μm) | 40→10** | | | | |
| | | $B_2H_6$ (against $SiH_4$) | 80 ppm | | | | |
| Upper layer | 1st layer region | $SiH_4$ | 100 | 300 | 10 | 0.35 | 3 |
| | | $H_2$ | 100 | | | | |
| | | $B_2H_6$ (against $SiH_4$) | 1000 ppm | | | | |
| | | $C_2H_2$ | 5 | | | | |
| | | $H_2S$ | 1 ppm | | | | |
| | 2nd layer region | $SiH_4$ | 100 | 300 | 3 | 0.5 | 3 |
| | | $SiF_4$ | 5 | | | | |
| | | $H_2$ | 200 | | | | |
| | | $H_2S$ | 1 ppm | | | | |
| | 3rd layer region | $SiH_4$ | 100 | 300 | 15 | 0.4 | 30 |
| | | $CH_4$ | 100 | | | | |
| | | $PH_3$ (against $SiH_4$) | 50 ppm | | | | |
| | | $H_2S$ | 1 ppm | | | | |
| | 4th layer region | $SiH_4$ | 50 | 300 | 10 | 0.4 | 0.5 |
| | | $CH_4$ | 600 | | | | |
| | | $H_2S$ | 1 ppm | | | | |

TABLE 69

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 50 | 250 | 5 | 0.4 | 0.05 |
| | | $H_2$ | 10→200* | | | | |
| | | $AlCl_3$/He | 120→40** | | | | |
| | | NO | 5 | | | | |
| Upper layer | 1st layer region | $SiH_4$ | 100 | 250 | 10 | 0.35 | 3 |
| | | $H_2$ | 100 | | | | |
| | | NO | 30 | | | | |
| | 2nd layer region | $SiH_4$ | 300 | 250 | 15 | 0.5 | 20 |
| | | $H_2$ | 300 | | | | |
| | 3rd layer | $SiH_4$ | 50 | 250 | 10 | 0.4 | 0.5 |
| | | $CH_4$ | 500 | | | | |

TABLE 69-continued

| Order of lamination (layer name) | Gases and their flow rates (SCCM) | Substrate temperature (°C.) | RF discharging power (mW/cm³) | Inner pressure (Torr) | Layer thickness (μm) |
|---|---|---|---|---|---|
| region | | | | | |

TABLE 70

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 50 | 250 | 5 | 0.4 | 0.05 |
| | | $AlCl_3$/He | 120→40** | | | | |
| Upper layer | 1st layer region | $SiH_4$ | 100 | 250 | 10 | 0.35 | 3 |
| | | $H_2$ | 100 | | | | |
| | | NO | 30 | | | | |
| | 2nd layer region | $SiH_4$ | 300 | 250 | 15 | 0.5 | 20 |
| | | $H_2$ | 300 | | | | |
| | 3rd layer region | $SiH_4$ | 50 | 250 | 10 | 0.4 | 0.5 |
| | | $CH_4$ | 500 | | | | |

TABLE 71

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 50 | 250 | 5 | 0.4 | 0.03 |
| | | $H_2$ | 10→200* | | | | |
| | | $AlCl_3$/He | | | | | |
| | | (S-side: 0.01 μm) | 100→10** | | | | |
| | | (UL-side: 0.01 μm) | 10 | | | | |
| | | NO | 5 | | | | |
| Upper layer | 1st layer region | $SiH_4$ | 100 | 250 | 10 | 0.35 | 3 |
| | | $H_2$ | 100 | | | | |
| | | $B_2H_6$ (against $SiH_4$) | 800 ppm | | | | |
| | | NO | 10 | | | | |
| | 2nd layer region | $SiH_4$ | 300 | 250 | 15 | 0.5 | 20 |
| | | $H_2$ | 300 | | | | |
| | 3rd layer region | $SiH_4$ | 50 | 250 | 10 | 0.4 | 0.5 |
| | | $CH_4$ | 500 | | | | |

TABLE 72

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 50 | 150 | 0.5 | 0.3 | 0.02 |
| | | $H_2$ | 5→200* | ↓ | ↓ | | |
| | | $AlCl_3$/He | | 300 | 1.5 | | |
| | | (S-side: 0.01 μm) | 200→30** | | | | |
| | | (UL-side: 0.01 μm) | 30→10** | | | | |
| | | NO | 5 | | | | |
| Upper layer | 1st layer region | $SiH_4$ | 100 | 270 | 10 | 0.35 | 3 |
| | | $H_2$ | 100 | | | | |
| | | $B_2H_6$ (against $SiH_4$) | 800 ppm | | | | |
| | | NO | 10 | | | | |
| | 2nd layer region | $SiH_4$ | 300 | 250 | 20 | 0.5 | 20 |
| | | $H_2$ | 500 | | | | |

TABLE 73

| Order of lamination (layer name) | Gases and their flow rates (SCCM) | | Substrate temperature (°C.) | RF discharging power (mW/cm³) | Inner pressure (Torr) | Layer thickness (μm) |
|---|---|---|---|---|---|---|
| Lower layer | $SiH_4$ | 50 | 250 | 1 | 0.3 | 0.02 |
| | $H_2$ | 5→200* | | | | |
| | $AlCl_3$/He | | | | | |
| | (S-side: 0.01 μm) | 200→30** | | | | |
| | (UL-side: 0.01 μm) | 30→10** | | | | |
| | NO | 10 | | | | |
| | $B_2H_6$ (against $SiH_4$) | 800 ppm | | | | |

TABLE 73-continued

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| | | $CH_4$ | 1 | | | | |
| Upper layer | 1st layer region | $SiH_4$ | 100 | 250 | 10 | 0.35 | 3 |
| | | He | 100 | | | | |
| | | $AlCl_3$/He | 0.3 | | | | |
| | | $SiF_4$ | 0.5 | | | | |
| | | $CH_4$ | 1 | | | | |
| | | NO | | | | | |
| | | (LL-side: 2 μm) | 10 | | | | |
| | | (U · 2nd LR-side: 1 μm) | 10→0** | | | | |
| | | $B_2H_6$ (against $SiH_4$) | 800 ppm | | | | |
| | 2nd layer region | $SiH_4$ | 300 | 250 | 25 | 0.6 | 25 |
| | | He | 600 | | | | |
| | | $AlCl_3$/He | 0.1 | | | | |
| | | $SiF_4$ | 0.2 | | | | |
| | | $CH_4$ | 0.5 | | | | |
| | | NO | 0.1 | | | | |
| | | $B_2H_6$ (against $SiH_4$) | 0.3 ppm | | | | |
| | 3rd layer region | $SiH_4$ | 50 | 250 | 10 | 0.4 | 1 |
| | | $CH_4$ | 500 | | | | |
| | | NO | 0.5 | | | | |
| | | $SiF_4$ | 0.7 | | | | |
| | | $AlCl_3$/He | 0.5 | | | | |
| | | $B_2H_6$ (against $SiH_4$) | 1 ppm | | | | |

TABLE 74

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 10→100* | 250 | 10 | 0.4 | 0.2 |
| | | $H_2$ | 5→200* | | | | |
| | | $Al(CH_3)_3$/He | | | | | |
| | | (S-side: 0.05 μm) | 200→40** | | | | |
| | | (UL-side: 0.15 μm) | 40→10** | | | | |
| | | $NH_3$ | 1→4* | | | | |
| Upper layer | 1st layer region | $SiH_4$ | 100 | 250 | 10 | 0.35 | 3 |
| | | $H_2$ | 100 | | | | |
| | | $PH_3$ (against $SiH_4$) | 800 ppm | | | | |
| | | $NH_3$ | 4 | | | | |
| | 2nd layer region | $SiH_4$ | 400 | 250 | 10 | 0.5 | 15 |
| | | Ar | 200 | | | | |
| | 3rd layer region | $SiH_4$ | 100 | 250 | 5 | 0.4 | 0.3 |
| | | $NH_3$ | 30 | | | | |

TABLE 75

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 10→100* | 300 | 10 | 0.4 | 0.2 |
| | | $H_2$ | 5→200* | | | | |
| | | $AlCl_3$/He | | | | | |
| | | (S-side: 0.05 μm) | 200→40** | | | | |
| | | (UL-side: 0.15 μm) | 40→10** | | | | |
| | | $C_2H_2$ | 1→5* | | | | |
| | | $B_2H_6$ (against $SiH_4$) | 100 ppm | | | | |
| Upper layer | 1st layer region | $SiH_4$ | 100 | 300 | 10 | 0.35 | 3 |
| | | $H_2$ | 100 | | | | |
| | | $B_2H_6$ | 1000 ppm | | | | |
| | | $C_2H_2$ | 5 | | | | |
| | 2nd layer region | $SiH_4$ | 300 | 300 | 20 | 0.5 | 20 |
| | | $H_2$ | 500 | | | | |
| | 3rd layer region | $SiH_4$ | 100 | 300 | 15 | 0.4 | 7 |
| | | $CH_4$ | 600 | | | | |
| | | $PH_3$ (against $SiH_4$) | 3000 ppm | | | | |
| | 4th layer region | $SiH_4$ | 40 | 300 | 10 | 0.4 | 0.1 |
| | | $CH_4$ | 600 | | | | |

TABLE 76

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 50 | 330 | 5 | 0.4 | 0.05 |
| | | $H_2$ | 5→200* | | | | |
| | | $AlCl_3$/He | 200→20** | | | | |
| | | NO | 5 | | | | |
| | | $PH_3$ (against $SiH_4$) | 100 ppm | | | | |
| Upper layer | 1st layer region | $SiH_4$ | 100 | 330 | 10 | 0.35 | 3 |
| | | $H_2$ | 100 | | | | |
| | | $PH_3$ (against $SiH_4$) | 800 ppm | | | | |
| | | NO | 10 | | | | |
| | 2nd layer region | $SiH_4$ | 400 | 330 | 25 | 0.5 | 25 |
| | | $SiF_4$ | 10 | | | | |
| | | $H_2$ | 800 | | | | |
| | 3rd layer region | $SiH_4$ | 100 | 350 | 15 | 0.4 | 5 |
| | | $CH_4$ | 400 | | | | |
| | | $B_2H_6$ (against $SiH_4$) | 5000 ppm | | | | |
| | 4th layer region | $SiH_4$ | 20 | 350 | 10 | 0.4 | 1 |
| | | $CH_4$ | 400 | | | | |
| | | $B_2H_6$ (against $SiH_4$) | 8000 ppm | | | | |

TABLE 77

| Order of lamination (layer name) | | Gases and their flow rates (SCCM) | | Substrate temperature (°C.) | RF discharging power (mW/cm²) | Inner pressure (Torr) | Layer thickness (μm) |
|---|---|---|---|---|---|---|---|
| Lower layer | | $SiH_4$ | 50 | 300 | 1 | 0.3 | 0.02 |
| | | $H_2$ | 5 → 200* | | | | |
| | | $AlCl_3$/He | | | | | |
| | | (S-side: 0.01 μm) | 200 → 30** | | | | |
| | | (UL-side: 0.01 μm) | 30 → 10** | | | | |
| | | $B_2H_6$ (against $SiH_4$) | 100 ppm | | | | |
| | | $N_2$ | 100 → 150* | | | | |
| | | $H_2S$ | 10 ppm | | | | |
| Upper layer | 1st layer region | $SiH_4$ | 100 | 300 | 10 | 0.35 | 3 |
| | | $H_2$ | 150 | | | | |
| | | $B_2H_6$ (against $SiH_4$) | 900 → 600 ppm** | | | | |
| | | $H_2$ | 150 | | | | |
| | 2nd layer region | $SiH_4$ | 300 | 300 | 20 | 0.5 | 20 |
| | | $H_2$ | 200 | | | | |
| | 3rd layer region | $SiH_4$ | 50 | 300 | 20 | 0.4 | 5 |
| | | $N_2$ | 500 | | | | |
| | | $PH_3$ (against $SiH_4$) | 3000 ppm | | | | |
| | 4th layer region | $SiH_4$ | 40 | 300 | 10 | 0.4 | 0.3 |
| | | $CH_4$ | 600 | | | | |

TABLE 78

| Order of lamination (layer name) | | Gases and their flow rates (SCCM) | | Substrate temperature (°C.) | RF discharging power (mW/cm²) | Inner pressure (Torr) | Layer thickness (μm) |
|---|---|---|---|---|---|---|---|
| Lower layer | | $SiH_4$ | 50 | 250 | 5 | 0.4 | 0.05 |
| | | $H_2$ | 5 → 200* | | | | |
| | | $AlCl_3$/He | 200 → 20** | | | | |
| | | $C_2H_2$ | 5 | | | | |
| | | $B_2H_6$ (against $SiH_4$) | 100 ppm | | | | |
| Upper layer | 1st layer region | $SiH_4$ | 100 | 250 | 10 | 0.35 | 3 |
| | | $H_2$ | 100 | | | | |
| | | $B_2H_6$ (against $SiH_4$) | 1000 ppm | | | | |
| | | $C_2H_2$ | 5 | | | | |
| | 2nd layer region | $SiH_4$ | 300 | 250 | 15 | 0.5 | 10 |
| | | $H_2$ | 300 | | | | |
| | 3rd layer region | $SiH_4$ | 200 | 250 | 15 | 0.4 | 20 |
| | | $C_2H_2$ | 10 → 20* | | | | |
| | | NO | 1 | | | | |

TABLE 79

| Order of lamination (layer name) | Gases and their flow rates (SCCM) | | Substrate temperature (°C.) | RF discharging power (mW/cm²) | Inner pressure (Torr) | Layer thickness (μm) |
|---|---|---|---|---|---|---|
| Lower layer | $SiH_4$ | 50 | 250 | 1 | 0.4 | 0.02 |
| | $H_2$ | 5 → 200* | | | | |

TABLE 79-continued

| Order of lamination (layer name) | | Gases and their flow rates (SCCM) | | Substrate temperature (°C.) | RF discharging power (mW/cm²) | Inner pressure (Torr) | Layer thickness (μm) |
|---|---|---|---|---|---|---|---|
| | | $AlCl_3$/He | | | | | |
| | | (S-side: 0.01 μm) | 200 → 30** | | | | |
| | | (UL-side: 0.01 μm) | 30 → 10** | | | | |
| | | $N_2$ | 100 | | | | |
| | | $H_2S$ (against $SiH_4$) | 10 ppm | | | | |
| Upper layer | 1st layer region | $SiH_4$ | 100 | 300 | 10 | 0.35 | 3 |
| | | $H_2$ | 150 | | | | |
| | | $B_2H_6$ (against $SiH_4$) | 900 → 600 ppm** | | | | |
| | | $H_2$ | 150 | | | | |
| | 2nd layer region | $SiH_4$ | 300 | 300 | 20 | 0.5 | 5 |
| | | $H_2$ | 300 | | | | |
| | 3rd layer region | $SiH_4$ | 100 | 300 | 15 | 0.4 | 20 |
| | | $CH_4$ | 100 | | | | |
| | 4th layer region | $SiH_4$ | 50 | 300 | 10 | 0.4 | 0.5 |
| | | $CH_4$ | 600 | | | | |

TABLE 80

| Order of lamination (layer name) | | Gases and their flow rates (SCCM) | | Substrate temperature (°C.) | RF discharging power (mW/cm²) | Inner pressure (Torr) | Layer thickness (μm) |
|---|---|---|---|---|---|---|---|
| Lower layer | | $SiH_4$ | 10 → 100* | 300 | 5 | 0.4 | 0.2 |
| | | $H_2$ | 5 → 200* | | | | |
| | | $AlCl_3$/He | | | | | |
| | | (S-side: 0.05 μm) | 200 → 40** | | | | |
| | | (UL-side: 0.15 μm) | 40 → 10** | | | | |
| | | $NH_3$ | 1 → 5* | | | | |
| Upper layer | 1st layer region | $SiH_4$ | 100 | 300 | 10 | 0.35 | 3 |
| | | $H_2$ | 100 | | | | |
| | | $PH_3$ (against $SiH_4$) | 800 ppm | | | | |
| | | $NH_3$ | 5 | | | | |
| | 2nd layer region | $SiH_4$ | 100 | 300 | 5 | 0.2 | 8 |
| | | $H_2$ | 300 | | | | |
| | 3rd layer region | $SiH_4$ | 300 | 300 | 15 | 0.4 | 25 |
| | | $NH_3$ | 50 | | | | |
| | 4th layer region | $SiH_4$ | 100 | 300 | 10 | 0.4 | 0.3 |
| | | $NH_3$ | 50 | | | | |

TABLE 81

| Order of lamination (layer name) | | Gases and their flow rates (SCCM) | | Substrate temperature (°C.) | RF discharging power (mW/cm²) | Inner pressure (Torr) | Layer thickness (μm) |
|---|---|---|---|---|---|---|---|
| Lower layer | | $SiH_4$ | 10 → 100* | 250 | 5 | 0.4 | 0.2 |
| | | $H_2$ | 5 → 200* | | | | |
| | | $AlCl_3$/He | | | | | |
| | | (S-side: 0.05 μm) | 200 → 40** | | | | |
| | | (UL-side: 0.15 μm) | 40 → 10** | | | | |
| | | NO | 5 → 10* | | | | |
| | | $B_2H_6$ (against $SiH_4$) | 10 → 100 ppm* | | | | |
| Upper layer | 1st layer region | $SiH_4$ | 100 | 280 | 10 | 0.35 | 3 |
| | | $H_2$ | 100 | | | | |
| | | $B_2H_6$ (against $SiH_4$) | 800 ppm | | | | |
| | | NO | 10 | | | | |
| | 2nd layer region | $SiH_4$ | 100 | 300 | 3 | 0.5 | 3 |
| | | $SiF_4$ | 5 | | | | |
| | | $H_2$ | 200 | | | | |
| | 3rd layer region | $SiH_4$ | 100 | 300 | 15 | 0.4 | 30 |
| | | $CH_4$ | 100 | | | | |
| | | $PH_3$ (against $SiH_4$) | 50 ppm | | | | |
| | 4th layer region | $SiH_4$ | 50 | 300 | 10 | 0.4 | 0.5 |
| | | $CH_4$ | 600 | | | | |

TABLE 82

| Order of lamination (layer name) | | Gases and their flow rates (SCCM) | | Substrate temperature (°C.) | RF discharging power (mW/cm²) | Inner pressure (Torr) | Layer thickness (μm) |
|---|---|---|---|---|---|---|---|
| Lower layer | | $SiH_4$ | 50 | 250 | 5 | 0.4 | 0.05 |
| | | $H_2$ | 5 → 200* | | | | |
| | | $AlCl_3$/He | 200 → 20** | | | | |
| | | NO | 10 | | | | |
| | | $PH_3$ (against $SiH_4$) | 100 ppm | | | | |
| Upper layer | 1st layer region | $SiH_4$ | 100 | 300 | 10 | 0.35 | 3 |
| | | $H_2$ | 100 | | | | |
| | | $PH_3$ (against $SiH_4$) | 800 ppm | | | | |
| | | NO | | | | | |
| | | (LL-side: 2 μm) | 10 | | | | |
| | | (U · 2nd LR side: 1 μm) | 10 → 0** | | | | |
| | 2nd layer region | $Si_2H_6$ | 200 | 300 | 10 | 0.5 | 10 |
| | | $H_2$ | 200 | | | | |
| | 3rd layer region | $SiH_4$ | 300 | 330 | 20 | 0.4 | 30 |
| | | $C_2H_2$ | 50 | | | | |
| | | $B_2H_6$ (against $SiH_4$) | 100 ppm | | | | |
| | 4th layer region | $SiH_4$ | 200 | 330 | 10 | 0.4 | 1 |
| | | $C_2H_2$ | 200 | | | | |

TABLE 83

| Order of lamination (layer name) | | Gases and their flow rates (SCCM) | | Substrate temperature (°C.) | RF discharging power (mW/cm²) | Inner pressure (Torr) | Layer thickness (μm) |
|---|---|---|---|---|---|---|---|
| Lower layer | | $SiH_4$ | 10 → 100* | 250 | 5 | 0.4 | 0.2 |
| | | $H_2$ | 5 → 200* | | | | |
| | | $AlCl_3$/He | | | | | |
| | | (S-side: 0.05 μm) | 200 → 40** | | | | |
| | | (UL-side: 0.15 μm) | 40 → 10** | | | | |
| | | $NH_3$ | 1 → 5* | | | | |
| | | $B_2H_6$ (against $SiH_4$) | 150 ppm | | | | |
| Upper layer | 1st layer region | $SiH_4$ | 100 | 270 | 10 | 0.35 | 3 |
| | | $H_2$ | 100 | | | | |
| | | $B_2H_6$ (against $SiH_4$) | 800 ppm | | | | |
| | | $NH_3$ | 5 | | | | |
| | 2nd layer region | $SiH_4$ | 100 | 300 | 5 | 0.2 | 8 |
| | | $H_2$ | 300 | | | | |
| | 3rd layer region | $SiH_4$ | 300 | 300 | 15 | 0.4 | 25 |
| | | $NH_3$ | 30 → 50* | | | | |
| | | $PH_3$ (against $SiH_4$) | 50 ppm | | | | |
| | 4th layer region | $SiH_4$ | 100 | 300 | 5 | 0.4 | 0.7 |
| | | $NH_3$ | 80 → 100* | | | | |
| | | $PH_3$ (against $SiH_4$) | 500 ppm | | | | |

TABLE 84

| Order of lamination (layer name) | | Gases and their flow rates (SCCM) | | Substrate temperature (°C.) | RF discharging power (mW/cm²) | Inner pressure (Torr) | Layer thickness (μm) |
|---|---|---|---|---|---|---|---|
| Lower layer | | $SiH_4$ | 50 | 250 | 1 | 0.4 | 0.02 |
| | | $H_2$ | 5 → 200* | | | | |
| | | $AlCl_3$/He | | | | | |
| | | (S-side: 0.01 μm) | 200 → 30** | | | | |
| | | (UL-side: 0.01 μm) | 30 → 10** | | | | |
| | | NO | 5 | | | | |
| Upper layer | 1st layer region | $SiH_4$ | 100 | 250 | 10 | 0.35 | 3 |
| | | $H_2$ | 100 | | | | |
| | | $B_2H_6$ (against $SiH_4$) | 800 ppm | | | | |
| | | NO | | | | | |
| | | (LL-side: 2 μm) | 10 | | | | |
| | | (U · 2nd LR-side: 1 μm) | 10 → 0** | | | | |
| | 2nd layer region | $SiH_4$ | 300 | 300 | 20 | 0.5 | 20 |
| | | $H_2$ | 500 | | | | |
| | 3rd layer region | $SiH_4$ | 100 | 300 | 5 | 0.4 | 1 |
| | | $GeH_4$ | 10 → 50* | | | | |
| | | $H_2$ | 300 | | | | |
| | 4th layer region | $SiH_4$ | 100 → 40** | 300 | 10 | 0.4 | 1 |
| | | $CH_4$ | 100 → 600* | | | | |

TABLE 85

| Order of lamination (layer name) | | Gases and their flow rates (SCCM) | | Substrate temperature (°C.) | RF discharging power (mW/cm²) | Inner pressure (Torr) | Layer thickness (μm) |
|---|---|---|---|---|---|---|---|
| Lower layer | | $SiH_4$ | 50 | 300 | 1 | 0.3 | 0.02 |
| | | $H_2$ | 5 → 200* | | | | |
| | | $AlCl_3$/He | | | | | |
| | | (S-side: 0.01 μm) | 200 → 30** | | | | |
| | | (UL-side: 0.01 μm) | 30 → 10** | | | | |
| | | NO | 9 | | | | |
| | | $B_2H_6$ (against $SiH_4$) | 80 ppm | | | | |
| Upper layer | 1st layer region | $SiH_4$ | 85 | 300 | 9 | 0.35 | 3 |
| | | $H_2$ | 90 | | | | |
| | | $B_2H_6$ (against $SiH_4$) | 800 ppm | | | | |
| | | NO | 9 | | | | |
| | 2nd layer region | $SiH_4$ | 300 | 300 | 15 | 0.5 | 20 |
| | | $H_2$ | 400 | | | | |
| | 3rd layer region | $SiH_4$ | 50 | 300 | 10 | 0.4 | 0.5 |
| | | $CH_4$ | 500 | | | | |

TABLE 86

| Order of lamination (layer name) | | Gases and their flow rates (SCCM) | | Substrate temperature (°C.) | RF discharging power (mW/cm²) | Inner pressure (Torr) | Layer thickness (μm) |
|---|---|---|---|---|---|---|---|
| Lower layer | | $SiH_4$ | 50 | 300 | 0.7 | 0.3 | 0.02 |
| | | $H_2$ | 5 → 200* | | | | |
| | | $AlCl_3$/He | | | | | |
| | | (S-side: 0.01 μm) | 200 → 30** | | | | |
| | | (UL-side: 0.01 μm) | 30 → 10** | | | | |
| | | NO | 8 | | | | |
| | | $B_2H_6$ (against $SiH_4$) | 80 ppm | | | | |
| Upper layer | 1st layer region | $SiH_4$ | 70 | 300 | 8 | 0.35 | 3 |
| | | $H_2$ | 80 | | | | |
| | | $B_2H_6$ (against $SiH_4$) | 800 ppm | | | | |
| | | NO | 8 | | | | |
| | 2nd layer region | $SiH_4$ | 200 | 300 | 12 | 0.4 | 20 |
| | | $H_2$ | 400 | | | | |
| | 3rd layer region | $SiH_4$ | 40 | 300 | 7 | 0.3 | 0.5 |
| | | $CH_4$ | 400 | | | | |

TABLE 87

| Order of lamination (layer name) | | Gases and their flow rates (SCCM) | | Substrate temperature (°C.) | RF discharging power (mW/cm²) | Inner pressure (Torr) | Layer thickness (μm) |
|---|---|---|---|---|---|---|---|
| Lower layer | | $SiH_4$ | 25 | 300 | 0.5 | 0.2 | 0.02 |
| | | $H_2$ | 5 → 100* | | | | |
| | | $AlCl_3$/He | | | | | |
| | | (S-side: 0.01 μm) | 100 → 15** | | | | |
| | | (UL-side: 0.01 μm) | 15 → 5** | | | | |
| | | NO | 7 | | | | |
| | | $B_2H_6$ (against $SiH_4$) | 80 ppm | | | | |
| Upper layer | 1st layer region | $SiH_4$ | 55 | 300 | 7 | 0.35 | 3 |
| | | $H_2$ | 70 | | | | |
| | | $B_2H_6$ (against $SiH_4$) | 800 ppm | | | | |
| | | NO | 7 | | | | |
| | 2nd layer region | $SiH_4$ | 150 | 300 | 10 | 0.4 | 20 |
| | | $H_2$ | 300 | | | | |
| | 3rd layer region | $SiH_4$ | 30 | 300 | 5 | 0.3 | 0.5 |
| | | $CH_4$ | 300 | | | | |

TABLE 88

| Order of lamination (layer name) | Gases and their flow rates (SCCM) | | Substrate temperature (°C.) | RF discharging power (mW/cm²) | Inner pressure (Torr) | Layer thickness (μm) |
|---|---|---|---|---|---|---|
| Lower layer | $SiH_4$ | 50 | 300 | 0.3 | 0.2 | 0.02 |
| | $H_2$ | 5 → 100* | | | | |
| | $AlCl_3$/He | | | | | |
| | (S-side: 0.01 μm) | 85 → 15** | | | | |

TABLE 88-continued

| Order of lamination (layer name) | | Gases and their flow rates (SCCM) | | Substrate temperature (°C.) | RF discharging power (mW/cm²) | Inner pressure (Torr) | Layer thickness (μm) |
|---|---|---|---|---|---|---|---|
| | | (UL-side: 0.01 μm) | 15 → 5** | | | | |
| | | NO | 5 | | | | |
| | | $B_2H_6$ (against $SiH_4$) | 80 ppm | | | | |
| Upper layer | 1st layer region | $SiH_4$ | 45 | 300 | 6 | 0.35 | 3 |
| | | $H_2$ | 60 | | | | |
| | | $B_2H_6$ (against $SiH_4$) | 800 ppm | | | | |
| | | NO | 5 | | | | |
| | 2nd layer region | $SiH_4$ | 100 | 300 | 6 | 0.3 | 20 |
| | | $H_2$ | 300 | | | | |
| | 3rd layer region | $SiH_4$ | 20 | 300 | 3 | 0.2 | 0.5 |
| | | $CH_4$ | 200 | | | | |

TABLE 89

| Order of lamination (layer name) | | Gases and their flow rates (SCCM) | | Substrate temperature (°C.) | RF discharging power (mW/cm²) | Inner pressure (Torr) | Layer thickness (μm) |
|---|---|---|---|---|---|---|---|
| Lower layer | | $SiH_4$ | 50 | 500 | 5 | 0.4 | 0.05 |
| | | $H_2$ | 5 → 200* | | | | |
| | | $AlCl_3$/He | 200 → 20** | | | | |
| | | $C_2H_2$ | 5 | | | | |
| | | $B_2H_6$ (against $SiH_4$) | 60 ppm | | | | |
| Upper layer | 1st layer region | $SiH_4$ | 180 | 500 | 22 | 0.4 | 4 |
| | | $H_2$ | 1200 | | | | |
| | | $B_2H_6$ (against $SiH_4$) | 700 ppm | | | | |
| | | $C_2H_2$ | 8 | | | | |
| | 2nd layer region | $SiH_4$ | 300 | 500 | 30 | 0.5 | 10 |
| | | $H_2$ | 1500 | | | | |
| | 3rd layer region | $SiH_4$ | 200 | 500 | 30 | 0.4 | 20 |
| | | $C_2H_2$ | 10 → 20* | | | | |
| | | NO | 1 | | | | |

TABLE 90

| Order of lamination (layer name) | | Gases and their flow rates (SCCM) | | Substrate temperature (°C.) | μW discharging power (mW/cm²) | Inner pressure (Torr) | Layer thickness (μm) |
|---|---|---|---|---|---|---|---|
| Lower layer | | $SiH_4$ | 150 | 250 | 0.5 | 0.6 | 0.02 |
| | | $H_2$ | 20 → 500* | | | | |
| | | $AlCl_3$/He | | | | | |
| | | (S-side: 0.01 μm) | 400 → 80** | | | | |
| | | (UL-side: 0.01 μm) | 80 → 50** | | | | |
| | | NO | 10 | | | | |
| | | $B_2H_6$ (against $SiH_4$) | 60 ppm | | | | |
| Upper layer | 1st layer region | $SiH_4$ | 350 | 250 | 0.5 | 0.5 | 3 |
| | | $H_2$ | 350 | | | | |
| | | $B_2H_6$ (against $SiH_4$) | 600 ppm | | | | |
| | | NO | 13 | | | | |
| | | $SiF_4$ | 20 | | | | |
| | 2nd layer region | $SiH_4$ | 700 | 250 | 0.5 | 0.5 | 20 |
| | | $SiF_4$ | 30 | | | | |
| | | $H_2$ | 500 | | | | |
| | 3rd layer region | $SiH_4$ | 150 | 250 | 0.5 | 0.3 | 1 |
| | | $CH_4$ | 500 | | | | |

TABLE 91

| Order of lamination (layer name) | | Gases and their flow rates (SCCM) | | Substrate temperature (°C.) | RF discharging power (mW/cm²) | Inner pressure (Torr) | Layer thickness (μm) |
|---|---|---|---|---|---|---|---|
| Lower layer | | $SiH_4$ | 50 | 250 | 5 | 0.4 | 0.05 |
| | | $H_2$ | 5 → 200* | | | | |
| | | $AlCl_3$/He | 200 → 20** | | | | |
| | | $C_2H_2$ | 5 | | | | |
| | | $B_2H_6$ (against $SiH_4$) | 100 ppm | | | | |
| Upper layer | 1st layer region | $SiH_4$ | 100 | 250 | 10 | 0.35 | 3 |
| | | $H_2$ | 100 | | | | |
| | | $B_2H_6$ (against $SiH_4$) | 1000 ppm | | | | |
| | | $C_2H_2$ | 5 | | | | |
| | 2nd | $SiH_4$ | 200 | 250 | 15 | 0.4 | 20 |

TABLE 91-continued

| Order of lamination (layer name) | | Gases and their flow rates (SCCM) | | Substrate temperature (°C.) | RF discharging power (mW/cm²) | Inner pressure (Torr) | Layer thickness (μm) |
|---|---|---|---|---|---|---|---|
| | layer region | $C_2H_2$ | 10 → 20* | | | | |
| | | NO | 1 | | | | |
| | 3rd layer region | $SiH_4$ | 300 | 250 | 15 | 0.5 | 10 |
| | | $H_2$ | 300 | | | | |

TABLE 92

| Order of lamination (layer name) | | Gases and their flow rates (SCCM) | | Substrate temperature (°C.) | RF discharging power (mW/cm²) | Inner pressure (Torr) | Layer thickness (μm) |
|---|---|---|---|---|---|---|---|
| Lower layer | | $SiH_4$ | 50 | 250 | 1 | 0.4 | 0.02 |
| | | $H_2$ | 5 → 200* | | | | |
| | | $AlCl_3$/He | | | | | |
| | | (S-side: 0.01 μm) | 200 → 30** | | | | |
| | | (UL-side: 0.01 μm) | 30 → 10** | | | | |
| | | $N_2$ | 100 | | | | |
| | | $B_2H_6$ (against $SiH_4$) | 10 ppm | | | | |
| Upper layer | 1st layer region | $SiH_4$ | 100 | 300 | 10 | 0.35 | 3 |
| | | $H_2$ | 150 | | | | |
| | | $B_2H_6$ (against $SiH_4$) | 900 → 600 ppm** | | | | |
| | | $N_2$ | 150 | | | | |
| | 2nd layer region | $SiH_4$ | 100 | 300 | 15 | 0.4 | 20 |
| | | $CH_4$ | 100 | | | | |
| | 3rd layer region | $SiH_4$ | 300 | 300 | 20 | 0.5 | 5 |
| | | $H_2$ | 300 | | | | |
| | 4th layer region | $SiH_4$ | 50 | 300 | 10 | 0.4 | 0.5 |
| | | $CH_4$ | 600 | | | | |

TABLE 93

| Order of lamination (layer name) | | Gases and their flow rates (SCCM) | | Substrate temperature (°C.) | RF discharging power (mW/cm²) | Inner pressure (Torr) | Layer thickness (μm) |
|---|---|---|---|---|---|---|---|
| Lower layer | | $SiH_4$ | 10 → 100* | 300 | 5 | 0.4 | 0.2 |
| | | $H_2$ | 5 → 200* | | | | |
| | | $AlCl_3$/He | | | | | |
| | | (S-side: 0.05 μm) | 200 → 40** | | | | |
| | | (UL-side: 0.15 μm) | 40 → 10** | | | | |
| | | $NH_3$ | 1 → 5* | | | | |
| Upper layer | 1st layer region | $SiH_4$ | 100 | 300 | 10 | 0.35 | 3 |
| | | $H_2$ | 100 | | | | |
| | | $B_2H_6$ (against $SiH_4$) | 800 ppm | | | | |
| | | $NH_3$ | 5 | | | | |
| | 2nd layer region | $SiH_4$ | 300 | 300 | 15 | 0.4 | 25 |
| | | $NH_3$ | 50 | | | | |
| | 3rd layer region | $SiH_4$ | 100 | 300 | 5 | 0.2 | 8 |
| | | $H_2$ | 300 | | | | |
| | 4th layer region | $SiH_4$ | 100 | 300 | 10 | 0.4 | 0.3 |
| | | $NH_3$ | 50 | | | | |

TABLE 94

| Order of lamination (layer name) | | Gases and their flow rates (SCCM) | | Substrate temperature (°C.) | RF discharging power (mW/cm²) | Inner pressure (Torr) | Layer thickness (μm) |
|---|---|---|---|---|---|---|---|
| Lower layer | | $SiH_4$ | 10 → 100* | 250 | 5 | 0.4 | 0.2 |
| | | $H_2$ | 5 → 200* | | | | |
| | | $AlCl_3$/He | | | | | |
| | | (S-side: 0.05 μm) | 200 → 40** | | | | |
| | | (UL-side: 0.15 μm) | 40 → 10** | | | | |
| | | $PH_3$ (against $SiH_4$) | 10 → 100 ppm* | | | | |
| Upper layer | 1st layer region | $SiH_4$ | 100 | 250 | 10 | 0.35 | 3 |
| | | $H_2$ | 100 | | | | |
| | | $PH_3$ (against $SiH_4$) | 800 ppm | | | | |
| | | NO | 10 | | | | |
| | 2nd layer | $SiH_4$ | 100 | 300 | 15 | 0.4 | 30 |
| | | $CH_4$ | 100 | | | | |

TABLE 94-continued

| Order of lamination (layer name) | | Gases and their flow rates (SCCM) | | Substrate temperature (°C.) | RF discharging power (mW/cm²) | Inner pressure (Torr) | Layer thickness (μm) |
|---|---|---|---|---|---|---|---|
| | region | $PH_3$ (against $SiH_4$) | 50 ppm | | | | |
| | 3rd | $SiH_4$ | 100 | 300 | 3 | 0.5 | 3 |
| | layer | $SiF_4$ | 5 | | | | |
| | region | $H_2$ | 200 | | | | |
| | 4th | $SiH_4$ | 50 | 300 | 10 | 0.4 | 0.5 |
| | layer | $CH_4$ | 600 | | | | |
| | region | | | | | | |

TABLE 95

| Order of lamination (layer name) | | Gases and their flow rates (SCCM) | | Substrate temperature (°C.) | RF discharging power (mW/cm²) | Inner pressure (Torr) | Layer thickness (μm) |
|---|---|---|---|---|---|---|---|
| Lower layer | | $SiH_4$ | 50 | 250 | 5 | 0.4 | 0.05 |
| | | $H_2$ | 5 → 200* | | | | |
| | | $AlCl_3$/He | 200 → 20** | | | | |
| | | NO | 10 | | | | |
| | | $B_2H_6$ (against $SiH_4$) | 100 ppm | | | | |
| Upper layer | 1st layer region | $SiH_4$ | 100 | 300 | 10 | 0.35 | 3 |
| | | $H_2$ | 100 | | | | |
| | | $B_2H_6$ (against $SiH_4$) | 800 ppm | | | | |
| | | NO | | | | | |
| | | (LL-side: 2 82 m) | 10 | | | | |
| | | (U · 2nd LR-side: 1 μm) | 10 → 0** | | | | |
| | 2nd layer region | $SiH_4$ | 100 | 330 | 20 | 0.4 | 30 |
| | | $C_2H_2$ | 50 | | | | |
| | | $B_2H_6$ (against $SiH_4$) | 100 ppm | | | | |
| | 3rd layer region | $Si_2H_6$ | 200 | 300 | 10 | 0.5 | 10 |
| | | $H_2$ | 200 | | | | |
| | 4th layer region | $SiH_4$ | 200 | 330 | 10 | 0.4 | 1 |
| | | $C_2H_2$ | 200 | | | | |

TABLE 96

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 10 → 100* | 250 | 5 | 0.4 | 0.2 |
| | | $H_2$ | 5 → 200* | | | | |
| | | $AlCl_3$/He | | | | | |
| | | (S-side: 0.05 μm) | 200 → 40** | | | | |
| | | (UL-side: 0.15 μm) | 40 → 10** | | | | |
| | | $NH_3$ | 1 → 5* | | | | |
| Upper layer | 1st layer region | $SiH_4$ | 100 | 300 | 10 | 0.35 | 3 |
| | | $H_2$ | 100 | | | | |
| | | $B_2H_6$ (against $SiH_4$) | 800 ppm | | | | |
| | | $NH_3$ | 5 | | | | |
| | 2nd layer region | $SiH_4$ | 300 | 300 | 15 | 0.4 | 25 |
| | | $NH_3$ | 30 → 50* | | | | |
| | | $B_2H_6$ (against $SiH_4$) | 50 ppm | | | | |
| | 3rd layer region | $SiH_4$ | 100 | 300 | 5 | 0.2 | 8 |
| | | $H_2$ | 300 | | | | |
| | 4th layer region | $SiH_4$ | 100 | 300 | 5 | 0.4 | 0.7 |
| | | $NH_3$ | 80 → 100* | | | | |
| | | $PH_3$ (against $SiH_4$) | 500 ppm | | | | |

TABLE 97

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 50 | 250 | 1 | 0.3 | 0.02 |
| | | $H_2$ | 5 → 200* | | | | |
| | | $AlCl_3$/He | | | | | |
| | | (S-side: 0.05 μm) | 200 → 30** | | | | |
| | | (UL-side: 0.15 μm) | 30 → 10** | | | | |
| | | NO | 10 | | | | |
| | | $B_2H_6$ (against $SiH_4$) | 800 ppm | | | | |
| Upper layer | 1st layer | $SiH_4$ | 100 | 250 | 10 | 0.35 | 3 |
| | | He | 100 | | | | |

TABLE 97-continued

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| | region | NO | | | | | |
| | | (LL-side: 2 μm) | 10 | | | | |
| | | (U · 2nd LR-side: 1 μm) | 10 → 0** | | | | |
| | | $B_2H_6$ (against $SiH_4$) | 800 ppm | | | | |
| | 2nd | $SiH_4$ | 300 | 250 | 25 | 0.6 | 25 |
| | layer | He | 600 | | | | |
| | region | $B_2H_6$ (against $SiH_4$) | 0.3 ppm | | | | |
| | 3rd | $SiH_4$ | 50 | 250 | 10 | 0.4 | 1 |
| | layer | $CH_4$ | 500 | | | | |
| | region | | | | | | |

TABLE 98

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 10 → 100* | 300 | 10 | 0.4 | 0.2 |
| | | $H_2$ | 5 → 200* | | | | |
| | | $AlCl_3$/He | | | | | |
| | | (S-side: 0.05 μm) | 200 → 40** | | | | |
| | | (UL-side: 0.15 μm) | 40 → 10** | | | | |
| | | $C_2H_2$ | 1 → 5* | | | | |
| | | $B_2H_6$ (against $SiH_4$) | 100 ppm | | | | |
| Upper layer | 1st layer region | $SiH_4$ | 100 | 300 | 10 | 0.35 | 3 |
| | | $H_2$ | 100 | | | | |
| | | $B_2H_6$ (against $SiH_4$) | 1000 ppm | | | | |
| | | $C_2H_2$ | 5 | | | | |
| | | $AlCl_3$/He | 0.1 | | | | |
| | | NO | 0.1 | | | | |
| | | $SiF_4$ | 0.5 | | | | |
| | 2nd layer region | $SiH_4$ | 300 | 300 | 20 | 0.5 | 20 |
| | | $H_2$ | 500 | | | | |
| | | $C_2H_2$ | 0.1 | | | | |
| | | $AlCl_3$/He | 0.1 | | | | |
| | | NO | 0.1 | | | | |
| | | $SiF_4$ | 0.5 | | | | |
| | | $B_2H_6$ | 0.3 ppm | | | | |
| | 3rd layer region | $SiH_4$ | 100 | 300 | 15 | 0.4 | 7 |
| | | $CH_4$ | 600 | | | | |
| | | $PH_3$ (against $SiH_4$) | 3000 ppm | | | | |
| | | $AlCl_3$/He | 0.1 | | | | |
| | | NO | 0.1 | | | | |
| | | $SiF_4$ | 0.5 | | | | |
| | | $B_2H_6$ | 0.3 ppm | | | | |
| | 4th layer region | $SiH_4$ | 40 | 300 | 10 | 0.4 | 0.1 |
| | | $CH_4$ | 600 | | | | |
| | | $AlCl_3$/He | 0.1 | | | | |
| | | NO | 0.1 | | | | |
| | | $SiF_4$ | 0.5 | | | | |
| | | $B_2H_6$ | 0.3 ppm | | | | |
| | | $PH_3$ | 0.3 ppm | | | | |

TABLE 99

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 10 → 100* | 250 | 5 | 0.4 | 0.2 |
| | | $H_2$ | 5 → 200* | | | | |
| | | $AlCl_3$/He | | | | | |
| | | (S-side: 0.05 μm) | 200 → 40** | | | | |
| | | (UL-side: 0.15 μm) | 40 → 10** | | | | |
| | | NO | 5 → 10 ppm* | | | | |
| | | $B_2H_6$ (against $SiH_4$) | 10 → 100 ppm* | | | | |
| Upper layer | 1st layer region | $SiH_4$ | 100 | 280 | 10 | 0.35 | 3 |
| | | $H_2$ | 100 | | | | |
| | | $B_2H_6$ (against $SiH_4$) | 800 ppm | | | | |
| | | NO | 10 | | | | |
| | | $AlCl_3$/He | 0.1 | | | | |
| | | $SiF_4$ | 0.5 | | | | |
| | | $CH_4$ | 1 | | | | |
| | 2nd layer region | $SiH_4$ | 100 | 300 | 3 | 0.5 | 3 |
| | | $SiF_4$ | 5 | | | | |
| | | $H_2$ | 200 | | | | |
| | | $PH_3$ | 0.3 ppm | | | | |

TABLE 99-continued

| Order of lamination (layer name) | | Gases and their flow rates (SCCM) | | Substrate temperature (°C.) | RF discharging power (mW/cm$^3$) | Inner pressure (Torr) | Layer thickness (μm) |
|---|---|---|---|---|---|---|---|
| | | NO | 0.1 | | | | |
| | | $CH_4$ | 1 | | | | |
| | | $AlCl_3$/He | 0.1 | | | | |
| | 3rd | $SiH_4$ | 100 | 300 | 15 | 0.4 | 30 |
| | layer | $CH_4$ | 100 | | | | |
| | region | $PH_3$ (against $SiH_4$) | 50 ppm | | | | |
| | | $AlCl_3$/He | 0.1 | | | | |
| | | NO | 0.1 | | | | |
| | | $SiF_4$ | 0.5 | | | | |
| | 4th | $SiH_4$ | 50 | 300 | 10 | 0.4 | 0.5 |
| | layer | $CH_4$ | 600 | | | | |
| | region | $AlCl_3$/He | 0.1 | | | | |
| | | $SiF_4$ | 0.5 | | | | |
| | | NO | 0.1 | | | | |
| | | $PH_3$ | 0.3 ppm | | | | |

TABLE 100

| Order of lamination (layer name) | | Gases and their flow rates (SCCM) | | Substrate temperature (°C.) | RF discharging power (mW/cm$^3$) | Inner pressure (Torr) | Layer thickness (μm) |
|---|---|---|---|---|---|---|---|
| Lower layer | | $SiH_4$ | 50 | 250 | 5 | 0.4 | 0.03 |
| | | $H_2$ | 10 → 200* | | | | |
| | | $AlCl_3$/He | | | | | |
| | | (S-side: 0.01 μm) | 100 → 10** | | | | |
| | | (UL-side: 0.01 μm) | 10 | | | | |
| | | $C_2H_2$ | 3 → 13* | | | | |
| | | $B_2H_6$ (against $SiH_4$) | 100 ppm | | | | |
| Upper layer | 1st layer region | $SiH_4$ | 100 | 250 | 10 | 0.5 | 2 |
| | | $B_2H_6$ (against $SiH_4$) | 1500 ppm | | | | |
| | | $C_2H_2$ | 13 | | | | |
| | | $H_2$ | 300 | | | | |
| | | NO | 1 | | | | |
| | 2nd layer region | $SiH_4$ | 100 | 250 | 25 | 0.5 | 22 |
| | | $B_2H_6$ (against $SiH_4$) | 40 ppm | | | | |
| | | $C_2H_2$ | 15 | | | | |
| | | $H_2$ | 300 | | | | |
| | 3rd layer region | $SiH_4$ | 100 | 250 | 20 | 0.5 | 5 |
| | | $C_2H_2$ | 10 | | | | |
| | | $H_2$ | 150 | | | | |
| | 4th layer region | $SiH_4$ | 60 | 250 | 10 | 0.4 | 0.5 |
| | | $C_2H_2$ | 60 | | | | |
| | | $H_2$ | 50 | | | | |

TABLE 101

| Order of lamination (layer name) | | Gases and their flow rates (SCCM) | | Substrate temperature (°C.) | RF discharging power (mW/cm$^3$) | Inner pressure (Torr) | Layer thickness (μm) |
|---|---|---|---|---|---|---|---|
| Lower layer | | $SiH_4$ | 50 | 250 | 5 | 0.4 | 0.03 |
| | | $H_2$ | 10 → 200* | | | | |
| | | $AlCl_3$/He | | | | | |
| | | (S-side: 0.01 μm) | 100 → 10** | | | | |
| | | (UL-side: 0.01 μm) | 10 | | | | |
| | | $C_2H_2$ | 3 → 13* | | | | |
| | | $PH_3$ (against $SiH_4$) | 10 → 100 ppm* | | | | |
| Upper layer | 1st layer region | $SiH_4$ | 100 | 250 | 10 | 0.5 | 2 |
| | | $PH_3$ (against $SiH_4$) | 1500 ppm | | | | |
| | | $C_2H_2$ | 13 | | | | |
| | | $H_2$ | 300 | | | | |
| | | NO | 1 | | | | |
| | 2nd layer region | $SiH_4$ | 100 | 250 | 25 | 0.5 | 22 |
| | | $C_2H_2$ | 15 | | | | |
| | | $H_2$ | 300 | | | | |
| | 3rd layer region | $SiH_4$ | 100 | 250 | 20 | 0.5 | 5 |
| | | $C_2H_2$ | 10 | | | | |
| | | $H_2$ | 150 | | | | |
| | 4th layer region | $SiH_4$ | 60 | 250 | 10 | 0.4 | 0.5 |
| | | $C_2H_2$ | 60 | | | | |
| | | $H_2$ | 50 | | | | |

TABLE 102

| Order of lamination (layer name) | | Gases and their flow rates (SCCM) | | Substrate temperature (°C.) | RF discharging power (mW/cm$^3$) | Inner pressure (Torr) | Layer thickness (μm) |
|---|---|---|---|---|---|---|---|
| Lower layer | | $SiH_4$ | 10 → 100* | 300 | 10 | 0.4 | 0.2 |
| | | $H_2$ | 5 → 200* | | | | |
| | | $AlCl_3$/He | | | | | |
| | | (S-side: 0.05 μm) | 200 → 40** | | | | |
| | | (UL-side: 0.15 μm) | 40 → 10** | | | | |
| | | $C_2H_2$ | 1 → 5* | | | | |
| | | $B_2H_6$ (against $SiH_4$) | 100 ppm | | | | |
| Upper layer | 1st layer region | $SiH_4$ | 100 | 300 | 10 | 0.35 | 3 |
| | | $H_2$ | 100 | | | | |
| | | $B_2H_6$ (against $SiH_4$) | 1000 ppm | | | | |
| | | $C_2H_2$ | 5 | | | | |
| | | $H_2S$ | 1 ppm | | | | |
| | | $AlCl_3$/He | 0.1 | | | | |
| | | NO | 0.1 | | | | |
| | | $SiF_4$ | 0.5 | | | | |
| | 2nd layer region | $SiH_4$ | 300 | 300 | 20 | 0.5 | 20 |
| | | $H_2$ | 500 | | | | |
| | | $C_2H_2$ | 0.1 | | | | |
| | | $AlCl_3$/He | 0.1 | | | | |
| | | NO | 0.1 | | | | |
| | | $SiF_4$ | 5 | | | | |
| | | $H_2S$ | 1 ppm | | | | |
| | | $B_2H_6$ | 0.3 ppm | | | | |
| | 3rd layer region | $SiH_4$ | 100 | 300 | 15 | 0.4 | 7 |
| | | $CH_4$ | 600 | | | | |
| | | $PH_3$ (against $SiH_4$) | 3000 ppm | | | | |
| | | $AlCl_3$/He | 0.1 | | | | |
| | | NO | 0.1 | | | | |
| | | $SiF_4$ | 0.5 | | | | |
| | | $B_2H_6$ | 0.3 ppm | | | | |
| | | $H_2S$ | 1 ppm | | | | |
| | 4th layer region | $SiH_4$ | 40 | 300 | 10 | 0.4 | 0.1 |
| | | $CH_4$ | 600 | | | | |
| | | $AlCl_3$/He | 0.1 | | | | |
| | | NO | 0.1 | | | | |
| | | $SiF_4$ | 0.5 | | | | |
| | | $B_2H_6$ | 0.3 ppm | | | | |
| | | $PH_3$ | 0.3 ppm | | | | |

TABLE 103

| Order of lamination (layer name) | | Gases and their flow rates (SCCM) | | Substrate temperature (°C.) | RF discharging power (mW/cm$^3$) | Inner pressure (Torr) | Layer thickness (μm) |
|---|---|---|---|---|---|---|---|
| Lower layer | | $SiH_4$ | 50 | 250 | 1 | 0.4 | 0.02 |
| | | $H_2$ | 5 → 200* | | | | |
| | | $AlCl_3$/He | | | | | |
| | | (S-side: 0.01 μm) | 200 → 30** | | | | |
| | | (UL-side: 0.01 μm) | 30 → 10** | | | | |
| | | $C_2H_2$ | 0.1 | | | | |
| | | NO | 5 | | | | |
| Upper layer | 1st layer region | $SiH_4$ | 100 | 300 | 10 | 0.35 | 3 |
| | | $H_2$ | 150 | | | | |
| | | $B_2H_6$ (against $SiH_4$) | 800 ppm | | | | |
| | | $AlCl_3$/He | 0.1 | | | | |
| | | $SiF_4$ | 0.5 | | | | |
| | | NO | 10 | | | | |
| | | $C_2H_2$ | 0.1 | | | | |
| | 2nd layer region | $AlCl_3$/He | 0.1 | 300 | 20 | 0.5 | 5 |
| | | $SiF_4$ | 0.1 | | | | |
| | | $SiH_4$ | 300 | | | | |
| | | $H_2$ | 300 | | | | |
| | | NO | 0.1 | | | | |
| | | $C_2H_2$ | 0.1 | | | | |
| | | $B_2H_6$ (against $SiH_4$) | 0.3 ppm | | | | |
| | 3rd layer region | $SiF_4$ | 0.5 | 300 | 15 | 0.4 | 20 |
| | | $AlCl_3$/He | 0.1 | | | | |
| | | $SiH_4$ | 100 | | | | |
| | | $C_2H_2$ | 15 | | | | |
| | | $B_2H_6$ (against $SiH_4$) | 0.3 ppm | | | | |
| | | NO | 0.1 | | | | |
| | 4th layer region | $SiH_4$ | 50 | 300 | 10 | 0.4 | 0.5 |
| | | $C_2H_2$ | 30 | | | | |
| | | NO | 0.1 | | | | |
| | | $B_2H_6$ (against $SiH_4$) | 0.3 ppm | | | | |
| | | $AlCl_3$/He | 0.1 | | | | |

TABLE 103-continued

| Order of lamination (layer name) | Gases and their flow rates (SCCM) | | Substrate temperature (°C.) | RF discharging power (mW/cm³) | Inner pressure (Torr) | Layer thickness (μm) |
|---|---|---|---|---|---|---|
| | $SiF_4$ | 0.5 | | | | |

TABLE 104

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 50 | 250 | 1 | 0.4 | 0.02 |
| | | $H_2$ | 5 → 200* | | | | |
| | | $AlCl_3$/He | | | | | |
| | | (S-side: 0.01 μm) | 200 → 30** | | | | |
| | | (UL-side: 0.01 μm) | 30 → 10** | | | | |
| | | $C_2H_2$ | 0.1 | | | | |
| | | NO | 10 | | | | |
| Upper layer | 1st layer region | $SiH_4$ | 100 | 300 | 10 | 0.35 | 3 |
| | | $H_2$ | 150 | | | | |
| | | $B_2H_6$ (against $SiH_4$) | 800 ppm | | | | |
| | | $AlCl_3$/He | 0.1 | | | | |
| | | $SiF_4$ | 0.5 | | | | |
| | | NO | 10 | | | | |
| | | $C_2H_2$ | 0.1 | | | | |
| | 2nd layer region | $AlCl_3$/He | 0.1 | 300 | 20 | 0.5 | 7 |
| | | $SiF_4$ | 0.1 | | | | |
| | | $SiH_4$ | 300 | | | | |
| | | $H_2$ | 300 | | | | |
| | | NO | 2 | | | | |
| | | $C_2H_2$ | 0.1 | | | | |
| | | $B_2H_6$ (against $SiH_4$) | 0.3 ppm | | | | |
| | 3rd layer region | $SiF_4$ | 0.5 | 300 | 15 | 0.4 | 20 |
| | | $AlCl_3$/He | 0.1 | | | | |
| | | $SiH_4$ | 100 | | | | |
| | | $C_2H_2$ | 15 | | | | |
| | | $B_2H_6$ (against $SiH_4$) | 0.3 ppm | | | | |
| | | NO | 0.1 | | | | |
| | 4th layer region | $SiH_4$ | 50 | 300 | 10 | 0.4 | 0.5 |
| | | $C_2H_2$ | 30 | | | | |
| | | NO | 0.1 | | | | |
| | | $B_2H_6$ (against $SiH_4$) | 0.3 ppm | | | | |
| | | $AlCl_3$/He | 0.1 | | | | |
| | | $SiF_4$ | 0.5 | | | | |

TABLE 105

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 50 | 250 | 1 | 0.4 | 0.02 |
| | | $H_2$ | 5 → 200* | | | | |
| | | $AlCl_3$/He | | | | | |
| | | (S-side: 0.01 μm) | 200 → 30** | | | | |
| | | (UL-side: 0.01 μm) | 30 → 10** | | | | |
| | | $C_2H_2$ | 0.1 | | | | |
| | | NO | 5 | | | | |
| | | $B_2H_6$ (against $SiH_4$) | 100 ppm | | | | |
| Upper layer | 1st layer region | $SiH_4$ | 100 | 300 | 10 | 0.35 | 3 |
| | | $H_2$ | 150 | | | | |
| | | $B_2H_6$ (against $SiH_4$) | 800 ppm | | | | |
| | | $AlCl_3$/He | 0.1 | | | | |
| | | $SiF_4$ | 0.5 | | | | |
| | | NO | 10 | | | | |
| | | $C_2H_2$ | 0.1 | | | | |
| | 2nd layer region | $AlCl_3$/He | 0.1 | 300 | 20 | 0.5 | 3 |
| | | $SiF_4$ | 0.1 | | | | |
| | | $SiH_4$ | 300 | | | | |
| | | $H_2$ | 300 | | | | |
| | | NO | 0.1 | | | | |
| | | $C_2H_2$ | 0.5 → 2* | | | | |
| | | $B_2H_6$ (against $SiH_4$) | 0.3 ppm | | | | |
| | 3rd layer region | $SiF_4$ | 0.5 | 300 | 15 | 0.4 | 20 |
| | | $AlCl_3$/He | 0.1 | | | | |
| | | $SiH_4$ | 100 | | | | |
| | | $C_2H_2$ | 15 | | | | |
| | | $B_2H_6$ (against $SiH_4$) | 0.3 ppm | | | | |
| | | NO | 0.1 | | | | |
| | 4th | $SiH_4$ | 50 | 300 | 10 | 0.4 | 0.5 |

TABLE 105-continued

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| | layer region | $C_2H_2$ | 30 | | | | |
| | | NO | 0.1 | | | | |
| | | $B_2H_6$ (against $SiH_4$) | 0.3 ppm | | | | |
| | | $AlCl_3$/He | 0.1 | | | | |
| | | $SiF_4$ | 0.5 | | | | |

TABLE 106

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 50 | 250 | 1 | 0.4 | 0.02 |
| | | $H_2$ | 5 → 200* | | | | |
| | | $AlCl_3$/He | | | | | |
| | | (S-side: 0.01 μm) | 200 → 30** | | | | |
| | | (UL-side: 0.01 μm) | 30 → 10** | | | | |
| | | $C_2H_2$ | 0.1 | | | | |
| | | NO | 10 | | | | |
| | | $B_2H_6$ (against $SiH_4$) | 10 ppm | | | | |
| Upper layer | 1st layer region | $SiH_4$ | 100 | 300 | 10 | 0.35 | 3 |
| | | $H_2$ | 150 | | | | |
| | | $B_2H_6$ (against $SiH_4$) | 800 ppm | | | | |
| | | $AlCl_3$/He | 0.1 | | | | |
| | | $SiF_4$ | 0.5 | | | | |
| | | NO | 10 | | | | |
| | | $C_2H_2$ | 0.1 | | | | |
| | 2nd layer region | $AlCl_3$/He | 0.1 | 300 | 20 | 0.5 | 8 |
| | | $SiF_4$ | 0.1 | | | | |
| | | $SiH_4$ | 300 | | | | |
| | | $H_2$ | 300 | | | | |
| | | NO | 0.1 | | | | |
| | | $C_2H_2$ | 1 | | | | |
| | | $B_2H_6$ (against $SiH_4$) | 5 → 0.3 ppm** | | | | |
| | 3rd layer region | $SiF_4$ | 0.5 | 300 | 15 | 0.4 | 20 |
| | | $AlCl_3$/He | 0.1 | | | | |
| | | $SiH_4$ | 100 | | | | |
| | | $C_2H_2$ | 15 | | | | |
| | | $B_2H_6$ (against $SiH_4$) | 0.3 ppm | | | | |
| | | NO | 0.1 | | | | |
| | 4th layer region | $SiH_4$ | 50 | 300 | 10 | 0.4 | 0.5 |
| | | $C_2H_2$ | 30 | | | | |
| | | NO | 0.1 | | | | |
| | | $B_2H_6$ (against $SiH_4$) | 0.3 ppm | | | | |
| | | $AlCl_3$/He | 0.1 | | | | |
| | | $SiF_4$ | 0.5 | | | | |

TABLE 107

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 50 | 250 | 1 | 0.4 | 0.02 |
| | | $H_2$ | 5 → 200* | | | | |
| | | $AlCl_3$/He | | | | | |
| | | (S-side: 0.01 μm) | 200 → 30** | | | | |
| | | (UL-side: 0.01 μm) | 30 → 10** | | | | |
| | | $C_2H_2$ | 0.1 | | | | |
| | | NO | 5 → 10* | | | | |
| Upper layer | 1st layer region | $SiH_4$ | 100 | 300 | 10 | 0.35 | 3 |
| | | $H_2$ | 150 | | | | |
| | | $B_2H_6$ (against $SiH_4$) | 800 ppm | | | | |
| | | $AlCl_3$/He | 0.1 | | | | |
| | | $SiF_4$ | 0.5 | | | | |
| | | NO | 10 | | | | |
| | | $C_2H_2$ | 0.1 | | | | |
| | 2nd layer region | $AlCl_3$/He | 0.1 | 300 | 20 | 0.5 | 5 |
| | | $SiF_4$ | 0.1 | | | | |
| | | $SiH_4$ | 300 | | | | |
| | | $H_2$ | 300 | | | | |
| | | NO | 0.1 | | | | |
| | | $C_2H_2$ | 0.1 | | | | |
| | | $B_2H_6$ (against $SiH_4$) | 0.3 ppm | | | | |
| | 3rd layer region | $SiF_4$ | 0.5 | 300 | 15 | 0.4 | 20 |
| | | $AlCl_3$/He | 0.1 | | | | |
| | | $SiH_4$ | 100 | | | | |

TABLE 107-continued

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| | | $C_2H_2$ | | | | | |
| | | (U · 2nd LR-side: 1 μm) | 0.1 → 15* | | | | |
| | | (U · 4th LR-side: 19 μm) | 15 | | | | |
| | | $B_2H_6$ (against $SiH_4$) | 0.3 ppm | | | | |
| | | NO | 0.1 | | | | |
| | 4th layer region | $SiH_4$ | 50 | 300 | 10 | 0.4 | 0.5 |
| | | $C_2H_2$ | 30 | | | | |
| | | NO | 0.1 | | | | |
| | | $B_2H_6$ (against $SiH_4$) | 0.3 ppm | | | | |
| | | $AlCl_3$/He | 0.1 | | | | |
| | | $SiF_4$ | 0.5 | | | | |

TABLE 108

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 50 | 250 | 1 | 0.4 | 0.02 |
| | | $H_2$ | 5 → 200* | | | | |
| | | $AlCl_3$/He | | | | | |
| | | (S-side: 0.01 μm) | 200 → 30** | | | | |
| | | (UL-side: 0.01 μm) | 30 → 10** | | | | |
| | | $C_2H_2$ | 0.1 | | | | |
| | | NO | 10 | | | | |
| | | $B_2H_6$ (against $SiH_4$) | 10 → 100 ppm* | | | | |
| Upper layer | 1st layer region | $SiH_4$ | 100 | 300 | 10 | 0.35 | 3 |
| | | $H_2$ | 150 | | | | |
| | | $B_2H_6$ (against $SiH_4$) | 800 ppm | | | | |
| | | $AlCl_3$/He | 0.1 | | | | |
| | | $SiF_4$ | 0.5 | | | | |
| | | NO | 10 | | | | |
| | | $C_2H_2$ | 0.1 | | | | |
| | 2nd layer region | $AlCl_3$/He | 0.1 | 300 | 20 | 0.5 | 2 |
| | | $SiF_4$ | 0.1 | | | | |
| | | $SiH_4$ | 300 | | | | |
| | | $H_2$ | 300 | | | | |
| | | NO | 0.1 | | | | |
| | | $C_2H_2$ | 0.1 | | | | |
| | | $B_2H_6$ (against $SiH_4$) | 0.3 ppm | | | | |
| | 3rd layer region | $SiF_4$ | 0.5 | 300 | 15 | 0.4 | 20 |
| | | $AlCl_3$/He | 0.1 | | | | |
| | | $SiH_4$ | 100 | | | | |
| | | $C_2H_2$ | | | | | |
| | | (U · 2nd LR-side: 5 μm) | 0.1 → 13* | | | | |
| | | (U · 4th LR-side) | 13 → 17** | | | | |
| | | $B_2H_6$ (against $SiH_4$) | 0.3 ppm | | | | |
| | | NO | 0.1 | | | | |
| | 4th layer region | $SiH_4$ | 50 | 300 | 10 | 0.4 | 0.5 |
| | | $C_2H_2$ | 30 | | | | |
| | | NO | 0.1 | | | | |
| | | $B_2H_6$ (against $SiH_4$) | 0.3 ppm | | | | |
| | | $AlCl_3$/He | 0.1 | | | | |
| | | $SiF_4$ | 0.5 | | | | |

TABLE 109

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 50 | 250 | 1 | 0.4 | 0.02 |
| | | $H_2$ | 5 → 200* | | | | |
| | | $AlCl_3$/He | | | | | |
| | | (S-side: 0.01 μm) | 200 → 30** | | | | |
| | | (UL-side: 0.01 μm) | 30 → 10** | | | | |
| | | $C_2H_2$ | 0.1 | | | | |
| | | NO | 10 | | | | |
| | | $B_2H_6$ (against $SiH_4$) | | | | | |
| | | (S-side: 0.01 μm) | 10 | | | | |
| | | (UL-side: 0.01 μm) | 10 → 100* | | | | |
| Upper layer | 1st layer region | $SiH_4$ | 100 | 300 | 10 | 0.35 | 3 |
| | | $H_2$ | 150 | | | | |
| | | $B_2H_6$ (against $SiH_4$) | 800 ppm | | | | |
| | | $AlCl_3$/He | 0.1 | | | | |
| | | $SiF_4$ | 0.5 | | | | |
| | | NO | 10 | | | | |

TABLE 109-continued

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| | | $C_2H_2$ | 0.1 | | | | |
| | 2nd layer region | $AlCl_3$/He | 0.1 | 300 | 20 | 0.5 | 5 |
| | | $SiF_4$ | 0.1 | | | | |
| | | $SiH_4$ | 300 | | | | |
| | | $H_2$ | 300 | | | | |
| | | NO | 0.1 | | | | |
| | | $C_2H_2$ | 0.1 | | | | |
| | | $B_2H_6$ (against $SiH_4$) | 0.3 ppm | | | | |
| | 3rd layer region | $SiF_4$ | 0.5 | 300 | 15 | 0.4 | 20 |
| | | $AlCl_3$/He | 0.1 | | | | |
| | | $C_2H_2$ | | | | | |
| | | (U · 2nd LR-side: 19 μm) | 15 | | | | |
| | | (U · 4th LR-side: 1 μm) | 15 → 30* | | | | |
| | | $SiH_4$ | | | | | |
| | | (U · 2nd LR-side: 19 μm) | 100 | | | | |
| | | (U · 4th LR-side: 1 μm) | 100 → 50** | | | | |
| | | NO | 0.1 | | | | |
| | | $B_2H_6$ (against $SiH_4$) | 0.3 ppm | | | | |
| | 4th layer region | $SiH_4$ | 50 | 300 | 10 | 0.4 | 0.5 |
| | | $C_2H_2$ | 30 | | | | |
| | | NO | 0.1 | | | | |
| | | $B_2H_6$ (against $SiH_4$) | 0.3 ppm | | | | |
| | | $AlCl_3$/He | 0.1 | | | | |
| | | $SiF_4$ | 0.5 | | | | |

TABLE 110

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 50 | 250 | 1 | 0.4 | 0.02 |
| | | $H_2$ | 5 → 200* | | | | |
| | | $AlCl_3$/He | | | | | |
| | | (S-side: 0.01 μm) | 200 → 30** | | | | |
| | | (UL-side: 0.01 μm) | 30 → 10** | | | | |
| | | $C_2H_2$ | 5 | | | | |
| | | NO | 0.1 | | | | |
| Upper layer | 1st layer region | $SiH_4$ | 100 | 300 | 10 | 0.35 | 3 |
| | | $H_2$ | 150 | | | | |
| | | $B_2H_6$ (against $SiH_4$) | 800 ppm | | | | |
| | | $AlCl_3$/He | 0.1 | | | | |
| | | $SiF_4$ | 0.5 | | | | |
| | | NO | 10 | | | | |
| | | $C_2H_2$ | 0.1 | | | | |
| | 2nd layer region | $AlCl_3$/He | 0.1 | 300 | 20 | 0.5 | 5 |
| | | $SiF_4$ | 0.1 | | | | |
| | | $SiH_4$ | 300 | | | | |
| | | $H_2$ | 300 | | | | |
| | | NO | 0.1 | | | | |
| | | $C_2H_2$ | 0.1 | | | | |
| | | $B_2H_6$ (against $SiH_4$) | 0.3 ppm | | | | |
| | 3rd layer region | $SiF_4$ | 0.5 | 300 | 15 | 0.4 | 20 |
| | | $AlCl_3$/He | 0.1 | | | | |
| | | $SiH_4$ | 100 | | | | |
| | | $C_2H_2$ | 15 | | | | |
| | | $B_2H_6$ (against $SiH_4$) | 10 ppm | | | | |
| | | NO | 0.1 | | | | |
| | 4th layer region | $SiH_4$ | 50 | 300 | 10 | 0.4 | 0.5 |
| | | $C_2H_2$ | 30 | | | | |
| | | NO | 0.1 | | | | |
| | | $B_2H_6$ (against $SiH_4$) | 0.3 ppm | | | | |
| | | $AlCl_3$/He | 0.1 | | | | |
| | | $SiF_4$ | 0.5 | | | | |

TABLE 111

| Order of lamination (layer name) | Gases and their flow rates (SCCM) | | Substrate temperature (°C.) | RF discharging power (mW/cm³) | Inner pressure (Torr) | Layer thickness (μm) |
|---|---|---|---|---|---|---|
| Lower layer | $SiH_4$ | 50 | 250 | 1 | 0.4 | 0.02 |
| | $H_2$ | 5 → 200* | | | | |
| | $AlCl_3$/He | | | | | |
| | (S-side: 0.01 μm) | 200 → 30** | | | | |
| | (UL-side: 0.01 μm) | 30 → 10** | | | | |
| | $C_2H_2$ | 1 → 6* | | | | |

TABLE 111-continued

| Order of lamination (layer name) | | Gases and their flow rates (SCCM) | | Substrate temperature (°C.) | RF discharging power (mW/cm$^3$) | Inner pressure (Torr) | Layer thickness (μm) |
|---|---|---|---|---|---|---|---|
| | | NO | 0.1 | | | | |
| Upper layer | 1st layer region | $SiH_4$ | 100 | 300 | 10 | 0.35 | 3 |
| | | $H_2$ | 150 | | | | |
| | | $B_2H_6$ (against $SiH_4$) | 800 ppm | | | | |
| | | $AlCl_3$/He | 0.1 | | | | |
| | | $SiF_4$ | 0.5 | | | | |
| | | NO | 10 | | | | |
| | | $C_2H_2$ | 0.1 | | | | |
| | 2nd layer region | $AlCl_3$/He | 0.1 | 300 | 20 | 0.5 | 6 |
| | | $SiF_4$ | 0.1 | | | | |
| | | $SiH_4$ | 300 | | | | |
| | | $H_2$ | 300 | | | | |
| | | NO | 0.1 | | | | |
| | | $C_2H_2$ | 0.1 | | | | |
| | | $B_2H_6$ (against $SiH_4$) | 0.3 ppm | | | | |
| | 3rd layer region | $SiF_4$ | 0.5 | 300 | 15 | 0.4 | 20 |
| | | $AlCl_3$/He | 0.1 | | | | |
| | | $SiH_4$ | 100 | | | | |
| | | $C_2H_2$ | 15 | | | | |
| | | $B_2H_6$ (against $SiH_4$) | 12 → 0.3 ppm** | | | | |
| | | NO | 0.1 | | | | |
| | 4th layer region | $SiH_4$ | 50 | 300 | 10 | 0.4 | 0.5 |
| | | $C_2H_2$ | 30 | | | | |
| | | NO | 0.1 | | | | |
| | | $B_2H_6$ (against $SiH_4$) | 0.3 ppm | | | | |
| | | $AlCl_3$/He | 0.1 | | | | |
| | | $SiF_4$ | 0.5 | | | | |

TABLE 112

| Order of lamination (layer name) | | Gases and their flow rates (SCCM) | | Substrate temperature (°C.) | RF discharging power (mW/cm$^3$) | Inner pressure (Torr) | Layer thickness (μm) |
|---|---|---|---|---|---|---|---|
| Lower layer | | $SiH_4$ | 50 | 250 | 1 | 0.4 | 0.02 |
| | | $H_2$ | 5 → 200* | | | | |
| | | $AlCl_3$/He | | | | | |
| | | (S-side: 0.01 μm) | 200 → 30** | | | | |
| | | (UL-side: 0.01 μm) | 30 → 10** | | | | |
| | | $C_2H_2$ | 3 | | | | |
| | | NO | 0.1 | | | | |
| | | $B_2H_6$ (against $SiH_4$) | 100 ppm | | | | |
| Upper layer | 1st layer region | $SiH_4$ | 100 | 300 | 10 | 0.35 | 3 |
| | | $H_2$ | 150 | | | | |
| | | $B_2H_6$ (against $SiH_4$) | 800 ppm | | | | |
| | | $AlCl_3$/He | 0.1 | | | | |
| | | $SiF_4$ | 0.5 | | | | |
| | | NO | 10 | | | | |
| | | $C_2H_2$ | 0.1 | | | | |
| | 2nd layer region | $AlCl_3$/He | 0.1 | 300 | 20 | 0.5 | 5 |
| | | $SiF_4$ | 0.1 | | | | |
| | | $SiH_4$ | 300 | | | | |
| | | $H_2$ | 300 | | | | |
| | | NO | 0.1 | | | | |
| | | $C_2H_2$ | 0.1 | | | | |
| | | $B_2H_6$ (against $SiH_4$) | 0.3 ppm | | | | |
| | 3rd layer region | $SiF_4$ | 0.5 | 300 | 15 | 0.4 | 20 |
| | | $AlCl_3$/He | 0.1 | | | | |
| | | $SiH_4$ | 100 | | | | |
| | | $C_2H_2$ | 15 | | | | |
| | | $B_2H_6$ (against $SiH_4$) | 0.3 ppm | | | | |
| | | $PH_3$ (against $SiH_4$) | 8 ppm | | | | |
| | | NO | 0.1 | | | | |
| | 4th layer region | $SiH_4$ | 50 | 300 | 10 | 0.4 | 0.5 |
| | | $C_2H_2$ | 30 | | | | |
| | | NO | 0.1 | | | | |
| | | $B_2H_6$ (against $SiH_4$) | 0.3 ppm | | | | |
| | | $AlCl_3$/He | 0.1 | | | | |
| | | $SiF_4$ | 0.5 | | | | |
| | | $PH_3$ (against $SiH_4$) | 0.3 ppm | | | | |

TABLE 113

| Order of lamination (layer name) | Gases and their flow rates (SCCM) | | Substrate temperature (°C.) | RF discharging power (mW/cm$^3$) | Inner pressure (Torr) | Layer thickness (μm) |
|---|---|---|---|---|---|---|
| Lower layer | $SiH_4$ | 50 | 250 | 1 | 0.4 | 0.02 |

TABLE 113-continued

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| | | $H_2$ | 5 → 200* | | | | |
| | | $AlCl_3$/He | | | | | |
| | | (S-side: 0.01 μm) | 200 → 30** | | | | |
| | | (UL-side: 0.01 μm) | 30 → 10** | | | | |
| | | $C_2H_2$ | 3 | | | | |
| | | NO | 0.1 | | | | |
| | | $B_2H_6$ (against $SiH_4$) | 10 → 100 ppm* | | | | |
| Upper layer | 1st layer region | $SiH_4$ | 100 | 300 | 10 | 0.35 | 3 |
| | | $H_2$ | 150 | | | | |
| | | $B_2H_6$ (against $SiH_4$) | 800 ppm | | | | |
| | | $AlCl_3$/He | 0.1 | | | | |
| | | $SiF_4$ | 0.5 | | | | |
| | | NO | 10 | | | | |
| | | $C_2H_2$ | 0.1 | | | | |
| | 2nd layer region | $AlCl_3$/He | 0.1 | 300 | 20 | 0.5 | 5 |
| | | $SiF_4$ | 0.1 | | | | |
| | | $SiH_4$ | 300 | | | | |
| | | $H_2$ | 300 | | | | |
| | | NO | 0.1 | | | | |
| | | $C_2H_2$ | 0.1 | | | | |
| | | $B_2H_6$ (against $SiH_4$) | 0.3 ppm | | | | |
| | 3rd layer region | $SiF_4$ | 0.5 | 300 | 15 | 0.4 | 20 |
| | | $AlCl_3$/He | 0.1 | | | | |
| | | $SiH_4$ | 100 | | | | |
| | | $C_2H_2$ | 15 | | | | |
| | | $B_2H_6$ (against $SiH_4$) | 0.3 ppm | | | | |
| | | $PH_3$ (against $SiH_4$) | 10 → 0.3 ppm** | | | | |
| | | NO | 0.1 | | | | |
| | 4th layer region | $SiH_4$ | 50 | 300 | 10 | 0.4 | 0.5 |
| | | $C_2H_2$ | 30 | | | | |
| | | NO | 0.1 | | | | |
| | | $B_2H_6$ (against $SiH_4$) | 0.3 ppm | | | | |
| | | $AlCl_3$/He | 0.1 | | | | |
| | | $SiF_4$ | 0.5 | | | | |
| | | $PH_3$ (against $SiH_4$) | 0.3 ppm | | | | |

TABLE 114

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 50 | 250 | 1 | 0.4 | 0.02 |
| | | $H_2$ | 5 → 200* | | | | |
| | | $AlCl_3$/He | | | | | |
| | | (S-side: 0.01 μm) | 200 → 30** | | | | |
| | | (UL-side: 0.01 μm) | 30 → 10** | | | | |
| | | $C_2H_2$ | 0.1 | | | | |
| | | NO | 10 | | | | |
| | | $H_2S$ | 1 ppm | | | | |
| Upper layer | 1st layer region | $SiH_4$ | 100 | 300 | 10 | 0.35 | 3 |
| | | $H_2$ | 150 | | | | |
| | | $B_2H_6$ (against $SiH_4$) | 800 ppm | | | | |
| | | $AlCl_3$/He | 0.1 | | | | |
| | | $SiF_4$ | 0.5 | | | | |
| | | NO | 10 | | | | |
| | | $C_2H_2$ | 0.1 | | | | |
| | | $H_2S$ | 1 ppm | | | | |
| | 2nd layer region | $AlCl_3$/He | 0.1 | 300 | 20 | 0.5 | 5 |
| | | $SiF_4$ | 0.1 | | | | |
| | | $SiH_4$ | 300 | | | | |
| | | $H_2$ | 300 | | | | |
| | | NO | 0.1 | | | | |
| | | $C_2H_2$ | 0.1 | | | | |
| | | $B_2H_6$ (against $SiH_4$) | 0.3 ppm | | | | |
| | | $H_2S$ | 1 ppm | | | | |
| | 3rd layer region | $SiF_4$ | 0.5 | 300 | 15 | 0.4 | 20 |
| | | $AlCl_3$/He | 0.1 | | | | |
| | | $SiH_4$ | 100 | | | | |
| | | $C_2H_2$ | 15 | | | | |
| | | $B_2H_6$ (against $SiH_4$) | 0.3 ppm | | | | |
| | | NO | 0.1 | | | | |
| | | $H_2S$ | 1 ppm | | | | |
| | 4th layer region | $SiH_4$ | 50 | 300 | 10 | 0.4 | 0.5 |
| | | $C_2H_2$ | 30 | | | | |
| | | NO | 0.1 | | | | |
| | | $B_2H_6$ (against $SiH_4$) | 0.3 ppm | | | | |
| | | $AlCl_3$/He | 0.1 | | | | |

TABLE 114-continued

| Order of lamination (layer name) | Gases and their flow rates (SCCM) | | Substrate temperature (°C.) | RF discharging power (mW/cm³) | Inner pressure (Torr) | Layer thickness (μm) |
|---|---|---|---|---|---|---|
| | $SiF_4$ | 0.5 | | | | |
| | $H_2S$ | 1 ppm | | | | |

TABLE 115

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 50 | 250 | 1 | 0.4 | 0.02 |
| | | $H_2$ | 5→200 * | | | | |
| | | $AlCl_3$/He | | | | | |
| | | (S-side: 0.01 μm) | 200→30 ** | | | | |
| | | (UL-side: 0.01 μm) | 30→10 ** | | | | |
| | | $C_2H_2$ | 0.1 | | | | |
| | | NO | 5 | | | | |
| Upper layer | 1st layer region | $SiH_4$ | 100 | 300 | 10 | 0.35 | 3 |
| | | $H_2$ | 150 | | | | |
| | | $B_2H_6$(against $SiH_4$) | 800 ppm | | | | |
| | | $AlCl_3$/He | 0.1 | | | | |
| | | $SiF_4$ | 0.5 | | | | |
| | | NO | 10 | | | | |
| | | $C_2H_2$ | 0.1 | | | | |
| | 2nd layer region | $AlCl_3$/He | 0.1 | 300 | 20 | 0.5 | 5 |
| | | $SiF_4$ | 0.1 | | | | |
| | | $SiH_4$ | 300 | | | | |
| | | $H_2$ | 300 | | | | |
| | | NO | 0.1 | | | | |
| | | $C_2H_2$ | 0.1 | | | | |
| | | $B_2H_6$(against $SiH_4$) | 0.3 ppm | | | | |
| | 3rd layer region | $SiF_4$ | 0.5 | 300 | 15 | 0.4 | 10 |
| | | $AlCl_3$/He | 0.1 | | | | |
| | | $SiH_4$ | 100 | | | | |
| | | $C_2H_2$ | 15 | | | | |
| | | $B_2H_6$(against $SiH_4$) | 0.3 ppm | | | | |
| | | NO | 0.1 | | | | |
| | 4th layer region | $SiH_4$ | 50 | 300 | 10 | 0.4 | 0.5 |
| | | $C_2H_2$ | 30 | | | | |
| | | NO | 0.1 | | | | |
| | | $B_2H_6$(against $SiH_4$) | 0.3 ppm | | | | |
| | | $AlCl_3$/He | 0.1 | | | | |
| | | $SiF_4$ | 0.5 | | | | |

TABLE 116

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 50 | 250 | 1 | 0.4 | 0.02 |
| | | $H_2$ | 5→200 * | | | | |
| | | $AlCl_3$/He | | | | | |
| | | (S-side: 0.01 μm) | 200→30 ** | | | | |
| | | (UL-side: 0.01 μm) | 30→10 ** | | | | |
| | | $C_2H_2$ | 0.1 | | | | |
| | | NO | 10 | | | | |
| | | $B_2H_6$(against $SiH_4$) | 150 ppm | | | | |
| Upper layer | 1st layer region | $SiH_4$ | 100 | 300 | 10 | 0.35 | 3 |
| | | $H_2$ | 150 | | | | |
| | | $B_2H_6$(against $SiH_4$) | 800 ppm | | | | |
| | | $AlCl_3$/He | 0.1 | | | | |
| | | $SiF_4$ | 0.5 | | | | |
| | | NO | 10 | | | | |
| | | $C_2H_2$ | 0.1 | | | | |
| | 2nd layer region | $AlCl_3$/He | 0.1 | 300 | 20 | 0.5 | 5 |
| | | $SiF_4$ | 0.1 | | | | |
| | | $SiH_4$ | 300 | | | | |
| | | $H_2$ | 300 | | | | |
| | | NO | 0.1 | | | | |
| | | $C_2H_2$ | 0.1 | | | | |
| | | $B_2H_6$(against $SiH_4$) | 0.3 ppm | | | | |
| | 3rd layer region | $SiF_4$ | 0.5 | 300 | 15 | 0.4 | 30 |
| | | $AlCl_3$/He | 0.1 | | | | |
| | | $SiH_4$ | 100 | | | | |
| | | $C_2H_2$ | 15 | | | | |
| | | $B_2H_6$(against $SiH_4$) | 0.3 ppm | | | | |
| | | NO | 0.1 | | | | |

TABLE 116-continued

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| | 4th layer region | $SiH_4$ | 50 | 300 | 10 | 0.4 | 0.5 |
| | | $C_2H_2$ | 30 | | | | |
| | | NO | 0.1 | | | | |
| | | $B_2H_6$(against $SiH_4$) | 0.3 ppm | | | | |
| | | $AlCl_3$/He | 0.1 | | | | |
| | | $SiF_4$ | 0.5 | | | | |

TABLE 117

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 50 | 250 | 1 | 0.4 | 0.02 |
| | | $H_2$ | 5→200 * | | | | |
| | | $AlCl_3$/He | | | | | |
| | | (S-side: 0.01 μm) | 200→30 ** | | | | |
| | | (UL-side: 0.01 μm) | 30→10 ** | | | | |
| | | $C_2H_2$ | 2 | | | | |
| | | NO | 5 | | | | |
| | | $B_2H_6$(against $SiH_4$) | 30 ppm | | | | |
| Upper layer | 1st layer region | $SiH_4$ | 100 | 300 | 10 | 0.35 | 3 |
| | | $H_2$ | 150 | | | | |
| | | $B_2H_6$(against $SiH_4$) | 800 ppm | | | | |
| | | $AlCl_3$/He | 0.1 | | | | |
| | | $SiF_4$ | 0.5 | | | | |
| | | NO | 10 | | | | |
| | | $C_2H_2$ | 0.1 | | | | |
| | 2nd layer region | $AlCl_3$/He | 0.1 | 300 | 20 | 0.5 | 5 |
| | | $SiF_4$ | 0.1 | | | | |
| | | $SiH_4$ | 300 | | | | |
| | | $H_2$ | 300 | | | | |
| | | NO | 0.1 | | | | |
| | | $C_2H_2$ | 0.1 | | | | |
| | | $B_2H_6$(against $SiH_4$) | 0.3 ppm | | | | |
| | 3rd layer region | $SiF_4$ | 0.5 | 300 | 15 | 0.4 | 20 |
| | | $AlCl_3$/He | 0.1 | | | | |
| | | $SiH_4$ | 100 | | | | |
| | | $C_2H_2$ | 0.1 | | | | |
| | | $B_2H_6$(against $SiH_4$) | 0.3 ppm | | | | |
| | | NO | 0.1 | | | | |
| | | $NH_3$ | 100 | | | | |
| | 4th layer region | $SiH_4$ | 50 | 300 | 10 | 0.4 | 0.5 |
| | | $C_2H_2$ | 30 | | | | |
| | | NO | 0.1 | | | | |
| | | $B_2H_6$(against $SiH_4$) | 0.3 ppm | | | | |
| | | $AlCl_3$/He | 0.1 | | | | |
| | | $SiF_4$ | 0.5 | | | | |

TABLE 118

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 50 | 250 | 1 | 0.4 | 0.02 |
| | | $H_2$ | 5→200 * | | | | |
| | | $AlCl_3$/He | | | | | |
| | | (S-side: 0.01 μm) | 200→30 ** | | | | |
| | | (UL-side: 0.01 μm) | 30→10 ** | | | | |
| | | $C_2H_2$ | 1→3 * | | | | |
| | | NO | 3 | | | | |
| | | $B_2H_6$(against $SiH_4$) | 100 ppm | | | | |
| Upper layer | 1st layer region | $SiH_4$ | 100 | 300 | 10 | 0.35 | 3 |
| | | $H_2$ | 150 | | | | |
| | | $B_2H_6$(against $SiH_4$) | 800 ppm | | | | |
| | | $AlCl_3$/He | 0.1 | | | | |
| | | $SiF_4$ | 0.5 | | | | |
| | | NO | 10 | | | | |
| | | $C_2H_2$ | 0.1 | | | | |
| | 2nd layer region | $AlCl_3$/He | 0.1 | 300 | 20 | 0.5 | 10 |
| | | $SiF_4$ | 0.1 | | | | |
| | | $SiH_4$ | 300 | | | | |
| | | $H_2$ | 300 | | | | |
| | | NO | 0.1 | | | | |
| | | $C_2H_2$ | 0.1 | | | | |
| | | $B_2H_6$(against $SiH_4$) | 0.3 ppm | | | | |

TABLE 118-continued

| Order of lamination (layer name) | | Gases and their flow rates (SCCM) | | Substrate temperature (°C.) | RF discharging power (mW/cm$^3$) | Inner pressure (Torr) | Layer thickness (μm) |
|---|---|---|---|---|---|---|---|
| | 3rd layer region | $SiF_4$ | 0.5 | 300 | 15 | 0.4 | 20 |
| | | $AlCl_3$/He | 0.1 | | | | |
| | | $SiH_4$ | 100 | | | | |
| | | $C_2H_2$ | | | | | |
| | | $B_2H_6$(against $SiH_4$) | 0.3 ppm | | | | |
| | | NO | 0.1 | | | | |
| | | $N_2$ | 500 | | | | |
| | 4th layer region | $SiH_4$ | 50 | 300 | 10 | 0.4 | 0.5 |
| | | $C_2H_2$ | 30 | | | | |
| | | NO | 0.1 | | | | |
| | | $B_2H_6$(against $SiH_4$) | 0.3 ppm | | | | |
| | | $AlCl_3$/He | 0.1 | | | | |
| | | $SiF_4$ | 0.5 | | | | |

TABLE 119

| Order of lamination (layer name) | | Gases and their flow rates (SCCM) | | Substrate temperature (°C.) | RF discharging power (mW/cm$^3$) | Inner pressure (Torr) | Layer thickness (μm) |
|---|---|---|---|---|---|---|---|
| Lower layer | | $SiH_4$ | 50 | 250 | 1 | 0.4 | 0.02 |
| | | $H_2$ | 5→200 * | | | | |
| | | $AlCl_3$/He | | | | | |
| | | (S-side: 0.01 μm) | 200→30 ** | | | | |
| | | (UL-side: 0.01 μm) | 30→10 ** | | | | |
| | | $C_2H_2$ | 2 | | | | |
| | | NO | 5→8 * | | | | |
| | | $B_2H_6$(against $SiH_4$) | 10→100 ppm | | | | |
| Upper layer | 1st layer region | $SiH_4$ | 100 | 300 | 10 | 0.35 | 3 |
| | | $H_2$ | 150 | | | | |
| | | $B_2H_6$(against $SiH_4$) | 800 ppm | | | | |
| | | $AlCl_3$/He | 0.1 | | | | |
| | | $SiF_4$ | 0.5 | | | | |
| | | NO | 10 | | | | |
| | | $C_2H_2$ | 0.1 | | | | |
| | 2nd layer region | $AlCl_3$/He | 0.1 | 300 | 15 | 0.4 | 20 |
| | | $SiF_4$ | 0.5 | | | | |
| | | $C_2H_2$ | 15 | | | | |
| | | $B_2H_6$(against $SiH_4$) | 0.3 ppm | | | | |
| | | NO | 0.1 | | | | |
| | 3rd layer region | $AlCl_3$/He | 0.1 | 300 | 20 | 0.5 | 5 |
| | | $SiF_4$ | 0.5 | | | | |
| | | $SiH_4$ | 300 | | | | |
| | | $H_2$ | 300 | | | | |
| | | NO | 0.1 | | | | |
| | | $C_2H_2$ | 0.1 | | | | |
| | | $B_2H_6$(against $SiH_4$) | 0.3 ppm | | | | |
| | 4th layer region | $SiH_4$ | 50 | 300 | 10 | 0.4 | 0.5 |
| | | $C_2H_2$ | 30 | | | | |
| | | NO | 0.1 | | | | |
| | | $B_2H_6$(against $SiH_4$) | 0.3 ppm | | | | |
| | | $AlCl_3$/He | 0.1 | | | | |
| | | $SiF_4$ | 0.5 | | | | |

TABLE 120

| Order of lamination (layer name) | | Gases and their flow rates (SCCM) | | Substrate temperature (°C.) | RF discharging power (mW/cm$^3$) | Inner pressure (Torr) | Layer thickness (μm) |
|---|---|---|---|---|---|---|---|
| Lower layer | | $SiH_4$ | 50 | 250 | 1 | 0.4 | 0.02 |
| | | $H_2$ | 5→200 * | | | | |
| | | $AlCl_3$/He | | | | | |
| | | (S-side: 0.01 μm) | 200→30 ** | | | | |
| | | (UL-side: 0.01 μm) | 30→10 ** | | | | |
| | | $C_2H_2$ | 2 | | | | |
| | | NO | 5→8 * | | | | |
| | | $B_2H_6$(against $SiH_4$) | | | | | |
| | | (S-side: 0.01 μm) | 50 | | | | |
| | | (UL-side: 0.01 μm) | 50→100 * | | | | |
| Upper layer | 1st layer region | $SiH_4$ | 100 | 300 | 10 | 0.35 | 3 |
| | | $H_2$ | 150 | | | | |
| | | $B_2H_6$(against $SiH_4$) | 800 ppm | | | | |
| | | $AlCl_3$/He | 0.1 | | | | |
| | | $SiF_4$ | 0.5 | | | | |
| | | NO | 10 | | | | |
| | | $C_2H_2$ | 0.1 | | | | |

TABLE 120-continued

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| | 2nd layer region | $AlCl_3$/He | 0.1 | 300 | 15 | 0.4 | 20 |
| | | $SiF_4$ | 0.5 | | | | |
| | | $SiH_4$ | 100 | | | | |
| | | $C_2H_2$ | 15 | | | | |
| | | $B_2H_6$(against $SiH_4$) | 10 ppm | | | | |
| | | NO | 0.1 | | | | |
| | 3rd layer region | $AlCl_3$/He | 0.1 | 300 | 20 | 0.5 | 4 |
| | | $SiF_4$ | 0.5 | | | | |
| | | $SiH_4$ | 300 | | | | |
| | | $H_2$ | 300 | | | | |
| | | NO | 0.1 | | | | |
| | | $C_2H_2$ | 0.1 | | | | |
| | | $B_2H_6$(against $SiH_4$) | 0.3 ppm | | | | |
| | 4th layer region | $SiH_4$ | 50 | 300 | 10 | 0.4 | 0.5 |
| | | $C_2H_2$ | 30 | | | | |
| | | NO | 0.1 | | | | |
| | | $B_2H_6$(against $SiH_4$) | 0.3 ppm | | | | |
| | | $AlCl_3$/He | 0.1 | | | | |
| | | $SiF_4$ | 0.5 | | | | |

TABLE 121

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 50 | 250 | 1 | 0.4 | 0.02 |
| | | $H_2$ | 5→200 * | | | | |
| | | $AlCl_3$/He | | | | | |
| | | (S-side: 0.01 μm) | 200→30 ** | | | | |
| | | (UL-side: 0.01 μm) | 30→10 ** | | | | |
| | | $C_2H_2$ | 0.1 | | | | |
| | | NO | 10 | | | | |
| Upper layer | 1st layer region | $SiH_4$ | 100 | 300 | 10 | 0.35 | 3 |
| | | $H_2$ | 150 | | | | |
| | | $B_2H_6$(against $SiH_4$) | 800 ppm | | | | |
| | | $AlCl_3$/He | 0.1 | | | | |
| | | NO | 10 | | | | |
| | | $SiF_4$ | 0.5 | | | | |
| | | $C_2H_2$ | 0.1 | | | | |
| | 2nd layer region | $AlCl_3$/He | 0.1 | 300 | 15 | 0.4 | 20 |
| | | $SiF_4$ | 0.5 | | | | |
| | | $SiH_4$ | 100 | | | | |
| | | $C_2H_2$ | 15 | | | | |
| | | $PH_3$ | 8 ppm | | | | |
| | | $B_2H_6$(against $SiH_4$) | 0.3 ppm | | | | |
| | | NO | 0.1 | | | | |
| | 3rd layer region | $AlCl_3$/He | 0.1 | 300 | 20 | 0.5 | 6 |
| | | $SiF_4$ | 0.5 | | | | |
| | | $SiH_4$ | 300 | | | | |
| | | $H_2$ | 300 | | | | |
| | | NO | 0.1 | | | | |
| | | $PH_3$ | 0.1 ppm | | | | |
| | | $C_2H_2$ | 0.1 | | | | |
| | | $B_2H_6$(against $SiH_4$) | 0.3 ppm | | | | |
| | 4th layer region | $SiH_4$ | 50 | 300 | 10 | 0.4 | 0.5 |
| | | $C_2H_2$ | 30 | | | | |
| | | NO | 0.1 | | | | |
| | | $B_2H_6$(against $SiH_4$) | 0.3 ppm | | | | |
| | | $AlCl_3$/He | 0.1 | | | | |
| | | $SiF_4$ | 0.5 | | | | |

TABLE 122

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 50 | 250 | 1 | 0.4 | 0.02 |
| | | $H_2$ | 5→200 * | | | | |
| | | $AlCl_3$/He | | | | | |
| | | (S-side: 0.01 μm) | 200→30 ** | | | | |
| | | (UL-side: 0.01 μm) | 30→10 ** | | | | |
| | | $C_2H_2$ | 10 | | | | |
| | | NO | 0.1 | | | | |
| Upper layer | 1st layer | $SiH_4$ | 100 | 300 | 10 | 0.35 | 3 |
| | | $H_2$ | 150 | | | | |

TABLE 122-continued

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| | region | $B_2H_6$(against $SiH_4$) | 800 ppm | | | | |
| | | $AlCl_3$/He | 0.1 | | | | |
| | | NO | 10 | | | | |
| | | $SiF_4$ | 0.5 | | | | |
| | | $C_2H_2$ | 0.1 | | | | |
| | 2nd layer region | $AlCl_3$/He | 0.1 | 300 | 15 | 0.4 | 20 |
| | | $SiF_4$ | 0.5 | | | | |
| | | $SiH_4$ | 100 | | | | |
| | | $C_2H_2$ | 15 | | | | |
| | | $B_2H_6$(against $SiH_4$) | 12→0.3 ppm ** | | | | |
| | | NO | 0.1 | | | | |
| | 3rd layer region | $AlCl_3$/He | 0.1 | 300 | 20 | 0.5 | 3 |
| | | $SiF_4$ | 0.5 | | | | |
| | | $SiH_4$ | 300 | | | | |
| | | $H_2$ | 300 | | | | |
| | | NO | 0.1 | | | | |
| | | $C_2H_2$ | 0.1 | | | | |
| | | $B_2H_6$(against $SiH_4$) | 0.3 ppm | | | | |
| | 4th layer region | $SiH_4$ | 50 | 300 | 10 | 0.4 | 0.5 |
| | | $C_2H_2$ | 30 | | | | |
| | | NO | 0.1 | | | | |
| | | $B_2H_6$(against $SiH_4$) | 0.3 ppm | | | | |
| | | $AlCl_3$/He | 0.1 | | | | |
| | | $SiF_4$ | 0.5 | | | | |

TABLE 123

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 50 | 250 | 5 | 0.4 | 0.05 |
| | | $SiF_4$ | 5 | | | | |
| | | $H_2$ | 10→200 * | | | | |
| | | $AlCl_3$/He | 120→40 ** | | | | |
| | | NO | 5 | | | | |
| Upper layer | 1st layer region | $SiH_4$ | 100 | 250 | 10 | 0.35 | 3 |
| | | $H_2$ | 100 | | | | |
| | | NO | 30 | | | | |
| | 2nd layer region | $SiH_4$ | 300 | 250 | 15 | 0.5 | 20 |
| | | $H_2$ | 300 | | | | |
| | 3rd layer region | $SiH_4$ | 50 | 250 | 10 | 0.4 | 0.5 |
| | | $CH_4$ | 500 | | | | |

TABLE 124

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 50 | 250 | 5 | 0.4 | 0.05 |
| | | $AlCl_3$/He | 120→40 ** | | | | |
| Upper layer | 1st layer region | $SiH_4$ | 100 | 250 | 10 | 0.35 | 3 |
| | | $H_2$ | 100 | | | | |
| | | NO | 30 | | | | |
| | 2nd layer region | $SiH_4$ | 300 | 250 | 15 | 0.5 | 20 |
| | | $H_2$ | 300 | | | | |
| | 3rd layer region | $SiH_4$ | 50 | 250 | 10 | 0.4 | 0.5 |
| | | $CH_4$ | 500 | | | | |

TABLE 125

| Order of lamination (layer name) | Gases and their flow rates (SCCM) | | Substrate temperature (°C.) | RF discharging power (mW/cm³) | Inner pressure (Torr) | Layer thickness (μm) |
|---|---|---|---|---|---|---|
| Lower layer | $SiH_4$ | 50 | 250 | 5 | 0.4 | 0.02 |
| | $SiF_4$ | 5 | | | | |
| | $H_2$ | 10→200 * | | | | |
| | $AlCl_3$/He | | | | | |
| | (S-side: 0.01 μm) | 100→10 ** | | | | |
| | (UL-side: 0.01 μm) | 10 | | | | |

TABLE 125-continued

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Upper layer | 1st layer region | $SiH_4$ | 100 | 250 | 10 | 0.35 | 3 |
| | | $H_2$ | 100 | | | | |
| | | NO | 30 | | | | |
| | 2nd layer region | $SiH_4$ | 300 | 250 | 15 | 0.5 | 20 |
| | | $H_2$ | 300 | | | | |
| | 3rd layer region | $SiH_4$ | 50 | 250 | 10 | 0.4 | 0.5 |
| | | $CH_4$ | 500 | | | | |

TABLE 126

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 50 | 150 | 0.5 | 0.3 | 0.02 |
| | | $H_2$ | 5→200 * | ↓ | ↓ | | |
| | | $AlCl_3$/He | | 300 | 1.5 | | |
| | | (S-side: 0.01 μm) | 200→30 ** | | | | |
| | | (UL-side: 0.01 μm) | 30→10 ** | | | | |
| | | NO | 5 | | | | |
| | | $SiF_4$ | 5 | | | | |
| | | $B_2H_6$(against $SiH_4$) | 100 ppm | | | | |
| Upper layer | 1st layer region | $SiH_4$ | 100 | 270 | 10 | 0.35 | 3 |
| | | $H_2$ | 100 | | | | |
| | | $B_2H_6$(against $SiH_4$) | 800 ppm | | | | |
| | | NO | 10 | | | | |
| | 2nd layer region | $SiH_4$ | 300 | 250 | 20 | 0.5 | 20 |
| | | $H_2$ | 500 | | | | |

TABLE 127

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 50 | 250 | 1 | 0.3 | 0.02 |
| | | $H_2$ | 5→200 * | | | | |
| | | $AlCl_3$/He | | | | | |
| | | (S-side: 0.01 μm) | 200→30 ** | | | | |
| | | (UL-side: 0.01 μm) | 30→10 ** | | | | |
| | | NO | 10 | | | | |
| | | $SiF_4$ | 5 | | | | |
| | | $B_2H_6$(against $SiH_4$) | 800 ppm | | | | |
| | | $CH_4$ | 1 | | | | |
| Upper layer | 1st layer region | $SiH_4$ | 100 | 250 | 10 | 0.35 | 3 |
| | | He | 100 | | | | |
| | | $AlCl_3$/He | 0.3 | | | | |
| | | $SiF_4$ | 0.5 | | | | |
| | | $CH_4$ | 1 | | | | |
| | | NO | | | | | |
| | | (LL-side: 2 μm) | 10 | | | | |
| | | (U · 2nd LR-side: 1 μm) | 10→1 ** | | | | |
| | | $B_2H_6$(against $SiH_4$) | 800 ppm | | | | |
| | 2nd layer region | $SiH_4$ | 300 | 250 | 25 | 0.6 | 25 |
| | | He | 600 | | | | |
| | | $AlCl_3$/He | 0.1 | | | | |
| | | $SiF_4$ | 0.2 | | | | |
| | | $CH_4$ | 0.5 | | | | |
| | | NO | 0.1 | | | | |
| | | $B_2H_6$(against $SiH_4$) | 0.3 ppm | | | | |
| | 3rd layer region | $SiH_4$ | 50 | 250 | 10 | 0.4 | 1 |
| | | $CH_4$ | 500 | | | | |
| | | NO | 0.5 | | | | |
| | | $SiF_4$ | 0.7 | | | | |
| | | $AlCl_3$/He | 0.5 | | | | |
| | | $B_2H_6$(against $SiH_4$) | 1 ppm | | | | |

TABLE 128

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 10→100 * | 250 | 10 | 0.4 | 0.2 |
| | | $H_2$ | 5→200 * | | | | |
| | | $Al(CH_3)_3$/He | | | | | |
| | | (S-side: 0.05 μm) | 200→40 ** | | | | |
| | | (UL-side: 0.15 μm) | 40→10 ** | | | | |
| | | $NH_3$ | 1→4 ** | | | | |
| | | $SiH_4$ | 1→10 * | | | | |
| Upper layer | 1st layer region | $SiH_4$ | 100 | 250 | 10 | 0.35 | 3 |
| | | $H_2$ | 100 | | | | |
| | | $PH_3$(against $SiH_4$) | 800 ppm | | | | |
| | | $NH_3$ | 4 | | | | |
| | 2nd layer region | $SiH_4$ | 400 | 250 | 10 | 0.5 | 15 |
| | | Ar | 200 | | | | |
| | 3rd layer region | $SiH_4$ | 100 | 250 | 5 | 0.4 | 0.3 |
| | | $NH_3$ | 30 | | | | |

TABLE 129

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 10→100 * | 300 | 10 | 0.4 | 0.2 |
| | | $H_2$ | 5→200 * | | | | |
| | | $AlCl_3$/He | | | | | |
| | | (S-side: 0.05 μm) | 200→40 ** | | | | |
| | | (UL-side: 0.15 μm) | 40→10 ** | | | | |
| | | $C_2H_2$ | 1→5 * | | | | |
| | | $B_2H_6$(against $SiH_4$) | 100 ppm | | | | |
| | | $SiF_4$ | 1→10 * | | | | |
| Upper layer | 1st layer region | $SiH_4$ | 100 | 300 | 10 | 0.35 | 3 |
| | | $H_2$ | 100 | | | | |
| | | $B_2H_6$(against $SiH_4$) | 1000 ppm | | | | |
| | | $C_2H_2$ | 5 | | | | |
| | 2nd layer region | $SiH_4$ | 300 | 300 | 20 | 0.5 | 20 |
| | | $H_2$ | 500 | | | | |
| | | $SiF_4$ | 50 | | | | |
| | 3rd layer region | $SiH_4$ | 100 | 300 | 15 | 0.4 | 7 |
| | | $CH_4$ | 600 | | | | |
| | | $PH_3$(against $SiH_4$) | 3000 ppm | | | | |
| | 4th layer region | $SiH_4$ | 40 | 300 | 10 | 0.4 | 0.1 |
| | | $CH_4$ | 600 | | | | |

TABLE 130

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 50 | 330 | 5 | 0.4 | 0.05 |
| | | $H_2$ | 5→200 * | | | | |
| | | $AlCl_3$/He | 200→20 ** | | | | |
| | | NO | 5 | | | | |
| | | $PH_3$ | 100 ppm | | | | |
| | | $SiF_4$ | 5 | | | | |
| Upper layer | 1st layer region | $SiH_4$ | 100 | 330 | 10 | 0.35 | 3 |
| | | $H_2$ | 100 | | | | |
| | | $PH_3$(against $SiH_4$) | 800 ppm | | | | |
| | | NO | 10 | | | | |
| | 2nd layer region | $SiH_4$ | 400 | 330 | 25 | 0.5 | 25 |
| | | $SiF_4$ | 10 | | | | |
| | | $H_2$ | 800 | | | | |
| | 3rd layer region | $SiH_4$ | 100 | 350 | 15 | 0.4 | 5 |
| | | $CH_4$ | 400 | | | | |
| | | $B_2H_6$(against $SiH_4$) | 5000 ppm | | | | |
| | 4th layer region | $SiH_4$ | 20 | 350 | 10 | 0.4 | 1 |
| | | $CH_4$ | 400 | | | | |
| | | $B_2H_6$(against $SiH_4$) | 800 ppm | | | | |

TABLE 131

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 50 | 300 | 1 | 0.3 | 0.02 |
| | | $H_2$ | 5→200 * | | | | |
| | | $AlCl_3$/He | | | | | |
| | | (S-side: 0.01 μm) | 200→30 ** | | | | |
| | | (UL-side: 0.01 μm) | 30→10 ** | | | | |
| | | $B_2H_6$(against $SiH_4$) | 100 ppm | | | | |
| | | $N_2$ | 100→150 * | | | | |
| | | $H_2S$ | 10 ppm | | | | |
| | | $SiF_4$ | 5 | | | | |
| Upper layer | 1st layer region | $SiH_4$ | 100 | 300 | 10 | 0.35 | 5 |
| | | $H_2$ | 150 | | | | |
| | | $B_2H_6$(against $SiH_4$) | 900→600 ppm ** | | | | |
| | | $N_2$ | 150 | | | | |
| | 2nd layer region | $SiH_4$ | 300 | 300 | 20 | 0.5 | 20 |
| | | $H_2$ | 200 | | | | |
| | 3rd layer region | $SiH_4$ | 50 | 300 | 20 | 0.4 | 5 |
| | | $N_2$ | 500 | | | | |
| | | $PH_3$(against $SiH_4$) | 3000 ppm | | | | |
| | 4th layer region | $SiH_4$ | 40 | 300 | 10 | 0.4 | 0.3 |
| | | $CH_4$ | 600 | | | | |

TABLE 132

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 50 | 250 | 1 | 0.4 | 0.02 |
| | | $SiF_4$ | 5 | | | | |
| | | $H_2$ | 5→200 * | | | | |
| | | $AlCl_3$/He | | | | | |
| | | (S-side: 0.01 μm) | 200→30 ** | | | | |
| | | (UL-side: 0.01 μm) | 30→10 ** | | | | |
| Upper layer | 1st layer region | $SiH_4$ | 100 | 250 | 10 | 0.4 | 3 |
| | | $H_2$ | 100 | | | | |
| | | $B_2H_6$(against $SiH_4$) | 1000 ppm | | | | |
| | | $C_2H_2$ | 5 | | | | |
| | 2nd layer region | $SiH_4$ | 300 | 250 | 15 | 0.5 | 10 |
| | | $H_2$ | 300 | | | | |
| | 3rd layer region | $SiH_4$ | 200 | 250 | 15 | 0.4 | 20 |
| | | $C_2H_2$ | 10→20 * | | | | |
| | | NO | 1 | | | | |

TABLE 133

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 50 | 250 | 1 | 0.4 | 0.02 |
| | | $H_2$ | 5→200 * | | | | |
| | | $AlCl_3$/He | | | | | |
| | | (S-side: 0.01 μm) | 200→30 ** | | | | |
| | | (UL-side: 0.01 μm) | 30→10 ** | | | | |
| | | $N_2$ | 100 | | | | |
| | | $H_2S$(against $SiH_4$) | 10 ppm | | | | |
| | | $BF_3$ | 10 ppm | | | | |
| Upper layer | 1st layer region | $SiH_4$ | 100 | 300 | 10 | 0.35 | 3 |
| | | $H_2$ | 150 | | | | |
| | | $BF_3$(against $SiH_4$) | 1000 ppm | | | | |
| | | $N_2$ | 150 | | | | |
| | 2nd layer region | $SiH_4$ | 300 | 300 | 20 | 0.5 | 5 |
| | | $H_2$ | 300 | | | | |
| | 3rd layer region | $SiH_4$ | 100 | 300 | 15 | 0.4 | 20 |
| | | $CH_4$ | 100 | | | | |
| | 4th layer region | $SiH_4$ | 50 | 300 | 10 | 0.4 | 0.5 |
| | | $CH_4$ | 600 | | | | |

TABLE 134

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 10→100* | 300 | 5 | 0.4 | 0.2 |
| | | $H_2$ | 5→200* | | | | |
| | | $AlCl_3$/He | | | | | |
| | | (S-side: 0.05 μm) | 200→40** | | | | |
| | | (UL-side: 0.15 μm) | 40→10** | | | | |
| | | $NH_3$ | 1→5* | | | | |
| | | $SiF_4$ | 1→10* | | | | |
| Upper layer | 1st layer region | $SiH_4$ | 100 | 300 | 10 | 0.35 | 3 |
| | | $H_2$ | 100 | | | | |
| | | $PH_3$ (against $SiH_4$) | 800 ppm | | | | |
| | | $NH_3$ | 5 | | | | |
| | 2nd layer region | $SiH_4$ | 100 | 300 | 5 | 0.2 | 8 |
| | | $H_2$ | 300 | | | | |
| | 3rd layer region | $SiH_4$ | 300 | 300 | 15 | 0.4 | 25 |
| | | $NH_3$ | 50 | | | | |
| | 4th layer region | $SiH_4$ | 100 | 300 | 10 | 0.4 | 0.3 |
| | | $NH_4$ | 50 | | | | |

TABLE 135

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 10→100* | 250 | 5 | 0.4 | 0.2 |
| | | $H_2$ | 5→200* | | | | |
| | | $AlCl_3$/He | | | | | |
| | | (S-side: 0.05 μm) | 200→40** | | | | |
| | | (UL-side: 0.15 μm) | 40→10** | | | | |
| | | NO | 5→10* | | | | |
| | | $PF_5$ (against $SiH_4$) | 10→100 ppm* | | | | |
| Upper layer | 1st layer region | $SiH_4$ | 100 | 280 | 10 | 0.35 | 3 |
| | | $H_2$ | 100 | | | | |
| | | $PF_5$ (against $SiH_4$) | 1000 ppm | | | | |
| | | NO | 10 | | | | |
| | 2nd layer region | $SiH_4$ | 100 | 300 | 3 | 0.5 | 3 |
| | | $SiF_4$ | 5 | | | | |
| | | $H_2$ | 200 | | | | |
| | 3rd layer region | $SiH_4$ | 100 | 300 | 15 | 0.4 | 30 |
| | | $CH_4$ | 100 | | | | |
| | | $PH_3$ (against $SiH_4$) | 50 ppm | | | | |
| | 4th layer region | $SiH_4$ | 50 | 300 | 10 | 0.4 | 0.5 |
| | | $CH_4$ | 600 | | | | |

TABLE 136

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 50 | 250 | 5 | 0.4 | 0.05 |
| | | $H_2$ | 5→200* | | | | |
| | | $AlCl_3$/He | 200→20** | | | | |
| | | NO | 10 | | | | |
| | | $B_2H_6$ (against $SiH_4$) | 100 ppm | | | | |
| | | $Si_2F_6$ | 5 | | | | |
| Upper layer | 1st layer region | $SiH_4$ | 100 | 300 | 10 | 0.35 | 3 |
| | | $H_2$ | 100 | | | | |
| | | $B_2H_6$ (against $SiH_4$) | 800 ppm | | | | |
| | | NO | | | | | |
| | | (LL-side: 2 μm) | 10 | | | | |
| | | (U · 2nd LR-side: 1 μm) | 10→0** | | | | |
| | 2nd layer region | $Si_2H_6$ | 200 | 300 | 10 | 0.5 | 10 |
| | | $H_2$ | 200 | | | | |
| | 3rd layer region | $SiH_4$ | 300 | 330 | 20 | 0.4 | 30 |
| | | $C_2H_2$ | 50 | | | | |
| | | $B_2H_6$ (against $SiH_4$) | 100 ppm | | | | |
| | 4th layer region | $SiH_4$ | 200 | 330 | 10 | 0.4 | 1 |
| | | $C_2H_2$ | 200 | | | | |

TABLE 137

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 10→100* | 250 | 5 | 0.4 | 0.2 |
| | | $H_2$ | 5→200* | | | | |
| | | $AlCl_3$/He | | | | | |
| | | (S-side: 0.05 μm) | 200→40** | | | | |
| | | (UL-side: 0.15 μm) | 40→10** | | | | |
| | | $NH_3$ | 1→5* | | | | |
| | | $B_2H_6$ (against $SiH_4$) | 150 ppm | | | | |
| | | $Si_2F_6$ | 1→8* | | | | |
| Upper layer | 1st layer region | $SiH_4$ | 100 | 270 | 10 | 0.35 | 3 |
| | | $H_2$ | 100 | | | | |
| | | $B_2H_6$ (against $SiH_4$) | 800 ppm | | | | |
| | | $NH_3$ | 5 | | | | |
| | 2nd layer region | $SiH_4$ | 100 | 300 | 5 | 0.2 | 8 |
| | | $H_2$ | 300 | | | | |
| | 3rd layer region | $SiH_4$ | 300 | 300 | 15 | 0.4 | 25 |
| | | $NH_3$ | 30→50* | | | | |
| | | $PF_5$ (against $SiH_4$) | 50 ppm | | | | |
| | 4th layer region | $SiH_4$ | 100 | 300 | 5 | 0.4 | 0.7 |
| | | $NH_3$ | 80→100* | | | | |
| | | $PF_5$ (against $SiH_4$) | 500 ppm | | | | |

TABLE 138

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 50 | 250 | 1 | 0.4 | 0.02 |
| | | $H_2$ | 5→200* | | | | |
| | | $AlCl_3$/He | | | | | |
| | | (S-side: 0.01 μm) | 200→30** | | | | |
| | | (UL-side: 0.01 μm) | 30→10** | | | | |
| | | NO | 5 | | | | |
| | | $SiF_5$ | 5 | | | | |
| Upper layer | 1st layer region | $SiH_4$ | 100 | 250 | 10 | 0.35 | 3 |
| | | $H_2$ | 100 | | | | |
| | | $B_2H_6$ (against $SiH_4$) | 800 ppm | | | | |
| | | NO | | | | | |
| | | (LL-side: 2 μm) | 10 | | | | |
| | | (U · 2nd LR-side: 1 μm) | 10→0** | | | | |
| | 2nd layer region | $SiH_4$ | 300 | 300 | 20 | 0.5 | 20 |
| | | $H_2$ | 500 | | | | |
| | 3rd layer region | $SiH_4$ | 100 | 300 | 5 | 0.4 | 1 |
| | | $GeH_4$ | 10→50* | | | | |
| | | $H_2$ | 300 | | | | |
| | 4th layer region | $SiH_4$ | 100→40** | 300 | 10 | 0.4 | 1 |
| | | $CH_4$ | 100→600* | | | | |

TABLE 139

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 50 | 300 | 1 | 0.3 | 0.02 |
| | | $H_2$ | 5→200* | | | | |
| | | $AlCl_3$/He | | | | | |
| | | (S-side: 0.01 μm) | 200→30** | | | | |
| | | (UL-side: 0.01 μm) | 30→10** | | | | |
| | | NO | 9 | | | | |
| | | $B_2H_6$ (against $SiH_4$) | 80 ppm | | | | |
| | | $SiF_4$ | 5 | | | | |
| Upper layer | 1st layer region | $SiH_4$ | 85 | 330 | 9 | 0.35 | 3 |
| | | $H_2$ | 95 | | | | |
| | | $B_2H_6$ (against $SiH_4$) | 800 ppm | | | | |
| | | NO | 9 | | | | |
| | 2nd layer region | $SiH_4$ | 300 | 300 | 15 | 0.5 | 20 |
| | | $H_2$ | 400 | | | | |
| | 3rd layer region | $SiH_4$ | 50 | 300 | 10 | 0.4 | 0.5 |
| | | $CH_4$ | 500 | | | | |

TABLE 140

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 50 | 300 | 0.7 | 0.3 | 0.02 |
| | | $H_2$ | 5→200* | | | | |
| | | $AlCl_3$/He | | | | | |
| | | (S-side: 0.01 μm) | 200→30** | | | | |
| | | (UL-side: 0.01 μm) | 30→10** | | | | |
| | | NO | 8 | | | | |
| | | $B_2H_6$ (against $SiH_4$) | 80 ppm | | | | |
| | | $SiF_4$ | 5 | | | | |
| Upper layer | 1st layer region | $SiH_4$ | 75 | 300 | 8 | 0.35 | 3 |
| | | $H_2$ | 80 | | | | |
| | | $B_2H_6$ (against $SiH_4$) | 800 ppm | | | | |
| | | NO | 8 | | | | |
| | 2nd layer region | $SiH_4$ | 200 | 300 | 12 | 0.4 | 20 |
| | | $H_2$ | 400 | | | | |
| | 3rd layer region | $SiH_4$ | 40 | 300 | 7 | 0.3 | 0.5 |
| | | $CH_2$ | 400 | | | | |

TABLE 141

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 25 | 300 | 0.5 | 0.2 | 0.02 |
| | | $H_2$ | 5→100* | | | | |
| | | $AlCl_3$/He | | | | | |
| | | (S-side: 0.01 μm) | 100→15** | | | | |
| | | (UL-side: 0.01 μm) | 15→5** | | | | |
| | | NO | 7 | | | | |
| | | $B_2H_6$ (against $SiH_4$) | 80 ppm | | | | |
| | | $SiF_4$ | 4 | | | | |
| Upper layer | 1st layer region | $SiH_4$ | 55 | 300 | 7 | 0.35 | 3 |
| | | $H_2$ | 70 | | | | |
| | | $B_2H_6$ (against $SiH_4$) | 800 ppm | | | | |
| | | NO | 7 | | | | |
| | 2nd layer region | $SiH_4$ | 150 | 300 | 10 | 0.4 | 20 |
| | | $H_2$ | 300 | | | | |
| | 3rd layer region | $SiH_4$ | 30 | 300 | 5 | 0.3 | 0.5 |
| | | $CH_4$ | 300 | | | | |

TABLE 142

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 20 | 300 | 0.3 | 0.2 | 0.02 |
| | | $H_2$ | 5→100* | | | | |
| | | $AlCl_3$/He | | | | | |
| | | (S-side: 0.01 μm) | 80→15** | | | | |
| | | (UL-side: 0.01 μm) | 15→5** | | | | |
| | | NO | 5 | | | | |
| | | $B_2H_6$ (against $SiH_4$) | 80 ppm | | | | |
| | | $SiF_4$ | 4 | | | | |
| Upper layer | 1st layer region | $SiH_4$ | 45 | 300 | 6 | 0.35 | 3 |
| | | $H_2$ | 60 | | | | |
| | | $B_2H_6$ (against $SiH_4$) | 800 ppm | | | | |
| | | NO | 5 | | | | |
| | 2nd layer region | $SiH_4$ | 100 | 300 | 6 | 0.3 | 20 |
| | | $H_2$ | 300 | | | | |
| | 3rd layer region | $SiH_4$ | 20 | 300 | 3 | 0.2 | 0.5 |
| | | $CH_4$ | 200 | | | | |

TABLE 143

| Order of lamination (layer name) | Gases and their flow rates (SCCM) | | Substrate temperature (°C.) | RF discharging power (mW/cm³) | Inner pressure (Torr) | Layer thickness (μm) |
|---|---|---|---|---|---|---|
| Lower layer | $SiH_4$ | 50 | 500 | 5 | 0.4 | 0.05 |
| | $H_2$ | 5→200* | | | | |

TABLE 143-continued

| Order of lamination (layer name) | | Gases and their flow rates (SCCM) | | Substrate temperature (°C.) | RF discharging power (mW/cm$^3$) | Inner pressure (Torr) | Layer thickness (μm) |
|---|---|---|---|---|---|---|---|
| | | $AlCl_3$/He | 200→20** | | | | |
| | | $C_2H_2$ | 5 | | | | |
| | | $B_2H_6$ (against $SiH_4$) | 60 ppm | | | | |
| | | $SiF_4$ | 5 | | | | |
| Upper layer | 1st layer region | $SiH_4$ | 180 | 500 | 22 | 0.4 | 4 |
| | | $H_2$ | 1200 | | | | |
| | | $B_2H_6$ (against $SiH_4$) | 700 ppm | | | | |
| | | $C_2H_2$ | 8 | | | | |
| | 2nd layer region | $SiH_4$ | 300 | 500 | 30 | 0.5 | 10 |
| | | $H_2$ | 1500 | | | | |
| | 3rd layer region | $SiH_4$ | 200 | 500 | 30 | 0.4 | 20 |
| | | $C_2H_2$ | 10→20* | | | | |
| | | NO | 1 | | | | |

TABLE 144

| Order of lamination (layer name) | | Gases and their flow rates (SCCM) | | Substrate temperature (°C.) | μW discharging power (mW/cm$^3$) | Inner pressure (Torr) | Layer thickness (μm) |
|---|---|---|---|---|---|---|---|
| Lower layer | | $SiH_4$ | 150 | 250 | 0.5 | 0.6 | 0.02 |
| | | $H_2$ | 20→500* | | | | |
| | | $AlCl_3$/He | | | | | |
| | | (S-side: 0.01 μm) | 400→80** | | | | |
| | | (UL-side: 0.01 μm) | 80→50** | | | | |
| | | NO | 10 | | | | |
| | | $B_2H_6$ (against $SiH_4$) | 60 ppm | | | | |
| | | $SiF_4$ | 10 | | | | |
| Upper layer | 1st layer region | $SiH_4$ | 350 | 250 | 0.5 | 0.5 | 3 |
| | | $H_2$ | 350 | | | | |
| | | $B_2H_6$ (against $SiH_4$) | 600 ppm | | | | |
| | | NO | 13 | | | | |
| | | $SiF_4$ | 20 | | | | |
| | 2nd layer region | $SiH_4$ | 700 | 250 | 0.5 | 0.5 | 20 |
| | | $SiF_4$ | 30 | | | | |
| | | $H_2$ | 500 | | | | |
| | 3rd layer region | $SiH_4$ | 150 | 250 | 0.5 | 0.3 | 1 |
| | | $CH_4$ | 500 | | | | |

TABLE 145

| Order of lamination (layer name) | | Gases and their flow rates (SCCM) | | Substrate temperature (°C.) | RF discharging power (mW/cm$^3$) | Inner pressure (Torr) | Layer thickness (μm) |
|---|---|---|---|---|---|---|---|
| Lower layer | | $SiH_4$ | 50 | 250 | 5 | 0.4 | 0.05 |
| | | $H_2$ | 5→200* | | | | |
| | | $AlCl_3$/He | 200→20** | | | | |
| | | $C_2H_2$ | 5 | | | | |
| | | $B_2H_6$ (against $SiH_4$) | 100 ppm | | | | |
| | | $SiF_4$ | 5 | | | | |
| Upper layer | 1st layer region | $SiH_4$ | 100 | 250 | 10 | 0.35 | 3 |
| | | $H_2$ | 100 | | | | |
| | | $B_2H_6$ (against $iH_4$) | 1000 ppm | | | | |
| | | $C_2H_2$ | 5 | | | | |
| | | $SiF_4$ | 5 | | | | |
| | 2nd layer region | $SiH_4$ | 200 | 250 | 15 | 0.4 | 20 |
| | | $C_2H_2$ | 10→200* | | | | |
| | | NO | 1 | | | | |
| | | $SiF_4$ | 5 | | | | |
| | 3rd layer region | $SiH_4$ | 300 | 250 | 15 | 0.5 | 10 |
| | | $H_2$ | 300 | | | | |
| | | $SiF_4$ | 5 | | | | |

TABLE 146

| Order of lamination (layer name) | Gases and their flow rates (SCCM) | | Substrate temperature (°C.) | RF discharging power (mW/cm$^3$) | Inner pressure (Torr) | Layer thickness (μm) |
|---|---|---|---|---|---|---|
| Lower layer | $SiH_4$ | 50 | 250 | 1 | 0.4 | 0.02 |
| | $H_2$ | 5→200* | | | | |
| | $AlCl_3$/He | | | | | |
| | (S-side: 0.01 μm) | 200→30** | | | | |
| | (UL-side: 0.01 μm) | 30→10** | | | | |

TABLE 146-continued

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| | | $N_2$ | 100 | | | | |
| | | $B_2H_6$ (against $SiH_4$) | 10 ppm | | | | |
| | | $SiF_4$ | 1→10* | | | | |
| Upper layer | 1st layer region | $SiH_4$ | 100 | 300 | 10 | 0.35 | 3 |
| | | $H_2$ | 150 | | | | |
| | | $B_2H_6$ (against $SiH_4$) | 900→600 ppm** | | | | |
| | | $N_2$ | 150 | | | | |
| | 2nd layer region | $SiH_4$ | 100 | 300 | 15 | 0.4 | 20 |
| | | $CH_2$ | 100 | | | | |
| | 3rd layer region | $SiH_4$ | 300 | 300 | 20 | 0.5 | 5 |
| | | $H_2$ | 300 | | | | |
| | 4th layer region | $SiH_4$ | 50 | 300 | 10 | 0.4 | 0.5 |
| | | $CH_4$ | 600 | | | | |

TABLE 147

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 10→100* | 300 | 5 | 0.4 | 0.02 |
| | | $H_2$ | 5→200* | | | | |
| | | $AlCl_3$/He | | | | | |
| | | (S-side: 0.05 μm) | 200→40** | | | | |
| | | (UL-side: 0.15 μm) | 40→10** | | | | |
| | | $NH_3$ | 1→5* | | | | |
| | | $SiF_4$ | 10 | | | | |
| Upper layer | 1st layer region | $SiH_4$ | 100 | 300 | 10 | 0.35 | 3 |
| | | $H_2$ | 100 | | | | |
| | | $PF_5$ (against $SiH_4$) | 800 ppm | | | | |
| | | $NH_3$ | 5 | | | | |
| | 2nd layer region | $SiH_4$ | 300 | 300 | 15 | 0.4 | 25 |
| | | $NH_2$ | 50 | | | | |
| | 3rd layer region | $SiH_4$ | 100 | 300 | 5 | 0.2 | 8 |
| | | $H_2$ | 300 | | | | |
| | | $Si_2F_6$ | 5 | | | | |
| | 4th layer region | $SiH_4$ | 100 | 300 | 10 | 0.4 | 0.3 |
| | | $NH_3$ | 50 | | | | |

TABLE 148

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 10→100* | 250 | 5 | 0.4 | 0.2 |
| | | $H_2$ | 5→200* | | | | |
| | | $AlCl_3$/He | | | | | |
| | | (S-side: 0.05 μm) | 200→40** | | | | |
| | | (UL-side: 0.15 μm) | 40→10** | | | | |
| | | NO | 5→10* | | | | |
| | | $PF_5$ (against $SiH_4$) | 10→100 ppm* | | | | |
| Upper layer | 1st layer region | $SiH_4$ | 100 | 250 | 10 | 0.35 | 3 |
| | | $H_2$ | 100 | | | | |
| | | $PF_5$ (against $SiH_4$) | 1000 ppm | | | | |
| | | NO | 10 | | | | |
| | 2nd layer region | $SiH_4$ | 100 | 300 | 15 | 0.4 | 30 |
| | | $CH_4$ | 100 | | | | |
| | | $PF_5$ (against $SiH_4$) | 50 ppm | | | | |
| | 3rd layer region | $SiH_4$ | 100 | 300 | 3 | 0.5 | 3 |
| | | $SiF_4$ | 5 | | | | |
| | | $H_2$ | 200 | | | | |
| | 4th layer region | $SiH_4$ | 50 | 300 | 10 | 0.4 | 0.5 |
| | | $CH_4$ | 600 | | | | |

TABLE 149

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 50 | 250 | 5 | 0.4 | 0.05 |
| | | $H_2$ | 5→200* | | | | |
| | | $AlCl_3$/He | 200→20** | | | | |
| | | NO | 10 | | | | |
| | | $B_2H_6$ (against $SiH_4$) | 100 ppm | | | | |
| | | $SiF_4$ | 5 | | | | |
| Upper layer | 1st layer region | $SiH_4$ | 100 | 300 | 10 | 0.35 | 3 |
| | | $H_2$ | 100 | | | | |
| | | $B_2H_6$ (against $SiH_4$) | 800 ppm | | | | |
| | | NO | | | | | |
| | | (LL-side: 2 μm) | 10 | | | | |
| | | (U · 2nd LR-side: 1 μm) | 10→0** | | | | |
| | 2nd layer region | $SiH_4$ | 300 | 330 | 20 | 0.4 | 30 |
| | | $C_2H_2$ | 50 | | | | |
| | | $B_2H_6$ (against $SiH_4$) | 100 ppm | | | | |
| | 3rd layer region | $Si_2H_6$ | 200 | 300 | 10 | 0.5 | 10 |
| | | $H_2$ | 200 | | | | |
| | 4th layer region | $SiH_4$ | 200 | 330 | 10 | 0.4 | 1 |
| | | $C_2H_2$ | 200 | | | | |

TABLE 150

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 10→100* | 250 | 5 | 0.4 | 0.2 |
| | | $SiF_4$ | 1→10* | | | | |
| | | $NH_3$ | 1→5* | | | | |
| | | $H_2$ | 5→200* | | | | |
| | | $AlCl_3$/He | | | | | |
| | | (S-side: 0.05 μm) | 200→40** | | | | |
| | | (UL-side: 0.15 μm) | 40→10** | | | | |
| Upper layer | 1st layer region | $SiH_4$ | 100 | 300 | 10 | 0.4 | 3 |
| | | $H_2$ | 100 | | | | |
| | | $PF_5$ (against $SiH_4$) | 800 ppm | | | | |
| | | $NH_3$ | 5 | | | | |
| | 2nd layer region | $SiH_4$ | 300 | 300 | 15 | 0.4 | 25 |
| | | $NH_3$ | 30→50* | | | | |
| | | $PH_3$ (against $SiH_4$) | 50 ppm | | | | |
| | 3rd layer region | $SiH_4$ | 100 | 300 | 5 | 0.4 | 8 |
| | | $H_2$ | 300 | | | | |
| | 4th layer region | $SiH_4$ | 100 | 300 | 5 | 0.4 | 0.7 |
| | | $NH_3$ | 80→100* | | | | |
| | | $B_2H_6$ (against $SiH_4$) | 500 ppm | | | | |

TABLE 151

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 50 | 250 | 1 | 0.3 | 0.02 |
| | | $H_2$ | 5→200* | | | | |
| | | $AlCl_3$/He | | | | | |
| | | (S-side: 0.01 μm) | 200→30** | | | | |
| | | (UL-side: 0.01 μm) | 30→10** | | | | |
| | | NO | 10 | | | | |
| | | $SiF_4$ | 5 | | | | |
| | | $B_2H_6$ (against $SiH_4$) | 800 ppm | | | | |
| Upper layer | 1st layer region | $SiH_4$ | 100 | 250 | 10 | 0.35 | 3 |
| | | He | 100 | | | | |
| | | NO | | | | | |
| | | (LL-side: 2 μm) | 10 | | | | |
| | | (U · 2nd LR-side: 1 μm) | 10→0** | | | | |
| | | $B_2H_6$ (against $SiH_4$) | 800 ppm | | | | |
| | 2nd layer region | $SiH_4$ | 300 | 250 | 25 | 0.6 | 25 |
| | | He | 600 | | | | |
| | | $B_2H_6$ (against $SiH_4$) | 0.3 ppm | | | | |
| | 3rd layer region | $SiH_4$ | 50 | 250 | 10 | 0.4 | 1 |
| | | $CH_4$ | 500 | | | | |

TABLE 152

| Order of lamination (layer name) | | Gases and their flow rates (SCCM) | | Substrate temperature (°C.) | RF discharging power (mW/cm$^3$) | Inner pressure (Torr) | Layer thickness (μm) |
|---|---|---|---|---|---|---|---|
| Lower layer | | $SiH_4$ | 10→100* | 300 | 10 | 0.4 | 0.2 |
| | | $H_2$ | 5→200* | | | | |
| | | $AlCl_3$/He | | | | | |
| | | (S-side: 0.05 μm) | 200→40** | | | | |
| | | (UL-side: 0.15 μm) | 40→10** | | | | |
| | | $C_2H_2$ | 1→5* | | | | |
| | | $B_2H_6$ (against $SiH_4$) | 100 ppm | | | | |
| | | $SiF_4$ | 5 | | | | |
| Upper layer | 1st layer region | $SiH_4$ | 100 | 300 | 10 | 0.35 | 3 |
| | | $H_2$ | 100 | | | | |
| | | $B_2H_6$ (against $SiH_4$) | 1000 ppm | | | | |
| | | $C_2H_2$ | 5 | | | | |
| | | $AlCl_3$/He | 0.1 | | | | |
| | | NO | 0.1 | | | | |
| | | $SiF_4$ | 0.5 | | | | |
| | 2nd layer region | $SiH_4$ | 300 | 300 | 20 | 0.5 | 20 |
| | | $H_2$ | 500 | | | | |
| | | $C_2H_2$ | 0.1 | | | | |
| | | $AlCl_3$/He | 0.1 | | | | |
| | | NO | 0.1 | | | | |
| | | $SiF_4$ | 0.5 | | | | |
| | | $B_2H_6$ | 0.3 ppm | | | | |
| | 3rd layer region | $SiH_4$ | 100 | 300 | 15 | 0.4 | 7 |
| | | $CH_4$ | 600 | | | | |
| | | $PH_3$ (against $SiH_4$) | 3000 ppm | | | | |
| | | $AlCl_3$/He | 0.1 | | | | |
| | | NO | 0.1 | | | | |
| | | $SiF_4$ | 0.5 | | | | |
| | | $B_2H_6$ | 0.3 ppm | | | | |
| | 4th layer region | $SiH_4$ | 40 | 300 | 10 | 0.4 | 0.1 |
| | | $CH_4$ | 600 | | | | |
| | | $AlCl_3$/He | 0.1 | | | | |
| | | NO | 0.1 | | | | |
| | | $SiF_4$ | 0.5 | | | | |
| | | $B_2H_6$ | 0.3 | | | | |
| | | $PH_3$ | 0.3 ppm | | | | |

TABLE 153

| Order of lamination (layer name) | | Gases and their flow rates (SCCM) | | Substrate temperature (°C.) | RF discharging power (mW/cm$^3$) | Inner pressure (Torr) | Layer thickness (μm) |
|---|---|---|---|---|---|---|---|
| Lower layer | | $SiH_4$ | 10→100* | 250 | 5 | 0.4 | 0.2 |
| | | $H_2$ | 5→200* | | | | |
| | | $AlCl_3$/He | | | | | |
| | | (S-side: 0.05 μm) | 200→40** | | | | |
| | | (UL-side: 0.15 μm) | 40→10** | | | | |
| | | NO | 5→10* | | | | |
| | | $PH_3$ (against $SiH_4$) | 10→100 ppm* | | | | |
| | | $SiF_4$ | 5 | | | | |
| Upper layer | 1st layer region | $SiH_4$ | 100 | 280 | 10 | 0.35 | 3 |
| | | $H_2$ | 100 | | | | |
| | | $PH_3$ (against $SiH_4$) | 800 ppm | | | | |
| | | NO | 10 | | | | |
| | | $AlCl_3$/He | 0.1 | | | | |
| | | $SiF_4$ | 0.5 | | | | |
| | | $CH_4$ | 1 | | | | |
| | 2nd layer region | $SiH_4$ | 100 | 300 | 3 | 0.5 | 3 |
| | | $SiF_4$ | 5 | | | | |
| | | $H_2$ | 200 | | | | |
| | | $PH_3$ | 0.3 ppm | | | | |
| | | NO | 0.1 | | | | |
| | | $CH_4$ | 1 | | | | |
| | | $AlCl_3$/He | 0.1 | | | | |
| | 3rd layer region | $SiH_4$ | 100 | 300 | 15 | 0.4 | 30 |
| | | $CH_4$ | 100 | | | | |
| | | $PH_3$ (against $SiH_4$) | 50 ppm | | | | |
| | | $AlCl_3$/He | 0.1 | | | | |
| | | NO | 500 | | | | |
| | | $SiF_4$ | 0.5 | | | | |
| | 4th layer region | $SiH_4$ | 50 | 300 | 10 | 0.4 | 0.5 |
| | | $CH_4$ | 600 | | | | |
| | | $AlCl_3$/He | 0.1 | | | | |
| | | $SiF_4$ | 0.5 | | | | |

TABLE 153-continued

| Order of lamination (layer name) | Gases and their flow rates (SCCM) | | Substrate temperature (°C.) | RF discharging power (mW/cm$^3$) | Inner pressure (Torr) | Layer thickness (μm) |
|---|---|---|---|---|---|---|
| | NO | 0.1 | | | | |
| | $PH_3$ | 0.3 ppm | | | | |

TABLE 154

| Order of lamination (layer name) | | Gases and their flow rates (SCCM) | | Substrate temperature (°C.) | RF discharging power (mW/cm$^3$) | Inner pressure (Torr) | Layer thickness (μm) |
|---|---|---|---|---|---|---|---|
| Lower layer | | $SiH_4$ | 50 | 250 | 5 | 0.4 | 0.03 |
| | | $H_2$ | 10→200* | | | | |
| | | $AlCl_3$/He (S-side: 0.01 μm) | 100→10** | | | | |
| | | (UL-side: 0.01 μm) | 10 | | | | |
| | | $C_2H_2$ | 3→13* | | | | |
| | | $B_2H_6$ (against $SiH_4$) | 100 ppm | | | | |
| | | $SiF_4$ | 10 | | | | |
| Upper layer | 1st layer region | $SiH_4$ | 100 | 250 | 10 | 0.5 | 2 |
| | | $B_2H_6$ (against $SiH_4$) | 1500 ppm | | | | |
| | | $C_2H_2$ | 13 | | | | |
| | | $H_2$ | 300 | | | | |
| | | NO | 1 | | | | |
| | 2nd layer region | $SiH_4$ | 100 | 250 | 25 | 0.5 | 22 |
| | | $H_2$ | 300 | | | | |
| | | $C_2H_2$ | 15 | | | | |
| | | $B_2H_6$ (against $SiH_4$) | 40 ppm | | | | |
| | 3rd layer region | $SiH_4$ | 100 | 250 | 20 | 0.5 | 5 |
| | | $C_2H_2$ | 10 | | | | |
| | | $H_2$ | 150 | | | | |
| | 4th layer region | $SiH_4$ | 60 | 250 | 10 | 0.4 | 0.5 |
| | | $C_2H_2$ | 60 | | | | |
| | | $H_2$ | 50 | | | | |

TABLE 155

| Order of lamination (layer name) | | Gases and their flow rates (SCCM) | | Substrate temperature (°C.) | RF discharging power (mW/cm$^3$) | Inner pressure (Torr) | Layer thickness (μm) |
|---|---|---|---|---|---|---|---|
| Lower layer | | $SiH_4$ | 50 | 250 | 5 | 0.4 | 0.03 |
| | | $H_2$ | 10→200* | | | | |
| | | $AlCl_3$/He (S-side: 0.01 μm) | 100→10** | | | | |
| | | (UL-side: 0.01 μm) | 10 | | | | |
| | | $C_2H_2$ | 3→13* | | | | |
| | | $PH_3$ (against $SiH_4$) | 10→100 ppm* | | | | |
| | | $SiF_4$ | 10 | | | | |
| Upper layer | 1st layer region | $SiH_4$ | 100 | 250 | 10 | 0.5 | 2 |
| | | $C_2H_2$ | 13 | | | | |
| | | $PH_3$ (against $SiH_4$) | 1500 ppm | | | | |
| | | $H_2$ | 300 | | | | |
| | | NO | 1 | | | | |
| | 2nd layer region | $SiH_4$ | 100 | 250 | 25 | 0.5 | 22 |
| | | $C_2H_2$ | 15 | | | | |
| | | $H_2$ | 300 | | | | |
| | 3rd layer region | $SiH_4$ | 100 | 250 | 20 | 0.5 | 5 |
| | | $C_2H_2$ | 10 | | | | |
| | | $H_2$ | 150 | | | | |
| | 4th layer region | $SiH_4$ | 60 | 250 | 10 | 0.4 | 0.5 |
| | | $C_2H_2$ | 60 | | | | |
| | | $H_2$ | 50 | | | | |

TABLE 156

| Order of lamination (layer name) | Gases and their flow rates (SCCM) | | Substrate temperature (°C.) | RF discharging power (mW/cm$^3$) | Inner pressure (Torr) | Layer thickness (μm) |
|---|---|---|---|---|---|---|
| Lower layer | $SiH_4$ | 10→100* | 300 | 10 | 0.4 | 0.2 |
| | $H_2$ | 5→200* | | | | |
| | $AlCl_3$/He (S-Side: 0.05 μm) | 200→40** | | | | |

TABLE 156-continued

| Order of lamination (layer name) | | Gases and their flow rates (SCCM) | | Substrate temperature (°C.) | RF discharging power (mW/cm$^3$) | Inner pressure (Torr) | Layer thickness (μm) |
|---|---|---|---|---|---|---|---|
| | | (UL-side: 0.15 μm) | | | | | |
| | | | 40→10** | | | | |
| | | $C_2H_2$ | 1→5* | | | | |
| | | $B_2H_6$ | | | | | |
| | | (against $SiH_4$) | 100 ppm | | | | |
| | | $SiF_4$ | 5 | | | | |
| Upper layer | 1st layer region | $SiH_4$ | 100 | 300 | 10 | 0.35 | 3 |
| | | $H_2$ | 100 | | | | |
| | | $B_2H_6$ | | | | | |
| | | (against $SiH_4$) | 1000 ppm | | | | |
| | | $C_2H_2$ | 5 | | | | |
| | | $AlCl_3$/He | 0.1 | | | | |
| | | NO | 0.1 | | | | |
| | | $H_2S$ | 1 ppm | | | | |
| | | $SiF_4$ | 0.5 | | | | |
| | 2nd layer region | $SiH_4$ | 300 | 300 | 20 | 0.5 | 20 |
| | | $H_2$ | 500 | | | | |
| | | $C_2H_2$ | 0.1 | | | | |
| | | NO | 0.1 | | | | |
| | | $B_2H_6$ | 0.3 ppm | | | | |
| | | $SiF_4$ | 0.5 | | | | |
| | | $AlCl_3$/He | 0.1 | | | | |
| | | $H_2S$ | 1 ppm | | | | |
| | 3rd layer region | $SiH_4$ | 100 | 300 | 15 | 0.4 | 7 |
| | | $CH_4$ | 600 | | | | |
| | | $PH_3$ | | | | | |
| | | (against $SiH_4$) | 3000 ppm | | | | |
| | | NO | 0.1 | | | | |
| | | $SiF_4$ | 0.5 | | | | |
| | | $AlCl_3$/He | 0.1 | | | | |
| | | $B_2H_6$ | 0.3 ppm | | | | |
| | | $H_2S$ | 1 ppm | | | | |
| | 4th layer region | $SiH_4$ | 40 | 300 | 10 | 0.4 | 0.1 |
| | | $CH_4$ | 600 | | | | |
| | | NO | 0.1 | | | | |
| | | $PH_3$ | 0.3 ppm | | | | |
| | | $B_2H_6$ | 0.3 ppm | | | | |
| | | $SiF_4$ | 0.5 | | | | |
| | | $AlCl_3$/He | 0.1 | | | | |

TABLE 157

| Order of lamination (layer name) | | Gases and their flow rates (SCCM) | | Substrate temperature (°C.) | RF discharging power (mW/cm$^3$) | Inner pressure (Torr) | Layer thickness (μm) |
|---|---|---|---|---|---|---|---|
| Lower layer | | $SiH_4$ | 50 | 250 | 1 | 0.4 | 0.02 |
| | | $H_2$ | 5→200* | | | | |
| | | $AlCl_3$/He | | | | | |
| | | (S-Side: 0.01 μm) | | | | | |
| | | | 200→30** | | | | |
| | | (UL-side: 0.01 μm) | | | | | |
| | | | 30→10** | | | | |
| | | $C_2H_2$ | 0.1 | | | | |
| | | NO | 5 | | | | |
| | | $SiF_4$ | 5 | | | | |
| Upper layer | 1st layer region | $SiH_4$ | 100 | 300 | 10 | 0.35 | 3 |
| | | $H_2$ | 150 | | | | |
| | | $B_2H_6$ (against $SiH_4$) | 800 ppm | | | | |
| | | $C_2H_2$ | 0.1 | | | | |
| | | $AlCl_3$/He | 0.1 | | | | |
| | | NO | 10 | | | | |
| | | $SiF_4$ | 0.5 | | | | |
| | 2nd layer region | $SiF_4$ | 0.1 | 300 | 20 | 0.5 | 5 |
| | | $SiH_4$ | 300 | | | | |
| | | $H_2$ | 300 | | | | |
| | | $C_2H_2$ | 0.1 | | | | |
| | | $AlCl_3$/He | 0.1 | | | | |
| | | NO | 0.1 | | | | |
| | | $B_2H_6$ (against $SiH_4$) | 0.3 ppm | | | | |
| | 3rd layer region | $SiF_4$ | 0.5 | 300 | 15 | 0.4 | 20 |
| | | $SiH_4$ | 100 | | | | |
| | | $C_2H_2$ | 15 | | | | |
| | | $AlCl_3$/He | 0.1 | | | | |
| | | NO | 0.1 | | | | |
| | | $B_2H_6$ (against $SiH_4$) | 0.3 ppm | | | | |
| | 4th layer | $SiH_4$ | 50 | 300 | 10 | 0.4 | 0.5 |
| | | $C_2H_2$ | 30 | | | | |

TABLE 157-continued

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| | region | $AlCl_3$/He | 0.1 | | | | |
| | | $SiF_4$ | 0.5 | | | | |
| | | NO | 0.1 | | | | |
| | | $B_2H_6$ (against $SiH_4$) | 0.3 ppm | | | | |

TABLE 158

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 50 | 250 | 1 | 0.4 | 0.02 |
| | | $H_2$ | 5→200* | | | | |
| | | $AlCl_3$/He (S-Side: 0.01 μm) | 200→30** | | | | |
| | | (UL-side: 0.01 μm) | 30→10** | | | | |
| | | NO | 10 | | | | |
| | | $C_2H_2$ | 0.1 | | | | |
| | | $SiF_4$ | 5 | | | | |
| Upper layer | 1st layer region | $SiH_4$ | 100 | 300 | 10 | 0.35 | 3 |
| | | $H_2$ | 150 | | | | |
| | | $B_2H_6$ (against $SiH_4$) | 800 ppm | | | | |
| | | $AlCl_3$/He | 0.1 | | | | |
| | | $SiF_4$ | 0.5 | | | | |
| | | NO | 10 | | | | |
| | | $C_2H_2$ | 0.1 | | | | |
| | 2nd layer region | $SiH_4$ | 300 | 300 | 20 | 0.5 | 7 |
| | | $SiF_4$ | 0.1 | | | | |
| | | $H_2$ | 300 | | | | |
| | | $B_2H_6$ (against $SiH_4$) | 0.3 ppm | | | | |
| | | $C_2H_2$ | 0.1 | | | | |
| | | NO | 2 | | | | |
| | | $AlCl_3$/He | 0.1 | | | | |
| | 3rd layer region | $SiH_4$ | 100 | 300 | 15 | 0.4 | 20 |
| | | $C_2H_2$ | 15 | | | | |
| | | $B_2H_6$ (against $SiH_4$) | 0.3 ppm | | | | |
| | | $AlCl_3$/He | 0.1 | | | | |
| | | NO | 0.1 | | | | |
| | | $SiF_4$ | 0.5 | | | | |
| | 4th layer region | $SiH_4$ | 50 | 300 | 10 | 0.4 | 0.5 |
| | | $C_2H_2$ | 30 | | | | |
| | | $AlCl_3$/He | 0.1 | | | | |
| | | $SiF_4$ | 0.5 | | | | |
| | | NO | 0.1 | | | | |
| | | $B_2H_6$ (against $SiH_4$) | 0.3 ppm | | | | |

TABLE 159

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 50 | 250 | 1 | 0.4 | 0.02 |
| | | $H_2$ | 5→200* | | | | |
| | | $AlCl_3$/He (S-Side: 0.01 μm) | 200→30** | | | | |
| | | (UL-side: 0.01 μm) | 30→10** | | | | |
| | | $C_2H_2$ | 0.1 | | | | |
| | | NO | 5 | | | | |
| | | $B_2H_6$ (against $SiH_4$) | 100 ppm | | | | |
| | | $SiF_4$ | 1→10* | | | | |
| Upper layer | 1st layer region | $SiH_4$ | 100 | 300 | 10 | 0.35 | 3 |
| | | $B_2H_6$ (against $SiH_4$) | 800 ppm | | | | |
| | | $AlCl_3$/He | 0.1 | | | | |
| | | $SiF_4$ | 0.5 | | | | |
| | | $C_2H_2$ | 0.1 | | | | |
| | | $H_2$ | 150 | | | | |
| | | NO | 10 | | | | |
| | 2nd layer region | $AlCl_3$/He | 0.1 | 300 | 20 | 0.5 | 3 |
| | | $SiF_4$ | 0.1 | | | | |
| | | $SiH_4$ | 300 | | | | |
| | | $H_2$ | 300 | | | | |
| | | NO | 0.1 | | | | |
| | - | $C_2H_2$ | 0.5→2* | | | | |

TABLE 159-continued

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| | | $B_2H_6$ (against $SiH_4$) | 0.3 ppm | | | | |
| | 3rd layer region | $SiF_4$ | 0.5 | 300 | 15 | 0.4 | 20 |
| | | $SiH_4$ | 100 | | | | |
| | | $C_2H_2$ | 15 | | | | |
| | | $AlCl_3$/He | 0.1 | | | | |
| | | $B_2H_6$ (against $SiH_4$) | 0.3 ppm | | | | |
| | | NO | 0.1 | | | | |
| | 4th layer region | $SiH_4$ | 50 | 300 | 10 | 0.4 | 0.5 |
| | | $C_2H_2$ | 30 | | | | |
| | | $B_2H_6$ (against $SiH_4$) | 0.3 ppm | | | | |
| | | NO | 0.1 | | | | |
| | | $AlCl_3$/He | 0.1 | | | | |
| | | $SiF_4$ | 0.5 | | | | |

TABLE 160

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 50 | 250 | 1 | 0.4 | 0.02 |
| | | $H_2$ | 5→200* | | | | |
| | | $AlCl_3$/He (S-Side: 0.01 μm) | 200→30** | | | | |
| | | (UL-side: 0.01 μm) | 30→10** | | | | |
| | | $C_2H_2$ | 0.1 | | | | |
| | | NO | 10 | | | | |
| | | $BF_3$ (against $SiH_4$) | 10 ppm | | | | |
| | | $SiF_4$ | 1→10* | | | | |
| Upper layer | 1st layer region | $SiH_4$ | 100 | 300 | 10 | 0.35 | 3 |
| | | $C_2H_2$ | 0.1 | | | | |
| | | $BF_3$ (against $SiH_4$) | 1000 ppm | | | | |
| | | $AlCl_3$/He | 0.1 | | | | |
| | | $SiF_4$ | 0.5 | | | | |
| | | $H_2$ | 150 | | | | |
| | | NO | 10 | | | | |
| | 2nd layer region | $SiH_4$ | 300 | 300 | 20 | 0.5 | 8 |
| | | $C_2H_2$ | 1 | | | | |
| | | $BF_3$ (against $SiH_4$) | 0.3 ppm | | | | |
| | | $AlCl_3$/He | 0.1 | | | | |
| | | $SiF_4$ | 0.1 | | | | |
| | | $H_2$ | 300 | | | | |
| | | NO | 0.1 | | | | |
| | 3rd layer region | $SiH_4$ | 100 | 300 | 15 | 0.4 | 20 |
| | | $C_2H_2$ | 15 | | | | |
| | | $BF_3$ (against $SiH_4$) | 0.3 ppm | | | | |
| | | $AlCl_3$/He | 0.1 | | | | |
| | | $SiF_4$ | 0.5 | | | | |
| | | NO | 0.1 | | | | |
| | 4th layer region | $SiH_4$ | 50 | 300 | 10 | 0.4 | 0.5 |
| | | $C_2H_2$ | 30 | | | | |
| | | $BF_3$ (against $SiH_4$) | 0.3 ppm | | | | |
| | | $AlCl_3$/He | 0.1 | | | | |
| | | $SiF_4$ | 0.5 | | | | |
| | | NO | 0.1 | | | | |

TABLE 161

| Order of lamination (layer name) | | Gases and their flow rates (SCCM) | | Substrate temperature (°C.) | RF discharging power (mW/Cm³) | Inner pressure (Torr) | Layer thickness (μm) |
|---|---|---|---|---|---|---|---|
| Lower layer | | $SiH_4$ | 50 | 250 | 1 | 0.4 | 0.02 |
| | | $H_2$ | 5→200* | | | | |
| | | $AlCl_3$/He (S-side: 0.01 μm) | 200→30** | | | | |
| | | (UL-side: 0.01 μm) | 30→10** | | | | |
| | | $C_2H_2$ | 0.1 | | | | |
| | | NO | 5→10* | | | | |
| | | $SiF_4$ | 5 | | | | |
| Upper layer | 1st layer region | $SiH_4$ | 100 | 300 | 10 | 0.35 | 3 |
| | | $H_2$ | 150 | | | | |
| | | $B_2H_6$ (against $SiH_4$) | 800 ppm | | | | |
| | | $C_2H_2$ | 5 | | | | |

TABLE 161-continued

| Order of lamination (layer name) | | Gases and their flow rates (SCCM) | | Substrate temperature (°C.) | RF discharging power (mW/Cm$^3$) | Inner pressure (Torr) | Layer thickness (μm) |
|---|---|---|---|---|---|---|---|
| | | $ALCL_3$/He | 0.1 | | | | |
| | | NO | 10 | | | | |
| | | $SiF_4$ | 0.5 | | | | |
| | 2nd layer region | $SiH_4$ | 300 | 300 | 20 | 0.5 | 5 |
| | | $H_2$ | 300 | | | | |
| | | $C_2H_2$ | 0.1 | | | | |
| | | NO | 0.1 | | | | |
| | | $B_2H_6$ (against $SiH_4$) | 0.3 ppm | | | | |
| | | $SiF_4$ | 0.1 | | | | |
| | | $AlCl_3$/He | 0.1 | | | | |
| | 3rd layer region | $SiH_4$ | 100 | 300 | 15 | 0.4 | 20 |
| | | NO | 0.1 | | | | |
| | | $SiF_4$ | 0.5 | | | | |
| | | $C_2H_2$ | | | | | |
| | | (U · 2nd LR-side: 1 μm) | | | | | |
| | | | 0.1→15* | | | | |
| | | (U · 4th LR-side: 19 μm) | | | | | |
| | | | 15 | | | | |
| | | $AlCl_3$/He | 0.1 | | | | |
| | | $B_2H_6$ (against $SiH_4$) | 0.3 ppm | | | | |
| | 4th layer region | $SiH_4$ | 50 | 300 | 10 | 0.4 | 0.5 |
| | | $C_2H_2$ | 30 | | | | |
| | | NO | 0.1 | | | | |
| | | $B_2H_6$ (against $SiH_4$) | 0.3 ppm | | | | |
| | | $SiF_4$ | 0.5 | | | | |
| | | $AlCl_3$/He | 0.1 | | | | |

TABLE 162

| Order of lamination (layer name) | | Gases and their flow rates (SCCM) | | Substrate temperature (°C.) | RF discharging power (mW/Cm$^3$) | Inner pressure (Torr) | Layer thickness (μm) |
|---|---|---|---|---|---|---|---|
| Lower layer | | $SiH_4$ | 50 | 250 | 1 | 0.4 | 0.02 |
| | | $H_2$ | 5→200* | | | | |
| | | $AlCl_3$/He | | | | | |
| | | (S-side: 0.01 μm) | | | | | |
| | | | 200→30** | | | | |
| | | (UL-side: 0.01 μm) | | | | | |
| | | | 30→10** | | | | |
| | | $C_2H_2$ | 0.1 | | | | |
| | | NO | 10 | | | | |
| | | $B_2H_6$ (against $SiH_4$) | | | | | |
| | | | 10→100 ppm* | | | | |
| | | $SiF_4$ | 5 | | | | |
| Upper layer | 1st layer region | $SiH_4$ | 100 | 300 | 10 | 0.35 | 3 |
| | | $H_2$ | 150 | | | | |
| | | $B_2H_6$ (against $SiH_4$) | 800 ppm | | | | |
| | | $C_2H_2$ | 0.1 | | | | |
| | | $AlCl_3$/He | 0.1 | | | | |
| | | NO | 10 | | | | |
| | | $SiF_4$ | 0.5 | | | | |
| | 2nd layer region | $SiF_4$ | 0.1 | 300 | 20 | 0.5 | 2 |
| | | $SiH_4$ | 300 | | | | |
| | | $H_2$ | 300 | | | | |
| | | $C_2H_2$ | 0.1 | | | | |
| | | $AlCl_3$/He | 0.1 | | | | |
| | | NO | 0.1 | | | | |
| | | $B_2H_6$ (against $SiH_4$) | 0.3 ppm | | | | |
| | 3rd layer region | $SiF_4$ | 0.5 | 300 | 15 | 0.4 | 20 |
| | | $SiH_4$ | 100 | | | | |
| | | $C_2H_2$ | | | | | |
| | | (U · 2nd LR-side:1 μm) | | | | | |
| | | | 0.1→13* | | | | |
| | | (U · 4th LR-side: 19 μm) | | | | | |
| | | | 1→17* | | | | |
| | | $AlCl_3$/He | 0.1 | | | | |
| | | NO | 0.1 | | | | |
| | | $B_2H_6$ (against $SiH_4$) | 0.3 ppm | | | | |
| | 4th layer region | $SiH_4$ | 50 | 300 | 10 | 0.4 | 0.5 |
| | | $C_2H_2$ | 30 | | | | |
| | | $AlCl_3$/He | 0.1 | | | | |
| | | $SiF_4$ | 0.5 | | | | |
| | | NO | 0.1 | | | | |
| | | $B_2H_6$ | | | | | |

TABLE 162-continued

| Order of lamination (layer name) | Gases and their flow rates (SCCM) | | Substrate temperature (°C.) | RF discharging power (mW/Cm$^3$) | Inner pressure (Torr) | Layer thickness (μm) |
|---|---|---|---|---|---|---|
| | (against $SiH_4$) | 0.3 ppm | | | | |

TABLE 163

| Order of lamination (layer name) | | Gases and their flow rates (SCCM) | | Substrate temperature (°C.) | RF discharging power (mW/Cm$^3$) | Inner pressure (Torr) | Layer thickness (μm) |
|---|---|---|---|---|---|---|---|
| Lower layer | | $SiH_4$ | 50 | 250 | 1 | 0.4 | 0.02 |
| | | $H_2$ | 5→200* | | | | |
| | | $AlCl_3$/He (S-side: 0.01 μm) | 200→30** | | | | |
| | | (UL-side: 0.01 μm) | 30→10** | | | | |
| | | NO | 10 | | | | |
| | | $C_2H_2$ | 0.1 | | | | |
| | | $SiF_4$ | 5 | | | | |
| | | $B_2H_6$ (against $SiH_4$) (S-side: 0.01 μm) | 10 | | | | |
| | | (UL-side: 0.01 μm) | 10→100** | | | | |
| Upper layer | 1st layer region | $SiH_4$ | 100 | 300 | 10 | 0.35 | 3 |
| | | $H_2$ | 150 | | | | |
| | | $B_2H_6$ (against $SiH_4$) | 800 ppm | | | | |
| | | $AlCl_3$/He | 0.1 | | | | |
| | | $SiF_4$ | 0.5 | | | | |
| | | NO | 10 | | | | |
| | | $C_2H_2$ | 0.1 | | | | |
| | 2nd layer region | $SiH_4$ | 300 | 300 | 20 | 0.5 | 5 |
| | | $SiF_4$ | 0.1 | | | | |
| | | $H_2$ | 300 | | | | |
| | | $B_2H_6$ (against $SiH_4$) | 0.3 ppm | | | | |
| | | $C_2H_2$ | 0.1 | | | | |
| | | NO | 0.1 | | | | |
| | | $AlCl_3$/He | 0.1 | | | | |
| | 3rd layer region | NO | 0.1 | 300 | 15 | 0.4 | 20 |
| | | $SiF_4$ | 0.5 | | | | |
| | | $C_2H_2$ (U · 2nd LR-side: 19 μm) | 15 | | | | |
| | | (U · 4th LR-side: 1 μm) | 15→30* | | | | |
| | | $SiH_4$ (U · 2nd LR-side: 19 μm) | 100 | | | | |
| | | (U · 4th LR-side: 1 μm) | 100→50** | | | | |
| | | $AlCl_3$/He | 0.1 | | | | |
| | | $B_2H_6$ (against $SiH_4$) | 0.3 ppm | | | | |
| | 4th layer region | $SiH_4$ | 50 | 300 | 10 | 0.4 | 0.5 |
| | | $C_2H_2$ | 30 | | | | |
| | | $AlCl_3$/He | 0.1 | | | | |
| | | $SiF_4$ | 0.5 | | | | |
| | | NO | 0.1 | | | | |
| | | $B_2H_6$ (against $SiH_4$) | 0.3 ppm | | | | |

TABLE 164

| Order of lamination (layer name) | | Gases and their flow rates (SCCM) | | Substrate temperature (°C.) | RF discharging power (mW/cm$^3$) | Inner pressure (Torr) | Layer thickness (μm) |
|---|---|---|---|---|---|---|---|
| Lower layer | | $SiH_4$ | 50 | 250 | 1 | 0.4 | 0.02 |
| | | $H_2$ | 5→200* | | | | |
| | | $AlCl_3$/He (S-side: 0.01 μm) | 200→30** | | | | |
| | | (UL-side: 0.01 μm) | 30→10** | | | | |
| | | $C_2H_2$ | 5 | | | | |
| | | NO | 0.1 | | | | |
| | | $SiF_4$ (S-side: 0.01 μm) | 2 | | | | |
| | | (UL-side: 0.01 μm) | 2→5* | | | | |
| Upper layer | 1st layer region | $SiH_4$ | 100 | 300 | 10 | 0.35 | 3 |
| | | $B_2H_6$ (against $SiH_4$) | 800 ppm | | | | |
| | | $AlCl_3$/He | 0.1 | | | | |

TABLE 164-continued

| Order of lamination (layer name) | | Gases and their flow rates (SCCM) | | Substrate temperature (°C.) | RF discharging power (mW/cm$^3$) | Inner pressure (Torr) | Layer thickness (μm) |
|---|---|---|---|---|---|---|---|
| | | $SiF_4$ | 0.5 | | | | |
| | | $C_2H_2$ | 0.1 | | | | |
| | | $H_2$ | 150 | | | | |
| | | NO | 10 | | | | |
| | 2nd | $AlCl_2$/He | 0.1 | 300 | 20 | 0.5 | 5 |
| | layer | $SiF_4$ | 0.1 | | | | |
| | region | $SiH_4$ | 300 | | | | |
| | | $H_2$ | 300 | | | | |
| | | NO | 0.1 | | | | |
| | | $C_2H_2$ | 0.1 | | | | |
| | | $B_2H_6$ (against $SiH_4$) | 0.3 ppm | | | | |
| | 3rd | $SiF_4$ | 0.5 | 300 | 15 | 0.4 | 20 |
| | layer | $SiH_4$ | 100 | | | | |
| | region | $C_2H_2$ | 15 | | | | |
| | | $AlCl_3$/He | 0.1 | | | | |
| | | $B_2H_6$ (against $SiH_4$) | 10 ppm | | | | |
| | | NO | 0.1 | | | | |
| | 4th | $SiH_4$ | 50 | 300 | 10 | 0.4 | 0.5 |
| | layer | $C_2H_2$ | 30 | | | | |
| | region | $B_2H_6$ (against $SiH_4$) | 0.3 ppm | | | | |
| | | NO | 0.1 | | | | |
| | | $AlCl_3$/He | 0.1 | | | | |
| | | $SiF_4$ | 0.5 | | | | |

TABLE 165

| Order of lamination (layer name) | | Gases and their flow rates (SCCM) | | Substrate temperature (°C.) | RF discharging power (mW/cm$^3$) | Inner pressure (Torr) | Layer thickness (μm) |
|---|---|---|---|---|---|---|---|
| Lower layer | | $SiH_4$ | 50 | 250 | 1 | 0.4 | 0.02 |
| | | $H_2$ | 5→200* | | | | |
| | | $AlCl_3$/He | | | | | |
| | | (S-side: 0.01 μm) | | | | | |
| | | | 200→30** | | | | |
| | | (UL-side: 0.01 μm) | | | | | |
| | | | 30→10** | | | | |
| | | $C_2H_2$ | 1→6* | | | | |
| | | NO | 0.1 | | | | |
| | | $SiF_4$ | 10 | | | | |
| Upper layer | 1st layer region | $SiH_4$ | 100 | 300 | 10 | 0.35 | 3 |
| | | $C_2H_2$ | 0.1 | | | | |
| | | $B_2H_6$ (against $SiH_4$) | 800 ppm | | | | |
| | | $AlCl_3$/He | 0.1 | | | | |
| | | $SiF_4$ | 0.5 | | | | |
| | | $H_2$ | 150 | | | | |
| | | NO | 10 | | | | |
| | 2nd layer region | $SiH_4$ | 300 | 300 | 20 | 0.5 | 6 |
| | | $C_2H_2$ | 0.1 | | | | |
| | | $B_2H_6$ (against $SiH_4$) | 0.3 ppm | | | | |
| | | $AlCl_3$/He | 0.1 | | | | |
| | | $SiF_4$ | 0.1 | | | | |
| | | $H_2$ | 300 | | | | |
| | | NO | 0.1 | | | | |
| | 3rd layer region | $SiH_4$ | 100 | 300 | 15 | 0.4 | 20 |
| | | $C_2H_2$ | 15 | | | | |
| | | $B_2H_6$ (against $SiH_4$) | 0.3 ppm | | | | |
| | | $AlCl_3$/He | 0.1 | | | | |
| | | $SiF_4$ | 0.5 | | | | |
| | | NO | 0.1 | | | | |
| | 4th layer region | $SiH_4$ | 50 | 300 | 10 | 0.4 | 0.5 |
| | | $C_2H_2$ | 30 | | | | |
| | | $B_2H_6$ (against $SiH_4$) | 0.3 ppm | | | | |
| | | $AlCl_3$/He | 0.1 | | | | |
| | | $SiF_4$ | 0.5 | | | | |
| | | NO | 0.1 | | | | |

TABLE 166

| Order of lamination (layer name) | Gases and their flow rates (SCCM) | | Substrate temperature (°C.) | RF discharging power (mW/cm$^3$) | Inner pressure (Torr) | Layer thickness (μm) |
|---|---|---|---|---|---|---|
| Lower layer | $SiH_4$ | 50 | 250 | 1 | 0.4 | 0.02 |
| | $H_2$ | 5→200* | | | | |
| | $AlCl_3$/He | | | | | |
| | (S-side: 0.01 μm) | | | | | |
| | | 200→30** | | | | |

TABLE 166-continued

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| | | (UL-side: 0.01 μm) | | | | | |
| | | | 30→10** | | | | |
| | | $C_2H_2$ | 3 | | | | |
| | | NO | 0.1 | | | | |
| | | $B_2H_6$ (against $SiH_4$) | 100 ppm | | | | |
| | | $Si_2F_6$ | 3 | | | | |
| Upper layer | 1st layer region | $SiH_4$ | 100 | 300 | 10 | 0.35 | 3 |
| | | $H_2$ | 150 | | | | |
| | | $B_2H_6$ (against $SiH_4$) | 800 ppm | | | | |
| | | $C_2H_2$ | 0.1 | | | | |
| | | $AlCl_3$/He | 0.1 | | | | |
| | | NO | 10 | | | | |
| | | $Si_2F_6$ | 0.5 | | | | |
| | 2nd layer region | $SiH_4$ | 300 | 300 | 20 | 0.5 | 5 |
| | | $H_2$ | 300 | | | | |
| | | $C_2H_2$ | 0.1 | | | | |
| | | NO | 0.1 | | | | |
| | | $B_2H_6$ (against $SiH_4$) | 0.3 ppm | | | | |
| | | $Si_2F_6$ | 0.5 | | | | |
| | | $AlCl_3$/He | 0.1 | | | | |
| | 3rd layer region | $Si_2F_6$ | 0.5 | 300 | 15 | 0.4 | 20 |
| | | NO | 0.1 | | | | |
| | | $SiH_4$ | 100 | | | | |
| | | $C_2H_2$ | 15 | | | | |
| | | $PH_3$ (against $SiH_4$) | 8 ppm | | | | |
| | | $AlCl_3$/He | 0.1 | | | | |
| | | $B_2H_6$ (against $SiH_4$) | 0.3 ppm | | | | |
| | 4th layer region | $SiH_4$ | 50 | 300 | 10 | 0.4 | 0.5 |
| | | $C_2H_2$ | 30 | | | | |
| | | NO | 0.1 | | | | |
| | | $B_2H_6$ (against $SiH_4$) | 0.3 ppm | | | | |
| | | $Si_2F_6$ | 0.5 | | | | |
| | | $PH_3$ (against $SiH_4$) | 0.3 ppm | | | | |
| | | $AlCl_3$/He | 0.1 | | | | |

TABLE 167

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 50 | 250 | 1 | 0.4 | 0.02 |
| | | $H_2$ | 5→200* | | | | |
| | | $AlCl_3$/He | | | | | |
| | | (S-side: 0.01 μm) | | | | | |
| | | | 200→30** | | | | |
| | | (UL-side: 0.01 μm) | | | | | |
| | | | 30→10** | | | | |
| | | $C_2H_2$ | 3 | | | | |
| | | NO | 0.1 | | | | |
| | | $B_2H_6$ (against $SiH_4$) | | | | | |
| | | | 10→100 ppm* | | | | |
| | | $SiF_4$ | 5 | | | | |
| Upper layer | 1st layer region | $SiH_4$ | 100 | 300 | 10 | 0.35 | 3 |
| | | $H_2$ | 150 | | | | |
| | | $B_2H_6$ (against $SiH_4$) | 800 ppm | | | | |
| | | $C_2H_2$ | 0.1 | | | | |
| | | $AlCl_3$/He | 0.1 | | | | |
| | | NO | 10 | | | | |
| | | $SiF_4$ | 0.5 | | | | |
| | 2nd layer region | $SiF_4$ | 0.1 | 300 | 20 | 0.5 | 5 |
| | | $SiH_4$ | 300 | | | | |
| | | $H_2$ | 300 | | | | |
| | | $C_2H_2$ | 0.1 | | | | |
| | | $AlCl_3$/He | 0.1 | | | | |
| | | NO | 0.1 | | | | |
| | | $B_2H_6$ (against $SiH_4$) | 0.3 ppm | | | | |
| | 3rd layer region | $SiF_4$ | 0.5 | 300 | 15 | 0.4 | 20 |
| | | $SiH_4$ | 100 | | | | |
| | | $C_2H_2$ | 15 | | | | |
| | | $PH_3$ (against $SiH_4$) | | | | | |
| | | | 10→0.3 ppm** | | | | |
| | | $AlCl_3$/He | 0.1 | | | | |
| | | NO | 0.1 | | | | |
| | | $B_2H_6$ (against $SiH_4$) | 0.3 ppm | | | | |

TABLE 167-continued

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| | 4th layer region | $SiH_4$ | 50 | 300 | 10 | 0.4 | 0.5 |
| | | $C_2H_2$ | 30 | | | | |
| | | $AlCl_3$/He | 0.1 | | | | |
| | | $SiF_4$ | 0.5 | | | | |
| | | NO | 0.1 | | | | |
| | | $B_2H_6$ (against $SiH_4$) | 0.3 ppm | | | | |
| | | $PH_3$ (against $SiH_4$) | 0.3 ppm | | | | |

TABLE 168

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 50 | 250 | 1 | 0.4 | 0.02 |
| | | $H_2$ | 5→200* | | | | |
| | | $AlCl_3$/He (S-side: 0.01 μm) | 200→30** | | | | |
| | | (UL-side: 0.01 μm) NO | 10 | | | | |
| | | | 30→10** | | | | |
| | | $C_2H_2$ | 0.1 | | | | |
| | | $SiF_4$ | 1→10* | | | | |
| | | $H_2S$ | 1 ppm | | | | |
| Upper layer | 1st layer region | $SiH_4$ | 100 | 300 | 10 | 0.35 | 3 |
| | | $H_2$ | 150 | | | | |
| | | $B_2H_6$ (against $SiH_4$) | 800 ppm | | | | |
| | | $AlCl_3$/He | 0.1 | | | | |
| | | $SiF_4$ | 0.5 | | | | |
| | | NO | 10 | | | | |
| | | $C_2H_2$ | 0.1 | | | | |
| | | $H_2S$ | 1 ppm | | | | |
| | 2nd layer region | $SiH_4$ | 300 | 300 | 20 | 0.5 | 5 |
| | | $SiF_4$ | 0.1 | | | | |
| | | $H_2$ | 300 | | | | |
| | | $B_2H_6$ (against $SiH_4$) | 0.3 ppm | | | | |
| | | $C_2H_2$ | 0.1 | | | | |
| | | NO | 0.1 | | | | |
| | | $AlCl_3$/He | 0.1 | | | | |
| | | $H_2S$ | 1 ppm | | | | |
| | 3rd layer region | NO | 0.1 | 300 | 15 | 0.4 | 20 |
| | | $SiF_4$ | 0.5 | | | | |
| | | $C_2H_2$ | 15 | | | | |
| | | $SiH_4$ | 100 | | | | |
| | | $AlCl_3$/He | 0.1 | | | | |
| | | $B_2H_6$ (against $SiH_4$) | 0.3 ppm | | | | |
| | | $H_2S$ | 1 ppm | | | | |
| | 4th layer region | $SiH_4$ | 50 | 300 | 10 | 0.4 | 0.5 |
| | | $C_2H_2$ | 30 | | | | |
| | | $AlCl_3$/He | 0.1 | | | | |
| | | $SiF_4$ | 0.5 | | | | |
| | | NO | 0.1 | | | | |
| | | $B_2H_6$ (against $SiH_4$) | 0.3 ppm | | | | |

TABLE 169

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 50 | 250 | 1 | 0.4 | 0.02 |
| | | $H_2$ | 5→200* | | | | |
| | | $AlCl_3$/He (S-side: 0.01 μm) | 200→30** | | | | |
| | | (UL-side: 0.01 μm) | 30→10** | | | | |
| | | $C_2H_2$ | 0.1 | | | | |
| | | NO | 5 | | | | |
| | | $SiF_4$ | 5 | | | | |
| Upper | 1st | $SiH_4$ | 100 | 300 | 10 | 0.35 | 3 |

TABLE 169-continued

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| layer | layer region | $B_2H_6$ (against $SiH_4$) | 800 ppm | | | | |
| | | $AlCl_3$/He | 0.1 | | | | |
| | | $SiF_4$ | 0.5 | | | | |
| | | $C_2H_2$ | 0.1 | | | | |
| | | $H_2$ | 150 | | | | |
| | | NO | 10 | | | | |
| | 2nd layer region | $AlCl_3$/He | 0.1 | 300 | 20 | 0.5 | 5 |
| | | $SiF_4$ | 0.1 | | | | |
| | | $SiH_4$ | 300 | | | | |
| | | $H_2$ | 300 | | | | |
| | | NO | 0.1 | | | | |
| | | $C_2H_2$ | 0.1 | | | | |
| | | $B_2H_6$ (against $SiH_4$) | 0.3 ppm | | | | |
| | 3rd layer region | $SiF_4$ | 0.5 | 300 | 15 | 0.4 | 10 |
| | | $SiH_4$ | 100 | | | | |
| | | $C_2H_2$ | 15 | | | | |
| | | $AlCl_3$/He | 0.1 | | | | |
| | | $B_2H_6$ (against $SiH_4$) | 0.3 ppm | | | | |
| | | NO | 0.1 | | | | |
| | 4th layer region | $SiH_4$ | 50 | 300 | 10 | 0.4 | 0.5 |
| | | $C_2H_2$ | 30 | | | | |
| | | $B_2H_6$ (against $SiH_4$) | 0.3 ppm | | | | |
| | | NO | 0.1 | | | | |
| | | $AlCl_3$/He | 0.1 | | | | |
| | | $SiF_4$ | 0.5 | | | | |

TABLE 170

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 50 | 250 | 1 | 0.4 | 0.02 |
| | | $H_2$ | 5→200* | | | | |
| | | $AlCl_3$/He (S-side: 0.01 μm) | 200→30** | | | | |
| | | (UL-side: 0.01 μm) | 30→10** | | | | |
| | | $C_2H_2$ | 0.1 | | | | |
| | | NO | 10 | | | | |
| | | $B_2H_6$ (against $SiH_4$) | 150 ppm | | | | |
| | | $SiF_4$ | 5 | | | | |
| Upper layer | 1st layer region | $SiH_4$ | 100 | 300 | 10 | 0.35 | 3 |
| | | $C_2H_2$ | 0.1 | | | | |
| | | $B_2H_6$ (against $SiH_4$) | 800 ppm | | | | |
| | | $AlCl_3$/He | 0.1 | | | | |
| | | $SiF_4$ | 0.5 | | | | |
| | | $H_2$ | 150 | | | | |
| | | NO | 10 | | | | |
| | 2nd layer region | $SiH_4$ | 300 | 300 | 20 | 0.5 | 5 |
| | | $C_2H_2$ | 0.1 | | | | |
| | | $B_2H_6$ (against $SiH_4$) | 0.3 ppm | | | | |
| | | $AlCl_3$/He | 0.1 | | | | |
| | | $SiF_4$ | 0.1 | | | | |
| | | $H_2$ | 300 | | | | |
| | | NO | 0.1 | | | | |
| | 3rd layer region | $SiH_4$ | 100 | 300 | 15 | 0.4 | 30 |
| | | $C_2H_2$ | 15 | | | | |
| | | $B_2H_6$ (against $SiH_4$) | 0.3 ppm | | | | |
| | | $AlCl_3$/He | 0.1 | | | | |
| | | $SiF_4$ | 0.5 | | | | |
| | | NO | 0.1 | | | | |
| | 4th layer region | $SiH_4$ | 50 | 300 | 10 | 0.4 | 0.5 |
| | | $C_2H_2$ | 30 | | | | |
| | | $B_2H_6$ (against $SiH_4$) | 0.3 ppm | | | | |
| | | $AlCl_3$/He | 0.1 | | | | |
| | | $SiF_4$ | 0.5 | | | | |
| | | NO | 0.1 | | | | |

TABLE 171

| Order of lamination (layer name) | Gases and their flow rates (SCCM) | | Substrate temperature (°C.) | RF discharging power (mW/cm³) | Inner pressure (Torr) | Layer thickness (μm) |
|---|---|---|---|---|---|---|
| Lower layer | $SiH_4$ | 50 | 250 | 1 | 0.4 | 0.02 |
| | $H_2$ | 5→200* | | | | |

TABLE 171-continued

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| | | $AlCl_3$/He | | | | | |
| | | (S-side: 0.01 μm) | | | | | |
| | | | 200→30** | | | | |
| | | (UL-side: 0.01 μm) | | | | | |
| | | | 30→10** | | | | |
| | | $C_2H_2$ | 2 | | | | |
| | | NO | 5 | | | | |
| | | $B_2H_6$ (against $SiH_4$) | 30 ppm | | | | |
| | | $SiF_4$ | 5 | | | | |
| Upper layer | 1st layer region | $SiH_4$ | 100 | 300 | 10 | 0.35 | 3 |
| | | $H_2$ | 150 | | | | |
| | | $B_2H_6$ (against $SiH_4$) | 800 ppm | | | | |
| | | $C_2H_2$ | 0.1 | | | | |
| | | $AlCl_3$/He | 0.1 | | | | |
| | | NO | 10 | | | | |
| | | $SiF_4$ | 0.5 | | | | |
| | 2nd layer region | $SiH_4$ | 300 | 300 | 20 | 0.5 | 5 |
| | | $H_2$ | 300 | | | | |
| | | $C_2H_2$ | 0.1 | | | | |
| | | NO | 0.1 | | | | |
| | | $B_2H_6$ (against $SiH_4$) | 0.3 ppm | | | | |
| | | $SiF_4$ | 0.1 | | | | |
| | | $AlCl_3$/He | 0.1 | | | | |
| | 3rd layer region | $SiF_4$ | 0.5 | 300 | 15 | 0.4 | 20 |
| | | NO | 0.1 | | | | |
| | | $SiH_4$ | 100 | | | | |
| | | $C_2H_2$ | 0.1 | | | | |
| | | $NH_3$ | 100 | | | | |
| | | $AlCl_3$/He | 0.1 | | | | |
| | | $B_2H_6$ (against $SiH_4$) | 0.3 ppm | | | | |
| | 4th layer region | $SiH_4$ | 50 | 300 | 10 | 0.4 | 0.5 |
| | | $C_2H_2$ | 30 | | | | |
| | | NO | 0.1 | | | | |
| | | $B_2H_6$ (against $SiH_4$) | 0.3 ppm | | | | |
| | | $SiF_4$ | 0.5 | | | | |
| | | $AlCl_3$/He | 0.1 | | | | |

TABLE 172

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 50 | 250 | 1 | 0.4 | 0.02 |
| | | $H_2$ | 5→200* | | | | |
| | | $AlCl_3$/He | | | | | |
| | | (S-side: 0.01 μm) | 200→30** | | | | |
| | | (UL-side: 0.01 μm) | 30→10** | | | | |
| | | $C_2H_2$ | 1→3* | | | | |
| | | NO | 3 | | | | |
| | | $B_2H_6$ (against $SiH_4$) | 100 ppm | | | | |
| | | $SiF_4$ | 10 | | | | |
| Upper layer | 1st layer region | $SiH_4$ | 100 | 300 | 10 | 0.35 | 3 |
| | | $H_2$ | 150 | | | | |
| | | $B_2H_6$ (against $SiH_4$) | 800 ppm | | | | |
| | | $AlCl_3$/He | 0.1 | | | | |
| | | $SiF_4$ | 0.5 | | | | |
| | | NO | 10 | | | | |
| | | $C_2H_2$ | 0.1 | | | | |
| | 2nd layer region | $SiF_4$ | 0.1 | 300 | 20 | 0.5 | 2 |
| | | $SiH_4$ | 300 | | | | |
| | | $H_2$ | 300 | | | | |
| | | $C_2H_2$ | 0.1 | | | | |
| | | $AlCl_3$/He | 0.1 | | | | |
| | | NO | 0.1 | | | | |
| | | $B_2H_6$ (against $SiH_4$) | 0.3 ppm | | | | |
| | 3rd layer region | $SiF_4$ | 0.5 | 300 | 15 | 0.4 | 20 |
| | | $SiH_4$ | 100 | | | | |
| | | $C_2H_2$ | 0.1 | | | | |
| | | $AlCl_3$/He | 0.1 | | | | |
| | | NO | 0.1 | | | | |
| | | $B_2H_6$ (against $SiH_4$) | 0.3 ppm | | | | |
| | | $N_2$ | 500 | | | | |
| | 4th layer region | $SiH_4$ | 50 | 300 | 10 | 0.4 | 0.5 |
| | | $C_2H_2$ | 30 | | | | |
| | | $AlCl_3$/He | 0.1 | | | | |
| | | $SiF_4$ | 0.5 | | | | |
| | | NO | 0.1 | | | | |

TABLE 172-continued

| Order of lamination (layer name) | Gases and their flow rates (SCCM) | | Substrate temperature (°C.) | RF discharging power (mW/cm$^3$) | Inner pressure (Torr) | Layer thickness (μm) |
|---|---|---|---|---|---|---|
| | $B_2H_6$ (against $SiH_4$) | 0.3 ppm | | | | |

TABLE 173

| Order of lamination (layer name) | | Gases and their flow rates (SCCM) | | Substrate temperature (°C.) | RF discharging power (mW/cm$^3$) | Inner pressure (Torr) | Layer thickness (μm) |
|---|---|---|---|---|---|---|---|
| Lower layer | | $SiH_4$ | 50 | 250 | 1 | 0.4 | 0.02 |
| | | $H_2$ | 5→200* | | | | |
| | | $AlCl_3$/He | | | | | |
| | | (S-side: 0.01 μm) | 200→30** | | | | |
| | | (UL-side: 0.01 μm) | 30→10** | | | | |
| | | $C_2H_2$ | 2 | | | | |
| | | NO | 5→8* | | | | |
| | | $B_2H_6$ (against $SiH_4$) | 10→100 ppm* | | | | |
| | | $SiF_4$ | 20 | | | | |
| Upper layer | 1st layer region | $SiH_4$ | 100 | 300 | 10 | 0.35 | 3 |
| | | $H_2$ | 150 | | | | |
| | | $B_2H_6$ (against $SiH_4$) | 800 ppm | | | | |
| | | $AlCl_3$/He | 0.1 | | | | |
| | | NO | 10 | | | | |
| | | $SiF_4$ | 0.5 | | | | |
| | | $C_2H_2$ | 0.1 | | | | |
| | 2nd layer region | $AlCl_3$/He | 0.1 | 300 | 15 | 0.4 | 20 |
| | | $SiF_4$ | 5 | | | | |
| | | $SiH_4$ | 100 | | | | |
| | | $C_2H_2$ | 15 | | | | |
| | | $B_2H_6$ (against $SiH_4$) | 0.3 ppm | | | | |
| | | NO | 0.1 | | | | |
| | 3rd layer region | $AlCl_3$/He | 0.1 | 300 | 20 | 0.5 | 5 |
| | | $SiF_4$ | 0.5 | | | | |
| | | $SiH_4$ | 300 | | | | |
| | | $H_2$ | 300 | | | | |
| | | NO | 0.1 | | | | |
| | | $C_2H_2$ | 0.1 | | | | |
| | | $B_2H_6$ (against $SiH_4$) | 0.3 ppm | | | | |
| | 4th layer region | $SiH_4$ | 50 | 300 | 10 | 0.4 | 0.5 |
| | | $C_2H_2$ | 30 | | | | |
| | | $B_2H_6$ (against $SiH_4$) | 0.3 ppm | | | | |
| | | $AlCl_3$/He | 0.1 | | | | |
| | | $SiF_4$ | 0.5 | | | | |

TABLE 174

| Order of lamination (layer name) | | Gases and their flow rates (SCCM) | | Substrate temperature (°C.) | RF discharging power (mW/cm$^3$) | Inner pressure (Torr) | Layer thickness (μm) |
|---|---|---|---|---|---|---|---|
| Lower layer | | $SiH_4$ | 50 | 250 | 1 | 0.4 | 0.02 |
| | | $H_2$ | 5→200* | | | | |
| | | $AlCl_3$/He | | | | | |
| | | (S-side: 0.01 μm) | 200→30** | | | | |
| | | (UL-side: 0.01 μm) | 30→10** | | | | |
| | | $C_2H_2$ | 2 | | | | |
| | | NO | 5→8* | | | | |
| | | $B_2H_6$ (against $SiH_4$) | | | | | |
| | | (S-side: 0.01 μm) | 50 ppm | | | | |
| | | (UL-side: 0.01 μm) | 50→100 ppm* | | | | |
| | | $SiF_4$ | 3 | | | | |
| Upper layer | 1st layer region | $SiH_4$ | 100 | 300 | 10 | 0.35 | 3 |
| | | $H_2$ | 150 | | | | |
| | | $B_2H_6$ (against $SiH_4$) | 800 ppm | | | | |
| | | $C_2H_2$ | 0.1 | | | | |
| | | $AlCl_3$/He | 0.1 | | | | |
| | | NO | 10 | | | | |
| | | $SiF_4$ | 0.5 | | | | |
| | 2nd layer region | $SiF_4$ | 0.5 | 300 | 15 | 0.4 | 20 |
| | | $SiH_4$ | 100 | | | | |
| | | $C_2H_2$ | 15 | | | | |
| | | $AlCl_3$/He | 0.1 | | | | |
| | | NO | 0.1 | | | | |
| | | $B_2H_6$ (against $SiH_4$) | 10 ppm | | | | |
| | 3rd layer region | $SiF_4$ | 0.5 | 300 | 20 | 0.5 | 4 |
| | | $SiH_4$ | 300 | | | | |
| | | $H_2$ | 300 | | | | |
| | | $C_2H_2$ | 0.1 | | | | |

TABLE 174-continued

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| | | $AlCl_3$/He | 0.1 | | | | |
| | | NO | 0.1 | | | | |
| | | $B_2H_6$ (against $SiH_4$) | 0.3 ppm | | | | |
| | 4th layer region | $SiH_4$ | 50 | 300 | 10 | 0.4 | 0.5 |
| | | $C_2H_2$ | 30 | | | | |
| | | $AlCl_3$/He | 0.1 | | | | |
| | | $SiF_4$ | 0.5 | | | | |
| | | NO | 0.1 | | | | |
| | | $B_2H_6$ (against $SiH_4$) | 0.3 ppm | | | | |

TABLE 175

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 50 | 250 | 1 | 0.4 | 0.02 |
| | | $H_2$ | 5→200* | | | | |
| | | $AlCl_3$/He | | | | | |
| | | (S-side: 0.01 μm) | 200→30** | | | | |
| | | (UL-side: 0.01 μm) | 30→10** | | | | |
| | | NO | 10 | | | | |
| | | $C_2H_2$ | 0.1 | | | | |
| | | $SiF_4$ | 5 | | | | |
| Upper layer | 1st layer region | $SiH_4$ | 100 | 300 | 10 | 0.35 | 3 |
| | | $H_2$ | 150 | | | | |
| | | $B_2H_6$ (against $SiH_4$) | 150 ppm | | | | |
| | | $AlCl_3$/He | 0.1 | | | | |
| | | $SiF_4$ | 0.5 | | | | |
| | | NO | 10 | | | | |
| | | $C_2H_2$ | 0.1 | | | | |
| | 2nd layer region | $SiH_4$ | 100 | 300 | 15 | 0.4 | 20 |
| | | $SiF_4$ | 0.5 | | | | |
| | | $B_2H_6$ (against $SiH_4$) | 0.3 ppm | | | | |
| | | $C_2H_2$ | 15 | | | | |
| | | $PH_3$ (against $SiH_4$) | 8 ppm | | | | |
| | | NO | 0.1 | | | | |
| | | $AlCl_3$/He | 0.1 | | | | |
| | 3rd layer region | NO | 0.1 | 300 | 20 | 0.5 | 6 |
| | | $SiF_4$ | 0.5 | | | | |
| | | $H_2$ | 300 | | | | |
| | | NO | 0.1 | | | | |
| | | $PH_3$ (against $SiH_4$) | 0.1 ppm | | | | |
| | | $AlCl_3$/He | 0.1 | | | | |
| | | $B_2H_6$ (against $SiH_4$) | 0.3 ppm | | | | |
| | | $C_2H_2$ | 0.1 | | | | |
| | 4th layer region | $SiH_4$ | 50 | 300 | 10 | 0.4 | 0.5 |
| | | $C_2H_2$ | 30 | | | | |
| | | $AlCl_3$/He | 0.1 | | | | |
| | | $SiF_4$ | 0.5 | | | | |
| | | NO | 0.1 | | | | |
| | | $B_2H_6$ (against $SiH_4$) | 0.3 ppm | | | | |

TABLE 176

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 50 | 250 | 1 | 0.4 | 0.02 |
| | | $H_2$ | 5→200* | | | | |
| | | $AlCl_3$/He | | | | | |
| | | (S-side: 0.01 μm) | 200→30** | | | | |
| | | (UL-side: 0.01 μm) | 30→10** | | | | |
| | | $C_2H_2$ | 10 | | | | |
| | | NO | 0.1 | | | | |
| | | $SiF_4$ | 5 | | | | |
| Upper layer | 1st layer region | $SiH_4$ | 100 | 300 | 10 | 0.35 | 3 |
| | | $B_2H_6$ (against $SiH_4$) | 800 ppm | | | | |
| | | $AlCl_3$/He | 0.1 | | | | |
| | | $SiF_4$ | 0.5 | | | | |
| | | $C_2H_2$ | 0.1 | | | | |
| | | $H_2$ | 150 | | | | |
| | | NO | 10 | | | | |
| | 2nd layer | $AlCl_3$/He | 0.1 | 300 | 15 | 0.4 | 20 |
| | | $SiF_4$ | 0.5 | | | | |

TABLE 176-continued

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| | region | $SiH_4$ | 100 | | | | |
| | | NO | 0.1 | | | | |
| | | $C_2H_2$ | 15 | | | | |
| | | $B_2H_6$ (against $SiH_4$) | 12→0.3 ppm** | | | | |
| | 3rd | $SiF_4$ | 0.5 | 300 | 20 | 0.5 | 3 |
| | layer | $SiH_4$ | 300 | | | | |
| | region | $H_2$ | 300 | | | | |
| | | $C_2H_2$ | 0.1 | | | | |
| | | $AlCl_3$/He | 0.1 | | | | |
| | | $B_2H_6$ (against $SiH_4$) | 0.3 ppm | | | | |
| | | NO | 0.1 | | | | |
| | 4th | $SiH_4$ | 50 | 300 | 10 | 0.4 | 0.5 |
| | layer | $C_2H_2$ | 30 | | | | |
| | region | $B_2H_6$ (against $SiH_4$) | 0.3 ppm | | | | |
| | | NO | 0.1 | | | | |
| | | $AlCl_3$/He | 0.1 | | | | |
| | | $SiF_4$ | 0.5 | | | | |

TABLE 177

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 50 | 250 | 5 | 0.4 | 0.05 |
| | | $GeH_4$ | 15 | | | | |
| | | $H_2$ | 10→200* | | | | |
| | | $AlCl_3$/He | 120→40** | | | | |
| Upper layer | 1st layer region | $SiH_4$ | 100 | 250 | 10 | 0.35 | 3 |
| | | $H_2$ | 100 | | | | |
| | | NO | 30 | | | | |
| | 2nd layer region | $SiH_4$ | 300 | 250 | 15 | 0.5 | 20 |
| | | $H_2$ | 300 | | | | |
| | 3rd layer region | $SiH_4$ | 50 | 250 | 10 | 0.4 | 0.5 |
| | | $CH_4$ | 500 | | | | |

TABLE 178

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 50 | 250 | 5 | 0.4 | 0.05 |
| | | $AlCl_3$/He | 120→40** | | | | |
| Upper layer | 1st layer region | $SiH_4$ | 100 | 250 | 10 | 0.35 | 3 |
| | | $H_2$ | 100 | | | | |
| | | NO | 30 | | | | |
| | 2nd layer region | $SiH_4$ | 300 | 250 | 15 | 0.5 | 20 |
| | | $H_2$ | 300 | | | | |
| | 3rd layer region | $SiH_4$ | 50 | 250 | 10 | 0.4 | 0.5 |
| | | $CH_4$ | 500 | | | | |

TABLE 179

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 50 | 250 | 5 | 0.4 | 0.02 |
| | | $GeH_4$ | 15 | | | | |
| | | $H_2$ | 10→200* | | | | |
| | | $AlCl_3$/He | | | | | |
| | | (S-side: 0.01 μm) | 100→10** | | | | |
| | | (UL-side: 0.01 μm) | 10 | | | | |
| Upper layer | 1st layer region | $SiH_4$ | 300 | 250 | 10 | 0.4 | 3 |
| | | $H_2$ | 300 | | | | |
| | | $B_2H_6$ (against $SiH_4$) | 800 ppm | | | | |
| | | NO | 30 | | | | |
| | 2nd layer region | $SiH_4$ | 300 | 250 | 15 | 0.5 | 20 |
| | | $H_2$ | 300 | | | | |
| | 3rd layer | $SiH_4$ | 50 | 250 | 10 | 0.4 | 0.5 |
| | | $CH_4$ | 500 | | | | |

TABLE 179-continued

| Order of lamination (layer name) | Gases and their flow rates (SCCM) | Substrate temperature (°C.) | RF discharging power (mW/cm³) | Inner pressure (Torr) | Layer thickness (μm) |
|---|---|---|---|---|---|
| region | | | | | |

TABLE 180

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 50 | 150 | 0.5 | 0.3 | 0.02 |
| | | $H_2$ | 5→200* | ↓ | ↓ | | |
| | | $AlCl_3$/He | | 300 | 1.5 | | |
| | | (S-side: 0.01 μm) | 200→30** | | | | |
| | | (UL-side: 0.01 μm) | 30→10** | | | | |
| | | NO | 5 | | | | |
| | | $GeH_4$ | 15 | | | | |
| | | $B_2H_6$ (against $SiH_4$) | 100 ppm | | | | |
| Upper layer | 1st layer region | $SiH_4$ | 100 | 270 | 10 | 0.35 | 3 |
| | | $H_2$ | 100 | | | | |
| | | $B_2H_6$ (against $SiH_4$) | 800 ppm | | | | |
| | | NO | 10 | | | | |
| | 2nd layer region | $SiH_4$ | 300 | 250 | 20 | 0.5 | 20 |
| | | $H_2$ | 500 | | | | |

TABLE 181

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 50 | 250 | 1 | 0.3 | 0.02 |
| | | $H_2$ | 5→200* | | | | |
| | | $AlCl_3$/He | | | | | |
| | | (S-side: 0.01 μm) | 200→30** | | | | |
| | | (UL-side: 0.01 μm) | 30→10** | | | | |
| | | NO | 10 | | | | |
| | | $GeH_4$ | 15 | | | | |
| Upper layer | 1st layer region | $SiH_4$ | 100 | 250 | 10 | 0.35 | 3 |
| | | He | 100 | | | | |
| | | $AlCl_3$/He | 0.4 | | | | |
| | | $SiF_4$ | 0.5 | | | | |
| | | $CH_4$ | 1 | | | | |
| | | NO | | | | | |
| | | (LL-side: 2 μm) | 10 | | | | |
| | | (U · 2nd LR-side: 1 μm) | 10→0** | | | | |
| | | $B_2H_6$ (against $SiH_4$) | 800 ppm | | | | |
| | 2nd layer region | $SiH_4$ | 300 | 250 | 25 | 0.6 | 25 |
| | | He | 600 | | | | |
| | | $AlCl_3$/He | 0.4 | | | | |
| | | $SiF_4$ | 0.5 | | | | |
| | | $CH_4$ | 1 | | | | |
| | | NO | 0.1 | | | | |
| | | $B_2H_6$ | 0.3 ppm | | | | |
| | | $GeH_4$ | 0.5 | | | | |
| | 3rd layer region | $SiH_4$ | 50 | 250 | 10 | 0.4 | 1 |
| | | $CH_4$ | 500 | | | | |
| | | NO | 0.1 | | | | |
| | | $SiF_4$ | 0.5 | | | | |
| | | $AlCl_3$/He | 0.5 | | | | |
| | | $B_2H_6$ | 0.3 ppm | | | | |
| | | $N_2$ | 1 | | | | |
| | | $GeH_4$ | 0.5 | | | | |

TABLE 182

| Order of lamination (layer name) | Gases and their flow rates (SCCM) | | Substrate temperature (°C.) | RF discharging power (mW/cm³) | Inner pressure (Torr) | Layer thickness (μm) |
|---|---|---|---|---|---|---|
| Lower layer | $SiH_4$ | 10→100* | 250 | 10 | 0.4 | 0.2 |
| | $H_2$ | 5→200* | | | | |
| | $Al(CH_3)_3$/He | | | | | |
| | (S-side: 0.05 μm) | 200→40** | | | | |
| | (UL-side: 0.15 μm) | 40→10** | | | | |
| | $NH_3$ | 1→4* | | | | |
| | $GeH_4$ | 1→10* | | | | |

TABLE 182-continued

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Upper layer | 1st layer region | $SiH_4$ | 100 | 250 | 10 | 0.35 | 3 |
| | | $H_2$ | 100 | | | | |
| | | $PH_3$ (against $SiH_4$) | 800 ppm | | | | |
| | | $NH_3$ | 4 | | | | |
| | 2nd layer region | $SiH_4$ | 400 | 250 | 10 | 0.5 | 15 |
| | | Ar | 200 | | | | |
| | 3rd layer region | $SiH_4$ | 100 | 250 | 5 | 0.4 | 0.3 |
| | | $NH_3$ | 30 | | | | |

TABLE 183

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 10→100* | 300 | 10 | 0.4 | 0.2 |
| | | $H_2$ | 5→200* | | | | |
| | | $AlCl_3$/He | | | | | |
| | | (S-side: 0.05 μm) | 200→40** | | | | |
| | | (UL-side: 0.15 μm) | 40→10** | | | | |
| | | $C_2H_2$ | 1→5* | | | | |
| | | $B_2H_6$ (against $SiH_4$) | 100 ppm | | | | |
| | | $GeH_4$ | 1→10* | | | | |
| Upper layer | 1st layer region | $SiH_4$ | 100 | 300 | 10 | 0.35 | 3 |
| | | $H_2$ | 100 | | | | |
| | | $B_2H_6$ (against $SiH_4$) | 1000 ppm | | | | |
| | | $C_2H_2$ | 5 | | | | |
| | 2nd layer region | $SiH_4$ | 300 | 300 | 20 | 0.5 | 20 |
| | | $H_2$ | 500 | | | | |
| | | $SiF_4$ | 50 | | | | |
| | 3rd layer region | $SiH_4$ | 100 | 300 | 15 | 0.4 | 7 |
| | | $CH_4$ | 600 | | | | |
| | | $PH_3$ (against $SiH_4$) | 3000 ppm | | | | |
| | 4th layer region | $SiH_4$ | 40 | 300 | 10 | 0.4 | 0.1 |
| | | $CH_4$ | 600 | | | | |

TABLE 184

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 50 | 330 | 5 | 0.4 | 0.05 |
| | | $H_2$ | 5→200* | | | | |
| | | $AlCl_3$/He | 200→20** | | | | |
| | | NO | 5 | | | | |
| | | $PH_3$ (against $SiH_4$) | 100 ppm | | | | |
| | | $GeH_4$ | 5 | | | | |
| Upper layer | 1st layer region | $SiH_4$ | 100 | 330 | 10 | 0.35 | 3 |
| | | $H_2$ | 100 | | | | |
| | | $PH_3$ (against $SiH_4$) | 800 ppm | | | | |
| | | NO | 10 | | | | |
| | 2nd layer region | $SiH_4$ | 400 | 330 | 25 | 0.5 | 25 |
| | | $SiF_4$ | 10 | | | | |
| | | $H_2$ | 800 | | | | |
| | 3rd layer region | $SiH_4$ | 100 | 350 | 15 | 0.4 | 5 |
| | | $CH_4$ | 400 | | | | |
| | | $B_2H_6$ (against $SiH_4$) | 5000 ppm | | | | |
| | 4th layer region | $SiH_4$ | 20 | 350 | 10 | 0.4 | 1 |
| | | $CH_4$ | 400 | | | | |
| | | $B_2H_6$ (against $SiH_4$) | 8000 ppm | | | | |

TABLE 185

| Order of lamination (layer name) | Gases and their flow rates (SCCM) | | Substrate temperature (°C.) | RF discharging power (mW/cm³) | Inner pressure (Torr) | Layer thickness (μm) |
|---|---|---|---|---|---|---|
| Lower layer | $SiH_4$ | 50 | 300 | 1 | 0.3 | 0.02 |
| | $H_2$ | 5→200* | | | | |
| | $AlCl_3$/He | | | | | |
| | (S-side: 0.01 μm) | 200→30** | | | | |
| | (UL-side: 0.01 μm) | 30→10** | | | | |
| | $B_2H_6$ (against $SiH_4$) | 100 ppm | | | | |

TABLE 185-continued

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| | | $N_2$ | 100→150* | | | | |
| | | $H_2S$ | 10 ppm | | | | |
| | | $GeH_4$ | 15 | | | | |
| Upper layer | 1st layer region | $SiH_4$ | 100 | 300 | 10 | 0.35 | 5 |
| | | $H_2$ | 150 | | | | |
| | | $B_2H_6$ (against $SiH_4$) | 900→600 ppm** | | | | |
| | | $N_2$ | 150 | | | | |
| | 2nd layer region | $SiH_4$ | 300 | 300 | 20 | 0.5 | 20 |
| | | $H_2$ | 200 | | | | |
| | 3rd layer region | $SiH_4$ | 50 | 300 | 20 | 0.4 | 5 |
| | | $N_2$ | 500 | | | | |
| | | $PH_3$ (against $SiH_4$) | 3000 ppm | | | | |
| | 4th layer region | $SiH_4$ | 40 | 300 | 10 | 0.4 | 0.3 |
| | | $CH_4$ | 600 | | | | |

TABLE 186

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 50 | 250 | 1 | 0.4 | 0.02 |
| | | $GeH_4$ | 15 | | | | |
| | | $H_2$ | 5→200* | | | | |
| | | $AlCl_3$/He | | | | | |
| | | (S-side: 0.01 μm) | 200→30** | | | | |
| | | (UL-side: 0.01 μm) | 30→10** | | | | |
| Upper layer | 1st layer region | $SiH_4$ | 100 | 250 | 10 | 0.4 | 3 |
| | | $H_2$ | 100 | | | | |
| | | $B_2H_6$ (against $SiH_4$) | 1000 ppm | | | | |
| | | $C_2H_2$ | 5 | | | | |
| | 2nd layer region | $SiH_4$ | 300 | 250 | 15 | 0.5 | 10 |
| | | $H_2$ | 300 | | | | |
| | 3rd layer region | $SiH_4$ | 200 | 250 | 15 | 0.4 | 20 |
| | | $C_2H_2$ | 10→20* | | | | |
| | | NO | 1 | | | | |

TABLE 187

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 50 | 250 | 1 | 0.4 | 0.02 |
| | | $H_2$ | 5→200* | | | | |
| | | $AlCl_3$/He | | | | | |
| | | (S-side: 0.01 μm) | 200→30** | | | | |
| | | (UL-side: 0.01 μm) | 30→10** | | | | |
| | | $N_2$ | 100 | | | | |
| | | $H_2S$ (against $SiH_4$) | 10 ppm | | | | |
| | | $BF_3$ | 10 ppm | | | | |
| | | $GeH_4$ | 20 | | | | |
| Upper layer | 1st layer region | $SiH_4$ | 100 | 300 | 10 | 0.35 | 3 |
| | | $H_2$ | 150 | | | | |
| | | $BF_3$ (against $SiH_4$) | 1000 ppm | | | | |
| | | $N_2$ | 150 | | | | |
| | 2nd layer region | $SiH_4$ | 300 | 300 | 20 | 0.5 | 5 |
| | | $H_2$ | 300 | | | | |
| | 3rd layer region | $SiH_4$ | 100 | 300 | 15 | 0.4 | 20 |
| | | $CH_4$ | 100 | | | | |
| | 4th layer region | $SiH_4$ | 50 | 300 | 10 | 0.4 | 0.5 |
| | | $CH_4$ | 600 | | | | |

TABLE 188

| Order of lamination (layer name) | Gases and their flow rates (SCCM) | | Substrate temperature (°C.) | RF discharging power (mW/cm³) | Inner pressure (Torr) | Layer thickness (μm) |
|---|---|---|---|---|---|---|
| Lower layer | $SiH_4$ | 10→100* | 300 | 5 | 0.4 | 0.2 |
| | $H_2$ | 5→200* | | | | |

TABLE 188-continued

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| | | $AlCl_3$/He | | | | | |
| | | (S-side: 0.05 μm) | 200→40** | | | | |
| | | (UL-side: 0.15 μm) | 40→10** | | | | |
| | | $NH_3$ | 1→5* | | | | |
| | | $GeH_4$ | 1→10* | | | | |
| Upper layer | 1st layer region | $SiH_4$ | 100 | 300 | 10 | 0.35 | 3 |
| | | $H_2$ | 100 | | | | |
| | | $PH_3$ (against $SiH_4$) | 800 ppm | | | | |
| | | $NH_3$ | 5 | | | | |
| | 2nd layer region | $SiH_4$ | 100 | 300 | 5 | 0.2 | 8 |
| | | $H_2$ | 300 | | | | |
| | 3rd layer region | $SiH_4$ | 300 | 300 | 15 | 0.4 | 25 |
| | | $NH_3$ | 50 | | | | |
| | | $B_2H_6$ | | | | | |
| | 4th layer region | $SiH_4$ | 100 | 300 | 10 | 0.4 | 0.3 |
| | | $NH_4$ | 50 | | | | |

TABLE 189

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 10→100* | 250 | 5 | 0.4 | 0.2 |
| | | $H_2$ | 5→200* | | | | |
| | | $AlCl_3$/He | | | | | |
| | | (S-side: 0.05 μm) | 200→40** | | | | |
| | | (UL-side: 0.15 μm) | 40→10** | | | | |
| | | NO | 5→10* | | | | |
| | | $GeF_4$ | 5→10* | | | | |
| | | $PF_5$ (against $SiH_4$) | 10→100 ppm* | | | | |
| Upper layer | 1st layer region | $SiH_4$ | 100 | 280 | 10 | 0.35 | 3 |
| | | $H_2$ | 100 | | | | |
| | | $PF_5$ (against $SiH_4$) | 1000 ppm | | | | |
| | | NO | 10 | | | | |
| | 2nd layer region | $SiH_4$ | 100 | 300 | 3 | 0.5 | 3 |
| | | $SiF_4$ | 5 | | | | |
| | | $H_2$ | 200 | | | | |
| | 3rd layer region | $SiH_4$ | 100 | 300 | 15 | 0.4 | 30 |
| | | $CH_4$( | 100 | | | | |
| | | $B_2H_6$ (against $SiH_4$) | 50 ppm | | | | |
| | 4th layer region | $SiH_4$ | 50 | 300 | 10 | 0.4 | 0.5 |
| | | $CH_4$ | 600 | | | | |

TABLE 190

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 50 | 250 | 5 | 0.4 | 0.05 |
| | | $H_2$ | 5→200* | | | | |
| | | $AlCl_3$/He | 200→20** | | | | |
| | | NO | 10 | | | | |
| | | $B_2H_6$ (against $SiH_4$) | 100 ppm | | | | |
| | | $Si_2F_6$ | 5 | | | | |
| | | $GeH_4$ | 20 | | | | |
| Upper layer | 1st layer region | $SiH_4$ | 100 | 300 | 10 | 0.35 | 3 |
| | | $H_2$ | 100 | | | | |
| | | $B_2H_6$ (against $SiH_4$) | 800 ppm | | | | |
| | | NO | | | | | |
| | | (LL-side: 2 μm) | 10 | | | | |
| | | (U · 2nd LR-side: 1 μm) | 10→0** | | | | |
| | 2nd layer region | $Si_2H_6$ | 200 | 300 | 10 | 0.5 | 10 |
| | | $H_2$ | 200 | | | | |
| | 3rd layer region | $SiH_4$ | 300 | 330 | 20 | 0.4 | 30 |
| | | $C_2H_2$ | 50 | | | | |
| | | $PH_3$ (against $SiH_4$) | 100 ppm | | | | |
| | 4th layer region | $SiH_4$ | 200 | 330 | 10 | 0.4 | 1 |
| | | $C_2H_2$ | 200 | | | | |

TABLE 191

| Order of lamination (layer name) | | Gases and their flow rates (SCCM) | | Substrate temperature (°C.) | RF discharging power (mW/cm$^3$) | Inner pressure (Torr) | Layer thickness (μm) |
|---|---|---|---|---|---|---|---|
| Lower layer | | $SiH_4$ | 10→100* | 250 | 5 | 0.4 | 0.2 |
| | | $H_2$ | 5→200* | | | | |
| | | $AlCl_3$/He | | | | | |
| | | (S-side: 0.05 μm) | 200→40** | | | | |
| | | (UL-side: 0.15 μm) | 40→10** | | | | |
| | | $NH_3$ | 1→5* | | | | |
| | | $B_2H_6$ (against $SiH_4$) | 150 ppm | | | | |
| | | $Si_2F_6$ | 1→8* | | | | |
| | | $GeH_4$ | 5→20* | | | | |
| Upper layer | 1st layer region | $SiH_4$ | 100 | 270 | 10 | 0.35 | 3 |
| | | $H_2$ | 100 | | | | |
| | | $B_2H_6$ (against $SiH_4$) | 800 ppm | | | | |
| | | $NH_3$ | 5 | | | | |
| | 2nd layer region | $SiH_4$ | 100 | 300 | 5 | 0.2 | 8 |
| | | $H_2$ | 300 | | | | |
| | | $Si_2F_6$ | 10 | | | | |
| | 3rd layer region | $SiH_4$ | 300 | 300 | 15 | 0.4 | 25 |
| | | $NH_3$ | 30→50* | | | | |
| | | $PF_5$ (against $SiH_4$) | 50 ppm | | | | |
| | 4th layer region | $SiH_4$ | 100 | 300 | 5 | 0.4 | 0.7 |
| | | $NH_3$ | 80→100* | | | | |
| | | $PF_5$ (against $SiH_4$) | 500 ppm | | | | |

TABLE 192

| Order of lamination (layer name) | | Gases and their flow rates (SCCM) | | Substrate temperature (°C.) | RF discharging power (mW/cm$^3$) | Inner pressure (Torr) | Layer thickness (μm) |
|---|---|---|---|---|---|---|---|
| Lower layer | | $SiH_4$ | 50 | 250 | 1 | 0.4 | 0.02 |
| | | $H_2$ | 5→200* | | | | |
| | | $AlCl_3$/He | | | | | |
| | | (S-side: 0.01 μm) | 200→30** | | | | |
| | | (UL-side: 0.01 μm) | 30→10** | | | | |
| | | NO | 5 | | | | |
| | | $GeH_4$ | 5 | | | | |
| Upper layer | 1st layer region | $SiH_4$ | 100 | 250 | 10 | 0.35 | 3 |
| | | $H_2$ | 100 | | | | |
| | | $B_2H_6$ (against $SiH_4$) | 800 ppm | | | | |
| | | NO | | | | | |
| | | (LL-side: 2 μm) | 10 | | | | |
| | | (U · 2nd LR-side: 1 μm) | 10→0** | | | | |
| | 2nd layer region | $SiH_4$ | 300 | 300 | 20 | 0.5 | 20 |
| | | $H_2$ | 500 | | | | |
| | 3rd layer region | $SiH_4$ | 100 | 300 | 5 | 0.4 | 1 |
| | | $GeH_4$ | 10→50* | | | | |
| | | $H_2$ | 300 | | | | |
| | 4th layer region | $SiH_4$ | 100→40** | 300 | 10 | 0.4 | 1 |
| | | $CH_4$ | 100→600* | | | | |

TABLE 193

| Order of lamination (layer name) | | Gases and their flow rates (SCCM) | | Substrate temperature (°C.) | RF discharging power (mW/cm$^3$) | Inner pressure (Torr) | Layer thickness (μm) |
|---|---|---|---|---|---|---|---|
| Lower layer | | $SiH_4$ | 50 | 300 | 1 | 0.3 | 0.02 |
| | | $H_2$ | 5→200* | | | | |
| | | $AlCl_3$/He | | | | | |
| | | (S-side: 0.01 μm) | 200→30** | | | | |
| | | (UL-side: 0.01 μm) | 30→10** | | | | |
| | | NO | 9 | | | | |
| | | $B_2H_6$ (against $SiH_4$) | 80 ppm | | | | |
| | | $GeH_4$ | 15 | | | | |
| Upper layer | 1st layer region | $SiH_4$ | 85 | 330 | 9 | 0.35 | 3 |
| | | $H_2$ | 95 | | | | |
| | | $B_2H_6$ (against $SiH_4$) | 800 ppm | | | | |
| | | NO | 9 | | | | |
| | 2nd layer region | $SiH_4$ | 300 | 300 | 15 | 0.5 | 20 |
| | | $H_2$ | 400 | | | | |
| | 3rd layer | $SiH_4$ | 50 | 300 | 10 | 0.4 | 0.5 |
| | | $CH_4$ | 500 | | | | |

TABLE 193-continued

| Order of lamination (layer name) | Gases and their flow rates (SCCM) | Substrate temperature (°C.) | RF discharging power (mW/cm³) | Inner pressure (Torr) | Layer thickness (μm) |
|---|---|---|---|---|---|
| region | | | | | |

TABLE 194

| Order of lamination (layer name) | Gases and their flow rates (SCCM) | | Substrate temperature (°C.) | RF discharging power (mW/cm³) | Inner pressure (Torr) | Layer thickness (μm) |
|---|---|---|---|---|---|---|
| Lower layer | $SiH_4$ | 50 | 300 | 0.7 | 0.3 | 0.02 |
| | $H_2$ | 5→200* | | | | |
| | $AlCl_3$/He | | | | | |
| | (S-side: 0.01 μm) | 200→30** | | | | |
| | (UL-side: 0.01 μm) | 30→10** | | | | |
| | NO | 8 | | | | |
| | $B_2H_6$ (against $SiH_4$) | 80 ppm | | | | |
| | $GeH_4$ | 15 | | | | |
| Upper layer 1st layer region | $SiH_4$ | 70 | 300 | 8 | 0.35 | 3 |
| | $H_2$ | 80 | | | | |
| | $B_2H_6$ (against $SiH_4$) | 800 ppm | | | | |
| | NO | 8 | | | | |
| 2nd layer region | $SiH_4$ | 200 | 300 | 12 | 0.4 | 20 |
| | $H_2$ | 400 | | | | |
| 3rd layer region | $SiH_4$ | 40 | 300 | 7 | 0.3 | 0.5 |
| | $CH_4$ | 400 | | | | |

TABLE 195

| Order of lamination (layer name) | Gases and their flow rates (SCCM) | | Substrate temperature (°C.) | RF discharging power (mW/cm³) | Inner pressure (Torr) | Layer thickness (μm) |
|---|---|---|---|---|---|---|
| Lower layer | $SiH_4$ | 25 | 300 | 0.5 | 0.2 | 0.02 |
| | $H_2$ | 5→100* | | | | |
| | $AlCl_3$/He | | | | | |
| | (S-side: 0.01 μm) | 100→15** | | | | |
| | (UL-side: 0.01 μm) | 15→5** | | | | |
| | NO | 7 | | | | |
| | $B_2H_6$ (against $SiH_4$) | 80 ppm | | | | |
| | $GeH_4$ | 4 | | | | |
| Upper layer 1st layer region | $SiH_4$ | 55 | 300 | 7 | 0.35 | 3 |
| | $H_2$ | 70 | | | | |
| | $B_2H_6$ (against $SiH_4$) | 800 ppm | | | | |
| | NO | 7 | | | | |
| 2nd layer region | $SiH_4$ | 150 | 300 | 10 | 0.4 | 20 |
| | $H_2$ | 300 | | | | |
| 3rd layer region | $SiH_4$ | 30 | 300 | 5 | 0.3 | 0.5 |
| | $CH_4$ | 300 | | | | |

TABLE 196

| Order of lamination (layer name) | Gases and their flow rates (SCCM) | | Substrate temperature (°C.) | RF discharging power (mW/cm³) | Inner pressure (Torr) | Layer thickness (μm) |
|---|---|---|---|---|---|---|
| Lower layer | $SiH_4$ | 20 | 300 | 0.3 | 0.2 | 0.02 |
| | $H_2$ | 5→100* | | | | |
| | $AlCl_3$/He | | | | | |
| | (S-side: 0.01 μm) | 80→15** | | | | |
| | (UL-side: 0.01 μm) | 15→5** | | | | |
| | NO | 5 | | | | |
| | $B_2H_6$ (against $SiH_4$) | 80 ppm | | | | |
| | $GeH_4$ | 4 | | | | |
| Upper layer 1st layer region | $SiH_4$ | 45 | 300 | 6 | 0.35 | 3 |
| | $H_2$ | 60 | | | | |
| | $B_2H_6$ (against $SiH_4$) | 800 ppm | | | | |
| | NO | 5 | | | | |
| 2nd layer region | $SiH_4$ | 100 | 300 | 6 | 0.3 | 20 |
| | $H_2$ | 300 | | | | |
| 3rd layer | $SiH_4$ | 20 | 300 | 3 | 0.2 | 0.5 |
| | $CH_4$ | 200 | | | | |

TABLE 196-continued

| Order of lamination (layer name) | Gases and their flow rates (SCCM) | Substrate temperature (°C.) | RF discharging power (mW/cm³) | Inner pressure (Torr) | Layer thickness (μm) |
|---|---|---|---|---|---|
| region | | | | | |

TABLE 197

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 50 | 500 | 5 | 0.4 | 0.05 |
| | | $H_2$ | 5→200* | | | | |
| | | $AlCl_3$/He | 200→20** | | | | |
| | | $C_2H_2$ | 5 | | | | |
| | | $B_2H_6$ (against $SiH_4$) | 60 ppm | | | | |
| | | $GeH_4$ | 25 | | | | |
| Upper layer | 1st layer region | $SiH_4$ | 180 | 500 | 22 | 0.4 | 4 |
| | | $H_2$ | 1200 | | | | |
| | | $B_2H_6$ (against $SiH_4$) | 700 ppm | | | | |
| | | $C_2H_2$ | 8 | | | | |
| | 2nd layer region | $SiH_4$ | 300 | 500 | 30 | 0.5 | 10 |
| | | $H_2$ | 1500 | | | | |
| | 3rd layer region | $SiH_4$ | 200 | 500 | 30 | 0.4 | 20 |
| | | $C_2H_2$ | 10→20* | | | | |
| | | NO | 1 | | | | |

TABLE 198

| Order of lamination (layer name) | | Gases and their flow rates (SCCM) | | Substrate temperature (°C.) | μW discharging power(mw/cm³) | Inner pressure (Torr) | Layer thickness (μm) |
|---|---|---|---|---|---|---|---|
| Lower layer | | $SiH_4$ | 150 | 250 | 0.5 | 0.6 | 0.02 |
| | | $H_2$ | 20→500* | | | | |
| | | $AlCl_3$/He | | | | | |
| | | (S-side: 0.01 μm) | 400→80** | | | | |
| | | (UL-side: 0.01 μm) | 80→50** | | | | |
| | | NO | 10 | | | | |
| | | $B_2H_6$ (against $SiH_4$) | 60 ppm | | | | |
| | | $GeH_4$ | 40 | | | | |
| Upper layer | 1st layer region | $SiH_4$ | 350 | 250 | 0.5 | 0.5 | 3 |
| | | $H_2$ | 350 | | | | |
| | | $B_2H_6$ (against $SiH_4$) | 600 ppm | | | | |
| | | NO | 13 | | | | |
| | | $SiF_4$ | 20 | | | | |
| | 2nd layer region | $SiH_4$ | 700 | 250 | 0.5 | 0.5 | 20 |
| | | $SiF_4$ | 30 | | | | |
| | | $H_2$ | 500 | | | | |
| | 3rd layer region | $SiH_4$ | 150 | 250 | 0.5 | 0.3 | 1 |
| | | $CH_4$ | 500 | | | | |

TABLE 199

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 50 | 250 | 5 | 0.4 | 0.05 |
| | | $H_2$ | 5→200* | | | | |
| | | $AlCl_3$/He | 200→20** | | | | |
| | | $C_2H_2$ | 5 | | | | |
| | | $B_2H_6$ (against $SiH_4$) | 100 ppm | | | | |
| | | $GeH_4$ | 15 | | | | |
| Upper layer | 1st layer region | $SiH_4$ | 100 | 250 | 10 | 0.35 | 3 |
| | | $H_2$ | 100 | | | | |
| | | $B_2H_6$ (against $SiH_4$) | 1000 ppm | | | | |
| | | $C_2H_2$ | 5 | | | | |
| | | $Si_2F_6$ | 5 | | | | |
| | 2nd layer region | $SiH_4$ | 200 | 250 | 15 | 0.4 | 20 |
| | | $C_2H_2$ | 10→20* | | | | |
| | | NO | 1 | | | | |
| | | $SiF_4$ | 5 | | | | |
| | 3rd layer region | $SiH_4$ | 300 | 250 | 15 | 0.5 | 10 |
| | | $H_2$ | 300 | | | | |
| | | $SiF_4$ | 5 | | | | |

TABLE 200

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 50 | 250 | 1 | 0.4 | 0.02 |
| | | $H_2$ | 5→200* | | | | |
| | | $AlCl_3$/He | | | | | |
| | | (S-side: 0.01 μm) | 200→30** | | | | |
| | | (UL-side: 0.01 μm) | 30→10** | | | | |
| | | $N_2$ | 100 | | | | |
| | | $B_2H_6$ (against $SiH_4$) | 10 ppm | | | | |
| | | $GeH_4$ | 1→10* | | | | |
| Upper layer | 1st layer region | $SiH_4$ | 100 | 300 | 10 | 0.35 | 3 |
| | | $H_2$ | 150 | | | | |
| | | $B_2H_6$ (against $SiH_4$) | 900→600 ppm** | | | | |
| | | $N_2$ | 150 | | | | |
| | 2nd layer region | $SiH_4$ | 100 | 300 | 15 | 0.4 | 20 |
| | | $CH_2$ | 100 | | | | |
| | 3rd layer region | $SiH_4$ | 300 | 300 | 20 | 0.5 | 5 |
| | | $H_2$ | 300 | | | | |
| | 4th layer region | $SiH_4$ | 50 | 300 | 10 | 0.4 | 0.5 |
| | | $CH_4$ | 600 | | | | |

TABLE 201

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 10→100* | 300 | 5 | 0.4 | 0.2 |
| | | $H_2$ | 5→200* | | | | |
| | | $AlCl_3$/He | | | | | |
| | | (S-side: 0.05 μm) | 200→40** | | | | |
| | | (UL-side: 0.15 μm) | 40→10** | | | | |
| | | $NH_3$ | 1→5* | | | | |
| | | $SnH_4$ | 2→20* | | | | |
| Upper layer | 1st layer region | $SiH_4$ | 100 | 300 | 10 | 0.35 | 3 |
| | | $H_2$ | 100 | | | | |
| | | $PF_5$ (against $SiH_4$) | 800 ppm | | | | |
| | | $NH_3$ | 5 | | | | |
| | 2nd layer region | $SiH_4$ | 300 | 300 | 15 | 0.4 | 25 |
| | | $NH_2$ | 5 | | | | |
| | 3rd layer region | $SiH_4$ | 100 | 300 | 5 | 0.2 | 8 |
| | | $H_2$ | 300 | | | | |
| | | $Si_2F_6$ | 5 | | | | |
| | 4th layer region | $SiH_4$ | 100 | 300 | 10 | 0.4 | 0.3 |
| | | $NH_3$ | 50 | | | | |

TABLE 202

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 10→100* | 250 | 5 | 0.4 | 0.2 |
| | | $H_2$ | 5→200* | | | | |
| | | $AlCl_3$/He | | | | | |
| | | (S-side: 0.05 μm) | 200→40** | | | | |
| | | (UL-side: 0.15 μm) | 40→10** | | | | |
| | | NO | 5→10* | | | | |
| | | $PF_5$ (against $SiH_4$) | 10→100 ppm* | | | | |
| | | $GeH_4$ | 2→20* | | | | |
| Upper layer | 1st layer region | $SiH_4$ | 100 | 250 | 10 | 0.35 | 3 |
| | | $H_2$ | 100 | | | | |
| | | $PF_5$ (against $SiH_4$) | 1000 ppm | | | | |
| | | NO | 10 | | | | |
| | 2nd layer region | $SiH_4$ | 100 | 300 | 15 | 0.4 | 30 |
| | | $CH_4$ | 100 | | | | |
| | | $PF_5$ (against $SiH_4$) | 50 ppm | | | | |
| | 3rd layer region | $SiH_4$ | 100 | 300 | 3 | 0.5 | 3 |
| | | $SiF_4$ | 5 | | | | |
| | | $H_2$ | 200 | | | | |
| | 4th layer | $SiH_4$ | 50 | 300 | 10 | 0.4 | 0.5 |
| | | $CH_4$ | 600 | | | | |

TABLE 202-continued

| Order of lamination (layer name) | Gases and their flow rates (SCCM) | Substrate temperature (°C.) | RF discharging power (mW/cm³) | Inner pressure (Torr) | Layer thickness (μm) |
|---|---|---|---|---|---|
| region | | | | | |

TABLE 203

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 50 | 250 | 5 | 0.4 | 0.05 |
| | | $H_2$ | 5→200* | | | | |
| | | $AlCl_3$/He | 200→20** | | | | |
| | | NO | 10 | | | | |
| | | $B_2H_6$ (against $SiH_4$) | 100 ppm | | | | |
| | | $GeH_4$ | 10 | | | | |
| Upper layer | 1st layer region | $SiH_4$ | 100 | 300 | 10 | 0.35 | 3 |
| | | $H_2$ | 100 | | | | |
| | | $B_2H_6$ (against $SiH_4$) | 800 ppm | | | | |
| | | NO | | | | | |
| | | (LL-side: 2 μm) | 10 | | | | |
| | | (U · 2nd LR-side: 1 μm) | 10→0** | | | | |
| | 2nd layer region | $SiH_4$ | 300 | 330 | 20 | 0.4 | 30 |
| | | $C_2H_2$ | 50 | | | | |
| | | $B_2H_6$ (against $SiH_4$) | 100 ppm | | | | |
| | 3rd layer region | $Si_2H_6$ | 200 | 300 | 10 | 0.5 | 10 |
| | | $H_2$ | 200 | | | | |
| | 4th layer region | $SiH_4$ | 200 | 330 | 10 | 0.4 | 1 |
| | | $C_2H_2$ | 200 | | | | |

TABLE 204

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 10→100* | 250 | 5 | 0.4 | 0.2 |
| | | $GeH_4$ | 1→10* | | | | |
| | | $NH_3$ | 1→5* | | | | |
| | | $H_2$ | 5→200* | | | | |
| | | $AlCl_3$/He | | | | | |
| | | (S-side: 0.05 μm) | 200→40** | | | | |
| | | (UL-side: 0.15 μm) | 40→10** | | | | |
| Upper layer | 1st layer region | $SiH_4$ | 100 | 300 | 10 | 0.4 | 3 |
| | | $H_2$ | 100 | | | | |
| | | $PH_3$ (against $SiH_4$) | 800 ppm | | | | |
| | | $NH_3$ | 5 | | | | |
| | 2nd layer region | $SiH_4$ | 300 | 300 | 15 | 0.4 | 25 |
| | | $NH_3$ | 30→50* | | | | |
| | | $PH_3$ (against $SiH_4$) | 50 ppm | | | | |
| | 3rd layer region | $SiH_4$ | 100 | 300 | 5 | 0.4 | 8 |
| | | $H_2$ | 300 | | | | |
| | 4th layer region | $SiH_4$ | 100 | 300 | 5 | 0.4 | 0.7 |
| | | $NH_3$ | 80→100* | | | | |
| | | $B_2H_6$ (against $SiH_4$) | 500 ppm | | | | |

TABLE 205

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 50 | 250 | 1 | 0.3 | 0.02 |
| | | $H_2$ | 5→200* | | | | |
| | | $AlCl_3$/He | | | | | |
| | | (S-side: 0.01 μm) | 200→30** | | | | |
| | | (UL-side: 0.01 μm) | 30→10** | | | | |
| | | NO | 10 | | | | |
| | | $GeH_4$ | 5 | | | | |
| Upper layer | 1st layer region | $SiH_4$ | 100 | 250 | 10 | 0.35 | 3 |
| | | $H_2$ | 100 | | | | |
| | | NO | | | | | |
| | | (LL-side: 2 μm) | 10 | | | | |
| | | (U · 2nd LR-side: 1 μm) | 10→0** | | | | |
| | | $B_2H_6$ (against $SiH_4$) | 800 ppm | | | | |

TABLE 205-continued

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| | 2nd layer region | $SiH_4$ | 300 | 250 | 25 | 0.6 | 25 |
| | | He | 600 | | | | |
| | 4th layer region | $SiH_4$ | 50 | 250 | 10 | 0.4 | 1 |
| | | $CH_4$ | 500 | | | | |
| | | NO | 0.1 | | | | |
| | | $N_2$ | 1 | | | | |

TABLE 206

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 10→100* | 300 | 10 | 0.4 | 0.2 |
| | | $H_2$ | 5→200* | | | | |
| | | $AlCl_3$/He | | | | | |
| | | (S-side: 0.05 μm) | 200→40** | | | | |
| | | (UL-side: 0.15 μm) | 40→10** | | | | |
| | | $C_2H_2$ | 1→5* | | | | |
| | | $B_2H_6$ (against $SiH_4$) | 100 ppm | | | | |
| | | $GeH_4$ | 2→20* | | | | |
| Upper layer | 1st layer region | $SiH_4$ | 100 | 300 | 10 | 0.35 | 3 |
| | | $H_2$ | 100 | | | | |
| | | $B_2H_6$ (against $SiH_4$) | 1000 ppm | | | | |
| | | $C_2H_2$ | 5 | | | | |
| | | $AlCl_3$/He | 0.1 | | | | |
| | | NO | 0.1 | | | | |
| | | $SiF_4$ | 0.5 | | | | |
| | 2nd layer region | $SiH_4$ | 300 | 300 | 20 | 0.5 | 20 |
| | | $H_2$ | 500 | | | | |
| | | $C_2H_2$ | 0.1 | | | | |
| | | $AlCl_3$/He | 0.1 | | | | |
| | | NO | 0.1 | | | | |
| | | $SiF_4$ | 0.5 | | | | |
| | | $B_2H_6$ (against $SiH_4$) | 0.3 ppm | | | | |
| | | $GeH_4$ | 1 | | | | |
| | 3rd layer region | $SiH_4$ | 100 | 300 | 15 | 0.4 | 7 |
| | | $CH_4$ | 600 | | | | |
| | | $PH_3$ (against $SiH_4$) | 3000 ppm | | | | |
| | | $AlCl_3$/He | 0.1 | | | | |
| | | NO | 0.1 | | | | |
| | | $SiF_4$ | 0.5 | | | | |
| | | $B_2H_6$ (against $SiH_4$) | 0.3 ppm | | | | |
| | | $GeH_4$ | 2 | | | | |
| | 4th layer region | $SiH_4$ | 40 | 300 | 10 | 0.4 | 0.1 |
| | | $CH_4$ | 600 | | | | |
| | | $AlCl_3$/He | 0.1 | | | | |
| | | NO | 0.1 | | | | |
| | | $SiF_4$ | 0.5 | | | | |
| | | $B_2H_6$ (against $SiH_4$) | 0.3 ppm | | | | |
| | | $PH_3$ | 1 ppm | | | | |
| | | $GeH_4$ | 0.5 | | | | |

TABLE 207

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 10→100* | 250 | 5 | 0.4 | 0.2 |
| | | $H_2$ | 5→200* | | | | |
| | | $AlCl_3$/He | | | | | |
| | | (S-side: 0.05 μm) | 200→40** | | | | |
| | | (UL-side: 0.15 μm) | 40→10** | | | | |
| | | NO | 5→10* | | | | |
| | | $PH_3$ (against $SiH_4$) | 10→100 ppm* | | | | |
| | | $GeH_4$ (against $SiH_4$) | 3→30 | | | | |
| Upper layer | 1st layer region | $SiH_4$ | 100 | 280 | 10 | 0.35 | 3 |
| | | $H_2$ | 100 | | | | |
| | | $PH_3$ (against $SiH_4$) | 800 ppm | | | | |
| | | NO | 10 | | | | |
| | | $AlCl_3$/He | 0.1 | | | | |
| | | $SiF_4$ | 0.5 | | | | |
| | | $CH_4$ | 1 | | | | |
| | 2nd layer | $SiH_4$ | 100 | 300 | 3 | 0.5 | 3 |
| | | $SiF_4$ | 5 | | | | |

TABLE 207-continued

| Order of lamination (layer name) | Gases and their flow rates (SCCM) | | Substrate temperature (°C.) | RF discharging power (mW/cm$^3$) | Inner pressure (Torr) | Layer thickness (μm) |
|---|---|---|---|---|---|---|
| region | $H_2$ | 200 | | | | |
| | $PH_3$ (against $SiH_4$) | 0.3 ppm | | | | |
| | NO | 0.5 | | | | |
| | $CH_4$ | 1 | | | | |
| | $AlCl_3$/He | 0.8 | | | | |
| 3rd layer region | $SiH_4$ | 100 | 300 | 15 | 0.4 | 30 |
| | $CH_4$ | 100 | | | | |
| | $PH_3$ (against $SiH_4$) | 0.5 ppm | | | | |
| | $AlCl_3$/He | 0.3 | | | | |
| | NO | 0.3 | | | | |
| | $SiF_4$ | 0.5 | | | | |
| | $B_2H_6$ (against $SiH_4$) | 50 ppm | | | | |
| 4th layer region | $SiH_4$ | 50 | 300 | 10 | 0.4 | 0.5 |
| | $CH_4$ | 600 | | | | |
| | $AlCl_3$/He | 0.3 | | | | |
| | $SiF_4$ | 0.5 | | | | |
| | NO | 0.1 | | | | |
| | $PH_3$ (against $SiH_4$) | 0.3 ppm | | | | |
| | $B_2H_6$ (against $SiH_4$) | 0.5 ppm | | | | |

TABLE 208

| Order of lamination (layer name) | Gases and their flow rates (SCCM) | | Substrate temperature (°C.) | RF discharging power (mW/cm$^3$) | Inner pressure (Torr) | Layer thickness (μm) |
|---|---|---|---|---|---|---|
| Lower layer | $SiH_4$ | 50 | 250 | 5 | 0.4 | 0.03 |
| | $H_2$ | 10→200* | | | | |
| | $AlCl_3$/He | | | | | |
| | (S-side: 0.01 μm) | 100→10** | | | | |
| | (UL-side: 0.01 μm) | 10 | | | | |
| | $C_2H_2$ | 3→13* | | | | |
| | $B_2H_6$ (against $SiH_4$) | 100 ppm | | | | |
| | $GeH_4$ | 20 | | | | |
| Upper layer 1st layer region | $SiH_4$ | 100 | 250 | 10 | 0.5 | 2 |
| | $B_2H_6$ (against $SiH_4$) | 1500 ppm | | | | |
| | $C_2H_2$ | 13 | | | | |
| | $H_2$ | 300 | | | | |
| | NO | 1 | | | | |
| 2nd layer region | $SiH_4$ | 100 | 250 | 25 | 0.5 | 22 |
| | $H_2$ | 300 | | | | |
| | $C_2H_2$ | 15 | | | | |
| | $B_2H_6$ (against $SiH_4$) | 40 ppm | | | | |
| 3rd layer region | $SiH_4$ | 100 | 250 | 20 | 0.5 | 5 |
| | $C_2H_2$ | 10 | | | | |
| | $H_2$ | 150 | | | | |
| 4th layer region | $SiH_4$ | 60 | 250 | 10 | 0.4 | 0.5 |
| | $C_2H_2$ | 60 | | | | |
| | $H_2$ | 50 | | | | |

TABLE 209

| Order of lamination (layer name) | Gases and their flow rates (SCCM) | | Substrate temperature (°C.) | RF discharging power (mW/cm$^3$) | Inner pressure (Torr) | Layer thickness (μm) |
|---|---|---|---|---|---|---|
| Lower layer | $SiH_4$ | 50 | 250 | 5 | 0.4 | 0.03 |
| | $H_2$ | 10→200* | | | | |
| | $AlCl_3$/He | | | | | |
| | (S-side: 0.01 μm) | 100→10** | | | | |
| | (UL-side: 0.01 μm) | 10 | | | | |
| | $C_2H_2$ | 3→13* | | | | |
| | $PH_3$ (against $SiH_4$) | 10→100 ppm* | | | | |
| | $GeH_4$ | 10 | | | | |
| | $SnH_4$ | 10 | | | | |
| Upper layer 1st layer region | $SiH_4$ | 100 | 250 | 10 | 0.5 | 2 |
| | $C_2H_2$ | 13 | | | | |
| | $PH_3$ (against $SiH_4$) | 1500 ppm | | | | |
| | $H_2$ | 300 | | | | |
| | NO | 1 | | | | |
| 2nd layer region | $SiH_4$ | 100 | 250 | 25 | 0.5 | 22 |
| | $C_2H_2$ | 15 | | | | |
| | $H_2$ | 300 | | | | |
| 3rd layer region | $SiH_4$ | 100 | 250 | 20 | 0.5 | 5 |
| | $C_2H_2$ | 10 | | | | |
| | $H_2$ | 150 | | | | |
| 4th | $SiH_4$ | 60 | 250 | 10 | 0.4 | 0.5 |

TABLE 209-continued

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| | layer region | $C_2H_2$ | 60 | | | | |
| | | $H_2$ | 50 | | | | |

TABLE 210

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 10→100 * | 300 | 10 | 0.4 | 0.2 |
| | | $H_2$ | 5→200 * | | | | |
| | | $AlCl_3$/He | | | | | |
| | | (S-side: 0.05 μm) | 200→40 ** | | | | |
| | | (UL-side: 0.15 μm) | 40→10 ** | | | | |
| | | $C_2H_2$ | 1→5 * | | | | |
| | | $B_2H_6$ (against $SiH_4$) | 100 ppm | | | | |
| | | $GeH_4$ | 2→20 * | | | | |
| | | $H_2S$ (against $SiH_4$) | 1 ppm | | | | |
| Upper layer | 1st layer region | $SiH_4$ | 100 | 300 | 10 | 0.35 | 3 |
| | | $H_2$ | 100 | | | | |
| | | $B_2H_6$ (against $SiH_4$) | 1000 ppm | | | | |
| | | $C_2H_2$ | 5 | | | | |
| | | $AlCl_3$/He | 0.1 | | | | |
| | | NO | 0.4 | | | | |
| | | $H_2S$ | 1 ppm | | | | |
| | | $SiF_4$ | 0.5 | | | | |
| | 2nd layer region | $SiH_4$ | 300 | 300 | 20 | 0.5 | 20 |
| | | $H_2$ | 500 | | | | |
| | | $C_2H_2$ | 0.1 | | | | |
| | | NO | 0.4 | | | | |
| | | $B_2H_6$ | 0.3 ppm | | | | |
| | | $SiF_4$ | 0.5 | | | | |
| | | $AlCl_3$/He | 0.3 | | | | |
| | | $H_2S$ | 1 ppm | | | | |
| | | $GeH_4$ | 5 | | | | |
| | 3rd layer region | $SiH_4$ | 100 | 300 | 15 | 0.4 | 7 |
| | | $CH_4$ | 600 | | | | |
| | | $PH_3$ (against $SiH_4$) | 3000 ppm | | | | |
| | | NO | 0.4 | | | | |
| | | $SiF_4$ | 0.5 | | | | |
| | | $AlCl_3$/He | 0.3 | | | | |
| | | $B_2H_6$ | 0.3 ppm | | | | |
| | | $H_2S$ | 1 ppm | | | | |
| | | $GeH_4$ | 3 | | | | |
| | 4th layer region | $SiH_4$ | 40 | 300 | 10 | 0.4 | 0.1 |
| | | $CH_4$ | 600 | | | | |
| | | NO | 0.4 | | | | |
| | | $PH_3$ | 0.3 | | | | |
| | | $B_2H_6$ | 0.3 | | | | |
| | | $SiF_4$ | 0.5 | | | | |
| | | $AlCl_3$/He | 0.5 | | | | |
| | | $H_2S$ | 1 ppm | | | | |
| | | $GeH_4$ | 2 | | | | |

TABLE 211

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 50 | 250 | 1 | 0.4 | 0.02 |
| | | $H_2$ | 5→200 * | | | | |
| | | $AlCl_3$/He | | | | | |
| | | (S-side: 0.01 μm) | 200→30 ** | | | | |
| | | (UL-side: 0.01 μm) | 30→10 ** | | | | |
| | | $C_2H_2$ | 0.1 | | | | |
| | | NO | 5 | | | | |
| | | $GeH_4$ | 10 | | | | |
| Upper layer | 1st layer region | $SiH_4$ | 100 | 300 | 10 | 0.35 | 3 |
| | | $H_2$ | 150 | | | | |
| | | $B_2H_6$ (against $SiH_4$) | 800 ppm | | | | |
| | | $C_2H_2$ | 0.1 | | | | |
| | | $AlCl_3$/He | 0.1 | | | | |
| | | NO | 10 | | | | |
| | | $SiF_4$ | 0.5 | | | | |
| | 2nd layer region | $SiF_4$ | 0.1 | 300 | 20 | 0.5 | 5 |
| | | $SiH_4$ | 300 | | | | |
| | | $H_2$ | 300 | | | | |

TABLE 211-continued

| Order of lamination (layer name) | Gases and their flow rates (SCCM) | | Substrate temperature (°C.) | RF discharging power (mW/cm³) | Inner pressure (Torr) | Layer thickness (μm) |
|---|---|---|---|---|---|---|
| | $C_2H_2$ | 0.1 | | | | |
| | $AlCl_3$/He | 0.1 | | | | |
| | NO | 0.1 | | | | |
| | $B_2H_6$ (against $SiH_4$) | 0.3 ppm | | | | |
| | $GeH_4$ | 2 | | | | |
| 3rd layer region | $SiF_4$ | 0.5 | 300 | 15 | 0.4 | 20 |
| | $SiH_4$ | 100 | | | | |
| | $C_2H_2$ | 15 | | | | |
| | $AlCl_3$/He | 0.1 | | | | |
| | NO | 0.1 | | | | |
| | $B_2H_6$ (against $SiH_4$) | 0.3 ppm | | | | |
| | $GeH_4$ | 3 | | | | |
| 4th layer region | $SiH_4$ | 50 | 300 | 10 | 0.4 | 0.5 |
| | $C_2H_2$ | 30 | | | | |
| | $AlCl_3$/He | 0.4 | | | | |
| | $SiF_4$ | 1 | | | | |
| | NO | 0.3 | | | | |
| | $B_2H_6$ (against $SiH_4$) | 0.3 ppm | | | | |
| | $GeH_4$ | 3 | | | | |

TABLE 212

| Order of lamination (layer name) | Gases and their flow rates (SCCM) | | Substrate temperature (°C.) | RF discharging power (mW/cm³) | Inner pressure (Torr) | Layer thickness (μm) |
|---|---|---|---|---|---|---|
| Lower layer | $SiH_4$ | 50 | 250 | 1 | 0.4 | 0.02 |
| | $H_2$ | 5→200 * | | | | |
| | $AlCl_3$/He | | | | | |
| | (S-side: 0.01 μm) | 200→30 ** | | | | |
| | (UL-side: 0.01 μm) | 30→10 ** | | | | |
| | NO | 10 | | | | |
| | $C_2H_2$ | 0.1 | | | | |
| | $SnH_4$ | 20 | | | | |
| Upper layer 1st layer region | $SiH_4$ | 100 | 300 | 10 | 0.35 | 3 |
| | $H_2$ | 150 | | | | |
| | $B_2H_6$ (against $SiH_4$) | 800 ppm | | | | |
| | $AlCl_3$/He | 0.1 | | | | |
| | $SiF_4$ | 0.5 | | | | |
| | NO | 10 | | | | |
| | $C_2H_2$ | 0.1 | | | | |
| 2nd layer region | $SiH_4$ | 300 | 300 | 20 | 0.5 | 7 |
| | $SiF_4$ | 0.1 | | | | |
| | $H_2$ | 300 | | | | |
| | $B_2H_6$ (against $SiH_4$) | 0.3 ppm | | | | |
| | $C_2H_2$ | 0.1 | | | | |
| | NO | 2 | | | | |
| | $AlCl_3$/He | 0.1 | | | | |
| | $SnH_4$ | 1 | | | | |
| 3rd layer region | $SiH_4$ | 100 | 300 | 15 | 0.4 | 20 |
| | $C_2H_2$ | 15 | | | | |
| | $B_2H_6$ (against $SiH_4$) | 0.3 ppm | | | | |
| | $AlCl_3$/He | 0.1 | | | | |
| | NO | 0.1 | | | | |
| | $SiF_4$ | 0.5 | | | | |
| | $SnH_4$ | 2 | | | | |
| 4th layer region | $SiH_4$ | 50 | 300 | 10 | 0.4 | 0.5 |
| | $C_2H_2$ | 30 | | | | |
| | $AlCl_3$/He | 0.3 | | | | |
| | $SiF_4$ | 1 | | | | |
| | NO | 0.4 | | | | |
| | $B_2H_6$ (against $SiH_4$) | 0.3 ppm | | | | |
| | $SnH_4$ | 2 | | | | |

TABLE 213

| Order of lamination (layer name) | Gases and their flow rates (SCCM) | | Substrate temperature (°C.) | RF discharging power (mW/cm³) | Inner pressure (Torr) | Layer thickness (μm) |
|---|---|---|---|---|---|---|
| Lower layer | $SiH_4$ | 50 | 250 | 1 | 0.4 | 0.02 |
| | $H_2$ | 5→200 * | | | | |
| | $AlCl_3$/He | | | | | |
| | (S-side: 0.01 μm) | 200→30 ** | | | | |
| | (UL-side: 0.01 μm) | 30→10 ** | | | | |
| | $C_2H_2$ | 0.1 | | | | |
| | NO | 5 | | | | |
| | $B_2H_6$ (against $SiH_4$) | 100 ppm | | | | |

TABLE 213-continued

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| | | $GeH_4$ | 1→10 * | | | | |
| Upper layer | 1st layer region | $SiH_4$ | 100 | 300 | 10 | 0.35 | 3 |
| | | $B_2H_6$ (against $SiH_4$) | 800 ppm | | | | |
| | | $AlCl_3$/He | 0.1 | | | | |
| | | $SiF_4$ | 0.5 | | | | |
| | | $C_2H_2$ | 0.1 | | | | |
| | | $H_2$ | 150 | | | | |
| | | NO | 10 | | | | |
| | 2nd layer region | $AlCl_3$/He | 0.1 | 300 | 20 | 0.5 | 3 |
| | | $SiF_4$ | 0.1 | | | | |
| | | $SiH_4$ | 300 | | | | |
| | | $H_2$ | 300 | | | | |
| | | NO | 0.1 | | | | |
| | | $C_2H_2$ | 0.5→2 * | | | | |
| | | $B_2H_6$ (against $SiH_4$) | 0.3 ppm | | | | |
| | | $GeH_4$ | 2 | | | | |
| | 3rd layer region | $SiF_4$ | 0.5 | 300 | 15 | 0.4 | 20 |
| | | $SiH_4$ | 100 | | | | |
| | | $C_2H_2$ | 15 | | | | |
| | | $AlCl_3$/He | 0.1 | | | | |
| | | $B_2H_6$ (against $SiH_4$) | 0.3 ppm | | | | |
| | | NO | 0.1 | | | | |
| | | $GeH_4$ | 3 | | | | |
| | 4th layer region | $SiH_4$ | 50 | 300 | 10 | 0.4 | 0.5 |
| | | $C_2H_2$ | 30 | | | | |
| | | $B_2H_6$ (against $SiH_4$) | 0.5 ppm | | | | |
| | | NO | 0.2 | | | | |
| | | $AlCl_3$/He | 0.3 | | | | |
| | | $SiF_4$ | 0.3 | | | | |
| | | $GeH_4$ | 3 | | | | |

TABLE 214

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 50 | 250 | 1 | 0.4 | 0.02 |
| | | $H_2$ | 5→200 * | | | | |
| | | $AlCl_3$/He | | | | | |
| | | (S-side: 0.01 μm) | 200→30 ** | | | | |
| | | (UL-side: 0.01 μm) | 30→10 ** | | | | |
| | | $C_2H_2$ | 0.1 | | | | |
| | | NO | 10 | | | | |
| | | $BF_3$ (against $SiH_4$) | 10 ppm | | | | |
| | | $GeH_4$ | 1→10 * | | | | |
| Upper layer | 1st layer region | $SiH_4$ | 100 | 300 | 10 | 0.35 | 3 |
| | | $C_2H_2$ | 0.1 | | | | |
| | | $BF_3$ (against $SiH_4$) | 1000 ppm | | | | |
| | | $AlCl_3$/He | 0.1 | | | | |
| | | $SiF_4$ | 0.5 | | | | |
| | | $H_2$ | 150 | | | | |
| | | NO | 10 | | | | |
| | 2nd layer region | $SiH_4$ | 300 | 300 | 20 | 0.5 | 8 |
| | | $C_2H_2$ | 1 | | | | |
| | | $BF_3$ (against $SiH_4$) | 10→0.3 ppm ** | | | | |
| | | $AlCl_3$/He | 0.1 | | | | |
| | | $SiF_4$ | 0.1 | | | | |
| | | $H_2$ | 300 | | | | |
| | | NO | 0.1 | | | | |
| | | $GeH_4$ | 2 | | | | |
| | 3rd layer region | $SiH_4$ | 100 | 300 | 15 | 0.4 | 20 |
| | | $C_2H_2$ | 15 | | | | |
| | | $BF_3$ (against $SiH_4$) | 0.3 ppm | | | | |
| | | $AlCl_3$/He | 0.1 | | | | |
| | | $SiF_4$ | 0.5 | | | | |
| | | NO | 0.1 | | | | |
| | | $GeH_4$ | 4 | | | | |
| | 4th layer region | $SiH_4$ | 50 | 300 | 15 | 0.5 | 0.5 |
| | | $C_2H_2$ | 30 | | | | |
| | | $BF_3$ (against $SiH_4$) | 0.3 ppm | | | | |
| | | $AlCl_3$/He | 0.4 | | | | |
| | | $SiF_4$ | 1 | | | | |
| | | NO | 0.3 | | | | |
| | | $GeH_4$ | 2 | | | | |

TABLE 215

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 50 | 250 | 1 | 0.4 | 0.02 |
| | | $H_2$ | 5→200 * | | | | |
| | | $AlCl_3$/He | | | | | |
| | | (S-side: 0.01 μm) | 200→30 ** | | | | |
| | | (UL-side: 0.01 μm) | 30→10 ** | | | | |
| | | $C_2H_2$ | 0.1 | | | | |
| | | NO | 5→10 * | | | | |
| | | $GeH_4$ | 20 | | | | |
| Upper layer | 1st layer region | $SiH_4$ | 100 | 300 | 10 | 0.35 | 3 |
| | | $H_2$ | 150 | | | | |
| | | $B_2H_6$ (against $SiH_4$) | 800 ppm | | | | |
| | | $C_2H_2$ | 0.1 | | | | |
| | | $AlCl_3$/He | 0.1 | | | | |
| | | NO | 10 | | | | |
| | | $SiF_4$ | 0.5 | | | | |
| | 2nd layer region | $SiH_4$ | 300 | 300 | 20 | 0.5 | 5 |
| | | $H_2$ | 300 | | | | |
| | | $C_2H_2$ | 0.1 | | | | |
| | | NO | 0.1 | | | | |
| | | $B_2H_6$ (against $SiH_4$) | 0.3 ppm | | | | |
| | | $SiF_4$ | 0.1 | | | | |
| | | $AlCl_3$/He | 0.1 | | | | |
| | | $GeF_4$ | 2 | | | | |
| | 3rd layer region | $SiH_4$ | 100 | 300 | 15 | 0.4 | 20 |
| | | NO | 0.1 | | | | |
| | | $SiF_4$ | 0.5 | | | | |
| | | $C_2H_2$ | | | | | |
| | | (U · 2nd LR-side: 1 μm) | 0.1→15 * | | | | |
| | | (U · 4th LR-side: 19 μm) | 15 | | | | |
| | | $AlCl_3$/He | 0.1 | | | | |
| | | $B_2H_6$ (against $SiH_4$) | 0.3 ppm | | | | |
| | | $GeF_4$ | 4 | | | | |
| | 4th layer region | $SiH_4$ | 50 | 300 | 10 | 0.4 | 0.5 |
| | | $C_2H_2$ | 30 | | | | |
| | | NO | 0.5 | | | | |
| | | $B_2H_6$ (against $SiH_4$) | 0.5 ppm | | | | |
| | | $SiF_4$ | 1 | | | | |
| | | $AlCl_3$/He | 0.3 | | | | |
| | | $GeF_4$ | 1 | | | | |

TABLE 216

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 50 | 250 | 1 | 0.4 | 0.02 |
| | | $H_2$ | 5→200 * | | | | |
| | | $AlCl_3$/He | | | | | |
| | | (S-side: 0.01 μm) | 200→30 ** | | | | |
| | | (UL-side: 0.01 μm) | 30→10 ** | | | | |
| | | $C_2H_2$ | 0.1 | | | | |
| | | NO | 10 | | | | |
| | | $B_2H_6$ (against $SiH_4$) | 10→100 ppm * | | | | |
| | | $GeF_4$ | 20 | | | | |
| Upper layer | 1st layer region | $SiH_4$ | 100 | 300 | 10 | 0.35 | 3 |
| | | $H_2$ | 150 | | | | |
| | | $B_2H_6$ (against $SiH_4$) | 800 ppm | | | | |
| | | $C_2H_2$ | 0.1 | | | | |
| | | $AlCl_3$/He | 0.1 | | | | |
| | | NO | 10 | | | | |
| | | $SiF_4$ | 0.5 | | | | |
| | 2nd layer region | $SiF_4$ | 0.1 | 300 | 20 | 0.5 | 2 |
| | | $SiH_4$ | 300 | | | | |
| | | $H_2$ | 300 | | | | |
| | | $C_2H_2$ | 0.1 | | | | |
| | | $AlCl_3$/He | 0.1 | | | | |
| | | NO | 0.1 | | | | |
| | | $B_2H_6$ (against $SiH_4$) | 0.3 ppm | | | | |
| | | $GeF_4$ | 2 | | | | |
| | 3rd layer region | $SiF_4$ | 0.5 | 300 | 15 | 0.4 | 20 |
| | | $SiH_4$ | 100 | | | | |
| | | $C_2H_2$ | | | | | |
| | | (U · 2nd LR-side: 5 μm) | 0.1→13 * | | | | |
| | | (U · 4th LR-side: 15 μm) | | | | | |

TABLE 216-continued

| Order of lamination (layer name) | Gases and their flow rates (SCCM) | | Substrate temperature (°C.) | RF discharging power (mW/cm³) | Inner pressure (Torr) | Layer thickness (μm) |
|---|---|---|---|---|---|---|
| | | 13→17 * | | | | |
| | $AlCl_3$/He | 0.1 | | | | |
| | NO | 0.1 | | | | |
| | $B_2H_6$ (against $SiH_4$) | 0.3 ppm | | | | |
| | $GeF_4$ | 1 | | | | |
| 4th layer region | $SiH_4$ | 50 | 300 | 10 | 0.4 | 0.5 |
| | $C_2H_2$ | 40 | | | | |
| | $AlCl_3$/He | 0.2 | | | | |
| | $SiF_4$ | 0.5 | | | | |
| | NO | 0.3 | | | | |
| | $B_2H_6$ (against $SiH_4$) | 0.2 ppm | | | | |
| | $GeF_4$ | 2 | | | | |

TABLE 217

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 50 | 250 | 1 | 0.4 | 0.02 |
| | | $H_2$ | 5→200 * | | | | |
| | | $AlCl_3$/He | | | | | |
| | | (S-side: 0.01 μm) | 200→30 ** | | | | |
| | | (UL-side: 0.01 μm) | 30→10 ** | | | | |
| | | NO | 10 | | | | |
| | | $C_2H_2$ | 0.1 | | | | |
| | | $GeH_4$ | 10 | | | | |
| | | $B_2H_6$ (against $SiH_4$) | | | | | |
| | | (S-side: 0.01 μm) | 10 | | | | |
| | | (UL-side: 0.01 μm) | 10→100 * | | | | |
| Upper layer | 1st layer region | $SiH_4$ | 100 | 300 | 10 | 0.35 | 3 |
| | | $H_2$ | 150 | | | | |
| | | $B_2H_6$ (against $SiH_4$) | 800 ppm | | | | |
| | | $AlCl_3$/He | 0.1 | | | | |
| | | $SiF_4$ | 0.5 | | | | |
| | | NO | 10 | | | | |
| | | $C_2H_2$ | 0.1 | | | | |
| | 2nd layer region | $SiH_4$ | 300 | 300 | 20 | 0.5 | 5 |
| | | $SiF_4$ | 0.1 | | | | |
| | | $H_2$ | 300 | | | | |
| | | $B_2H_6$ (against $SiH_4$) | 0.3 ppm | | | | |
| | | $C_2H_2$ | 0.1 | | | | |
| | | NO | 0.1 | | | | |
| | | $AlCl_3$/He | 0.1 | | | | |
| | | $GeH_4$ | 1 | | | | |
| | 3rd layer region | NO | 0.1 | 300 | 15 | 0.4 | 20 |
| | | $SiF_4$ | 0.5 | | | | |
| | | $C_2H_2$ | | | | | |
| | | (U · 2nd LR-side: 19 μm) | | | | | |
| | | | 15 | | | | |
| | | (U · 4th LR-side: 1 μm) | | | | | |
| | | | 15→30 * | | | | |
| | | $SiH_4$ | | | | | |
| | | (U · 2nd LR-side: 19 μm) | | | | | |
| | | | 100 | | | | |
| | | (U · 4th LR-side: 1 μm) | | | | | |
| | | | 100→50 ** | | | | |
| | | $AlCl_3$/He | 0.1 | | | | |
| | | $B_2H_6$ (against $SiH_4$) | 0.3 ppm | | | | |
| | | $GeH_4$ | 2 | | | | |
| | 4th layer region | $SiH_4$ | 50 | 300 | 10 | 0.4 | 0.5 |
| | | $C_2H_2$ | 25 | | | | |
| | | $AlCl_3$/He | 0.3 | | | | |
| | | $SiF_4$ | 0.5 | | | | |
| | | NO | 0.3 | | | | |
| | | $B_2H_6$ (against $SiH_4$) | 0.5 ppm | | | | |
| | | $GeH_4$ | 1 | | | | |

TABLE 218

| Order of lamination (layer name) | Gases and their flow rates (SCCM) | | Substrate temperature (°C.) | RF discharging power (mW/cm³) | Inner pressure (Torr) | Layer thickness (μm) |
|---|---|---|---|---|---|---|
| Lower layer | $SiH_4$ | 50 | 250 | 1 | 0.4 | 0.02 |
| | $H_2$ | 5→200 * | | | | |
| | $AlCl_3$/He | | | | | |
| | (S-side: 0.01 μm) | 200→30 ** | | | | |

TABLE 218-continued

| Order of lamination (layer name) | | Gases and their flow rates (SCCM) | | Substrate temperature (°C.) | RF discharging power (mW/cm$^3$) | Inner pressure (Torr) | Layer thickness (μm) |
|---|---|---|---|---|---|---|---|
| | | (UL-side: 0.01 μm) | 30→10 ** | | | | |
| | | $C_2H_2$ | 5 | | | | |
| | | NO | 0.1 | | | | |
| | | $GeF_4$ | | | | | |
| | | (S-side: 0.01 μm) | 2 | | | | |
| | | (UL-side: 0.01 μm) | 2→5 * | | | | |
| | | $GeH_4$ | 10 | | | | |
| Upper layer | 1st layer region | $SiH_4$ | 100 | 300 | 10 | 0.35 | 3 |
| | | $B_2H_6$ (against $SiH_4$) | 800 ppm | | | | |
| | | $AlCl_3$/He | 0.1 | | | | |
| | | $SiF_4$ | 0.5 | | | | |
| | | $C_2H_2$ | 0.1 | | | | |
| | | $H_2$ | 150 | | | | |
| | | NO | 10 | | | | |
| | 2nd layer region | $AlCl_3$/He | 0.1 | 300 | 20 | 0.5 | 5 |
| | | $SiF_4$ | 0.1 | | | | |
| | | $SiH_4$ | 300 | | | | |
| | | $H_2$ | 300 | | | | |
| | | NO | 0.1 | | | | |
| | | $C_2H_2$ | 0.1 | | | | |
| | | $B_2H_6$ (against $SiH_4$) | 0.3 ppm | | | | |
| | | $GeF_4$ | 2 | | | | |
| | 3rd layer region | $SiF_4$ | 0.5 | 300 | 15 | 0.4 | 20 |
| | | $SiH_4$ | 100 | | | | |
| | | $C_2H_2$ | 15 | | | | |
| | | $AlCl_3$/He | 0.1 | | | | |
| | | $B_2H_6$ (against $SiH_4$) | 10 ppm | | | | |
| | | NO | 0.1 | | | | |
| | | $GeF_4$ | 2 | | | | |
| | 4th layer region | $SiH_4$ | 50 | 300 | 10 | 0.4 | 0.5 |
| | | $C_2H_2$ | 30 | | | | |
| | | $B_2H_6$ (against $SiH_4$) | 0.5 ppm | | | | |
| | | NO | 0.2 | | | | |
| | | $AlCl_3$/He | 0.3 | | | | |
| | | $SiF_4$ | 0.4 | | | | |
| | | $GeF_4$ | 1 | | | | |

TABLE 219

| Order of lamination (layer name) | | Gases and their flow rates (SCCM) | | Substrate temperature (°C.) | RF discharging power (mW/cm$^3$) | Inner pressure (Torr) | Layer thickness (μm) |
|---|---|---|---|---|---|---|---|
| Lower layer | | $SiH_4$ | 50 | 250 | 1 | 0.4 | 0.02 |
| | | $H_2$ | 5→200 * | | | | |
| | | $AlCl_3$/He | | | | | |
| | | (S-side: 0.01 μm) | 200→30 ** | | | | |
| | | (UL-side: 0.01 μm) | 30→10 ** | | | | |
| | | $C_2H_2$ | 1→6 * | | | | |
| | | NO | 0.1 | | | | |
| | | $GeH_4$ | 15 | | | | |
| Upper layer | 1st layer region | $SiH_4$ | 100 | 300 | 10 | 0.35 | 3 |
| | | $C_2H_2$ | 0.1 | | | | |
| | | $B_2H_6$ (against $SiH_4$) | 800 ppm | | | | |
| | | $AlCl_3$/He | 0.1 | | | | |
| | | $SiF_4$ | 0.5 | | | | |
| | | $H_2$ | 150 | | | | |
| | | NO | 10 | | | | |
| | 2nd layer region | $SiH_4$ | 300 | 300 | 20 | 0.5 | 6 |
| | | $C_2H_2$ | 0.1 | | | | |
| | | $B_2H_6$ (against $SiH_4$) | 0.3 ppm | | | | |
| | | $AlCl_3$/He | 0.1 | | | | |
| | | $SiF_4$ | 0.1 | | | | |
| | | $H_2$ | 300 | | | | |
| | | NO | 0.1 | | | | |
| | | $GeH_4$ | 2 | | | | |
| | 3rd layer region | $SiH_4$ | 100 | 300 | 15 | 0.4 | 20 |
| | | $C_2H_2$ | 15 | | | | |
| | | $B_2H_6$ (against $SiH_4$) | 12→0.3 ** | | | | |
| | | $AlCl_3$/He | 0.1 | | | | |
| | | $SiF_4$ | 0.5 | | | | |
| | | NO | 0.1 | | | | |
| | | $GeH_4$ | 2 | | | | |
| | 4th layer region | $SiH_4$ | 60 | 300 | 10 | 0.4 | 0.5 |
| | | $C_2H_2$ | 30 | | | | |
| | | $B_2H_6$ (against $SiH_4$) | 0.3 ppm | | | | |
| | | $AlCl_3$/He | 1 | | | | |
| | | $SiF_4$ | 0.5 | | | | |

TABLE 219-continued

| Order of lamination (layer name) | Gases and their flow rates (SCCM) | | Substrate temperature (°C.) | RF discharging power (mW/cm³) | Inner pressure (Torr) | Layer thickness (μm) |
|---|---|---|---|---|---|---|
| | NO | 0.3 | | | | |
| | $GeH_4$ | 1 | | | | |

TABLE 220

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 50 | 250 | 1 | 0.4 | 0.02 |
| | | $H_2$ | 5→200 * | | | | |
| | | $AlCl_3$/He | | | | | |
| | | (S-side: 0.01 μm) | 200→30 ** | | | | |
| | | (UL-side: 0.01 μm) | 30→10 ** | | | | |
| | | $C_2H_2$ | 3 | | | | |
| | | NO | 0.1 | | | | |
| | | $B_2H_6$ (against $SiH_4$) | 100 ppm | | | | |
| | | $Si_2F_6$ | 3 | | | | |
| | | $GeH_4$ | 10 | | | | |
| Upper layer | 1st layer region | $SiH_4$ | 100 | 300 | 10 | 0.35 | 3 |
| | | $H_2$ | 150 | | | | |
| | | $B_2H_6$ (against $SiH_4$) | 800 ppm | | | | |
| | | $C_2H_2$ | 0.1 | | | | |
| | | $AlCl_3$/He | 0.1 | | | | |
| | | NO | 10 | | | | |
| | | $Si_2F_6$ | 0.5 | | | | |
| | 2nd layer region | $SiH_4$ | 300 | 300 | 20 | 0.5 | 5 |
| | | $H_2$ | 300 | | | | |
| | | $C_2H_2$ | 0.1 | | | | |
| | | NO | 0.1 | | | | |
| | | $B_2H_6$ (against $SiH_4$) | 0.3 ppm | | | | |
| | | $Si_2F_4$ | 0.5 | | | | |
| | | $AlCl_3$/He | 0.1 | | | | |
| | | $GeH_4$ | 4 | | | | |
| | 3rd layer region | $Si_2F_6$ | 0.5 | 300 | 15 | 0.4 | 20 |
| | | NO | 0.1 | | | | |
| | | $SiH_4$ | 100 | | | | |
| | | $C_2H_2$ | 15 | | | | |
| | | $PH_3$ (against $SiH_4$) | 8 ppm | | | | |
| | | $AlCl_3$/He | 0.1 | | | | |
| | | $B_2H_6$ (against $SiH_4$) | 0.1 ppm | | | | |
| | | $GeH_4$ | 1 | | | | |
| | 4th layer region | $SiH_4$ | 50 | 300 | 10 | 0.4 | 0.5 |
| | | $C_2H_2$ | 30 | | | | |
| | | NO | 0.3 | | | | |
| | | $B_2H_6$ (against $SiH_4$) | 0.5 ppm | | | | |
| | | $Si_2F_6$ | 1 | | | | |
| | | $PH_3$ (against $SiH_4$) | 0.1 ppm | | | | |
| | | $AlCl_3$/He | 0.5 | | | | |
| | | $GeH_4$ | 1 | | | | |

TABLE 221

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 50 | 250 | 1 | 0.4 | 0.02 |
| | | $H_2$ | 5→200 * | | | | |
| | | $AlCl_3$/He | | | | | |
| | | (S-side: 0.01 μm) | 200→30 ** | | | | |
| | | (UL-side: 0.01 μm) | 30→10 ** | | | | |
| | | $C_2H_2$ | 3 | | | | |
| | | NO | 0.1 | | | | |
| | | $B_2H_6$ (against $SiH_4$) | 10→100 ppm * | | | | |
| | | $SiF_4$ | 5 | | | | |
| | | $GeH_4$ | 10 | | | | |
| Upper layer | 1st layer region | $SiH_4$ | 100 | 300 | 10 | 0.35 | 3 |
| | | $H_2$ | 150 | | | | |
| | | $B_2H_6$ (against $SiH_4$) | 800 ppm | | | | |
| | | $C_2H_2$ | 0.1 | | | | |
| | | $AlCl_3$/He | 0.1 | | | | |
| | | NO | 10 | | | | |
| | | $SiF_4$ | 0.5 | | | | |
| | 2nd layer region | $SiF_4$ | 0.1 | 300 | 20 | 0.5 | 5 |
| | | $SiH_4$ | 300 | | | | |
| | | $H_2$ | 300 | | | | |
| | | $C_2H_2$ | 0.1 | | | | |

TABLE 221-continued

| Order of lamination (layer name) | | Gases and their flow rates (SCCM) | | Substrate temperature (°C.) | RF discharging power (mW/cm$^3$) | Inner pressure (Torr) | Layer thickness (μm) |
|---|---|---|---|---|---|---|---|
| | | $AlCl_3$/He | 0.1 | | | | |
| | | NO | 0.1 | | | | |
| | | $B_2H_6$ (against $SiH_4$) | 0.3 ppm | | | | |
| | | $GeH_4$ | 1 | | | | |
| | 3rd layer region | $SiF_4$ | 0.5 | 300 | 15 | 0.4 | 20 |
| | | $SiH_4$ | 100 | | | | |
| | | $C_2H_2$ | 15 | | | | |
| | | $PH_3$ (against $SiH_4$) | 10→0.3 ** | | | | |
| | | $AlCl_3$/He | 0.1 | | | | |
| | | NO | 0.1 | | | | |
| | | $B_2H_6$ (against $SiH_4$) | 0.3 ppm | | | | |
| | | $GeH_4$ | 2 | | | | |
| | 4th layer region | $SiH_4$ | 50 | 300 | 15 | 0.4 | 0.6 |
| | | $C_2H_2$ | 20 | | | | |
| | | $AlCl_3$/He | 0.2 | | | | |
| | | $SiF_4$ | 0.5 | | | | |
| | | NO | 0.3 | | | | |
| | | $B_2H_6$ (against $SiH_4$) | 0.4 ppm | | | | |
| | | $PH_3$ (against $SiH_4$) | 0.3 ppm | | | | |
| | | $GeH_4$ | 1 | | | | |

TABLE 222

| Order of lamination (layer name) | | Gases and their flow rates (SCCM) | | Substrate temperature (°C.) | RF discharging power (mW/cm$^3$) | Inner pressure (Torr) | Layer thickness (μm) |
|---|---|---|---|---|---|---|---|
| Lower layer | | $SiH_4$ | 50 | 250 | 1 | 0.4 | 0.02 |
| | | $H_2$ | 5→200 * | | | | |
| | | $AlCl_3$/He | | | | | |
| | | (S-side: 0.01 μm) | 200→30 ** | | | | |
| | | (UL-side: 0.01 μm) | 30→10 ** | | | | |
| | | NO | 10 | | | | |
| | | $C_2H_2$ | 0.1 | | | | |
| | | $GeH_4$ | 1→10 * | | | | |
| | | $H_2S$ | 1 ppm | | | | |
| Upper layer | 1st layer region | $SiH_4$ | 100 | 300 | 10 | 0.35 | 3 |
| | | $H_2$ | 150 | | | | |
| | | $B_2H_6$ (against $SiH_4$) | 800 ppm | | | | |
| | | $AlCl_3$/He | 0.1 | | | | |
| | | $SiF_4$ | 0.5 | | | | |
| | | NO | 10 | | | | |
| | | $C_2H_2$ | 0.1 | | | | |
| | | $H_2S$ (against $SiH_4$) | 1 ppm | | | | |
| | 2nd layer region | $SiH_4$ | 300 | 300 | 20 | 0.5 | 5 |
| | | $SiF_4$ | 0.1 | | | | |
| | | $H_2$ | 300 | | | | |
| | | $B_2H_6$ (against $SiH_4$) | 0.3 ppm | | | | |
| | | $C_2H_2$ | 0.1 | | | | |
| | | NO | 0.1 | | | | |
| | | $AlCl_3$/He | 0.1 | | | | |
| | | $H_2S$ (against $SiH_4$) | 1 ppm | | | | |
| | | $GeH_4$ | 2 | | | | |
| | 3rd layer region | NO | 0.1 | 300 | 15 | 0.4 | 20 |
| | | $SiF_4$ | 0.5 | | | | |
| | | $C_2H_2$ | 15 | | | | |
| | | $SiH_4$ | 100 | | | | |
| | | $AlCl_3$/He | 0.1 | | | | |
| | | $B_2H_6$ (against $SiH_4$) | 0.3 ppm | | | | |
| | | $H_2S$ (against $SiH_4$) | 1 ppm | | | | |
| | | $GeH_4$ | 1 | | | | |
| | 4th layer region | $SiH_4$ | 50 | 300 | 15 | 0.5 | 0.6 |
| | | $C_2H_2$ | 20 | | | | |
| | | $AlCl_3$/He | 0.2 | | | | |
| | | $SiF_4$ | 0.8 | | | | |
| | | NO | 0.4 | | | | |
| | | $B_2H_6$ (against $SiH_4$) | 0.3 ppm | | | | |
| | | $H_2S$ (against $SiH_4$) | 1 ppm | | | | |
| | | $GeH_4$ | 2 | | | | |

TABLE 223

| Order of lamination (layer name) | Gases and their flow rates (SCCM) | | Substrate temperature (°C.) | RF discharging power (mW/cm$^3$) | Inner pressure (Torr) | Layer thickness (μm) |
|---|---|---|---|---|---|---|
| Lower layer | $SiH_4$ | 50 | 250 | 1 | 0.4 | 0.02 |
| | $H_2$ | 5→200 * | | | | |

TABLE 223-continued

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| | | $AlCl_3$/He | | | | | |
| | | (S-side: 0.01 μm) | 200→30 ** | | | | |
| | | (UL-side: 0.01 μm) | 30→10 ** | | | | |
| | | $C_2H_2$ | 0.1 | | | | |
| | | NO | 5 | | | | |
| | | $GeH_4$ | 10 | | | | |
| Upper layer | 1st layer region | $SiH_4$ | 100 | 300 | 10 | 0.35 | 3 |
| | | $B_2H_6$ (against $SiH_4$) | 800 ppm | | | | |
| | | $AlCl_3$/He | 0.1 | | | | |
| | | $SiF_4$ | 0.5 | | | | |
| | | $C_2H_2$ | 0.1 | | | | |
| | | $H_2$ | 150 | | | | |
| | | NO | 10 | | | | |
| | 2nd layer region | $AlCl_3$/He | 0.1 | 300 | 20 | 0.5 | 5 |
| | | $SiF_4$ | 0.1 | | | | |
| | | $SiH_4$ | 300 | | | | |
| | | $H_2$ | 300 | | | | |
| | | NO | 0.1 | | | | |
| | | $C_2H_2$ | 0.1 | | | | |
| | | $B_2H_6$ (against $SiH_4$) | 0.3 ppm | | | | |
| | | $GeH_4$ | 1 | | | | |
| | 3rd layer region | $SiF_4$ | 0.5 | 300 | 15 | 0.4 | 10 |
| | | $SiH_4$ | 100 | | | | |
| | | $C_2H_2$ | 15 | | | | |
| | | $AlCl_3$/He | 0.1 | | | | |
| | | $B_2H_6$ (against $SiH_4$) | 0.3 ppm | | | | |
| | | NO | 0.1 | | | | |
| | | $GeH_4$ | 2 | | | | |
| | 4th layer region | $SiH_4$ | 60 | 300 | 15 | 0.5 | 0.5 |
| | | $C_2H_2$ | 40 | | | | |
| | | $B_2H_6$ (against $SiH_4$) | 0.4 ppm | | | | |
| | | NO | 0.3 | | | | |
| | | $AlCl_3$/He | 0.2 | | | | |
| | | $SiF_4$ | 0.6 | | | | |
| | | $GeH_4$ | 1 | | | | |

TABLE 224

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 50 | 250 | 1 | 0.4 | 0.02 |
| | | $H_2$ | 5→200 * | | | | |
| | | $AlCl_3$/He | | | | | |
| | | (S-side: 0.01 μm) | 200→30 ** | | | | |
| | | (UL-side: 0.01 μm) | 30→10 ** | | | | |
| | | $C_2H_2$ | 0.1 | | | | |
| | | NO | 10 | | | | |
| | | $B_2H_6$ (against $SiH_4$) | 150 ppm | | | | |
| | | $SiF_4$ | 5 | | | | |
| | | $GeH_4$ | 20 | | | | |
| Upper layer | 1st layer region | $SiH_4$ | 100 | 300 | 10 | 0.35 | 3 |
| | | $C_2H_2$ | 0.1 | | | | |
| | | $B_2H_6$ (against $SiH_4$) | 800 ppm | | | | |
| | | $AlCl_3$/He | 0.1 | | | | |
| | | $SiF_4$ | 0.5 | | | | |
| | | $H_2$ | 150 | | | | |
| | | NO | 10 | | | | |
| | 2nd layer region | $SiH_4$ | 300 | 300 | 20 | 0.5 | 5 |
| | | $C_2H_2$ | 0.1 | | | | |
| | | $B_2H_6$ (against $SiH_4$) | 0.3 ppm | | | | |
| | | $AlCl_3$/He | 0.1 | | | | |
| | | $SiF_4$ | 0.1 | | | | |
| | | $H_2$ | 300 | | | | |
| | | NO | 0.1 | | | | |
| | | $GeH_4$ | 1 | | | | |
| | 3rd layer region | $SiH_4$ | 100 | 300 | 15 | 0.4 | 30 |
| | | $C_2H_2$ | 15 | | | | |
| | | $B_2H_6$ (against $SiH_4$) | 0.3 ppm | | | | |
| | | $AlCl_3$/He | 0.1 | | | | |
| | | $SiF_4$ | 0.5 | | | | |
| | | NO | 0.1 | | | | |
| | | $GeH_4$ | 2 | | | | |
| | 4th layer region | $SiH_4$ | 60 | 300 | 15 | 0.5 | 0.5 |
| | | $C_2H_2$ | 40 | | | | |
| | | $B_2H_6$ (against $SiH_4$) | 0.5 ppm | | | | |
| | | $AlCl_3$/He | 0.2 | | | | |

TABLE 224-continued

| Order of lamination (layer name) | Gases and their flow rates (SCCM) | | Substrate temperature (°C.) | RF discharging power (mW/cm³) | Inner pressure (Torr) | Layer thickness (μm) |
|---|---|---|---|---|---|---|
| | $SiF_4$ | 0.5 | | | | |
| | NO | 0.2 | | | | |
| | $GeH_4$ | 3 | | | | |

TABLE 225

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 50 | 250 | 1 | 0.4 | 0.02 |
| | | $H_2$ | 5→200 * | | | | |
| | | $AlCl_3$/He | | | | | |
| | | (S-side: 0.01 μm) | 200→30 ** | | | | |
| | | (UL-side: 0.01 μm) | 30→10 ** | | | | |
| | | $C_2H_2$ | 2 | | | | |
| | | NO | 5 | | | | |
| | | $B_2H_6$ (against $SiH_4$) | 30 ppm | | | | |
| | | $GeH_4$ | 10 | | | | |
| Upper layer | 1st layer region | $SiH_4$ | 100 | 300 | 10 | 0.35 | 3 |
| | | $H_2$ | 150 | | | | |
| | | $B_2H_6$ (against $SiH_4$) | 800 ppm | | | | |
| | | $C_2H_2$ | 0.1 | | | | |
| | | $AlCl_3$/He | 0.1 | | | | |
| | | NO | 10 | | | | |
| | | $SiF_4$ | 0.5 | | | | |
| | 2nd layer region | $SiH_4$ | 300 | 300 | 20 | 0.5 | 5 |
| | | $H_2$ | 300 | | | | |
| | | $C_2H_2$ | 0.1 | | | | |
| | | NO | 0.1 | | | | |
| | | $B_2H_6$ (against $SiH_4$) | 0.3 ppm | | | | |
| | | $SiF_4$ | 0.1 | | | | |
| | | $AlCl_3$/He | 0.1 | | | | |
| | | $GeH_4$ | 1 | | | | |
| | 3rd layer region | $SiF_4$ | 0.5 | 300 | 15 | 0.4 | 20 |
| | | NO | 0.1 | | | | |
| | | $SiH_4$ | 100 | | | | |
| | | $C_2H_2$ | 0.1 | | | | |
| | | $NH_3$ | 100 | | | | |
| | | $AlCl_3$/He | 0.1 | | | | |
| | | $B_2H_6$ (against $SiH_4$) | 0.3 ppm | | | | |
| | | $GeH_4$ | 2 | | | | |
| | 4th layer region | $SiH_4$ | 55 | 300 | 15 | 0.5 | 0.5 |
| | | $C_2H_2$ | 30 | | | | |
| | | NO | 0.2 | | | | |
| | | $B_2H_6$ (against $SiH_4$) | 0.4 ppm | | | | |
| | | $SiF_4$ | 1 | | | | |
| | | $AlCl_3$/He | 0.2 | | | | |
| | | $GeH_4$ | 3 | | | | |

TABLE 226

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 50 | 250 | 1 | 0.4 | 0.02 |
| | | $H_2$ | 5→200 * | | | | |
| | | $AlCl_3$/He | | | | | |
| | | (S-side: 0.01 μm) | 200→30 ** | | | | |
| | | (UL-side: 0.01 μm) | 30→10 ** | | | | |
| | | $C_2H_2$ | 1→3 * | | | | |
| | | NO | 3 | | | | |
| | | $B_2H_6$ (against $SiH_4$) | 100 ppm | | | | |
| | | $GeH_4$ | 15 | | | | |
| Upper layer | 1st layer region | $SiH_4$ | 100 | 300 | 10 | 0.35 | 3 |
| | | $H_2$ | 150 | | | | |
| | | $B_2H_6$ (against $SiH_4$) | 800 ppm | | | | |
| | | $AlCl_3$/He | 0.1 | | | | |
| | | $SiF_4$ | 0.5 | | | | |
| | | NO | 10 | | | | |
| | | $C_2H_2$ | 0.1 | | | | |
| | 2nd layer region | $SiF_4$ | 0.1 | 300 | 20 | 0.5 | 2 |
| | | $SiH_4$ | 300 | | | | |
| | | $H_2$ | 300 | | | | |
| | | $C_2H_2$ | 0.1 | | | | |
| | | $AlCl_3$/He | 0.1 | | | | |
| | | NO | 0.1 | | | | |

TABLE 226-continued

| Order of lamination (layer name) | | Gases and their flow rates (SCCM) | | Substrate temperature (°C.) | RF discharging power (mW/cm$^3$) | Inner pressure (Torr) | Layer thickness (μm) |
|---|---|---|---|---|---|---|---|
| | | $B_2H_6$ (against $SiH_4$) | 0.3 ppm | | | | |
| | | $GeH_4$ | 1 | | | | |
| | 3rd | $SiF_4$ | 0.5 | 300 | 15 | 0.4 | 20 |
| | layer | $SiH_4$ | 100 | | | | |
| | region | $C_2H_2$ | 0.4 | | | | |
| | | $AlCl_3$/He | 0.1 | | | | |
| | | NO | 0.1 | | | | |
| | | $B_2H_6$ (against $SiH_4$) | 0.3 ppm | | | | |
| | | $N_2$ | 500 | | | | |
| | | $GeH_4$ | 1 | | | | |
| | 4th | $SiH_4$ | 50 | 300 | 10 | 0.4 | 0.5 |
| | layer | $C_2H_2$ | 25 | | | | |
| | region | $AlCl_3$/He | 0.1 | | | | |
| | | $SiF_4$ | 0.3 | | | | |
| | | NO | 0.2 | | | | |
| | | $B_2H_6$ (against $SiH_4$) | 0.3 ppm | | | | |
| | | $GeH_4$ | 1 | | | | |

TABLE 227

| Order of lamination (layer name) | | Gases and their flow rates (SCCM) | | Substrate temperature (°C.) | RF discharging power (mW/cm$^3$) | Inner pressure (Torr) | Layer thickness (μm) |
|---|---|---|---|---|---|---|---|
| Lower layer | | $SiH_4$ | 50 | 250 | 1 | 0.4 | 0.02 |
| | | $H_2$ | 5→200 * | | | | |
| | | $AlCl_3$/He | | | | | |
| | | (S-side: 0.01 μm) | 200→30 ** | | | | |
| | | (UL-side: 0.01 μm) | 30→10 ** | | | | |
| | | $C_2H_2$ | 2 | | | | |
| | | NO | 5→8 * | | | | |
| | | $B_2H_6$ (against $SiH_4$) | 10→100 ppm * | | | | |
| | | $SnH_4$ | 20 | | | | |
| Upper layer | 1st layer region | $SiH_4$ | 100 | 300 | 10 | 0.35 | 3 |
| | | $H_2$ | 150 | | | | |
| | | $B_2H_6$ (against $SiH_4$) | 800 ppm | | | | |
| | | $AlCl_3$/He | 0.1 | | | | |
| | | NO | 10 | | | | |
| | | $SiF_4$ | 0.5 | | | | |
| | | $C_2H_2$ | 0.1 | | | | |
| | 2nd layer region | $AlCl_3$/He | 0.1 | 300 | 15 | 0.4 | 20 |
| | | $SiF_4$ | 5 | | | | |
| | | $SiH_4$ | 100 | | | | |
| | | $C_2H_2$ | 15 | | | | |
| | | $B_2H_6$ (against $SiH_4$) | 0.3 ppm | | | | |
| | | NO | 0.1 | | | | |
| | | $SnH_4$ | 1 | | | | |
| | 3rd layer region | $AlCl_3$/He | 0.1 | 300 | 20 | 0.5 | 5 |
| | | $SiF_4$ | 0.5 | | | | |
| | | $SiH_4$ | 300 | | | | |
| | | $H_2$ | 300 | | | | |
| | | NO | 0.1 | | | | |
| | | $C_2H_2$ | 0.1 | | | | |
| | | $B_2H_6$ (against $SiH_4$) | 0.3 ppm | | | | |
| | | $SnH_4$ | 2 | | | | |
| | 4th layer region | $SiH_4$ | 60 | 300 | 10 | 0.5 | 0.5 |
| | | $C_2H_2$ | 20 | | | | |
| | | $B_2H_6$ (against $SiH_4$) | 0.4 ppm | | | | |
| | | $AlCl_3$/He | 0.2 | | | | |
| | | $SiF_4$ | 1 | | | | |
| | | NO | 0.3 | | | | |
| | | $SnH_4$ | 2 | | | | |

TABLE 228

| Order of lamination (layer name) | Gases and their flow rates (SCCM) | | Substrate temperature (°C.) | RF discharging power (mW/cm$^3$) | Inner pressure (Torr) | Layer thickness (μm) |
|---|---|---|---|---|---|---|
| Lower layer | $SiH_4$ | 50 | 250 | 1 | 0.4 | 0.02 |
| | $H_2$ | 5 → 200* | | | | |
| | $AlCl_3$/He | | | | | |
| | (S-side: 0.01 μm) | 200 → 30** | | | | |
| | (UL-side: 0.01 μm) | 30 → 10** | | | | |
| | $C_2H_2$ | 2 | | | | |
| | NO | 5 → 8* | | | | |
| | $B_2H_6$ (against $SiH_4$) | | | | | |

TABLE 228-continued

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| | | (S-side: 0.01 μm) | 50 | | | | |
| | | (UL-side: 0.01 μm) | 50 → 100* | | | | |
| | | $GeH_4$ | 20 | | | | |
| Upper layer | 1st layer region | $SiH_4$ | 100 | 300 | 10 | 0.35 | 3 |
| | | $H_2$ | 150 | | | | |
| | | $B_2H_6$ (against $SiH_4$) | 800 ppm | | | | |
| | | $C_2H_2$ | 0.1 | | | | |
| | | $AlCl_3$/He | 0.1 | | | | |
| | | NO | 10 | | | | |
| | | $SiF_4$ | 0.5 | | | | |
| | 2nd layer region | $SiF_4$ | 0.5 | 300 | 15 | 0.4 | 20 |
| | | $SiH_4$ | 100 | | | | |
| | | $C_2H_2$ | 15 | | | | |
| | | $AlCl_3$/He | 0.1 | | | | |
| | | NO | 0.1 | | | | |
| | | $B_2H_6$ (against $SiH_4$) | 10 ppm | | | | |
| | | $GeH_4$ | 2 | | | | |
| | 3rd layer region | $SiF_4$ | 0.5 | 300 | 20 | 0.5 | 4 |
| | | $SiH_4$ | 300 | | | | |
| | | $H_2$ | 300 | | | | |
| | | $C_2H_2$ | 0.1 | | | | |
| | | $AlCl_3$/He | 0.1 | | | | |
| | | NO | 0.1 | | | | |
| | | $B_2H_6$ (against $SiH_4$) | 0.3 ppm | | | | |
| | | $GeH_4$ | 1 | | | | |
| | 4th layer region | $SiH_4$ | 60 | 300 | 15 | 0.5 | 0.4 |
| | | $C_2H_2$ | 30 | | | | |
| | | $AlCl_3$/He | 0.5 | | | | |
| | | $SiF_4$ | 0.5 | | | | |
| | | NO | 0.2 | | | | |
| | | $B_2H_6$ (against $SiH_4$) | 0.4 ppm | | | | |
| | | $GeH_4$ | 1 | | | | |

TABLE 229

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 50 | 250 | 1 | 0.4 | 0.02 |
| | | $H_2$ | 5 → 200* | | | | |
| | | $AlCl_3$/He | | | | | |
| | | (S-side: 0.01 μm) | 200 → 30** | | | | |
| | | (UL-side: 0.01 μm) | 30 → 10** | | | | |
| | | NO | 10 | | | | |
| | | $C_2H_2$ | 0.1 | | | | |
| | | $GeH_4$ | 15 | | | | |
| Upper layer | 1st layer region | $SiH_4$ | 100 | 300 | 10 | 0.35 | 3 |
| | | $H_2$ | 150 | | | | |
| | | $PH_3$ (against $SiH_4$) | 800 ppm | | | | |
| | | $AlCl_3$/He | 0.1 | | | | |
| | | $SiF_4$ | 0.5 | | | | |
| | | NO | 10 | | | | |
| | | $C_2H_2$ | 0.1 | | | | |
| | 2nd layer region | $SiH_4$ | 100 | 300 | 15 | 0.4 | 20 |
| | | $SiF_4$ | 0.5 | | | | |
| | | $GeH_4$ | 2 | | | | |
| | | $C_2H_2$ | 15 | | | | |
| | | $PH_3$ (against $SiH_4$) | 8 ppm | | | | |
| | | NO | 0.1 | | | | |
| | | $AlCl_3$/He | 0.1 | | | | |
| | 3rd layer region | NO | 0.1 | 300 | 20 | 0.5 | 6 |
| | | $SiF_4$ | 0.5 | | | | |
| | | $H_2$ | 300 | | | | |
| | | $SiH_4$ | 300 | | | | |
| | | $PH_3$ (against $SiH_4$) | 0.1 ppm | | | | |
| | | $AlCl_3$/He | 0.1 | | | | |
| | | $C_2H_2$ | 0.1 | | | | |
| | 4th layer region | $SiH_4$ | 50 | 300 | 10 | 0.5 | 0.6 |
| | | $C_2H_2$ | 20 | | | | |
| | | $AlCl_3$/He | 0.2 | | | | |
| | | $SiF_4$ | 0.5 | | | | |
| | | NO | 0.2 | | | | |
| | | $B_2H_6$ (against $SiH_4$) | 0.3 ppm | | | | |
| | | $GeH_4$ | 1 | | | | |
| | | $PH_3$ (against $SiH_4$) | 0.1 ppm | | | | |

TABLE 230

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 50 | 250 | 1 | 0.4 | 0.02 |
| | | $H_2$ | 5 → 200* | | | | |
| | | $AlCl_3$/He | | | | | |
| | | (S-side: 0.01 μm) | 200 → 30** | | | | |
| | | (UL-side: 0.01 μm) | 30 → 10** | | | | |
| | | $C_2H_2$ | 10 | | | | |
| | | NO | 0.1 | | | | |
| | | $GeH_4$ | 15 | | | | |
| Upper layer | 1st layer region | $SiH_4$ | 100 | 300 | 10 | 0.35 | 3 |
| | | $B_2H_6$ (against $SiH_4$) | 800 ppm | | | | |
| | | $AlCl_3$/He | 0.1 | | | | |
| | | $SiF_4$ | 0.5 | | | | |
| | | $C_2H_2$ | 0.1 | | | | |
| | | $H_2$ | 150 | | | | |
| | | NO | 10 | | | | |
| | 2nd layer region | $AlCl_3$/He | 0.1 | 300 | 15 | 0.4 | 20 |
| | | $SiF_4$ | 0.5 | | | | |
| | | $SiH_4$ | 100 | | | | |
| | | NO | 0.1 | | | | |
| | | $C_2H_2$ | 15 | | | | |
| | | $B_2H_6$ (against $SiH_4$) | 12 → 0.3 ppm** | | | | |
| | | $GeH_4$ | 1 | | | | |
| | 3rd layer region | $SiF_4$ | 0.5 | 300 | 20 | 0.5 | 3 |
| | | $SiH_4$ | 300 | | | | |
| | | $H_2$ | 300 | | | | |
| | | $C_2H_2$ | 0.1 | | | | |
| | | $AlCl_3$/He | 0.1 | | | | |
| | | $B_2H_6$ (against $SiH_4$) | 0.3 ppm | | | | |
| | | NO | 0.1 | | | | |
| | | $GeH_4$ | 1 | | | | |
| | 4th layer region | $SiH_4$ | 50 | 300 | 15 | 0.4 | 0.5 |
| | | $C_2H_2$ | 30 | | | | |
| | | $B_2H_6$ (against $SiH_4$) | 0.2 ppm | | | | |
| | | NO | 0.3 | | | | |
| | | $AlCl_3$/He | 0.1 | | | | |
| | | $SiF_4$ | 0.4 | | | | |
| | | $GeH_4$ | 0.5 | | | | |

TABLE 231

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 50 | 250 | 5 | 0.4 | 0.05 |
| | | $H_2$ | 10 → 200* | | | | |
| | | $AlCl_3$/He | 120 → 40** | | | | |
| | | $Mg(C_5H_5)_2$/He | 10 | | | | |
| Upper layer | 1st layer region | $SiH_4$ | 100 | 250 | 10 | 0.35 | 3 |
| | | $H_2$ | 100 | | | | |
| | | NO | 30 | | | | |
| | 2nd layer region | $SiH_4$ | 300 | 250 | 15 | 0.5 | 20 |
| | | $H_2$ | 300 | | | | |
| | 3rd layer region | $SiH_4$ | 50 | 250 | 10 | 0.4 | 0.5 |
| | | $CH_4$ | 500 | | | | |

TABLE 232

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 50 | 250 | 5 | 0.4 | 0.05 |
| | | $AlCl_3$/He | 120 → 40** | | | | |
| Upper layer | 1st layer region | $SiH_4$ | 100 | 250 | 10 | 0.35 | 3 |
| | | $H_2$ | 100 | | | | |
| | | NO | 30 | | | | |
| | 2nd layer region | $SiH_4$ | 300 | 250 | 15 | 0.5 | 20 |
| | | $H_2$ | 300 | | | | |
| | 3rd layer region | $SiH_4$ | 50 | 250 | 10 | 0.4 | 0.5 |
| | | $CH_4$ | 500 | | | | |

TABLE 233

| Order of lamination (layer name) | | Gases and their flow rates (SCCM) | | Substrate temperature (°C.) | RF discharging power (mW/cm$^3$) | Inner pressure (Torr) | Layer thickness (μm) |
|---|---|---|---|---|---|---|---|
| Lower layer | | $SiH_4$ | 50 | 250 | 5 | 0.4 | 0.02 |
| | | $H_2$ | 10 → 200* | | | | |
| | | $AlCl_3$/He | | | | | |
| | | (S-side: 0.01 μm) | 100 → 10** | | | | |
| | | (UL-side: 0.01 μm) | 10 | | | | |
| | | $Mg(C_5H_5)_2$/He | 5 | | | | |
| | | $B_2H_6$ (against $SiH_4$) | 100 ppm | | | | |
| | | NO | 3 | | | | |
| Upper layer | 1st layer region | $SiH_4$ | 300 | 250 | 10 | 0.4 | 3 |
| | | $H_2$ | 300 | | | | |
| | | NO | 30 | | | | |
| | | $B_2H_6$ (against $SiH_4$) | 800 ppm | | | | |
| | 2nd layer region | $SiH_4$ | 300 | 250 | 15 | 0.5 | 20 |
| | | $H_2$ | 300 | | | | |
| | 3rd layer region | $SiH_4$ | 50 | 250 | 10 | 0.4 | 0.5 |
| | | $CH_4$ | 500 | | | | |

TABLE 234

| Order of lamination (layer name) | | Gases and their flow rates (SCCM) | | Substrate temperature (°C.) | RF discharging power (mW/cm$^3$) | Inner pressure (Torr) | Layer thickness (μm) |
|---|---|---|---|---|---|---|---|
| Lower layer | | $SiH_4$ | 50 | 150 | 0.5 | 0.3 | 0.02 |
| | | $H_2$ | 5 → 200* | ↓ | ↓ | | |
| | | $AlCl_3$/He | | 300 | 1.5 | | |
| | | (S-side: 0.01 μm) | 200 → 30** | | | | |
| | | (UL-side: 0.01 μm) | 30 → 10** | | | | |
| | | $Mg(C_5H_5)_2$/He | 8 | | | | |
| Upper layer | 1st layer region | $SiH_4$ | 100 | 270 | 10 | 0.35 | 3 |
| | | $H_2$ | 100 | | | | |
| | | $B_2H_6$ (against $SiH_4$) | 800 ppm | | | | |
| | | NO | 10 | | | | |
| | 2nd layer region | $SiH_4$ | 300 | 250 | 20 | 0.5 | 20 |
| | | $H_2$ | 500 | | | | |

TABLE 235

| Order of lamination (layer name) | | Gases and their flow rates (SCCM) | | Substrate temperature (°C.) | RF discharging power (mW/cm$^3$) | Inner pressure (Torr) | Layer thickness (μm) |
|---|---|---|---|---|---|---|---|
| Lower layer | | $SiH_4$ | 50 | 250 | 1 | 0.3 | 0.02 |
| | | $H_2$ | 5 → 200* | | | | |
| | | $AlCl_3$/He | | | | | |
| | | (S-side: 0.01 μm) | 200 → 30** | | | | |
| | | (UL-side: 0.01 μm) | 30 → 10** | | | | |
| | | NO | 10 | | | | |
| | | $SiF_4$ | 0.2 | | | | |
| | | $B_2H_6$ (against $SiH_4$) | 50 ppm | | | | |
| | | $CH_4$ | 0.5 | | | | |
| | | $Mg(C_5H_5)_2$/He | 5 | | | | |
| Upper layer | 1st layer region | $SiH_4$ | 100 | 250 | 10 | 0.35 | 3 |
| | | He | 100 | | | | |
| | | $AlCl_3$/He | 0.3 | | | | |
| | | $SiF_4$ | 0.5 | | | | |
| | | $CH_4$ | 1 | | | | |
| | | NO | 10 | | | | |
| | | $Mg(C_5H_5)_2$/He | 0.2 | | | | |
| | | $B_2H_6$ (against $SiH_4$) | 300 ppm | | | | |
| | 2nd layer region | $SiH_4$ | 300 | 250 | 25 | 0.6 | 25 |
| | | $Mg(C_5H_5)_2$/He | 0.1 | | | | |
| | | He | 600 | | | | |
| | | $AlCl_3$/He | 0.1 | | | | |
| | | $SiF_4$ | 0.2 | | | | |
| | | $CH_4$ | 0.5 | | | | |
| | | NO | 0.1 | | | | |
| | | $B_2H_6$ | 0.3 ppm | | | | |
| | 3rd layer region | $SiH_4$ | 50 | 250 | 10 | 0.4 | 1 |
| | | $CH_4$ | 500 | | | | |
| | | NO | 0.1 | | | | |
| | | $SiF_4$ | 0.5 | | | | |
| | | $AlCl_3$/He | 0.5 | | | | |
| | | $B_2H_6$ (against $SiH_4$) | 0.1 ppm | | | | |

TABLE 235-continued

| Order of lamination (layer name) | Gases and their flow rates (SCCM) | | Substrate temperature (°C.) | RF discharging power (mW/cm³) | Inner pressure (Torr) | Layer thickness (μm) |
|---|---|---|---|---|---|---|
| | $Mg(C_5H_5)_2$/He | 0.5 | | | | |
| | $N_2$ | 1 | | | | |

TABLE 236

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 10 → 100* | 250 | 10 | 0.4 | 0.2 |
| | | $H_2$ | 5 → 200* | | | | |
| | | $AlCl_3$/He | | | | | |
| | | (S-side: 0.05 μm) | 200 → 40** | | | | |
| | | (UL-side: 0.15 μm) | 40 → 10** | | | | |
| | | $NH_3$ | 1 → 4* | | | | |
| | | $Mg(C_5H_5)_2$/He | 1 → 10* | | | | |
| Upper layer | 1st layer region | $SiH_4$ | 100 | 250 | 10 | 0.35 | 3 |
| | | $H_2$ | 100 | | | | |
| | | $PH_3$ (against $SiH_4$) | 800 ppm | | | | |
| | | $NH_3$ | 4 | | | | |
| | 2nd layer region | $SiH_4$ | 400 | 250 | 10 | 0.5 | 15 |
| | | Ar | 200 | | | | |
| | 3rd layer region | $SiH_4$ | 100 | 250 | 5 | 0.4 | 0.3 |
| | | $NH_3$ | 30 | | | | |

TABLE 237

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 10 → 100* | 300 | 10 | 0.4 | 0.2 |
| | | $H_2$ | 5 → 200* | | | | |
| | | $AlCl_3$/He | | | | | |
| | | (S-side: 0.05 μm) | 200 → 40** | | | | |
| | | (UL-side: 0.15 μm) | 40 → 10** | | | | |
| | | $C_2H_2$ | 1 → 5* | | | | |
| | | $B_2H_6$ (against $SiH_4$) | 100 ppm | | | | |
| | | $Mg(C_5H_5)_2$/He | 1 → 5* | | | | |
| Upper layer | 1st layer region | $SiH_4$ | 100 | 300 | 10 | 0.35 | 3 |
| | | $H_2$ | 100 | | | | |
| | | $B_2H_6$ (against $SiH_4$) | 1000 ppm | | | | |
| | | $C_2H_2$ | 5 | | | | |
| | 2nd layer region | $SiH_4$ | 300 | 300 | 20 | 0.5 | 20 |
| | | $H_2$ | 500 | | | | |
| | | $SiF_4$ | 50 | | | | |
| | 3rd layer region | $SiH_4$ | 100 | 300 | 15 | 0.4 | 7 |
| | | $CH_4$ | 600 | | | | |
| | | $PH_3$ (against $SiH_4$) | 3000 ppm | | | | |
| | 4th layer region | $SiH_4$ | 40 | 300 | 10 | 0.4 | 0.1 |
| | | $CH_4$ | 600 | | | | |

TABLE 238

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 50 | 330 | 5 | 0.4 | 0.05 |
| | | $H_2$ | 5 → 200* | | | | |
| | | $AlCl_3$/He | 200 → 20** | | | | |
| | | NO | 5 | | | | |
| | | $PH_3$ (against $SiH_4$) | 100 ppm | | | | |
| | | $Mg(C_5H_5)_2$/He | 5 | | | | |
| Upper layer | 1st layer region | $SiH_4$ | 100 | 330 | 10 | 0.35 | 3 |
| | | $H_2$ | 100 | | | | |
| | | $PH_3$ (against $SiH_4$) | 800 ppm | | | | |
| | | NO | 10 | | | | |
| | 2nd layer region | $SiH_4$ | 400 | 330 | 25 | 0.5 | 25 |
| | | $SiF_4$ | 10 | | | | |
| | | $H_2$ | 800 | | | | |
| | 3rd layer region | $SiH_4$ | 100 | 350 | 15 | 0.4 | 5 |
| | | $CH_4$ | 400 | | | | |
| | | $B_2H_6$ (against $SiH_4$) | 5000 ppm | | | | |

TABLE 238-continued

| Order of lamination (layer name) | Gases and their flow rates (SCCM) | | Substrate temperature (°C.) | RF discharging power (mW/cm³) | Inner pressure (Torr) | Layer thickness (μm) |
|---|---|---|---|---|---|---|
| 4th layer region | $SiH_4$ | 20 | 350 | 10 | 0.4 | 1 |
| | $CH_4$ | 400 | | | | |
| | $B_2H_6$ (against $SiH_4$) | 800 ppm | | | | |

TABLE 239

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 50 | 300 | 1 | 0.3 | 0.02 |
| | | $H_2$ | 5 → 200* | | | | |
| | | $AlCl_3$/He | | | | | |
| | | (S-side: 0.01 μm) | 200 → 30** | | | | |
| | | (UL-side: 0.01 μm) | 30 → 10** | | | | |
| | | $B_2H_6$ (against $SiH_4$) | 100 ppm | | | | |
| | | $N_2$ | 100 → 150* | | | | |
| | | $H_2S$ | 10 ppm | | | | |
| | | $Mg(C_5H_5)_2$/He | 10 | | | | |
| Upper layer | 1st layer region | $SiH_4$ | 100 | 300 | 10 | 0.35 | 5 |
| | | $H_2$ | 150 | | | | |
| | | $B_2H_6$ (against $SiH_4$) | 900 → 600 ppm** | | | | |
| | | $N_2$ | 150 | | | | |
| | 2nd layer region | $SiH_4$ | 300 | 300 | 20 | 0.5 | 20 |
| | | $H_2$ | 200 | | | | |
| | 3rd layer region | $SiH_4$ | 50 | 300 | 20 | 0.4 | 5 |
| | | $N_2$ | 500 | | | | |
| | | $PH_3$ (against $SiH_4$) | 3000 ppm | | | | |
| | 4th layer region | $SiH_4$ | 40 | 300 | 10 | 0.4 | 0.3 |
| | | $CH_4$ | 600 | | | | |

TABLE 240

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 50 | 250 | 1 | 0.4 | 0.02 |
| | | $B_2H_6$ (against $SiH_4$) | 100 ppm | | | | |
| | | $C_2H_2$ | 0.5 | | | | |
| | | $H_2$ | 5 → 200* | | | | |
| | | $AlCl_3$/He | | | | | |
| | | (S-side: 0.01 μm) | 200 → 30** | | | | |
| | | (UL-side: 0.01 μm) | 30 → 10** | | | | |
| | | $Mg(C_5H_5)_2$/He | 3 | | | | |
| Upper layer | 1st layer region | $SiH_4$ | 100 | 250 | 10 | 0.4 | 0.3 |
| | | $H_2$ | 100 | | | | |
| | | $B_2H_6$ (against $SiH_4$) | 1000 ppm | | | | |
| | | $C_2H_2$ | 5 | | | | |
| | 2nd layer region | $SiH_4$ | 300 | 250 | 15 | 0.5 | 10 |
| | | $H_2$ | 300 | | | | |
| | 3rd layer region | $SiH_4$ | 200 | 250 | 15 | 0.4 | 20 |
| | | $C_2H_2$ | 10 → 20* | | | | |
| | | NO | 1 | | | | |

TABLE 241

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 50 | 250 | 1 | 0.4 | 0.02 |
| | | $H_2$ | 5 → 200* | | | | |
| | | $AlCl_3$/He | | | | | |
| | | (S-side: 0.01 μm) | 200 → 30** | | | | |
| | | (UL-side: 0.01 μm) | 30 → 10** | | | | |
| | | $N_2$ | 100 | | | | |
| | | $H_2S$ (against $SiH_4$) | 10 ppm | | | | |
| | | $BF_3$ | 10 ppm | | | | |
| | | $Mg(C_5H_5)_2$/He | 5 | | | | |
| Upper layer | 1st layer region | $SiH_4$ | 100 | 300 | 10 | 0.35 | 3 |
| | | $H_2$ | 150 | | | | |
| | | $BF_3$ (against $SiH_4$) | 1000 ppm | | | | |
| | | $N_2$ | 150 | | | | |

TABLE 241-continued

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| | 2nd layer region | $SiH_4$ | 300 | 300 | 20 | 0.5 | 5 |
| | | $H_2$ | 300 | | | | |
| | 3rd layer region | $SiH_4$ | 100 | 300 | 15 | 0.4 | 20 |
| | | $CH_4$ | 100 | | | | |
| | 4th layer region | $SiH_4$ | 50 | 300 | 10 | 0.4 | 0.5 |
| | | $CH_4$ | 600 | | | | |

TABLE 242

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 10 → 100* | 300 | 5 | 0.4 | 0.2 |
| | | $H_2$ | 5 → 200* | | | | |
| | | $AlCl_3$/He | | | | | |
| | | (S-side: 0.05 μm) | 200 → 40** | | | | |
| | | (UL-side: 0.15 μm) | 40 → 10** | | | | |
| | | $NH_3$ | 1 → 5* | | | | |
| | | $Mg(C_5H_5)_2$/He | 1 → 10* | | | | |
| | | $PH_3$ (against $SiH_4$) | 100 ppm | | | | |
| Upper layer | 1st layer region | $SiH_4$ | 100 | 300 | 10 | 0.35 | 3 |
| | | $H_2$ | 100 | | | | |
| | | $PH_3$ (against $SiH_4$) | 800 ppm | | | | |
| | | $NH_3$ | 5 | | | | |
| | 2nd layer region | $SiH_4$ | 100 | 300 | 5 | 0.2 | 8 |
| | | $H_2$ | 300 | | | | |
| | 3rd layer region | $SiH_4$ | 300 | 300 | 15 | 0.4 | 25 |
| | | $NH_3$ | 50 | | | | |
| | 4th layer region | $SiH_4$ | 100 | 300 | 10 | 0.4 | 0.3 |
| | | $NH_3$ | 50 | | | | |

TABLE 243

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 10 → 100* | 250 | 5 | 0.4 | 0.2 |
| | | $H_2$ | 5 → 200* | | | | |
| | | $AlCl_3$/He | | | | | |
| | | (S-side: 0.05 μm) | 200 → 40** | | | | |
| | | (UL-side: 0.15 μm) | 40 → 10** | | | | |
| | | NO | 5 → 10* | | | | |
| | | $PF_5$ (against $SiH_4$) | 10 → 100 ppm* | | | | |
| | | $Mg(C_5H_5)_2$/He | 5 → 10* | | | | |
| Upper layer | 1st layer region | $SiH_4$ | 100 | 280 | 10 | 0.35 | 3 |
| | | $H_2$ | 100 | | | | |
| | | $PF_5$ (against $SiH_4$) | 1000 ppm | | | | |
| | | NO | 10 | | | | |
| | 2nd layer region | $SiH_4$ | 100 | 300 | 3 | 0.5 | 3 |
| | | $SiF_4$ | 5 | | | | |
| | | $H_2$ | 200 | | | | |
| | 3rd layer region | $SiH_4$ | 100 | 300 | 15 | 0.4 | 30 |
| | | $CH_4$ | 100 | | | | |
| | | $B_2H_6$ (against $SiH_4$) | 50 ppm | | | | |
| | 4th layer region | $SiH_4$ | 50 | 300 | 10 | 0.4 | 0.5 |
| | | $CH_4$ | 600 | | | | |

TABLE 244

| Order of lamination (layer name) | Gases and their flow rates (SCCM) | | Substrate temperature (°C.) | RF discharging power (mW/cm³) | Inner pressure (Torr) | Layer thickness (μm) |
|---|---|---|---|---|---|---|
| Lower layer | $SiH_4$ | 50 | 250 | 5 | 0.4 | 0.05 |
| | $H_2$ | 5 → 200* | | | | |
| | $AlCl_3$/He | 200 → 20** | | | | |
| | NO | 10 | | | | |
| | $B_2H_6$ (against $SiH_4$ | 100 ppm | | | | |

TABLE 244-continued

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| | | $Si_2F_6$ | 5 | | | | |
| | | $Mg(C_5H_5)_2$/He | 3 | | | | |
| Upper layer | 1st layer region | $SiH_4$ | 100 | 300 | 10 | 0.35 | 3 |
| | | $H_2$ | 150 | | | | |
| | | $B_2H_6$ (against $SiH_4$) | 800 ppm | | | | |
| | | NO | | | | | |
| | | (LL-side: 2 μm) | 10 | | | | |
| | | (U · 2nd LR-side: 1 μm) | 10 → 0** | | | | |
| | 2nd layer region | $Si_2H_6$ | 200 | 300 | 10 | 0.5 | 10 |
| | | $H_2$ | 200 | | | | |
| | 3rd layer region | $SiH_4$ | 300 | 330 | 20 | 0.4 | 30 |
| | | $C_2H_2$ | 50 | | | | |
| | | $PH_3$ (against $SiH_4$) | 100 ppm | | | | |
| | 4th layer region | $SiH_4$ | 200 | 330 | 10 | 0.4 | 1 |
| | | $C_2H_2$ | 200 | | | | |

TABLE 245

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 10 → 100* | 250 | 5 | 0.4 | 0.2 |
| | | $H_2$ | 5 → 200* | | | | |
| | | $AlCl_3$/He | | | | | |
| | | (S-side: 0.05 μm) | 200 → 40** | | | | |
| | | (UL-side: 0.15 μm) | 40 → 10** | | | | |
| | | $NH_3$ | 1 → 5* | | | | |
| | | $B_2H_6$ (against $SiH_4$) | 150 ppm | | | | |
| | | $GeH_4$ | 5 | | | | |
| | | $Mg(C_5H_5)_2$/He | 5 → 1** | | | | |
| | | $Si_2F_6$ | 1 → 8* | | | | |
| Upper layer | 1st layer region | $SiH_4$ | 100 | 270 | 10 | 0.35 | 3 |
| | | $H_2$ | 100 | | | | |
| | | $B_2H_6$ (against $SiH_4$) | 800 ppm | | | | |
| | | $NH_3$ | 5 | | | | |
| | 2nd layer region | $SiH_4$ | 100 | 300 | 5 | 0.2 | 8 |
| | | $H_2$ | 300 | | | | |
| | | $Si_2F_6$ | 10 | | | | |
| | 3rd layer region | $SiH_4$ | 300 | 300 | 15 | 0.4 | 25 |
| | | $NH_3$ | 30 → 50* | | | | |
| | | $PF_5$ (against $SiH_4$) | 50 ppm | | | | |
| | 4th layer region | $SiH_4$ | 100 | 300 | 5 | 0.4 | 0.7 |
| | | $NH_3$ | 80 → 100* | | | | |
| | | $PF_5$ (against $SiH_4$) | 500 ppm | | | | |

TABLE 246

| Order of lamination (layer name) | | Gases and their flow rates (SCCM) | | Substrate temperature (°C.) | RF discharging power (mW/cm²) | Inner pressure (Torr) | Layer thickness (μm) |
|---|---|---|---|---|---|---|---|
| Lower layer | | $SiH_4$ | 50 | 250 | 1 | 0.4 | 0.02 |
| | | $H_2$ | 5 → 200* | | | | |
| | | $AlCl_3$/He | | | | | |
| | | (S-side: 0.01 μm) | 200 → 30** | | | | |
| | | (UL-side: 0.01 μm) | 30 → 10** | | | | |
| | | $GeH_4$ | 5 | | | | |
| | | $Mg(C_5H_5)_2$/He | 3 | | | | |
| Upper layer | 1st layer region | $SiH_4$ | 100 | 250 | 10 | 0.35 | 3 |
| | | $H_2$ | 100 | | | | |
| | | $B_2H_6$ (against $SiH_4$) | 800 ppm | | | | |
| | | NO | | | | | |
| | | (LL-side: 2 μm) | 10 | | | | |
| | | (U · 2nd LR-side: 1 μm) | 10 → 0** | | | | |
| | 2nd layer region | $SiH_4$ | 300 | 300 | 20 | 0.5 | 20 |
| | | $H_2$ | 500 | | | | |
| | 3rd layer region | $SiH_4$ | 100 | 300 | 5 | 0.4 | 1 |
| | | $GeH_4$ | 10 → 50* | | | | |
| | | $H_2$ | 300 | | | | |
| | 4th layer | $SiH_4$ | 100 → 40** | 300 | 10 | 0.4 | 1 |
| | | $CH_4$ | 100 → 600* | | | | |

TABLE 246-continued

| Order of lamination (layer name) | Gases and their flow rates (SCCM) | Substrate temperature (°C.) | RF discharging power (mW/cm²) | Inner pressure (Torr) | Layer thickness (μm) |
|---|---|---|---|---|---|
| region | | | | | |

TABLE 247

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 50 | 300 | 1 | 0.3 | 0.02 |
| | | $H_2$ | 5→200* | | | | |
| | | $AlCl_3$/He | | | | | |
| | | (S-side: 0.01 μm) | 200→30** | | | | |
| | | (UL-side: 0.01 μm) | 30→10** | | | | |
| | | NO | 9 | | | | |
| | | $B_2H_6$ (against $SiH_4$) | 80 ppm | | | | |
| | | $Mg(C_5H_5)_2$/He | 8 | | | | |
| Upper layer | 1st layer region | $SiH_4$ | 85 | 330 | 9 | 0.35 | 3 |
| | | $H_2$ | 90 | | | | |
| | | $B_2H_6$ (against $SiH_4$) | 800 ppm | | | | |
| | | NO | 9 | | | | |
| | 2nd layer region | $SiH_4$ | 300 | 300 | 15 | 0.5 | 20 |
| | | $H_2$ | 400 | | | | |
| | 3rd layer region | $SiH_4$ | 50 | 300 | 10 | 0.4 | 0.5 |
| | | $CH_4$ | 500 | | | | |

TABLE 248

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 50 | 300 | 0.7 | 0.3 | 0.02 |
| | | $H_2$ | 5→200* | | | | |
| | | $AlCl_3$/He | | | | | |
| | | (S-side: 0.01 μm) | 200→30** | | | | |
| | | (UL-side: 0.01 μm) | 30→10** | | | | |
| | | NO | 8 | | | | |
| | | $B_2H_6$ (against $SiH_4$) | 80 ppm | | | | |
| | | $Mg(C_5H_5)_2$/He | 5 | | | | |
| Upper layer | 1st layer region | $SiH_4$ | 70 | 300 | 8 | 0.35 | 3 |
| | | $H_2$ | 80 | | | | |
| | | $B_2H_6$ (against $SiH_4$) | 800 ppm | | | | |
| | | NO | 8 | | | | |
| | 2nd layer region | $SiH_4$ | 200 | 300 | 12 | 0.4 | 20 |
| | | $H_2$ | 400 | | | | |
| | 3rd layer region | $SiH_4$ | 40 | 300 | 7 | 0.3 | 0.5 |
| | | $CH_4$ | 400 | | | | |

TABLE 249

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 25 | 300 | 0.5 | 0.2 | 0.02 |
| | | $H_2$ | 5→100* | | | | |
| | | $AlCl_3$/He | | | | | |
| | | (S-side: 0.01 μm) | 100→15** | | | | |
| | | (UL-side: 0.01 μm) | 15→5** | | | | |
| | | NO | 7 | | | | |
| | | $B_2H_6$ (against $SiH_4$) | 80 ppm | | | | |
| | | $Mg(C_5H_5)_2$/He | 3 | | | | |
| Upper layer | 1st layer region | $SiH_4$ | 55 | 300 | 7 | 0.35 | 3 |
| | | $H_2$ | 70 | | | | |
| | | $B_2H_6$ (against $SiH_4$) | 800 ppm | | | | |
| | | NO | 7 | | | | |
| | 2nd layer region | $SiH_4$ | 150 | 300 | 10 | 0.4 | 20 |
| | | $H_2$ | 300 | | | | |
| | 3rd layer | $SiH_4$ | 30 | 300 | 5 | 0.3 | 0.5 |
| | | $CH_4$ | 300 | | | | |

TABLE 249-continued

| Order of lamination (layer name) | Gases and their flow rates (SCCM) | Substrate temperature (°C.) | RF discharging power (mW/cm³) | Inner pressure (Torr) | Layer thickness (μm) |
|---|---|---|---|---|---|
| region | | | | | |

TABLE 250

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 20 | 300 | 0.3 | 0.2 | 0.02 |
| | | $H_2$ | 5→100* | | | | |
| | | $AlCl_3$/He | | | | | |
| | | (S-side: 0.01 μm) | 80→15** | | | | |
| | | (UL-side: 0.01 μm) | 15→5** | | | | |
| | | NO | 5 | | | | |
| | | $B_2H_6$ (against $SiH_4$) | 80 ppm | | | | |
| | | $Mg(C_5H_5)_2$/He | 3 | | | | |
| Upper layer | 1st layer region | $SiH_4$ | 45 | 300 | 6 | 0.35 | 3 |
| | | $H_2$ | 60 | | | | |
| | | $B_2H_6$ (against $SiH_4$) | 800 ppm | | | | |
| | | NO | 5 | | | | |
| | 2nd layer region | $SiH_4$ | 100 | 300 | 6 | 0.3 | 20 |
| | | $H_2$ | 300 | | | | |
| | 3rd layer region | $SiH_4$ | 20 | 300 | 3 | 0.2 | 0.5 |
| | | $CH_4$ | 200 | | | | |

TABLE 251

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 50 | 500 | 5 | 0.4 | 0.05 |
| | | $H_2$ | 5→200* | | | | |
| | | $AlCl_3$/He | 200→20** | | | | |
| | | $C_2H_2$ | 5 | | | | |
| | | $B_2H_6$ (against $SiH_4$) | 60 ppm | | | | |
| | | $Mg(C_5H_5)_2$/He | 10 | | | | |
| Upper layer | 1st layer region | $SiH_4$ | 180 | 500 | 22 | 0.4 | 4 |
| | | $H_2$ | 1200 | | | | |
| | | $B_2H_6$ (against $SiH_4$) | 700 ppm | | | | |
| | | $C_2H_2$ | 8 | | | | |
| | 2nd layer region | $SiH_4$ | 300 | 500 | 30 | 0.5 | 10 |
| | | $H_2$ | 1500 | | | | |
| | 3rd layer region | $SiH_4$ | 200 | 500 | 30 | 0.4 | 20 |
| | | $C_2H_2$ | 10→20* | | | | |
| | | NO | 1 | | | | |

TABLE 252

| Order of lamination (layer name) | | Gases and their flow rates (SCCM) | | Substrate temperature (°C.) | μW discharging power (mW/cm³) | Inner pressure (Torr) | Layer thickness (μm) |
|---|---|---|---|---|---|---|---|
| Lower layer | | $SiH_4$ | 150 | 250 | 0.5 | 0.6 | 0.02 |
| | | $H_2$ | 20→500* | | | | |
| | | $AlCl_3$/He | | | | | |
| | | (S-side: 0.01 μm) | 400→80** | | | | |
| | | (UL-side: 0.01 μm) | 80→50** | | | | |
| | | NO | 10 | | | | |
| | | $B_2H_6$ (against $SiH_4$) | 60 ppm | | | | |
| | | $SiF_4$ | 20 | | | | |
| | | $Mg(C_5H_5)_2$/He | 15 | | | | |
| Upper layer | 1st layer region | $SiH_4$ | 350 | 250 | 0.5 | 0.5 | 3 |
| | | $H_2$ | 350 | | | | |
| | | $B_2H_6$ (against $SiH_4$) | 600 ppm | | | | |
| | | NO | 13 | | | | |
| | | $SiF_4$ | 20 | | | | |
| | 2nd layer region | $SiH_4$ | 700 | 250 | 0.5 | 0.5 | 20 |
| | | $SiF_4$ | 30 | | | | |
| | | $H_2$ | 500 | | | | |
| | 3rd layer | $SiH_4$ | 150 | 250 | 0.5 | 0.3 | 1 |
| | | $CH_4$ | 500 | | | | |

TABLE 252-continued

| Order of lamination (layer name) | Gases and their flow rates (SCCM) | Substrate temperature (°C.) | μW discharging power (mW/cm³) | Inner pressure (Torr) | Layer thickness (μm) |
|---|---|---|---|---|---|
| region | | | | | |

TABLE 253

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 50 | 250 | 5 | 0.4 | 0.05 |
| | | $H_2$ | 5→200* | | | | |
| | | $AlCl_3$/He | 200→20** | | | | |
| | | $C_2H_2$ | 5 | | | | |
| | | $B_2H_6$ (against $SiH_4$) | 100 ppm | | | | |
| | | $SiF_4$ | 1 | | | | |
| | | $Mg(C_5H_5)_2$/He | 5 | | | | |
| Upper layer | 1st layer region | $SiH_4$ | 100 | 250 | 10 | 0.35 | 3 |
| | | $H_2$ | 100 | | | | |
| | | $B_2H_6$ (against $SiH_4$) | 1000 ppm | | | | |
| | | $C_2H_2$ | 5 | | | | |
| | | $SiF_4$ | 5 | | | | |
| | 2nd layer region | $SiH_4$ | 200 | 250 | 15 | 0.4 | 20 |
| | | $C_2H_2$ | 10→20* | | | | |
| | | NO | 1 | | | | |
| | | $SiF_4$ | 5 | | | | |
| | 3rd layer region | $SiH_4$ | 300 | 250 | 15 | 0.5 | 10 |
| | | $H_2$ | 300 | | | | |
| | | $SiF_4$ | 5 | | | | |

TABLE 254

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 50 | 250 | 1 | 0.4 | 0.02 |
| | | $H_2$ | 5→200* | | | | |
| | | $AlCl_3$/He | | | | | |
| | | (S-side: 0.01 μm) | 200→30** | | | | |
| | | (UL-side: 0.01 μm) | 30→10** | | | | |
| | | $N_2$ | 100 | | | | |
| | | $B_2H_6$ (against $SiH_4$) | 10 ppm | | | | |
| | | $Mg(C_5H_5)_2$/He | 1→10* | | | | |
| Upper layer | 1st layer region | $SiH_4$ | 100 | 300 | 10 | 0.35 | 3 |
| | | $H_2$ | 150 | | | | |
| | | $B_2H_6$ (against $SiH_4$) | 900→600 ppm** | | | | |
| | | $N_2$ | 150 | | | | |
| | 2nd layer region | $SiH_4$ | 100 | 300 | 15 | 0.4 | 20 |
| | | $CH_4$ | 100 | | | | |
| | 3rd layer region | $SiH_4$ | 300 | 300 | 20 | 0.5 | 5 |
| | | $H_2$ | 300 | | | | |
| | 4th layer region | $SiH_4$ | 50 | 300 | 10 | 0.4 | 0.5 |
| | | $CH_4$ | 600 | | | | |

TABLE 255

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 10→100* | 300 | 5 | 0.4 | 0.2 |
| | | $H_2$ | 5→200* | | | | |
| | | $AlCl_3$/He | | | | | |
| | | (S-side: 0.05 μm) | 200→40** | | | | |
| | | (UL-side: 0.01 μm) | 40→10** | | | | |
| | | $NH_3$ | 1→5* | | | | |
| | | $Mg(C_3H_5)_2$/He | 8 | | | | |
| | | $SiH_4$ | 2→20* | | | | |
| Upper layer | 1st layer region | $SiH_4$ | 100 | 300 | 10 | 0.35 | 3 |
| | | $H_2$ | 100 | | | | |
| | | $PF_5$ (against $SiH_4$) | 800 ppm | | | | |
| | | $NH_3$ | 5 | | | | |
| | 2nd layer region | $SiH_4$ | 300 | 300 | 15 | 0.4 | 25 |
| | | $NH_2$ | 50 | | | | |

TABLE 255-continued

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| | 3rd layer region | $SiH_4$ | 100 | 300 | 5 | 0.2 | 8 |
| | | $H_2$ | 300 | | | | |
| | | $Si_2F_6$ | 5 | | | | |
| | 4th layer region | $SiH_4$ | 100 | 300 | 10 | 0.4 | 0.3 |
| | | $NH_3$ | 50 | | | | |

TABLE 256

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 10→100* | 250 | 5 | 0.4 | 0.2 |
| | | $H_2$ | 5→200* | | | | |
| | | $AlCl_3$/He | | | | | |
| | | (S-side: 0.05 μm) | 200→40** | | | | |
| | | (UL-side: 0.15 μm) | 40→10** | | | | |
| | | NO | 1 | | | | |
| | | $Mg(C_5H_5)_2$/He | 10 | | | | |
| | | $PF_5$ (against $SiH_4$) | 10→100 ppm* | | | | |
| Upper layer | 1st layer region | $SiH_4$ | 100 | 250 | 10 | 0.35 | 3 |
| | | $H_2$ | 100 | | | | |
| | | $PF_5$ (against $SiH_4$) | 1000 ppm | | | | |
| | | NO | 10 | | | | |
| | 2nd layer region | $SiH_4$ | 100 | 300 | 15 | 0.4 | 30 |
| | | $CH_4$ | 100 | | | | |
| | | $PF_5$ (against $SiH_4$) | 50 ppm | | | | |
| | 3rd layer region | $SiH_4$ | 100 | 300 | 3 | 0.5 | 3 |
| | | $SiF_4$ | 5 | | | | |
| | | $H_2$ | 200 | | | | |
| | 4th layer region | $SiH_4$ | 50 | 300 | 10 | 0.4 | 0.5 |
| | | $CH_4$ | 600 | | | | |

TABLE 257

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 50 | 250 | 5 | 0.4 | 0.05 |
| | | $H_2$ | 5→200* | | | | |
| | | $AlCl_3$/He | 200→20** | | | | |
| | | NO | 10 | | | | |
| | | $B_2H_6$ (against $SiH_4$) | 100 ppm | | | | |
| | | $Mg(C_5H_5)_2$/He | 10 | | | | |
| Upper layer | 1st layer region | $SiH_4$ | 100 | 300 | 10 | 0.35 | 3 |
| | | $H_2$ | 100 | | | | |
| | | $B_2H_6$ (against $SiH_4$) | 800 ppm | | | | |
| | | NO | | | | | |
| | | (LL-side: 2 μm) | 10 | | | | |
| | | (U · 2nd LR-side: 1 μm) | 10→0** | | | | |
| | 2nd layer region | $SiH_4$ | 300 | 330 | 20 | 0.4 | 30 |
| | | $C_2H_2$ | 50 | | | | |
| | | $B_2H_6$ (against $SiH_4$) | 100 ppm | | | | |
| | 3rd layer region | $Si_2H_6$ | 200 | 300 | 10 | 0.5 | 10 |
| | | $H_2$ | 200 | | | | |
| | 4th layer region | $SiH_4$ | 200 | 330 | 10 | 0.4 | 1 |
| | | $C_2H_2$ | 200 | | | | |

TABLE 258

| Order of lamination (layer name) | Gases and their flow rates (SCCM) | | Substrate temperature (°C.) | RF discharging power (mW/cm³) | Inner pressure (Torr) | Layer thickness (μm) |
|---|---|---|---|---|---|---|
| Lower layer | $SiH_4$ | 10→100* | 250 | 5 | 0.4 | 0.2 |
| | $Mg(C_5H_5)_2$/He | 1→10* | | | | |
| | $NH_3$ | 1→5* | | | | |
| | $H_2$ | 5→200* | | | | |
| | $AlCl_3$/He | | | | | |
| | (S-side: 0.05 μm) | 200→40** | | | | |
| | (UL-side: 0.15 μm) | 40→10** | | | | |
| | $PF_3$ (against $SiH_4$) | 50 ppm | | | | |

TABLE 258-continued

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Upper layer | 1st layer region | $SiH_4$ | 100 | 300 | 10 | 0.4 | 3 |
| | | $H_2$ | 100 | | | | |
| | | $PH_3$ (against $SiH_4$) | 800 ppm | | | | |
| | | $NH_3$ | 5 | | | | |
| | 2nd layer region | $SiH_4$ | 300 | 300 | 15 | 0.4 | 25 |
| | | $NH_3$ | 30→50* | | | | |
| | | $PH_3$ (against $SiH_4$) | 50 ppm | | | | |
| | 3rd layer region | $SiH_4$ | 100 | 300 | 5 | 0.4 | 8 |
| | | $H_2$ | 300 | | | | |
| | 4th layer region | $SiH_4$ | 100 | 300 | 5 | 0.4 | 0.7 |
| | | $NH_3$ | 80→100* | | | | |
| | | $B_2H_6$ (against $SiH_4$) | 500 ppm | | | | |

TABLE 259

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 50 | 250 | 1 | 0.3 | 0.02 |
| | | $H_2$ | 5→200* | | | | |
| | | $AlCl_3$/He | | | | | |
| | | (S-side: 0.01 μm) | 200→30** | | | | |
| | | (UL-side: 0.01 μm) | 30→10** | | | | |
| | | NO | 10 | | | | |
| | | $B_2H_6$ (against $SiH_4$) | 200 ppm | | | | |
| | | $Mg(C_5H_5)_2$/He | 8 | | | | |
| Upper layer | 1st layer region | $SiH_4$ | 100 | 250 | 10 | 0.35 | 3 |
| | | He | 100 | | | | |
| | | NO | 10 | | | | |
| | | $B_2H_6$ (against $SiH_4$) | 800 ppm | | | | |
| | 2nd layer region | $SiH_4$ | 300 | 250 | 25 | 0.6 | 25 |
| | | He | 600 | | | | |
| | | $B_2H_6$ (against $SiH_4$) | 0.3 ppm | | | | |
| | 3rd layer region | $SiH_4$ | 50 | 250 | 10 | 0.4 | 1 |
| | | $CH_4$ | 500 | | | | |

TABLE 260

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 10→100* | 300 | 10 | 0.4 | 0.2 |
| | | $H_2$ | 5→200* | | | | |
| | | $AlCl_3$/He | | | | | |
| | | (S-side: 0.05 μm) | 200→40** | | | | |
| | | (UL-side: 0.15 μm) | 40→10** | | | | |
| | | $C_2H_2$ | 1→5* | | | | |
| | | $B_2H_6$ (against $SiH_4$) | 100 ppm | | | | |
| | | NO | 0.5 | | | | |
| | | $Mg(C_5H_5)_2$/He | 10 | | | | |
| | | $SiF_4$ | 0.5 | | | | |
| Upper layer | 1st layer region | $SiH_4$ | 100 | 300 | 10 | 0.35 | 3 |
| | | $H_2$ | 100 | | | | |
| | | $B_2H_6$ (against $SiH_4$) | 1000 ppm | | | | |
| | | $C_2H_2$ | 5 | | | | |
| | | $AlCl_3$/He | 1 | | | | |
| | | NO | 1 | | | | |
| | | $Mg(C_5H_5)_2$/He | 0.5 | | | | |
| | | $SiF_4$ | 1 | | | | |
| | 2nd layer region | $SiH_4$ | 300 | 300 | 20 | 0.5 | 20 |
| | | $H_2$ | 500 | | | | |
| | | $C_2H_2$ | 0.1 | | | | |
| | | $AlCl_3$/He | 0.1 | | | | |
| | | NO | 0.1 | | | | |
| | | $SiF_4$ | 0.5 | | | | |
| | | $B_2H_6$ | 0.3 ppm | | | | |
| | | $Mg(C_5H_5)_2$/He | 0.2 | | | | |
| | 3rd layer region | $SiH_4$ | 100 | 300 | 15 | 0.4 | 7 |
| | | $CH_4$ | 600 | | | | |
| | | $PH_3$ (against $SiH_4$) | 3000 ppm | | | | |
| | | $AlCl_3$/He | 0.1 | | | | |
| | | NO | 0.1 | | | | |
| | | $Mg(C_5H_5)_2$/He | 0.1 | | | | |

TABLE 260-continued

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| | | $SiF_4$ | 0.5 | | | | |
| | | $B_2H_6$ (against $SiH_4$) | 0.3 ppm | | | | |
| | 4th layer region | $SiH_4$ | 40 | 300 | 10 | 0.4 | 0.1 |
| | | $CH_4$ | 600 | | | | |
| | | $AlCl_3$/He | 0.5 | | | | |
| | | NO | 0.5 | | | | |
| | | $SiF_4$ | 1 | | | | |
| | | $B_2H_6$ (against $SiH_4$) | 1 ppm | | | | |
| | | $PH_3$ (against $SiH_4$) | 3 ppm | | | | |
| | | $Mg(C_5H_5)_2$/He | 0.1 | | | | |

TABLE 261

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 10→100* | 250 | 5 | 0.4 | 0.2 |
| | | $H_2$ | 5→200* | | | | |
| | | $AlCl_3$/He | | | | | |
| | | (S-side: 0.05 μm) | 200→40** | | | | |
| | | (UL-side: 0.15 μm) | 40→10** | | | | |
| | | NO | 5→10* | | | | |
| | | $PH_3$ (against $SiH_4$) | 10→100 ppm* | | | | |
| | | $SiF_4$ | 0.5 | | | | |
| | | $Mg(C_5H_5)_2$/He | 10 | | | | |
| Upper layer | 1st layer region | $SiH_4$ | 100 | 280 | 10 | 0.35 | 3 |
| | | $H_2$ | 100 | | | | |
| | | $PH_3$ (against $SiH_4$) | 800 ppm | | | | |
| | | $Mg(C_5H_5)_2$/He | 0.5 | | | | |
| | | NO | 10 | | | | |
| | | $AlCl_3$/He | 0.1 | | | | |
| | | $SiF_4$ | 0.5 | | | | |
| | | $CH_4$ | 1 | | | | |
| | 2nd layer region | $SiH_4$ | 100 | 300 | 3 | 0.5 | 3 |
| | | $SiF_4$ | 5 | | | | |
| | | $H_2$ | 200 | | | | |
| | | $PH_3$ (against $SiH_4$) | 0.3 ppm | | | | |
| | | NO | 0.5 | | | | |
| | | $CH_4$ | 1 | | | | |
| | | $AlCl_3$/He | 0.8 | | | | |
| | | $Mg(C_5H_5)_2$/He | 0.3 | | | | |
| | 3rd layer region | $SiH_4$ | 100 | 300 | 15 | 0.4 | 30 |
| | | $CH_4$ | 100 | | | | |
| | | $B_2H_6$ (against $SiH_4$) | 50 ppm | | | | |
| | | $PH_3$ (against $SiH_4$) | 0.5 ppm | | | | |
| | | $AlCl_3$/He | 0.3 | | | | |
| | | NO | 0.3 | | | | |
| | | $SiF_4$ | 0.5 | | | | |
| | | $Mg(C_5H_5)_2$/He | 0.2 | | | | |
| | 4th layer region | $SiH_4$ | 50 | 300 | 10 | 0.4 | 0.5 |
| | | $CH_4$ | 600 | | | | |
| | | $B_2H_6$ (against $SiH_4$) | 0.5 ppm | | | | |
| | | $AlCl_3$/He | 0.3 | | | | |
| | | $SiF_4$ | 0.5 | | | | |
| | | NO | 0.1 | | | | |
| | | $PH_3$ (against $SiH_4$) | 0.3 ppm | | | | |
| | | $Mg(C_5H_5)_2$/He | 0.1 | | | | |

TABLE 262

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 50 | 250 | 5 | 0.4 | 0.03 |
| | | $H_4$ | 10→200* | | | | |
| | | $AlCl_3$/He | | | | | |
| | | (S-side: 0.01 μm) | 100→10** | | | | |
| | | (UL-side: 0.01 μm) | 10 | | | | |
| | | $CH_2$ | 3→13* | | | | |
| | | $B_2H_6$ (against $SiH_4$) | 100 ppm | | | | |
| | | $Mg(C_5H_5)_2$/He | 8 | | | | |
| | | NO | 0.5 | | | | |
| Upper layer | 1st layer region | $SiH_4$ | 100 | 250 | 10 | 0.5 | 2 |
| | | $B_2H_6$(against $SiH_4$) | 1500 ppm | | | | |

TABLE 262-continued

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| | | $C_2H_2$ | 13 | | | | |
| | | $H_2$ | 300 | | | | |
| | | NO | 1 | | | | |
| | 2nd layer region | $SiH_4$ | 100 | 250 | 25 | 0.5 | 22 |
| | | $H_2$ | 300 | | | | |
| | | $C_2H_2$ | 15 | | | | |
| | | $B_2H_6$ (against $SiH_4$) | 40 ppm | | | | |
| | 3rd layer region | $SiH_4$ | 100 | 250 | 20 | 0.5 | 5 |
| | | $C_2H_2$ | 10 | | | | |
| | | $H_2$ | 150 | | | | |
| | 4th layer region | $SiH_4$ | 60 | 250 | 10 | 0.4 | 0.5 |
| | | $C_2H_2$ | 60 | | | | |
| | | $H_2$ | 50 | | | | |

TABLE 263

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 50 | 250 | 5 | 0.4 | 0.03 |
| | | $H_2$ | 10→200* | | | | |
| | | $AlCl_3$/He | | | | | |
| | | (S-side: 0.01 μm) | 100→10** | | | | |
| | | (UL-side: 0.01 μm) | 10 | | | | |
| | | $C_2H_2$ | 3→13* | | | | |
| | | $PH_3$ (against $SiH_4$) | 10→100 ppm* | | | | |
| | | $Mg(C_5H_5)_2$/He | 3 | | | | |
| | | NO | 0.5 | | | | |
| Upper layer | 1st layer region | $SiH_4$ | 100 | 250 | 10 | 0.5 | 2 |
| | | $C_2H_2$ | 13 | | | | |
| | | $PH_3$ (against $SiH_4$) | 1500 ppm | | | | |
| | | $H_2$ | 300 | | | | |
| | | NO | 1 | | | | |
| | 2nd layer region | $SiH_4$ | 100 | 250 | 25 | 0.5 | 22 |
| | | $C_2H_2$ | 15 | | | | |
| | | $H_2$ | 300 | | | | |
| | 3rd layer region | $SiH_4$ | 100 | 250 | 20 | 0.5 | 5 |
| | | $C_2H_2$ | 10 | | | | |
| | | $H_2$ | 150 | | | | |
| | 4th layer region | $SiH_4$ | 60 | 250 | 10 | 0.4 | 0.5 |
| | | $C_2H_2$ | 60 | | | | |
| | | $H_2$ | 50 | | | | |

TABLE 264

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 10→100* | 300 | 10 | 0.4 | 0.2 |
| | | $H_2$ | 5→200* | | | | |
| | | $AlCl_3$/He | | | | | |
| | | (S-side: 0.05 μm) | 200→40** | | | | |
| | | (UL-side: 0.15 μm) | 40→10** | | | | |
| | | $C_2H_2$ | 1→5* | | | | |
| | | $B_2H_6$ (against $SiH_4$) | 100 ppm | | | | |
| | | $SiF_4$ | 0.5 | | | | |
| | | NO | 0.5 | | | | |
| | | $H_2S$ (against $SiH_4$) | 50 ppm | | | | |
| | | $Mg(C_5H_5)_2$/He | 5 | | | | |
| Upper layer | 1st layer region | $SiH_4$ | 100 | 300 | 10 | 0.35 | 3 |
| | | $H_2$ | 100 | | | | |
| | | $B_2H_6$ (against $SiH_4$) | 1000 ppm | | | | |
| | | $Mg(C_5H_5)_2$/He | 0.5 | | | | |
| | | $C_2H_2$ | 5 | | | | |
| | | $AlCl_3$/He | 1 | | | | |
| | | NO | 1 | | | | |
| | | $H_2S$ (against $SiH_4$) | 10 ppm | | | | |
| | | $SiF_4$ | 0.5 | | | | |
| | 2nd layer region | $SiH_4$ | 300 | 300 | 20 | 0.5 | 20 |
| | | $H_2$ | 500 | | | | |
| | | $C_2H_2$ | 0.1 | | | | |
| | | NO | 0.1 | | | | |
| | | $B_2H_6$ (against $SiH_4$) | 0.3 ppm | | | | |
| | | $SiF_4$ | 0.5 | | | | |
| | | $AlCl_3$/He | 0.1 | | | | |

TABLE 264-continued

| Order of lamination (layer name) | Gases and their flow rates (SCCM) | | Substrate temperature (°C.) | RF discharging power (mW/cm$^3$) | Inner pressure (Torr) | Layer thickness (μm) |
|---|---|---|---|---|---|---|
| | $H_2S$ (against $SiH_4$) | 1 ppm | | | | |
| | $Mg(C_5H_5)_2$/He | 0.1 | | | | |
| 3rd layer region | $SiH_4$ | 100 | 300 | 15 | 0.4 | 7 |
| | $CH_4$ | 600 | | | | |
| | $PH_3$ (against $SiH_4$) | 3000 ppm | | | | |
| | NO | 0.4 | | | | |
| | $SiF_4$ | 0.5 | | | | |
| | $AlCl_3$/He | 0.3 | | | | |
| | $B_2H_6$ (against $SiH_4$) | 0.3 ppm | | | | |
| | $H_2S$ (against $SiH_4$) | 1 ppm | | | | |
| | $Mg(C_5H_5)_2$/He | 0.1 | | | | |
| 4th layer region | $SiH_4$ | 40 | 300 | 10 | 0.4 | 0.1 |
| | $CH_4$ | 600 | | | | |
| | NO | 0.4 | | | | |
| | $PH_3$ (against $SiH_4$) | 3 ppm | | | | |
| | $B_2H_6$ (against $SiH_4$) | 1 ppm | | | | |
| | $SiF_4$ | 1 | | | | |
| | $AlCl_3$/He | 0.5 | | | | |
| | $Mg(C_5H_5)_2$/He | 0.5 | | | | |
| | $H_2S$ (against $SiH_4$) | 10 ppm | | | | |

TABLE 265

| Order of lamination (layer name) | | Gases and their flow rates (SCCM) | | Substrate temperature (°C.) | RF discharging power (mW/cm$^3$) | Inner pressure (Torr) | Layer thickness (μm) |
|---|---|---|---|---|---|---|---|
| Lower layer | | $SiH_4$ | 50 | 250 | 1 | 0.4 | 0.02 |
| | | $H_2$ | 5→200* | | | | |
| | | $AlCl_3$/He | | | | | |
| | | (S-side: 0.01 μm) | 200→30** | | | | |
| | | (UL-side: 0.01 μm) | 30→10** | | | | |
| | | $B_2H_6$ (against $SiH_4$) | 100 ppm | | | | |
| | | $C_2H_2$ | 0.1 | | | | |
| | | NO | 5 | | | | |
| | | $SiF_4$ | 5 | | | | |
| | | $Mg(C_5H_5)_2$/He | 10 | | | | |
| Upper layer | 1st layer region | $SiH_4$ | 100 | 300 | 10 | 0.35 | 3 |
| | | $H_2$ | 150 | | | | |
| | | $B_2H_6$ (against $SiH_4$) | 800 ppm | | | | |
| | | $C_2H_2$ | 0.1 | | | | |
| | | $AlCl_3$/He | 0.1 | | | | |
| | | NO | 10 | | | | |
| | | $SiF_4$ | 0.5 | | | | |
| | | $Mg(C_5H_5)_2$/He | 0.1 | | | | |
| | 2nd layer region | $SiF_4$ | 0.1 | 300 | 20 | 0.5 | 5 |
| | | $SiH_4$ | 300 | | | | |
| | | $H_2$ | 300 | | | | |
| | | $C_2H_2$ | 0.1 | | | | |
| | | $AlCl_3$/He | 0.1 | | | | |
| | | NO | 0.1 | | | | |
| | | $B_2H_6$ (against $SiH_4$) | 0.3 ppm | | | | |
| | | $Mg(C_5H_5)_2$/He | 0.1 | | | | |
| | 3rd layer region | $SiF_4$ | 0.5 | 300 | 15 | 0.4 | 20 |
| | | $SiH_4$ | 100 | | | | |
| | | $C_2H_2$ | 15 | | | | |
| | | $AlCl_3$/He | 0.1 | | | | |
| | | NO | 0.1 | | | | |
| | | $B_2H_6$ (against $SiH_4$) | 0.3 ppm | | | | |
| | | $Mg(C_5H_5)_2$/He | 0.1 | | | | |
| | 4th layer region | $SiH_4$ | 50 | 300 | 10 | 0.4 | 0.5 |
| | | $C_2H_2$ | 30 | | | | |
| | | $AlCl_3$/He | 0.1 | | | | |
| | | $SiF_4$ | 1 | | | | |
| | | NO | 0.3 | | | | |
| | | $B_2H_6$ (against $SiH_4$) | 0.3 ppm | | | | |
| | | $Mg(C_5H_5)_2$/He | 0.1 | | | | |

TABLE 266

| Order of lamination (layer name) | Gases and their flow rates (SCCM) | | Substrate temperature (°C.) | RF discharging power (mW/cm$^3$) | Inner pressure (Torr) | Layer thickness (μm) |
|---|---|---|---|---|---|---|
| Lower layer | $SiH_4$ | 50 | 250 | 1 | 0.4 | 0.02 |
| | $H_2$ | 5→200* | | | | |
| | $AlCl_3$/He | | | | | |

TABLE 266-continued

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| | | (S-side: 0.01 μm) | 200→30** | | | | |
| | | (UL-side: 0.01 μm) | 30→10** | | | | |
| | | $B_2H_6$(against $SiH_4$) | 100 ppm | | | | |
| | | NO | 10 | | | | |
| | | $C_2H_2$ | 0.1 | | | | |
| | | $SiF_4$ | 0.5 | | | | |
| | | $Mg(C_5H_5)_2$/He | 10 | | | | |
| Upper layer | 1st layer region | $SiH_4$ | 100 | 300 | 10 | 0.35 | 3 |
| | | $H_2$ | 150 | | | | |
| | | $B_2H_6$(against $SiH_4$) | 800 ppm | | | | |
| | | $AlCl_3$/He | 0.1 | | | | |
| | | $SiF_4$ | 0.5 | | | | |
| | | NO | 10 | | | | |
| | | $C_2H_2$ | 0.1 | | | | |
| | | $Mg(C_5H_5)_2$/He | 0.3 | | | | |
| | 2nd layer region | $SiH_4$ | 300 | 300 | 20 | 0.5 | 7 |
| | | $SiF_4$ | 0.1 | | | | |
| | | $H_2$ | 300 | | | | |
| | | $B_2H_6$(against $SiH_4$) | 0.3 ppm | | | | |
| | | $C_2H_2$ | 0.1 | | | | |
| | | NO | 2 | | | | |
| | | $AlCl_3$/He | 0.1 | | | | |
| | | $Mg(C_5H_5)_2$/He | 0.3 | | | | |
| | 3rd layer region | $SiH_4$ | 100 | 300 | 15 | 0.4 | 20 |
| | | $C_2H_2$ | 15 | | | | |
| | | $B_2H_6$(against $SiH_4$) | 0.3 ppm | | | | |
| | | $AlCl_3$/He | 0.1 | | | | |
| | | NO | 0.1 | | | | |
| | | $SiF_4$ | 0.5 | | | | |
| | | $Mg(C_5H_5)_2$/He | 0.1 | | | | |
| | 4th layer region | $SiH_4$ | 50 | 300 | 10 | 0.4 | 0.5 |
| | | $C_2H_2$ | 30 | | | | |
| | | $AlCl_3$/He | 0.1 | | | | |
| | | $SiF_4$ | 1 | | | | |
| | | NO | 0.4 | | | | |
| | | $B_2H_6$(against $SiH_4$) | 0.3 ppm | | | | |
| | | $Mg(C_5H_5)_2$/He | 0.1 | | | | |

TABLE 267

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 50 | 250 | 1 | 0.4 | 0.02 |
| | | $H_2$ | 5→200* | | | | |
| | | $AlCl_3$/He | | | | | |
| | | (S-side: 0.01 μm) | 200→30** | | | | |
| | | (UL-side: 0.01 μm) | 30→10** | | | | |
| | | $C_2H_2$ | 0.1 | | | | |
| | | NO | 5 | | | | |
| | | $B_2H_6$(against $SiH_4$) | 100 ppm | | | | |
| | | $SiF_4$ | 3 | | | | |
| | | $Mg(C_5H_5)_2$/He | 8 | | | | |
| Upper layer | 1st layer region | $SiH_4$ | 100 | 300 | 10 | 0.35 | 3 |
| | | $B_2H_6$(against $SiH_4$) | 800 ppm | | | | |
| | | $AlCl_3$/He | 0.1 | | | | |
| | | $SiF_4$ | 0.5 | | | | |
| | | $C_2H_2$ | 0.1 | | | | |
| | | $H_2$ | 150 | | | | |
| | | NO | 10 | | | | |
| | | $Mg(C_5H_5)_2$/He | 0.1 | | | | |
| | 2nd layer region | $AlCl_3$/He | 0.1 | 300 | 20 | 0.5 | 3 |
| | | $SiF_4$ | 0.1 | | | | |
| | | $SiH_4$ | 300 | | | | |
| | | $H_2$ | 300 | | | | |
| | | NO | 0.1 | | | | |
| | | $C_2H_2$ | 0.5→2* | | | | |
| | | $B_2H_6$(against $SiH_4$) | 0.3 ppm | | | | |
| | | $Mg(C_5H_5)_2$/He | 0.1 | | | | |
| | 3rd layer region | $SiF_4$ | 0.5 | 300 | 15 | 0.4 | 20 |
| | | $SiH_4$ | 100 | | | | |
| | | $C_2H_2$ | 15 | | | | |
| | | $AlCl_3$/He | 0.1 | | | | |
| | | $B_2H_6$(against $SiH_4$) | 0.3 ppm | | | | |
| | | NO | 0.1 | | | | |
| | | $Mg(C_5H_5)_2$/He | 0.1 | | | | |
| | 4th | $SiH_4$ | 50 | 300 | 10 | 0.4 | 0.5 |

TABLE 267-continued

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| | layer region | $C_2H_2$ | 30 | | | | |
| | | $B_2H_6$(against $SiH_4$) | 0.5 ppm | | | | |
| | | NO | 0.2 | | | | |
| | | $AlCl_3$/He | 0.3 | | | | |
| | | $SiF_4$ | 0.3 | | | | |
| | | $Mg(C_5H_5)_2$/He | 0.1 | | | | |

TABLE 268

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 50 | 250 | 1 | 0.4 | 0.02 |
| | | $H_2$ | 5→200* | | | | |
| | | $AlCl_3$/He | | | | | |
| | | (S-side: 0.01 μm) | 200→30** | | | | |
| | | (UL-side: 0.01 μm) | 30→10** | | | | |
| | | $C_2H_2$ | 0.1 | | | | |
| | | NO | 10 | | | | |
| | | $BF_3$ (against $SiH_4$) | 10 ppm | | | | |
| | | $SiF_4$ | 0.8 | | | | |
| | | $Mg(C_5H_5)_2$/He | 1→8* | | | | |
| Upper layer | 1st layer region | $SiH_4$ | 100 | 300 | 10 | 0.35 | 3 |
| | | $C_2H_2$ | 0.1 | | | | |
| | | $BF_3$(against $SiH_4$) | 1000 ppm | | | | |
| | | $AlCl_3$/He | 0.1 | | | | |
| | | $SiF_4$ | 0.5 | | | | |
| | | $H_2$ | 150 | | | | |
| | | NO | 10 | | | | |
| | | $Mg(C_5H_5)_2$/He | 0.1 | | | | |
| | 2nd layer region | $SiH_4$ | 300 | 300 | 20 | 0.5 | 8 |
| | | $C_2H_2$ | 1 | | | | |
| | | $BF_3$(against $SiH_4$) | 10→0.3 ppm | ** | | | |
| | | $AlCl_3$/He | 0.1 | | | | |
| | | $SiF_4$ | 0.1 | | | | |
| | | $H_2$ | 300 | | | | |
| | | NO | 0.1 | | | | |
| | | $Mg(C_5H_5)_2$/He | 0.1 | | | | |
| | 3rd layer region | $SiH_4$ | 100 | 300 | 15 | 0.4 | 20 |
| | | $C_2H_2$ | 15 | | | | |
| | | $BF_3$(against $SiH_4$) | 0.3 ppm | | | | |
| | | $AlCl_3$/He | 0.1 | | | | |
| | | $SiF_4$ | 0.5 | | | | |
| | | NO | 0.1 | | | | |
| | | $Mg(C_5H_5)_2$/He | 0.1 | | | | |
| | 4th layer region | $SiH_4$ | 50 | 300 | 15 | 0.5 | 0.5 |
| | | $C_2H_2$ | 30 | | | | |
| | | $BF_3$(against $SiH_4$) | 0.3 ppm | | | | |
| | | $AlCl_3$/He | 0.4 | | | | |
| | | $SiF_4$ | 1 | | | | |
| | | NO | 0.3 | | | | |
| | | $Mg(C_5H_5)_2$/He | 0.1 | | | | |

TABLE 269

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 50 | 250 | 1 | 0.4 | 0.02 |
| | | $H_2$ | 5→200* | | | | |
| | | $AlCl_3$/He | | | | | |
| | | (S-side: 0.01 μm) | 200→30** | | | | |
| | | (UL-side: 0.01 μm) | 30→10** | | | | |
| | | $B_2H_6$(against $SiH_4$) | 100 ppm | | | | |
| | | $C_2H_2$ | 0.1 | | | | |
| | | NO | 5→10* | | | | |
| | | $SiF_4$ | 5 | | | | |
| | | $Mg(C_5H_5)_2$/He | 10 | | | | |
| Upper layer | 1st layer region | $SiH_4$ | 100 | 300 | 10 | 0.35 | 3 |
| | | $H_2$ | 150 | | | | |
| | | $B_2H_6$(against $SiH_4$) | 2000 ppm | | | | |
| | | $C_2H_2$ | 0.1 | | | | |
| | | $AlCl_3$/He | 0.1 | | | | |
| | | NO | 10 | | | | |

TABLE 269-continued

| Order of lamination (layer name) | | Gases and their flow rates (SCCM) | | Substrate temperature (°C.) | RF discharging power (mW/cm$^3$) | Inner pressure (Torr) | Layer thickness (μm) |
|---|---|---|---|---|---|---|---|
| | | $SiF_4$ | 0.5 | | | | |
| | | $Mg(C_5H_5)_2$/He | 0.1 | | | | |
| | 2nd layer region | $SiH_4$ | 300 | 300 | 20 | 0.5 | 5 |
| | | $H_2$ | 300 | | | | |
| | | $C_2H_2$ | 0.1 | | | | |
| | | NO | 0.1 | | | | |
| | | $B_2H_6$(against $SiH_4$) | 0.3 ppm | | | | |
| | | $SiF_4$ | 0.1 | | | | |
| | | $AlCl_3$/He | 0.1 | | | | |
| | | $Mg(C_5H_5)_2$/He | 0.1 | | | | |
| | 3rd layer region | $SiH_4$ | 100 | 300 | 15 | 0.4 | 20 |
| | | NO | 0.1 | | | | |
| | | $SiF_4$ | 0.5 | | | | |
| | | $C_2H_2$ | | | | | |
| | | (U · 2nd LR-side: 1 μm) | 0.1→15* | | | | |
| | | (U · 4th LR-side: 19 μm) | 15 | | | | |
| | | $AlCl_3$/He | 0.1 | | | | |
| | | $B_2H_6$(against $SiH_4$) | 0.3 ppm | | | | |
| | | $Mg(C_5H_5)_2$/He | 0.1 | | | | |
| | 4th layer region | $SiH_4$ | 50 | 300 | 10 | 0.4 | 0.5 |
| | | $C_2H_2$ | 30 | | | | |
| | | NO | 0.5 | | | | |
| | | $B_2H_6$(against $SiH_4$) | 0.5 ppm | | | | |
| | | $SiF_4$ | 1 | | | | |
| | | $AlCl_3$/He | 0.3 | | | | |
| | | $Mg(C_5H_5)_2$/He | 0.1 | | | | |

TABLE 270

| Order of lamination (layer name) | | Gases and their flow rates (SCCM) | | Substrate temperature (°C.) | RF discharging power (mW/cm$^3$) | Inner pressure (Torr) | Layer thickness (μm) |
|---|---|---|---|---|---|---|---|
| Lower layer | | $SiH_4$ | 50 | 250 | 1 | 0.4 | 0.02 |
| | | $H_2$ | 5→200* | | | | |
| | | $AlCl_3$/He | | | | | |
| | | (S-side: 0.01 μm) | 200→30** | | | | |
| | | (UL-side: 0.01 μm) | 30→10** | | | | |
| | | $C_2H_2$ | 0.1 | | | | |
| | | NO | 10 | | | | |
| | | $B_2H_6$(against $SiH_4$) | 10→100 ppm | | | | |
| | | $SiF_4$ | 1 | | | | |
| | | $Mg(C_5H_5)_2$/He | 5 | | | | |
| Upper layer | 1st layer region | $SiH_4$ | 100 | 300 | 10 | 0.35 | 3 |
| | | $H_2$ | 150 | | | | |
| | | $B_2H_6$(against $SiH_4$) | 800 ppm | | | | |
| | | $C_2H_2$ | 0.1 | | | | |
| | | $AlCl_3$/He | 0.1 | | | | |
| | | NO | 10 | | | | |
| | | $SiF_4$ | 0.5 | | | | |
| | | $Mg(C_5H_5)_2$/He | 0.2 | | | | |
| | 2nd layer region | $SiF_4$ | 0.1 | 300 | 20 | 0.5 | 2 |
| | | $SiH_4$ | 300 | | | | |
| | | $H_2$ | 300 | | | | |
| | | $C_2H_2$ | 0.1 | | | | |
| | | $AlCl_3$/He | 0.1 | | | | |
| | | NO | 0.1 | | | | |
| | | $B_2H_6$(against $SiH_4$) | 0.3 ppm | | | | |
| | | $Mg(C_5H_5)_2$/He | 0.1 | | | | |
| | 3rd layer region | $SiF_4$ | 0.5 | 300 | 15 | 0.4 | 20 |
| | | $SiH_4$ | 100 | | | | |
| | | $C_2H_2$ | 15 | | | | |
| | | (U · 2nd LR-side: 5 μm) | 0.1→13* | | | | |
| | | (U · 4th LR-side) | 13→17* | | | | |
| | | $AlCl_3$/He | 0.1 | | | | |
| | | NO | 0.1 | | | | |
| | | $B_2H_6$(against $SiH_4$) | 0.3 ppm | | | | |
| | | $Mg(C_5H_5)_2$/He | 0.1 | | | | |
| | 4th layer region | $SiH_4$ | 50 | 300 | 10 | 0.4 | 0.5 |
| | | $C_2H_2$ | 40 | | | | |
| | | $AlCl_3$/He | 0.1 | | | | |
| | | $SiF_4$ | 0.5 | | | | |
| | | NO | 0.1 | | | | |
| | | $B_2H_6$(against $SiH_4$) | 0.2 ppm | | | | |
| | | $Mg(C_5H_5)_2$/He | 0.1 | | | | |

TABLE 271

| Order of lamination (layer name) | | Gases and their flow rates (SCCM) | | | Substrate temperature (°C.) | RF discharging power (mW/cm³) | Inner pressure (Torr) | Layer thickness (μm) |
|---|---|---|---|---|---|---|---|---|
| Lower layer | | $SiH_4$ | 50 | | 250 | 1 | 0.4 | 0.02 |
| | | $H_2$ | 5→20-0* | | | | | |
| | | $AlCl_3$/He | | | | | | |
| | | (S-side: 0.01 μm) | 200→30-** | | | | | |
| | | (UL-side: 0.01 μm) | 30→10-** | | | | | |
| | | NO | 10 | | | | | |
| | | $C_2H_2$ | 0.1 | | | | | |
| | | $SiF_4$ | 3 | | | | | |
| | | $B_2H_6$(against $SiH_4$) | | | | | | |
| | | (S-side: 0.01 μm) | 10 | | | | | |
| | | (UL-side: 0.01 μm) | 10→100-** | | | | | |
| | | $Mg(C_5H_5)_2$/He | 8 | | | | | |
| Upper layer | 1st layer region | $SiH_4$ | 100 | | 300 | 10 | 0.35 | 3 |
| | | $H_2$ | 150 | | | | | |
| | | $B_2H_6$(against $SiH_4$) | 800 ppm | | | | | |
| | | $AlCl_3$/He | 0.1 | | | | | |
| | | $SiF_4$ | 0.5 | | | | | |
| | | NO | 10 | | | | | |
| | | $C_2H_2$ | 0.1 | | | | | |
| | | $Mg(C_5H_5)_2$/He | 0.1 | | | | | |
| | 2nd layer region | $SiH_4$ | 300 | 300 | 20 | 0.5 | 5 | |
| | | $SiF_4$ | 0.5 | | | | | |
| | | $H_2$ | 300 | | | | | |
| | | $B_2H_6$(against $SiH_4$) | 0.3 ppm | | | | | |
| | | $C_2H_2$ | 0.1 | | | | | |
| | | NO | 0.1 | | | | | |
| | | $AlCl_3$/He | 0.1 | | | | | |
| | | $Mg(C_5H_5)_2$/He | 0.1 | | | | | |
| | 3rd layer region | NO | 0.1 | 300 | 15 | 0.4 | 20 | |
| | | $SiF_4$ | 0.5 | | | | | |
| | | $C_2H_2$ | | | | | | |
| | | (U · 2nd LR-side: 19 μm) | 15 | | | | | |
| | | (U · 4th LR-side: 1 μm) | 15→3-0* | | | | | |
| | | $SiH_4$ | | | | | | |
| | | (U · 2nd LR-side: 19 μm) | 100 | | | | | |
| | | (U · 4th LR-side: 1 μm) | 100→50-** | | | | | |
| | | $AlCl_3$/He | 0.1 | | | | | |
| | | $B_2H_6$(against $SiH_4$) | 0.3 ppm | | | | | |
| | | $Mg(C_5H_5)_2$/He | 0.1 | | | | | |
| | 4th layer region | $SiH_4$ | 50 | 300 | 10 | 0.4 | 0.5 | |
| | | $C_2H_2$ | 25 | | | | | |
| | | $AlCl_3$/He | 0.1 | | | | | |
| | | $SiF_4$ | 0.5 | | | | | |
| | | NO | 0.1 | | | | | |
| | | $B_2H_6$(against $SiH_4$) | 0.3 ppm | | | | | |
| | | $Mg(C_5H_5)_2$/He | 0.1 | | | | | |

TABLE 272

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 50 | 250 | 1 | 0.4 | 0.02 |
| | | $H_2$ | 5→200* | | | | |
| | | $AlCl_3$/He | | | | | |
| | | (S-side: 0.01 μm) | 200→30** | | | | |
| | | (UL-side: 0.01 μm) | 30→10** | | | | |
| | | $C_2H_2$ | 5 | | | | |
| | | NO | 0.1 | | | | |
| | | $SiF_4$ | 5 | | | | |
| | | $B_2H_6$ (against $SiH_4$) | 50 ppm | | | | |
| | | $Mg(C_5H_5)_2$/He | 10 | | | | |
| Upper layer | 1st layer region | $SiH_4$ | 100 | 300 | 10 | 0.35 | 3 |
| | | $B_2H_6$ (against $SiH_4$) | 800 ppm | | | | |
| | | $AlCl_3$/He | 0.1 | | | | |
| | | $SiF_4$ | 0.5 | | | | |
| | | $C_2H_2$ | 0.1 | | | | |
| | | $H_2$ | 150 | | | | |
| | | NO | 10 | | | | |
| | | $Mg(C_5H_5)_2$/He | 0.2 | | | | |

TABLE 272-continued

| Order of lamination (layer name) | | Gases and their flow rates (SCCM) | | Substrate temperature (°C.) | RF discharging power (mW/cm$^3$) | Inner pressure (Torr) | Layer thickness (μm) |
|---|---|---|---|---|---|---|---|
| | 2nd layer region | $AlCl_3$/He | 0.1 | 300 | 20 | 0.5 | 5 |
| | | $SiF_4$ | 0.1 | | | | |
| | | $SiH_4$ | 300 | | | | |
| | | $H_2$ | 300 | | | | |
| | | NO | 0.1 | | | | |
| | | $C_2H_2$ | 0.1 | | | | |
| | | $B_2H_6$ (against $SiH_4$) | 0.3 ppm | | | | |
| | | $Mg(C_5H_5)_2$/He | 0.1 | | | | |
| | 3rd layer region | $SiF_4$ | 0.5 | 300 | 15 | 0.4 | 20 |
| | | $SiH_4$ | 100 | | | | |
| | | $C_2H_2$ | 15 | | | | |
| | | $AlCl_3$/He | 0.1 | | | | |
| | | $B_2H_6$ (against $SiH_4$) | 10 ppm | | | | |
| | | NO | 0.1 | | | | |
| | | $Mg(C_5H_5)_2$/He | 0.1 | | | | |
| | 4th layer region | $SiH_4$ | 50 | 300 | 10 | 0.4 | 0.5 |
| | | $C_2H_2$ | 30 | | | | |
| | | $B_2H_6$ (against $SiH_4$) | 0.5 ppm | | | | |
| | | NO | 0.2 | | | | |
| | | $AlCl_3$/He | 0.3 | | | | |
| | | $SiF_4$ | 0.4 | | | | |
| | | $Mg(C_5H_5)_2$/He | 0.1 | | | | |

TABLE 273

| Order of lamination (layer name) | | Gases and their flow rates (SCCM) | | Substrate temperature (°C.) | RF discharging power (mW/cm$^3$) | Inner pressure (Torr) | Layer thickness (μm) |
|---|---|---|---|---|---|---|---|
| Lower layer | | $SiH_4$ | 50 | 250 | 1 | 0.4 | 0.02 |
| | | $H_2$ | 5→200* | | | | |
| | | $AlCl_3$/He | | | | | |
| | | (S-side: 0.01 μm) | 200→30** | | | | |
| | | (UL-side: 0.01 μm) | 30→10** | | | | |
| | | $C_2H_2$ | 1→6* | | | | |
| | | $B_2H_6$ (against $SiH_4$) | 100 ppm | | | | |
| | | NO | 0.1 | | | | |
| | | $SiF_4$ | 1 | | | | |
| | | $Mg(C_5H_5)_2$/He | 5 | | | | |
| Upper layer | 1st layer region | $SiH_4$ | 100 | 300 | 10 | 0.35 | 3 |
| | | $C_2H_2$ | 0.1 | | | | |
| | | $B_2H_6$ (against $SiH_4$) | 800 ppm | | | | |
| | | $AlCl_3$/He | 0.1 | | | | |
| | | $SiF_4$ | 0.5 | | | | |
| | | $H_2$ | 150 | | | | |
| | | NO | 10 | | | | |
| | | $Mg(C_5H_5)_2$/He | 0.1 | | | | |
| | 2nd layer region | $SiH_4$ | 300 | 300 | 20 | 0.5 | 6 |
| | | $C_2H_2$ | 0.1 | | | | |
| | | $B_2H_6$ (against $SiH_4$) | 0.3 ppm | | | | |
| | | $AlCl_3$/He | 0.1 | | | | |
| | | $SiF_4$ | 0.1 | | | | |
| | | $H_2$ | 300 | | | | |
| | | NO | 0.1 | | | | |
| | | $Mg(C_5H_5)_2$/He | 0.1 | | | | |
| | 3rd layer region | $SiH_4$ | 100 | 300 | 15 | 0.4 | 20 |
| | | $C_2H_2$ | 15 | | | | |
| | | $B_2H_6$ (against $SiH_4$) | 12→0.3 ppm** | | | | |
| | | $AlCl_3$/He | 0.1 | | | | |
| | | $SiF_4$ | 0.5 | | | | |
| | | NO | 0.1 | | | | |
| | | $Mg(C_5H_5)_2$/He | 0.1 | | | | |
| | 4th layer region | $SiH_4$ | 60 | 300 | 10 | 0.4 | 0.5 |
| | | $C_2H_2$ | 30 | | | | |
| | | $B_2H_6$ (against $SiH_4$) | 0.3 ppm | | | | |
| | | $AlCl_3$/He | 1 | | | | |
| | | $SiF_4$ | 0.5 | | | | |
| | | NO | 0.3 | | | | |
| | | $Mg(C_5H_5)_2$/He | 0.1 | | | | |

TABLE 274

| Order of lamination (layer name) | Gases and their flow rates (SCCM) | | Substrate temperature (°C.) | RF discharging power (mW/cm$^3$) | Inner pressure (Torr) | Layer thickness (μm) |
|---|---|---|---|---|---|---|
| Lower layer | $SiH_4$ | 50 | 250 | 1 | 0.4 | 0.02 |
| | $H_2$ | 5→200* | | | | |

TABLE 274-continued

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| | | $AlCl_3$/He | | | | | |
| | | (S-side: 0.01 μm) | 200→30** | | | | |
| | | (UL-side: 0.01 μm) | 30→10** | | | | |
| | | $C_2H_2$ | 3 | | | | |
| | | NO | 0.1 | | | | |
| | | $B_2H_6$ (against $SiH_4$) | 100 ppm | | | | |
| | | $Si_2F_6$ | 3 | | | | |
| | | $Mg(C_5H_5)_2$/He | 10 | | | | |
| Upper layer | 1st layer region | $SiH_4$ | 100 | 300 | 10 | 0.35 | 3 |
| | | $H_2$ | 150 | | | | |
| | | $B_2H_6$ (against $SiH_4$) | 800 ppm | | | | |
| | | $C_2H_2$ | 0.1 | | | | |
| | | $AlCl_3$/He | 0.1 | | | | |
| | | NO | 10 | | | | |
| | | $Si_2F_6$ | 0.5 | | | | |
| | | $Mg(C_5H_5)_2$/He | 0.2 | | | | |
| | 2nd layer region | $SiH_4$ | 300 | 300 | 20 | 0.5 | 5 |
| | | $H_2$ | 300 | | | | |
| | | $C_2H_2$ | 0.1 | | | | |
| | | NO | 0.1 | | | | |
| | | $B_2H_6$ (against $SiH_4$) | 0.3 ppm | | | | |
| | | $Si_2F_6$ | 0.5 | | | | |
| | | $AlCl_3$/He | 0.1 | | | | |
| | | $Mg(C_5H_5)_2$/He | 0.2 | | | | |
| | 3rd layer region | $Si_2F_6$ | 0.5 | 300 | 15 | 0.4 | 20 |
| | | NO | 0.1 | | | | |
| | | $SiH_4$ | 100 | | | | |
| | | $C_2H_2$ | 15 | | | | |
| | | $PH_3$ (against $SiH_4$) | 8 ppm | | | | |
| | | $AlCl_3$/He | 0.1 | | | | |
| | | $B_2H_6$ (against $SiH_4$) | 0.1 ppm | | | | |
| | | $Mg(C_5H_5)_2$/He | 0.1 | | | | |
| | 4th layer region | $SiH_4$ | 50 | 300 | 10 | 0.4 | 0.5 |
| | | $C_2H_2$ | 30 | | | | |
| | | NO | 0.3 | | | | |
| | | $B_2H_6$ (against $SiH_4$) | 0.5 ppm | | | | |
| | | $Si_2F_6$ | 1 | | | | |
| | | $PH_3$ (against $SiH_4$) | 0.1 ppm | | | | |
| | | $AlCl_3$/He | 0.5 | | | | |
| | | $Mg(C_5H_5)_2$/He | 0.1 | | | | |

TABLE 275

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 50 | 250 | 1 | 0.4 | 0.02 |
| | | $H_2$ | 5→200* | | | | |
| | | $AlCl_3$/He | | | | | |
| | | (S-side: 0.01 μm) | 200→30** | | | | |
| | | (UL-side: 0.01 μm) | 30→10** | | | | |
| | | $C_2H_2$ | 3 | | | | |
| | | NO | 0.1 | | | | |
| | | $B_2H_6$ (against $SiH_4$) | 10→100 ppm* | | | | |
| | | $SiF_4$ | 5 | | | | |
| | | $Mg(C_5H_5)_2$/He | 8 | | | | |
| Upper layer | 1st layer region | $SiH_4$ | 100 | 300 | 10 | 0.35 | 3 |
| | | $H_2$ | 150 | | | | |
| | | $B_2H_6$ (against $SiH_4$) | 800 ppm | | | | |
| | | $C_2H_2$ | 0.1 | | | | |
| | | $AlCl_3$/He | 0.1 | | | | |
| | | NO | 10 | | | | |
| | | $SiF_4$ | 0.5 | | | | |
| | | $Mg(C_5H_5)_2$/He | 0.1 | | | | |
| | 2nd layer region | $SiF_4$ | 0.1 | 300 | 20 | 0.5 | 5 |
| | | $SiH_4$ | 300 | | | | |
| | | $H_2$ | 300 | | | | |
| | | $C_2H_2$ | 0.1 | | | | |
| | | $AlCl_3$/He | 0.1 | | | | |
| | | NO | 0.1 | | | | |
| | | $B_2H_6$ (against $SiH_4$) | 0.3 ppm | | | | |
| | | $Mg(C_5H_5)_2$/He | 0.1 | | | | |
| | 3rd layer region | $SiF_4$ | 0.5 | 300 | 15 | 0.4 | 20 |
| | | $SiH_4$ | 100 | | | | |
| | | $C_2H_2$ | 15 | | | | |
| | | $PH_3$ (against $SiH_4$) | 10→0.3 ppm** | | | | |
| | | $AlCl_3$/He | 0.1 | | | | |

TABLE 275-continued

| Order of lamination (layer name) | | Gases and their flow rates (SCCM) | | Substrate temperature (°C.) | RF discharging power (mW/cm$^3$) | Inner pressure (Torr) | Layer thickness (μm) |
|---|---|---|---|---|---|---|---|
| | | NO | 0.1 | | | | |
| | | $B_2H_6$ (against $SiH_4$) | 0.3 ppm | | | | |
| | | $Mg(C_5H_5)_2$/He | 0.1 | | | | |
| | 4th layer region | $SiH_4$ | 50 | 300 | 15 | 0.4 | 0.6 |
| | | $C_2H_2$ | 20 | | | | |
| | | $AlCl_3$/He | 0.1 | | | | |
| | | $SiF_4$ | 0.5 | | | | |
| | | NO | 0.3 | | | | |
| | | $B_2H_6$ (against $SiH_4$) | 0.4 ppm | | | | |
| | | $PH_3$ (against $SiH_4$) | 0.3 ppm | | | | |
| | | $Mg(C_5H_5)_2$/He | 0.1 | | | | |

TABLE 276

| Order of lamination (layer name) | | Gases and their flow rates (SCCM) | | Substrate temperature (°C.) | RF discharging power (mW/cm$^3$) | Inner pressure (Torr) | Layer thickness (μm) |
|---|---|---|---|---|---|---|---|
| Lower layer | | $SiH_4$ | 50 | 250 | 1 | 0.4 | 0.02 |
| | | $H_2$ | 5→200* | | | | |
| | | $AlCl_3$/He | | | | | |
| | | (S-side: 0.01 μm) | 200→30** | | | | |
| | | (UL-side: 0.01 μm) | 30→10** | | | | |
| | | $B_2H_6$ (against $SiH_4$) | 100 ppm | | | | |
| | | NO | 10 | | | | |
| | | $C_2H_2$ | 0.1 | | | | |
| | | $SiF_4$ | 5 | | | | |
| | | $H_2S$ | 1 ppm | | | | |
| | | $Mg(C_5H_5)_2$/He | 10→1** | | | | |
| Upper layer | 1st layer region | $SiH_4$ | 100 | 300 | 10 | 0.35 | 3 |
| | | $H_2$ | 150 | | | | |
| | | $B_2H_6$ (against $SiH_4$) | 800 ppm | | | | |
| | | $AlCl_3$/He | 0.1 | | | | |
| | | $SiF_4$ | 0.5 | | | | |
| | | NO | 10 | | | | |
| | | $C_2H_2$ | 0.1 | | | | |
| | | $H_2S$ (against $SiH_4$) | 1 ppm | | | | |
| | | $Mg(C_5H_5)_2$/He | 0.2 | | | | |
| | 2nd layer region | $SiH_4$ | 300 | 300 | 20 | 0.5 | 5 |
| | | $SiF_4$ | 0.1 | | | | |
| | | $H_2$ | 300 | | | | |
| | | $B_2H_6$ (against $SiH_4$) | 0.3 ppm | | | | |
| | | $C_2H_2$ | 0.1 | | | | |
| | | NO | 0.1 | | | | |
| | | $AlCl_3$/He | 0.1 | | | | |
| | | $H_2S$ (against $SiH_4$) | 1 ppm | | | | |
| | | $Mg(C_5H_5)_2$/He | 0.2 | | | | |
| | 3rd layer region | $GeH_4$ | 1 | 300 | 15 | 0.4 | 20 |
| | | NO | 0.1 | | | | |
| | | $SiF_4$ | 0.5 | | | | |
| | | $C_2H_2$ | 15 | | | | |
| | | $SiH_4$ | 100 | | | | |
| | | $AlCl_3$/He | 0.1 | | | | |
| | | $B_2H_6$ (against $SiH_4$) | 0.3 ppm | | | | |
| | | $H_2S$ (against $SiH_4$) | 1 ppm | | | | |
| | | $Mg(C_5H_5)_2$/He | 0.1 | | | | |
| | 4th layer region | $SiH_4$ | 50 | 300 | 15 | 0.5 | 0.6 |
| | | $C_2H_2$ | 20 | | | | |
| | | $AlCl_3$/He | 0.2 | | | | |
| | | $SiF_4$ | 0.8 | | | | |
| | | NO | 0.4 | | | | |
| | | $B_2H_6$ (against $SiH_4$) | 0.3 ppm | | | | |
| | | $H_2S$ (against $SiH_4$) | 1 ppm | | | | |
| | | $Mg(C_5H_5)_2$/He | 0.1 | | | | |

TABLE 277

| Order of lamination (layer name) | Gases and their flow rates (SCCM) | | Substrate temperature (°C.) | RF discharging power (mW/cm$^3$) | Inner pressure (Torr) | Layer thickness (μm) |
|---|---|---|---|---|---|---|
| Lower layer | $SiH_4$ | 50 | 250 | 1 | 0.4 | 0.02 |
| | $H_2$ | 5→200* | | | | |
| | $AlCl_3$/He | | | | | |
| | (S-side: 0.01 μm) | 200→30** | | | | |
| | (UL-side: 0.01 μm) | 30→10** | | | | |
| | $B_2H_6$ (against $SiH_4$) | 100 ppm | | | | |

TABLE 277-continued

| Order of lamination (layer name) | | Gases and their flow rates (SCCM) | | Substrate temperature (°C.) | RF discharging power (mW/cm$^3$) | Inner pressure (Torr) | Layer thickness (μm) |
|---|---|---|---|---|---|---|---|
| | | $C_2H_2$ | 0.1 | | | | |
| | | NO | 5 | | | | |
| | | $SiF_4$ | 0.5 | | | | |
| | | $Mg(C_5H_5)_2$/He | 10 | | | | |
| Upper layer | 1st layer region | $SiH_4$ | 100 | 300 | 10 | 0.35 | 3 |
| | | $B_2H_6$ (against $SiH_4$) | 800 ppm | | | | |
| | | $AlCl_3$/He | 0.1 | | | | |
| | | $SiF_4$ | 0.5 | | | | |
| | | $C_2H_2$ | 0.1 | | | | |
| | | $H_2$ | 150 | | | | |
| | | NO | 10 | | | | |
| | | $Mg(C_5H_5)_2$/He | 0.1 | | | | |
| | 2nd layer region | $AlCl_3$/He | 0.1 | 300 | 20 | 0.5 | 5 |
| | | $SiF_4$ | 0.1 | | | | |
| | | $SiH_4$ | 300 | | | | |
| | | $H_2$ | 300 | | | | |
| | | NO | 0.1 | | | | |
| | | $C_2H_2$ | 0.1 | | | | |
| | | $B_2H_6$ (against $SiH_4$) | 0.3 ppm | | | | |
| | | $Mg(C_5H_5)_2$/He | 0.1 | | | | |
| | 3rd layer region | $SiF_4$ | 0.5 | 300 | 15 | 0.4 | 10 |
| | | $SiH_4$ | 100 | | | | |
| | | $C_2H_2$ | 15 | | | | |
| | | $AlCl_3$/He | 0.1 | | | | |
| | | $B_2H_6$ (against $SiH_4$) | 0.3 ppm | | | | |
| | | NO | 0.1 | | | | |
| | | $Mg(C_5H_5)_2$/He | 0.1 | | | | |
| | 4th layer region | $SiH_4$ | 60 | 300 | 15 | 0.5 | 0.5 |
| | | $C_2H_2$ | 40 | | | | |
| | | $B_2H_6$ (against $SiH_4$) | 0.4 ppm | | | | |
| | | NO | 0.3 | | | | |
| | | $AlCl_3$/He | 0.2 | | | | |
| | | $SiF_4$ | 0.6 | | | | |
| | | $Mg(C_5H_5)_2$/He | 0.1 | | | | |

TABLE 278

| Order of lamination (layer name) | | Gases and their flow rates (SCCM) | | Substrate temperature (°C.) | RF discharging power (mW/cm$^3$) | Inner pressure (Torr) | Layer thickness (μm) |
|---|---|---|---|---|---|---|---|
| Lower layer | | $SiH_4$ | 50 | 250 | 1 | 0.4 | 0.02 |
| | | $H_2$ | 5→200* | | | | |
| | | $AlCl_3$/He | | | | | |
| | | (S-side: 0.01 μm) | 200→30** | | | | |
| | | (UL-side: 0.01 μm) | 30→10** | | | | |
| | | $C_2H_2$ | 0.1 | | | | |
| | | NO | 10 | | | | |
| | | $B_2H_6$ (against $SiH_4$) | 150 ppm | | | | |
| | | $SiF_4$ | 5 | | | | |
| | | $Mg(C_5H_5)_2$/He | 5 | | | | |
| Upper layer | 1st layer region | $SiH_4$ | 100 | 300 | 10 | 0.35 | 3 |
| | | $C_2H_2$ | 0.1 | | | | |
| | | $B_2H_6$ (against $SiH_4$) | 800 ppm | | | | |
| | | $AlCl_3$/He | 0.1 | | | | |
| | | $SiF_4$ | 0.5 | | | | |
| | | $H_2$ | 150 | | | | |
| | | NO | 10 | | | | |
| | | $Mg(C_5H_5)_2$/He | 0.1 | | | | |
| | 2nd layer region | $SiH_4$ | 300 | 300 | 20 | 0.5 | 5 |
| | | $C_2H_2$ | 0.1 | | | | |
| | | $B_2H_6$ (against $SiH_4$) | 0.3 ppm | | | | |
| | | $AlCl_3$/He | 0.1 | | | | |
| | | $SiF_4$ | 0.1 | | | | |
| | | $H_2$ | 300 | | | | |
| | | NO | 0.1 | | | | |
| | | $Mg(C_5H_5)_2$/He | 0.1 | | | | |
| | 3rd layer region | $SiH_4$ | 100 | 300 | 15 | 0.4 | 30 |
| | | $C_2H_2$ | 15 | | | | |
| | | $B_2H_6$ (against $SiH_4$) | 0.3 ppm | | | | |
| | | $AlCl_3$/He | 0.1 | | | | |
| | | $SiF_4$ | 0.5 | | | | |
| | | NO | 0.1 | | | | |
| | | $Mg(C_5H_5)_2$/He | 0.1 | | | | |
| | 4th layer region | $SiH_4$ | 60 | 300 | 15 | 0.5 | 0.5 |
| | | $C_2H_2$ | 40 | | | | |
| | | $B_2H_6$ (against $SiH_4$) | 0.5 ppm | | | | |
| | | $AlCl_3$/He | 0.2 | | | | |

TABLE 278-continued

| Order of lamination (layer name) | Gases and their flow rates (SCCM) | | Substrate temperature (°C.) | RF discharging power (mW/cm³) | Inner pressure (Torr) | Layer thickness (μm) |
|---|---|---|---|---|---|---|
| | $SiF_4$ | 0.5 | | | | |
| | NO | 0.2 | | | | |
| | $Mg(C_5H_5)_2/He$ | 0.1 | | | | |

TABLE 279

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 50 | 250 | 1 | 0.4 | 0.02 |
| | | $H_2$ | 5→200* | | | | |
| | | $AlCl_3/He$ | | | | | |
| | | (S-side: 0.01 μm) | 200→30** | | | | |
| | | (UL-side: 0.01 μm) | 30→10** | | | | |
| | | $C_2H_2$ | 2 | | | | |
| | | NO | 5 | | | | |
| | | $B_2H_6$ (against $SiH_4$) | 30 ppm | | | | |
| | | $SiF_4$ | 0.5 | | | | |
| | | $Mg(C_5H_5)_2/He$ | 10 | | | | |
| Upper layer | 1st layer region | $SiH_4$ | 100 | 300 | 10 | 0.35 | 3 |
| | | $H_2$ | 150 | | | | |
| | | $B_2H_6$ (against $SiH_4$) | 800 ppm | | | | |
| | | $C_2H_2$ | 0.1 | | | | |
| | | $AlCl_3/He$ | 0.1 | | | | |
| | | NO | 10 | | | | |
| | | $SiF_4$ | 0.5 | | | | |
| | | $Mg(C_5H_5)_2/He$ | 0.2 | | | | |
| | 2nd layer region | $SiH_4$ | 300 | 300 | 20 | 0.5 | 5 |
| | | $H_2$ | 300 | | | | |
| | | $C_2H_2$ | 0.1 | | | | |
| | | NO | 0.1 | | | | |
| | | $B_2H_6$ (against $SiH_4$) | 0.3 ppm | | | | |
| | | $SiF_4$ | 0.1 | | | | |
| | | $AlCl_3/He$ | 0.1 | | | | |
| | | $Mg(C_5H_5)_2/He$ | 0.2 | | | | |
| | 3rd layer region | $SiF_4$ | 0.5 | 300 | 15 | 0.4 | 20 |
| | | NO | 0.1 | | | | |
| | | $SiH_4$ | 100 | | | | |
| | | $C_2H_2$ | 0.1 | | | | |
| | | $NH_3$ | 100 | | | | |
| | | $AlCl_3/He$ | 0.1 | | | | |
| | | $B_2H_6$ (against $SiH_4$) | 0.3 ppm | | | | |
| | | $Mg(C_5H_5)_2/He$ | 0.1 | | | | |
| | 4th layer region | $SiH_4$ | 55 | 300 | 15 | 0.5 | 0.5 |
| | | $C_2H_2$ | 30 | | | | |
| | | NO | 0.2 | | | | |
| | | $B_2H_6$ (against $SiH_4$) | 0.4 ppm | | | | |
| | | $SiF_4$ | 1 | | | | |
| | | $AlCl_3/He$ | 0.1 | | | | |
| | | $Mg(C_5H_5)_2/He$ | 0.1 | | | | |

TABLE 280

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 50 | 250 | 1 | 0.4 | 0.02 |
| | | $H_2$ | 5→200* | | | | |
| | | $AlCl_3/He$ | | | | | |
| | | (S-side: 0.01 μm) | 200→30** | | | | |
| | | (UL-side: 0.01 μm) | 30→10** | | | | |
| | | $C_2H_2$ | 1→3* | | | | |
| | | NO | 3 | | | | |
| | | $B_2H_6$ (against $SiH_4$) | 100 ppm | | | | |
| | | $SiF_4$ | 0.5 | | | | |
| | | $Mg(C_5H_5)_2/He$ | 15 | | | | |
| Upper layer | 1st layer region | $SiH_4$ | 100 | 300 | 10 | 0.35 | 3 |
| | | $H_2$ | 150 | | | | |
| | | $B_2H_6$ (against $SiH_4$) | 800 ppm | | | | |
| | | $AlCl_3/He$ | 0.1 | | | | |
| | | $SiF_4$ | 0.5 | | | | |
| | | NO | 10 | | | | |
| | | $C_2H_2$ | 0.1 | | | | |
| | | $Mg(C_5H_5)_2/He$ | 0.3 | | | | |
| | 2nd | $SiF_4$ | 0.1 | 300 | 20 | 0.5 | 10 |

TABLE 280-continued

| Order of lamination (layer name) | | Gases and their flow rates (SCCM) | | Substrate temperature (°C.) | RF discharging power (mW/cm$^3$) | Inner pressure (Torr) | Layer thickness (μm) |
|---|---|---|---|---|---|---|---|
| | layer region | $SiH_4$ | 300 | | | | |
| | | $H_2$ | 300 | | | | |
| | | $C_2H_2$ | 0.1 | | | | |
| | | $AlCl_3$/He | 0.1 | | | | |
| | | NO | 0.1 | | | | |
| | | $B_2H_6$ (against $SiH_4$) | 0.3 ppm | | | | |
| | | $Mg(C_5H_5)_2$/He | 0.2 | | | | |
| | 3rd layer region | $SiF_4$ | 0.5 | 300 | 15 | 0.4 | 20 |
| | | $SiH_4$ | 100 | | | | |
| | | $C_2H_2$ | 0.4 | | | | |
| | | $AlCl_3$/He | 0.1 | | | | |
| | | NO | 0.1 | | | | |
| | | $B_2H_6$ (against $SiH_4$) | 0.3 ppm | | | | |
| | | $N_2$ | 500 | | | | |
| | | $Mg(C_5H_5)_2$/He | 0.1 | | | | |
| | 4th layer region | $SiH_4$ | 50 | 300 | 10 | 0.4 | 0.5 |
| | | $C_2H_2$ | 25 | | | | |
| | | $AlCl_3$/He | 0.1 | | | | |
| | | $SiF_4$ | 0.3 | | | | |
| | | NO | 0.2 | | | | |
| | | $B_2H_6$ (against $SiH_4$) | 0.3 ppm | | | | |
| | | $Mg(C_5H_5)_2$/He | 0.1 | | | | |

TABLE 281

| Order of lamination (layer name) | | Gases and their flow rates (SCCM) | | Substrate temperature (°C.) | RF discharging power (mW/cm$^3$) | Inner pressure (Torr) | Layer thickness (μm) |
|---|---|---|---|---|---|---|---|
| Lower layer | | $SiH_4$ | 50 | 250 | 1 | 0.4 | 0.02 |
| | | $H_2$ | 5→200* | | | | |
| | | $AlCl_3$/He | | | | | |
| | | (S-side: 0.01 μm) | 200→30** | | | | |
| | | (UL-side: 0.01 μm) | 30→10** | | | | |
| | | $C_2H_2$ | 2 | | | | |
| | | NO | 5→8* | | | | |
| | | $B_2H_6$ (against $SiH_4$) | 10→100 ppm* | | | | |
| | | $SiF_4$ | 0.5 | | | | |
| | | $Mg(C_5H_5)_2$/He | 5 | | | | |
| Upper layer | 1st layer region | $SiH_4$ | 100 | 300 | 10 | 0.35 | 3 |
| | | $H_2$ | 150 | | | | |
| | | $B_2H_6$ (against $SiH_4$) | 800 ppm | | | | |
| | | $AlCl_3$/He | 0.1 | | | | |
| | | NO | 10 | | | | |
| | | $SiF_4$ | 0.5 | | | | |
| | | $C_2H_2$ | 0.1 | | | | |
| | | $Mg(C_5H_5)_2$/He | 0.1 | | | | |
| | 2nd layer region | $AlCl_3$/He | 0.1 | 300 | 15 | 0.4 | 20 |
| | | $SiF_4$ | 5 | | | | |
| | | $SiH_4$ | 100 | | | | |
| | | $C_2H_2$ | 15 | | | | |
| | | $B_2H_6$ (against $SiH_4$) | 0.3 ppm | | | | |
| | | NO | 0.1 | | | | |
| | | $Mg(C_5H_5)_2$/He | 0.1 | | | | |
| | 3rd layer region | $AlCl_3$/He | 0.1 | 300 | 20 | 0.5 | 5 |
| | | $SiF_4$ | 0.5 | | | | |
| | | $SiH_4$ | 300 | | | | |
| | | $H_2$ | 300 | | | | |
| | | NO | 0.1 | | | | |
| | | $C_2H_2$ | 0.1 | | | | |
| | | $B_2H_6$ (against $SiH_4$) | 0.3 ppm | | | | |
| | | $Mg(C_5H_5)_2$/He | 0.1 | | | | |
| | 4th layer region | $SiH_4$ | 60 | 300 | 10 | 0.5 | 0.5 |
| | | $C_2H_2$ | 20 | | | | |
| | | $B_2H_6$ (against $SiH_4$) | 0.4 ppm | | | | |
| | | $AlCl_3$/He | 0.2 | | | | |
| | | $SiF_4$ | 1 | | | | |
| | | $Mg(C_5H_5)_2$/He | 0.1 | | | | |
| | | NO | 0.3 | | | | |

TABLE 282

| Order of lamination (layer name) | | Gases and their flow rates (SCCM) | | Substrate temperature (°C.) | RF discharging power (mW/cm$^3$) | Inner pressure (Torr) | Layer thickness (μm) |
|---|---|---|---|---|---|---|---|
| Lower layer | | $SiH_4$ | 50 | 250 | 1 | 0.4 | 0.02 |
| | | $H_2$ | 5→200* | | | | |

TABLE 282-continued

| Order of lamination (layer name) | | Gases and their flow rates (SCCM) | | Substrate temperature (°C.) | RF discharging power (mW/cm$^3$) | Inner pressure (Torr) | Layer thickness (μm) |
|---|---|---|---|---|---|---|---|
| | | $AlCl_3$/He | | | | | |
| | | (S-side: 0.01 μm) | 200→30** | | | | |
| | | (UL-side: 0.01 μm) | 30→10** | | | | |
| | | $C_2H_2$ | 2 | | | | |
| | | NO | 5→8* | | | | |
| | | $B_2H_6$ (against $SiH_4$) | | | | | |
| | | (S-side: 0.01 μm) | 50 ppm | | | | |
| | | (UL-side: 0.01 μm) | 50→100 ppm* | | | | |
| | | $SiF_4$ | 0.5 | | | | |
| | | $Mg(C_5H_5)_2$/He | 5 | | | | |
| Upper layer | 1st layer region | $SiH_4$ | 100 | 300 | 10 | 0.35 | 3 |
| | | $H_2$ | 150 | | | | |
| | | $B_2H_6$ (against $SiH_4$) | 800 ppm | | | | |
| | | $C_2H_2$ | 0.1 | | | | |
| | | $AlCl_3$/He | 0.1 | | | | |
| | | NO | 10 | | | | |
| | | $SiF_4$ | 0.5 | | | | |
| | | $Mg(C_5H_5)_2$/He | 0.1 | | | | |
| | 2nd layer region | $SiF_4$ | 0.5 | 300 | 15 | 0.4 | 20 |
| | | $SiH_4$ | 100 | | | | |
| | | $C_2H_2$ | 15 | | | | |
| | | $AlCl_3$/He | 0.1 | | | | |
| | | NO | 0.1 | | | | |
| | | $B_2H_6$ (against $SiH_4$) | 10 ppm | | | | |
| | | $Mg(C_5H_5)_2$/He | 0.1 | | | | |
| | 3rd layer region | $SiF_4$ | 0.5 | 300 | 20 | 0.5 | 4 |
| | | $SiH_4$ | 300 | | | | |
| | | $H_2$ | 300 | | | | |
| | | $C_2H_2$ | 0.1 | | | | |
| | | $AlCl_3$/He | 0.1 | | | | |
| | | NO | 0.1 | | | | |
| | | $B_2H_6$ (against $SiH_4$) | 0.3 ppm | | | | |
| | | $Mg(C_5H_5)_2$/He | 0.1 | | | | |
| | 4th layer region | $SiH_4$ | 60 | 300 | 15 | 0.5 | 0.5 |
| | | $C_2H_2$ | 30 | | | | |
| | | $AlCl_3$/He | 0.5 | | | | |
| | | $SiF_4$ | 0.5 | | | | |
| | | NO | 0.2 | | | | |
| | | $B_2H_6$ (against $SiH_4$) | 0.4 ppm | | | | |
| | | $Mg(C_5H_5)_2$/He | 0.1 | | | | |

TABLE 283

| Order of lamination (layer name) | | Gases and their flow rates (SCCM) | | Substrate temperature (°C.) | RF discharging power (mW/cm$^3$) | Inner pressure (Torr) | Layer thickness (μm) |
|---|---|---|---|---|---|---|---|
| Lower layer | | $SiH_4$ | 50 | 250 | 1 | 0.4 | 0.02 |
| | | $H_2$ | 5→200* | | | | |
| | | $AlCl_3$/He | | | | | |
| | | (S-side: 0.01 μm) | 200→30** | | | | |
| | | (UL-side: 0.01 μm) | 30→10** | | | | |
| | | $PH_3$ (against $SiH_4$) | 50 ppm | | | | |
| | | NO | 5 | | | | |
| | | $C_2H_2$ | 0.1 | | | | |
| | | $SiF_4$ | 0.5 | | | | |
| | | $Mg(C_5H_5)_2$/He | 20 | | | | |
| Upper layer | 1st layer region | $SiH_4$ | 100 | 300 | 10 | 0.35 | 3 |
| | | $H_2$ | 150 | | | | |
| | | $PH_3$ (against $SiH_4$) | 800 ppm | | | | |
| | | $AlCl_3$/He | 0.1 | | | | |
| | | $SiF_4$ | 0.5 | | | | |
| | | NO | 5 | | | | |
| | | $C_2H_2$ | 0.1 | | | | |
| | | $Mg(C_5H_5)_2$/He | 0.3 | | | | |
| | 2nd layer region | $SiH_4$ | 100 | 300 | 15 | 0.4 | 20 |
| | | $SiF_4$ | 0.5 | | | | |
| | | $C_2H_2$ | 15 | | | | |
| | | $PH_3$ (against $SiH_4$) | 8 ppm | | | | |
| | | NO | 0.1 | | | | |
| | | $AlCl_3$/He | 0.1 | | | | |
| | | $Mg(C_5H_5)_2$/He | 0.2 | | | | |
| | 3rd layer region | $SiH_4$ | 300 | 300 | 20 | 0.5 | 6 |
| | | $SiF_4$ | 0.5 | | | | |
| | | $H_2$ | 300 | | | | |
| | | NO | 0.1 | | | | |
| | | $PH_3$ (against $SiH_4$) | 0.1 ppm | | | | |
| | | $AlCl_3$/He | 0.1 | | | | |

TABLE 283-continued

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| | | $C_2H_2$ | 0.1 | | | | |
| | | $Mg(C_5H_5)_2$/He | 0.1 | | | | |
| | 4th layer region | $SiH_4$ | 50 | 300 | 10 | 0.5 | 0.6 |
| | | $C_2H_2$ | 20 | | | | |
| | | $AlCl_3$/He | 0.2 | | | | |
| | | $SiF_4$ | 0.5 | | | | |
| | | NO | 0.2 | | | | |
| | | $B_2H_6$ (against $SiH_4$) | 0.3 ppm | | | | |
| | | $Mg(C_5H_5)_2$/He | 0.1 | | | | |
| | | $PH_3$ (against $SiH_4$) | 0.1 ppm | | | | |

TABLE 284

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 50 | 250 | 1 | 0.4 | 0.02 |
| | | $H_2$ | 5→200* | | | | |
| | | $AlCl_3$/He | | | | | |
| | | (S-side: 0.01 μm) | 200→30** | | | | |
| | | (UL-side: 0.01 μm) | 30→10** | | | | |
| | | $B_2H_6$ (against $SiH_4$) | 100 ppm | | | | |
| | | $C_2H_2$ | 10 | | | | |
| | | NO | 0.1 | | | | |
| | | $SiF_4$ | 0.5 | | | | |
| | | $Mg(C_5H_5)_2$/He | 15 | | | | |
| Upper layer | 1st layer region | $SiH_4$ | 100 | 300 | 10 | 0.35 | 3 |
| | | $B_2H_6$ (against $SiH_4$) | 800 ppm | | | | |
| | | $AlCl_3$/He | 0.1 | | | | |
| | | $SiF_4$ | 0.5 | | | | |
| | | $C_2H_2$ | 0.1 | | | | |
| | | $H_2$ | 150 | | | | |
| | | NO | 10 | | | | |
| | | $Mg(C_5H_5)_2$/He | 0.2 | | | | |
| | 2nd layer region | $AlCl_3$/He | 0.1 | 300 | 15 | 0.4 | 20 |
| | | $SiF_4$ | 0.5 | | | | |
| | | $SiH_4$ | 100 | | | | |
| | | NO | 0.1 | | | | |
| | | $C_2H_2$ | 15 | | | | |
| | | $B_2H_6$ (against $SiH_4$) | 12→0.3 ppm** | | | | |
| | | $Mg(C_5H_5)_2$/He | 0.2 | | | | |
| | 3rd layer region | $SiF_4$ | 0.5 | 300 | 20 | 0.5 | 3 |
| | | $SiH_4$ | 300 | | | | |
| | | $H_2$ | 300 | | | | |
| | | $C_2H_2$ | 0.1 | | | | |
| | | $AlCl_3$/He | 0.1 | | | | |
| | | $B_2H_6$ (against $SiH_4$) | 0.3 ppm | | | | |
| | | NO | 0.1 | | | | |
| | | $Mg(C_5H_5)_2$/He | 0.1 | | | | |
| | 4th layer region | $SiH_4$ | 50 | 300 | 15 | 0.4 | 0.5 |
| | | $C_2H_2$ | 30 | | | | |
| | | $B_2H_6$ (against $SiH_4$) | 0.2 ppm | | | | |
| | | NO | 0.3 | | | | |
| | | $AlCl_3$/He | 0.1 | | | | |
| | | $SiF_4$ | 0.4 | | | | |
| | | $Mg(C_5H_5)_2$/He | 0.1 | | | | |

TABLE 285

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 50 | 250 | 1 | 0.01 | 0.05 |
| | | $H_2$ | 5→100 * | | | | |
| | | Ar | 200 | | | | |
| Upper layer | 1st layer region | $SiH_4$ | 100 | 250 | 10 | 0.35 | 3 |
| | | He | 600 | | | | |
| | | $B_2H_6$(against $SiH_4$) | 800 ppm | | | | |
| | | NO | 10 | | | | |
| | 2nd layer region | $SiH_4$ | 300 | 250 | 25 | 0.6 | 25 |
| | | He | 100 | | | | |
| | | $B_2H_6$(against $SiH_4$) | 0.3 ppm | | | | |
| | 3rd layer | $SiH_4$ | 50 | 250 | 10 | 0.4 | 1 |
| | | $CH_4$ | 500 | | | | |

TABLE 285-continued

| Order of lamination (layer name) | Gases and their flow rates (SCCM) | Substrate temperature (°C.) | RF discharging power (mW/cm$^3$) | Inner pressure (Torr) | Layer thickness (μm) |
|---|---|---|---|---|---|
| region | | | | | |

TABLE 286

| Order of lamination (layer name) | | Gasses and their flow rates (SCCM) | | Substrate temperature (°C.) | RF discharging power (mW/cm$^3$) | Inner pressure (Torr) | Layer thickness (μm) |
|---|---|---|---|---|---|---|---|
| Lower layer | | $SiH_4$ | 50 | 250 | 5 | 0.4 | 0.05 |
| | | $H_2$ | 10→200 * | | | | |
| | | $AlCl_3$/He | 120→40 ** | | | | |
| | | $Cu(C_4H_7N_2O_2)_2$/He | 5 | | | | |
| Upper layer | 1st layer region | $SiH_4$ | 100 | 250 | 10 | 0.4 | 3 |
| | | $B_2H_6$(against $SiH_4$) | 800 ppm | | | | |
| | | $H_2$ | 100 | | | | |
| | | NO | | | | | |
| | | (LL-side: 2 μm) | 10 | | | | |
| | | (U · 2nd LR-side: 1 μm) | | | | | |
| | | | 10→0 ** | | | | |
| | 2nd layer region | $SiH_4$ | 300 | 250 | 15 | 0.5 | 20 |
| | | $H_2$ | 300 | | | | |
| | 3rd layer region | $SiH_4$ | 50 | 250 | 10 | 0.4 | 0.5 |
| | | $CH_4$ | 500 | | | | |

TABLE 287

| Order of lamination (layer name) | | Gases and their flow rates (SCCM) | | Substrate temperature (°C.) | RF discharging power (mW/cm$^3$) | Inner pressure (Torr) | Layer thickness (μm) |
|---|---|---|---|---|---|---|---|
| Lower layer | | $SiH_4$ | 50 | 250 | 5 | 0.4 | 0.05 |
| | | $AlCl_3$/He | 120→40 ** | | | | |
| Upper layer | 1st layer region | $SiH_4$ | 100 | 250 | 10 | 0.4 | 3 |
| | | $B_2H_6$(against $SiH_4$) | 800 ppm | | | | |
| | | NO | | | | | |
| | | (LL-side: 2 μm) | 10 | | | | |
| | | (U · 2nd LR-side: 1 μm) | | | | | |
| | | | 10→0 ** | | | | |
| | | $H_2$ | 100 | | | | |
| | 2nd layer region | $SiH_4$ | 300 | 250 | 15 | 0.5 | 20 |
| | | $H_2$ | 500 | | | | |
| | 3rd layer region | $SiH_4$ | 50 | 250 | 10 | 0.4 | 0.5 |
| | | $CH_4$ | 500 | | | | |

TABLE 288

| Order of lamination (layer name) | | Gases and their flow rates (SCCM) | | Substrate temperature (°C.) | RF discharging power (mW/cm$^3$) | Inner pressure (Torr) | Layer thickness (μm) |
|---|---|---|---|---|---|---|---|
| Lower layer | | $SiH_4$ | 50 | 250 | 5 | 0.4 | 0.03 |
| | | $H_2$ | 10→200 * | | | | |
| | | $AlCl_3$/He | 120→40 ** | | | | |
| | | (S-side: 0.01 μm) | | | | | |
| | | | 100→10 ** | | | | |
| | | (UL-side: 0.02 μm) | 10 | | | | |
| | | $Cu(C_4H_7N_2O_2)_2$/He | 10 | | | | |
| | | $B_2H_6$(against $SiH_4$) | 100 ppm | | | | |
| | | NO | 5 | | | | |
| Upper layer | 1st layer region | $SiH_4$ | 100 | 250 | 10 | 0.4 | 3 |
| | | $B_2H_6$(against $SiH_4$) | 800 ppm | | | | |
| | | NO | | | | | |
| | | (LL-side: 2 μm) | 10 | | | | |
| | | (U · 2nd LR-side: 1 μm) | | | | | |
| | | | 10→0 ** | | | | |
| | | $H_2$ | 100 | | | | |
| | 2nd layer region | $SiH_4$ | 300 | 250 | 15 | 0.5 | 20 |
| | | $H_2$ | 300 | | | | |
| | 3rd layer region | $SiH_4$ | 50 | 250 | 10 | 0.4 | 0.5 |
| | | $CH_4$ | 500 | | | | |

TABLE 289

| Order of lamination (layer name) | | Gases and their flow rates (SCCM) | | Substrate temperature (°C.) | RF discharging power (mW/cm$^3$) | Inner pressure (Torr) | Layer thickness (μm) |
|---|---|---|---|---|---|---|---|
| Lower layer | | $SiH_4$ | 50 | 150 | 0.5 | 0.3 | 0.02 |
| | | $H_2$ | 5→200 * | ↓ | ↓ | | |
| | | $AlCl_3$/He | | 300 | 1.5 | | |
| | | (S-side: 0.01 μm) | | | | | |
| | | | 200→30 ** | | | | |
| | | (UL-side: 0.01 μm) | | | | | |
| | | | 30→10 ** | | | | |
| | | $GeH_4$ | 5 | | | | |
| | | $Cu(C_4H_7N_2O_2)_2$/He | 5→3 ** | | | | |
| | | $Mg(C_5H_5)_2$/He | 2 | | | | |
| Upper layer | 1st layer region | $SiH_4$ | 100 | 250 | 10 | 0.4 | 3 |
| | | $H_2$ | 100 | | | | |
| | | NO | 10 | | | | |
| | 2nd layer region | $SiH_4$ | 300 | 250 | 20 | 0.5 | 20 |
| | | $H_2$ | 500 | | | | |

TABLE 290

| Order of lamination (layer name) | | Gases and their flow rates (SCCM) | | Substrate temperature (°C.) | RF discharging power (mW/cm$^3$) | Inner pressure (Torr) | Layer thickness (μm) |
|---|---|---|---|---|---|---|---|
| Lower layer | | $SiH_4$ | 50 | 250 | 1 | 0.3 | 0.02 |
| | | $H_2$ | 5→200 * | | | | |
| | | $AlCl_3$/He | | | | | |
| | | (S-side: 0.01 μm) | | | | | |
| | | | 200→30 ** | | | | |
| | | (UL-side: 0.01 μm) | | | | | |
| | | | 30→10 ** | | | | |
| | | $B_2H_6$(against $SiH_4$) | 100 ppm | | | | |
| | | $Cu(C_4H_7N_2O_2)_2$/He | 6 | | | | |
| | | $SiF_4$ | 3 | | | | |
| | | $Mg(C_5H_5)_2$/He | 5 | | | | |
| | | NO | 8 | | | | |
| | | $CH_4$ | 1 | | | | |
| Upper layer | 1st layer region | $SiH_4$ | 100 | 250 | 10 | 0.3 | 0.02 |
| | | He | 300 | | | | |
| | | $CH_4$ | 1 | | | | |
| | | NO | 5 | | | | |
| | | $B_2H_6$(against $SiH_4$) | 1500 ppm | | | | |
| | | $Mg(C_5H_5)_2$/He | 0.4 | | | | |
| | | $SiF_4$ | 0.5 | | | | |
| | | $Cu(C_4H_7N_2O_2)_2$/He | 0.4 | | | | |
| | | $AlCl_3$/He | 0.3 | | | | |
| | 2nd layer region | $SiH_4$ | 300 | 250 | 25 | 0.6 | 25 |
| | | He | 600 | | | | |
| | | $Cu(C_4H_7N_2O_2)_2$/He | 0.1 | | | | |
| | | $B_2H_6$(against $SiH_4$) | 0.1 ppm | | | | |
| | | $Mg(C_5H_5)_2$/He | 0.2 | | | | |
| | | $SiF_4$ | 0.1 | | | | |
| | | NO | 0.1 | | | | |
| | | $CH_4$ | 1 | | | | |
| | | $AlCl_3$/He | 0.1 | | | | |
| | 3rd layer region | $SiH_4$ | 50 | 250 | 10 | 0.4 | 1 |
| | | $CH_4$ | 500 | | | | |
| | | $Cu(C_4H_7N_2O_2)_2$/He | 1 | | | | |
| | | $N_2$ | 1 | | | | |
| | | $B_2H_6$(against $SiH_4$) | 1 ppm | | | | |
| | | $Mg(C_5H_5)_2$/He | 1 | | | | |
| | | $SiF_4$ | 2 | | | | |
| | | $AlCl_3$/He | 1 | | | | |
| | | $N_2$ | 0.5 | | | | |

TABLE 291

| Order of lamination (layer name) | Gases and their flow rates (SCCM) | | Substrate temprature (°C.) | RF discharging power (mW/cm$^3$) | Inner pressure (Torr) | Layer thickness (μm) |
|---|---|---|---|---|---|---|
| Lower layer | $SiH_4$ | 10→100 * | 250 | 10 | 0.4 | 0.2 |
| | $SiF_4$ | 10 | | | | |
| | $H_2$ | 5→200 * | | | | |
| | $AlCl_3$/He | | | | | |
| | (S-side: 0.05 μm) | | | | | |
| | | 200→40 ** | | | | |
| | (UL-side: 0.15 μm) | | | | | |
| | | 40→10 ** | | | | |

TABLE 291-continued

| Order of lamination (layer name) | | Gases and their flow rates (SCCM) | | Substrate temprature (°C.) | RF discharging power (mW/cm³) | Inner pressure (Torr) | Layer thickness (μm) |
|---|---|---|---|---|---|---|---|
| | | $GeH_4$ | 1→5 * | | | | |
| | | $B_2H_6$(against $SiH_4$) | 100 ppm | | | | |
| | | $Cu(C_4H_7N_2O_2)_2$/He | 20 | | | | |
| Upper layer | 1st layer region | $SiH_4$ | 100 | 250 | 10 | 0.4 | 3 |
| | | $B_2H_6$(against $SiH_4$) | 800 ppm | | | | |
| | | NO | | | | | |
| | | (LL-side: 2 μm) | 5 | | | | |
| | | (U · 2nd LR-side: 1 μm) | | | | | |
| | | | 5→0 ** | | | | |
| | | $SiF_4$ | 10 | | | | |
| | 2nd layer region | $SiH_4$ | 400 | 250 | 10 | 0.5 | 15 |
| | | Ar | 200 | | | | |
| | | $SiF_4$ | 40 | | | | |
| | 3rd layer region | $SiH_4$ | 100 | 250 | 5 | 0.4 | 0.3 |
| | | $NH_3$ | 30 | | | | |
| | | $SiF_4$ | 10 | | | | |

TABLE 292

| Order of lamination (layer name) | | Gases and their flow rates (SCCM) | | Substrate temperature (°C.) | RF discharging power (mW/Cm³) | Inner pressure (Torr) | Layer thickness (μm) |
|---|---|---|---|---|---|---|---|
| Lower layer | | $SiH_4$ | 10→100 * | 300 | 10 | 0.4 | 0.2 |
| | | $Cu(C_4H_7N_2O_2)_2$/He | | | | | |
| | | | 1→10 * | | | | |
| | | $CH_4$ | 2→25 * | | | | |
| | | $H_2$ | 5→200 * | | | | |
| | | $AlCl_3$/He | | | | | |
| | | (S-side: 0.05 μm) | | | | | |
| | | | 200→40 ** | | | | |
| | | (UL-side: 0.15 μm) | | | | | |
| | | | 40→10 ** | | | | |
| | | $B_2H_6$(against $SiH_4$) | 10 ppm | | | | |
| Upper layer | 1st layer region | $SiH_4$ | 100 | 300 | 10 | 0.4 | 3 |
| | | $CH_4$ | 20 | | | | |
| | | $B_2H_6$ | | | | | |
| | | (against $SiH_4$) | 1000 ppm | | | | |
| | | $H_2$ | 100 | | | | |
| | 2nd layer region | $SiH_4$ | 300 | 300 | 20 | 0.5 | 20 |
| | | $H_2$ | 500 | | | | |
| | 3rd layer region | $SiH_4$ | 100 | 300 | 15 | 0.4 | 7 |
| | | $CH_4$ | 600 | | | | |
| | | $PH_3$(against $SiH_4$) | 3000 ppm | | | | |
| | 4th layer region | $SiH_4$ | 40 | 300 | 10 | 0.4 | 0.1 |
| | | $CH_4$ | 600 | | | | |

TABLE 293

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 50 | 330 | 5 | 0.4 | 0.05 |
| | | $Cu(C_4H_7N_2O_2)_2$/He | 10 | | | | |
| | | $H_2$ | 5→200 * | | | | |
| | | $AlCl_3$/He | 200→20 ** | | | | |
| | | $Mg(C_5H_5)_2$/He | 3 | | | | |
| Upper layer | 1st layer region | $SiH_4$ | 100 | 330 | 10 | 0.4 | 3 |
| | | $CH_4$ | 20 | | | | |
| | | $PH_3$(against $SiH_4$) | 800 ppm | | | | |
| | | $H_2$ | 300 | | | | |
| | 2nd layer region | $SiH_4$ | 400 | 330 | 25 | 0.5 | 25 |
| | | $SiF_4$ | 10 | | | | |
| | | $H_2$ | 800 | | | | |
| | 3rd layer region | $SiH_4$ | 100 | 350 | 15 | 0.4 | 5 |
| | | $CH_4$ | 400 | | | | |
| | | $B_2H_6$ | | | | | |
| | | (against $SiH_4$) | 5000 ppm | | | | |
| | 4th layer region | $SiH_4$ | 20 | 350 | 10 | 0.4 | 1 |
| | | $CH_4$ | 400 | | | | |
| | | $B_2H_6$ | | | | | |
| | | (against $SiH_4$) | 8000 ppm | | | | |

TABLE 294

| Order of lamination (layer name) | | Gases and their flow rates (SCCM) | | Substrate temperature (°C.) | RF discharging power (mW/cm$^3$) | Inner pressure (Torr) | Layer thickness (μm) |
|---|---|---|---|---|---|---|---|
| Lower layer | | $SiH_4$ | 50 | 300 | 1 | 0.3 | 0.02 |
| | | $H_2$ | 5→200 * | | | | |
| | | $AlCl_3$/He | | | | | |
| | | (S-side: 0.01 μm) | | | | | |
| | | | 200→30 ** | | | | |
| | | (UL-side: 0.01 μm) | | | | | |
| | | | 30→10 ** | | | | |
| | | $Mg(C_5H_5)_2$/He | 2 | | | | |
| | | $Cu(C_4H_7N_2O_2)_2$/He | 30 | | | | |
| Upper layer | 1st layer region | $SiH_4$ | 100 | 300 | 10 | 0.4 | 3 |
| | | $B_2H_6$ | | | | | |
| | | (against $SiH_4$) | 1000 ppm | | | | |
| | | $CH_4$ | 20 | | | | |
| | | $H_2$ | 100 | | | | |
| | 2nd layer region | $SiH_4$ | 300 | 300 | 20 | 0.5 | 20 |
| | | $H_2$ | 200 | | | | |
| | 3rd layer region | $SiH_4$ | 50 | 300 | 20 | 0.4 | 5 |
| | | $N_2$ | 500 | | | | |
| | | $PH_3$(against $SiH_4$) | 3000 ppm | | | | |
| | 4th layer region | $SiH_4$ | 40 | 300 | 10 | 0.4 | 0.3 |
| | | $CH_4$ | 600 | | | | |

TABLE 295

| Order of lamination (layer name) | | Gases and their flow rates (SCCM) | | Substrate temperature (°C.) | RF discharging power (mW/cm$^3$) | Inner pressure (Torr) | Layer thickness (μm) |
|---|---|---|---|---|---|---|---|
| Lower layer | | $SiH_4$ | 50 | 250 | 5 | 0.4 | 0.05 |
| | | $CH_4$ | 10 | | | | |
| | | $H_2$ | 5→200 * | | | | |
| | | $AlCl_3$/He | 200→20 ** | | | | |
| | | $B_2H_6$ | | | | | |
| | | (against $SiH_4$) | 100 ppm | | | | |
| | | $Cu(C_4H_7N_2O_2)_2$/He | 5 | | | | |
| Upper layer | 1st layer region | $SiH_4$ | 100 | 250 | 15 | 0.4 | 3 |
| | | NO | 10 | | | | |
| | | $B_2H_6$ | | | | | |
| | | (against $SiH_4$) | 800 ppm | | | | |
| | | $H_2$ | 100 | | | | |
| | 2nd layer region | $SiH_4$ | 300 | 250 | 15 | 0.5 | 10 |
| | | $H_2$ | 300 | | | | |
| | 3rd layer region | $SiH_4$ | 200 | 250 | 15 | 0.4 | 20 |
| | | $C_2H_2$ | 10→20 * | | | | |
| | | NO | 1 | | | | |

TABLE 296

| Order of lamination (layer name) | | Gases and their flow rates (SCCM) | | Substrate temperature (°C.) | RF discharging power (mW/cm$^3$) | Inner pressure (Torr) | Layer thickness (μm) |
|---|---|---|---|---|---|---|---|
| Lower layer | | $SiH_4$ | 50 | 250 | 1 | 0.4 | 0.02 |
| | | $H_2$ | 5→200 * | | | | |
| | | $AlCl_3$/He | | | | | |
| | | (S-side: 0.01 μm) | | | | | |
| | | | 200→30 ** | | | | |
| | | (UL-side: 0.01 μm) | | | | | |
| | | | 30→10 ** | | | | |
| | | | 1→10 * | | | | |
| | | $Cu(C_4H_7N_2O_2)_2$/He | 5 | | | | |
| | | $Mg(C_5H_5)_2$/He | 10 | | | | |
| | | $PH_3$(against $SiH_4$) | 100 ppm | | | | |
| Upper layer | 1st layer region | $SiH_4$ | 100 | 250 | 10 | 0.4 | 3 |
| | | $CH_4$ | | | | | |
| | | (LL-side: 2 μm) | 20 | | | | |
| | | (U · 2nd LR-side: 1 μm) | | | | | |
| | | | 20→0 ** | | | | |
| | | $PH_3$(against $SiH_4$) | 800 ppm | | | | |
| | | $H_2$ | 100 | | | | |
| | | $SiF_4$ | 5 | | | | |
| | 2nd layer region | $SiH_4$ | 300 | 300 | 20 | 0.5 | 5 |
| | | $H_2$ | 300 | | | | |
| | | $SiF_4$ | 20 | | | | |
| | 3rd | $SiH_4$ | 100 | 300 | 15 | 0.4 | 20 |

TABLE 296-continued

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| | layer | $CH_4$ | 100 | | | | |
| | region | $SiF_4$ | 5 | | | | |
| | 4th | $SiH_4$ | 50 | 300 | 10 | 0.4 | 0.5 |
| | layer | $CH_4$ | 600 | | | | |
| | region | $SiF_4$ | 5 | | | | |

TABLE 297

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 10→100 * | 300 | 5 | 0.4 | 0.2 |
| | | $Cu(C_4H_7N_2O_2)_2$/He | | | | | |
| | | | 1→10 * | | | | |
| | | $H_2$ | 5→200 * | | | | |
| | | $AlCl_3$/He | | | | | |
| | | (S-side: 0.05 μm) | | | | | |
| | | | 200→40 ** | | | | |
| | | (UL-side: 0.15 μm) | | | | | |
| | | | 40→10 ** | | | | |
| Upper layer | 1st layer region | $SiH_4$ | 100 | 250 | 10 | 0.4 | 3 |
| | | $B_2H_6$ | | | | | |
| | | (against $SiH_4$) | 800 ppm | | | | |
| | | NO | | | | | |
| | | (LL-side: 2 μm) | 5 | | | | |
| | | (U · 2nd LR-side: 1 μm) | | | | | |
| | | | 5→0 ** | | | | |
| | | $H_2$ | 100 | | | | |
| | 2nd layer region | $SiH_4$ | 100 | 300 | 5 | 0.2 | 8 |
| | | $H_2$ | 300 | | | | |
| | 3rd layer region | $SiH_4$ | 300 | 300 | 15 | 0.4 | 25 |
| | | $NH_3$ | 50 | | | | |
| | 4th layer region | $SiH_4$ | 100 | 300 | 10 | 0.4 | 0.3 |
| | | $NH_4$ | 50 | | | | |

TABLE 298

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 10→100 * | 250 | 5 | 0.4 | 0.2 |
| | | $CH_4$ | 2→20 * | | | | |
| | | $H_2$ | 5→200 * | | | | |
| | | $AlCl_3$/He | | | | | |
| | | (S-side: 0.05 μm) | | | | | |
| | | | 200→40 ** | | | | |
| | | (UL-side: 0.15 μm) | | | | | |
| | | | 40→10 ** | | | | |
| | | $Cu(C_4H_7N_2O_2)_2$/He | 5 | | | | |
| | | $B_2H_6$(against $SiH_4$) | 10 ppm | | | | |
| Upper layer | 1st layer region | $SiH_4$ | 100 | 250 | 10 | 0.4 | 3 |
| | | $CH_4$ | 20 | | | | |
| | | $B_2H_6$ | | | | | |
| | | (against $SiH_4$) | 1000 ppm | | | | |
| | | $H_2$ | 100 | | | | |
| | 2nd layer region | $SiH_4$ | 100 | 300 | 3 | 0.5 | 3 |
| | | $SiF_4$ | 5 | | | | |
| | | $H_2$ | 200 | | | | |
| | 3rd layer region | $SiH_4$ | 100 | 300 | 15 | 0.4 | 30 |
| | | $CH_4$ | 100 | | | | |
| | | $PH_3$(against $SiH_4$) | 50 ppm | | | | |
| | 4th layer region | $SiH_4$ | 50 | 300 | 10 | 0.4 | 0.5 |
| | | $CH_4$ | 600 | | | | |
| | | $SiF_4$ | 5 | | | | |

TABLE 299

| Order of lamination (layer name) | Gases and their flow rates (SCCM) | Substrate temperature (°C.) | RF discharging power (mW/cm³) | Inner pressure (Torr) | Layer thickness (μm) |
|---|---|---|---|---|---|
| Lower layer | $Cu(C_4H_7N_1O_2)_2$/He | 250 | 5 | 0.4 | 0.05 |

TABLE 299-continued

| Order of lamination (layer name) | | Gases and their flow rates (SCCM) | | Substrate temperature (°C.) | RF discharging power (mW/cm$^3$) | Inner pressure (Torr) | Layer thickness (μm) |
|---|---|---|---|---|---|---|---|
| | | | 3→1 ** | | | | |
| | | $SiH_4$ | 50 | | | | |
| | | $C_2H_2$ | 5 | | | | |
| | | $H_2$ | 5→200 * | | | | |
| | | $AlCl_3$/He | 200→20 ** | | | | |
| | | $PH_3$(against $SiH_4$) | 10 ppm | | | | |
| Upper layer | 1st layer region | $SiH_4$ | 100 | 250 | 10 | 0.4 | 3 |
| | | $C_2H_2$ | 10 | | | | |
| | | $PH_3$(against $SiH_4$) | 800 ppm | | | | |
| | | $H_2$ | 300 | | | | |
| | 2nd layer region | $Si_2H_4$ | 200 | 300 | 10 | 0.5 | 10 |
| | | $H_2$ | 200 | | | | |
| | | $Si_2H_6$ | 10 | | | | |
| | 3rd layer region | $SiH_4$ | 300 | 330 | 20 | 0.4 | 30 |
| | | $C_2H_2$ | 50 | | | | |
| | | $B_2H_6$(against $SiH_4$) | | | | | |
| | | (U · 2nd LR-side: 1 μm) | | | | | |
| | | | 800→100 ppm** | | | | |
| | | (U · 4th LR-side: 29 μm) | | | | | |
| | | | 100 ppm | | | | |
| | 4th layer region | $SiH_4$ | 200 | 330 | 10 | 0.4 | 1 |
| | | $C_2H_2$ | 200 | | | | |

TABLE 300

| Order of lamination (layer name) | | Gases and their flow rates (SCCM) | | Substrate temperature (°C.) | RF discharging power (mW/cm$^3$) | Inner pressure (Torr) | Layer thickness (μm) |
|---|---|---|---|---|---|---|---|
| Lower layer | | $SiH_4$ | 10→100 * | 250 | 5 | 0.4 | 0.2 |
| | | NO | 1→10 * | | | | |
| | | $Cu(C_4H_7N_2O_2)_2$/He | | | | | |
| | | | 1→5 * | | | | |
| | | $H_2$ | 5→200 * | | | | |
| | | $AlCl_3$/He | | | | | |
| | | (S-side: 0.05 μm) | | | | | |
| | | | 200→40 ** | | | | |
| | | (UL-side: 0.15 μm) | | | | | |
| | | | 40→10 ** | | | | |
| | | $Si_2F_6$ | 1 | | | | |
| Upper layer | 1st layer region | $SiH_4$ | 100 | 250 | 10 | 0.4 | 3 |
| | | $B_2H_6$(against $SiH_4$) | 800 ppm | | | | |
| | | NO | | | | | |
| | | (LL-side: 2 μm) | 10 | | | | |
| | | (U · 2nd LR-side: 1 μm) | | | | | |
| | | | 10→0 ** | | | | |
| | | $H_2$ | 100 | | | | |
| | | $Si_2F_6$ | 10 | | | | |
| | 2nd layer region | $SiH_4$ | 100 | 300 | 5 | 0.2 | 8 |
| | | $H_2$ | 300 | | | | |
| | | $Si_2F_6$ | 10 | | | | |
| | 3rd layer region | $SiH_4$ | 300 | 300 | 15 | 0.4 | 25 |
| | | $NH_3$ | 30→50 * | | | | |
| | | $PF_3$(against $SiH_4$) | 50 ppm | | | | |
| | | $Si_2F_6$ | 30 | | | | |
| | 4th layer region | $SiH_4$ | 100 | 300 | 5 | 0.4 | 0.7 |
| | | $NH_3$ | 80→100 * | | | | |
| | | $PF_3$(against $SiH_4$) | 500 ppm | | | | |
| | | $Si_2F_6$ | 10 | | | | |

TABLE 301

| Order of lamination (layer name) | | Gases and their flow rates (SCCM) | | Substrate temperature (°C.) | RF discharging power (mW/cm$^3$) | Inner pressure (Torr) | Layer thickness (μm) |
|---|---|---|---|---|---|---|---|
| Lower layer | | $SiH_4$ | 50 | 250 | 1 | 0.4 | 0.02 |
| | | $H_2$ | 5→200 * | | | | |
| | | $AlCl_3$/He | | | | | |
| | | (S-side: 0.01 μm) | | | | | |
| | | | 200→30 ** | | | | |
| | | (UL-side: 0.01 μm) | | | | | |
| | | | 30→10 ** | | | | |
| | | $Cu(C_4H_7N_2O_2)_2$/He | 20 | | | | |
| | | $B_2H_6$(against $SiH_4$) | 100 ppm | | | | |
| Upper layer | 1st layer | $SiH_4$ | 100 | 300 | 10 | 0.4 | 3 |
| | | $CH_4$ | 20 | | | | |

TABLE 301-continued

| Order of lamination (layer name) | | Gases and their flow rates (SCCM) | | Substrate temperature (°C.) | RF discharging power (mW/cm$^3$) | Inner pressure (Torr) | Layer thickness (μm) |
|---|---|---|---|---|---|---|---|
| | region | $B_2H_6$(against $SiH_4$) | 1000 ppm | | | | |
| | | $H_2$ | 100 | | | | |
| | 2nd layer region | $SiH_4$ | 300 | 300 | 20 | 0.5 | 20 |
| | | $H_2$ | 500 | | | | |
| | 3rd layer region | $SiH_4$ | 100 | 300 | 5 | 0.4 | 1 |
| | | $GeH_4$ | 10→50 * | | | | |
| | | $H_2$ | 300 | | | | |
| | 3rd layer region | $SiH_4$ | 100→40 ** | 300 | 10 | 0.4 | 1 |
| | | $CH_4$ | 100→600 * | | | | |

TABLE 302

| Order of lamination (layer name) | | Gases and their flow rates (SCCM) | | Substrate temperature (°C.) | RF discharging power (mW/cm$^3$) | Inner pressure (Torr) | Layer thickness (μm) |
|---|---|---|---|---|---|---|---|
| Lower layer | | $Cu(C_4H_7N_2O_2)_2$/He | 25 | 300 | 1 | 0.3 | 0.02 |
| | | $SiH_4$ | 50 * | | | | |
| | | $H_2$ | 5→200 * | | | | |
| | | $AlCl_3$/He | | | | | |
| | | (S-side: 0.01 μm) | | | | | |
| | | | 200→30 ** | | | | |
| | | (UL-side: 0.01 μm) | | | | | |
| | | | 30→10 ** | | | | |
| | | NO | 5 | | | | |
| | | $B_2H_6$(againt $SiH_4$) | 50 ppm | | | | |
| Upper layer | 1st layer region | $SiH_4$ | 85 | 300 | 10 | 0.4 | 3 |
| | | $B_2H_6$(against $SiH_4$) | 800 ppm | | | | |
| | | NO | 10 | | | | |
| | | (LL-side: 2 μm) | 10 | | | | |
| | | (U · 2nd LR-side: 1 μm) | | | | | |
| | | | 10→0 ** | | | | |
| | | $H_2$ | 100 | | | | |
| | 2nd layer region | $SiH_4$ | 300 | 300 | 15 | 0.5 | 20 |
| | | $H_2$ | 400 | | | | |
| | 3rd layer region | $SiH_4$ | 50 | 300 | 10 | 0.4 | 0.5 |
| | | $CH_4$ | 500 | | | | |

TABLE 303

| Order of lamination (layer name) | | Gases and their flow rates (SCCM) | | Substrate temperature (°C.) | RF discharging power (mW/cm$^3$) | Inner pressure (Torr) | Layer thickness (μm) |
|---|---|---|---|---|---|---|---|
| Lower layer | | $SiH_4$ | 50 | 300 | 0.7 | 0.3 | 0.02 |
| | | $Cu(C_4H_7N_2O_2)_2$/He | 2 | | | | |
| | | $H_2$ | 5→200 * | | | | |
| | | $AlCl_3$/He | | | | | |
| | | (S-side: 0.01 μm) | | | | | |
| | | | 200→30 ** | | | | |
| | | (UL-side: 0.01 μm) | | | | | |
| | | | 30→10 ** | | | | |
| | | NO | 4 | | | | |
| | | $B_2H_6$(against $SiH_4$) | 50 ppm | | | | |
| Upper layer | 1st layer region | $SiH_4$ | 80 | 300 | 10 | 0.4 | 3 |
| | | $B_2H_6$(against $SiH_4$) | 800 ppm | | | | |
| | | NO | | | | | |
| | | (LL-side: 2 μm) | 8 | | | | |
| | | (U · 2nd LR-side: 1 μm) | | | | | |
| | | | 8→0 ** | | | | |
| | | $H_2$ | 80 | | | | |
| | 2nd layer region | $SiH_4$ | 200 | 300 | 12 | 0.4 | 20 |
| | | $H_2$ | 400 | | | | |
| | 3rd layer region | $SiH_4$ | 40 | 300 | 7 | 0.3 | 0.5 |
| | | $CH_4$ | 400 | | | | |

TABLE 304

| Order of lamination (layer name) | | Gases and their flow rates (SCCM) | | Substrate temperature (°C.) | RF discharging power (mW/cm$^3$) | Inner pressure (Torr) | Layer thickness (μm) |
|---|---|---|---|---|---|---|---|
| Lower layer | | $SiH_4$ | 25 | 300 | 0.5 | 0.2 | 0.02 |
| | | $Cu(C_4H_7N_2O_2)_2/He$ | 15 | | | | |
| | | $H_2$ | 5→100* | | | | |
| | | $AlCl_3/He$ | | | | | |
| | | (S-side:0.01 μm) | 100→15** | | | | |
| | | (UL-side:0.01 μm) | 15→5** | | | | |
| | | NO | 3 | | | | |
| | | $B_2H_6$(against $SiH_4$) | 50 ppm | | | | |
| Upper layer | 1st layer region | $SiH_4$ | 60 | 300 | 10 | 0.4 | 3 |
| | | $B_2H_6$(against $SiH_4$) | 800 ppm | | | | |
| | | NO | | | | | |
| | | (LL-side:2 μm) | 6 | | | | |
| | | (U · 2nd LR-side:1 μm) | 6→0** | | | | |
| | | $H_2$ | 80 | | | | |
| | 2nd layer region | $SiH_4$ | 150 | | | | |
| | | $H_2$ | 300 | | | | |
| | 3rd layer region | $SiH_4$ | 30 | 300 | 5 | 0.3 | 0.5 |
| | | $CH_4$ | 300 | | | | |

TABLE 305

| Order of lamination (layer name) | | Gases and their flow rates (SCCM) | | Substrate temperature (°C.) | RF discharging power (mW/cm$^3$) | Inner pressure (Torr) | Layer thickness (μm) |
|---|---|---|---|---|---|---|---|
| Lower layer | | $SiH_4$ | 20 | 300 | 0.3 | 0.2 | 0.02 |
| | | $H_2$ | 5→100* | | | | |
| | | $AlCl_3/He$ | | | | | |
| | | (S-side:0.01 μm) | 80→15** | | | | |
| | | (UL-side:0.01 μm) | 15→5** | | | | |
| | | $Cu(C_4H_7N_2O_2)_2/He$ | 10 | | | | |
| | | NO | 2 | | | | |
| | | $B_2H_6$(against $SiH_4$) | 50 ppm | | | | |
| Upper layer | 1st layer region | $SiH_4$ | 40 | 300 | 10 | 0.4 | 3 |
| | | $B_2H_6$(against $SiH_4$) | 800 ppm | | | | |
| | | NO | | | | | |
| | | (LL-side:2 μm) | 4 | | | | |
| | | (U · 2nd LR-side: 1 μm) | 4→0** | | | | |
| | | $H_2$ | 80 | | | | |
| | 2nd layer region | $SiH_4$ | 100 | 300 | 6 | 0.3 | 20 |
| | | $H_2$ | 300 | | | | |
| | 3rd layer region | $SiH_4$ | 20 | 300 | 3 | 0.2 | 0.5 |
| | | $CH_4$ | 200 | | | | |

TABLE 306

| Order of lamination (layer name) | | Gases and their flow rates (SCCM) | | Substrate temperature (°C.) | RF discharging power (mW/cm$^3$) | Inner pressure (Torr) | Layer thickness (μm) |
|---|---|---|---|---|---|---|---|
| Lower layer | | $SiH_4$ | 50 | 500 | 5 | 0.4 | 0.05 |
| | | $C_2H_2$ | 5 | | | | |
| | | $H_2$ | 5→200* | | | | |
| | | $AlCl_3/He$ | 200→20** | | | | |
| | | $Cu(C_4H_7N_2O_2)_2/He$ | 20 | | | | |
| | | $B_2H_6$(against $SiH_4$) | 10 ppm | | | | |
| Upper layer | 1st layer region | $SiH_4$ | 100 | 500 | 30 | 0.4 | 3 |
| | | $C_2H_2$ | 30 | | | | |
| | | $B_2H_6$(against $SiH_4$) | 800 ppm | | | | |
| | | $H_2$ | 500 | | | | |
| | 2nd layer region | $SiH_4$ | 300 | 500 | 30 | 0.5 | 10 |
| | | $H_2$ | 1500 | | | | |
| | 3rd layer region | $SiH_4$ | 200 | 500 | 30 | 0.4 | 20 |
| | | $C_2H_2$ | 10→20* | | | | |
| | | NO | 1 | | | | |

TABLE 307

| Order of lamination (layer name) | | Gases and their flow rates (SCCM) | | Substrate temperature (°C. | μW discharging power (mW/cm³) | Inner pressure (Torr) | Layer thickness (μm) |
|---|---|---|---|---|---|---|---|
| Lower layer | | $SiH_4$ | 150 | 250 | 0.5 | 0.6 | 0.02 |
| | | $Cu(C_4H_7N_2O_2)_2$/He | 10 | | | | |
| | | $SiF_4$ | 10 | | | | |
| | | $H_2$ | 20→500* | | | | |
| | | $AlCl_3$/He | | | | | |
| | | (S-side:0.01 μm) | 400→80** | | | | |
| | | (UL-side:0.01 μm) | 80→50** | | | | |
| | | NO | 10 | | | | |
| | | $B_2H_6$(against $SiH_4$) | 100 ppm | | | | |
| Upper layer | 1st layer region | $SiH_4$ | 500 | 250 | 0.5 | 0.4 | 3 |
| | | $SiF_4$ | 20 | | | | |
| | | $B_2H_6$(against $SiH_4$) | 1000 ppm | | | | |
| | | $H_2$ | 303 | | | | |
| | | NO | 13 | | | | |
| | 2nd layer region | $SiH_4$ | 700 | 250 | 0.5 | 0.5 | 20 |
| | | $SiF_4$ | 30 | | | | |
| | | $H_2$ | 500 | | | | |
| | 3rd layer region | $SiH_4$ | 150 | 250 | 0.5 | 0.3 | 1 |
| | | $CH_4$ | 500 | | | | |

TABLE 308

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 50 | 250 | 5 | 0.4 | 0.05 |
| | | $C_2H_2$ | 10 | | | | |
| | | $H_2$ | 5→200* | | | | |
| | | $AlCl_3$/He | 200→20** | | | | |
| | | $Cu(C_4H_7N_2O_2)_2$/He | 10 | | | | |
| | | $B_2H_6$(against $SiH_4$) | 100 ppm | | | | |
| Upper layer | 1st layer region | $SiH_4$ | 100 | 250 | 15 | 0.4 | 3 |
| | | $C_2H_2$ | 10 | | | | |
| | | $B_2H_6$(against $SiH_4$) | 800 ppm | | | | |
| | | $H_2$ | 300 | | | | |
| | 2nd layer region | $SiH_4$ | 200 | 250 | 15 | 0.4 | 20 |
| | | $C_2H_2$ | 10→20* | | | | |
| | | NO | 1 | | | | |
| | 3rd layer region | $SiH_4$ | 300 | 250 | 15 | 0.5 | 10 |
| | | $H_2$ | 300 | | | | |

TABLE 309

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 50 | 250 | 1 | 0.4 | 0.02 |
| | | $Cu(C_4H_7N_2O_2)_2$He | 10 | | | | |
| | | $H_2$ | 5→200* | | | | |
| | | $AlCl_3$/He | | | | | |
| | | (S-side:0.01 μm) | 200→30** | | | | |
| | | (UL-side:0.01 μm) | 30→10** | | | | |
| | | $SiF_4$ | 10 | | | | |
| | | $CH_4$ | 10 | | | | |
| | | $PH_3$(against $SiH_4$) | 100 ppm | | | | |
| Upper layer | 1st layer region | $SiH_4$ | 100 | 250 | 10 | 0.4 | 3 |
| | | $CH_4$ | | | | | |
| | | (LL-side:2 μm) | 20 | | | | |
| | | (U · 2nd LR-side:1 μm) | 20→0** | | | | |
| | | $PH_3$(against $SiH_4$) | 800 ppm | | | | |
| | | $H_2$ | 100 | | | | |
| | | $SiF_4$ | 10 | | | | |
| | 2nd layer region | $SiH_4$ | 100 | 300 | 15 | 0.4 | 20 |
| | | $CH_4$ | 100 | | | | |
| | | $SiF_4$ | 10 | | | | |
| | 3rd layer region | $SiH_4$ | 300 | 300 | 20 | 0.5 | 5 |
| | | $H_2$ | 300 | | | | |
| | | $SiF_4$ | 20 | | | | |
| | 4th layer region | $SiH_4$ | 50 | 300 | 10 | 0.4 | 0.5 |
| | | $CH_4$ | 600 | | | | |
| | | $SiF_4$ | 5 | | | | |

TABLE 310

| Order of lamination (layer name) | | Gases and their flow rates (SCCM) | | Substrate temperature (°C.) | RF discharging power (mW/cm$^3$) | Inner pressure (Torr) | Layer thickness (μm) |
|---|---|---|---|---|---|---|---|
| Lower layer | | $Cu(C_4H_7N_2O_2)_2$/He) | | 300 | 5 | 0.4 | 0.2 |
| | | | 5→10* | | | | |
| | | $SiH_4$ | 10→100* | | | | |
| | | $SnH_4$ | 1→10* | | | | |
| | | NO | 1→10* | | | | |
| | | $H_2$ | 5→200* | | | | |
| | | $AlCl_3$/He | | | | | |
| | | (S-side:0.05 μm) | 200→40** | | | | |
| | | (UL-side:0.15 μm) | 40→10** | | | | |
| | | $Mg(C_5H_5)_2$/He | 8 | | | | |
| Upper layer | 1st layer region | $SiH_4$ | 100 | 300 | 10 | 0.4 | 3 |
| | | $B_2H_6$(against $SiH_4$) | 800 ppm | | | | |
| | | NO | | | | | |
| | | (LL-side:2 μm) | 5 | | | | |
| | | (U · 2nd LR-side:1 μm) | 5→0** | | | | |
| | | $H_2$ | 100 | | | | |
| | 2nd layer region | $SiH_4$ | 300 | 300 | 15 | 0.4 | 25 |
| | | $NH_2$ | 50 | | | | |
| | 3rd layer region | $SiH_4$ | 100 | 300 | 5 | 0.2 | 8 |
| | | $H_2$ | 300 | | | | |
| | 4th layer region | $SiH_4$ | 100 | 300 | 10 | 0.4 | 0.3 |
| | | $NH_3$ | 50 | | | | |

TABLE 311

| Order of lamination (layer name) | | Gases and their flow rates (SCCM) | | Substrate temperature (°C.) | RF discharging power (mW/cm$^3$) | Inner pressure (Torr) | Layer thickness (μm) |
|---|---|---|---|---|---|---|---|
| Lower layer | | $SiH_4$ | 10→100* | 250 | 5 | 0.4 | 0.2 |
| | | $Cu(C_4H_7N_2O_2)_2$/He | 1→10* | | | | |
| | | $CH_4$ | 2→20* | | | | |
| | | $H_2$ | 5→200* | | | | |
| | | $AlCl_3$/He | | | | | |
| | | (S-side:0.05 μm) | 200→40** | | | | |
| | | (UL-side:0.15 μm) | 40→10** | | | | |
| | | $PH_3$(against $SiH_4$) | 10 ppm | | | | |
| Upper layer | 1st layer region | $SiH_4$ | 100 | 250 | 10 | 0.4 | 3 |
| | | $CH_4$ | 20 | | | | |
| | | $PH_3$(against $SiH_4$) | 1000 ppm | | | | |
| | | $H_2$ | 100 | | | | |
| | | $SiF_4$ | 10 | | | | |
| | 2nd layer region | $SiH_4$ | 100 | 300 | 15 | 0.4 | 30 |
| | | $CH_4$ | 100 | | | | |
| | | $PH_3$(against $SiH_4$) | 50 ppm | | | | |
| | | $SiF_4$ | 10 | | | | |
| | 3rd layer region | $SiH_4$ | 100 | 300 | 3 | 0.5 | 3 |
| | | $SiF_4$ | 5 | | | | |
| | | $H_2$ | 200 | | | | |
| | 4th layer region | $SiH_4$ | 50 | 300 | 10 | 0.4 | 0.5 |
| | | $CH_4$ | 600 | | | | |
| | | $SiF_4$ | 5 | | | | |

TABLE 312

| Order of lamination (layer name) | | Gases and their flow rates (SCCM) | | Substrate temperature (°C.) | RF discharging power (mW/cm$^3$) | Inner pressure (Torr) | Layer thickness (μm) |
|---|---|---|---|---|---|---|---|
| Lower layer | | $SiH_4$ | 50 | 250 | 5 | 0.4 | 0.05 |
| | | $Cu(C_4H_7N_2O_2)_2$/He | 10→3** | | | | |
| | | $C_2H_2$ | 5 | | | | |
| | | $H_2$ | 5→200* | | | | |
| | | $AlCl_3$/He | 200→20** | | | | |
| | | $B_2H_6$(against $SiH_4$) | 10 ppm | | | | |
| Upper layer | 1st layer region | $SiH_4$ | 100 | 250 | 10 | 0.4 | 3 |
| | | $C_2H_2$ | 10 | | | | |
| | | $B_2H_6$(against $SiH_4$) | 800 ppm | | | | |
| | | $H_2$ | 300 | | | | |
| | 2nd layer region | $SiH_4$ | 300 | 330 | 20 | 0.4 | 30 |
| | | Cphd $2H_2$ | 50 | | | | |
| | | $B_2H_6$(against $SiH_4$) | | | | | |
| | | (U · 1st LR-side:1 μm) | 0→100 ppm* | | | | |
| | | (U · 3rd LR-side:29 μm) | 100 ppm | | | | |
| | 3rd | $Si_2H_6$ | 200 | 300 | 10 | 0.5 | 10 |

TABLE 312-continued

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| | layer region | $H_2$ | 200 | | | | |
| | 4th layer region | $SiH_4$ | 200 | 330 | 10 | 0.4 | 1 |
| | | $C_2H_2$ | 200 | | | | |

TABLE 313

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 10→100* | 250 | 5 | 0.4 | 0.2 |
| | | NO | 1→10* | | | | |
| | | $H_2$ | 5→200* | | | | |
| | | $AlCl_3$/He | | | | | |
| | | (S-side:0.05 μm) | 200→40** | | | | |
| | | (UL-side:0.15 μm) | 40→10** | | | | |
| | | $Cu(C_4H_7N_2O_2)_2$/He | 20→5** | | | | |
| Upper layer | 1st layer region | $SiH_4$ | 100 | 250 | 10 | 0.4 | 3 |
| | | $PH_3$(against $SiH_4$) | 800 ppm | | | | |
| | | NO | | | | | |
| | | (LL-side:2 μm) | 10 | | | | |
| | | (U · 2nd LR-side:1 μm) | 10→0** | | | | |
| | | $H_2$ | 100 | | | | |
| | 2nd layer region | $SiH_4$ | 300 | 300 | 15 | 0.4 | 25 |
| | | $NH_3$ | 30→50* | | | | |
| | | $PH_3$(against $SiH_4$) | 50 ppm | | | | |
| 3rd | $SiH_4$ | 100 | 300 | 5 | 0.2 | 8 | |
| | layer region | $H_2$ | 300 | | | | |
| | 4th layer region | $SiH_4$ | 100 | 300 | 5 | 0.4 | 0.7 |
| | | $NH_3$ | 80→100* | | | | |
| | | $B_2H_6$(against $SiH_4$) | 500 ppm | | | | |

TABLE 314

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 50 | 250 | 1 | 0.3 | 0.02 |
| | | $H_2$ | 5→200 | | | | |
| | | $AlCl_3$/He | | | | | |
| | | (S-side:0.01 μm) | 200→30** | | | | |
| | | (UL-side:0.01 μm) | 30→10** | | | | |
| | | $B_2H_6$ (against $SiH_4$) | 100 ppm | | | | |
| | | NO | 1 | | | | |
| | | Mg $(C_2H_5)_2$/He | 5 | | | | |
| | | Cu $(C_4H_7N_2O_2)_2$/He | 1 | | | | |
| Upper layer | 1st layer region | $SiH_4$ | 100 | 250 | 10 | 0.4 | 3 |
| | | He | 300 | | | | |
| | | NO | 5 | | | | |
| | | $B_2H_6$ (against $SiH_4$) | 1500 ppm | | | | |
| | 2nd layer region | $SiH_4$ | 300 | 250 | 25 | 0.6 | 25 |
| | | He | 600 | | | | |
| | 3rd layer region | $SiH_4$ | 50 | 250 | 10 | 0.4 | 1 |
| | | $CH_4$ | 500 | | | | |

TABLE 315

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 10→100* | 300 | 10 | 0.4 | 0.2 |
| | | $H_2$ | 5→200* | | | | |
| | | $AlCl_3$/He | | | | | |
| | | (S-side:0.05 μm) | 200→40** | | | | |
| | | (UL-side:0.15 μm) | 40→10** | | | | |
| | | $CH_4$ | 5→25* | | | | |
| | | $SiF_4$ | 1 | | | | |
| | | NO | 0.5 | | | | |
| | | Cu $(C_4H_{72}O_2)_2$/He | 10→0.5** | | | | |
| | | $B_2H_6$ (against $SiH_4$) | 10 ppm | | | | |

TABLE 315-continued

| Order of lamination (layer name) | | Gases and their flow rates (SCCM) | | Substrate temperature (°C.) | RF discharging power (mW/cm$^3$) | Inner pressure (Torr) | Layer thickness (μm) |
|---|---|---|---|---|---|---|---|
| Upper layer | 1st layer region | $SiH_4$ | 100 | 300 | 10 | 0.4 | 3 |
| | | $CH_4$ | 20 | | | | |
| | | $B_2H_6$ (against $SiH_4$) | 1000 ppm | | | | |
| | | $H_2$ | 100 | | | | |
| | | $SiF_4$ | 1 | | | | |
| | | Cu $(C_4H_7N_2O_2)_2$/He | 0.5 | | | | |
| | | $AlCl_3$/He | 0.4 | | | | |
| | | NO | 0.5 | | | | |
| | 2nd layer region | $SiH_4$ | 300 | 300 | 20 | 0.5 | 20 |
| | | $H_2$ | 500 | | | | |
| | | $B_2H_6$ (against $SiH_4$) | 0.1 ppm | | | | |
| | | $CH_4$ | 1 | | | | |
| | | NO | 0.1 | | | | |
| | | Cu $(C_4H_7N_2O_2)_2$/He | 0.1 | | | | |
| | | $SiF_4$ | 0.2 | | | | |
| | | $AlCl_3$/He | 0.1 | | | | |
| | 3rd layer region | $SiH_4$ | 100 | 300 | 15 | 0.4 | 7 |
| | | $CH_4$ | 600 | | | | |
| | | $PH_3$ (against $SiH_4$) | 3000 ppm | | | | |
| | | $B_2H_6$ (against $SiH_4$) | 0.3 ppm | | | | |
| | | Cu $(C_4H_7N_2O_2)_2$/He | 0.1 | | | | |
| | | $SiF_4$ | 0.3 | | | | |
| | | $AlCl_3$/He | 0.2 | | | | |
| | | NO | 0.2 | | | | |
| | 4th layer region | $SiH_4$ | 40 | 300 | 10 | 0.4 | 0.1 |
| | | $CH_4$ | 600 | | | | |
| | | $PH_3$ (against $SiH_4$) | 2 ppm | | | | |
| | | $B_2H_6$ (against $SiH_4$) | 1 ppm | | | | |
| | | Cu $(C_4H_7N_2O_2)_2$/He | 1 | | | | |
| | | $SiF_4$ | 1 | | | | |
| | | $AlCl_3$/He | 1 | | | | |
| | | NO | 0.5 | | | | |

TABLE 316

| Order of lamination (layer name) | | Gases and their flow rates (SCCM) | | Substrate temperature (°C.) | RF discharging power (mW/cm$^3$) | Inner pressure (Torr) | Layer thickness (μm) |
|---|---|---|---|---|---|---|---|
| Lower layer | | $SiH_4$ | 10→200* | 250 | 5 | 0.4 | 0.2 |
| | | $CH_4$ | 2→20* | | | | |
| | | $H_2$ | 5→200* | | | | |
| | | $AlCl_3$/He | | | | | |
| | | (S-side:0.05 μm) | 200→40** | | | | |
| | | (UL-side:0.15 μm) | 40→10** | | | | |
| | | $SiF_4$ | 10 | | | | |
| | | Cu $(C_4H_7N_2O_2)_2$/He | 5 | | | | |
| | | NO | 0.5 | | | | |
| | | $B_2H_6$ (against $SiH_4$) | 10 ppm | | | | |
| Upper layer | 1st layer region | $SiH_4$ | 100 | 250 | 10 | 0.4 | 3 |
| | | $CH_4$ | 20 | | | | |
| | | $B_2H_6$ (against $SiH_4$) | 1000 ppm | | | | |
| | | $H_2$ | 100 | | | | |
| | | Cu$(C_4H_7N_2O_2)_2$/He | 0.5 | | | | |
| | | $SiF_4$ | 10 | | | | |
| | | $AlCl_3$/He | 0.4 | | | | |
| | | NO | 0.5 | | | | |
| | 2nd layer region | $SiH_4$ | 100 | 300 | 3 | 0.5 | 3 |
| | | $SiF_4$ | 5 | | | | |
| | | $H_2$ | 200 | | | | |
| | | $B_2H_6$ (against $SiH_4$) | 0.3 ppm | | | | |
| | | Cu $(C_4H_7N_2O_2)_2$/He | 0.3 | | | | |
| | | $CH_4$ | 1 | | | | |
| | | $AlCl_3$/He | 0.6 | | | | |
| | | NO | 0.5 | | | | |
| | 3rd layer region | $SiH_4$ | 100 | 300 | 15 | 0.4 | 30 |
| | | $CH_4$ | 100 | | | | |
| | | $PH_3$ (against $SiH_4$) | 50 ppm | | | | |
| | | $B_2H_6$ (against $SiH_4$) | 0.1 ppm | | | | |
| | | Cu $(C_4H_7N_2O_2)_2$/He | 0.1 | | | | |
| | | $SiF_4$ | 5 | | | | |
| | | $AlCl_3$/He | 0.1 | | | | |
| | | NO | 0.1 | | | | |
| | 4th layer region | $SiH_4$ | 50 | 300 | 10 | 0.4 | 0.5 |
| | | $CH_4$ | 600 | | | | |
| | | $PH_3$ (against $SiH_4$) | 1 ppm | | | | |
| | | $B_2H_6$ (against $SiH_4$) | 1 ppm | | | | |
| | | Cu $(C_4H_7N_2O_2)_2$/He | 0.5 | | | | |

TABLE 316-continued

| Order of lamination (layer name) | Gases and their flow rates (SCCM) | | Substrate temperature (°C.) | RF discharging power (mW/cm$^3$) | Inner pressure (Torr) | Layer thickness (μm) |
|---|---|---|---|---|---|---|
| | $SiF_4$ | 3 | | | | |
| | $AlCl_3$/He | 1 | | | | |
| | NO | 0.5 | | | | |

TABLE 317

| Order of lamination (layer name) | | Gases and their flow rates (SCCM) | | Substrate temperature (°C.) | RF discharging power (mW/cm$^3$) | Inner pressure (Torr) | Layer thickness (μm) |
|---|---|---|---|---|---|---|---|
| Lower layer | | $SiH_4$ | 50 | 250 | 5 | 0.4 | 0.05 |
| | | NO | 5 | | | | |
| | | $H_2$ | 10→200* | | | | |
| | | $AlCl_3$/He | 120→40** | | | | |
| | | Cu $(C_4H_7N_2O_2)_2$/He | 5 | | | | |
| Upper layer | 1st layer region | $SiH_4$ | 100 | 250 | 10 | 0.5 | 3 |
| | | $C_2H_2$ | 10 | | | | |
| | | $B_2H_6$ (against $SiH_4$) | 1500 ppm | | | | |
| | | NO | | | | | |
| | | (LL-side:2 μm) | 3 | | | | |
| | | (U · 2nd LR-side:1 μm) | 3→0** | | | | |
| | | $H_2$ | 300 | | | | |
| | 2nd layer region | $SiH_4$ | 100 | 250 | 15 | 0.5 | 25 |
| | | $C_2H_2$ | 10 | | | | |
| | | $H_2$ | 300 | | | | |
| | | $B_2H_6$ (against $SiH_4$) | 50 ppm | | | | |
| | 3rd layer region | $SiH_4$ | 60 | 250 | 10 | 0.4 | 0.5 |
| | | $C_2H_2$ | 60 | | | | |
| | | $H_2$ | 50 | | | | |

TABLE 318

| Order of lamination (layer name) | | Gases and their flow rates (SCCM) | | Substrate temperature (°C.) | RF discharging power (mW/cm$^3$) | Inner pressure (Torr) | Layer thickness (μm) |
|---|---|---|---|---|---|---|---|
| Lower layer | | $SiH_4$ | 50 | 250 | 1 | 0.3 | 0.02 |
| | | $H_2$ | 5→200* | | | | |
| | | $AlCl_3$/He | | | | | |
| | | (S-side:0.01 μm) | 200→30** | | | | |
| | | (UL-side:0.01 μm) | 30→10** | | | | |
| | | Cu $(C_4H_7N_2O_2)_2$/He | 5→1** | | | | |
| | | NO | 5 | | | | |
| | | $C_2H_2$ | 5 | | | | |
| | | $PH_3$ | 10 ppm | | | | |
| Upper layer | 1st layer region | $SiH_4$ | 100 | 250 | 10 | 0.5 | 3 |
| | | $C_2H_2$ | 10 | | | | |
| | | $PH_3$ (against $SiH_4$) | 1500 ppm | | | | |
| | | NO | | | | | |
| | | (LL-side:2 μm) | 3 | | | | |
| | | (U · 2nd LR-side:1 μm) | 3→0** | | | | |
| | | $H_2$ | 300 | | | | |
| | 2nd layer region | $SiH_4$ | 100 | 250 | 15 | 0.5 | 20 |
| | | $C_2H_2$ | 15 | | | | |
| | | $H_2$ | 300 | | | | |
| | | $PH_3$ (against $SiH_4$) | 40 ppm | | | | |
| | 3rd layer region | $SiH_4$ | 100 | 250 | 15 | 0.5 | 3 |
| | | $C_2H_2$ | 10 | | | | |
| | | $H_2$ | 150 | | | | |
| | 4th layer region | $SiH_4$ | 60 | 250 | 10 | 0.4 | 0.5 |
| | | $C_2H_2$ | 60 | | | | |
| | | $H_2$ | 50 | | | | |

TABLE 319

| Order of lamination (layer name) | Gases and their flow rates (SCCM) | | Substrate temperature (°C.) | RF discharging power (mW/cm$^3$) | Inner pressure (Torr) | Layer thickness (μm) |
|---|---|---|---|---|---|---|
| Lower layer | $SiH_4$ | 10→100* | 300 | 10 | 0.4 | 0.2 |
| | $CH_4$ | 2→25* | | | | |
| | $H_2$ | 5→200* | | | | |
| | $AlCl_3$/He | | | | | |
| | (S-side:0.05 μm) | 200→40** | | | | |
| | (UL-side:0.15 μm) | 40→10** | | | | |

TABLE 319-continued

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| | | $Cu(C_4H_7N_2O_2)_2$/He | 5 | | | | |
| | | NO | 0.5 | | | | |
| | | $SiF_4$ | 0.5 | | | | |
| | | $B_2H_6$ (against $SiH_4$) | 100 ppm | | | | |
| | | $H_2S$ (against $SiH_4$) | 0.6 ppm | | | | |
| Upper layer | 1st layer region | $SiH_4$ | 100 | 300 | 10 | 0.4 | 3 |
| | | $CH_4$ | 20 | | | | |
| | | $B_2H_6$ (against $SiH_4$) | 1000 ppm | | | | |
| | | $H_2$ | 100 | | | | |
| | | $SiF_4$ | 0.5 | | | | |
| | | $Cu(C_4H_7N_2O_2)_2$/He | 0.5 | | | | |
| | | $AlCl_3$/He | 0.4 | | | | |
| | | NO | 0.4 | | | | |
| | | $H_2S$ (against $SiH_4$) | 0.5 ppm | | | | |
| | 2nd layer region | $SiH_4$ | 300 | 300 | 20 | 0.5 | 20 |
| | | $H_2$ | 500 | | | | |
| | | $B_2H_6$ (against $SiH_4$) | 0.1 ppm | | | | |
| | | $CH_4$ | 1 | | | | |
| | | $Cu(C_4H_7N_2O_2)_2$/He | 0.1 | | | | |
| | | $SiF_4$ | 0.3 | | | | |
| | | $AlCl_3$/He | 0.1 | | | | |
| | | NO | 0.2 | | | | |
| | | $H_2S$ (against $SiH_4$) | 0.3 ppm | | | | |
| | 3rd layer region | $SiH_4$ | 100 | 300 | 15 | 0.4 | 7 |
| | | $CH_4$ | 600 | | | | |
| | | $PH_3$ (against $SiH_4$) | 3000 ppm | | | | |
| | | $B_2H_6$ (against $SiH_4$) | 0.2 ppm | | | | |
| | | $Cu(C_4H_7N_2O_2)_2$/He | 0.2 | | | | |
| | | $SiF_4$ | 0.3 | | | | |
| | | $AlCl_3$/He | 0.2 | | | | |
| | | NO | 0.1 | | | | |
| | 4th layer region | $SiH_4$ | 40 | 300 | 10 | 0.4 | 0.1 |
| | | $C_4$ | 600 | | | | |
| | | $PH_3$ (against $SiH_4$) | 1.5 ppm | | | | |
| | | $B_2H_6$ (against $SiH_4$) | 1 ppm | | | | |
| | | $Cu(C_4H_7N_2O_2)_2$/He | 1 | | | | |
| | | $SiF_4$ | 5 | | | | |
| | | NO | 1 | | | | |
| | | $AlCl_3$/He | 1 | | | | |
| | | $H_2S$ (against $SiH_4$) | 1 ppm | | | | |

TABLE 320

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 50 | 250 | 1 | 0.4 | 0.02 |
| | | $H_2$ | 5→200* | | | | |
| | | $AlCl_3$/He | | | | | |
| | | (S-side:0.01 μm) | 200→30** | | | | |
| | | (UL-side:0.01 μm) | 30→10** | | | | |
| | | $B_2H_6$ (against $SiH_4$) | 100 ppm | | | | |
| | | $C_2H_2$ | 1 | | | | |
| | | NO | 5 | | | | |
| | | $SiF_4$ | 1 | | | | |
| | | $Cu(C_4H_7N_2O_2)_2$/He | 5 | | | | |
| Upper layer | 1st layer region | $SiH_4$ | 100 | 300 | 10 | 0.35 | 3 |
| | | $H_2$ | 150 | | | | |
| | | $Cu(C_4H_7N_2O_2)_2$/He | 0.5 | | | | |
| | | $B_2H_6$ (against $SiH_4$) | 800 ppm | | | | |
| | | $AlCl_3$/He | 0.4 | | | | |
| | | $SiF_4$ | 0.5 | | | | |
| | | NO | 10 | | | | |
| | | $C_2H_2$ | 0.5 | | | | |
| | 2nd layer region | $SiH_4$ | 300 | 300 | 20 | 0.5 | 5 |
| | | $H_2$ | 300 | | | | |
| | | $C_2H_2$ | 0.1 | | | | |
| | | $Cu(C_4H_7N_2O_2)_2$/He | 0.1 | | | | |
| | | $B_2H_6$ (against $SiH_4$) | 0.2 ppm | | | | |
| | | $AlCl_3$/He | 0.1 | | | | |
| | | $SiF_4$ | 0.3 | | | | |
| | | NO | 0.1 | | | | |
| | 3rd layer region | $SiH_4$ | 100 | 300 | 15 | 0.4 | 20 |
| | | $C_2H_2$ | 15 | | | | |
| | | $Cu(C_4H_7N_2O_2)_2$/He | 0.1 | | | | |
| | | $B_2H_6$ (against $SiH_4$) | 0.3 ppm | | | | |
| | | $AlCl_3$/He | 0.2 | | | | |

TABLE 320-continued

| Order of lamination (layer name) | | Gases and their flow rates (SCCM) | | Substrate temperature (°C.) | RF discharging power (mW/cm$^3$) | Inner pressure (Torr) | Layer thickness (μm) |
|---|---|---|---|---|---|---|---|
| | | $SiF_4$ | 0.5 | | | | |
| | | NO | 0.2 | | | | |
| | 4th layer region | $SiH_4$ | 50 | 300 | 10 | 0.4 | 0.5 |
| | | $C_2H_2$ | 30 | | | | |
| | | Cu $(C_4H_7N_2O_2)_2$/He | 1 | | | | |
| | | $B_2H_6$ (against $SiH_4$) | 1 ppm | | | | |
| | | $AlCl_3$/He | 1 | | | | |
| | | $SiF_4$ | 0.5 | | | | |
| | | NO | 1 | | | | |

TABLE 321

| Order of lamination (layer name) | | Gases and their flow rates (SCCM) | | Substrate temperature (°C.) | RF discharging power (mW/cm$^3$) | Inner pressure (Torr) | Layer thickness (μm) |
|---|---|---|---|---|---|---|---|
| Lower layer | | $SiH_4$ | 50 | 250 | 1 | 0.4 | 145 0.02 |
| | | $H_2$ | 5→200* | | | | |
| | | $AlCl_3$/He | | | | | |
| | | (S-side:0.01 μm) | 200→30** | | | | |
| | | (UL-side:0.01 μm) | 30→10** | | | | |
| | | $B_2H_6$ (against $SiH_4$) | 100 ppm | | | | |
| | | Cu $(C_4H_7N_2O_2)_2$/He | 10→5** | | | | |
| | | $C_2H_2$ | 3 | | | | |
| | | NO | 1 | | | | |
| | | $SiF_4$ | 5 | | | | |
| Upper layer | 1st layer region | $SiH_4$ | 100 | 300 | 10 | 0.35 | 3 |
| | | $H_2$ | 150 | | | | |
| | | Cu $(C_4H_7N_2O_2)_2$/He | 0.5 | | | | |
| | | $B_2H_6$ (against $SiH_4$) | 800 ppm | | | | |
| | | $AlCl_3$/He | 0.4 | | | | |
| | | $SiF_4$ | 0.5 | | | | |
| | | NO | 10 | | | | |
| | | $C_2H_2$ | 0.3 | | | | |
| | and layer region | $SiH_4$ | 300 | 300 | 20 | 0.5 | 7 |
| | | $H_2$ | 300 | | | | |
| | | NO | 2 | | | | |
| | | Cu $(C_4H_7N_2O_2)_2$/He | 0.2 | | | | |
| | | $B_2H_6$ (against $SiH_4$) | 0.2 ppm | | | | |
| | | $SiF_4$ | 0.4 | | | | |
| | | $AlCl_3$/He | 0.2 | | | | |
| | | $C_2H_2$ | 0.3 | | | | |
| | 3rd layer region | $SiH_4$ | 100 | 300 | 15 | 0.4 | 20 |
| | | $C_2H_2$ | 15 | | | | |
| | | Cu $(C_4H_7N_2O_2)_2$/He | 0.1 | | | | |
| | | $B_2H_6$ (against $SiH_4$) | 0 ppm | | | | |
| | | $SiF_4$ | 0.3 | | | | |
| | | $AlCl_3$/He | 0.1 | | | | |
| | | NO | 0.1 | | | | |
| | 4th layer region | $SiH_4$ | 50 | 300 | 10 | 0.4 | 0.5 |
| | | $C_2H_2$ | 30 | | | | |
| | | Cu $(C_4H_7N_2O_2)_2$/He | 1 | | | | |
| | | $B_2H_6$ (against $SiH_4$) | 1 ppm | | | | |
| | | $SiF_4$ | 0.5 | | | | |
| | | $AlCl_3$/He | 1 | | | | |
| | | NO | 0.5 | | | | |

TABLE 322

| Order of lamination (layer name) | Gases and their flow rates (SCCM) | | Substrate temperature (°C.) | RF discharging power (mW/cm$^3$) | Inner pressure (Torr) | Layer thickness (μm) |
|---|---|---|---|---|---|---|
| Lower layer | $SiH_4$ | 50 | 250 | 1 | 0.4 | 0.02 |
| | $H_2$ | 5→200* | | | | |
| | $AlCl_3$/He | | | | | |
| | (S-side:0.01 μm) | 200→30** | | | | |
| | (UL-side:0.01 μm) | 30→10** | | | | |
| | Mg $(C_2H_5)_2$/He | 5 | | | | |
| | $C_2H_2$ | 3 | | | | |

TABLE 322-continued

| Order of lamination (layer name) | | Gases and their flow rates (SCCM) | | Substrate temperature (°C.) | RF discharging power (mW/cm$^3$) | Inner pressure (Torr) | Layer thickness (μm) |
|---|---|---|---|---|---|---|---|
| | | NO | 5 | | | | |
| | | $SiF_4$ | 5 | | | | |
| | | Cu $(C_4H_7N_2O_2)_2$/He | 3 | | | | |
| Upper layer | 1st layer region | Mg $(C_2H_5)_2$/He | 0.5 | 300 | 10 | 0.35 | 3 |
| | | $SiH_4$ | 100 | | | | |
| | | $H_2$ | 150 | | | | |
| | | $B_2H_6$ (against $SiH_4$) | 800 ppm | | | | |
| | | $AlCl_3$/He | 0.3 | | | | |
| | | $SiF_4$ | 0.5 | | | | |
| | | $C_2H_2$ | 0.3 | | | | |
| | | NO | 10 | | | | |
| | | Cu $(C_4H_7N_2O_2)_2$/He | 0.3 | | | | |
| | 2nd layer region | $SiH_4$ | 300 | 300 | 20 | 0.5 | 3 |
| | | $C_2H_2$ | 0.5→2* | | | | |
| | | $H_2$ | 300 | | | | |
| | | Cu $(C_4H_7N_2O_2)_2$/He | 0.3 | | | | |
| | | $B_2H_6$ (against $SiH_4$) | 0.3 ppm | | | | |
| | | $SiF_4$ | 0.3 | | | | |
| | | Mg $(C_2H_5)_2$/He | 0.2 | | | | |
| | | $AlCl_3$/He | 0.2 | | | | |
| | | NO | 0.3 | | | | |
| | 3rd layer region | $SiH_4$ | 100 | 300 | 15 | 0.4 | 20 |
| | | $C_2H_2$ | 15 | | | | |
| | | Cu $(C_4H_7N_2O_2)_2$/He | 0.1 | | | | |
| | | $B_2H_6$ (against $SiH_4$) | 1 ppm | | | | |
| | | $SiF_4$ | 0.3 | | | | |
| | | $AlCl_3$/He | 0.1 | | | | |
| | | NO | 0.1 | | | | |
| | 4th layer region | $SiH_4$ | 50 | 300 | 10 | 0.4 | 0.5 |
| | | $C_2H_2$ | 30 | | | | |
| | | Cu $(C_4H_7N_2O_2)_2$/He | 0.1 | | | | |
| | | $B_2H_6$ (against $SiH_4$) | 1 ppm | | | | |
| | | $SiF_4$ | 1 | | | | |
| | | $AlCl_3$/He | 1 | | | | |
| | | NO | 0.5 | | | | |
| | | Mg $(C_2H_5)_2$/He | 0.5 | | | | |

TABLE 323

| Order of lamination (layer name) | | Gases and their flow rates (SCCM) | | Substrate temperature (°C.) | RF discharging power (mW/cm$^3$) | Inner pressure (Torr) | Layer thickness (μm) |
|---|---|---|---|---|---|---|---|
| Lower layer | | $SiH_4$ | 10→100* | 250 | 1 | 0.4 | 0.2 |
| | | $H_2$ | 5→200* | | | | |
| | | $AlCl_3$/He | | | | | |
| | | (S-side:0.05 μm) | 200→40** | | | | |
| | | (UL-side:0.05 μm) | 40→10** | | | | |
| | | NO | 5 | | | | |
| | | $C_2H_2$ | 1 | | | | |
| | | Cu $(C_4H_7N_2O_2)_2$/He | 10→0.5** | | | | |
| | | $SiF_4$ | 1 | | | | |
| Upper layer | 1st layer region | $SiH_4$ | 100 | 300 | 10 | 0.35 | 3 |
| | | $H_2$ | 150 | | | | |
| | | $B_2H_6$ (against $SiH_4$) | 800 ppm | | | | |
| | | $SiF_4$ | 0.5 | | | | |
| | | NO | 10 | | | | |
| | | $C_2H_2$ | 0.5 | | | | |
| | | $AlCl_3$/He | 0.5 | | | | |
| | | Cu $(C_4H_7N_2O_2)_2$/He | 0.5 | | | | |
| | 2nd layer region | $SiH_4$ | 300 | 300 | 20 | 0.5 | 8 |
| | | $H_2$ | 300 | | | | |
| | | $AlCl_3$/He | 0.3 | | | | |
| | | $SiF_4$ | 0.3 | | | | |
| | | Cu $(C_4H_7N_2O_2)_2$/He | 0.3 | | | | |
| | | $C_2H_2$ | 0.2 | | | | |
| | | $B_2H_6$ (against $SiH_4$) | 5→0.3 ppm** | | | | |
| | | NO | 0.3 | | | | |
| | 3rd layer region | $SiH_4$ | 100 | 300 | 15 | 0.4 | 20 |
| | | $C_2H_2$ | 15 | | | | |
| | | $SiF_4$ | 0.5 | | | | |
| | | $AlCl_3$/He | 0.1 | | | | |
| | | Cu $(C_4H_7N_2O_2)_2$/He | 0.1 | | | | |
| | | $B_2H_6$ (against $SiH_4$) | 0.1 ppm | | | | |
| | | NO | 0.1 | | | | |
| | 4th layer region | $SiH_4$ | 50 | 300 | 10 | 0.4 | 0.5 |
| | | $C_2H_2$ | 30 | | | | |
| | | NO | 0.5 | | | | |

TABLE 323-continued

| Order of lamination (layer name) | Gases and their flow rates (SCCM) | | Substrate temperature (°C.) | RF discharging power (mW/cm³) | Inner pressure (Torr) | Layer thickness (μm) |
|---|---|---|---|---|---|---|
| | $B_2H_6$ (against $SiH_4$) | 1 ppm | | | | |
| | $AlCl_3$/He | 1 | | | | |
| | $SiF_4$ | 1 | | | | |
| | Cu $(C_4H_7N_2O_2)_2$/He | 0.1 | | | | |

TABLE 324

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 10→100* | 250 | 1 | 0.4 | 0.2 |
| | | $H_2$ | 5→200* | | | | |
| | | $AlCl_3$/He | | | | | |
| | | (S-side: 0.05 μm) | 200→40** | | | | |
| | | (UL-side: 0.15 μm) | 40→10** | | | | |
| | | NO | 5 | | | | |
| | | $SiF_4$ | 1 | | | | |
| | | $B_2H_6$ (against $SiH_4$) | 100 ppm | | | | |
| | | $Cu(C_4H_7N_2O_2)_2$/He | 5 | | | | |
| | | $Mg(C_5H_5)_2$/He | 0.5 | | | | |
| | | $C_2H_2$ | 1 | | | | |
| Upper layer | 1st layer region | $Cu(C_4H_7N_2O_2)_2$/He | 0.5 | 300 | 10 | 0.35 | 3 |
| | | $SiH_4$ | 100 | | | | |
| | | $H_2$ | 150 | | | | |
| | | $B_2H_6$ (against $SiH_4$) | 800 ppm | | | | |
| | | $AlCl_3$/He | 0.4 | | | | |
| | | $SiF_4$ | 0.5 | | | | |
| | | NO | 10 | | | | |
| | | $C_2H_2$ | 0.5 | | | | |
| | | $Mg(C_5H_5)_2$/He | 0.4 | | | | |
| | 2nd layer region | $AlCl_3$/He | 0.3 | 300 | 20 | 0.5 | 5 |
| | | $SiH_4$ | 300 | | | | |
| | | $SiF_4$ | 0.3 | | | | |
| | | $H_2$ | 300 | | | | |
| | | NO | 0.2 | | | | |
| | | $C_2H_2$ | 0.2 | | | | |
| | | $Mg(C_5H_5)_2$/He | 0.2 | | | | |
| | | $Cu(C_4H_7N_2O_2)_2$/He | 0.3 | | | | |
| | | $B_2H_6$ (against $SiH_4$) | 0.3 ppm | | | | |
| | 3rd layer region | $Mg(C_5H_5)_2$/He | 0.1 | 300 | 15 | 0.4 | 20 |
| | | $SiF_4$ | 0.3 | | | | |
| | | $AlCl_3$/He | 0.1 | | | | |
| | | $SiH_4$ | 100 | | | | |
| | | $C_2H_2$ | | | | | |
| | | (U · 2nd LR-side: 1 μm) | 0.1→15* | | | | |
| | | (U · 4th LR-side: 19 μm) | 15 | | | | |
| | | $B_2H_6$ (against $SiH_4$) | 0.1 ppm | | | | |
| | | $Cu(C_4H_7N_2O_2)_2$/He | 0.1 | | | | |
| | | NO | 0.1 | | | | |
| | 4th layer region | $SiH_4$ | 50 | 300 | 10 | 0.4 | 0.5 |
| | | $C_2H_2$ | 30 | | | | |
| | | $SiF_4$ | 1 | | | | |
| | | $B_2H_6$ (against $SiH_4$) | 1 ppm | | | | |
| | | $AlCl_3$/He | 1 | | | | |
| | | NO | 1 | | | | |
| | | $Mg(C_5H_5)_2$/He | 0.1 | | | | |
| | | $Cu(C_4H_7N_2O_2)_2$/He | 1 | | | | |

TABLE 325

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 20 | 250 | 1 | 0.4 | 0.02 |
| | | $H_2$ | 5→200* | | | | |
| | | $AlCl_3$/He | | | | | |
| | | (S-side: 0.01 μm) | 80→15** | | | | |
| | | (UL-side: 0.01 μm) | 15→5** | | | | |
| | | $C_2H_2$ | 5 | | | | |
| | | $Cu(C_4H_7N_2O_2)_2$/He | 5 | | | | |
| | | NO | 10 | | | | |
| Upper layer | 1st layer region | $SiH_4$ | 100 | 300 | 10 | 0.35 | 3 |
| | | $H_2$ | 150 | | | | |
| | | $B_2H_6$ (against $SiH_4$) | 800 ppm | | | | |
| | | $AlCl_3$/He | 0.4 | | | | |

TABLE 325-continued

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| | | NO | 10 | | | | |
| | | $C_2H_2$ | 0.5 | | | | |
| | | $SiF_4$ | 0.5 | | | | |
| | | $Cu(C_4H_7N_2O_2)_2$/He | 0.4 | | | | |
| | 2nd | $SiH_4$ | 300 | 300 | 20 | 0.5 | 2 |
| | layer | $H_2$ | 300 | | | | |
| | region | NO | 0.2 | | | | |
| | | $C_2H_2$ | 0.3 | | | | |
| | | $B_2H_6$ (against $SiH_4$) | 0.2 ppm | | | | |
| | | $AlCl_3$/He | 0.1 | | | | |
| | | $SiF_4$ | 0.5 | | | | |
| | | $Cu(C_4H_7N_2O_2)_2$/He | 0.4 | | | | |
| | 3rd | $SiH_4$ | 100 | 300 | 15 | 0.4 | 20 |
| | layer | $C_2H_2$ | | | | | |
| | region | (U · 2nd LR-side: 5 μm) | 0.1→13* | | | | |
| | | (U · 4th LR-side: 15 μm) | 13→17* | | | | |
| | | NO | 0.3 | | | | |
| | | $B_2H_6$ (against $SiH_4$) | 0.3 ppm | | | | |
| | | $SiF_4$ | 0.1 | | | | |
| | | $AlCl_3$/He | 0.1 | | | | |
| | | $Cu(C_4H_7N_2O_2)_2$/He | 0.1 | | | | |
| | 4th | $SiH_4$ | 50 | 300 | 10 | 0.4 | 0.5 |
| | layer | $C_2H_2$ | 30 | | | | |
| | region | NO | 1 | | | | |
| | | $B_2H_6$ (against $SiH_4$) | 2 ppm | | | | |
| | | $SiF_4$ | 1 | | | | |
| | | $AlCl_3$He | 1 | | | | |
| | | $Cu(C_4H_7N_2O_2)_2$/He | 1 | | | | |

TABLE 326

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 50 | 250 | 5 | 0.4 | 0.02 |
| | | $H_2$ | 5→20* | | | | |
| | | $AlCl_3$/He | | | | | |
| | | (S-side: 0.01 μm) | 200→30** | | | | |
| | | (UL-side: 0.01 μm) | 30→10** | | | | |
| | | NO | 5 | | | | |
| | | $B_2H_6$ (against $SiH_4$) | 100 ppm | | | | |
| | | $Cu(C_4H_7N_2O_2)_2$/He | 3 | | | | |
| | | $C_2H_2$ | 3 | | | | |
| | | $SiF_4$ | 5 | | | | |
| Upper layer | 1st layer region | $SiH_4$ | 100 | 300 | 10 | 0.35 | 3 |
| | | $H_2$ | 150 | | | | |
| | | $B_2H_6$ (against $SiH_4$) | 800 ppm | | | | |
| | | $AlCl_3$/He | 0.3 | | | | |
| | | $SiF_4$ | 0.5 | | | | |
| | | NO | 10 | | | | |
| | | $C_2H_2$ | 0.3 | | | | |
| | | $Cu(C_4H_7N_2O_2)_2$/He | 0.4 | | | | |
| | 2nd layer region | $SiH_4$ | 300 | 300 | 20 | 0.5 | 5 |
| | | $H_2$ | 300 | | | | |
| | | NO | 0.1 | | | | |
| | | $C_2H_2$ | 0.2 | | | | |
| | | $B_2H_6$ (against $SiH_4$) | 0 ppm | | | | |
| | | $SiF_4$ | 0.5 | | | | |
| | | $AlCl_3$/He | 0.3 | | | | |
| | | $Cu(C_4H_7N_2O_2)_2$/He | 0.2 | | | | |
| | 3rd | $SiH_4$ | | 300 | 15 | 0.4 | 20 |
| | layer | (U · 2nd LR-side: 19 μm) | 100 | | | | |
| | region | (U · 4th LR-side: 1 μm) | 100→50** | | | | |
| | | $SiF_4$ | 0.3 | | | | |
| | | $AlCl_3$/He | 0.1 | | | | |
| | | NO | 0.1 | | | | |
| | | $C_2H_2$ | | | | | |
| | | (U · 2nd LR-side: 19 μm) | 15 | | | | |
| | | (U · 4th LR-side: 1 μm) | 15→30** | | | | |
| | | $B_2H_6$ (against $SiH_4$) | 0.1 ppm | | | | |
| | | $Cu(C_4H_7N_2O_2)_2$/He | 0.1 | | | | |
| | 4th | $SiH_4$ | 50 | 300 | 10 | 0.4 | 0.5 |
| | layer | $C_2H_2$ | 30 | | | | |
| | region | $B_2H_6$ (against $SiH_4$) | 1 ppm | | | | |
| | | NO | 1 | | | | |
| | | $SiF_4$ | 0.5 | | | | |
| | | $AlCl_3$/He | 0.7 | | | | |

TABLE 326-continued

| Order of lamination (layer name) | Gases and their flow rates (SCCM) | Substrate temperature (°C.) | RF discharging power (mW/cm³) | Inner pressure (Torr) | Layer thickness (μm) |
|---|---|---|---|---|---|
| | $Cu(C_4H_7N_2O_2)_2$/He | 1 | | | |

TABLE 327

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 50 | 250 | 5 | 0.4 | 0.05 |
| | | $B_2H_6$ (against $SiH_4$) | 100 ppm | | | | |
| | | NO | 5 | | | | |
| | | $C_2H_2$ | 10 | | | | |
| | | $H_2$ | 5→200* | | | | |
| | | $AlCl_3$/He | 200→20** | | | | |
| | | $SiF_4$ | 1 | | | | |
| | | $Cu(C_4H_7N_2O_2)_2$/He | 10→5** | | | | |
| Upper layer | 1st layer region | $Cu(C_4H_7N_2O_2)_2$/He | 0.4 | 300 | 10 | 0.35 | 3 |
| | | $SiH_4$ | 100 | | | | |
| | | $H_2$ | 150 | | | | |
| | | $B_2H_6$ (against $SiH_4$) | 800 ppm | | | | |
| | | $AlCl_3$/He | 0.3 | | | | |
| | | $SiF_4$ | 0.5 | | | | |
| | | NO | 10 | | | | |
| | | $C_2H_2$ | 0.4 | | | | |
| | 2nd layer region | $AlCl_3$/He | 0.2 | 300 | 20 | 0.5 | 5 |
| | | $SiF_4$ | 0.2 | | | | |
| | | $SiH_4$ | 300 | | | | |
| | | $H_2$ | 300 | | | | |
| | | NO | 0.2 | | | | |
| | | $Cu(C_4H_7N_2O_2)_2$/He | 0.2 | | | | |
| | | $C_2H_2$ | 0.1 | | | | |
| | | $B_2H_6$ (against $SiH_4$) | 0.1 ppm | | | | |
| | 3rd layer region | $SiF_4$ | 0.3 | 300 | 15 | 0.4 | 20 |
| | | $SiH_4$ | 100 | | | | |
| | | $AlCl_3$/He | 0.1 | | | | |
| | | $C_2H_2$ | 15 | | | | |
| | | $Cu(C_4H_7N_2O_2)_2$/He | 0.1 | | | | |
| | | $B_2H_6$ (against $SiH_4$) | 10 ppm | | | | |
| | | NO | 0.1 | | | | |
| | 4th layer region | $SiH_4$ | 50 | 300 | 10 | 0.4 | 0.5 |
| | | $C_2H_2$ | 30 | | | | |
| | | NO | 0.5 | | | | |
| | | $B_2H_6$ (against $SiH_4$) | 1 ppm | | | | |
| | | $AlCl_3$/He | 1 | | | | |
| | | $SiF_4$ | 0.5 | | | | |
| | | $Cu(C_4H_7N_2O_2)_2$/He | 1 | | | | |

TABLE 328

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 20 | 300 | 0.3 | 0.2 | 0.02 |
| | | NO | 2 | | | | |
| | | $B_2H_6$ (against $SiH_4$) | 100 ppm | | | | |
| | | $H_2$ | 5→100* | | | | |
| | | $AlCl_3$/He | | | | | |
| | | (S-side: 0.01 μm) | 80→15** | | | | |
| | | (UL-side: 0.01 μm) | 15→5** | | | | |
| | | $Cu(C_4H_7N_2O_2)_2$/He | 10 | | | | |
| | | $C_2H_2$ | 1 | | | | |
| | | $SiF_4$ | 3 | | | | |
| Upper layer | 1st layer region | $SiH_4$ | 100 | 300 | 10 | 0.35 | 3 |
| | | $H_2$ | 150 | | | | |
| | | $B_2H_6$ (against $SiH_4$) | 800 ppm | | | | |
| | | $AlCl_3$/He | 0.5 | | | | |
| | | $SiF_4$ | 0.5 | | | | |
| | | NO | 10 | | | | |
| | | $C_2H_2$ | 0.4 | | | | |
| | | $Cu(C_4H_7N_2O_2)_2$/He | 0.5 | | | | |
| | 2nd layer region | $AlCl_3$/He | 0.1 | 300 | 20 | 0.5 | 6 |
| | | $SiF_4$ | 0.1 | | | | |
| | | $SiH_4$ | 300 | | | | |
| | | $H_2$ | 300 | | | | |
| | | NO | 0.1 | | | | |
| | | $C_2H_2$ | 0.1 | | | | |
| | | $Cu(C_4H_7N_2O_2)_2$/He | 0.1 | | | | |

TABLE 328-continued

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| | | $B_2H_6$ (against $SiH_4$) | 0.1 ppm | | | | |
| | 3rd | $SiF_4$ | 0.2 | 300 | 15 | 0.4 | 20 |
| | layer | $AlCl_3$/He | 0.1 | | | | |
| | region | $SiH_4$ | 100 | | | | |
| | | $C_2H_2$ | 15 | | | | |
| | | $Cu(C_4H_7N_2O_2)_2$/He | 0.1 | | | | |
| | | $B_2H_6$ (against $SiH_4$) | 12→1 ppm** | | | | |
| | | NO | 0.1 | | | | |
| | 4th | $SiH_4$ | 50 | 300 | 10 | 0.4 | 0.5 |
| | layer | $C_2H_2$ | 30 | | | | |
| | region | NO | 0.1 | | | | |
| | | $B_2H_6$ (against $SiH_4$) | 1 ppm | | | | |
| | | $SiF_4$ | 1 | | | | |
| | | $AlCl_3$/He | 1 | | | | |
| | | $Cu(C_4H_7N_2O_2)_2$/He | 0.7 | | | | |

TABLE 329

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 50 | 300 | 1 | 0.3 | 0.02 |
| | | NO | 5 | | | | |
| | | $C_2H_2$ | 5 | | | | |
| | | $B_2H_6$ (against $SiH_4$) | 100 ppm | | | | |
| | | $H_2S$ (against $SiH_4$) | 10 ppm | | | | |
| | | $H_2$ | 5→200* | | | | |
| | | $AlCl_3$/He | | | | | |
| | | (S-side: 0.01 μm) | 200→30** | | | | |
| | | (UL-side: 0.01 μm) | 30→10** | | | | |
| | | $SiF_4$ | 5 | | | | |
| | | $Cu(C_4H_7N_2O_2)_2$/He | 10 | | | | |
| Upper layer | 1st layer region | $SiH_4$ | 100 | 300 | 10 | 0.35 | 3 |
| | | $H_2$ | 150 | | | | |
| | | $B_2H_6$ (against $SiH_4$) | 800 ppm | | | | |
| | | $AlCl_3$/He | 0.4 | | | | |
| | | $SiF_4$ | 1 | | | | |
| | | NO | 10 | | | | |
| | | $H_2S$ (against $SiH_4$) | 0.3 ppm | | | | |
| | | $C_2H_2$ | 0.5 | | | | |
| | | $Cu(C_4H_7N_2O_2)_2$/He | 0.1 | | | | |
| | 2nd layer region | $AlCl_3$/He | 0.1 | 300 | 20 | 0.5 | 5 |
| | | $SiF_4$ | 0.1 | | | | |
| | | $SiH_4$ | 300 | | | | |
| | | $H_2$ | 300 | | | | |
| | | $H_2S$ (against $SiH_4$) | 0.1 ppm | | | | |
| | | $Cu(C_4H_7N_2O_2)_2$/He | 0.1 | | | | |
| | | $C_2H_2$ | 0.1 | | | | |
| | | NO | 0.1 | | | | |
| | | $B_2H_6$ (against $SiH_4$) | 0.1 ppm | | | | |
| | 3rd layer region | $SiF_4$ | 0.1 | 300 | 15 | 0.4 | 20 |
| | | $AlCl_3$/He | 0.1 | | | | |
| | | $SiH_4$ | 100 | | | | |
| | | $C_2H_2$ | 15 | | | | |
| | | NO | 0.1 | | | | |
| | | $Cu(C_4H_7N_2O_2)_2$/He | 0.1 | | | | |
| | | $B_2H_6$ (against $SiH_4$) | 0.2 ppm | | | | |
| | | $PH_3$ (against $SiH_4$) | 8 ppm | | | | |
| | | $H_2S$ (against $SiH_4$) | 0.1 ppm | | | | |
| | 4th layer region | $SiH_4$ | 50 | 300 | 10 | 0.4 | 0.5 |
| | | $C_2H_2$ | 30 | | | | |
| | | NO | 0.5 | | | | |
| | | $Cu(C_4H_7N_2O_2)_2$/He | 1 | | | | |
| | | $B_2H_6$ (against $SiH_4$) | 1 ppm | | | | |
| | | $SiF_4$ | 0.5 | | | | |
| | | $H_2S$ (against $SiH_4$) | 1 ppm | | | | |
| | | $AlCl_3$/He | 1 | | | | |
| | | $PH_3$ (against $SiH_4$) | 1 ppm | | | | |

TABLE 330

| Order of lamination (layer name) | Gases and their flow rates (SCCM) | | Substrate temperature (°C.) | RF discharging power (mW/cm³) | Inner pressure (Torr) | Layer thickness (μm) |
|---|---|---|---|---|---|---|
| Lower layer | $SiH_4$ | 50 | 250 | 1 | 0.4 | 0.02 |
| | NO | 5 | | | | |

TABLE 330-continued

| Order of lamination (layer name) | | Gases and their flow rates (SCCM) | | Substrate temperature (°C.) | RF discharging power (mW/cm$^3$) | Inner pressure (Torr) | Layer thickness (μm) |
|---|---|---|---|---|---|---|---|
| | | $SiF_4$ | 5 | | | | |
| | | $H_2$ | 5→200* | | | | |
| | | $AlCl_3$/He | | | | | |
| | | (S-side: 0.01 μm) | 200→30** | | | | |
| | | (UL-side: 0.01 μm) | 30→10** | | | | |
| | | $Cu(C_4H_7N_2O_2)_2$/He | 10→5** | | | | |
| | | $C_2H_2$ | 0.1 | | | | |
| Upper layer | 1st layer region | $SiH_4$ | 100 | 300 | 10 | 0.35 | 3 |
| | | $H_2$ | 150 | | | | |
| | | $B_2H_6$ (against $SiH_4$) | 800 ppm | | | | |
| | | $AlCl_3$/He | 0.5 | | | | |
| | | $SiF_4$ | 0.5 | | | | |
| | | NO | 10 | | | | |
| | | $C_2H_2$ | 0.5 | | | | |
| | | $Cu(C_4H_7N_2O_2)_2$/He | 0.4 | | | | |
| | 2nd layer region | $AlCl_3$/He | 0.1 | 300 | 20 | 0.5 | 5 |
| | | $SiF_4$ | 0.1 | | | | |
| | | $SiH_4$ | 300 | | | | |
| | | $H_2$ | 300 | | | | |
| | | NO | 0.1 | | | | |
| | | $C_2H_2$ | 0.1 | | | | |
| | | $Cu(C_4H_7N_2O_2)_2$/He | 0.1 | | | | |
| | | $B_2H_6$ (against $SiH_4$) | 0.1 ppm | | | | |
| | 3rd layer region | $SiF_4$ | 0.2 | 300 | 15 | 0.4 | 20 |
| | | $AlCl_3$/He | 0.2 | | | | |
| | | $SiH_4$ | 100 | | | | |
| | | $C_2H_2$ | 15 | | | | |
| | | $Cu(C_4H_7N_2O_2)_2$/He | 0.1 | | | | |
| | | $B_2H_6$ (against $SiH_4$) | 0.3 ppm | | | | |
| | | $PH_3$ (against $SiH_4$) | 10→1 ppm** | | | | |
| | | NO | 0.1 | | | | |
| | 4th layer region | $SiH_4$ | 50 | 300 | 15 | 0.4 | 0.5 |
| | | $C_2H_2$ | 30 | | | | |
| | | $B_2H_6$ (against $SiH_4$) | 0.3 ppm | | | | |
| | | $Cu(C_4H_7N_2O_2)_2$/He | 1 | | | | |
| | | $SiF_4$ | 0.5 | | | | |
| | | NO | 0.5 | | | | |
| | | $AlCl_3$/He | 0.1 | | | | |
| | | $PH_3$ (against $SiH_4$) | 1 ppm | | | | |

TABLE 331

| Order of lamination (layer name) | | Gases and their flow rates (SCCM) | | Substrate temperature (°C.) | RF discharging power (mW/cm$^3$) | Inner pressure (Torr) | Layer thickness (μm) |
|---|---|---|---|---|---|---|---|
| Lower layer | | $SiH_4$ | 50 | 250 | 5 | 0.4 | 0.02 |
| | | NO | 5 | | | | |
| | | $C_2H_2$ | 0.5 | | | | |
| | | $H_2$ | 10→200* | | | | |
| | | $AlCl_3$/He | | | | | |
| | | (S-side: 0.01 μm) | 100→10** | | | | |
| | | (UL-side: 0.01 μm) | 10 | | | | |
| | | $H_2S$ (against $SiH_4$) | 1 ppm | | | | |
| | | $Cu(C_4H_7N_2O_2)_2$/He | 3 | | | | |
| | | $SiF_4$ | 3 | | | | |
| Upper layer | 1st layer region | $SiH_4$ | 100 | 300 | 10 | 0.35 | 3 |
| | | $H_2$ | 150 | | | | |
| | | $B_2H_6$ (against $SiH_4$) | 800 ppm | | | | |
| | | $AlCl_3$/He | 0.4 | | | | |
| | | $SiF_4$ | 0.5 | | | | |
| | | NO | 10 | | | | |
| | | $C_2H_2$ | 0.4 | | | | |
| | | $Cu(C_4H_7N_2O_2)_2$/He | 0.5 | | | | |
| | | $H_2S$ (against $SiH_4$) | 0.5 ppm | | | | |
| | 2nd layer region | $AlCl_3$/He | 0.1 | 300 | 20 | 0.5 | 5 |
| | | $SiF_4$ | 0.1 | | | | |
| | | $SiH_4$ | 300 | | | | |
| | | $H_2$ | 300 | | | | |
| | | $Cu(C_4H_7N_2O_2)_2$/He | 0.1 | | | | |
| | | NO | 0.1 | | | | |
| | | $C_2H_2$ | 0.1 | | | | |
| | | $B_2H_6$ (against $SiH_4$) | 0.2 ppm | | | | |
| | | $H_2S$ (against $SiH_4$) | 0.1 ppm | | | | |
| | 3rd layer region | $SiF_4$ | 0.5 | 300 | 15 | 0.4 | 20 |
| | | $AlCl_3$/He | 0.2 | | | | |
| | | $SiH_4$ | 100 | | | | |
| | | $C_2H_2$ | 15 | | | | |

TABLE 331-continued

| Order of lamination (layer name) | | Gases and their flow rates (SCCM) | | Substrate temperature (°C.) | RF discharging power (mW/cm$^3$) | Inner pressure (Torr) | Layer thickness (μm) |
|---|---|---|---|---|---|---|---|
| | | NO | 0.2 | | | | |
| | | $B_2H_6$ (against $SiH_4$) | 0.3 ppm | | | | |
| | | $Cu(C_4H_7N_2O_2)_2$/He | 0.1 | | | | |
| | | $H_2S$(against $SiH_4$) | 0.1 ppm | | | | |
| | 4th layer region | $SiH_4$ | 50 | 300 | 10 | 0.4 | 0.5 |
| | | $C_2H_2$ | 30 | | | | |
| | | NO | 0.5 | | | | |
| | | $Cu(C_4H_7N_2O_2)_2$/He | 1 | | | | |
| | | $B_2H_6$ (against $SiH_4$) | 1 ppm | | | | |
| | | $SiF_4$ | 0.5 | | | | |
| | | $AlCl_3$/He | 1 | | | | |
| | | $H_2S$ (against $SiH_4$) | 1 ppm | | | | |

TABLE 332

| Order of lamination (layer name) | | Gases and their flow rates (SCCM) | | Substrate temperature (°C.) | RF discharging power (mW/cm$^3$) | Inner pressure (Torr) | Layer thickness (μm) |
|---|---|---|---|---|---|---|---|
| Lower layer | | $SiH_4$ | 50 | 250 | 1 | 0.3 | 0.02 |
| | | NO | 5 | | | | |
| | | $SiF_4$ | 1 | | | | |
| | | $B_2H_6$ (against $SiH_4$) | 100 ppm | | | | |
| | | $H_2$ | 5→200* | | | | |
| | | $AlCl_3$/He | | | | | |
| | | (S-side: 0.01 μm) | 200→30** | | | | |
| | | (UL-side: 0.01 μm) | 30→10** | | | | |
| | | $Cu(C_4H_7N_2O_2)_2$/He | 8 | | | | |
| | | $C_2H_2$ | 0.5 | | | | |
| Upper layer | 1st layer region | $SiH_4$ | 100 | 300 | 10 | 0.35 | 3 |
| | | $H_2$ | 150 | | | | |
| | | $B_2H_6$ (against $SiH_4$) | 800 ppm | | | | |
| | | $AlCl_3$/He | 0.5 | | | | |
| | | $SiF_4$ | 0.5 | | | | |
| | | NO | 10 | | | | |
| | | $C_2H_2$ | 0.5 | | | | |
| | | $Cu(C_4H_7N_2O_2)_2$/He | 0.1 | | | | |
| | 2nd layer region | $AlCl_3$/He | 0.1 | 300 | 20 | 0.5 | 5 |
| | | $SiF_4$ | 0.1 | | | | |
| | | $SiH_4$ | 300 | | | | |
| | | $H_2$ | 300 | | | | |
| | | NO | 0.1 | | | | |
| | | $Cu(C_4H_7N_2O_2)_2$/He | 0.1 | | | | |
| | | $C_2H_2$ | 0.1 | | | | |
| | | $B_2H_6$ (against $SiH_4$) | 0.1 ppm | | | | |
| | 3rd layer region | $SiF_4$ | 0.5 | 300 | 15 | 0.4 | 10 |
| | | $SiH_4$ | 100 | | | | |
| | | $C_2H_2$ | 15 | | | | |
| | | $AlCl_3$/He | 0.1 | | | | |
| | | $Cu(C_4H_7N_2O_2)_2$/He | 0.2 | | | | |
| | | $B_2H_6$ (against $SiH_4$) | 0.1 ppm | | | | |
| | | NO | 0.1 | | | | |
| | 4th layer region | $SiH_4$ | 50 | 300 | 10 | 0.4 | 0.5 |
| | | $C_2H_2$ | 30 | | | | |
| | | NO | 0.5 | | | | |
| | | $B_2H_6$ (against $SiH_4$) | 1 ppm | | | | |
| | | $SiF_4$ | 1 | | | | |
| | | $AlCl_3$/He | 1 | | | | |
| | | $Cu(C_4H_7N_2O_2)_2$/He | 0.8 | | | | |

TABLE 333

| Order of lamination (layer name) | Gases and their flow rates (SCCM) | | Substrate temperature (°C.) | RF discharging power (mW/cm$^3$) | Inner pressure (Torr) | Layer thickness (μm) |
|---|---|---|---|---|---|---|
| Lower layer | $SiH_4$ | 50 | 150 | 0.5 | 0.3 | 0.02 |
| | NO | 5 | ↓ | ↓ | | |
| | $SiF_4$ | 1 | 300 | 1.5 | | |
| | $B_2H_6$ (against $SiH_4$) | 100 ppm | | | | |
| | $H_2$ | 5→200* | | | | |
| | $AlCl_3$/He | | | | | |
| | (S-side: 0.01 μm) | 200→30** | | | | |
| | (UL-side: 0.01 μm) | 10 | | | | |
| | | 30→10** | | | | |
| | $C_2H_2$ | 1 | | | | |
| | $Cu(C_4H_7N_2O_2)_2$/He | 2 | | | | |

TABLE 333-continued

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| | | $Mg(C_5H_5)_2$/He | 3 | | | | |
| Upper layer | 1st layer region | $SiH_4$ | 100 | 300 | 10 | 0.35 | 3 |
| | | $H_2$ | 150 | | | | |
| | | $B_2H_6$ (against $SiH_4$) | 800 ppm | | | | |
| | | $AlCl_3$/He | 0.3 | | | | |
| | | $SiF_4$ | 0.5 | | | | |
| | | NO | 10 | | | | |
| | | $C_2H_2$ | 0.4 | | | | |
| | | $Cu(C_4H_7N_2O_2)_2$/He | 0.5 | | | | |
| | | $Mg(C_5H_5)_2$/He | 0.3 | | | | |
| | 2nd layer region | $AlCl_3$/He | 0.1 | 300 | 20 | 0.5 | 5 |
| | | $SiF_4$ | 0.1 | | | | |
| | | $SiH_4$ | 300 | | | | |
| | | $H_2$ | 300 | | | | |
| | | $C_2H_2$ | 0.1 | | | | |
| | | NO | 0.1 | | | | |
| | | $Cu(C_4H_7N_2O_2)_2$/He | 0.1 | | | | |
| | | $B_2H_6$ (against $SiH_4$) | 0.1 ppm | | | | |
| | | $Mg(C_5H_5)_2$/He | 0.2 | | | | |
| | 3rd layer region | $SiF_4$ | 0.2 | 300 | 15 | 0.4 | 30 |
| | | $AlCl_3$/He | 0.1 | | | | |
| | | $SiH_4$ | 100 | | | | |
| | | $C_2H_2$ | 15 | | | | |
| | | NO | 0.1 | | | | |
| | | $Cu(C_4H_7N_2O_2)_2$/He | 0.1 | | | | |
| | | $B_2H_6$ (against $SiH_4$) | 0.1 ppm | | | | |
| | | $Mg(C_5H_5)_2$/He | 0.2 | | | | |
| | 4th layer region | $SiH_4$ | 50 | 300 | 10 | 0.4 | 0.5 |
| | | $C_2H_2$ | 30 | | | | |
| | | NO | 0.5 | | | | |
| | | $Cu(C_4H_7N_2O_2)_2$/He | 0.1 | | | | |
| | | $B_2H_6$ (against $SiH_4$) | 1 ppm | | | | |
| | | $SiF_4$ | 0.5 | | | | |
| | | $AlCl_3$/He | 0.1 | | | | |
| | | $Mg(C_5H_5)_2$/He | 0.5 | | | | |

TABLE 334

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 50 | 250 | 1 | 0.4 | 0.02 |
| | | NO | 5 | | | | |
| | | $SiF_4$ | 0.5 | | | | |
| | | $H_2S$ (against $SiH_4$) | 10 ppm | | | | |
| | | $H_2$ | 5→200* | | | | |
| | | $AlCl_3$/He | | | | | |
| | | (S-side: 0.01 μm) | 200→30** | | | | |
| | | (UL-side: 0.01 μm) | 30→10** | | | | |
| | | $NH_3$ | 0.5 | | | | |
| | | $C_2H_2$ | 0.8 | | | | |
| | | $Cu(C_4H_7N_2O_2)_2$/He | 5 | | | | |
| Upper layer | 1st layer region | $SiH_4$ | 100 | 300 | 10 | 0.35 | 3 |
| | | $H_2$ | 150 | | | | |
| | | $B_2H_6$ (against $SiH_4$) | 800 ppm | | | | |
| | | $AlCl_3$/He | 0.4 | | | | |
| | | $SiF_4$ | 0.5 | | | | |
| | | NO | 10 | | | | |
| | | $C_2H_2$ | 0.4 | | | | |
| | | $Cu(C_4H_7N_2O_2)_2$/He | 0.3 | | | | |
| | | $H_2S$ (against $SiH_4$) | ppm | | | | |
| | | $NH_3$ | 0.3 | | | | |
| | 2nd layer region | $AlCl_3$/He | 0.1 | 300 | 20 | 0.5 | 5 |
| | | $SiF_4$ | 0.1 | | | | |
| | | $SiH_4$ | 300 | | | | |
| | | $H_2$ | 300 | | | | |
| | | NO | 0.1 | | | | |
| | | $C_2H_2$ | 0.1 | | | | |
| | | $Cu(C_4H_7N_2O_2)_2$/He | 0.2 | | | | |
| | | $B_2H_6$ (against $SiH_4$) | 0.1 ppm | | | | |
| | | $H_2S$ (against $SiH_4$) | 0.1 ppm | | | | |
| | | $NH_3$ | 0.1 | | | | |
| | 3rd layer region | $SiF_4$ | 0.5 | 300 | 15 | 0.4 | 20 |
| | | $AlCl_3$/He | 0.1 | | | | |
| | | $SiH_4$ | 100 | | | | |
| | | $Cu(C_4H_7N_2O_2)_2$/He | 0.2 | | | | |
| | | NO | 0.1 | | | | |

TABLE 334-continued

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| | | $C_2H_2$ | 0.1 | | | | |
| | | $B_2H_6$ (against $SiH_4$) | 0.2 ppm | | | | |
| | | $NH_3$ | 100 | | | | |
| | | $H_2S$ (against $SiH_4$) | 0.1 ppm | | | | |
| | 4th layer region | $SiH_4$ | 50 | 300 | 10 | 0.4 | 0.5 |
| | | $C_2H_2$ | 30 | | | | |
| | | NO | 0.5 | | | | |
| | | $B_2H_6$ (against $SiH_4$) | 1 ppm | | | | |
| | | $SiF_4$ | 1 | | | | |
| | | $AlCl_3$/He | 1 | | | | |
| | | $H_2S$ (against $SiH_4$) | 1 ppm | | | | |
| | | $Cu(C_4H_7N_2O_2)_2$/He | 1.5 | | | | |

TABLE 335

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 10→100* | 250 | 5 | 0.4 | 0.2 |
| | | $H_2$ | 5→200* | | | | |
| | | $AlCl_3$/He | | | | | |
| | | (S-side: 0.05 μm) | 200→40** | | | | |
| | | (UL-side: 0.15 μm) | 40→10** | | | | |
| | | $C_2H_2$ | 2 | | | | |
| | | NO | 5→20* | | | | |
| | | $SiF_4$ | 2 | | | | |
| | | $Cu(C_4H_7N_2O_2)_2$/He | 1 | | | | |
| Upper layer | 1st layer region | $SiH_4$ | 100 | 300 | 10 | 0.35 | 3 |
| | | $H_2$ | 150 | | | | |
| | | $B_2H_6$ (against $SiH_4$) | 800 ppm | | | | |
| | | $AlCl_3$/He | 0.5 | | | | |
| | | NO | 10 | | | | |
| | | $SiF_4$ | 0.5 | | | | |
| | | $C_2H_2$ | 0.5 | | | | |
| | | $Cu(C_4H_7N_2O_2)_2$/He | 0.4 | | | | |
| | 2nd layer region | $AlCl_3$/He | 0.1 | 300 | 20 | 0.5 | 10 |
| | | $H_2$ | 300 | | | | |
| | | $SiF_4$ | 20 | | | | |
| | | $SiH_4$ | 300 | | | | |
| | | $C_2H_2$ | 0.1 | | | | |
| | | $B_2H_6$ (against $SiH_4$) | 0.1 ppm | | | | |
| | | NO | 0.1 | | | | |
| | | $Cu(C_4H_7N_2O_2)_2$/He | 0.1 | | | | |
| | 3rd layer region | $AlCl_3$/He | 0.1 | 300 | 15 | 0.4 | 20 |
| | | $SiF_4$ | 10 | | | | |
| | | $SiH_4$ | 100 | | | | |
| | | $N_2$ | 500 | | | | |
| | | NO | 0.1 | | | | |
| | | $C_2H_2$ | 0.1 | | | | |
| | | $B_2H_6$ (against $SiH_4$) | 0.1 ppm | | | | |
| | | $Cu(C_4H_7N_2O_2)_2$/He | 0.1 | | | | |
| | 4th layer region | $SiH_4$ | 50 | 300 | 10 | 0.4 | 0.5 |
| | | $C_2H_2$ | 30 | | | | |
| | | $B_2H_6$ (against $SiH_4$) | 1 ppm | | | | |
| | | $AlCl_3$/He | 1 | | | | |
| | | $SiF_4$ | 3 | | | | |
| | | $Cu(C_4H_7N_2O_2)_2$/He | 1 | | | | |
| | | NO | 1 | | | | |

TABLE 336

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 25 | 300 | 0.5 | 0.2 | 0.02 |
| | | $H_2$ | 5→100* | | | | |
| | | $AlCl_3$/He | | | | | |
| | | (S-side: 0.01 μm) | 100→15** | | | | |
| | | (UL-side: 0.01 μm) | 15→5** | | | | |
| | | $C_2H_2$ | 1 | | | | |
| | | NO | 3 | | | | |
| | | $B_2H_6$ (against $SiH_4$) | 100 ppm | | | | |
| | | $SiF_4$ | 1 | | | | |
| | | $Cu(C_4H_7N_2O_2)_2$/He | 2 | | | | |
| Upper | 1st | $SiH_4$ | 100 | 300 | 10 | 0.35 | 3 |

TABLE 336-continued

| Order of lamination (layer name) | | Gases and their flow rates (SCCM) | | Substrate temperature (°C.) | RF discharging power (mW/cm$^3$) | Inner pressure (Torr) | Layer thickness (μm) |
|---|---|---|---|---|---|---|---|
| layer | layer region | $H_2$ | 150 | | | | |
| | | $B_2H_6$ (against $SiH_4$) | 800 ppm | | | | |
| | | $C_2H_2$ | 0.5 | | | | |
| | | $AlCl_3$/He | 0.4 | | | | |
| | | NO | 10 | | | | |
| | | $SiF_4$ | 0.5 | | | | |
| | | $Cu(C_4H_7N_2O_2)_2$/He | 0.4 | | | | |
| | 2nd layer region | $SiF_4$ | 0.5 | 300 | 15 | 0.4 | 20 |
| | | $SiH_4$ | 100 | | | | |
| | | $C_2H_2$ | 15 | | | | |
| | | $AlCl_3$/He | 0.1 | | | | |
| | | NO | 0.1 | | | | |
| | | $SnH_4$ | 0.3 | | | | |
| | | $B_2H_6$ (against $SiH_4$) | 0.1 ppm | | | | |
| | | $Cu(C_4H_7N_2O_2)_2$/He | 0.1 | | | | |
| | 3rd layer region | $SiF_4$ | 0.5 | 300 | 20 | 0.5 | 5 |
| | | $SiH_4$ | 300 | | | | |
| | | $H_2$ | 300 | | | | |
| | | $C_2H_2$ | 0.1 | | | | |
| | | $AlCl_3$/He | 0.1 | | | | |
| | | NO | 0.1 | | | | |
| | | $SnH_4$ | 0.2 | | | | |
| | | $B_2H_6$ (against $SiH_4$) | 0.1 ppm | | | | |
| | | $Cu(C_4H_7N_2O_2)_2$/He | 0.1 | | | | |
| | 4th layer region | $SiH_4$ | 50 | 300 | 10 | 0.4 | 0.5 |
| | | $C_2H_2$ | 30 | | | | |
| | | $AlCl_3$/He | 1 | | | | |
| | | $SiF_4$ | 1 | | | | |
| | | NO | 0.5 | | | | |
| | | $SnH_4$ | 1.5 | | | | |
| | | $B_2H_6$ (against $SiH_4$) | 1 ppm | | | | |
| | | $Cu(C_4H_7N_2O_2)_2$/He | 1 | | | | |

TABLE 337

| Order of lamination (layer name) | | Gases and their flow rates (SCCM) | | Substrate temperature (°C.) | RF discharging power (mW/cm$^3$) | Inner pressure (Torr) | Layer thickness (μm) |
|---|---|---|---|---|---|---|---|
| Lower layer | | $SiH_4$ | 50 | 250 | 1 | 0.3 | 0.02 |
| | | $H_2$ | 5→200* | | | | |
| | | $AlCl_3$/He | | | | | |
| | | (S-side: 0.01 μm) | 200→30** | | | | |
| | | (UL-side: 0.01 μm) | 30→10** | | | | |
| | | $C_2H_2$ | 1 | | | | |
| | | NO | 5 | | | | |
| | | $B_2H_6$ (against $SiH_4$) | 100 ppm | | | | |
| | | $Mg(C_5H_5)_2$/He | 2 | | | | |
| | | $SiF_4$ | 0.5 | | | | |
| | | $Cu(C_4H_7N_2O_2)_2$/He | 5 | | | | |
| Upper layer | 1st layer region | $SiH_4$ | 100 | 300 | 10 | 0.35 | 3 |
| | | $H_2$ | 150 | | | | |
| | | $B_2H_6$ (against $SiH_4$) | 800 ppm | | | | |
| | | $C_2H_2$ | 0.4 | | | | |
| | | $AlCl_3$/He | 0.3 | | | | |
| | | NO | 10 | | | | |
| | | $SiF_4$ | 0.5 | | | | |
| | | $Cu(C_4H_7N_2O_2)_2$/He | 0.4 | | | | |
| | | $Mg(C_5H_5)_2$/He | 0.5 | | | | |
| | 2nd layer region | $SiF_4$ | 0.3 | 300 | 15 | 0.4 | 20 |
| | | $SiH_4$ | 100 | | | | |
| | | $C_2H_2$ | 15 | | | | |
| | | $AlCl_3$/He | 0.2 | | | | |
| | | NO | 0.1 | | | | |
| | | $B_2H_6$ (against $SiH_4$) | 10 ppm | | | | |
| | | $Cu(C_4H_7N_2O_2)_2$/He | 0.2 | | | | |
| | | $Mg(C_5H_5)_2$/He | 0.2 | | | | |
| | 3rd layer region | $SiF_4$ | 0.2 | 300 | 20 | 0.5 | 4 |
| | | $SiH_4$ | 300 | | | | |
| | | $H_2$ | 300 | | | | |
| | | $C_2H_2$ | 0.1 | | | | |
| | | $AlCl_3$/He | 0.1 | | | | |
| | | NO | 0.1 | | | | |
| | | $B_2H_6$ (against $SiH_4$) | 0.1 ppm | | | | |
| | | $Cu(C_4H_7N_2O_2)_2$/He | 0.1 | | | | |
| | | $Mg(C_5H_5)_2$/He | 0.2 | | | | |
| | 4th layer | $SiH_4$ | 50 | 300 | 10 | 0.4 | 0.5 |
| | | $C_2H_2$ | 30 | | | | |

TABLE 337-continued

| Order of lamination (layer name) | | Gases and their flow rates (SCCM) | | Substrate temperature (°C.) | RF discharging power (mW/cm$^3$) | Inner pressure (Torr) | Layer thickness (μm) |
|---|---|---|---|---|---|---|---|
| | region | $AlCl_3$/He | 0.1 | | | | |
| | | $SiF_4$ | 0.5 | | | | |
| | | NO | 0.1 | | | | |
| | | $B_2H_6$ (against $SiH_4$) | 0.3 ppm | | | | |
| | | $Cu(C_4H_7N_2O_2)_2$/He | 1 | | | | |
| | | $Mg(C_5H_5)_2$/He | 5 | | | | |

TABLE 338

| Order of lamination (layer name) | | Gases and their flow rates (SCCM) | | Substrate temperature (°C.) | RF discharging power (mW/cm$^3$) | Inner pressure (Torr) | Layer thickness (μm) |
|---|---|---|---|---|---|---|---|
| Lower layer | | $SiH_4$ | 50 | 250 | 1 | 0.4 | 0.02 |
| | | NO | 5 | | | | |
| | | $SiF_4$ | 1 | | | | |
| | | $H_2$ | 10→200* | | | | |
| | | $AlCl_3$/He | 120→40** | | | | |
| | | $Cu(C_4H_7N_2O_2)_2$/He | 10 | | | | |
| | | $C_2H_2$ | 0.8 | | | | |
| | | $Mg(C_5H_5)_2$/He | 5→0.2* | | | | |
| Upper layer | 1st layer region | $SiH_4$ | 100 | 300 | 10 | 0.35 | 3 |
| | | $H_2$ | 150 | | | | |
| | | $B_2H_6$ (against $SiH_4$) | 800 ppm | | | | |
| | | $AlCl_3$/He | 0.5 | | | | |
| | | $SiF_4$ | 0.5 | | | | |
| | | NO | 10 | | | | |
| | | $C_2H_2$ | 0.3 | | | | |
| | | $Cu(C_4H_7N_2O_2)_2$/He | 0.1 | | | | |
| | | $Mg(C_5H_5)_2$/He | 0.2 | | | | |
| | 2nd layer region | $AlCl_3$/He | 0.2 | 300 | 15 | 0.4 | 20 |
| | | $SiF_4$ | 0.5 | | | | |
| | | $SiH_4$ | 100 | | | | |
| | | $C_2H_2$ | 15 | | | | |
| | | NO | 0.1 | | | | |
| | | $PH_3$ (against $SiH_4$) | 8 ppm | | | | |
| | | $B_2H_6$ (against $SiH_4$) | 0.1 ppm | | | | |
| | | $Cu(C_4H_7N_2O_2)_2$/He | 0.1 | | | | |
| | | $Mg(C_5H_5)_2$/He | 0.2 | | | | |
| | 3rd layer region | $AlCl_3$/He | 0.1 | 300 | 20 | 0.5 | 6 |
| | | $SiH_4$ | 300 | | | | |
| | | $SiF_4$ | 0.5 | | | | |
| | | $H_2$ | 300 | | | | |
| | | NO | 0.1 | | | | |
| | | $C_2H_2$ | 0.1 | | | | |
| | | $PH_3$ (against $SiH_4$) | 0.1 ppm | | | | |
| | | $B_2H_6$ (against $SiH_4$) | 0.1 ppm | | | | |
| | | $Cu(C_4H_7N_2O_2)_2$/He | 0.1 | | | | |
| | | $Mg(C_5H_5)_2$/He | 0.2 | | | | |
| | 4th layer region | $SiH_4$ | 50 | 300 | 10 | 0.4 | 0.5 |
| | | $C_2H_2$ | 30 | | | | |
| | | NO | 0.1 | | | | |
| | | $B_2H_6$ (against $SiH_4$) | 1 ppm | | | | |
| | | $AlCl_3$/He | 1 | | | | |
| | | $SiF_4$ | 1 | | | | |
| | | $PH_3$ (against $SiH_4$) | 1 ppm | | | | |
| | | $Mg(C_5H_5)_2$/He | 0.5 | | | | |
| | | $Cu(C_4H_7N_2O_2)_2$/He | 1 | | | | |

TABLE 339

| Order of lamination (layer name) | | Gases and their flow rates (SCCM) | | Substrate temperature (°C.) | RF discharging power (mW/cm$^3$) | Inner pressure (Torr) | Layer thickness (μm) |
|---|---|---|---|---|---|---|---|
| Lower layer | | $SiH_4$ | 10→100* | 300 | 10 | 0.4 | 0.2 |
| | | NO | 5→20* | | | | |
| | | $H_2$ | 5→200* | | | | |
| | | $B_2H_6$ (against $SiH_4$) | 100 ppm | | | | |
| | | $AlCl_3$/He | | | | | |
| | | (S-side: 0.05 μm) | 200→0** | | | | |
| | | (UL-side: 0.15 μm) | 40→10** | | | | |
| | | $C_2H_2$ | 1 | | | | |
| | | $SiF_4$ | 1 | | | | |
| | | $Cu(C_4H_7N_2O_2)_2$/He | 5 | | | | |
| Upper layer | 1st layer region | $SiH_4$ | 100 | 300 | 10 | 0.35 | 3 |
| | | $H_2$ | 150 | | | | |
| | | $B_2H_6$ (against $SiH_4$) | 800 ppm | | | | |

TABLE 339-continued

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| | | $AlCl_3$/He | 0.3 | | | | |
| | | NO | 10 | | | | |
| | | $SiF_4$ | 0.5 | | | | |
| | | $C_2H_2$ | 0.4 | | | | |
| | | $Cu(C_4H_7N_2O_2)_2$/He | 0.4 | | | | |
| | 2nd layer region | $AlCl_3$/He | 0.1 | 300 | 15 | 0.4 | 20 |
| | | $SiF_4$ | 0.2 | | | | |
| | | $SiH_4$ | 100 | | | | |
| | | $C_2H_2$ | 15 | | | | |
| | | $B_2H_6$ (against $SiH_4$) | 12→0.1 ppm** | | | | |
| | | NO | 0.1 | | | | |
| | | $Cu(C_4H_7N_2O_2)_2$/He | 0.1 | | | | |
| | 3rd layer region | $AlCl_3$/He | 0.1 | 300 | 20 | 0.5 | 3 |
| | | $SiF_4$ | 0.2 | | | | |
| | | $SiH_4$ | 300 | | | | |
| | | $H_2$ | 300 | | | | |
| | | NO | 0.1 | | | | |
| | | $Cu(C_4H_7N_2O_2)_2$/He | 0.1 | | | | |
| | | $C_2H_2$ | 0.1 | | | | |
| | | $B_2H_6$ (against $SiH_4$) | 0.1 ppm | | | | |
| | 4th layer region | $SiH_4$ | 50 | 300 | 15 | 0.4 | 0.5 |
| | | $C_2H_2$ | 30 | | | | |
| | | NO | 0.5 | | | | |
| | | $B_2H_6$ (against $SiH_4$) | 0.1 ppm | | | | |
| | | $AlCl_3$/He | 1 | | | | |
| | | $SiF_4$ | 1 | | | | |
| | | $Cu(C_4H_7N_2O_2)_2$/He | 1 | | | | |

TABLE 340

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 50 | 300 | 2 | 0.3 | 0.05 |
| | | $H_2$ | 5→200* | | | | |
| | | Al(CH₃)He | | | | | |
| | | (S-side: 0.03 μm) | 200→50** | | | | |
| | | (UL-side: 0.02 μm) | 50→5** | | | | |
| | | $SiF_4$ | 1 | | | | |
| | | NO | 5 | | | | |
| | | $B_2H_6$ (against $SiH_4$) | 100 ppm | | | | |
| | | $CH_4$ | 1 | | | | |
| | | $Cu(C_4H_7N_2O_2)_2$/He | 20→2** | | | | |
| | | $Mg(C_5H_5)_2$/He | 5→1** | | | | |
| Upper layer | 1st layer region | $SiH_4$ | 100 | 300 | 10 | 0.4 | 10 |
| | | $H_2$ | 100 | | | | |
| | | $Cu(C_4H_7N_2O_2)_2$/He | 0.6 | | | | |
| | | $B_2H_6$ (against $SiH_4$) | 1500 ppm | | | | |
| | | $CH_4$ | 5 | | | | |
| | | $SiF_4$ | 5 | | | | |
| | | $Al(CH_3)$He | 0.3 | | | | |
| | | $Mg(C_5H_5)_2$/He | 0.3 | | | | |
| | | NO | | | | | |
| | | (LL-side: 9 μm) | 5 | | | | |
| | | (U · 2nd LR-side: 1 μm) | 5→0.1** | | | | |
| | 2nd layer region | $SiH_4$ | 300 | 300 | 25 | 0.5 | 25 |
| | | $H_2$ | 300 | | | | |
| | | NO | 0.1 | | | | |
| | | $Cu(C_4H_7N_2O_2)_2$/He | 0.1 | | | | |
| | | $B_2H_6$ (against $SiH_4$) | 0.5 ppm | | | | |
| | | $CH_4$ | 1 | | | | |
| | | $SiF_4$ | 1 | | | | |
| | | $Al(CH_3)$He | 0.1 | | | | |
| | | $Mg(C_5H_5)_2$/He | 0.1 | | | | |
| | 3rd layer region | $SiH_4$ | 200 | 300 | 15 | 0.4 | 5 |
| | | $H_2$ | 200 | | | | |
| | | $Cu(C_4H_7N_2O_2)_2$/He | 0.2 | | | | |
| | | $B_2H_6$ (against $SiH_4$) | 0.1 ppm | | | | |
| | | $PH_3$ (against $SiH_4$) | 1000 ppm | | | | |
| | | $SiF_4$ | 1 | | | | |
| | | $Al(CH_3)$He | 0.1 | | | | |
| | | $Mg(C_5H_5)_2$/He | 0.2 | | | | |
| | | NO | 0.1 | | | | |
| | | $CH_4$ | | | | | |
| | | (U · 2nd LR-side: 1 μm) | 1→600* | | | | |
| | | (U · 4th LR-side: 4 μm) | 600 | | | | |
| | 4th | $H_2$ | 200 | 300 | 10 | 0.4 | 0.3 |

TABLE 340-continued

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| | layer region | $SiF_4$ | 5 | | | | |
| | | $Cu(C_4H_7N_2O_2)_2$/He | 0.5 | | | | |
| | | $B_2H_6$ (against $SiH_4$) | 1 ppm | | | | |
| | | $PH_3$ (against $SiH_4$) | 5 ppm | | | | |
| | | NO | 0.5 | | | | |
| | | $CH_4$ | 600 | | | | |
| | | $Al(CH_3)$He | 0.5 | | | | |
| | | $Mg(C_5H_5)_2$/He | 0.5 | | | | |
| | | $SiH_4$ | | | | | |
| | | (U · 3rd LR-side: 0.03 μm) | 200→20** | | | | |
| | | (FS-side: 0.27 μm) | 20 | | | | |

TABLE 341

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 30 | 330 | 1 | 0.01 | 0.05 |
| | | $H_2$ | 5→100* | | | | |
| | | Ar | 100 | | | | |
| Upper layer | 1st layer region | $SiH_4$ | 100 | 250 | 10 | 0.4 | 3 |
| | | $B_2H_6$ (against $SiH_4$) | 800 ppm | | | | |
| | | NO | | | | | |
| | | (LL-side: 2 μm) | 10 | | | | |
| | | (U · 2nd LR-side: 1 μm) | 10→0** | | | | |
| | | $H_2$ | 100 | | | | |
| | 2nd layer region | $SiH_4$ | 300 | 250 | 15 | 0.5 | 20 |
| | | $H_2$ | 300 | | | | |
| | 3rd layer region | $SiH_4$ | 50 | 250 | 10 | 0.4 | 0.5 |
| | | $CH_4$ | 500 | | | | |

TABLE 342

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 5→50* | 250 | 5 | 0.4 | 0.05 |
| | | $H_2$ | 10→200* | | | | |
| | | $Al(CH_3)_3$/He | 120→40** | | | | |
| | | $NaNH_2$/He | 10 | | | | |
| Upper layer | 1st layer region | $SiH_4$ | 100 | 250 | 10 | 0.4 | 3 |
| | | $B_2H_6$ (against $SiH_4$) | 500 ppm | | | | |
| | | NO | 5 | | | | |
| | | $H_2$ | 100 | | | | |
| | 2nd layer region | $SiH_4$ | 300 | 250 | 15 | 0.5 | 20 |
| | | $H_2$ | 300 | | | | |
| | 3rd layer region | $SiH_4$ | 50 | 250 | 10 | 0.4 | 0.5 |
| | | $CH_4$ | 500 | | | | |

TABLE 343

| | Comparative Example 2 | | Example 1 | Example 2 | |
|---|---|---|---|---|---|
| $Al(CH_3)_3$/He Flow rates (sccm) | 120→10** | 120→20** | 120→40** | 120→60** | 120→80** |
| Content of Al (atomic %) | 9 | 14 | 21 | 27 | 35 |
| Ratio of film peeling-off (Example 1 = 1) | 22 | 10 | 1 | 0.95 | 0.93 |

TABLE 344

| Order of lamination | Gases and their flow rates (sccm) | |
|---|---|---|
| Lower layer | $SiF_4$ | 3 |
| | NO | 3 |
| | $CH_4$ | 2 |
| | $B_2H_6$ (against $SiH_4$) | 100 ppm |

TABLE 344-continued

| Order of lamination | | Gases and their flow rates (sccm) | |
|---|---|---|---|
| Upper layer | 1st layer region | $CH_4$ | 2 |
| | | $SiF_4$ | 1 |
| | | $Zn(C_2H_5)_2$/He | 1 |
| | 2nd layer region | $B_2H_6$ (against $SiH_4$) | 0.5 ppm |

TABLE 344-continued

| Order of lamination | Gases and their flow rates (sccm) | |
|---|---|---|
| | NO | 0.1 |
| | $CH_4$ | 1 |
| | $SiF_4$ | 0.2 |
| | $Zn(C_2H_5)_2$/He | 0.3 |
| 3rd layer region | $SiF_4$ | 1 |
| | $B_2H_6$ (against $SiH_4$) | 2 ppm |
| | NO | 0.5 |
| | $Al(CH_3)_3$/He | 0.5 |
| | $Zn(C_2H_5)_2$/He | 1 |

TABLE 345

| Order of lamination (layer name) | | Gases and their flow rates (SCCM) | | Substrate temperature (°C.) | RF discharging power (mW/cm³) | Inner pressure (Torr) | Layer thickness (μm) |
|---|---|---|---|---|---|---|---|
| Lower layer | | $SiH_4$ | 5→50* | 300 | 5 | 0.4 | 0.05 |
| | | $H_2$ | 10→200* | | | | |
| | | $Al(CH_3)_3$/He | 120→40** | | | | |
| | | $Y(oi\text{-}C_3H_7)_3$/He | 10 | | | | |
| Upper layer | 1st layer region | $SiH_4$ | 200 | 300 | 30 | 0.5 | 5 |
| | | $C_2H_2$ | 20 | | | | |
| | | $B_2H_6$ (against $SiH_4$) | 800 ppm | | | | |
| | | $H_2$ | 500 | | | | |
| | 2nd layer region | $SiH_4$ | 200 | 300 | 30 | 0.5 | 5 |
| | | $C_2H_2$ | 20 | | | | |
| | | $B_2H_6$ (against $SiH_4$) | 5 ppm | | | | |
| | | $H_2$ | 300 | | | | |
| | 3rd layer region | $SiH_4$ | 300 | 300 | 15 | 0.5 | 5 |
| | | $H_2$ | 300 | | | | |
| | 4th layer region | $SiH_4$ | 50 | 300 | 10 | 0.4 | 0.5 |
| | | $CH_4$ | 500 | | | | |

TABLE 346

| Order of lamination (layer name) | | Gases and their flow rates (SCCM) | | Substrate temperature (°C.) | μW discharging power (mW/cm³) | Inner pressure (Torr) | Layer thickness (μm) |
|---|---|---|---|---|---|---|---|
| Lower layer | | $SiH_4$ | 15→150* | 250 | 0.5 | 0.6 | 0.07 |
| | | $SiF_4$ | 10→20* | | | | |
| | | $H_2$ | 20→300* | | | | |
| | | $Al(CH_3)_3$/He | 400→50** | | | | |
| | | $NaNH_2$/He | 20 | | | | |
| Upper layer | 1st layer region | $SiH_4$ | 230 | 250 | 0.5 | 0.5 | 3 |
| | | $SiF_4$ | 20 | | | | |
| | | $B_2H_6$ (against $SiH_4$) | 150 ppm | | | | |
| | | NO | 10 | | | | |
| | | $H_2$ | 150 | | | | |
| | 2nd layer region | $SiH_4$ | 700 | 250 | 0.5 | 0.5 | 20 |
| | | $SiF_4$ | 30 | | | | |
| | | $H_2$ | 500 | | | | |
| | 3rd layer region | $SiH_4$ | 150 | 250 | 0.5 | 0.3 | 1 |
| | | $CH_4$ | 500 | | | | |

What is claimed is:

1. An electrophotographic process comprising the steps of:

(a) charging a light receiving member having an aluminum support and a multilayered light receiving layer exhibiting photoconductivity formed on said aluminum support, characterized in that said multilayered light receiving layer comprises: (i) a lower layer (a) in contact with said support and (ii) an upper layer (b) having a free surface disposed of said lower layer (a); said lower layer (a) comprising an inorganic material composed of aluminum atoms, silicon atoms, hydrogen atoms and atoms of an element capable of contributing to the control of image quality selected from the group consisting of boron, gallium, indium, thallium, phosphorous, arsenic, antimony, bismuth, sulfur, selenium, tellurium and polonium; said lower layer (a) having a portion in which said aluminum, silicon and hydrogen atoms are unevenly distributed across the layer thickness; said aluminum atoms being contained in said lower layer (a) such that their content decreases across the layer thickness upward from the interface between said lower layer (a) and said aluminum support and wherein said content of said aluminum atoms is lower than 95 atomic % in the vicinity of the interface between said lower layer (a) and said aluminum support and higher than 5 atomic % in the vicinity of the interface between said lower layer (a) and said upper layer (b); and said upper layer (b) comprising a plurality of layer regions, each said region comprising a non-single-crystal material composed of silicon atoms as the matrix, and wherein the layer region adjacent said lower layer (a) comprises (iii) a non-single-crystal material containing silicon atoms as the matrix, (iv) at least one kind of atom selected from the group consisting of hydrogen atoms and halogen atoms, and (v) at least one kind of atom selected from the group consisting of carbon atoms, nitrogen atoms and oxygen atoms; and (b) irradiating said charged light receiving member with an electromagnetic wave carrying information, thereby forming an electrostatic latent image.

2. The process according to claim 1, wherein the amount of said silicon atoms contained in the lower layer is from 5 to 95 atomic %.

3. The process according to claim 1, wherein the amount of said hydrogen atoms contained in the lower layer is from 0.01 to 70 atomic %.

4. The process according to claim 1, wherein the amount of said atoms capable of contributing to the control of image quality contained in the lower layer is from $1\times10^{-3}$ to $5\times10^{4}$ atomic ppm.

5. The process according to claim 1, wherein the lower layer further contains one kind of atoms selected from the group consisting of carbon atoms, nitrogen atoms and oxygen atoms.

6. The process according to claim 5, wherein the amount of said one kind of atoms contained in the lower layer is from $1\times10^{3}$ to $5\times10^{5}$ ppm.

7. The process according to claim 1, wherein the lower layer further contains a halogen selected from the group consisting of fluorine atoms, chlorine atoms, bromine atoms and iodine atoms.

8. The process according to claim 7, wherein the amount of said halogen contained in the lower layer is from 1 to $4\times10^{5}$ atomic ppm.

9. The process according to claim 5, wherein the lower layer further contains a halogen selected from the group consisting of fluorine atoms, chlorine atoms, bromine atoms and iodine atoms.

10. The process according to claim 9, wherein the amount of said halogen contained in the lower layer is from 1 to $4\times10^{5}$ atomic ppm.

11. The process according to claim 1, wherein the lower layer further contains one kind of atoms selected from the group consisting of germanium atoms and tin atoms.

12. The process according to claim 11, wherein the amount of said one kind of atoms contained in the lower layer is from 1 to $9\times10^{5}$ ppm.

13. The process according to claim 5, wherein the lower layer further contains one kind of atoms selected from the group consisting of germanium atoms and tin atoms.

14. The process according to claim 3, wherein the amount of said one kind of atoms contained in the lower layer is from 1 to $9\times10^{5}$ ppm.

15. The process according to claim 7, wherein the lower layer further contains one kind of atoms selected from the group consisting of germanium atoms and tin atoms.

16. The process according to claim 15, wherein the amount of said one kind of atoms contained in the lower layer is from 1 to $9\times10^{5}$ ppm.

17. The process according to claim 1, wherein the lower layer further contains atoms of a metal selected yttrium, manganese and zinc.

18. The process according to claim 17, wherein the amount of said metal atoms contained in the lower layer is from 1 to $2\times10^{5}$ atomic ppm.

19. The process according to claim 5, wherein the lower layer further contains atoms of a metal selected from the group consisting of magnesium, copper, sodium, yttrium, manganese and zinc.

20. The process according to claim 19, wherein the amount of said metal atoms contained in the lower layer is from 1 to $2\times10^{5}$ atomic ppm.

21. The process according to claim 7, wherein the lower layer further contains atoms of a metal selected from the group consisting of magnesium, copper, sodium, yttrium, manganese and zinc.

22. The process according to claim 21, wherein the amount of said metal atoms contained in the lower layer is from 1 to $2\times10^{5}$ atomic ppm.

23. The process according to claim 11, wherein the lower layer further contains atoms of a metal selected from the group consisting of magnesium, copper, sodium, yttrium, manganese and zinc.

24. The process according to claim 23, wherein the amount of said metal atoms contained in the lower layer is from 1 to $2\times10^{5}$ atomic ppm.

25. The process according to claim 1, wherein the amount of said one kind of atoms selected from the group consisting of carbon atoms, nitrogen atoms and oxygen atoms contained in the layer region of the upper layer (b) adjacent the lower layer (a) is from $9.5\times10^{5}$ atomic ppm.

26. The process according to claim 1, wherein the lower layer is 0.03 to 5 μm thick and the upper layer is 1 to 130 μm thick.

* * * * *

UNITED STATES PATENT AND TRADEMARK OFFICE

CERTIFICATE OF CORRECTION

PATENT NO. : 4,981,766

DATED : January 1, 1991

INVENTOR(S) : TATSUYUKI AOIKE, ET AL.

It is certified that error appears in the above-identified patent and that said Letters Patent is hereby corrected as shown below:

ON THE TITLE PAGE:

IN [57] ABSTRACT

Line 16, "in" (second occurrence) should be deleted.

IN THE DRAWINGS:

SHEET 9 OF 16

FIG. 33, "C322" should read --C332--.

COLUMN 1

Line 47, "Nos. 746967" should read --Nos. 2746967--.
Line 56, "plasma CVD process" (second occurrence) should be deleted.
Line 66, "inter mediate" should read --intermediate--.

COLUMN 2

Line 15, "has" should read --have--.
Line 31, "matters which have" should read --matter which has--.
Line 35, "to" should be deleted.

COLUMN 3

Line 7, "oxygen atoms (O)" should read --oxygen atoms (O)--.
Line 8, "in" should be deleted.
Line 12, "abovementioned" should read --above-mentioned--.
Line 44, "in" should be deleted.
Line 55, "hereinafter." should read --hereinafter).--.

UNITED STATES PATENT AND TRADEMARK OFFICE

CERTIFICATE OF CORRECTION

PATENT NO. : 4,981,766

DATED : January 1, 1991

INVENTOR(S) : TATSUYUKI AOIKE, ET AL.

It is certified that error appears in the above-identified patent and that said Letters Patent is hereby corrected as shown below:

COLUMN 9

Line 33, "shows" should read --show--.
Line 42, "layer will" should read --layer (will--.

COLUMN 10

Line 6, "C" should read --C133--.

COLUMN 11

Line 4, "less" should read --lesser--.
Line 9, "atom-ppm" should read --atom-ppm.--.
Line 15, "contributed" should read --contribute--.
Line 22, "less" should read --lesser--.
Line 34, "hands" should read --bands--.
Line 62, "atom-ppm" should read --atom-ppm.--.

COLUMN 14

Line 25, "a" (second occurrence) should read --an--.
Line 29, "$All_3$," should read --$AlI_3$,--.
Line 68, "include," should read --includes,--.

COLUMN 15

Line 2, "$PF_3$," (second occurrence) should read --$PF_5$,--.
Line 10, "of" should read --or--.
Line 11, "$(CH_3)_2)Se$," should read --$(CH_3)_2Se$,-- and
"$(C_2H_5)_2Se$." should read --$(C_2H_5)_2Se$,--.

UNITED STATES PATENT AND TRADEMARK OFFICE

CERTIFICATE OF CORRECTION

PATENT NO. : 4,981,766

DATED : January 1, 1991

INVENTOR(S) : TATSUYUKI AOIKE, ET AL.

It is certified that error appears in the above-identified patent and that said Letters Patent is hereby corrected as shown below:

COLUMN 15

Line 18, "nitrogen atom" should read --nitrogon atoms--.
Line 32, "ethylene," should read --ethylene--.
Line 39, "propylene)," should read --propylene ($C_3H_6$),--.
Line 42, "),"  should read --($C_2H_2$),--.

COLUMN 16

Line 13, "$Si_2F$" should read --$Si_2F_6$,--.
Line 15, "is" should read --are--.
Line 68, "$Ge_4H_{10}$" should read --$Ge_4aH_{10}$.--.

COLUMN 17

Line 24, "is" should read --if--.

COLUMN 18

Line 1, "normal." should read --normal--.
Line 6, "(Na)." should read --(Na),--.
Line 48, "if" should read --it--.
Line 50, "ha" should read --has--.
Line 53, "nd" should read --and--.

COLUMN 19

Line 4, "to" should read --so--.
Line 30, "contained" should read --contained in--.
Line 35, "in" should be deleted.

UNITED STATES PATENT AND TRADEMARK OFFICE

CERTIFICATE OF CORRECTION

PATENT NO. : 4,981,766

DATED : January 1, 1991

INVENTOR(S) : TATSUYUKI AOIKE, ET AL.

It is certified that error appears in the above-identified patent and that said Letters Patent is hereby corrected as shown below:

COLUMN 19

Line 36, "at least in" should read --at least--.
Line 37, "contains" should be deleted.
Line 57, "may" should read --may be--.

COLUMN 20

Line 16, "referred" should read --referred to--.

COLUMN 21

Line 33, "C442" should read --C242--.

COLUMN 22

Line 32, "periodical table" should read --periodic table--.
Line 35, "periodical table" should read --periodic table--.

COLUMN 23

Line 12, "more" should be deleted.

COLUMN 25

Line 19, "the." should read --the--.
Line 34, "$IF_7ICl$" should read --$IF_7$, ICl--.

UNITED STATES PATENT AND TRADEMARK OFFICE

CERTIFICATE OF CORRECTION

PATENT NO. : 4,981,766

DATED : January 1, 1991

INVENTOR(S) : TATSUYUKI AOIKE, ET AL.

It is certified that error appears in the above-identified patent and that said Letters Patent is hereby corrected as shown below:

COLUMN 26

Line 7, "silicoharide" should read --silicohydride-- and "$Si_2H$" should read --$Si_2H_6$--.
Line 20, "a" should be deleted.
Line 31, "harides" should read --halides--.
Line 41, "$AsCl_3AsBr_3$," should read --$AsCl_3$, $AsBr_3$,--.
Line 46, "$C_2H_5)_2S$," should read --$(C_2H_5)_2S$,--.
Line 54, "accomplished" should read --is accomplished--.

COLUMN 27

Line 2, "hydrocarbon" should read --hydrocarbons having--.
Line 3, "atoms" (first occurrence) should be deleted.
Line 5, "propane," should read --propane ($C_3H_8$),--.
Line 6, "pentane (Examples" should read --pentane ($C_5H_{12}$). Examples--.
Line 7, "propylene butene-1)," should read --propylene ($C_3H_6$), butene-1 ($C_4H_8$)--.
Line 8, "butene-2, isobutylene" should read --butene-2 ($C_4H_8$), isobutylene ($C_4H_8$)--.
Line 10, "methylacetylene)" should read --methylacetylene ($C_3H_4$).
Line 15, "materials" should read --material--.
Line 51, "$Ge_4H_{10}$." should read --$Ge_4H_{10}$,--.
Line 59, "$GeH_2Br_2$." should read --$GeH_2Br_2$,--.

UNITED STATES PATENT AND TRADEMARK OFFICE

CERTIFICATE OF CORRECTION

PATENT NO. : 4,981,766

DATED : January 1, 1991

INVENTOR(S) : TATSUYUKI AOIKE, ET AL.

It is certified that error appears in the above-identified patent and that said Letters Patent is hereby corrected as shown below:

COLUMN 28

Line 9, "This" should read --This is--.
Line 22, "form an" should read --forming and--.
Line 38, "$CU(C_4N_2O_2)_2$" should read --$Cu(C_4N_2O_2)_2$--.
Line 68, "ytrrium" should read --yttrium--.

COLUMN 29

Line 4, "can" should read --that can--.

COLUMN 30

Line 31, "No-" should read --Non- --.

COLUMN 37

Line 62, "to," should read --to--.

COLUMN 38

Line 5, "bearing balls" should read --ball bearings--.
Line 8, "be" should be deleted.
Line 9, "same" should read --same manner--.
Line 42, "was" should read --were--.

COLUMN 39

Line 23, "$B_2H_6lH_2$" should read --$B_2H_6/H_2$--.

UNITED STATES PATENT AND TRADEMARK OFFICE

CERTIFICATE OF CORRECTION

PATENT NO. : 4,981,766

DATED : January 1, 1991

INVENTOR(S) : TATSUYUKI AOIKE, ET AL.

It is certified that error appears in the above-identified patent and that said Letters Patent is hereby corrected as shown below:

COLUMN 40

Line 24, "No gas" should read --NO gas--.
Line 39, "coarse . image" should read --coarse image--.
Line 55, "$B_2H_6lH_2$" should read --$B_2H_6/H_2$--.

COLUMN 41

Line 37, "$B_2H_6lH_2$" should read --$B_2H_6/H_2$--.

COLUMN 42

Line 5, "using gas" should read --using $B_2H_6/H_2$ gas--.

COLUMN 43

Line 7, "$B_2H_6lH_2$" should read --$B_2H_6/H_2$--.

COLUMN 44

Line 20, "Bphd $2H_6/H_2$" should read --$B_2H_6/H_2$--.

COLUMN 45

Line 50, "bearing balls" should read --ball bearings--.
Line 54, "same" should read --same manner--.

COLUMN 46

Line 15, "No" should read --NO--.
Line 46, "$B_2H_6lH_2$" should read --$B_2H_6/H_2$--.

UNITED STATES PATENT AND TRADEMARK OFFICE

CERTIFICATE OF CORRECTION

PATENT NO. : 4,981,766

DATED : January 1, 1991

INVENTOR(S) : TATSUYUKI AOIKE, ET AL.

It is certified that error appears in the above-identified patent and that said Letters Patent is hereby corrected as shown below:

COLUMN 48

Line 24, "for" should read --than--.
Line 28, "Electrophotography" should read --electrophotography--.
Line 41, "to" should be deleted.

COLUMN 49

Line 29, "$pH_3/H_2$" should read --$PH_3/H_2$--.

COLUMN 51

Line 39, "improve" should read --improvement--.
Line 52, "to," should read --to--.
Line 63, "bearing balls" should read --ball bearings--.
Line 67, "same" should read --same manner--.

COLUMN 52

Line 7, "the" should read --under the--.
Line 16, "B gas" should read --$B_2H_6$ gas--.

COLUMN 53

Line 1, "using gas" should read --using $B_2H_6/H_2$ gas--.
Line 31, "C gas" should read --$C_2H_2$ gas--.
Line 50, "us" should read --use--.

UNITED STATES PATENT AND TRADEMARK OFFICE

CERTIFICATE OF CORRECTION

PATENT NO. : 4,981,766

DATED : January 1, 1991

INVENTOR(S) : TATSUYUKI AOIKE, ET AL.

It is certified that error appears in the above-identified patent and that said Letters Patent is hereby corrected as shown below:

COLUMN 54

Line 66, "was . obtained" should read --was obtained--.

COLUMN 57

Line 8, "electro photography" should read --electrophotography--.
Line 40, "Electrophotography" should read --electrophotography--.
Line 55, "for" should read --of--.

COLUMN 59

Line 37, "replating" should read --replacing--.

COLUMN 60

Line 67, "to," should read --to--.

COLUMN 61

Line 10, "bearing balls" should read --ball bearings--.
Line 13, "be" should be deleted.
Line 14, "same" should read --same manner--.
Line 32, "No gas" should read --NO gas--.

UNITED STATES PATENT AND TRADEMARK OFFICE

CERTIFICATE OF CORRECTION

PATENT NO. : 4,981,766

DATED : January 1, 1991

INVENTOR(S) : TATSUYUKI AOIKE, ET AL.

It is certified that error appears in the above-identified patent and that said Letters Patent is hereby corrected as shown below:

COLUMN 63

Lines 17-19, "by further using $C_2H_2$ gas, $PF_3/H_2$ gas and $H_2S$ gas from a not was prepared in the same manner as in Example 126" should be deleted.

COLUMN 66

Line 11, "Comparative Example 5" should read --¶ Comparative Example 5--.
Line 17, "electro photography" should read --electrophotography--.
Line 48, "Electrophotography" should read --electrophotography--.

COLUMN 68

Line 41, "replacing cylinder" should read --replacing the NO gas cylinder with a $NH_3$ gas (99.999% purity) cylinder--.
Line 63,"(99199%" should read --(99.999%--.

COLUMN 69

Line 22, "was" should read --was prepared--.

COLUMN 70

Line 13, "to," should read --to--.
Line 25, "bearing balls" should read --ball bearings--.

UNITED STATES PATENT AND TRADEMARK OFFICE

CERTIFICATE OF CORRECTION

PATENT NO. : 4,981,766

DATED : January 1, 1991

INVENTOR(S) : TATSUYUKI AOIKE, ET AL.

It is certified that error appears in the above-identified patent and that said Letters Patent is hereby corrected as shown below:

COLUMN 70

Line 28, "be" should be deleted.
Line 29, "same" should read --same manner--.

COLUMN 72

Line 25, "$C_2H_2$ and $SnH_4$" should read --$C_2H_2$ gas, $PH_3/H_2$ and $SnH_4$--.

COLUMN 78

Line 25, "wa" should read --was--.
Line 46, "Electrophotography" should read --electrophotography--.

COLUMN 79

Line 44, "purity," should be deleted.
Line 45, "hereinafter simply referred to as $PH_3/H_2$" should be deleted.

COLUMN 80

Line 67, "99199%" should read --99.99%--.
Line 68, "$PH_3/H_3$" should read --$PH_3/H_2$--.

UNITED STATES PATENT AND TRADEMARK OFFICE

CERTIFICATE OF CORRECTION

PATENT NO. : 4,981,766

DATED : January 1, 1991

INVENTOR(S) : TATSUYUKI AOIKE, ET AL.

It is certified that error appears in the above-identified patent and that said Letters Patent is hereby corrected as shown below:

COLUMN 82

Line 20, "to," should read --to--.
Line 31, "bearing balls" should read --ball bearings--.
Line 34, "be" should be deleted.
Line 35, "same" should read --same manner--.
Line 61, "Example 236." should read --Example 236,--.

COLUMN 87

Line 17, Close up right margin.
Line 18, Close up left margin.
Line 37, "formed" should read --formed by--.
Line 58, "was" should read --were--.

COLUMN 89

Line 3, "istic" should read --istics--.

COLUMN 90

Line 26, "$SiV_4$ gas" should read --$SiF_4$--.
Line 50, "Table 298" should read --Table 293--.

COLUMN 91

Line 48, "(99.99 a% purity)" should read --(99.99% purity)--.

UNITED STATES PATENT AND TRADEMARK OFFICE

CERTIFICATE OF CORRECTION

PATENT NO. : 4,981,766

DATED : January 1, 1991

INVENTOR(S) : TATSUYUKI AOIKE, ET AL.

It is certified that error appears in the above-identified patent and that said Letters Patent is hereby corrected as shown below:

COLUMN 92

Line 67, "to," should read --to--.

COLUMN 93

Line 10, "bearing balls" should read --ball bearings--.
Line 13, "be" should be deleted.
Line 14, "same" should read --same manner--.
Line 21, "$C_2h_2$ gas" should read --$C_2H_2$ gas--.
Line 33, "$Cu(C_4H_7N_2O_2)$He gas," should read --$Cu(C_4H_7N_2O_2)_2$/He gas,--.

COLUMN 94

Line 41, "nor" should read --not--.

COLUMN 95

Line 23, "$C_4$" should read --$CH_4$-- and "$C_2H_2$ 2" should read --$C_2H_2$--.

COLUMN 96

Line 9, "327" should read --327.--.

COLUMN 99

Line 19, "Cannon Inc." should read --Canon Inc.--.

UNITED STATES PATENT AND TRADEMARK OFFICE

CERTIFICATE OF CORRECTION

PATENT NO. : 4,981,766

DATED : January 1, 1991

INVENTOR(S) : TATSUYUKI AOIKE, ET AL.

It is certified that error appears in the above-identified patent and that said Letters Patent is hereby corrected as shown below:

COLUMN 102

Line 13, "is" should read --are--.

COLUMN 143

TABLE 65, "$PH_3$ (against $SiH_4$)" should read
--$PH_3$ (against $SiH_4$) 30 ppm--.

COLUMN 157

TABLE 88, "$SiH_4$ 50" should read --$SiH_4$ 20--.

COLUMN 177

TABLE 111, "$C_2H_2$ 1→6*" should read --$C_2H_2$ 1→6**--.

COLUMN 205

TABLE 145, "$C_2H_2$ 10→200*" should read
--$C_2H_2$ 10→20*--.

COLUMN 229

TABLE 168, "(UL-side: 0.01 μm)
NO 10
30→10**"

should read --(UL-side: 0.01 μm) 30→10**
NO 10--.

UNITED STATES PATENT AND TRADEMARK OFFICE

CERTIFICATE OF CORRECTION

PATENT NO. : 4,981,766

DATED : January 1, 1991

INVENTOR(S) : TATSUYUKI AOIKE, ET AL.

It is certified that error appears in the above-identified patent and that said Letters Patent is hereby corrected as shown below:

COLUMN 317

TABLE 268, "10→0.3 ppm **"

should read --10→0.3 ppm**--.

COLUMN 319

TABLE 270, "10→100 ppm *"

should read --10→100 ppm*--.

COLUMN 321

| | | | |
|---|---|---|---|
| TABLE 271, | "5→20-0* " | should read | --5→200*--; |
| | "200→30-** " | should read | --200→30**--; |
| | "30→10-** " | should read | --30→10**--; |
| | "10→100-** " | should read | --10→100**--; |
| | "15→3-0 * " | should read | --15→30*--; |
| | "100→50-** " | should read | --100→50**--. |

UNITED STATES PATENT AND TRADEMARK OFFICE

CERTIFICATE OF CORRECTION

PATENT NO. : 4,981,766

DATED : January 1, 1991

INVENTOR(S) : TATSUYUKI AOIKE, ET AL.

It is certified that error appears in the above-identified patent and that said Letters Patent is hereby corrected as shown below:

COLUMN 322

TABLE 271, "

| | | | | |
|---|---|---|---|---|
| | 300 | 10 | 0.35 | 3 |
| 300 | 20 | 0.5 | 5 | |
| 300 | 15 | 0.4 | 20 | |
| 300 | 10 | 0.4 | 0.5 " | |

should read --

| | | | |
|---|---|---|---|
| 300 | 10 | 0.35 | 3 |
| 300 | 20 | 0.5 | 5 |
| 300 | 15 | 0.4 | 20 |
| 300 | 10 | 0.4 | 0.5 --. |

COLUMN 339

TABLE 287, "$H_2$ 500" should read --$H_2$ 300--.

COLUMN 342

TABLE 290, "250 10 0.3 0.02" should read
--250 10 0.4 3 --.

COLUMN 347

TABLE 298, "$PH_3$(against $SiH_4$) 50 ppm
$SiH_4$ 50 "

should read --$PH_3$(against $SiH_4$) 50 ppm
$SiF_4$ 5
$SiH_4$ 50 --.

UNITED STATES PATENT AND TRADEMARK OFFICE

CERTIFICATE OF CORRECTION

PATENT NO. : 4,981,766

DATED : January 1, 1991

INVENTOR(S) : TATSUYUKI AOIKE, ET AL.

It is certified that error appears in the above-identified patent and that said Letters Patent is hereby corrected as shown below:

COLUMN 353

TABLE 304, "2nd layer region " $SiH_4$ 150
$H_2$ 300 should read

--2nd layer region $SiH_4$ 150
$H_2$ 300 300 10 0.4 20 --.

COLUMN 360

TABLE 313, "

| | | | | |
|---|---|---|---|---|
| | 250 | 5 | 0.4 | 0.2 |
| | 250 | 10 | 0.4 | 3 |
| | 300 | 15 | 0.4 | 25 |
| 300 | 5 | 0.2 | 8 | |
| | 300 | 5 | 0.4 | 0.7 " |

should read --

| | | | | |
|---|---|---|---|---|
| 250 | 5 | 0.4 | 0.2 | |
| 250 | 10 | 0.4 | 3 | |
| 300 | 15 | 0.4 | 25 | |
| 300 | 5 | 0.2 | 8 | |
| 300 | 5 | 0.4 | 0.7 | --. |

UNITED STATES PATENT AND TRADEMARK OFFICE

CERTIFICATE OF CORRECTION

PATENT NO. : 4,981,766

DATED : January 1, 1991

INVENTOR(S) : TATSUYUKI AOIKE, ET AL.

It is certified that error appears in the above-identified patent and that said Letters Patent is hereby corrected as shown below:

COLUMN 361

TABLE 316, "$SiH_4$ 10→200*" should read --$SiH_4$ 10→100*--.

COLUMN 368

TABLE 321, "145 0.02" should read --0.02--.

COLUMN 395

Line 60, "of" should read --on--.

COLUMN 398

Line 1, "claim 3," should read --claim 13,--.
Line 13, "yttrium," should read --from the group consisting of magnesium, copper, sodium, yttrium,--.
Line 42, "from 9.5 X $10^5$" should read --from 9 X $10^5$--.

Signed and Sealed this

Fourth Day of June, 1996

Bruce Lehman

*Attest:*

BRUCE LEHMAN

*Attesting Officer*

*Commissioner of Patents and Trademarks*